United States Patent [19]

Rowan

[11] Patent Number: 5,020,411

[45] Date of Patent: Jun. 4, 1991

[54] MOBILE ASSAULT LOGISTIC KINETMATIC ENGAGEMENT DEVICE

[76] Inventor: Larry Rowan, 3440½ Caroline Ave., Culver, Calif. 90230

[21] Appl. No.: 277,122

[22] Filed: Mar. 6, 1989

[51] Int. Cl.[5] ..... F41B 15/00

[52] U.S. Cl. ..... 89/1.11; 376/319; 60/203.1

[58] Field of Search ..... 89/1.11, 1.1, 36.15; 244/159, 172, 62, 63; 60/202, 203.1; 376/319

[56] References Cited

U.S. PATENT DOCUMENTS

| | | | |
|---|---|---|---|
| 1,274,721 | 8/1918 | Krzan | 89/36.15 |
| 1,505,168 | 8/1924 | Sparhawk | 89/36.15 |
| 3,217,097 | 11/1965 | Pauli et al. | 89/36.15 |
| 4,816,211 | 3/1989 | Parker et al. | 376/354 |

FOREIGN PATENT DOCUMENTS

| | | | |
|---|---|---|---|
| 2062820 | 5/1981 | United Kingdom | 89/36.15 |

OTHER PUBLICATIONS

*Space/Aeronautics, "How close is a practical plasma rocket", Mar. 1960, pp. 50–54, by Stehling.*

*Primary Examiner*—Charles T. Jordan
*Assistant Examiner*—Michael Carone
*Attorney, Agent, or Firm*—Malke Leah Bas Meyer; Itzhak Ben Shlomo

[57] ABSTRACT

A portable-mobile-self propelled weapons plateform. Said plateform being propelled by an automated array of plasma engines coupled to a plasma source, energy source and further being coupled to energy weapon systems.

12 Claims, 226 Drawing Sheets

FIG. 3
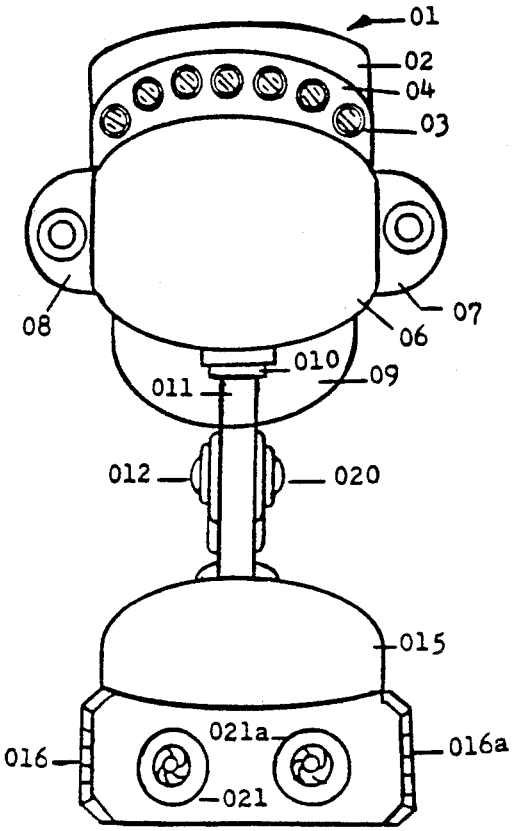
FIG. 4
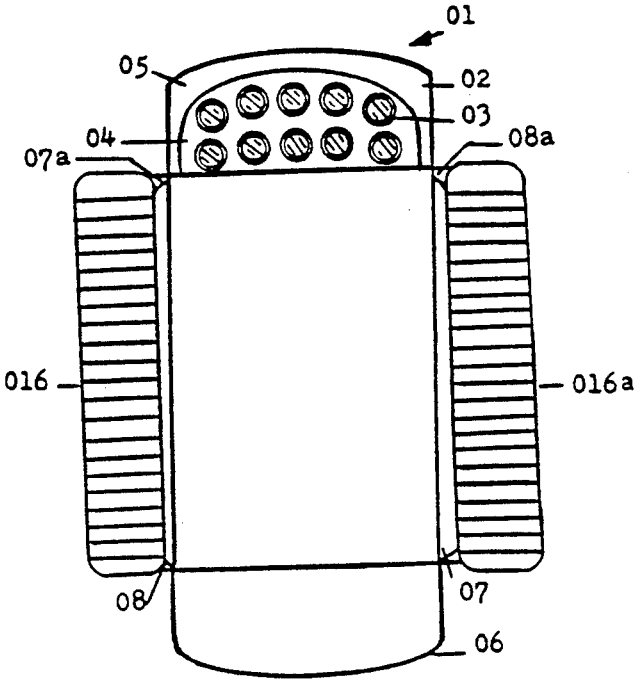
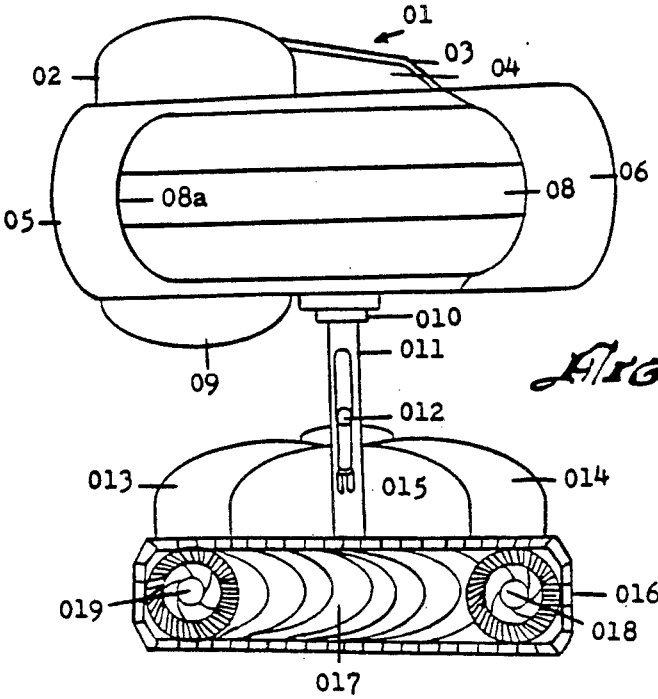
FIG. 5

FIG. 6
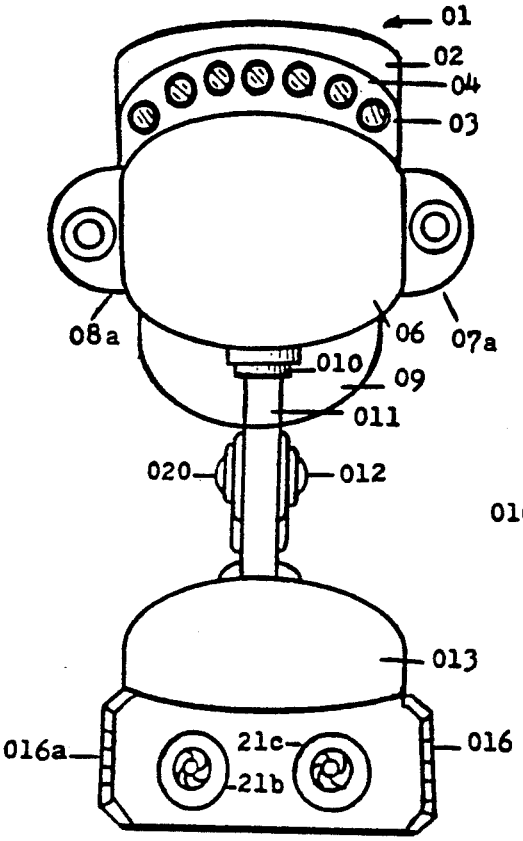
FIG. 7
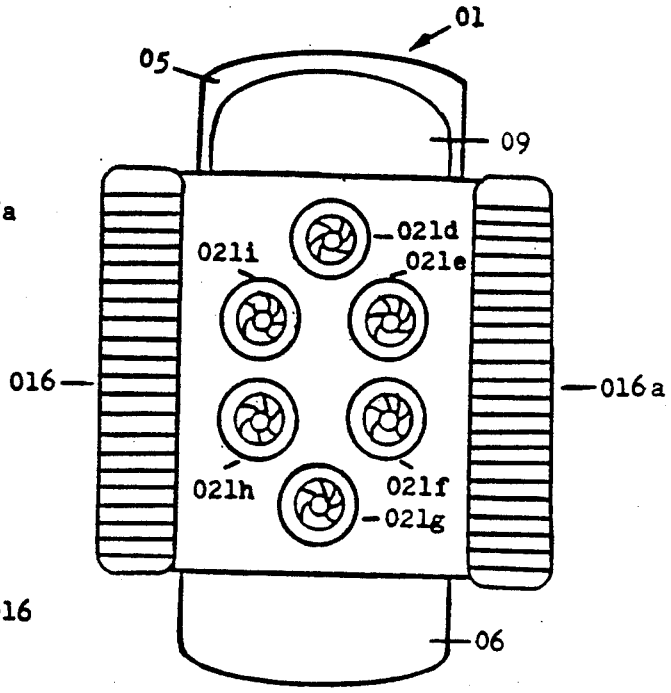
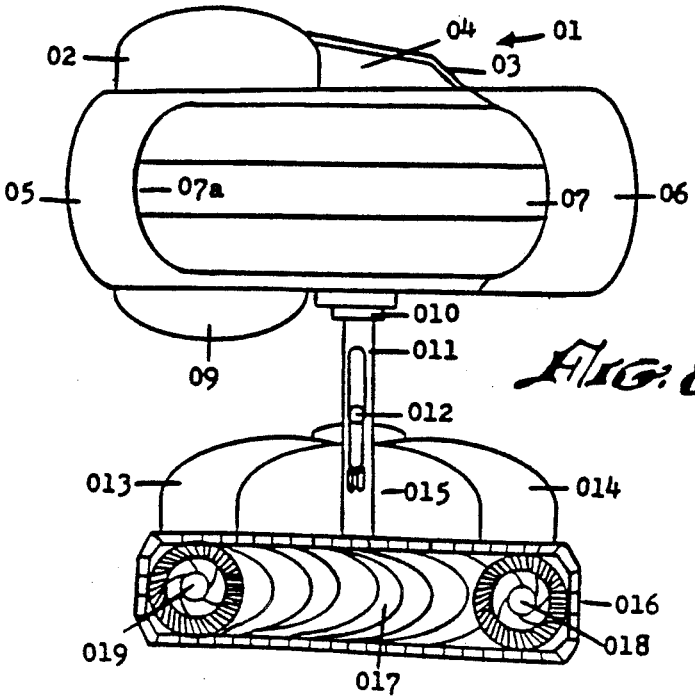
FIG. 8

TYPICAL PHASE DIAGRAM FOR SILICON NITRIDE WITH RARE EARTH ADDITIVES 25
26
27
28
29
30
31
32
33
34
34a
34b
34c
34d
35
35a
35b
35c
35d
36
36a
36b
36c
36d
25a
26a
27a
28a
29a
30a
31a
32a
33a
X
A
Z
C
Y
N
B
25 - 36d

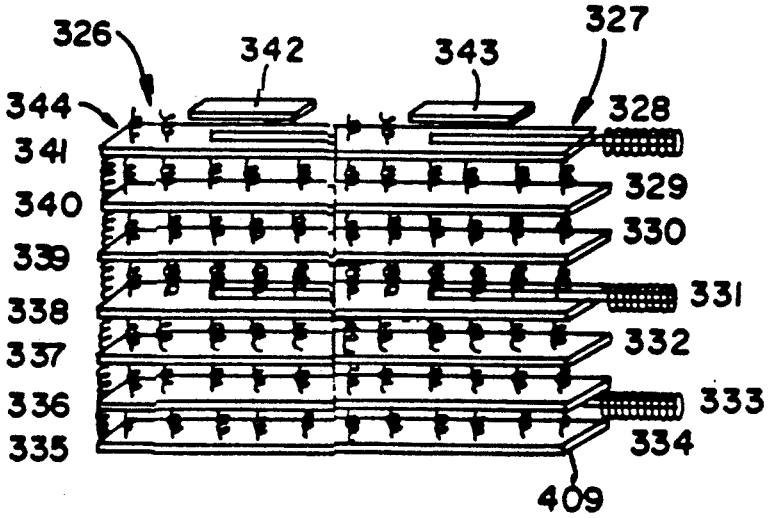
FIG. 24a
FIG. 24b
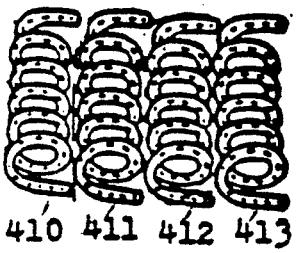

FIG. 3.1d
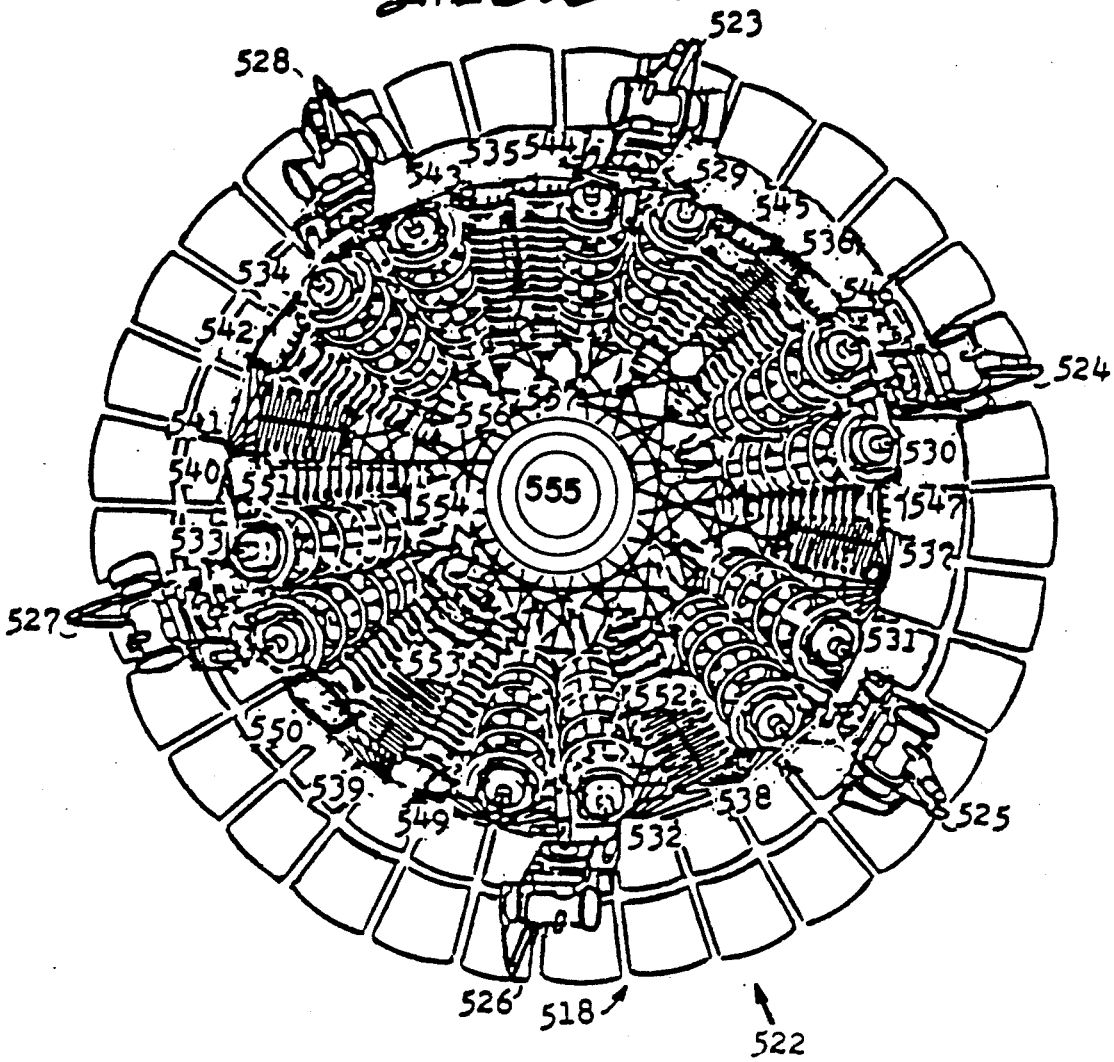

1
2
3
4
5
6
7
8
9
10
11
12
13
14
15
16
16a
17
18
19
20
12345
678910
dbcde
+Vcc
Vcc
GND
Vout-k2
1-k1Vin GND
GND
3000
1
2
3
4
5
6
7
8
9
10
11
12
13
14
15
16
17
18
19
20
21
22
23
24
25
26
27
28

1107
1108'
1109'
1110'
1099'-1100'
1101'
1102'
1103'
1104'
1105
1106'
62

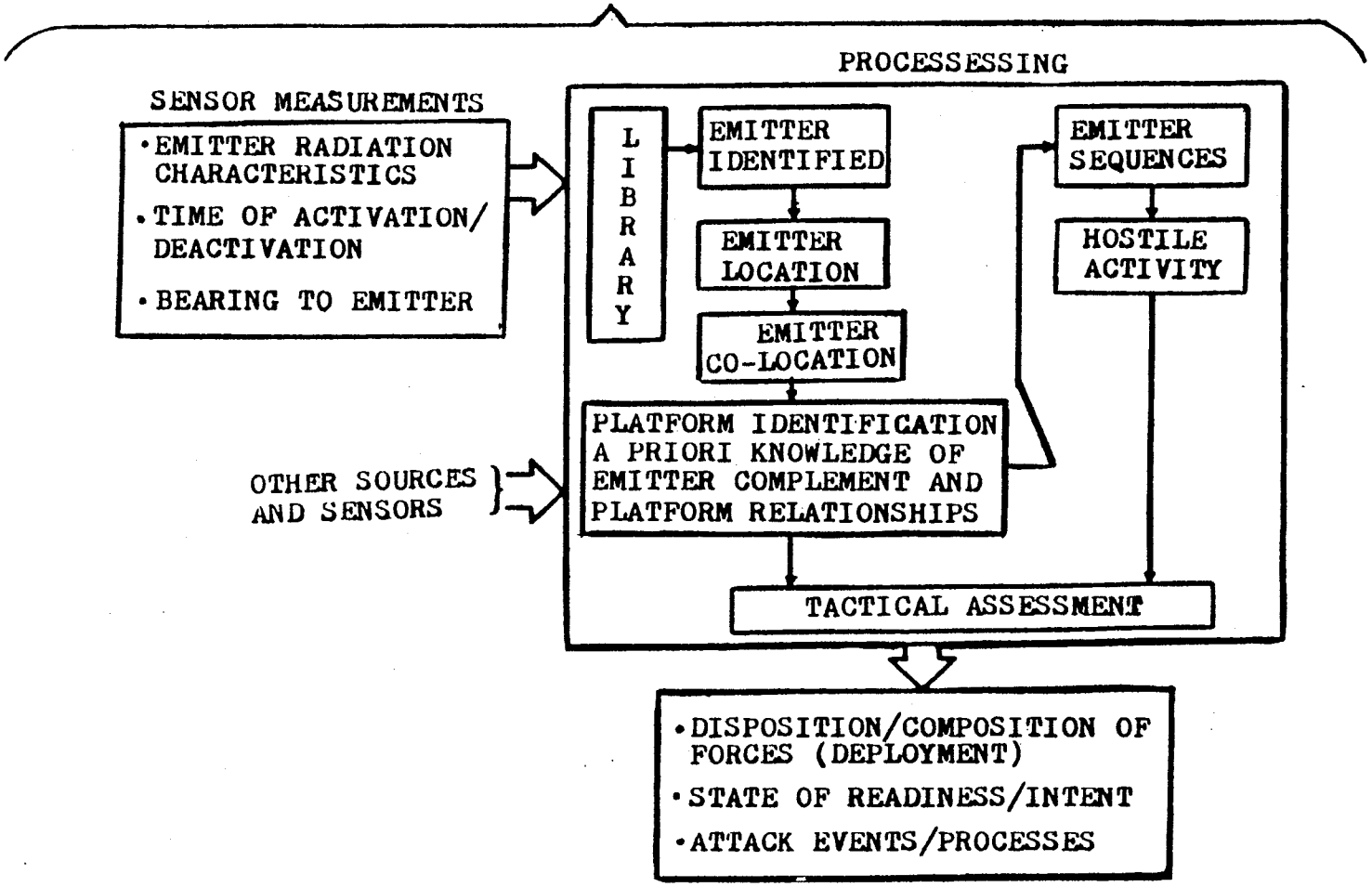
FIG. 48c"

FIG. 51"
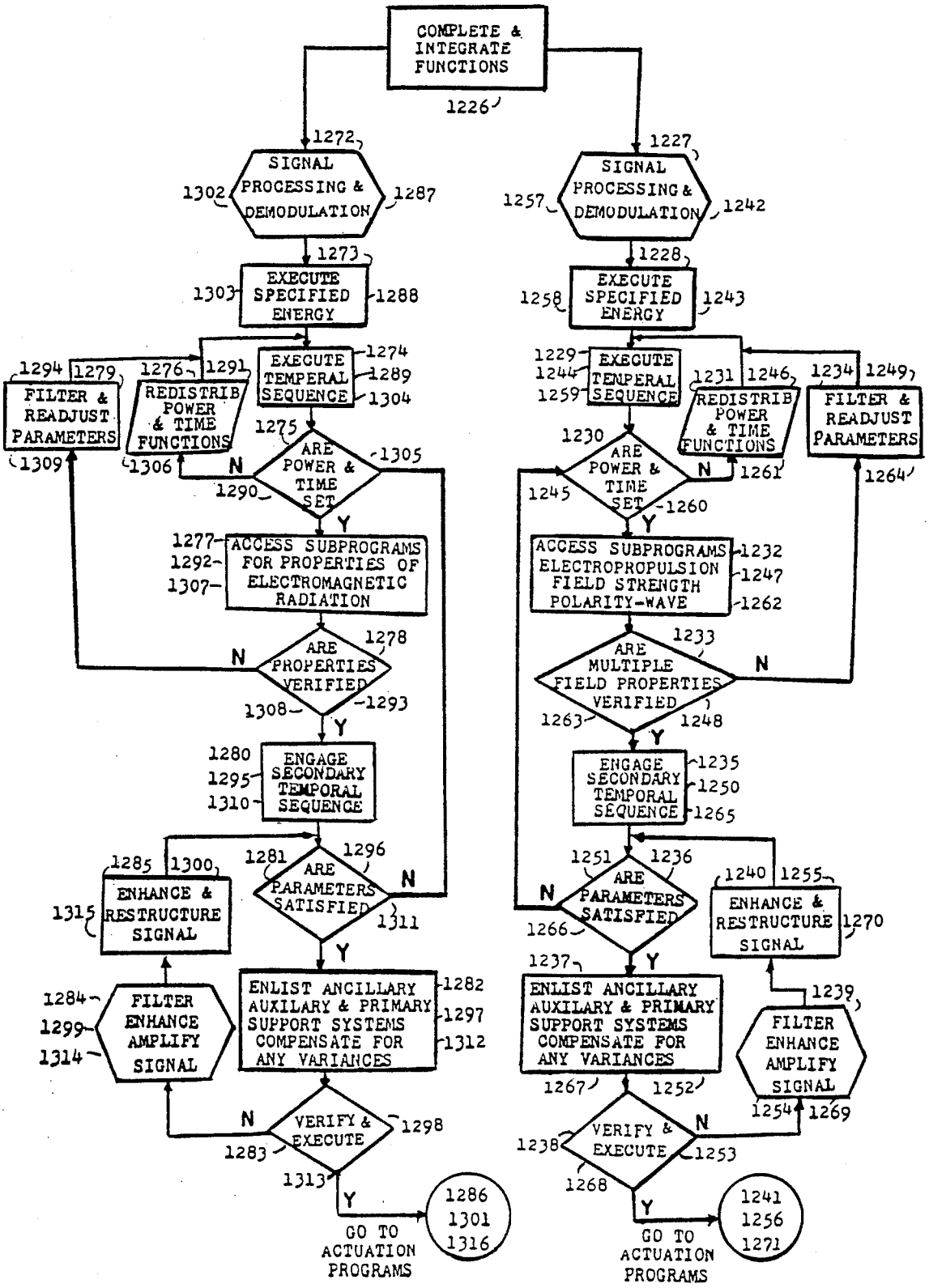

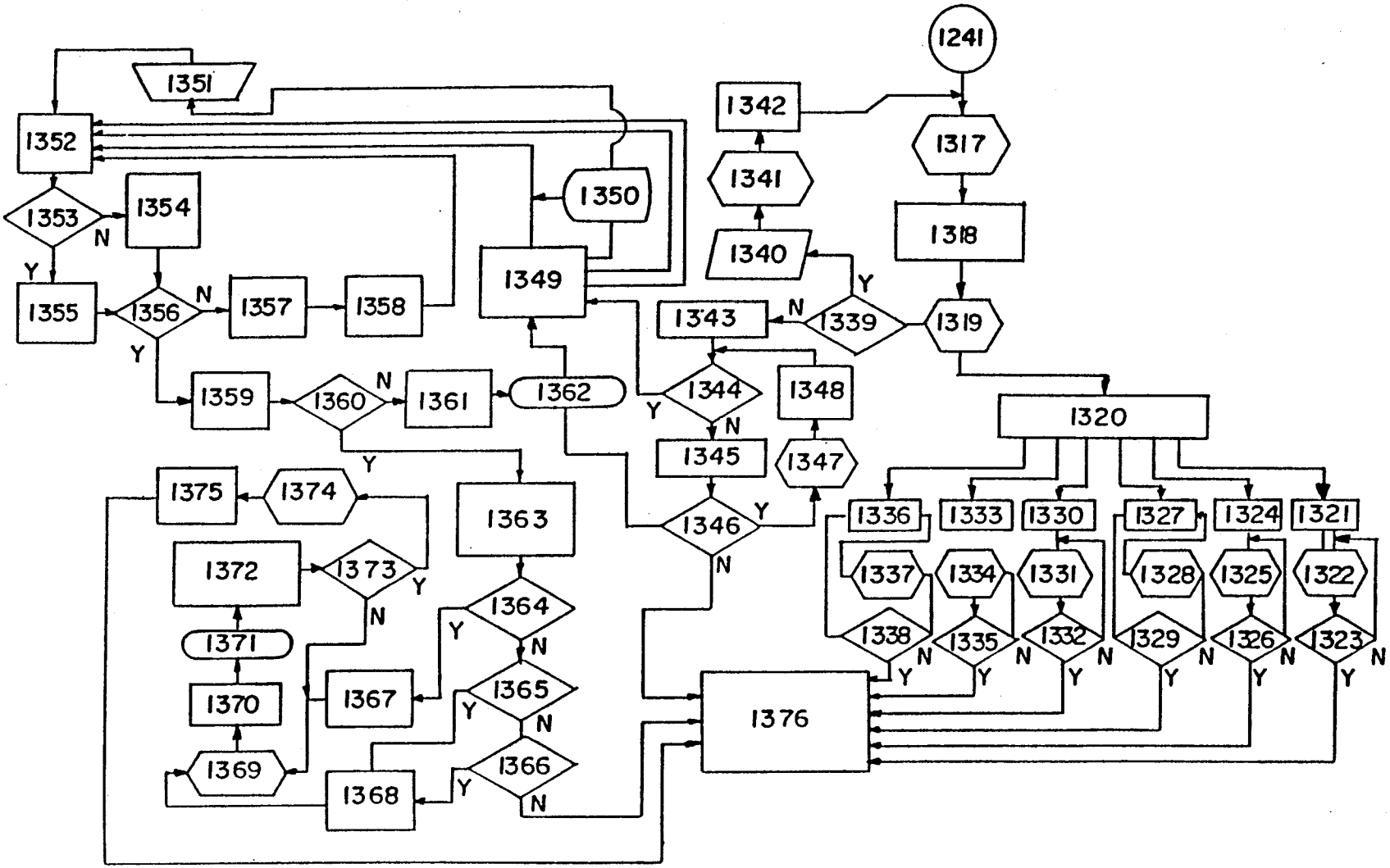
FIG. 52"

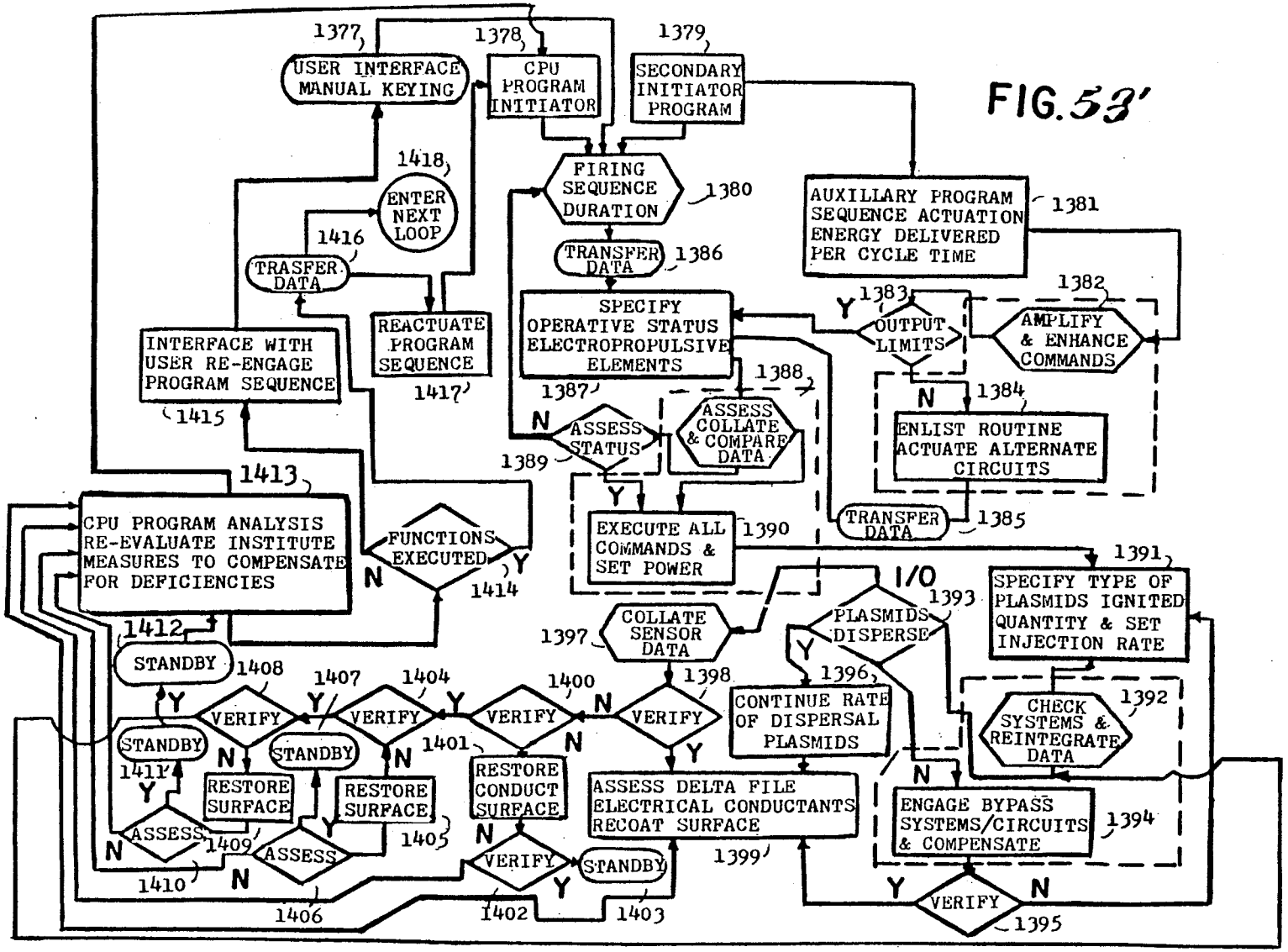
FIG. 53'
AUXILLARY PROGRAM SEQUENCE ACTUATION ENERGY DELIVERED PER CYCLE TIME
1381
AMPLIFY & ENHANCE COMMANDS
1382
OUTPUT LIMITS
1383
ENLIST ROUTINE ACTUATE ALTERNATE CIRCUITS
1384
TRANSFER DATA
1385
SPECIFY TYPE OF PLASMIDS IGNITED QUANTITY & SET INJECTION RATE
1391
CHECK SYSTEMS & REINTEGRATE DATA
1392
ENGAGE BYPASS SYSTEMS/CIRCUITS & COMPENSATE
1394
VERIFY
1395
I/O
PLASMIDS DISPERSE
1393
CONTINUE RATE OF DISPERSAL PLASMIDS
1396
ASSESS DELTA FILE ELECTRICAL CONDUCTANTS RECOAT SURFACE
1399
SECONDARY INITIATOR PROGRAM
1379
FIRING SEQUENCE DURATION
1380
TRANSFER DATA
1386
SPECIFY OPERATIVE STATUS ELECTROPROPULSIVE ELEMENTS
1387
ASSESS & COLLATE & COMPARE DATA
1388
ASSESS STATUS
1389
EXECUTE ALL COMMANDS & SET POWER
1390
COLLATE SENSOR DATA
1397
VERIFY
1398
VERIFY
1400
VERIFY
1404
VERIFY
1407
VERIFY
1408
STANDBY
1403
VERIFY
1402
RESTORE CONDUCT SURFACE
1401
RESTORE SURFACE
1405
ASSESS
1406
STANDBY
1409
RESTORE SURFACE
1410
ASSESS
1411
STANDBY
1412
CPU PROGRAM INITIATOR
1378
USER INTERFACE MANUAL KEYING
1377
ENTER NEXT LOOP
1418
TRASFER DATA
1416
REACTUATE PROGRAM SEQUENCE
1417
INTERFACE WITH USER RE-ENGAGE PROGRAM SEQUENCE
1415
FUNCTIONS EXECUTED
1414
CPU PROGRAM ANALYSIS RE-EVALUATE INSTITUTE MEASURES TO COMPENSATE FOR DEFICIENCIES
1413
Y
N

NOISE PROPERTIES

Gaussian Noise

— Probability Distribution Of Noise Amplitudes Is Normal $$P(n) = \frac{1}{\sqrt{2\pi\sigma_n^2}}\, e^{-\left(\frac{n}{2\sigma_n}\right)^2}$$

FIG. 54d

THE AMBIGUITY FUNCTION

- Consider The Effects Of A Frequency Shift In Either The Signal Or The Replica
- Let the Signal Be Shifted In Frequency $\omega$ And $E(t)\cos\phi(t) = \mathrm{Re}\left\{E(t)\,e^{j\phi(t)}\right\}$ $S(t) = E(t)\,e^{j\phi(t)}$ And $S'(t) = E(t)\,e^{j[\phi(t)+\omega t]}$ $$R_{SS'}(\tau) = \int S'(t)\,S^*(t+\tau)\,d\tau = \int S(t)S^*(t+\tau)\,e^{j\omega t}dt$$

$$\psi(\tau,\omega) = \int S(t)\,S^*(t+\tau)\,e^{j\omega t}dt = \text{The Ambiguity Function}$$

$$E\left\{\psi\right\} = \sigma_S^2\ T\,\rho_{SS}(\tau)\,\frac{1}{T}\int_{-\frac{T}{2}}^{+\frac{T}{2}} e^{j\omega t}\,dt$$

$$= (\sigma_S^2\,T)\,\rho_{SS}(\tau)\,\frac{\sin(\pi\Delta f T)}{(\pi\Delta f T)}$$

$$E\left\{\psi\right\} = 0,\ \text{if } \Delta f T = 1, 2, 3\ldots$$

- Consider A Low-Pass White Signal Spectrum Of Bandwidth W $$\text{Then } \rho(\tau) = \frac{\sin 2\pi W\tau}{2\pi W\tau}$$

$$\psi(\tau,\Delta f) = \frac{\sin 2\pi W\tau}{2\pi W\tau}\cdot\frac{\sin\pi\Delta f T}{\pi\Delta f T}$$

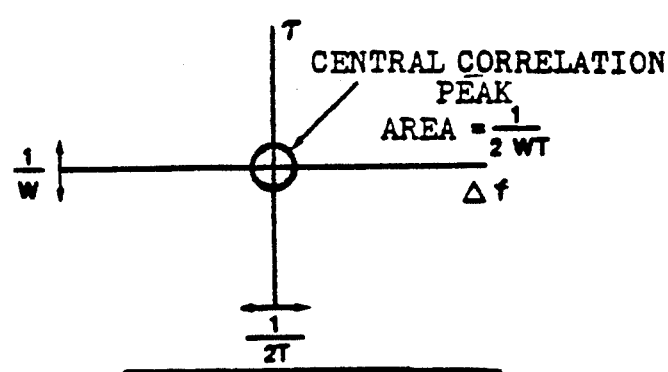

THE AMBIGUITY PLANE

COHERENT DETECTOR

Let $x(t) = S(t) + n(t)$ $$R_{XS}(t) = \frac{1}{2WT} \sum_{i=1}^{2WT} X_i(t) S_i = \frac{1}{2WT} \sum_{i=1}^{2WT} [S_i(t) + n_i(t)] S_i$$

$$E\left[R_{XS}(t)\right] = R_{SS}(t)$$

$$\left(\frac{S}{N}\right)_0 = 2\,WT\,(S/N)_i$$

Gain $= 2\,WT$

Output Pulse Width $= \frac{1}{W}$

FIG. 54f

MULTI-ELEMENT LINE ARRAY

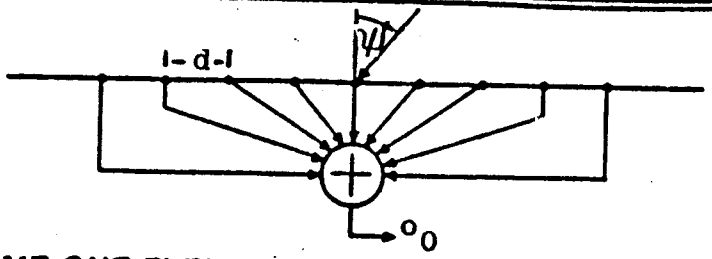

- ASSUME ONE ELEMENT AT THE ORIGIN AND M ELEMENTS EQUALLY SPACED ON EACH SIDE FOR A TOTAL OF N = 2M+1 ELEMENTS $$e_0 = \underbrace{\left[\sum_{n=-M}^{+M} \exp\left(j\frac{2\pi nd}{\lambda}\sin\psi\right)\right]}_{\text{ANGULAR FUNCTION}} \underbrace{\exp\ (jwt)}_{\text{TIME FUNCTION}}$$

- THE ANGULAR AMPLITUDE RESPONSE IS CALLED THE <u>PATTERN FUNCTION</u>
- PATTERN FUNCTION = $G(\psi) = \sum_{n=-M}^{+M} \exp\left(j\frac{2\pi nd}{\lambda}\sin\psi\right)$

FIG. 54g

PATTERN FUNCTION: FOR A LINE ARRAY OF EQUALLY SPACED, EQUAL GAIN ELEMENTS, THE PATTERN FUNCTION HAS A CLOSED FORM SOLUTION $$G(\psi) = \sum_{n=-m}^{+m} \exp\left(j\frac{2\pi nd}{\lambda}\sin\psi\right) j = \frac{j\sin\left(\frac{\pi Nd}{\lambda}\sin\psi\right)}{\sin\left(\frac{\pi d}{\lambda}\sin\psi\right)}$$

FOR CONVENIENCE, DEFINE A NEW VARIABLE $u = (\sin\psi)/\lambda$, AND AN EFFECTIVE ARRAY LENGTH $L = Nd$ $$G(u) = \frac{\sin(\pi Lu)}{\sin(\pi du)}$$

THE VARIABLE u HAS MEANING ONLY OVER THE RANGE $-1/\lambda \leq u \leq 1/\lambda$
HOWEVER, IT IS INSTRUCTIVE TO PLOT G(u) OVER A WIDER RANGE

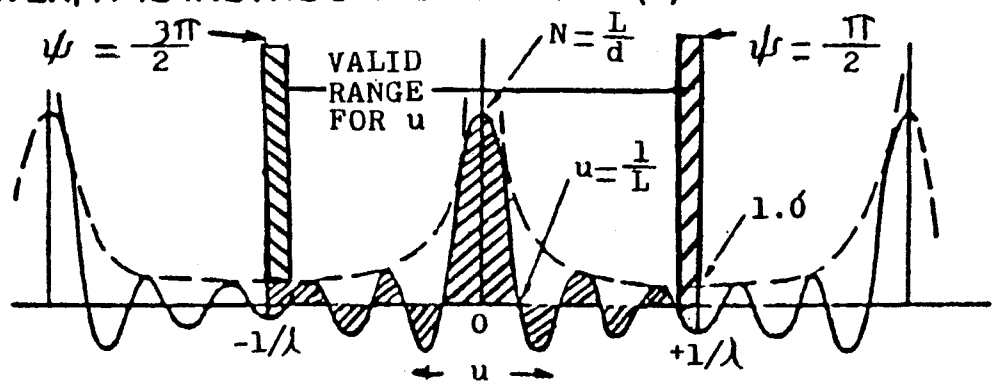

G(u) FOR $d = \lambda/2$

FIG. 54h

FULL WAVE LINEAR DETECTION

- Output Signal-To-Noise For Gaussian Signals and Noise $$(S/N)_0 = \frac{4\,WT}{(\pi - 2)} \left\{ 2 + (S/N)_I - 2\left[1 + (S/N)_I\right]^{1/2} \right\}$$

PASSIVE SYSTEM PERFORMANCE

TYPICAL PASSIVE SYSTEM

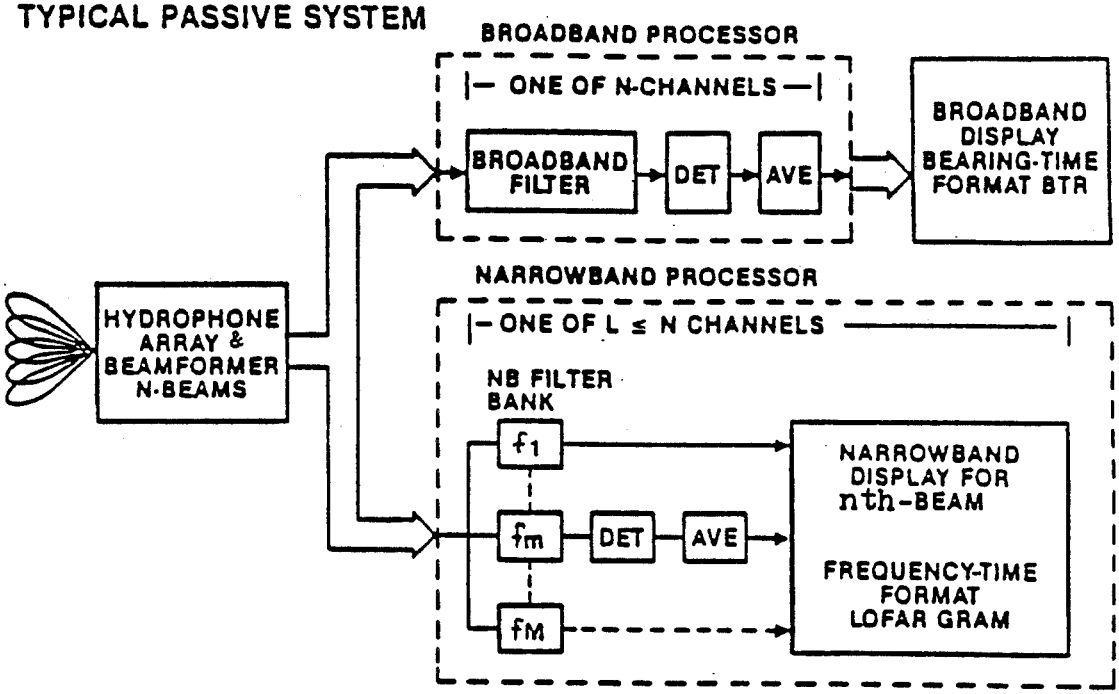

ACTIVE SYSTEM PERFORMANCE

ACTIVE TARGET STRENGTH: RATIO OF REFLECTED INTENSITY ONE METER FROM THE TARGET TO THE INCIDENT INTENSITY

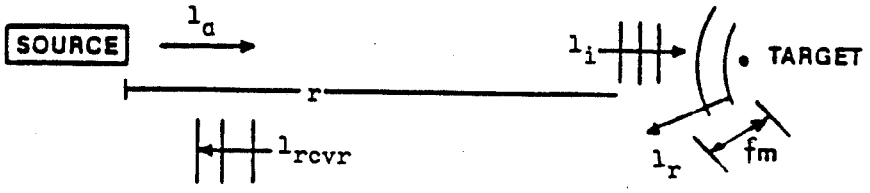

$$I_i = I_a/r^2, \quad I_r = t_s I_i$$

$$I_{rcvr} = I_r/r^2 = I_s I_a/r^4$$

IN DECIBEL NOTATION:

$$\text{ECHO LEVEL} = \underbrace{10\,\text{LOG}(I_{rcvr}/I_{ref})}_{\text{EL}} = \underbrace{10\,\text{LOG}(I_a/I_{ref})}_{\text{SL}} + \underbrace{10\,\text{LOG}(t_s)}_{\text{TS}} - \underbrace{40\,\text{LOG}(r_{meters})}_{\text{2TL}}$$

THREE-DIMENSIONAL BEAM PATTERN

FIG. 58a
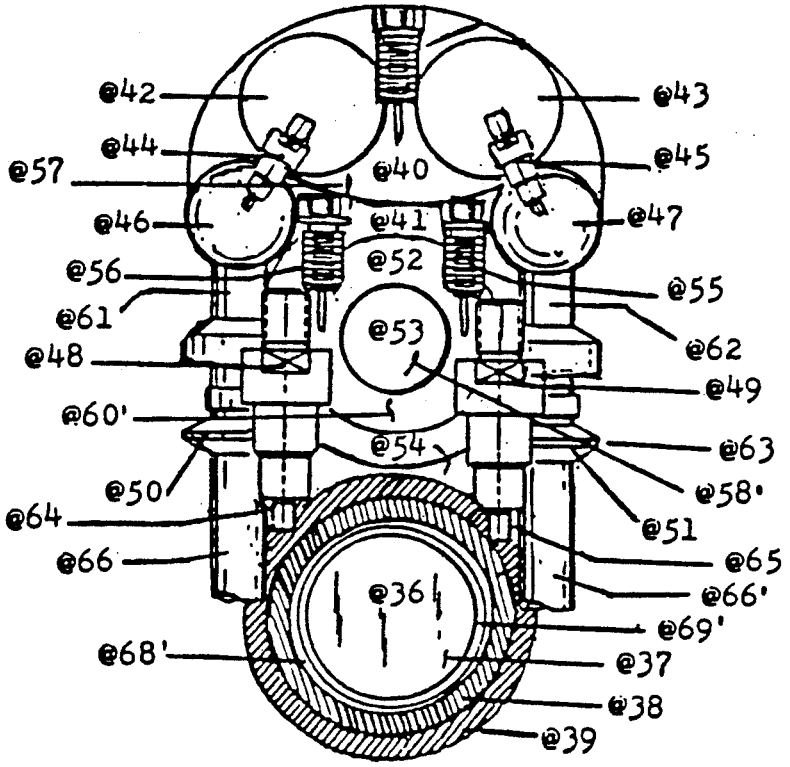
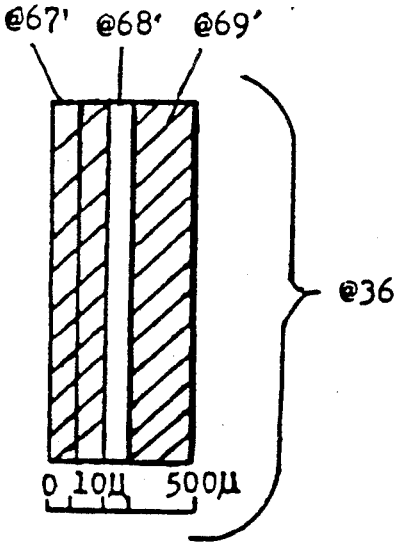
FIG. 58a'

D

C

MODIFIED CLOSED LOOP SERVOMECHANISM

COMPENSATION USING OPPOSING ENVIRONMENTAL INPUTS

FIG. 81b
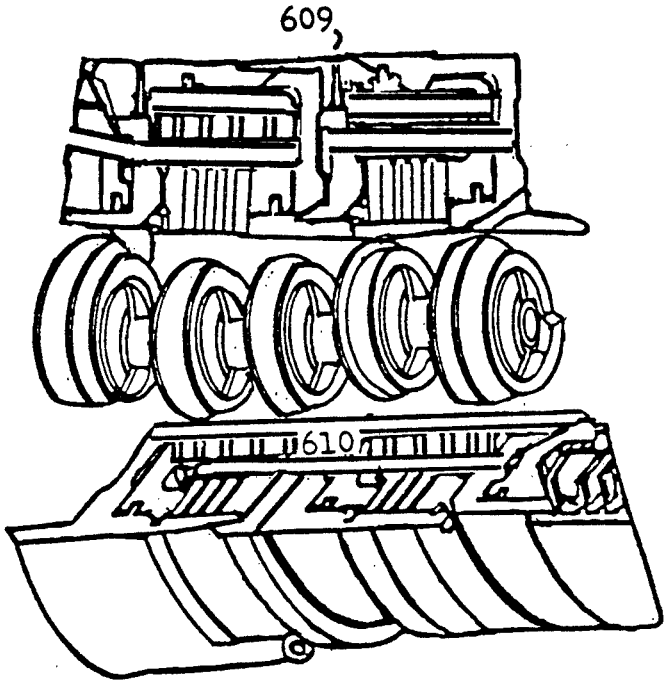
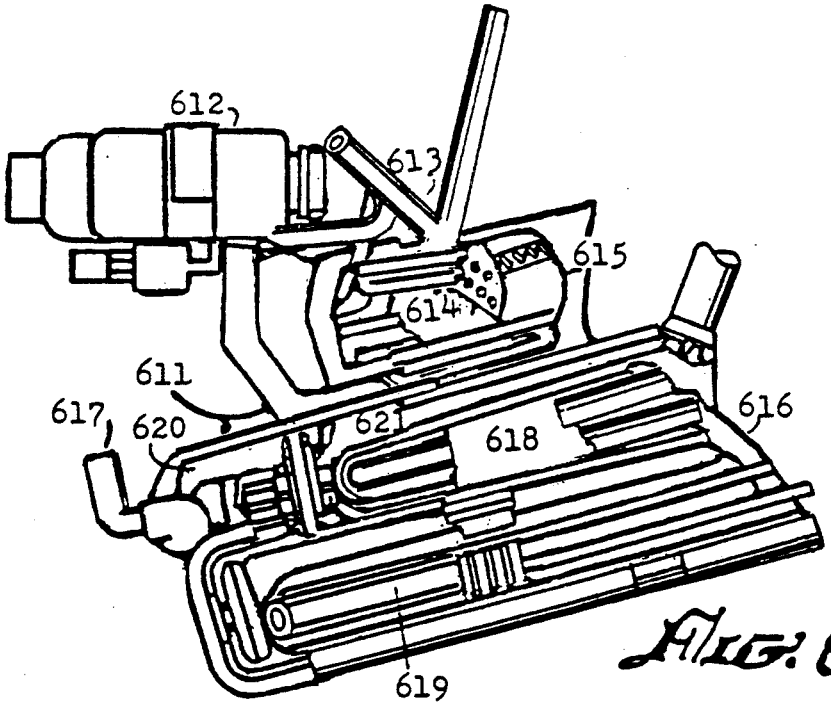
FIG. 81c 1
2
3
4
5
6
7
8
9
10
11
12
13
14
15
16
17
18
19
20
1 2 3 4 5 6 7 8 9 10 a b c d e
+Vcc
Vcc
Vout-k2
1-k1 Vin FIG. 86
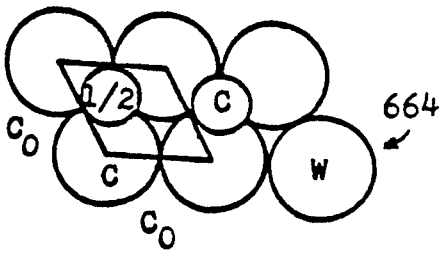
FIG. 86a
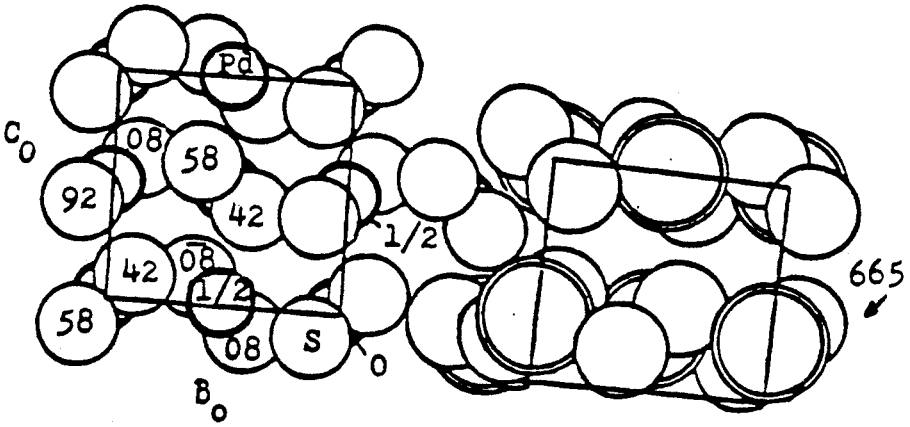
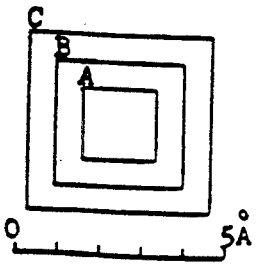

FIG. 86b
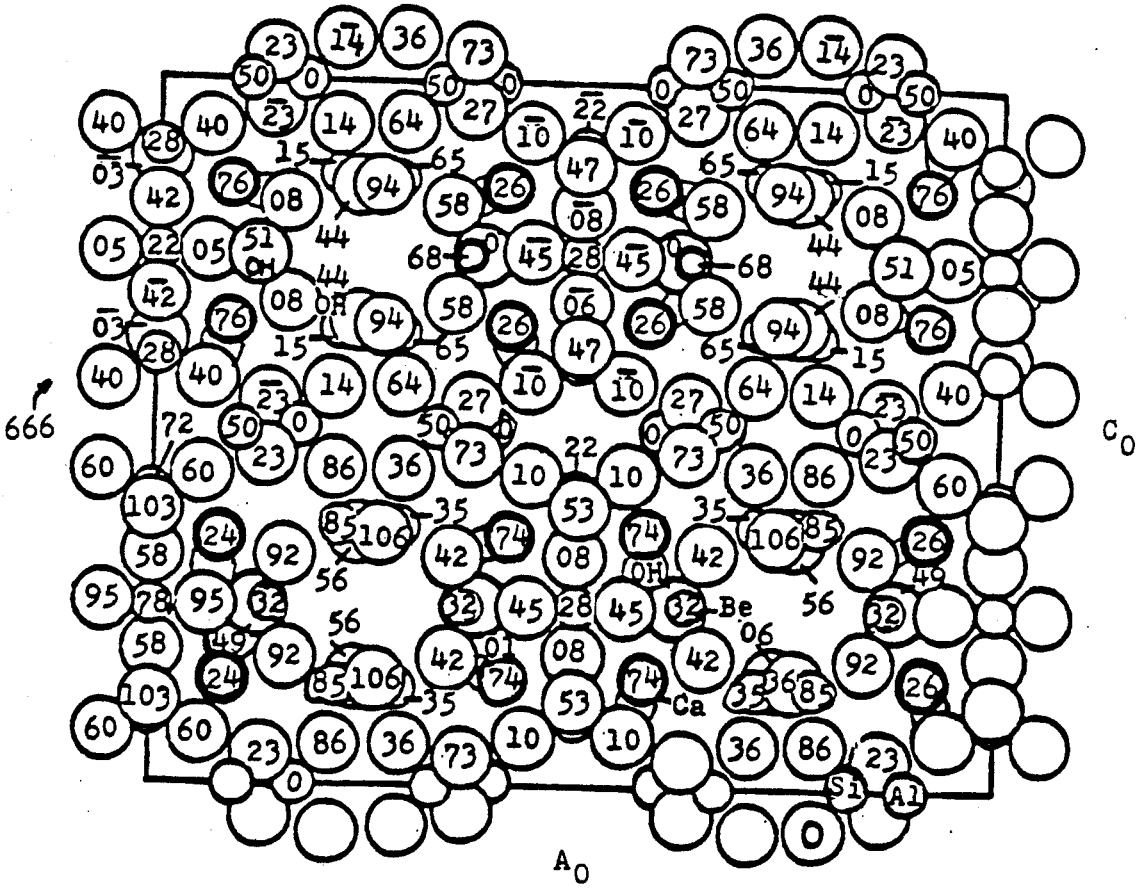
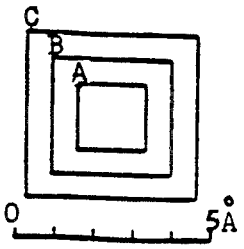

FIG. 86c
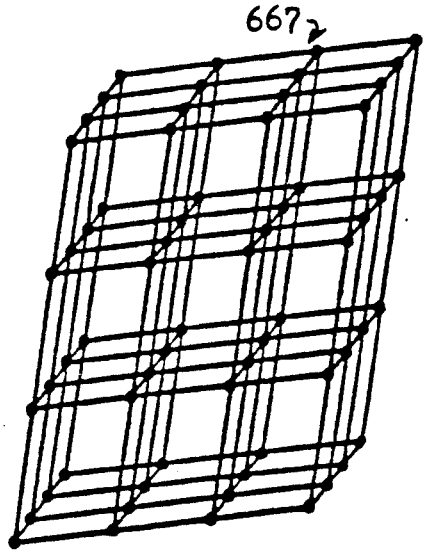
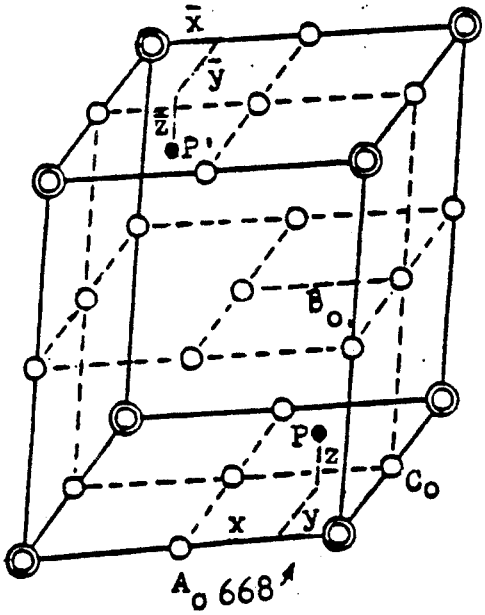
FIG. 86d
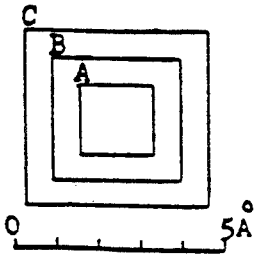

FIG. 88c

LEGEND

ERGS INITIALLY DISPERSED---KILIJOULES/NANOSECOND
MASS EXTINCT. COEFF. ABSORPT./REFLECT.---KILIJOULES/NANOSECOND
LAYER MASS DENSITY RATIO---MICROGRAMS DEPOSITED / CUBIC MILLIMETER OF SPACE SECTOR POLAR COORDINATES / REAL TIME

REAL TIME---IS THE ABSOLUTE DIFFERENCE BETWEEN THE INTERVAL OF MATERIALIZATION AND THE INITIAL ONSET OF DETERIORIZATION OF REFLECT.

DECAY RATE--- THERMAL KINETIC DISPERSAL CAUSED BY INCIDENT BEAM(S)
---ABSOLUTE DIST. IN POLAR COORDINATES TRAVELED BY REFLECTANT / KILOJOULES / MICROSECOND / HEAT CAPACITY OF REFLECTANT

SPECTRAL CHARACTERISTICS MODULATED OVER EMISSIVE BANDWIDTH --- WAVELENGTH / AMPLITUDE / FREQUENCY / INTERVAL OF EXPOSURE IIN NANOSECONDS

FIG. 93"

FIG. 93"
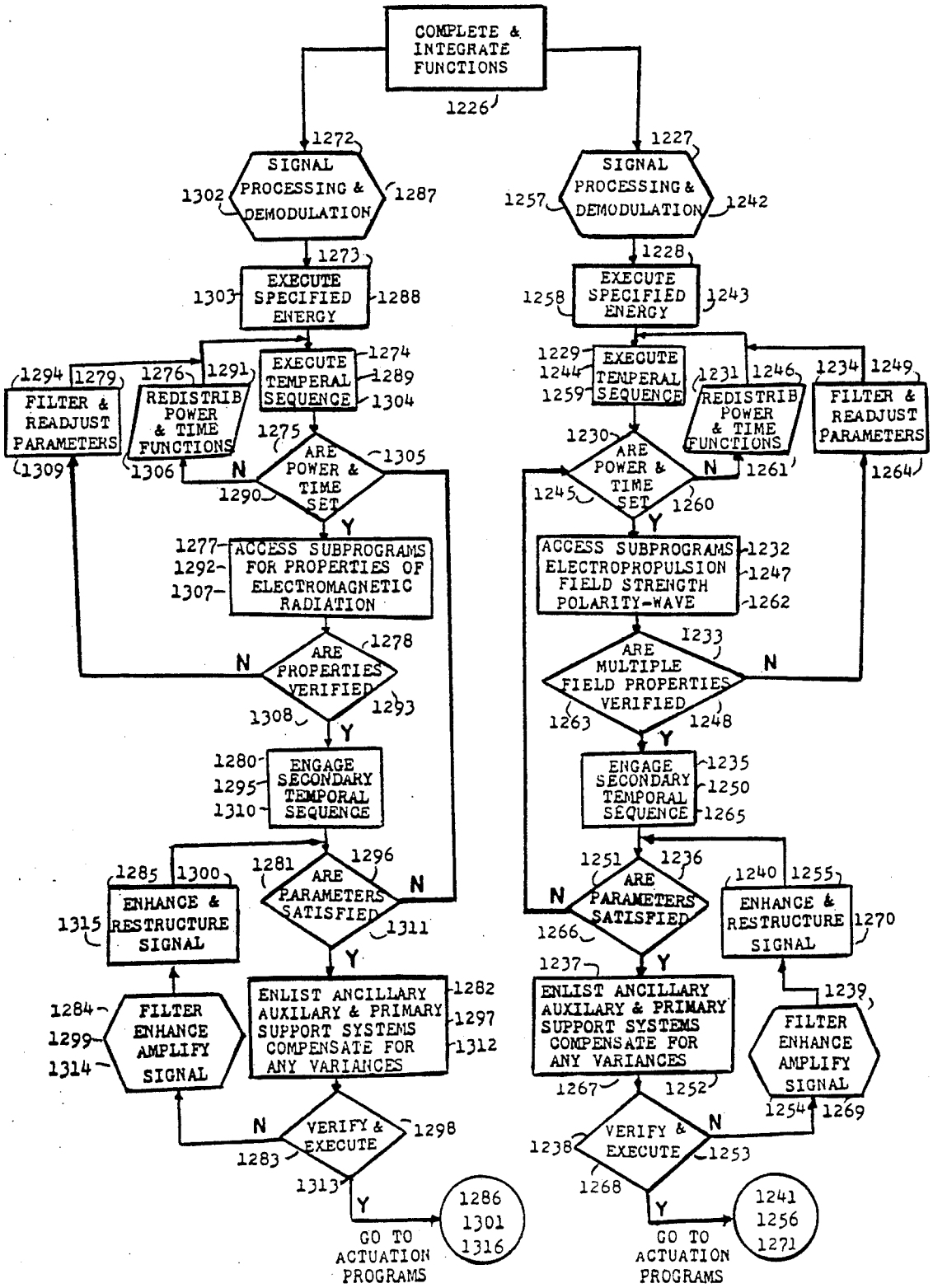

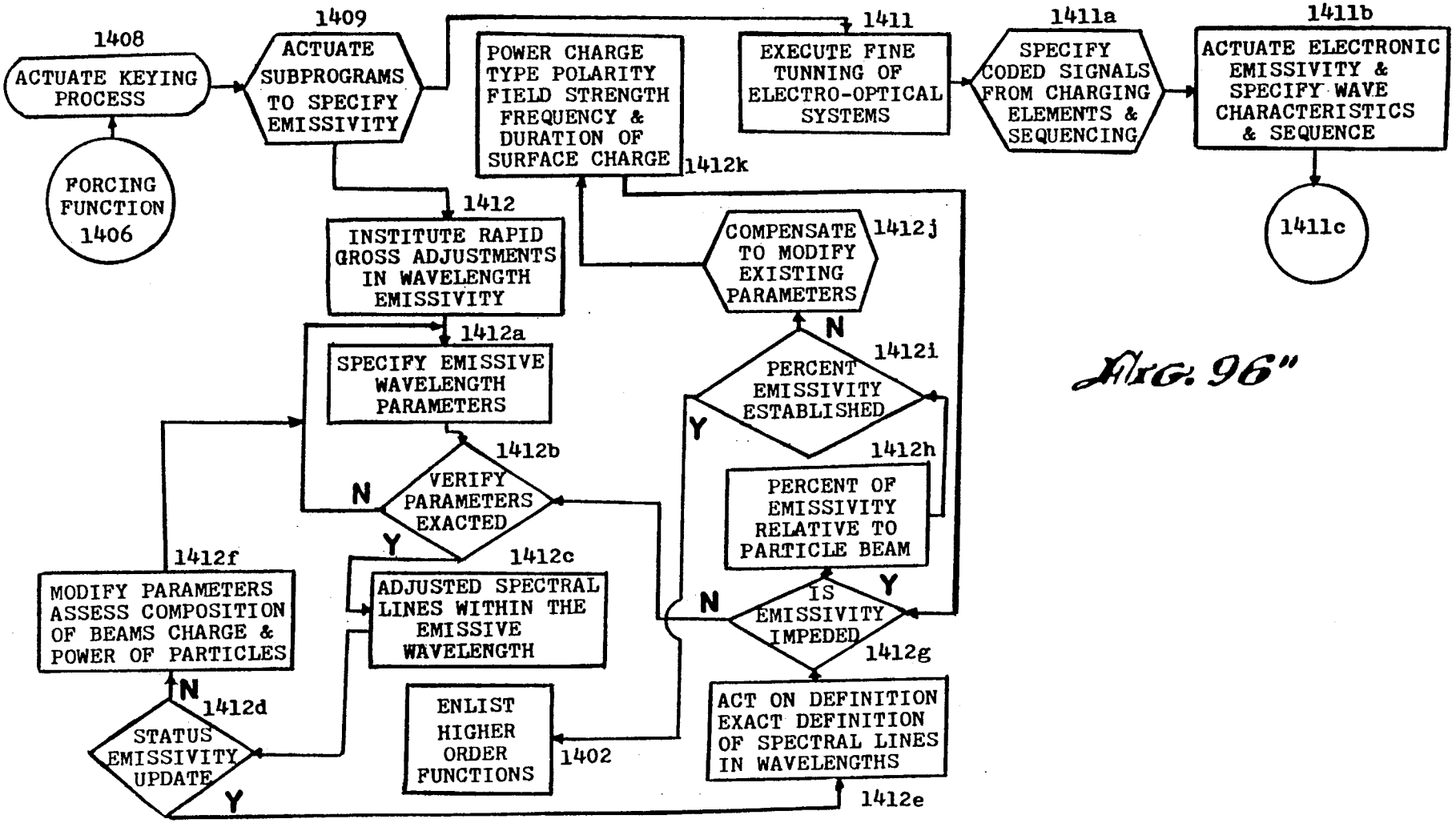
Fig. 96"

FIG. 97"
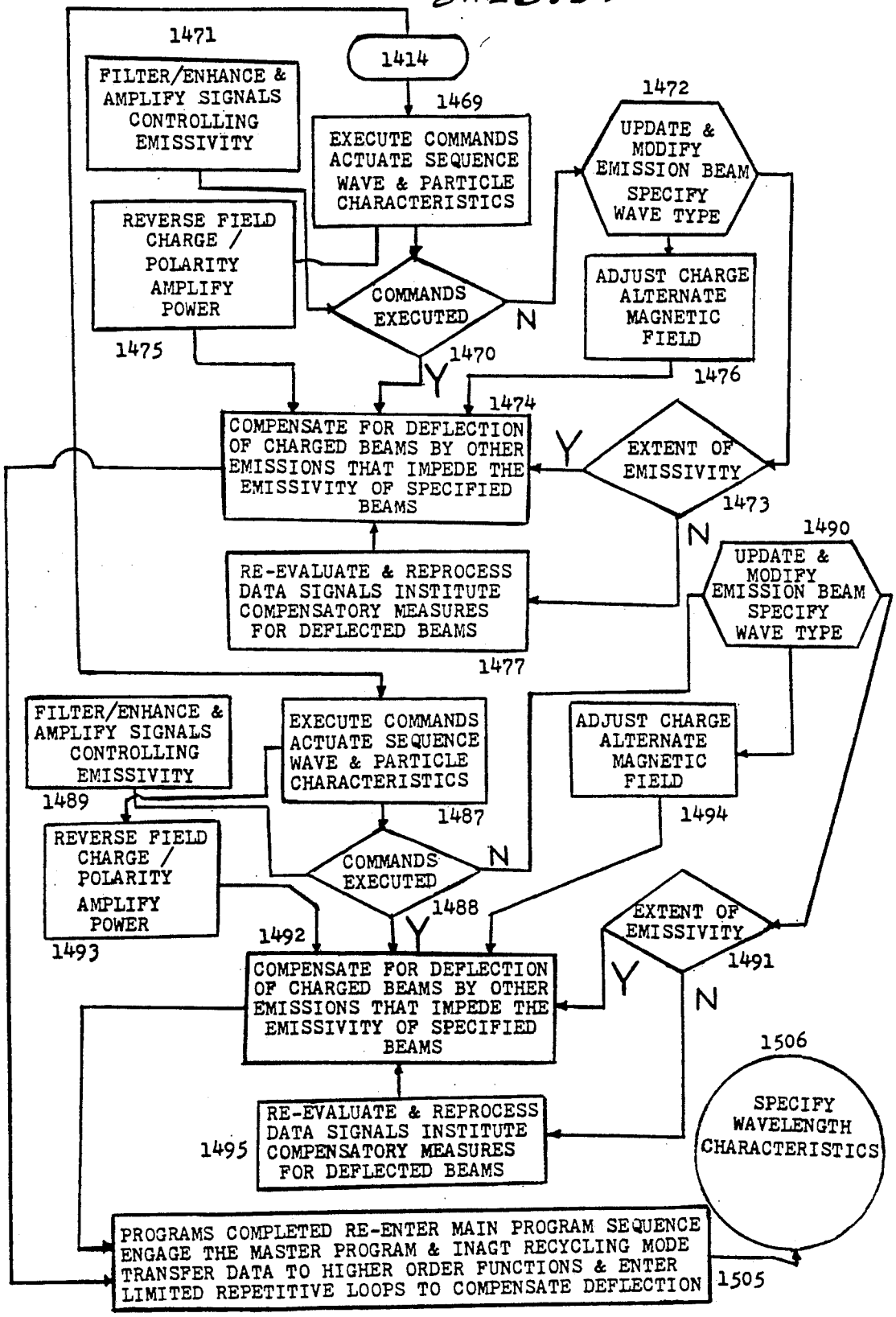

FIG. 97''''
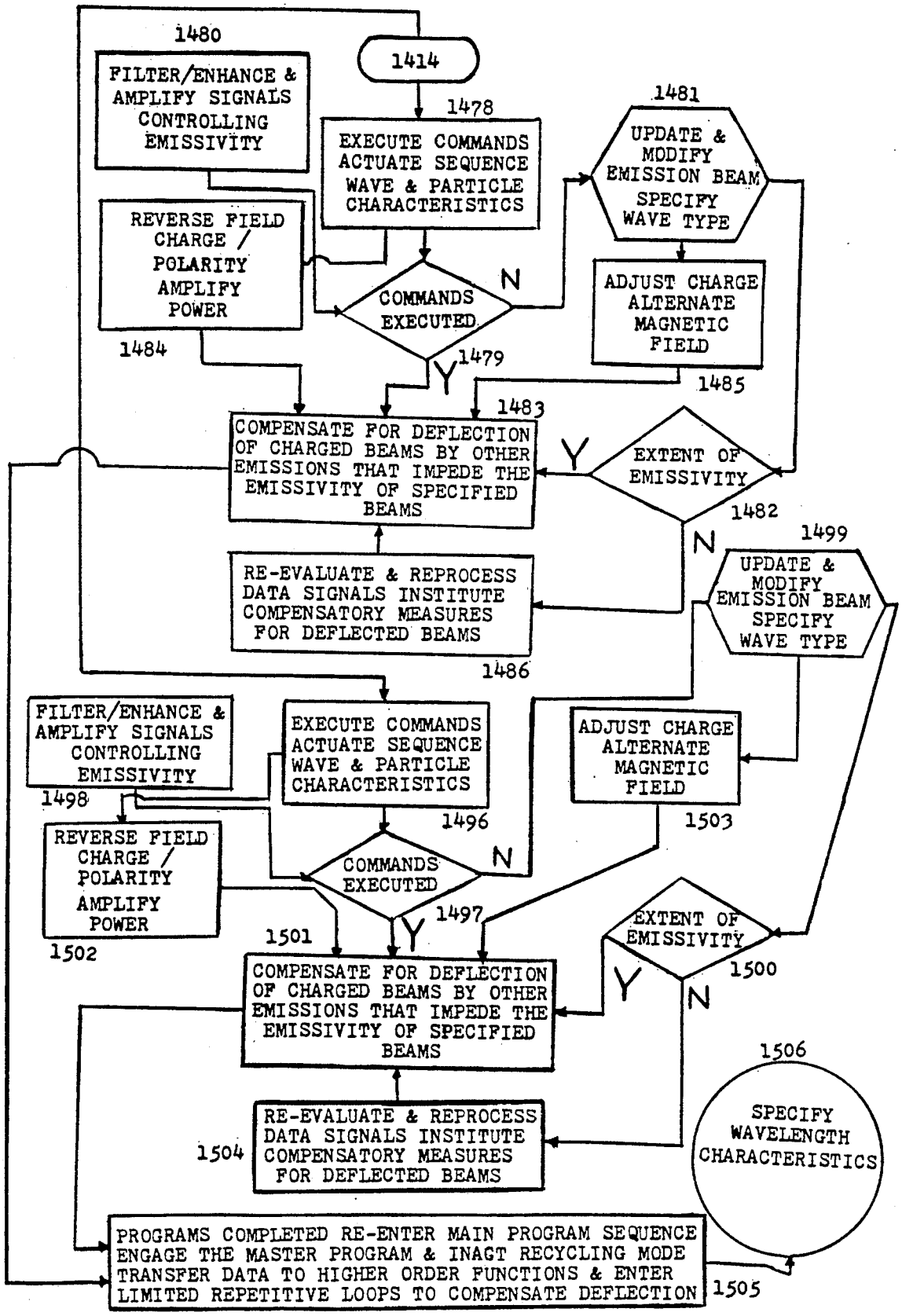

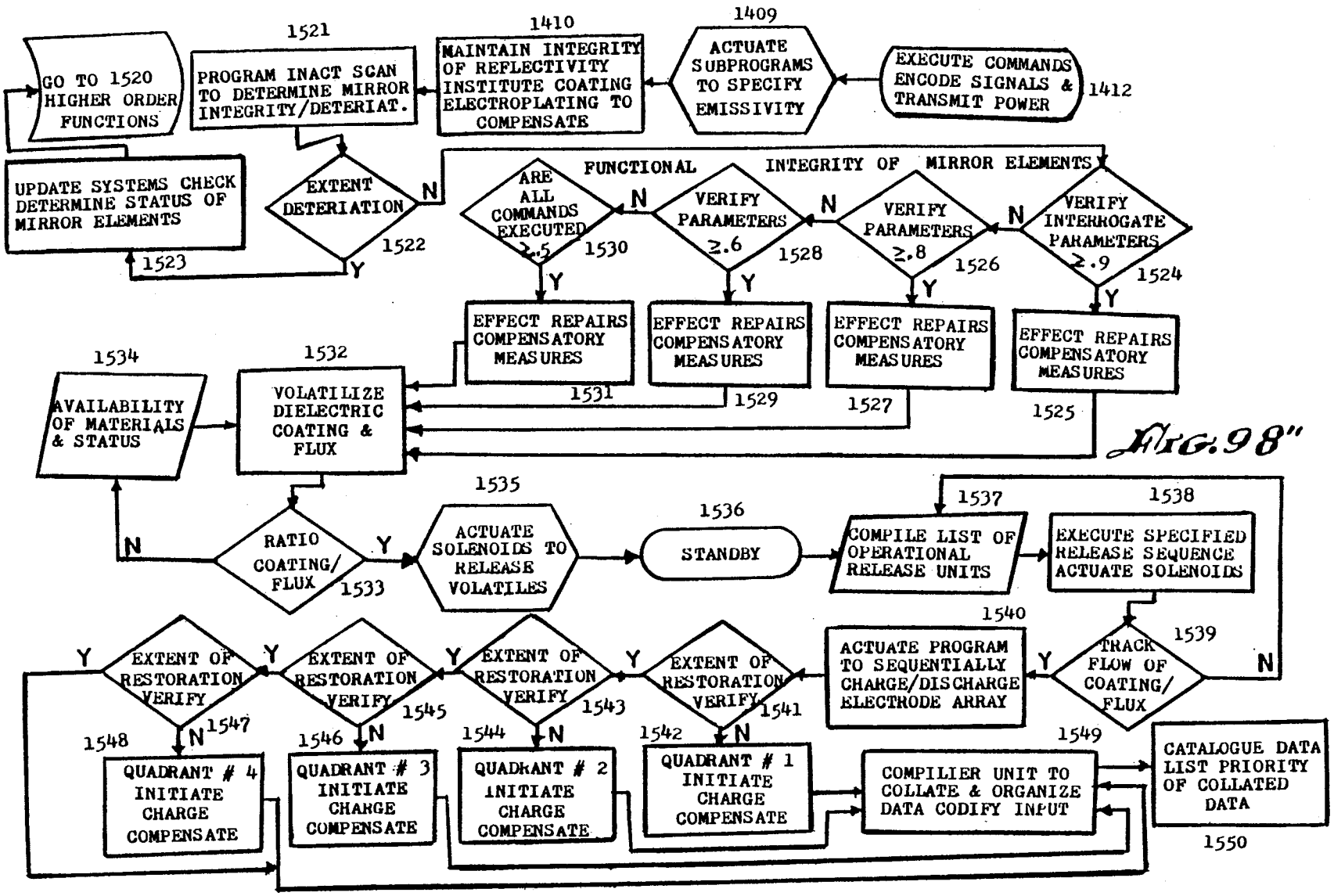
FIG. 98"

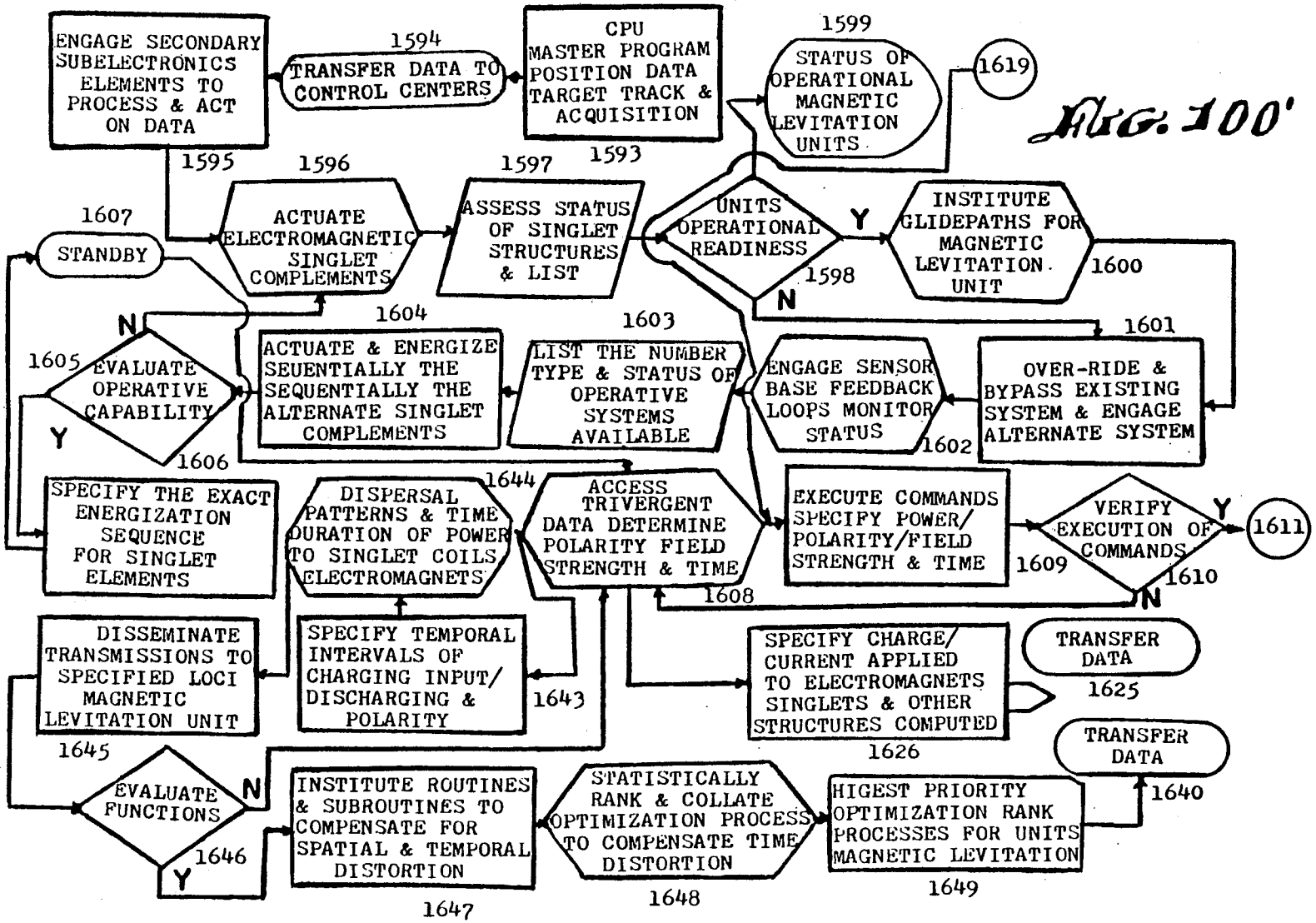
Fig. 100'
CPU MASTER PROGRAM POSITION DATA TARGET TRACK & ACQUISITION
1593
TRANSFER DATA TO CONTROL CENTERS
1594
ENGAGE SECONDARY SUBELECTRONICS ELEMENTS TO PROCESS & ACT ON DATA
1595
STATUS OF OPERATIONAL MAGNETIC LEVITATION UNITS
1599
1619
ASSESS STATUS OF SINGLET STRUCTURES & LIST
1597
ACTUATE ELECTROMAGNETIC SINGLET COMPLEMENTS
1596
STANDBY
1607
UNITS OPERATIONAL READINESS
1598
Y
N
INSTITUTE GLIDEPATHS FOR MAGNETIC LEVITATION UNIT
1600
OVER-RIDE & BYPASS EXISTING SYSTEM & ENGAGE ALTERNATE SYSTEM
1601
ACTUATE & ENERGIZE SEUENTIALLY THE SEQUENTIALLY THE ALTERNATE SINGLET COMPLEMENTS
1604
EVALUATE OPERATIVE CAPABILITY
1605
1606
LIST THE NUMBER TYPE & STATUS OF OPERATIVE SYSTEMS AVAILABLE
1603
ENGAGE SENSOR BASE FEEDBACK LOOPS MONITOR STATUS
1602
SPECIFY THE EXACT ENERGIZATION SEQUENCE FOR SINGLET ELEMENTS
ACCESS TRIVERGENT DATA DETERMINE POLARITY FIELD STRENGTH & TIME
1608
DISPERSAL PATTERNS & TIME DURATION OF POWER TO SINGLET COILS ELECTROMAGNETS
1644
EXECUTE COMMANDS SPECIFY POWER/ POLARITY/FIELD STRENGTH & TIME
1609
VERIFY EXECUTION OF COMMANDS
1610
1611
TRANSFER DATA
1625
SPECIFY CHARGE/ CURRENT APPLIED TO ELECTROMAGNETS SINGLETS & OTHER STRUCTURES COMPUTED
1626
SPECIFY TEMPORAL INTERVALS OF CHARGING INPUT/ DISCHARGING & POLARITY
1643
DISSEMINATE TRANSMISSIONS TO SPECIFIED LOCI MAGNETIC LEVITATION UNIT
1645
EVALUATE FUNCTIONS
1646
TRANSFER DATA
1640
HIGEST PRIORITY OPTIMIZATION RANK PROCESSES FOR UNITS MAGNETIC LEVITATION
1649
STATISTICALLY RANK & COLLATE OPTIMIZATION PROCESS TO COMPENSATE TIME DISTORTION
1648
INSTITUTE ROUTINES & SUBROUTINES TO COMPENSATE FOR SPATIAL & TEMPORAL DISTORTION
1647

FIG. 100"
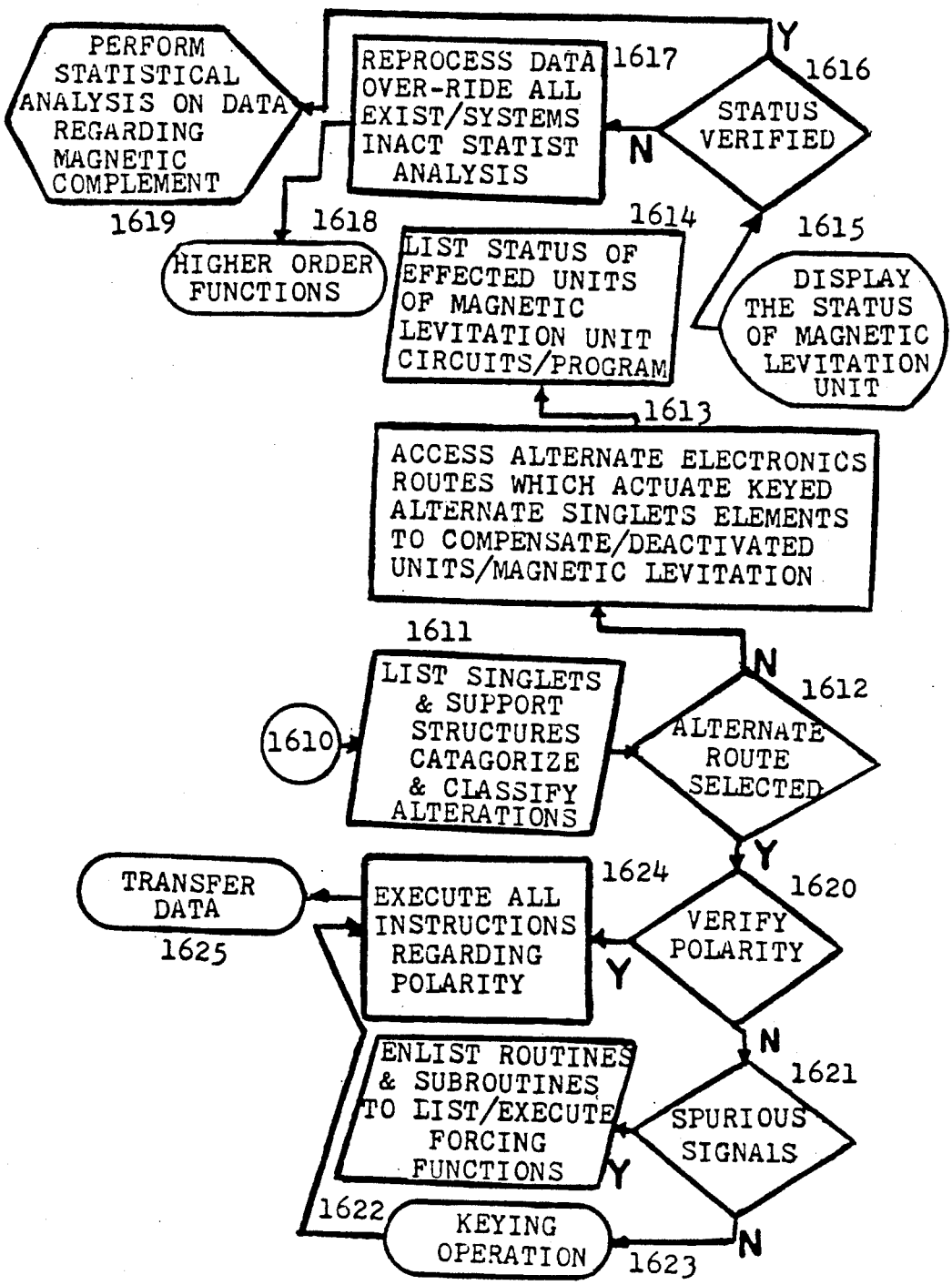

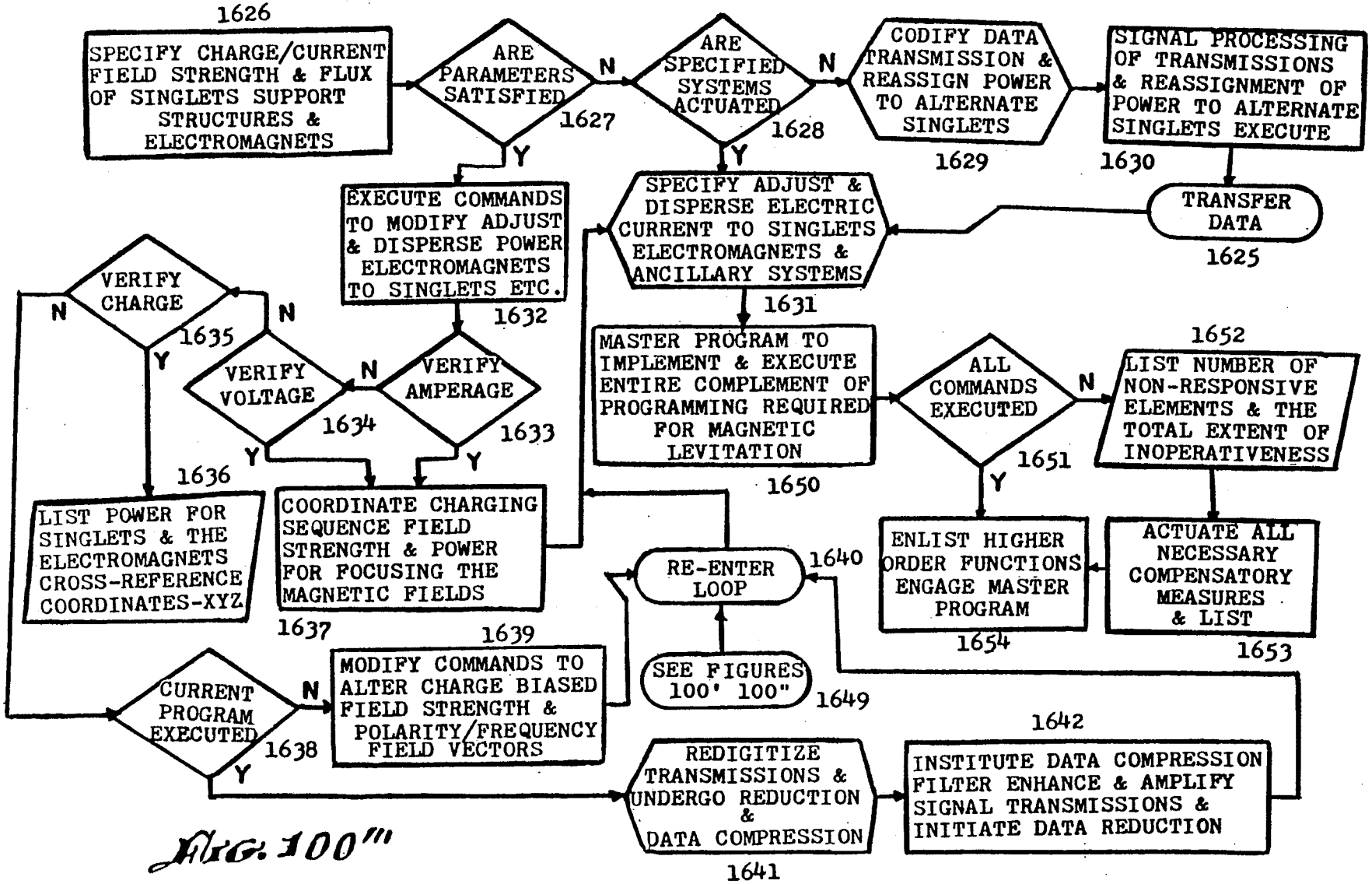
FIG. 100"

HYPOTHESIS TREE REPRESENTATION

FIG. 102a

Representation of Hypothesis Matrix

| Hypothesis Number | First Data Set | | Second Data Set | | Track Numbers Contained in Hypothesis |
|---|---|---|---|---|---|
| | $y_1(1)$ | $y_2(1)$ | $y_1(2)$ | $y_2(2)$ | |
| 1 | 0 | 0 | 0 | 0 | 0 |
| 2 | 1 | 0 | 0 | 0 | 1 |
| 3 | 0 | 2 | 0 | 0 | 2 |
| 4 | 1 | 2 | 0 | 0 | 1,2 |
| 5 | 1 | 0 | 1(3) | 0 | 3 |
| 6 | 1 | 2 | 1(3) | 0 | 2,3 |
| 7 | 0 | 2 | 2(4) | 0 | 4 |
| 8 | 1 | 2 | 2(4) | 0 | 1,4 |
| 9 | 0 | 0 | 5 | 0 | 5 |
| 10 | 1 | 0 | 5 | 0 | 1,5 |
| 11 | 0 | 2 | 5 | 0 | 2,5 |
| 12 | 1 | 2 | 5 | 0 | 1,2,5 |
| 13 | 1 | 0 | 0 | 1(6) | 6 |
| 14 | 1 | 2 | 0 | 1(6) | 2,6 |
| 15 | 1 | 2 | 2(4) | 1(6) | 4,6 |
| 16 | 1 | 0 | 5 | 1(6) | 5,6 |
| 17 | 1 | 2 | 5 | 1(6) | 2,5,6 |
| 18 | 0 | 2 | 0 | 2(7) | 7 |
| 19 | 1 | 2 | 0 | 2(7) | 1,7 |
| 20 | 1 | 2 | 1(3) | 2(7) | 3,7 |
| 21 | 0 | 2 | 5 | 2(7) | 5,7 |
| 22 | 1 | 2 | 5 | 2(7) | 1,5,7 |
| 23 | 0 | 0 | 0 | 8 | 8 |
| 24 | 1 | 0 | 0 | 8 | 1,8 |
| 25 | 0 | 2 | 0 | 8 | 2,8 |
| 26 | 1 | 2 | 0 | 8 | 1,2,8 |
| 27 | 1 | 0 | 1(3) | 8 | 3,8 |
| 28 | 1 | 2 | 1(3) | 8 | 2,3,8 |
| 29 | 0 | 2 | 2(4) | 8 | 4,8 |
| 30 | 1 | 2 | 2(4) | 8 | 1,4,8 |
| 31 | 0 | 0 | 5 | 8 | 5,8 |
| 32 | 1 | 0 | 5 | 8 | 1,5,8 |
| 33 | 0 | 2 | 5 | 8 | 2,5,8 |
| 34 | 1 | 2 | 5 | 8 | 1,2,5,8 |

A

• DATA POINTS

PI • EXTRAPOLATED POSITION FOR TRACK I

TRACKS ASSOCIATED WITH $H_{15}$ (T4, T6)

TRACKS ASSOCIATED WITH $H_{20}$ (T3, T7)

HYPOTHESIZED TRACK FORMATION FOR TWO DATA SCANS

FULL HYPOTHESIS MATRIX AFTER THIRD DATA SCAN

| Hypothesis Number | Second Data Scan | | Third Data Scan | |
|---|---|---|---|---|
| | $y_1(2)$ | $y_2(2)$ | $y_1(3)$ | $y_2(3)$ |
| 1(15) | 4 | 6 | 0 | 0 |
| 2(20) | 3 | 7 | 0 | 0 |
| 3 | 4 | 6 | 6(9) | 0 |
| 4 | 4 | 6 | 10 | 0 |
| 5 | 3 | 7 | 10 | 0 |
| 6 | 4 | 6 | 0 | 4(11) |
| 7 | 4 | 6 | 6(9) | 4(11) |
| 8 | 4 | 6 | 10 | 4(11) |
| 9 | 4 | 6 | 0 | 12 |
| 10 | 3 | 7 | 0 | 12 |
| 11 | 4 | 6 | 6(9) | 12 |
| 12 | 4 | 6 | 10 | 12 |
| 13 | 3 | 7 | 10 | 12 |

B

GATES AND OBSERVATIONS FOR THE THIRD DATA SCAN

REDUCED HYPOTHESIS MATRIX AFTER THIRD SCAN DATA

| Hypothesis Number | Third Scan Data | |
|---|---|---|
| | $y_1(3)$ | $y_2(3)$ |
| 1(3) | 9 | 0 |
| 2(7) | 9 | 11 |
| 3(11) | 9 | 12 |

FIG. 105

A

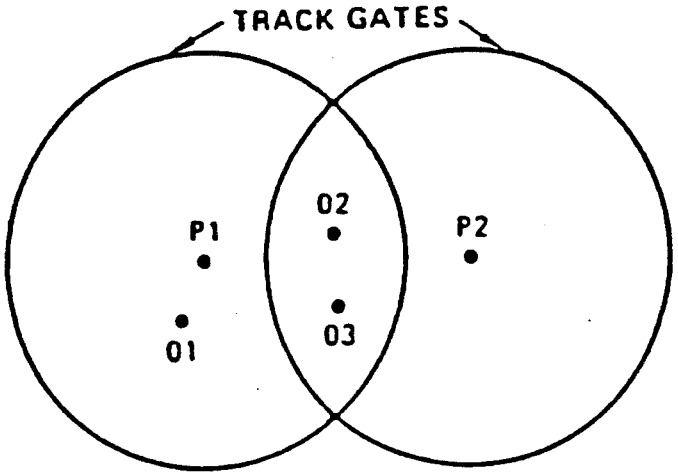

01, 02, 03 = OBSERVATION POSITIONS
P1, P2 = PREDICTED TARGET POSITION

FIG. 105a

B

TARGET ORIENTED HYPOTHESIS MATRIX

| Hypothesis Number | Track Number 1 | Track Number 2 | Hypothesis Probability $P'(H_i)$ | Probability Values for Example* |
|---|---|---|---|---|
| 1 | 0 | 0 | $(1-P_D)^2\beta^1$ | $2.4\times10^{-6}(0.011)$ |
| 2 | 1 | 0 | $g_{11}P_D(1-P_D)\beta^2$ | $1.82\times10^{-5}(0.086)$ |
| 3 | 2 | 0 | $g_{12}P_D(1-P_D)\beta^2$ | $1.11\times10^{-5}(0.053)$ |
| 4 | 3 | 0 | $g_{13}P_D(1-P_D)\beta^2$ | $4.1\times10^{-6}(0.019)$ |
| 5 | 0 | 2 | $g_{22}P_D(1-P_D)\beta^2$ | $8.6\times10^{-6}(0.041)$ |
| 6 | 1 | 2 | $g_{11}g_{22}P_D^2\beta$ | $6.47\times10^{-5}(0.306)$ |
| 7 | 3 | 2 | $g_{11}g_{22}P_D^2\beta$ | $1.44\times10^{-5}(0.068)$ |
| 8 | 0 | 3 | $g_{22}P_D(1-P_D)\beta^2$ | $6.7\times10^{-6}(0.032)$ |
| 9 | 1 | 3 | $g_{11}g_{21}P_D^2\beta$ | $5.04\times10^{-5}(0.239)$ |
| 10 | 2 | 3 | $g_{12}g_{21}P_D^2\beta$ | $3.06\times10^{-5}(0.145)$ |

*Normalized values, $P(H_1)$.within paretheses.

FIG. 109

```
PROGRAM SAMPLE(INPUT, OUTPUT);
{This program illustrates the use of procedure names as
 parameters to other procedures}
 .
 .
 .
 VAR FLAG: BOOLEAN;  {Set by CHECK1 and CHECK2}

 PROCEDURE CHECK1(X, Y, Z: REAL);
     {Performs some type of validity checking on X, Y, and Z
      and sets FLAG accordingly}
     BEGIN
     .
     .
     .
     FLAG:=TRUE
     END;

 PROCEDURE CHECK2(X, Y, Z: REAL);
     {Performs a different type of validity check and sets
      FLAG accordingly}
     BEGIN
     .
     .
     .
     FLAG:=TRUE
     END;

 PROCEDURE READDATA(PROCEDURE CHECK);
     {This procedure reads in data and validates it using a
      checking procedure passed in as a parameter}
     BEGIN
     .
     .
     .
     READLN(X, Y, Z);  {Input the data}
     CHECK(X, Y, Z);  {Check it for correctness}
     IF FLAG THEN . . .
     .
     .
     .
     END;
```

FIG. 109'

```
FUNCTION POWER(X: REAL; N: INTEGER): REAL;
{Compute X raised to the power N recursively. The function
 always returns 0 for X = 0}
BEGIN
    IF X = 0.0 THEN POWER:=0.0
    ELSE IF N = 0 THEN POWER:=1.0
         ELSE IF N < 0 THEN POWER:=POWER(X, N+1)/X
                       ELSE POWER:=POWER(X, N-1)*X
    END;  {Of POWER}

        IF X>Y THEN
          BEGIN
          IF X>Z THEN
            WRITE(X)
          ELSE
            WRITE(Z)
          END
        ELSE
          BEGIN
          IF Y>Z THEN
            WRITE(Y)
          ELSE
            WRITE(X)
          END;


{ ACCESS CODE COMPLETED GOTO MAIN PROGRAM }
```

FIG. 110

COMPARISON OF CONTINUOUS-TIME AND DISCRETE-TIME TRANSFORMS

CONTINUOUS-TIME TRANSFORMS

Fourier Series $$x(t) = \sum_{k=-\infty}^{\infty} c_k e^{j2\pi kt/T}$$

$$c_k = \frac{1}{T} \int_{-T/2}^{T/2} x(t) e^{-j2\pi kt/T} dt$$

Fourier Transform $$x(t) = 1/2\pi \int_{-\infty}^{\infty} X(\omega) e^{j\omega t} d\omega$$

$$X(\omega) = \int_{-\infty}^{\infty} x(t) e^{-j\omega t} dt$$

Laplace Transform $$x(t) = 1/2\pi j \int_{Br} X(s) e^{st} ds$$

$$X(s) = \int^{\infty} x(t) e^{-st} dt$$

DISCRETE-TIME TRANSFORMS

DFT $$x(n) = 1/N \sum_{k=0}^{N-1} X_k e^{j2\pi kn/N}$$

$$X_k = \sum_{n=0}^{N-1} x(n) e^{-2\pi kn/N}$$

Fourier Transform (Discrete Signal)

$$x(n) = 1/2\pi \int_{0}^{2\pi} X(\omega) e^{j\omega n} d\omega$$

$$X(\omega) = \sum_{-\infty}^{\infty} x(n) e^{-j\omega n}$$

z Transform $$x(n) = 1/2\pi j \int_{C} X(z) z^{n-1} dz$$

$$X(z) = \sum_{n=-\infty}^{\infty} x(n) z^{-n}$$

FIG. 111

AUTOCORRELATION FUNCTION $$R_{yy}(\beta) = \lim_{T_O \to \infty} \frac{1}{T_O} \int_0^{T_O} y(t)\,y(t-\beta)\,dt$$

Autocorrelation function of a continuous signal

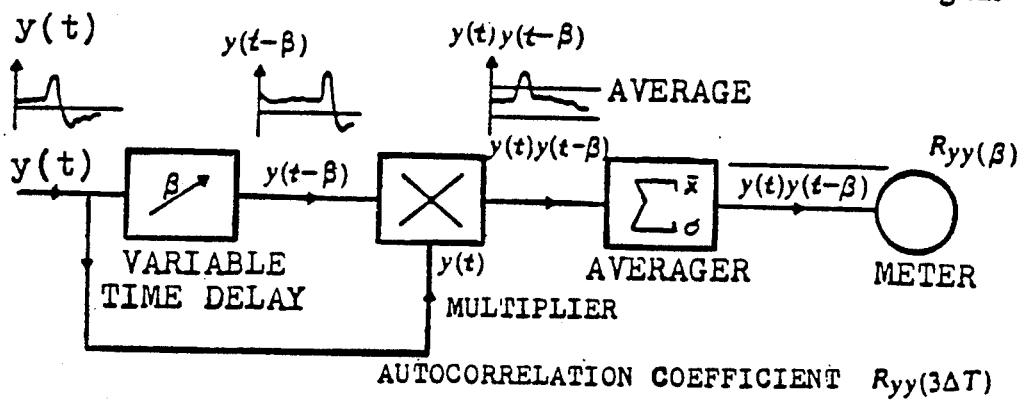

FIG. 111a

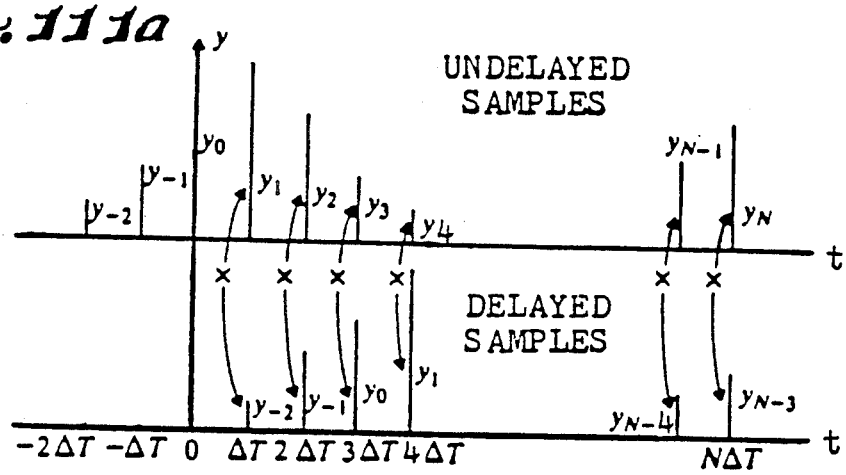

Thus, if $y(t) = b\sin(\omega_1 t + \phi)$, $$R_{yy}(\beta) = b^2 \lim_{T_O \to \infty} \frac{1}{T_O} \int_0^{T_O} \sin(\omega_1 t + \phi)\sin[\omega_1(t-\beta) + \phi]\,dt$$

$$= b^2 \lim_{T_O \to \infty} \frac{1}{T_O} \int_0^{T_O} \tfrac{1}{2}\{\cos\omega_1\beta - \cos[\omega_1(2t-\beta) + 2\phi]\}\,dt$$

$$R_{yy}(\beta) = \frac{b^2}{2}\cos\omega_1\beta \lim_{T_O \to \infty} \frac{1}{T_O} \int_0^{T_O} dt - \frac{b^2}{2} \lim_{T_O \to \infty} \frac{1}{T_O} \int_0^{T_O} \cos[\omega_1(2t-\beta) + 2\phi]\,dt$$

$$= \frac{b^2}{2}\cos\omega_1\beta$$

FIG. 112

STANDARD DEVIATION AND VARIANCE

```
label 1;
var
    i    :        integer;
begin
    sumsq := 0;
    writeln ('enter -999 to exit');
    writeln;
    for i := 1 to MAXINT do
        begin
        write ('input data ',i:2,' : ');
        readln (dat[i]);
        if dat[i] = -999 then
        goto 1;
        writeln;
        sum := sum + dat[i];
        nbr := i
        end;
   1: avg := sum / nbr;
    for i := 1 to nbr do
        begin
        d := dat[i] - avg;
        sumsq := sumsq + sqr(d)
        end;
    vr := sumsq / (nbr - 1);
    pvr := sumsq / nbr;
    sd := sqrt (vr);
    psd := sqrt (pvr)
end; {inpt}

procedure print;
begin
    skip (4);
    writeln ('number of data items ',nbr:3);
    writeln;
    writeln ('average ',avg:8:4);
    writeln;
    writeln ('variance ',vr:8:4);
    writeln;
    writeln ('standard deviation ',sd:8:4);
    writeln;
    writeln ('population standard deviation ',psd:8:4)
end; {print}

begin {main}
    clear;
    skip (4);
    sum := 0;
    skip (4);
    writeln ('            Standard Deviation and Variance');
    skip (3);
    inpt;
    print
end.
```

FIG. 112a

FORMUAS RESPONSIBLE FOR ALGORITHMS EMBODIED WITHIN PROGRAM CALCULATING STANDARD DEVIATIONS

If $x_1, x_2, \ldots, x_n$ is a sample of *n* numbers, the formula for the mean x (x bar) is:

$$\bar{x} = \frac{1}{n}\sum_{j=1}^{n} x_j$$

The standard deviation *s* of the sample is defined by $$(n-1)s^2 = (x_1 - x)^2 + (x_2 - x)^2 + \ldots + (x_n - x)^2$$

which, using the summation notation, looks like this:

$$(n - 1)s^2 = \sum_{j=1}^{n} (xj - x)^2$$

or, solving for *s* looks like this:

$$s = \frac{(x_1 - x)^2 + (x_2 - x)^2 + \ldots + (x_n - x)^2}{n - 1}$$

FIG. 113

SECOND-ORDER CURVE-FIT

```
var
    i : integer;
    x : real;
begin
    x := 1.0;
    for i := 1 to xpnt do
        x := x * mantissa;
    pwr := x
end;

procedure leastsquares (nbr : integer);
var
    i            : integer;
begin
    a0 := 1;
    a1 := 0;
    a2 := 0;
    a3 := 0;
    a4 := 0;
    b0 := 0;
    b1 := 0;
    b2 := 0;
    for i := 1 to nbr  do
        begin
        a1 := a1 + x[i];
        a2 := a2 + pwr (x[i], 2);
        a3 := a3 + pwr (x[i], 3);
        a4 := a4 + pwr (x[i], 4);
        b0 := b0 + y[i];
        b1 := b1 + x[i] * y[i];
        b2 := b2 + y[i] * pwr (x[i], 2)
        end;
    a1 := a1 / nbr;
    a2 := a2 / nbr;
    a3 := a3 / nbr;
    a4 := a4 / nbr;
    b0 := b0 / nbr;
    b1 := b1 / nbr;
    b2 := b2 / nbr;
    d := a0*(a2*a4 - a3*a3) - a1*(a1*a4 - a3*a2)+a2*(a1*a3 - a2*a2);
    a := b0*(a2*a4 - a3*a3) + b1*(a3*a2 - a1*a4)+b2*(a1*a3 - a2*a2);
    a := a / d;
    b := b0*(a3*a2 - a1*a4) + b1*(a0*a4 - a2*a2)+b2*(a2*a1 - a0*a3);
    b := b / d;
    c := b0*(a1*a3 - a2*a2) + b1*(a1*a2 - a0*a3)+b2*(a0*a2 - a1*a1);
    c := c / d;
    d := 0;
    for i := 1 to nbr do
        begin
        d1 := y[i] - a - b * x[i] - c * pwr (x[i], 2);
        d := d + pwr(d1, 2);
        end;
```

FIG. 113a $$Y = f(X)$$

Polynomial curve-fitting involves matching data to an x,y relationship. For a binomial or second-order polynomial, the relationship is $$x^2 +/- 2xy +/- y^2$$

For a third-order polynomial, it is $$x^3 +/- x^2y +/- xy^2 +/- y^3$$

FIG. 11A

SINGLE DIGITIZED SIGNAL

```
000000000
```

REPETITIVE DIGITIZED SIGNAL

FIG. 114b

DIGITIZED SIGNAL AFTER DATA REDUCTION

```
000000000000000000011100000000000000000000000000111
0000000000000000000011110000000000000000000000001110
000000000000000000011100000000000000000000000000111
000000000000000000011100000000000000000000000000111
011111111111111111111111111111111111111111111111111
000000000000000000000011100000000000000000000111000
011111111111111111111111111111111111111111111111111
011000000000000000000000000000000000000000000000011
```

SYMBOLIC CODE KEY
TARGET ACQUISITION USER
FRIENDLY ANCILLARY SYSTEM

FIG. 116

$$X = \begin{bmatrix} 1 & -1 & 1 & -1 & 1 & -1 \\ 1 & 1 & 1 & 1 & 1 & 1 \\ 1 & -1 & 0 & 1 & -1 & 0 \\ 1 & 0 & -1 & 1 & 0 & -1 \\ 0 & 1 & -1 & 0 & 1 & -1 \\ 1 & 1 & 0 & -1 & -1 & 0 \\ 1 & 0 & -1 & -1 & 0 & 1 \\ 0 & 1 & 1 & 0 & -1 & -1 \end{bmatrix}$$

$$Y = \begin{bmatrix} 1 & -1 & 1 & -1 & 1 & -1 \\ 1 & 1 & 1 & 1 & 1 & 1 \\ 1 & -1 & 0 & 1 & -1 & 0 \\ 1 & 0 & -1 & 1 & 0 & -1 \\ 1 & 1 & -1 & 0 & 1 & -1 \\ 1 & 1 & 0 & -1 & -1 & 0 \\ 1 & 0 & -1 & -1 & 0 & 1 \\ 1 & 1 & 1 & 0 & -1 & -1 \end{bmatrix}$$

$$Z = \begin{bmatrix} 1 & -1 & 1 & -1 & 1 & -1 \\ 1 & 1 & 1 & 1 & 1 & 1 \\ 0 & -1 & 0 & 1 & -1 & 0 \\ 1 & 0 & -1 & 1 & 0 & -1 \\ 0 & 1 & -1 & 0 & 1 & -1 \\ 1 & 1 & 0 & -1 & -1 & 0 \\ 1 & 0 & -1 & -1 & 0 & 1 \\ 0 & 1 & 1 & 0 & -1 & -1 \end{bmatrix}$$

$$T = \begin{bmatrix} 1 & 1 & 1 & 1 & -1 & -1 & 1 & -1 \\ -1 & 1 & -1 & 1 & 1 & 1 & 1 & 1 \\ 1 & 1 & 1 & 1 & 0 & 1 & -1 & 0 \\ -1 & 1 & -1 & 1 & -1 & 1 & 0 & -1 \\ 1 & 1 & 1 & 1 & 1 & 0 & -1 & -1 \\ -1 & 1 & -1 & 1 & 0 & 1 & 1 & 0 \end{bmatrix}$$

FIG. 117

```
C ------------------------------------------------------------
        A COOLEY-TUKEY RADIX-8 DIF  FFT PROGRAM
        TWO BF, TABLE LOOKUP OF  W  VALUES
        COMPLEX INPUT DATA IN ARRAYS X AND Y
        TWIDDLE FACTORS ARE STORED IN TABLE
        LENGTH IS  N = 8 ** M
        SUBROUTINE  FFT8 (X,Y,N,M,WR,WI)
        REAL X(1), Y(1), WR(1), WI(1)
        C81 = 0.707106778
C-------------MAIN FFT LOOPS----------------------------
        N2 = N
        DO 10 K = 1, M
            N1 = N2
            N2 = N2/8
            DO 1 I1 = 1, N, N1
                    I2 = I1 + N2
                    I3 = I2 + N2
                    I4 = I3 + N2
                    I5 = I4 + N2
                    I6 = I5 + N2
                    I7 = I6 + N2
                    I8 = I7 + N2
                    R1 = X(I1) + X(I5)
                    R5 = X(I1) - X(I5)
                    R2 = X(I2) + X(I6)
                    R6 = X(I2) - X(I6)
                    R3 = X(I3) + X(I7)
                    R7 = X(I3) - X(I7)
                    R4 = X(I4) + X(I8)
                    R8 = X(I4) - X(I8)
                    T1 = R1 - R3
                    R1 = R1 + R3
                    R3 = R2 - R4
                    R2 = R2 + R4
                    X(I1) = R1 + R2
                    X(I5) = R1 - R2
                    R1 = Y(I1) + Y(I5)
                    S5 = Y(I1) - Y(I5)
                    R2 = Y(I2) + Y(I6)
                    S6 = Y(I2) - Y(I6)
                    S3 = Y(I3) + Y(I7)
                    S7 = Y(I3) - Y(I7)
                    R4 = Y(I4) + Y(I8)
                    S8 = Y(I4) - Y(I8)
                    T2 = R1 - S3
                    R1 = R1 + S3
                    S3 = R2 - R4
                    R2 = R2 + R4
                    Y(I1) = R1 + R2
                    Y(I5) = R1 - R2
                    X(I3) = T1 + S3
                    X(I7) = T1 - S3
                    Y(I3) = T2 - R3
                    Y(I7) = T2 + R3
```

FIG. 117a

```
T1 = R1 - R3
R1 = R1 + R3
R3 = R2 - R4
R2 = R2 + R4
X(I1) = R1 + R2
R2    = R1 - R2
S1 = Y(I1) + Y(I5)
S5 = Y(I1) - Y(I5)
S2 = Y(I2) + Y(I6)
S6 = Y(I2) - Y(I6)
S3 = Y(I3) + Y(I7)
S7 = Y(I3) - Y(I7)
S4 = Y(I4) + Y(I8)
S8 = Y(I4) - Y(I8)
T2 = S1 - S3
S1 = S1 + S3
S3 = S2 - S4
S2 = S2 + S4
Y(I1) = S1 + S2
S2    = S1 - S2
R1 = T1 + S3
T1 = T1 - S3
S1 = T2 - R3
T2 = T2 + R3
X(I5) = CO5*R2 + SI5*S2
Y(I5) = CO5*S2 - SI5*R2
X(I3) = CO3*R1 + SI3*S1
Y(I3) = CO3*S1 - SI3*R1
X(I7) = CO7*T1 + SI7*T2
Y(I7) = CO7*T2 - SI7*T1
R1 = (R6 - R8)*C81
R6 = (R6 + R8)*C81
S1 = (S6 - S8)*C81
S6 = (S6 + S8)*C81
T1 = R5 - R1
R5 = R5 + R1
R8 = R7 - R6
R7 = R7 + R6
T2 = S5 - S1
S5 = S5 + S1
S8 = S7 - S6
S7 = S7 + S6
R1 = R5 + S7
R5 = R5 - S7
R6 = T1 + S8
T1 = T1 - S8
S1 = S5 - R7
S5 = S5 + R7
S6 = T2 - R8
T2 = T2 + R8
X(I2) = CO2*R1 + SI2*S1
Y(I2) = CO2*S1 - SI2*R1
X(I8) = CO8*R5 + SI8*S5
Y(I8) = CO8*S5 - SI8*R5
X(I6) = CO6*R6 + SI6*S6
Y(I6) = CO6*S6 - SI6*R6
X(I4) = CO4*T1 + SI4*T2
Y(I4) = CO4*T2 - SI4*T1
        CONTINUE
    CONTINUE
CONTINUE
```

FIG. 117b

```
            R1 = (R6 - R8)*C81
            R6 = (R6 + R8)*C81
            R2 = (S6 - S8)*C81
            S6 = (S6 + S8)*C81
            T1 = R5 - R1
            R5 = R5 + R1
            R8 = R7 - R6
            R7 = R7 + R6
            T2 = S5 - R2
            S5 = S5 + R2
            S8 = S7 - S6
            S7 = S7 + S6
            X(I2) = R5 + S7
            X(I8) = R5 - S7
            X(I6) = T1 + S8
            X(I4) = T1 - S8
            Y(I2) = S5 - R7
            Y(I8) = S5 + R7
            Y(I6) = T2 - R8
            Y(I4) = T2 + R8
1       CONTINUE
        IF (K.EQ.M) GOTO 10
        IE = N/N1 - 1
        IA1 = 1
        DO 20 J = 2, N2
            ID   = IA1 + IE
            IA1  = 1   + ID
            IA2  = IA1 + ID
            IA3  = IA2 + ID
            IA4  = IA3 + ID
            IA5  = IA4 + ID
            IA6  = IA5 + ID
            IA7  = IA6 + ID
            CO2  = WR(IA1)
            CO3  = WR(IA2)
            CO4  = WR(IA3)
            CO5  = WR(IA4)
            CO6  = WR(IA5)
            CO7  = WR(IA6)
            CO8  = WR(IA7)
            SI2  = WI(IA1)
            SI3  = WI(IA2)
            SI4  = WI(IA3)
            SI5  = WI(IA4)
            SI6  = WI(IA5)
            SI7  = WI(IA6)
            SI8  = WI(IA7)
```

FIG. 117c

```
C----------------BUTTERFLIES WITH SAME W---------------
      DO 30 I1 = J, N, N1
          I2 = I1 + N2
          I3 = I2 + N2
          I4 = I3 + N2
          I5 = I4 + N2
          I6 = I5 + N2
          I7 = I6 + N2
          I8 = I7 + N2
          R1 = X(I1) + X(I5)
          R5 = X(I1) - X(I5)
          R2 = X(I2) + X(I6)
          R6 = X(I2) - X(I6)
          R3 = X(I3) + X(I7)
          R7 = X(I3) - X(I7)
          R4 = X(I4) + X(I8)
          R8 = X(I4) - X(I8)


C-----------DIGIT REVERSE COUNTER----------
  100     J = 1
          N1 = N - 1
          DO 104 I = 1, N1
              IF (I.GE.J) GOTO 101
              R1   = X(J)
              X(J) = X(I)
              X(I) = R1
              R1   = Y(J)
              Y(J) = Y(I)
              Y(I) = R1
 101          K = N/4
 102          IF (K*3.GE.J) GOTO 103
                  J = J - K*3
                  K = K/4
                  GOTO 102
 103          J = J + K
 104      CONTINUE
          RETURN
          END
```

FIG. 118

INITIAL MISSILE SIZING TO MEET RANGE, VELOCITY, AND MANEUVERABILITY REQUIREMENTS DONE WITH CLOSE FORM SOLUTIONS

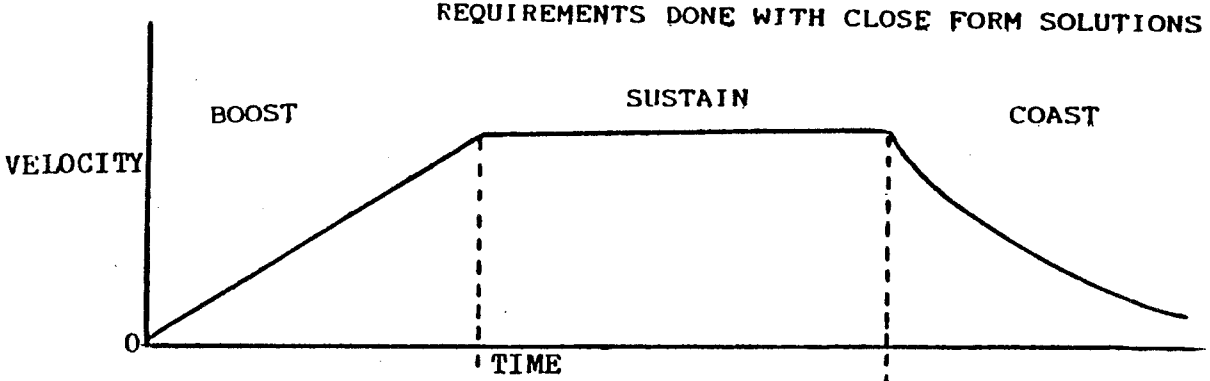

BOOST $$M\dot{V} = T - \tfrac{1}{2}pV^2SC_D$$

$$T >> \tfrac{1}{2}pV^2SC_D$$

$$M = Mf - \dot{M}t$$

$$\dot{V} = \frac{T}{Mf - Mt}$$

$$V = \frac{T}{\dot{M}} \log \frac{\dot{M}f}{Mf - \dot{M}t}$$

$$Vb = g\ Isp \log \frac{Wf}{We}$$

SUSTAIN $$M\dot{V} = 0$$

$$T = \tfrac{1}{2}pVs^2SC_D$$

$$\frac{T \cdot t}{Ws} = Isp = \tfrac{1}{2}p \frac{VsSC_DR}{Ws}$$

$$Rs = \frac{2Ws\ Isp}{p\ VsSC_D}$$

COAST $$M\dot{V} = \tfrac{1}{2}pV^2SC_D$$

$$\frac{\dot{V}}{V} = \tfrac{1}{2}p \frac{RSC_Dg}{We}$$

$$V = Vs\ e^{-\frac{1}{2}p \frac{C_DSgRc}{We}}$$

$$R = \frac{2We}{pC_DSg} \log \frac{Vs}{\dot{V}}$$

$$N = \tfrac{1}{2}p \frac{V^2SCN}{W}$$

$C_D$-DRAG COEFFICIENT
CN-NORMAL FORCE COEFFICIENT
Isp-SPECIFIC IMPULSE (SEC)
=TOTAL IMPULSE / PROPELLANT WEIGHT
V-VELOCITY
Vb-END OF BOOST VELOCITY
Vs-SUSTAIN VELOCITY
W-WEIGHT
M-MASS
Wf-FULL WEIGHT
Mf-FULL MASS
We-EMPTY WEIGHT
Ws-SUSTAINER PROPELLANT WEIGHT
R-RANGE
P-AIR DENSITY
S-REFERENCE AREA
T-THRUST
g-ACCELERATION DUE TO GRAVITY
N-MANEUVERABILITY
Rs-RANGE DURING SUSTAIN
Rc-RANGE DURING COAST

FIG. 119

TIME FOR MISSILE SEEKER TARGET ACQUISITION CAN BE AS LONG AS THE TERMINAL GUIDANCE TIME

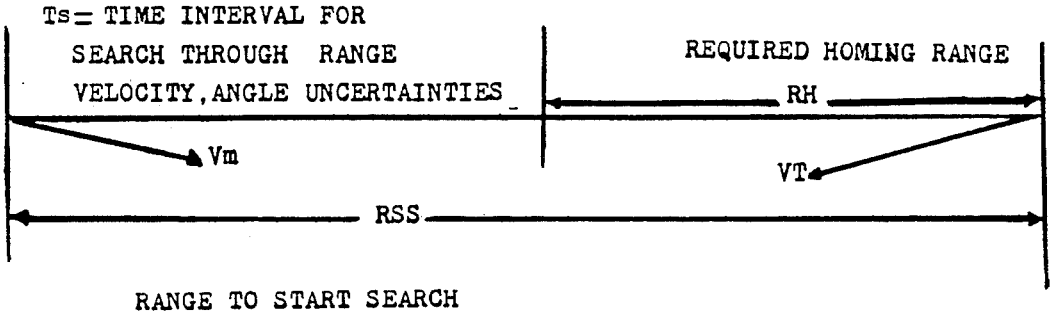

RANGE TO START SEARCH $RSS = RH + Vc\ Ts$ ($Vc$ = CLOSING VELOCITY MAGNITUDE)

RECEIVER PROCESSING BANDWIDTH, $\Delta f$ WILL BE

PROPORTIONAL TO $\frac{1}{\text{DWELL TIME}} = \frac{\text{NUMBER OF LOOKS}}{Ts}$

| TYPE SYSTEM | UV/LASER/IR | SEMI-ACTIVE RADAR | ACTIVE RADAR |
|---|---|---|---|
| SIGNAL POWER | $S \propto \frac{1}{(RH+VcTs)^2}$ | $S \propto \frac{1}{(RH+VcTs)^2}$ | $S \propto \frac{1}{(RH+VcTs)^4}$ |
| NOISE POWER | $N \propto \sqrt{\Delta f} \propto \frac{1}{\sqrt{Ts}}$ | $N \propto \Delta f \propto \frac{1}{Ts}$ | $N \propto \Delta f \propto \frac{1}{Ts}$ |
| Ts FOR MAX.S/N | $Ts = \frac{RH}{3Vc}$ | $Ts = \frac{RH}{Vc}$ | $Ts = \frac{RH}{3Vc}$ |

MAXIMIZE S/N BY FINDING Ts FOR $\frac{2\ S/N}{2\ Ts} = 0$

FOR TERMINAL GUIDANCE MOST MISSILES USE PROPORTIONAL NAVIGATION

THE BASIC PROPORTIONAL NAVIGATION EQUATION $$A_M = V\dot{\gamma}_M = \lambda \dot{R} \dot{\sigma}$$

MISSILE MANEUVER

NAVIGATION RATIO

CLOSING VELOCITY

LINE OF SIGHT RATE

GUIDANCE AUTOPILOT

SEEKER FILTER $G_A(S)$ $G_S(S)$ $G_F(S)$

GUIDANCE RESPONSE

= VELOCITY LINE OF SIGHT RANGE

FIG. 121

DERIVATION OF $A_m/\dot{\sigma}$ TRANSFER FUNCTION

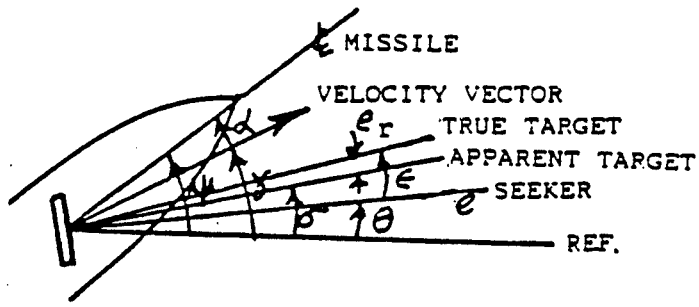

GEOMETRIC TRACK ERROR $\epsilon = \sigma - \theta$

RADOME BORESIGHT ERROR $\epsilon_r = r(\sigma - \psi)$

MEASURE TRACK ERROR $\epsilon' = \epsilon + \epsilon_r = \sigma - \theta + r(\sigma - \psi)$ ANGLE OF ATTACK $\alpha = \psi - \gamma$ AERODYNAMIC LIFT $A_M = V_M \dot{\gamma} \equiv V_M M \alpha = A V_M (\psi - \gamma); = A$ $A$ = LIFT COEFFICIENT $$\psi = \left(\frac{S}{A} + 1\right)\gamma \text{ or } \dot{\psi} = \left(\frac{S}{A} + 1\right)\frac{A_M}{V_M}$$

IDEAL TRACK LOOP $\dot{\theta} = Ks\,\epsilon'\,Ks(\sigma - \theta + r(\sigma - \psi))$ MEASURED LINE OF SIGHT RATE $\dot{\theta} = \dfrac{\dot{\sigma} + r\dot{\sigma} - r\dot{\psi}}{S/Ks + 1}$

GUIDANCE EQUATION AND AUTOPILOT $$A_M = \frac{\Lambda |\dot{R}|\,\dot{\theta}}{1 + 2T_A S + 2T_A{}^2 S^2 + T_A{}^3 S^3}$$

$$= \frac{|\dot{R}|((1 + r)\dot{\sigma} - r\dot{\psi})}{(1 + 2T_A S + 2T_A{}^2 S^2 + T_A{}^3 S^3)(1 + S/Ks)}$$

SUBSTITUTING FOR $\dot{\psi}$; $\dfrac{A_M}{\dot{\sigma}} =$ $$\frac{R(1 + r)}{1 + \frac{\Lambda|\dot{R}|}{V_M} r + \left(2T_A + \frac{1}{Ks} + \frac{\Lambda|\dot{R}|r}{V_M A}\right)S + \left(2T_A{}^2 + \frac{2T_A}{Ks}\right)S^2 + \left(T_A{}^3 + \frac{2T_A}{Ks}\right)S^3 + \frac{T_A{}^3}{Ks} S^4}$$

FIG. 122
THE RADOME ERROR SLOPE CAN BE THE DOMINANT FACTOR IN THE GUIDANCE RESPONSE TIME
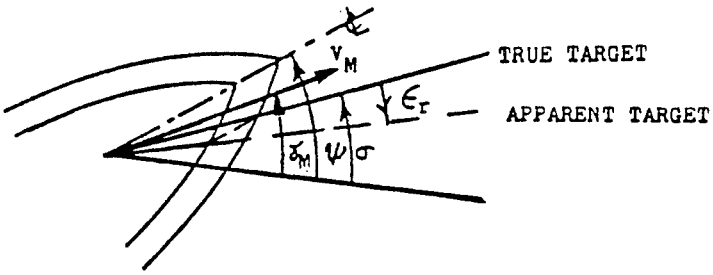
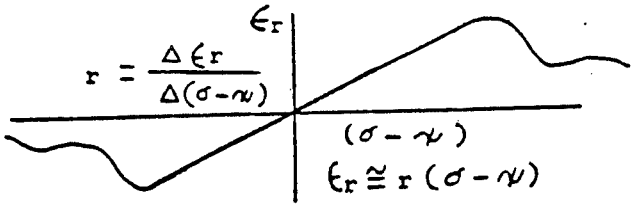
r = RADOME ERROR SLOPE
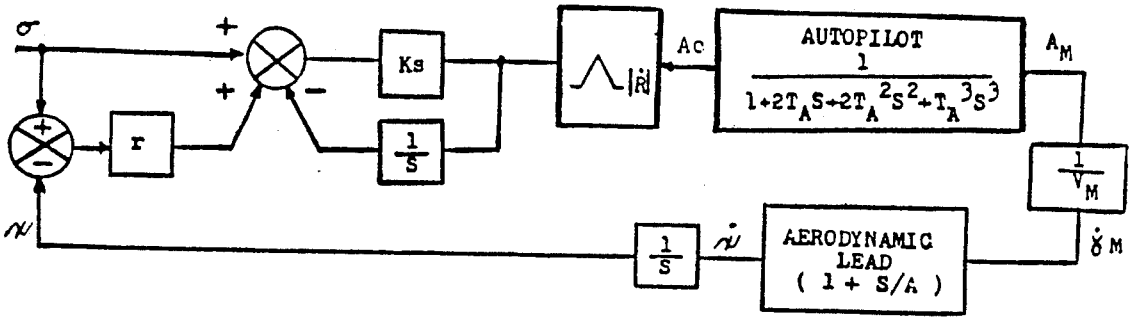
$$\frac{A_M}{\dot{\sigma}} = \frac{\Lambda|\dot{R}|(1+r)}{1 + \frac{r|\dot{R}|}{V_M} r + (2T_A + \frac{1}{Ks} + \underbrace{\frac{R\,r}{V_M A}})S + (2T_A^2 + \frac{2T_A}{Ks})S^2 + (T_A^3 + \frac{2T_A^2}{Ks})S^3 + \frac{T_A^3}{Ks}S^4}$$
WITH $\frac{R}{V_M} = 6$, $r \pm 02$, $\frac{1}{A} = 10$, THIS TERM CAN BE $\pm$ 1.2 SECONDS

MOBILE ASSAULT LOGISTIC KINETMATIC ENGAGEMENT DEVICE

BACKGROUND OF THE INVENTION

1. Field of the Invention

The scope of the invention resides in the application of portable-mobile weapons platforms coupled to jet and/or rocket engines.

2. Description of the Prior Art

The prior art consists of portable-mobile-multiple weapons platforms and delivery systems. Existing systems are the Anti-Assault Submersible Vehicular Device Ser. No. 019,069, the Interactive Transector Device Commercial and Military Grade Ser. No. 090,036 and the Multiple Amplitude Logistic Kinetmatic Emitter Ser. No. 863,685. Further examples of multiple weapons platforms, M.I.R.V. systems, submarines, multiple rocket launchers and similar systems are known by those skilled in the art. Additionally, within the field of the invention are turbine engines powered by nuclear and plasma power sources and other similar systems known to exist by those skilled in the art.

SUMMARY OF THE INVENTION

The Multiple Assault Logistic Kinetmatic Engagement Device also referred to as M.A.L.K.E. device is a portable-mobile weapons deployment system. A nuclear power source coupled to generators, magnetic hydrodynamic preferably (MHD) systems provides a continuous source of electrical power to an array of plasma engines, Hybrid Mass Action Driver (MAD) systems and a full compliment of energy weapons. Other sources of power consist of solar energy coupled to rechargible lithium batteries for limited intermittent operations. The main sources of propulsion excluding wheel driven tracks and subterranean concentric tracks are plasma engines. The aforesaid plasma engines consist of no fewer than six and no more than ten equivalent engines. Each said engines is powered at low sonic or subsonic speeds by piezoelectric magnetic levitation motors coupled to drive means and a power train elements rotating a turbine shaft. The aforesaid power train is engaged at lower speeds and disengaged at higher speeds when the introduction of plasma is required for deployment of said weapons. Said turbines and rotating shaft element are composed of a silicon nitride composite materials impregnated by metallics and coupled to a coolant system. Plasmitizable substances are obtained from primary and secondary reservoirs and from source materials obtained from the immediate environment surrounding said M.A.L.K.E. device. Said plasmitizable are gasified and volatilized by radiofrequency elements, microwave generators and excismer laser elements prior to undergoing plasmitization. Plasmitization is completed when said plasmitizable are introduced to a series of Tesla coil elements coupled to circularly disposed to magnetic induction means. The aforesaid Tesla elements are circumferentially arranged and discharge their plasmoids sequentially in a manner specifically designed to rotate said turbines coupled to said rotating shaft. Said Tesla unit terminate in jets and are angularly situated to alternately strike blades of the aforesaid turbine structures. The plasma exiting along said turbines provided additional thrust as the plasmoids exit from the directional nozzular structure aft of the aforemention plasma engine.

BRIEF DESCRIPTION OF THE DRAWINGS

FIGS. 1 through 8 entail pictorial representations of four perspective views of the Mobile Assault Logistic Kinetmatic Engagement Device;

FIG. 22*c* entails an exploded view of the mass action driver device described in FIGS. 21, 22.

FIG. 24*a* is a detailed perspective of a single heat exchanger grid pair;

FIG. 24*b* is a detailed illustration of four microcoiled heat exchanger elements forming in part the coiled heat exchanger units mutually disposed between the plate means of the heat exchanger grid pair described in FIG. 24*a;*

FIG. 31*d* is a detailed descriptive view of the specially prepared explosive and a proposed configuration for the hyperatomic explosive means;

FIG. 31*e* is a simplified detailed cross-sectional perspective of a single special d.c. rail assembly of the explosive means depicted in FIG. 31*d;*

FIG. 33 is a concise schematic representation of an electric field applied to a rail gun system;

FIG. 33*a* is a concise schematic representation of an electric field applied to a rail gun system;

FIGS. 54*c* to 54*k* describe the properties of white noise, the ambiguity function, active/passive system performance and related processes;

FIGS. 58 to 58*a* describe a detailed cross-sectional view of one of several automated beam splitter units;

FIG. 58*d* discloses an alternate mechanism by which depleted or damaged reflective coatings are restored within the automated mirror means;

FIG. 67*a* denotes basic structural configuration of the underlying piezoelectric focusing elements which consist of a series of mutually exclusive overlapping piezoelectric plates;

FIG. 69*a'* denotes a single view of one of the microcoiled super heat exchangers;

FIG. 69 is a detailed view of the microvents;

FIG. 69*h* is a brief circuit diagram;

FIG. 82 is a typical schematic representation of a Closed Cycle Nuclear Magnetohydrodynamic Power Generator (MHD);

FIG. 83 is a concise electrical schematic of an auxiliary timing sequencer;

Figure 84:
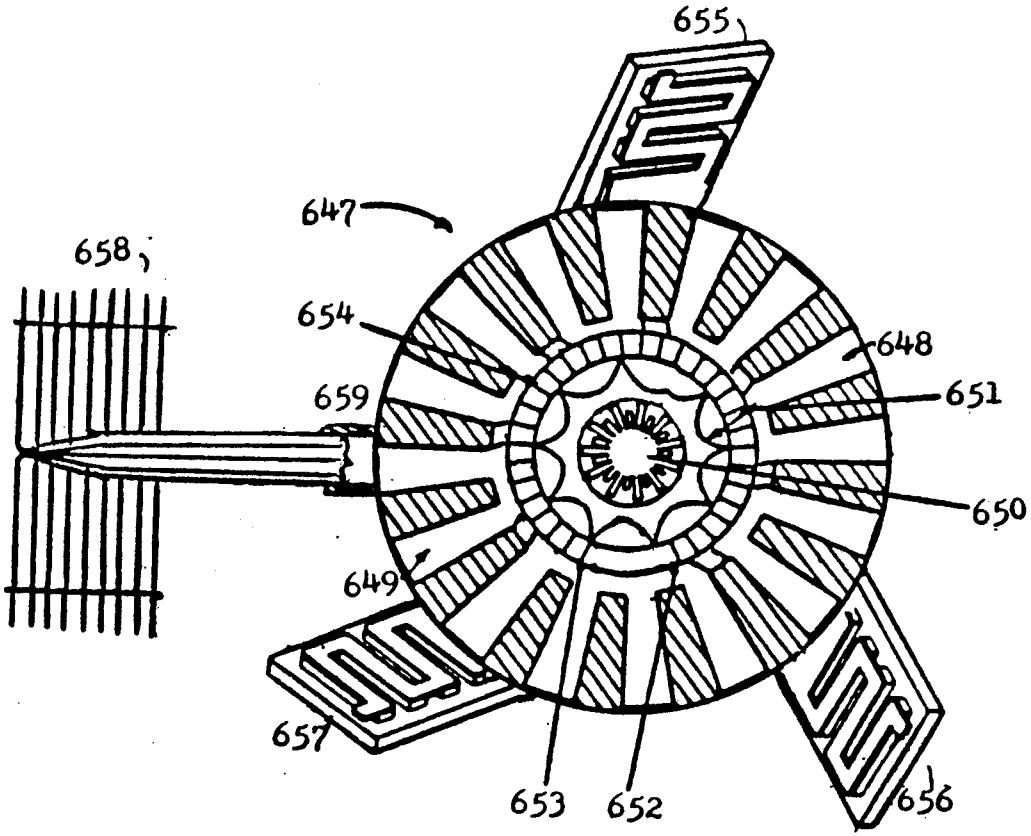
Figure 84A:
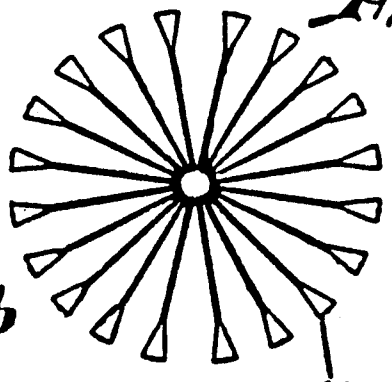
Figure 84B:
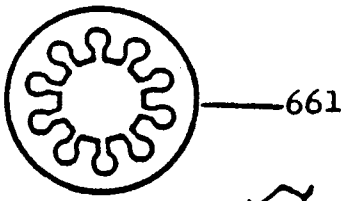
Figure 84C:
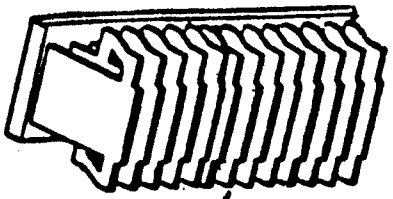
Figure 85:
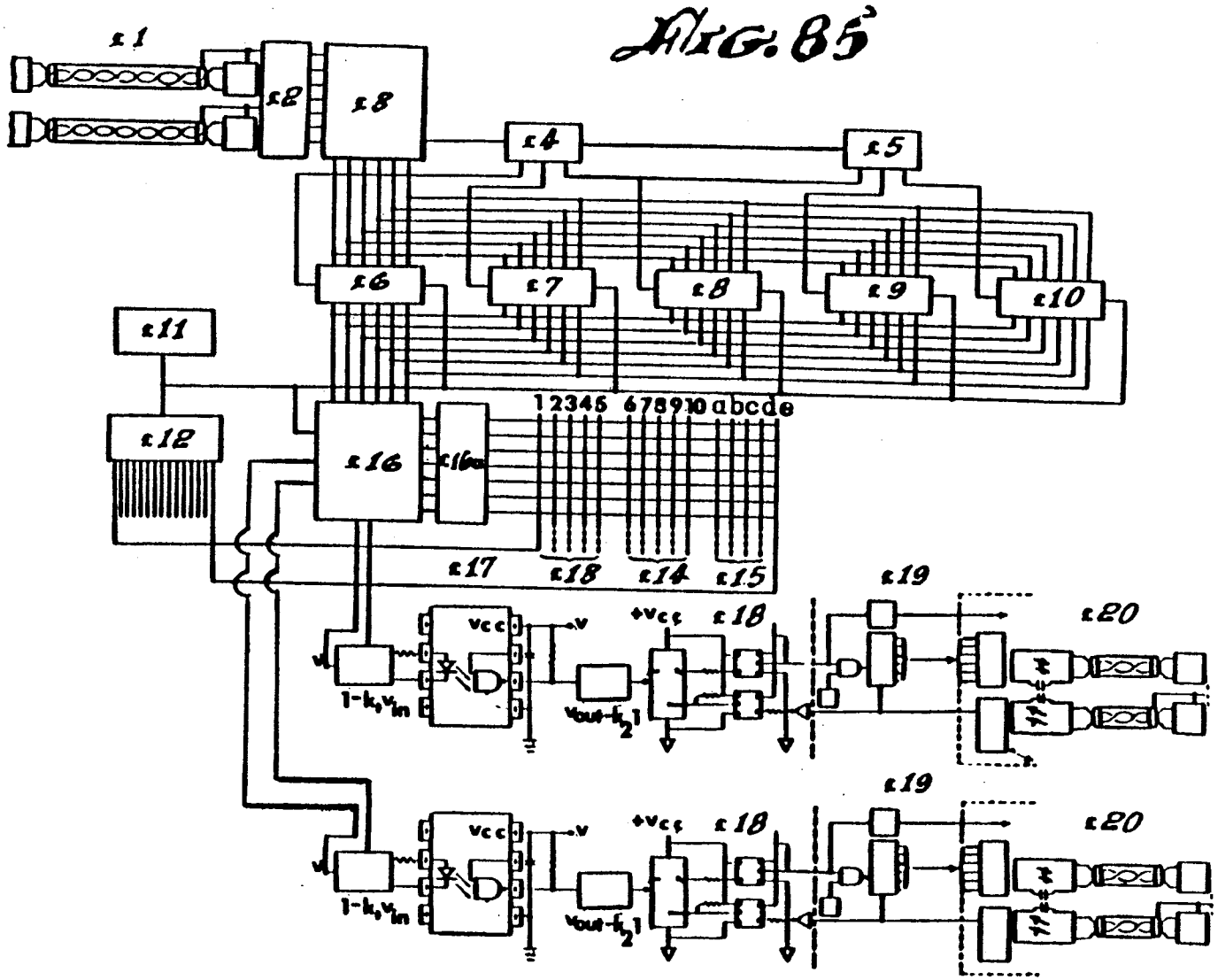
Figure 87:
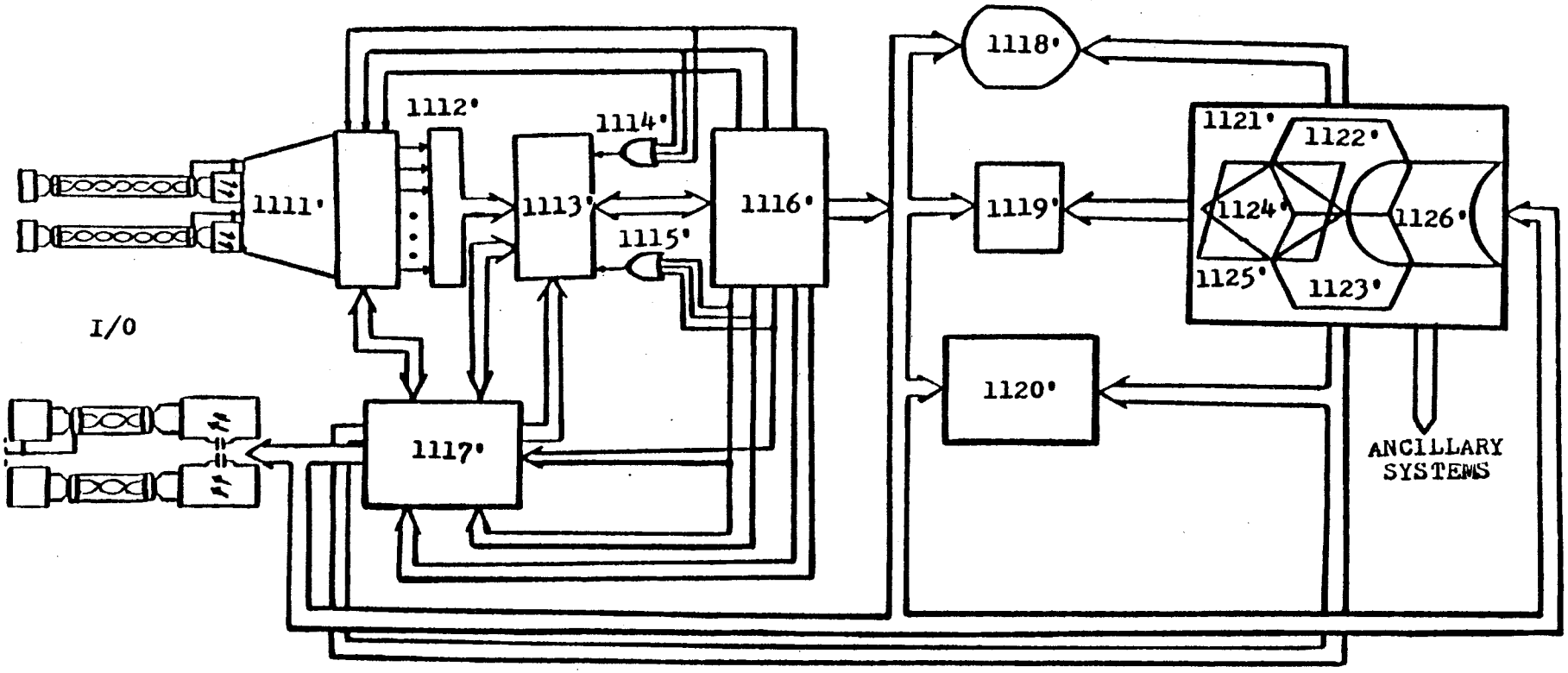
Figure 88:
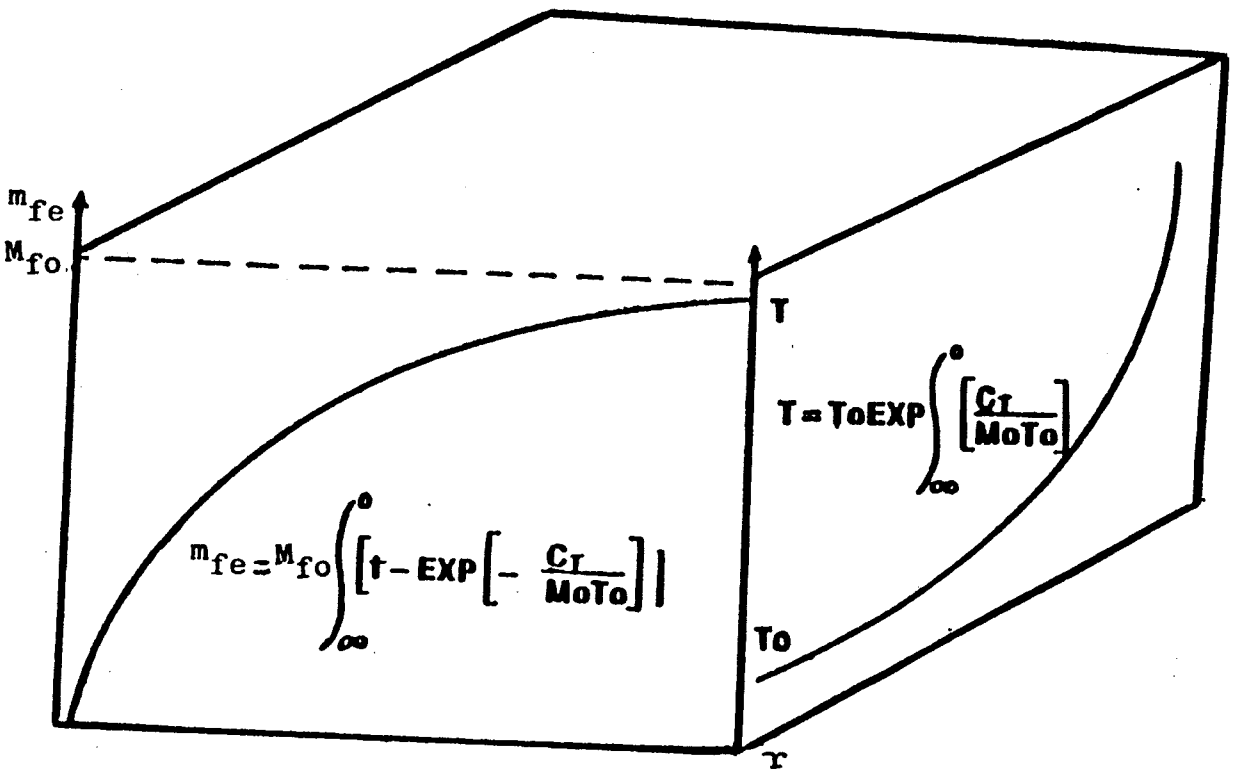
Figure 88A:
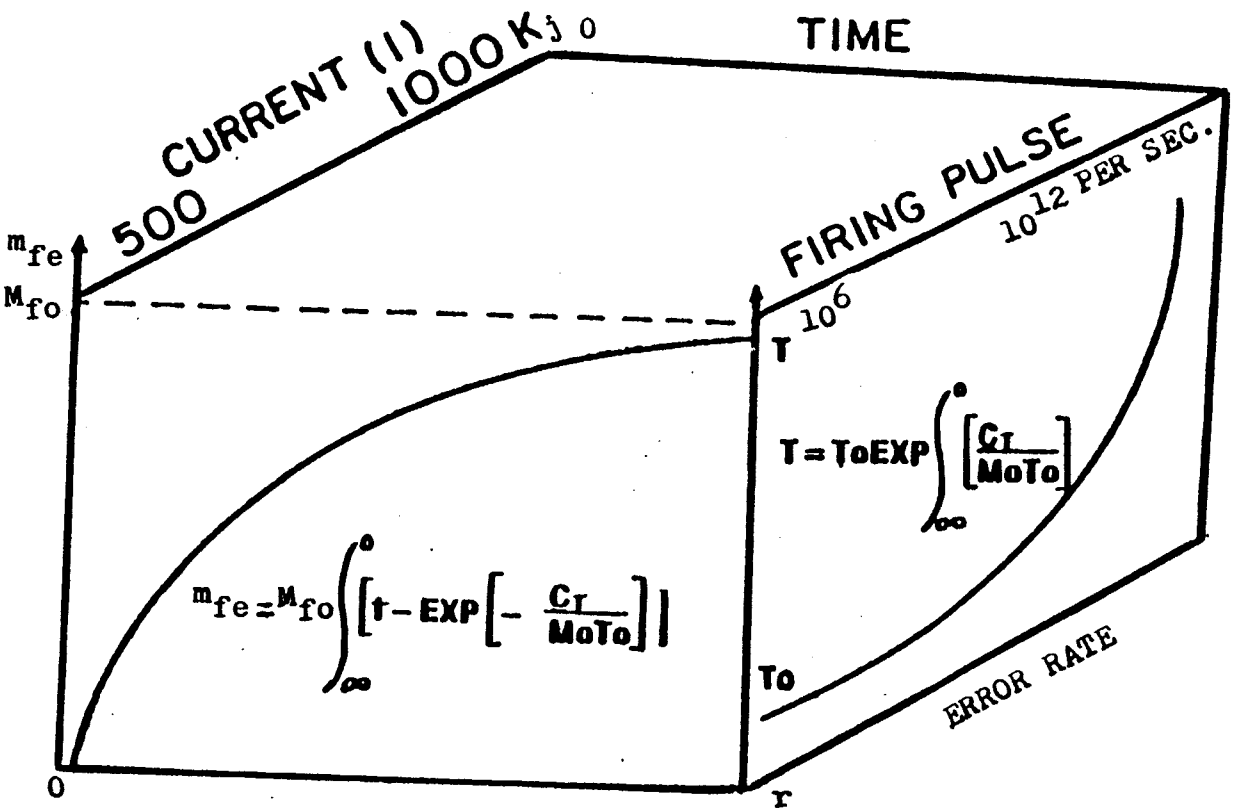
Figure 88B:
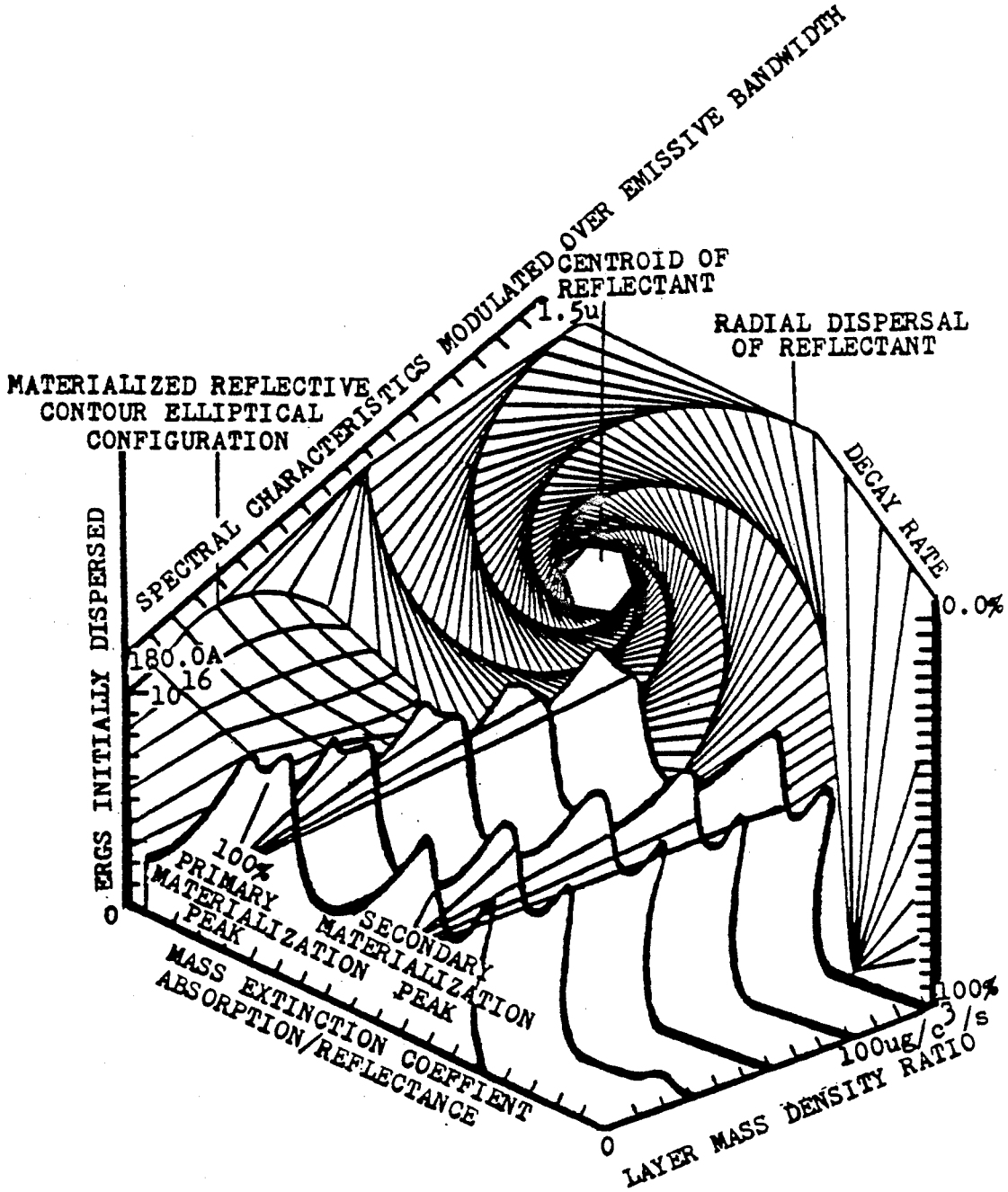
Figure 89:
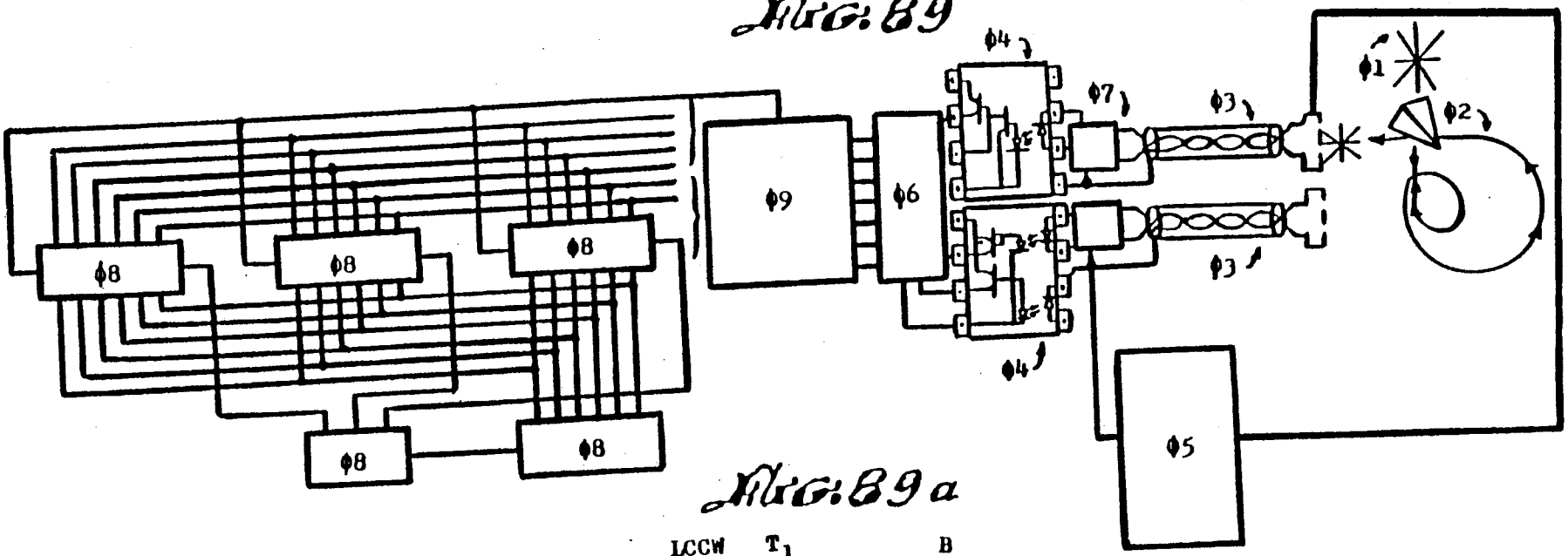
Figure 89A:
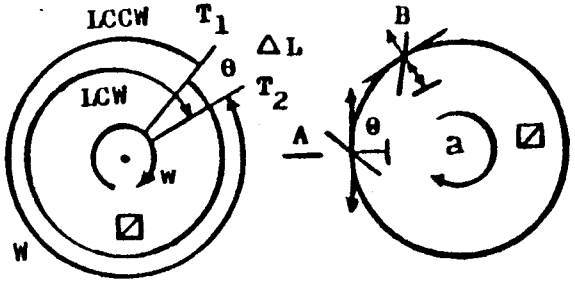
Figure 90:
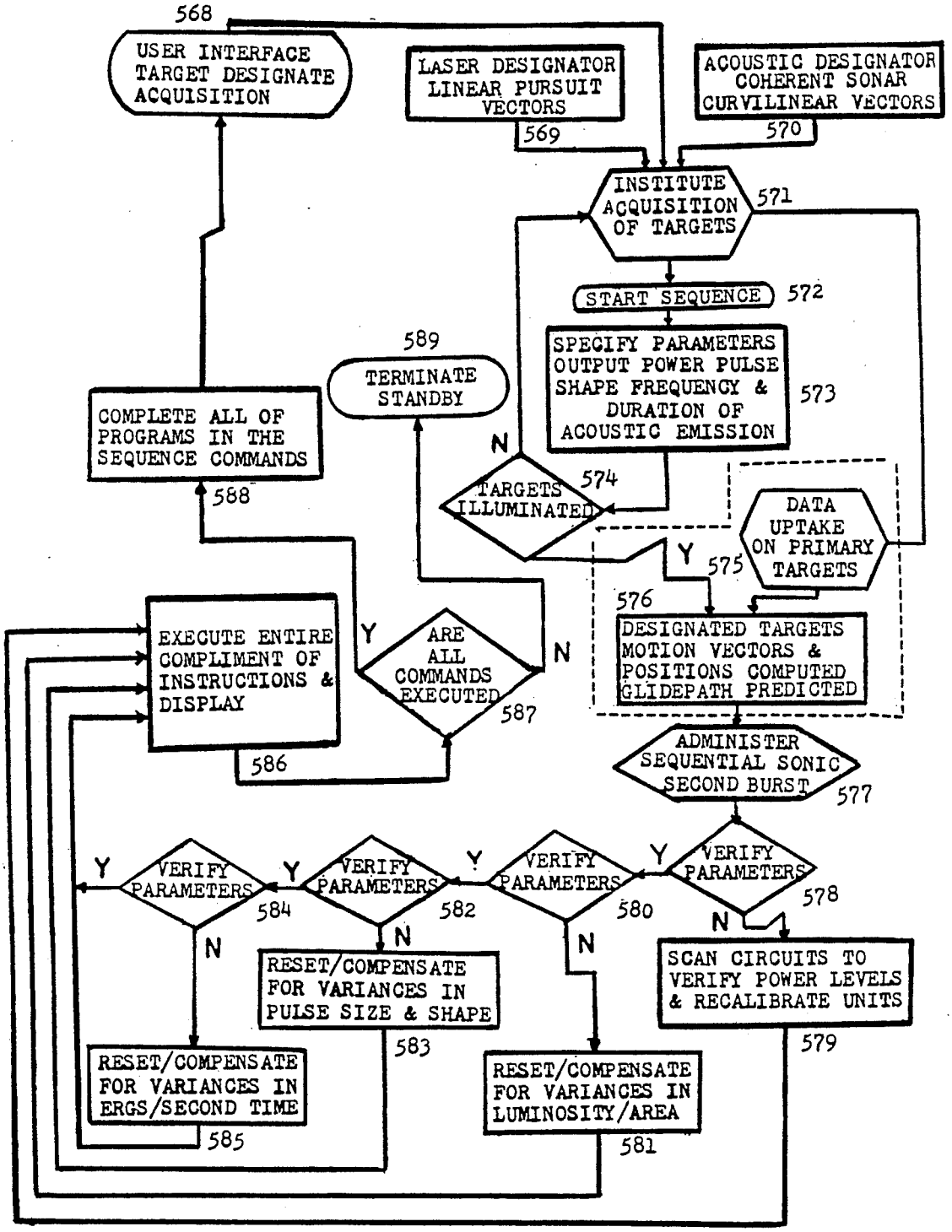
Figure 91:
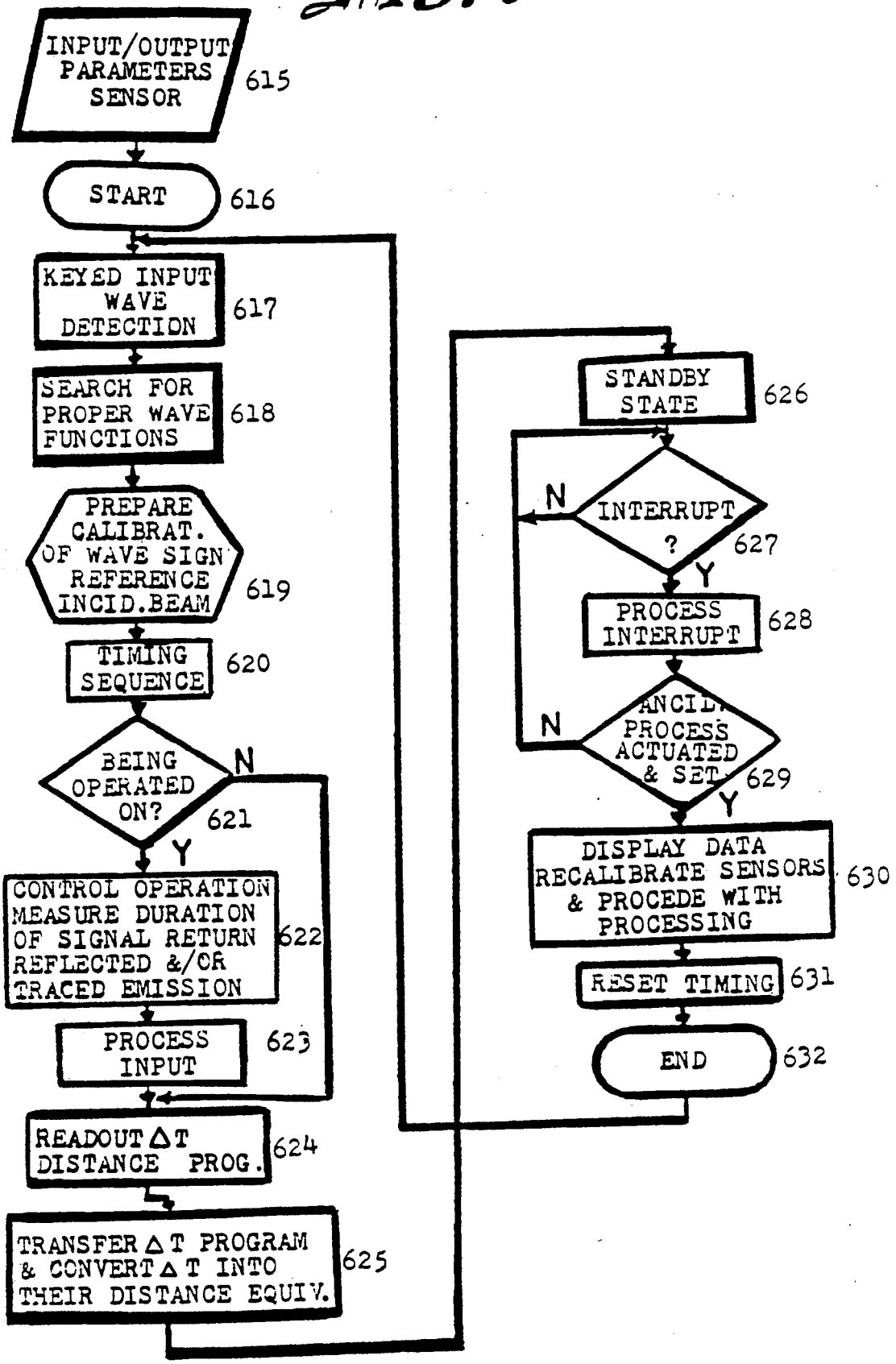
Figure 92:
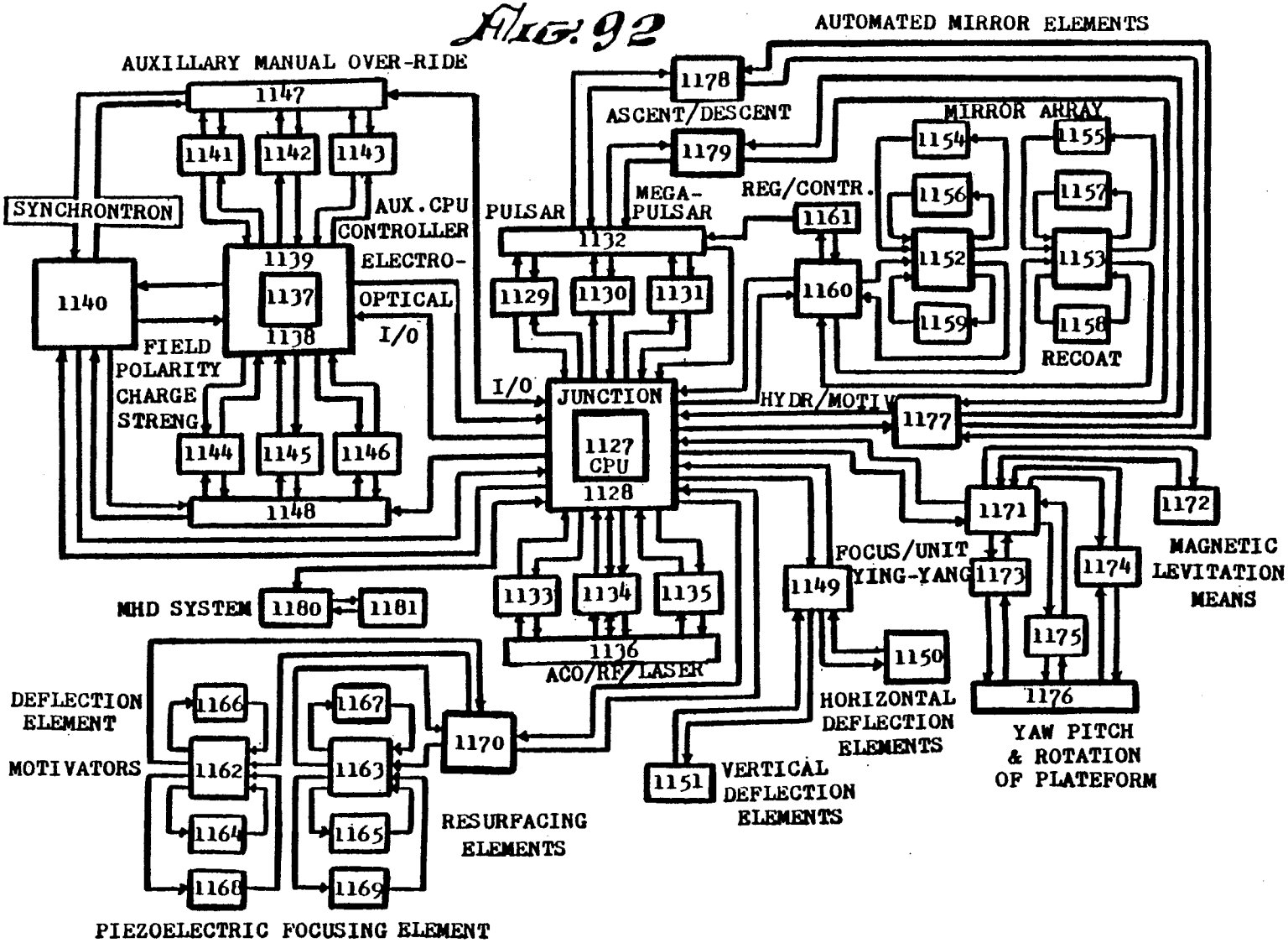
Figure 93:
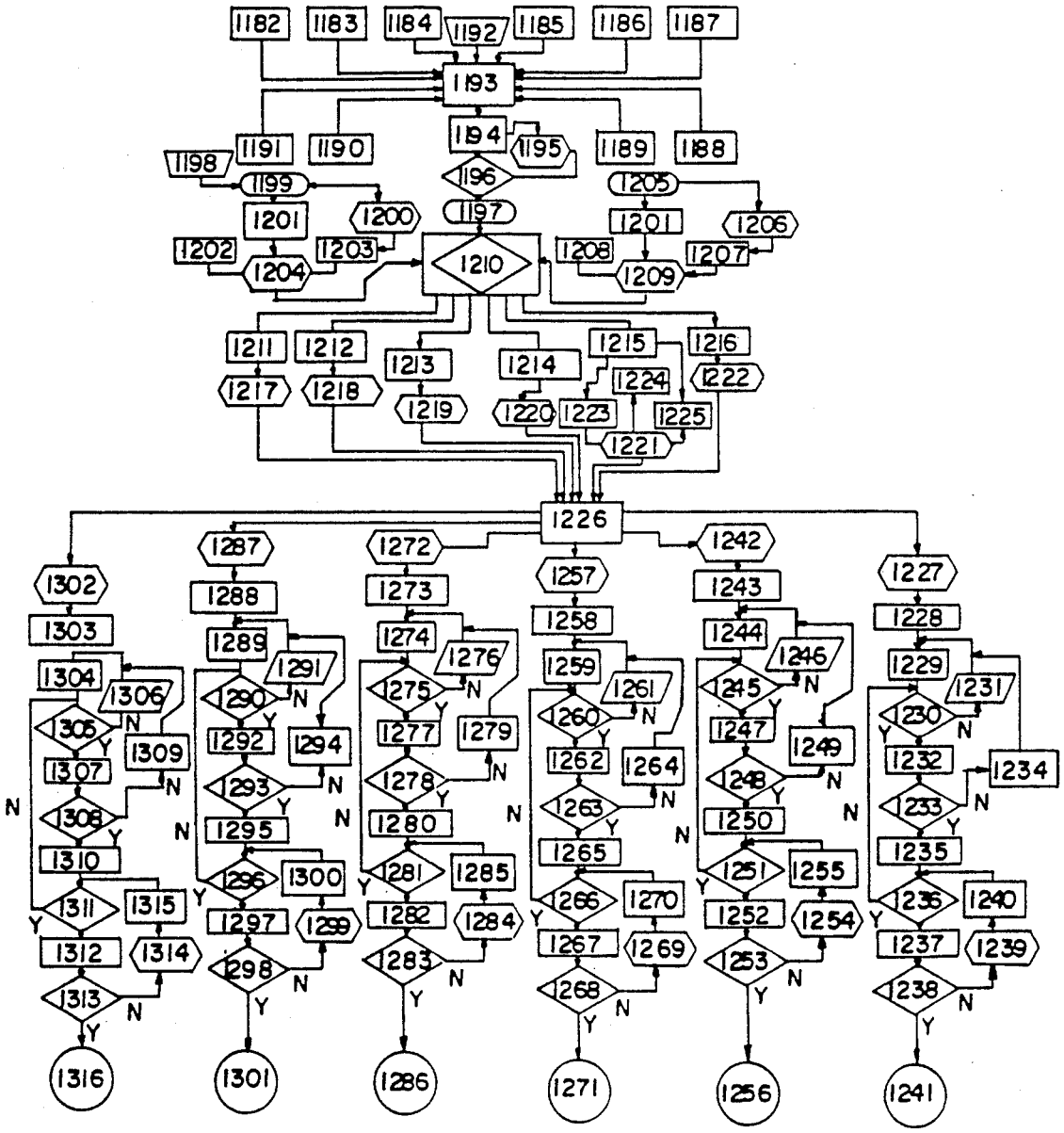
Figure 93:
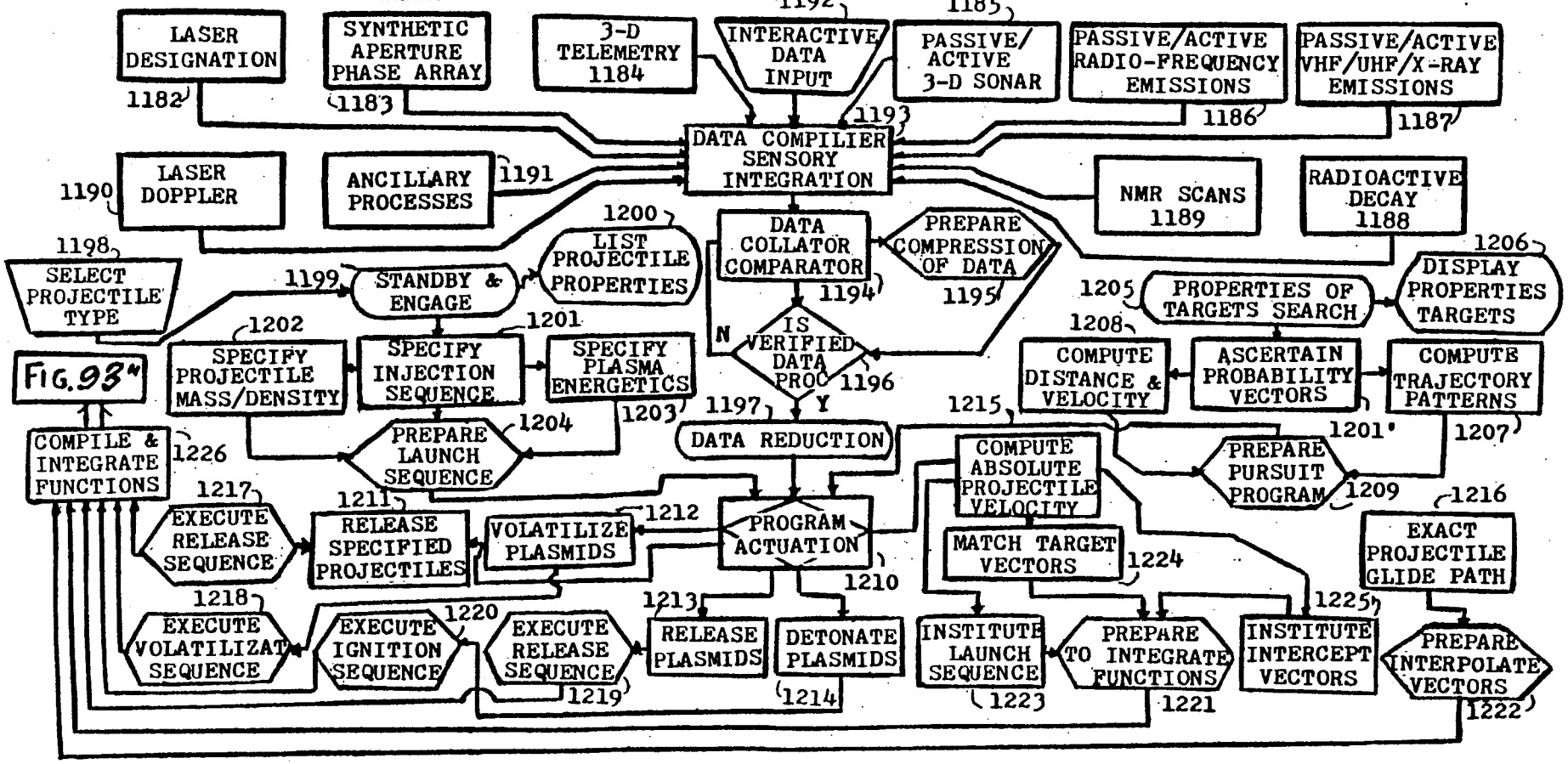
Figure 94:
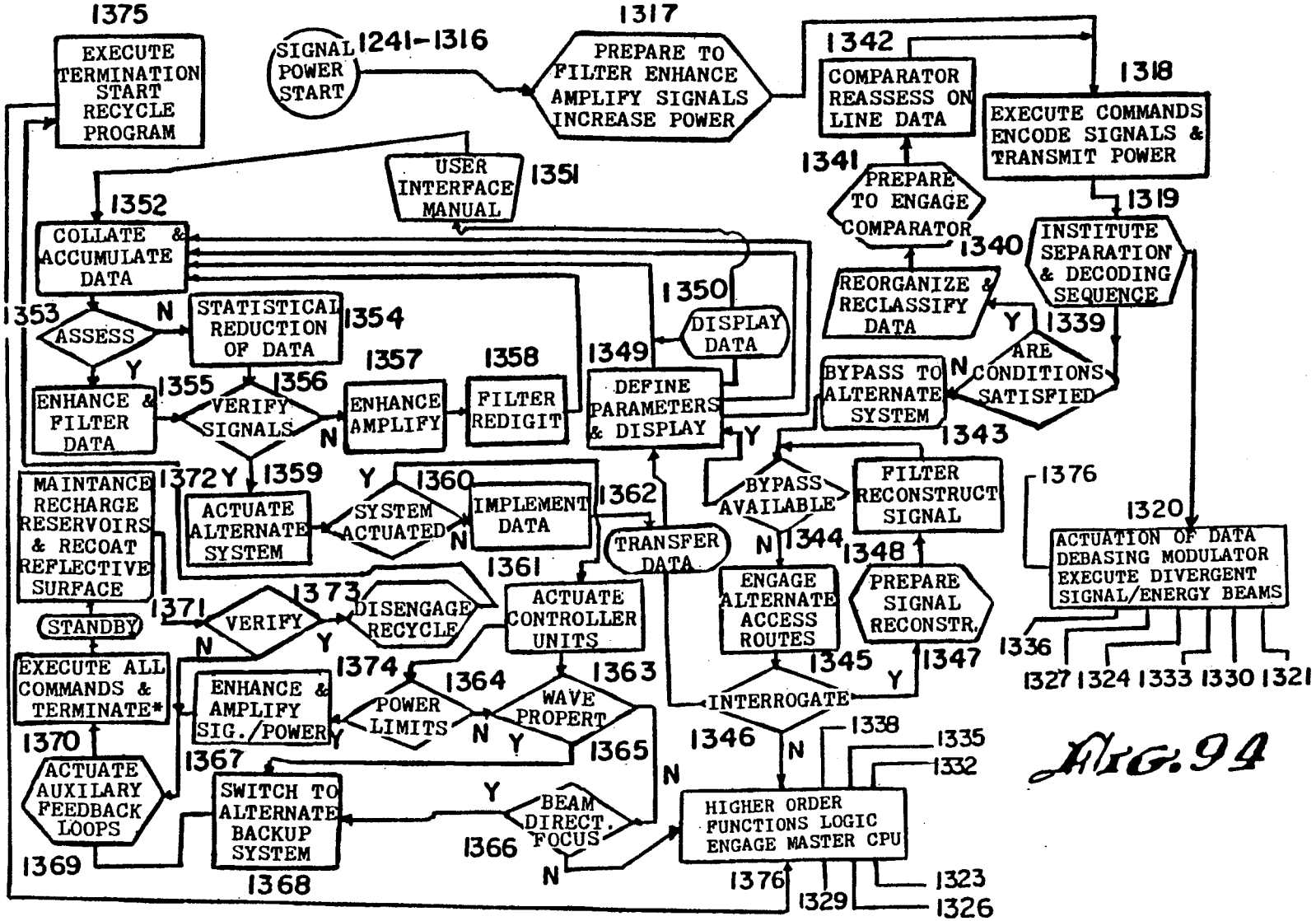
Figure 94:
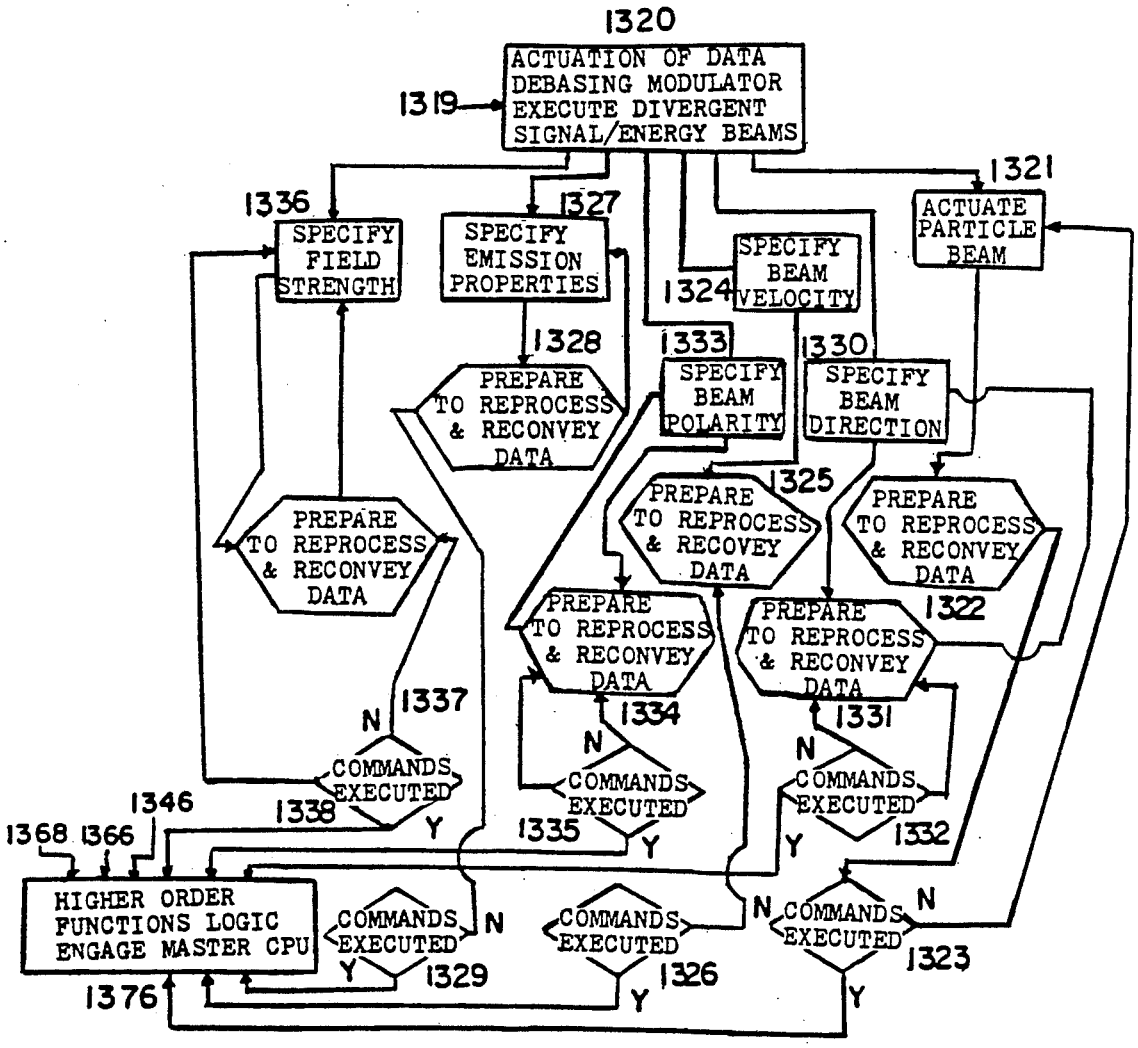
Figure 95:
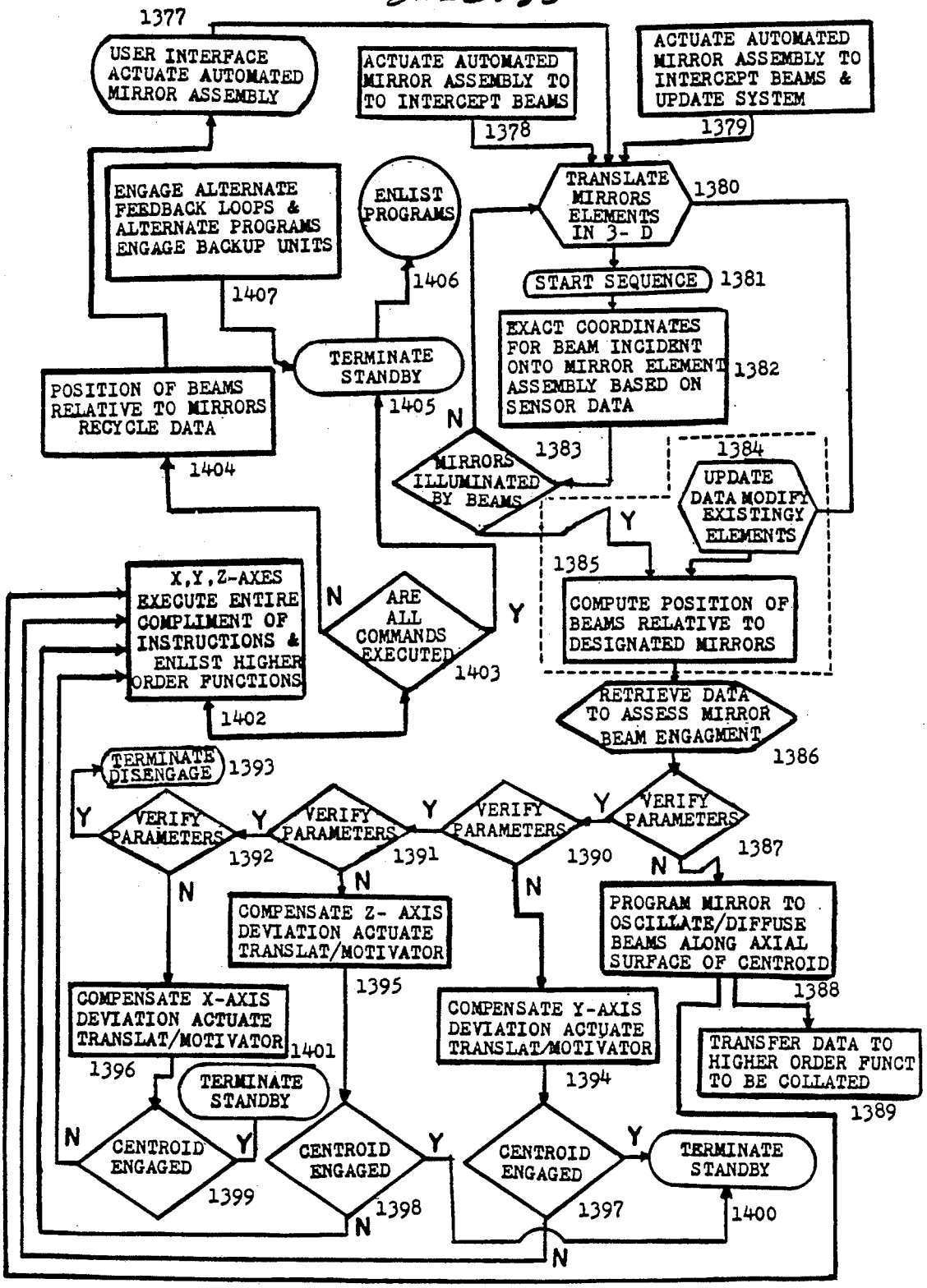
Figure 96:
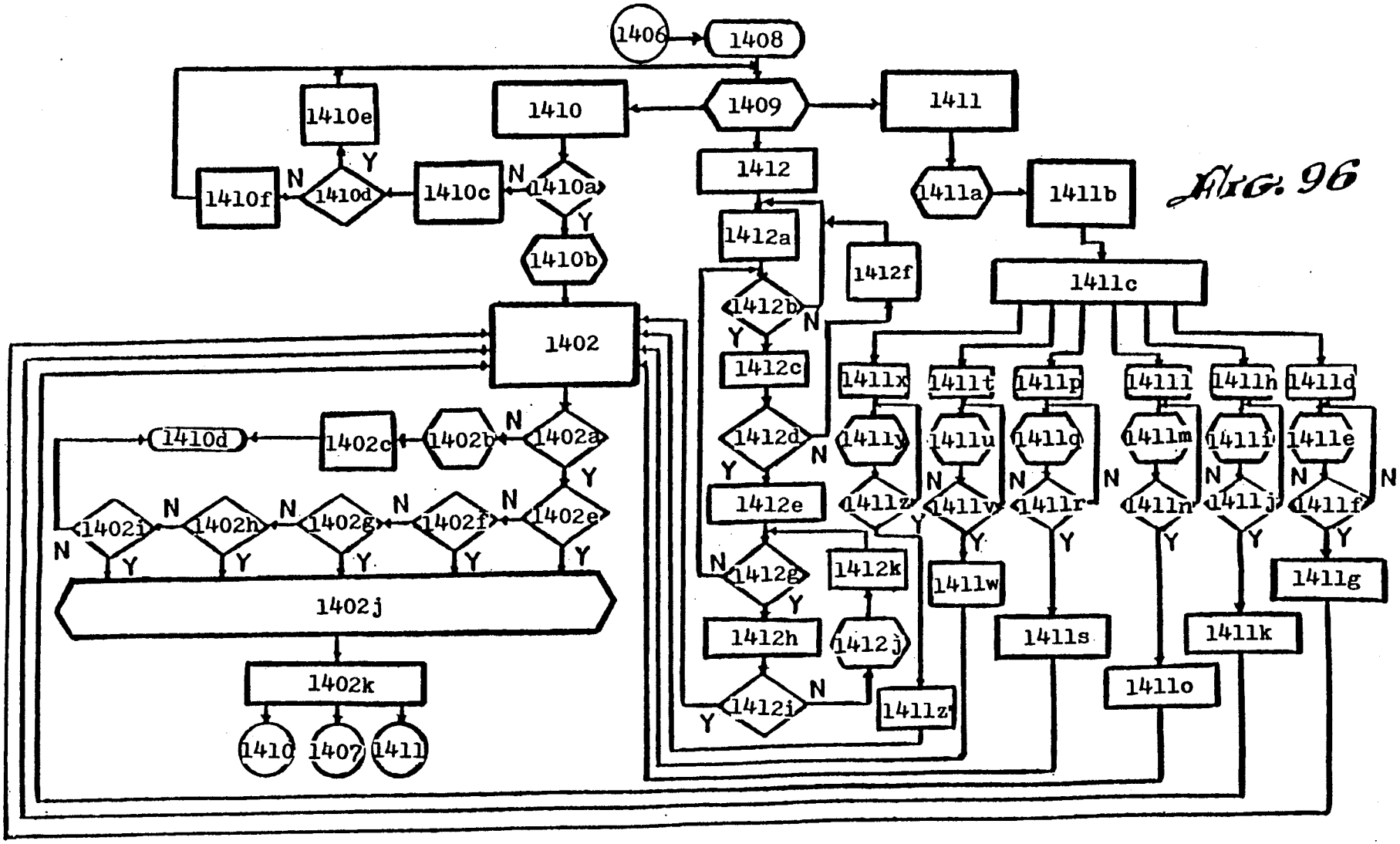
Figure 96:
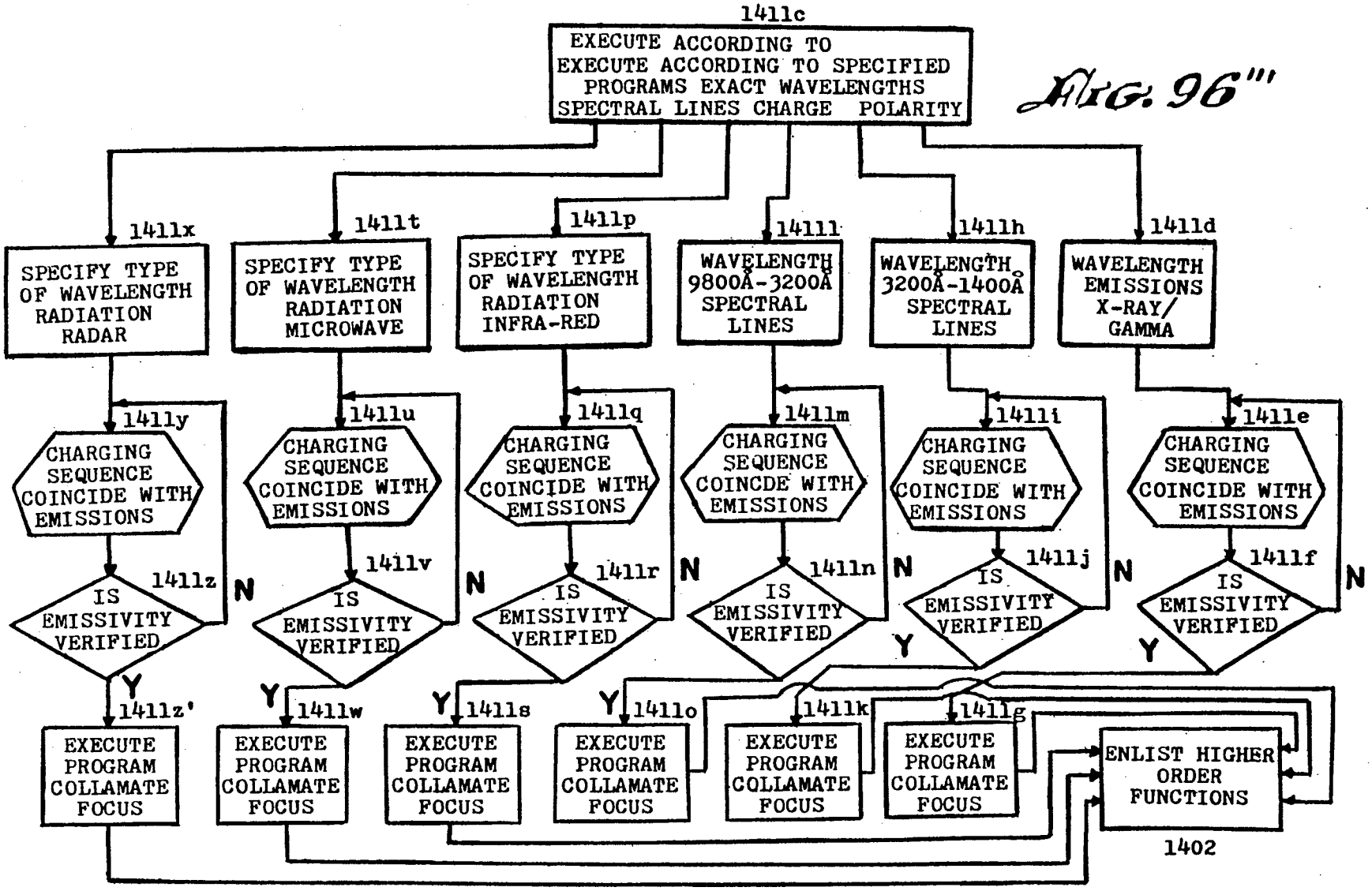
Figure 97:
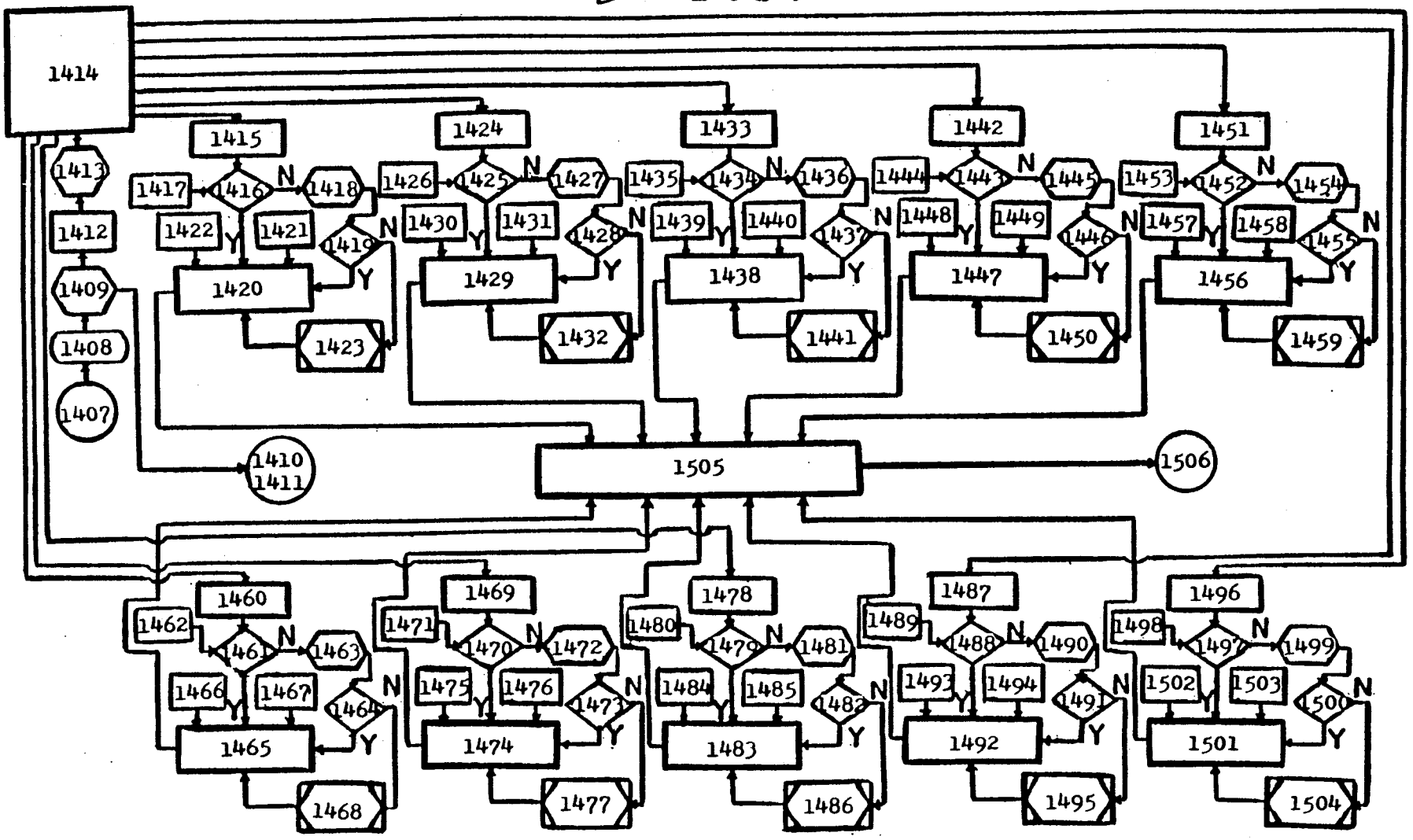
Figure 97:
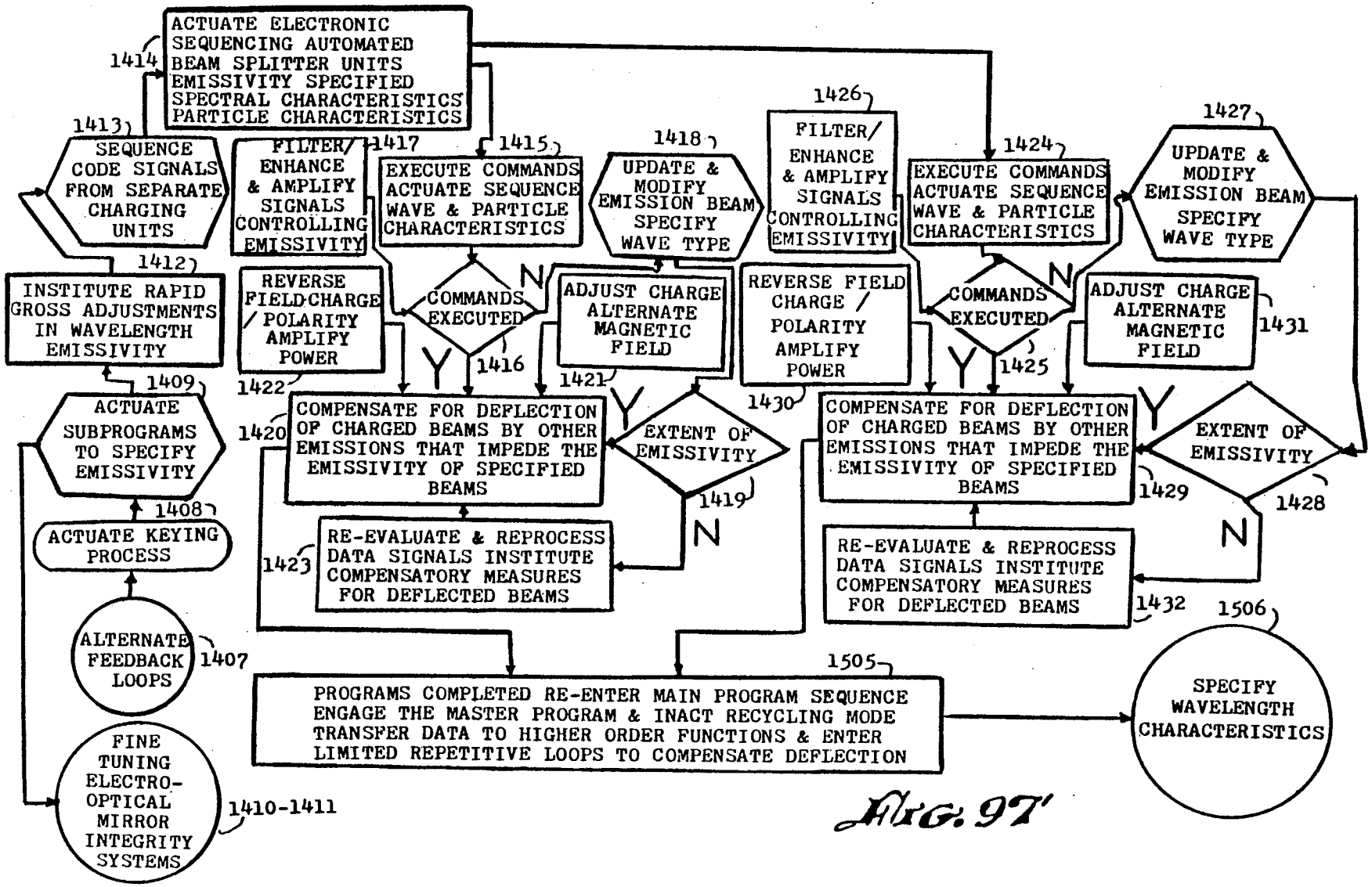
Figure 98:
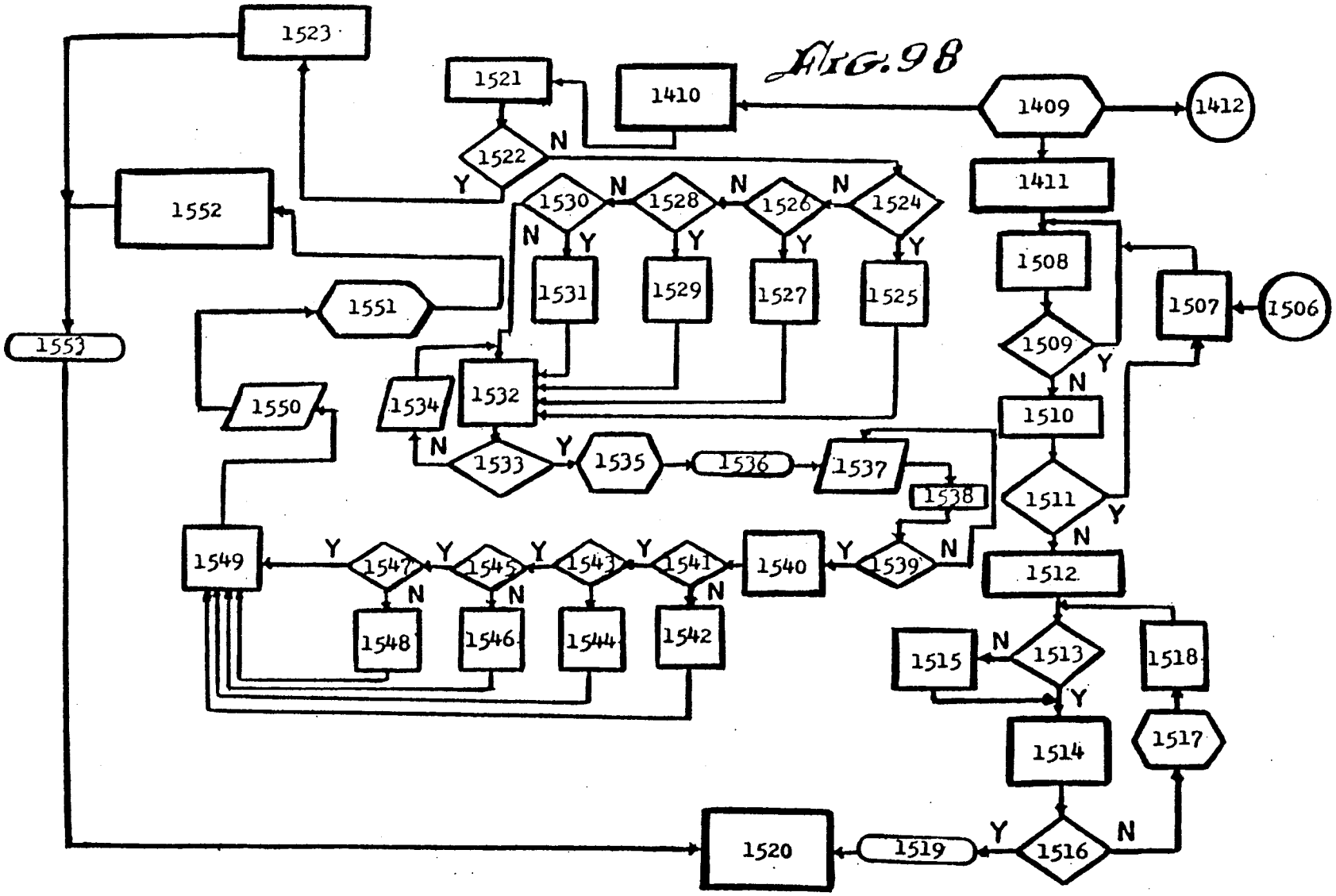
Figure 98:
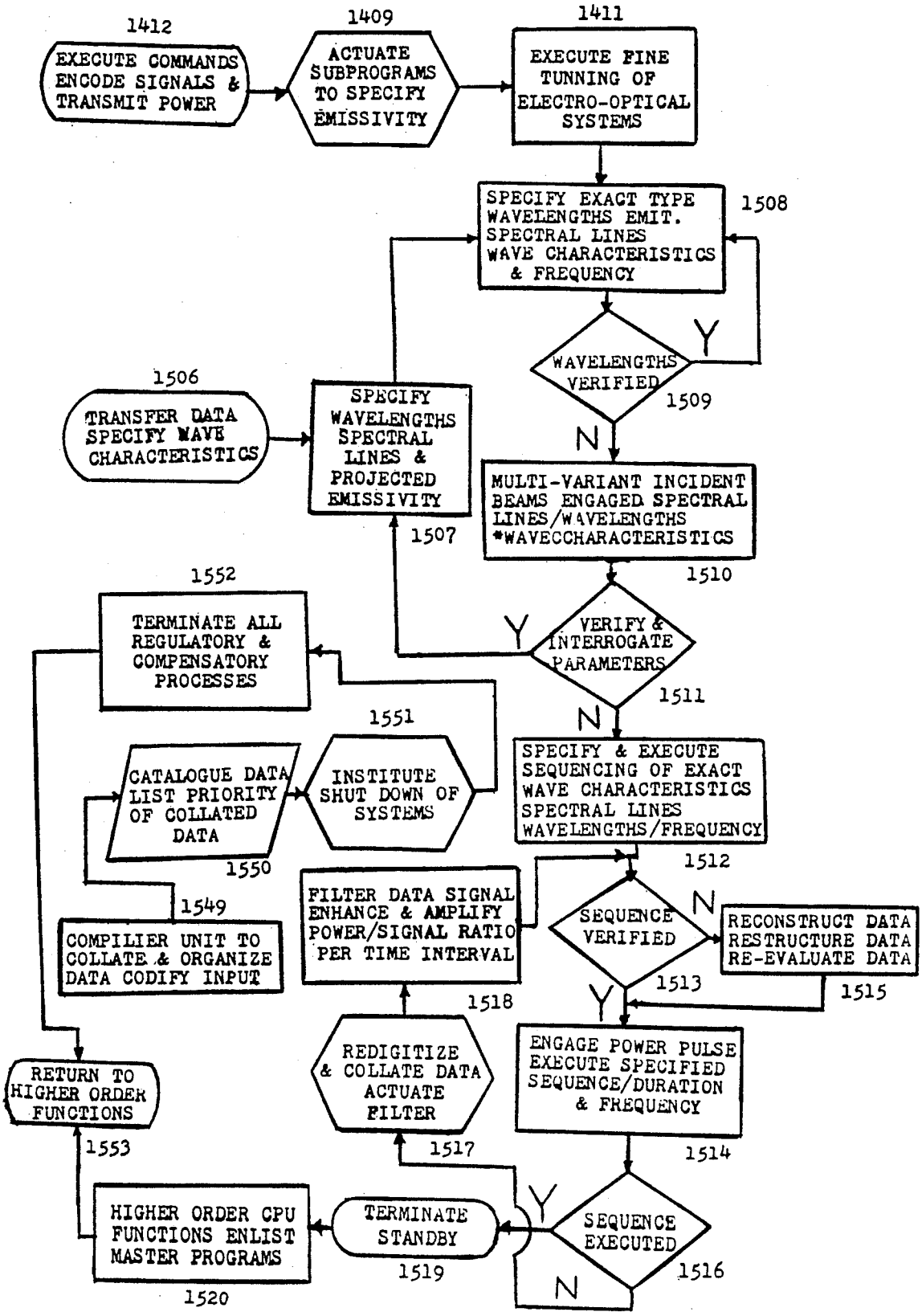
Figure 99:
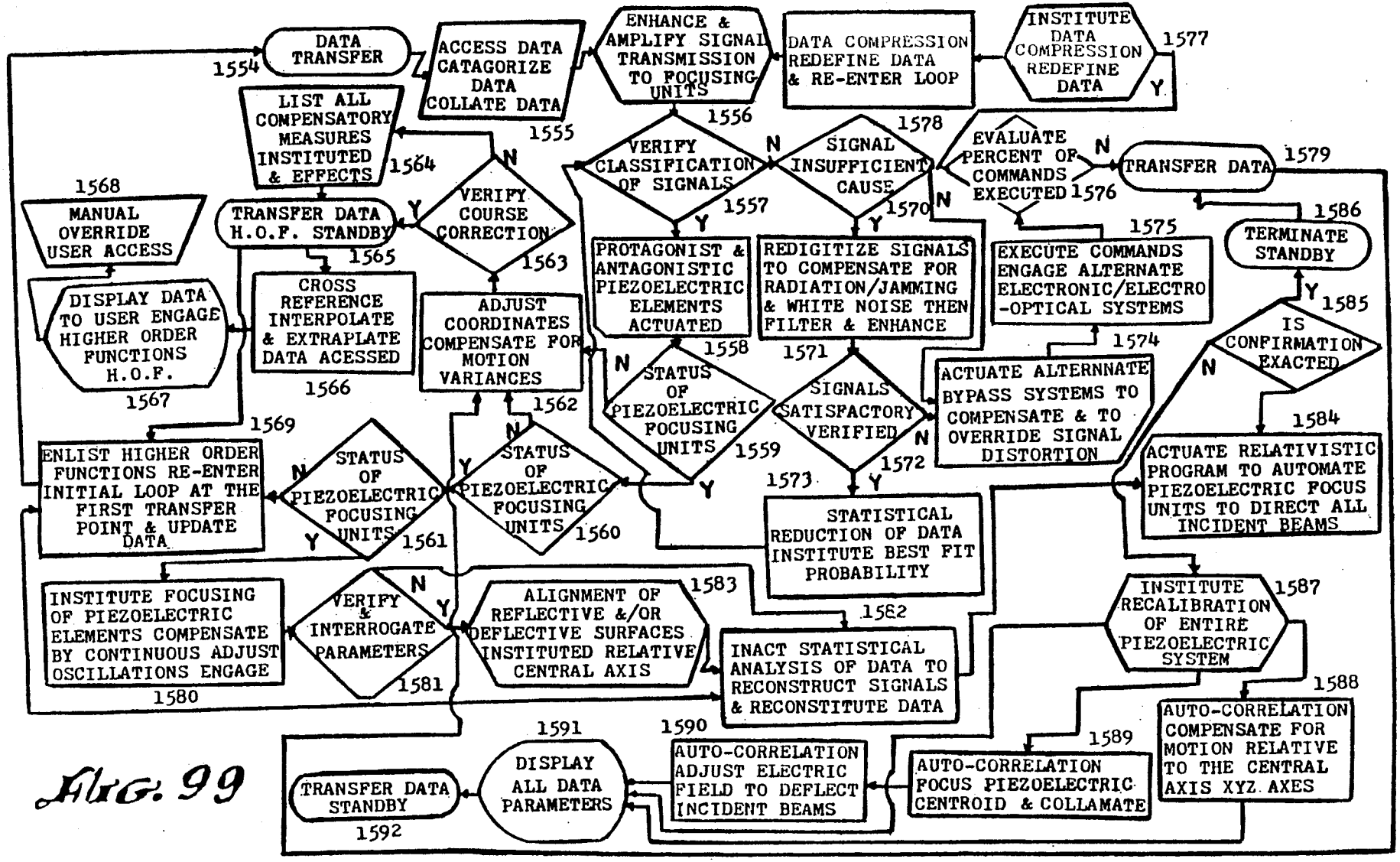
Figure 100:
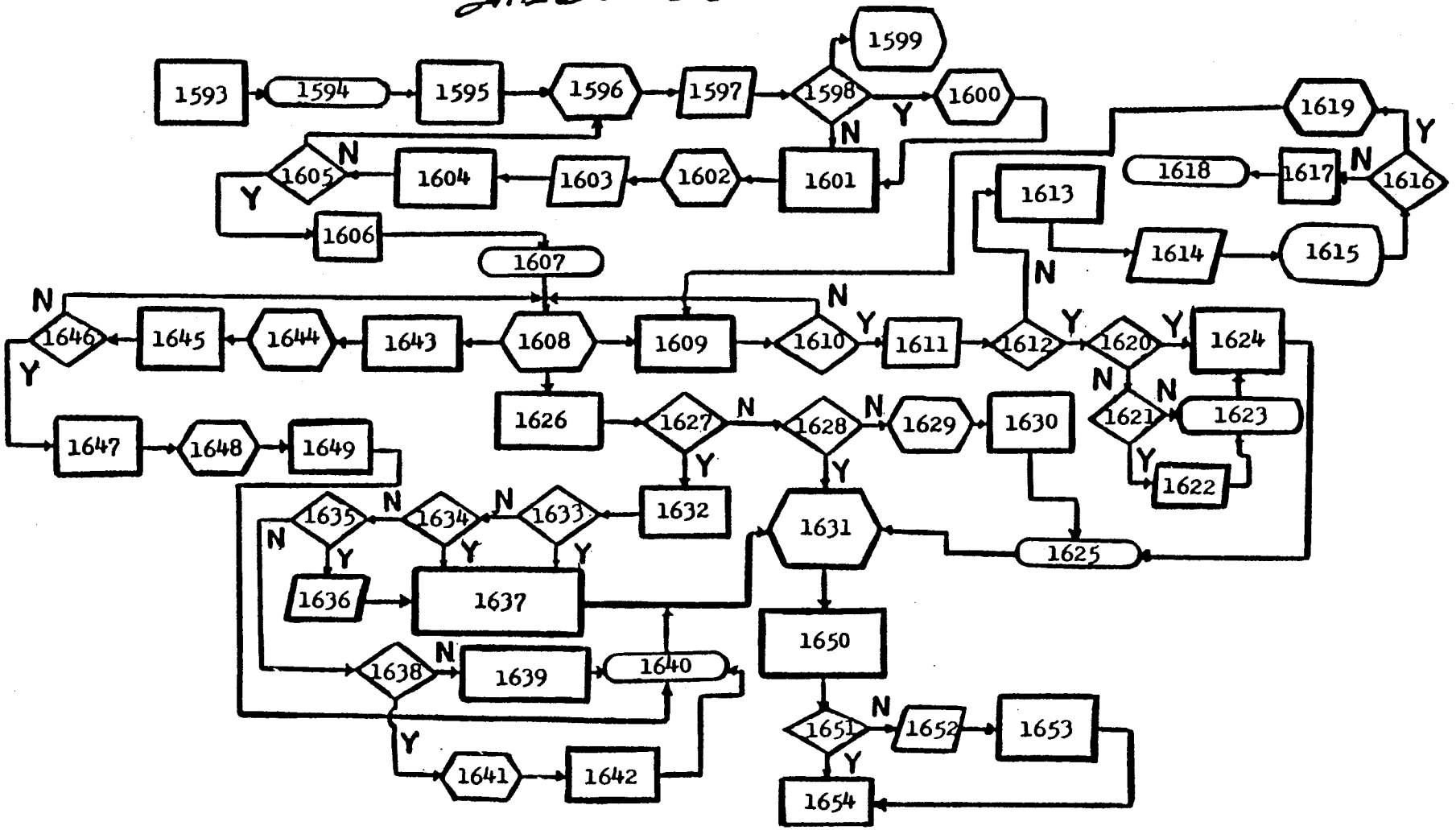
Figure 101:
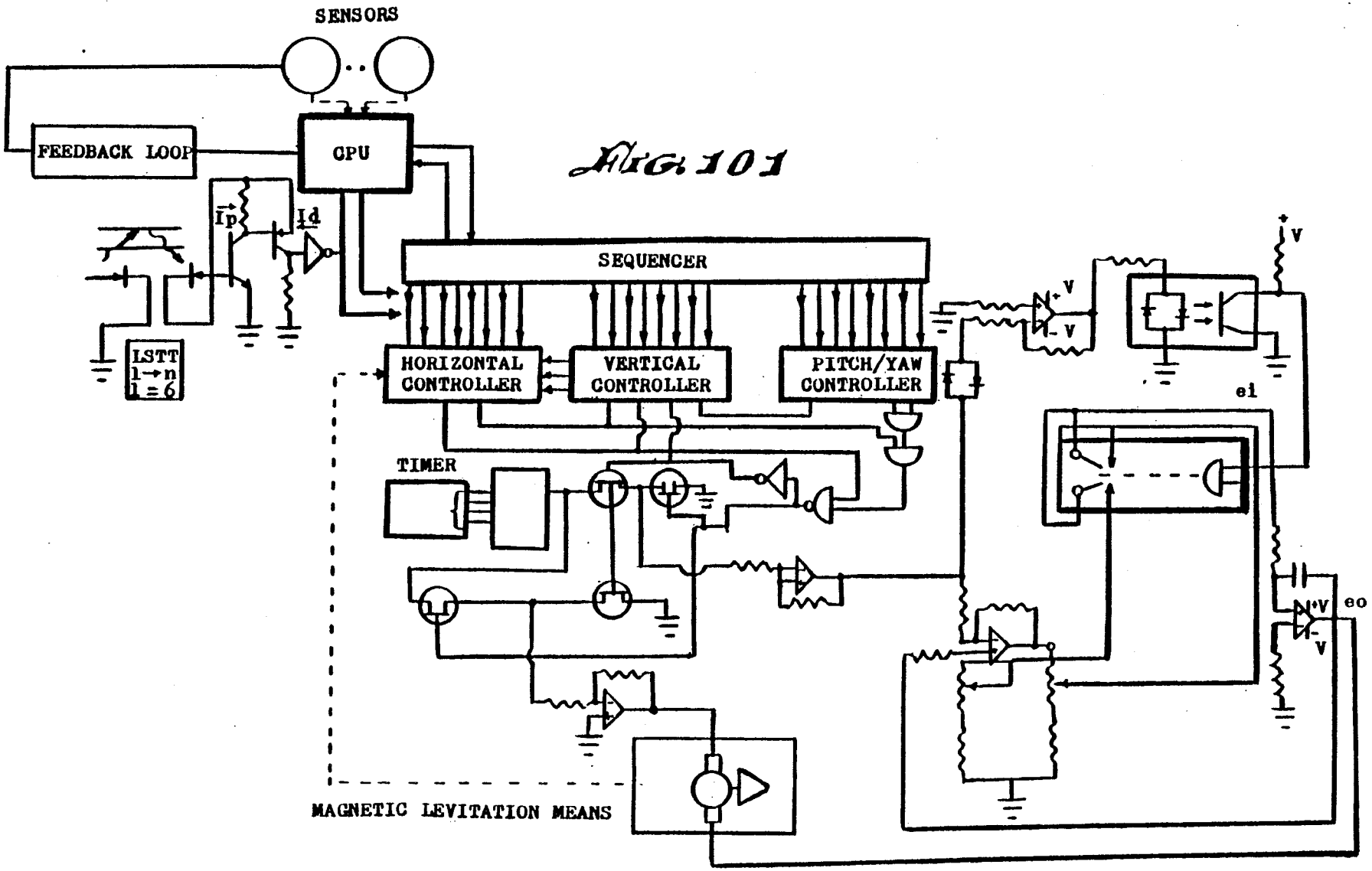
Figure 102:
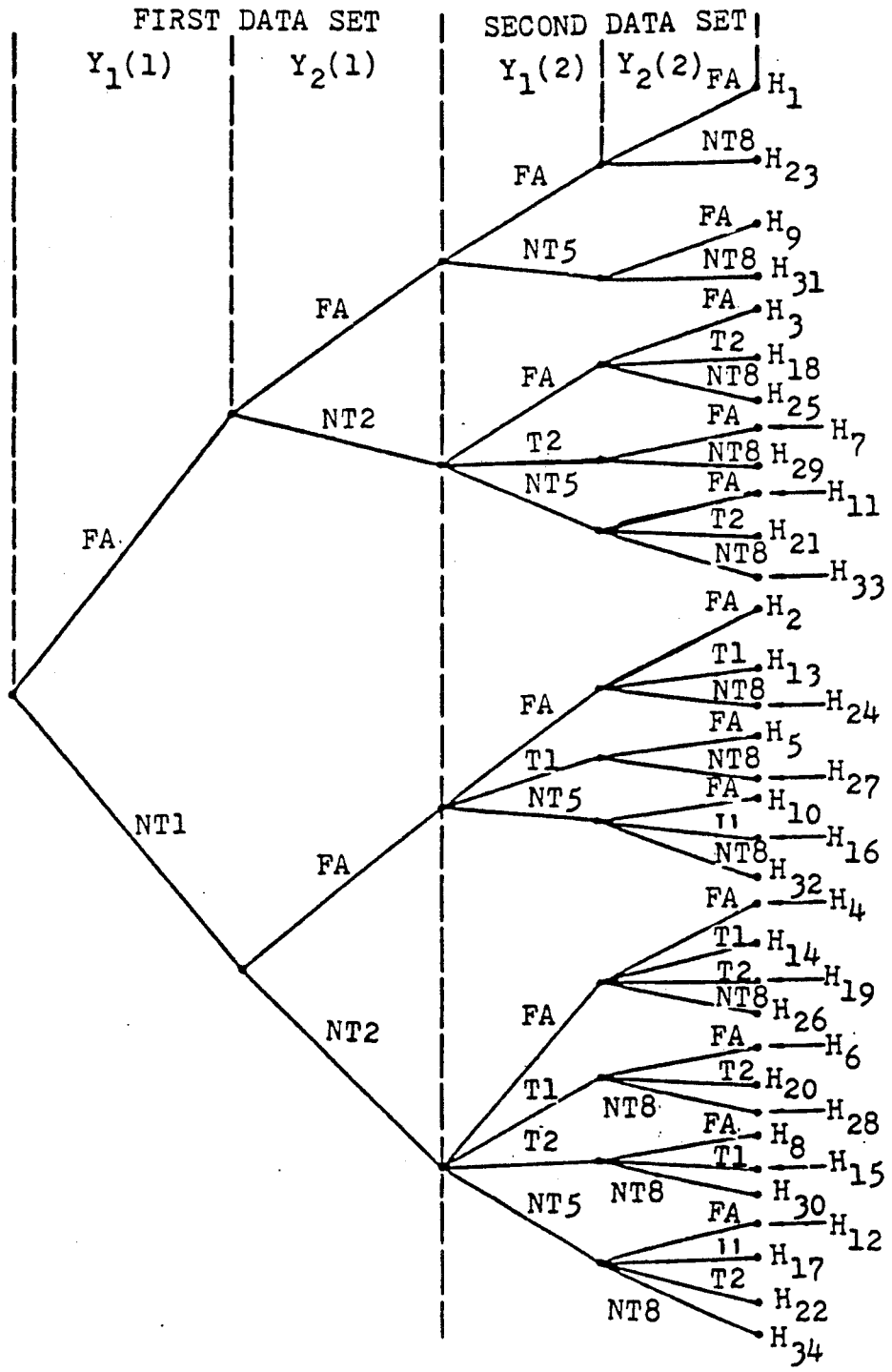
Figures 103, 103A:
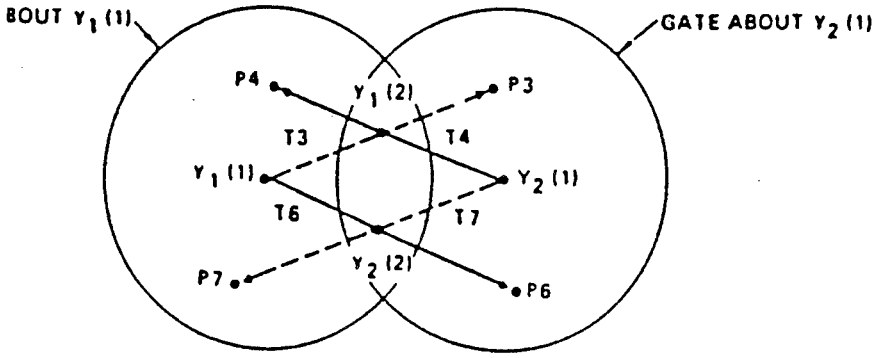
Figures 104, 104A:
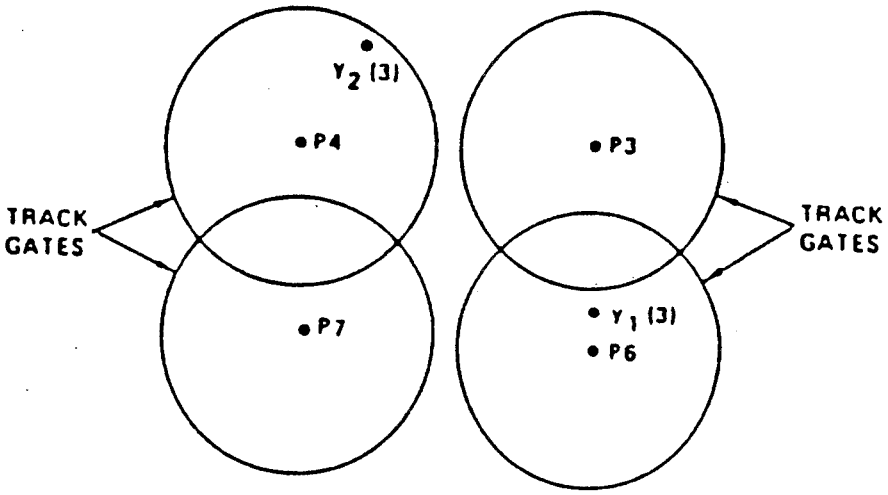
Figure 106:
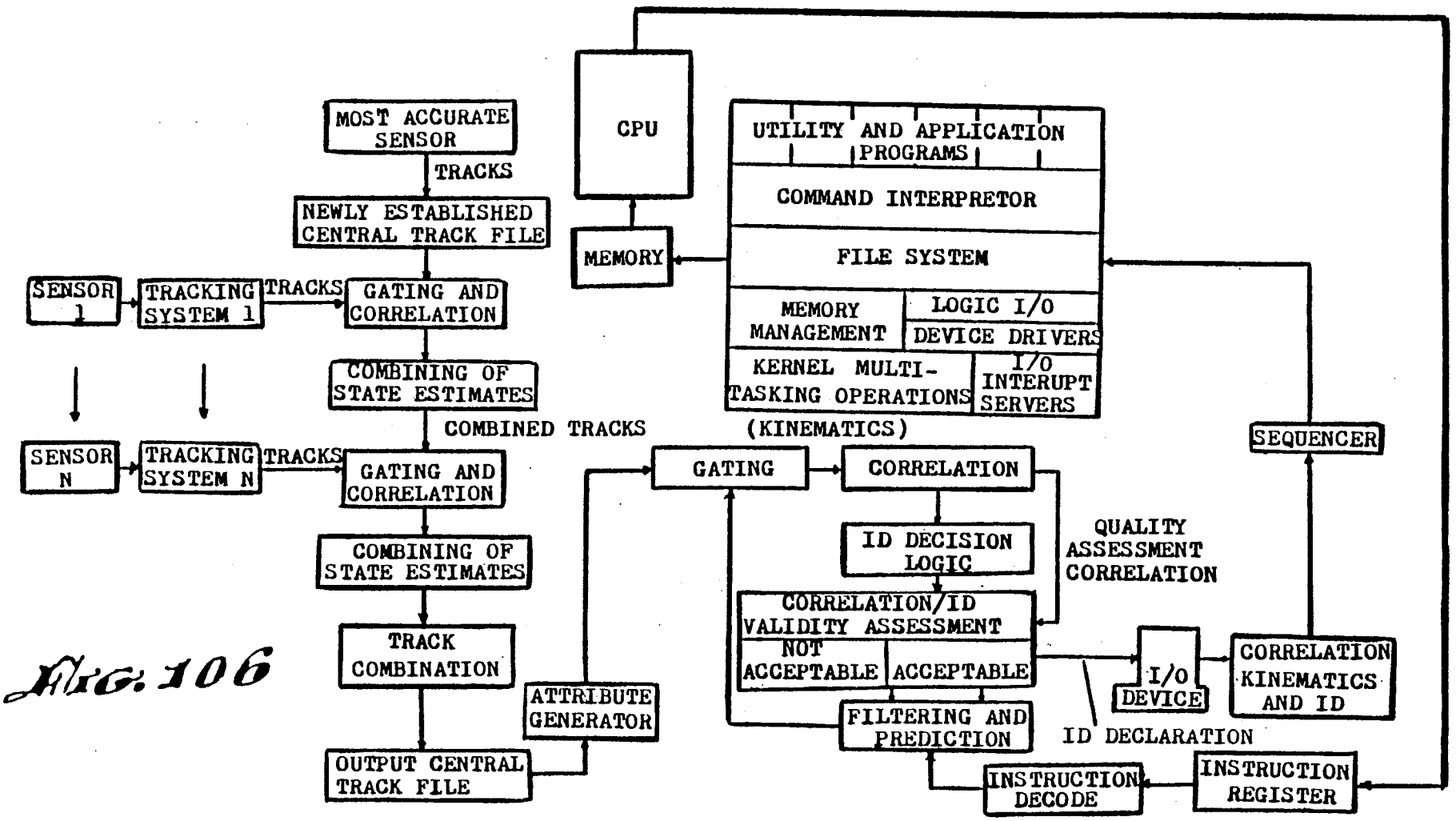
Figure 107:
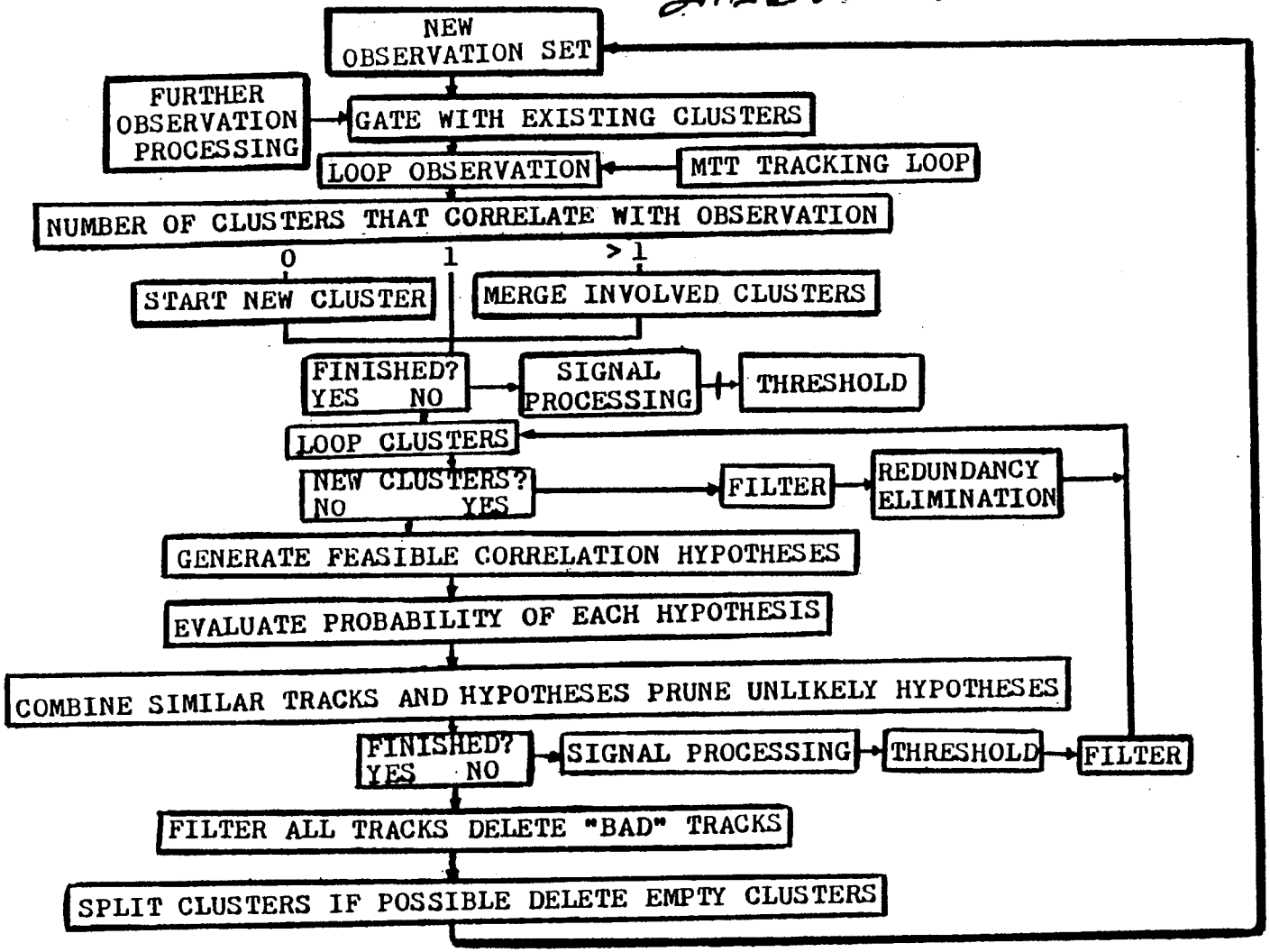
Figure 108:
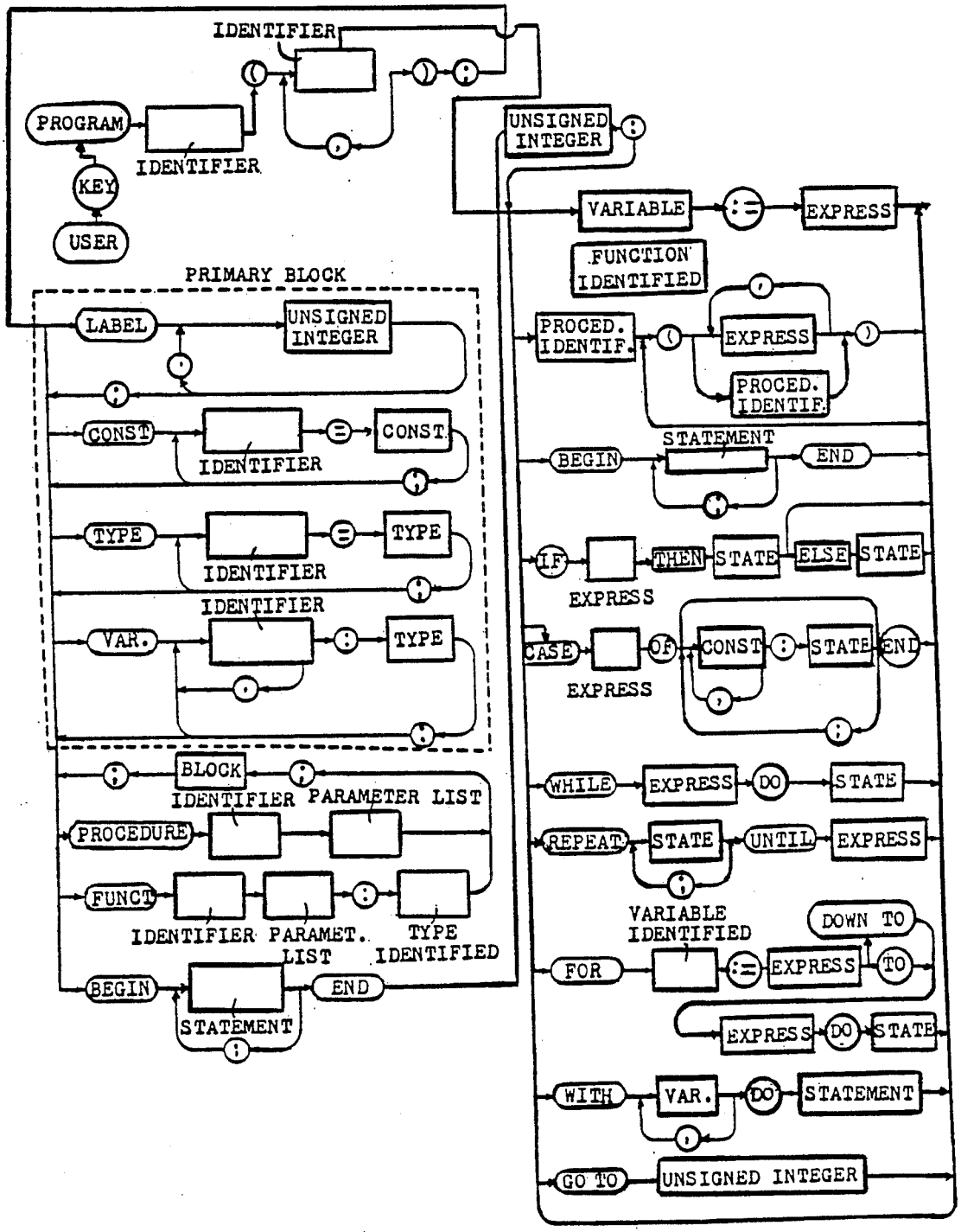
Figure 108A:
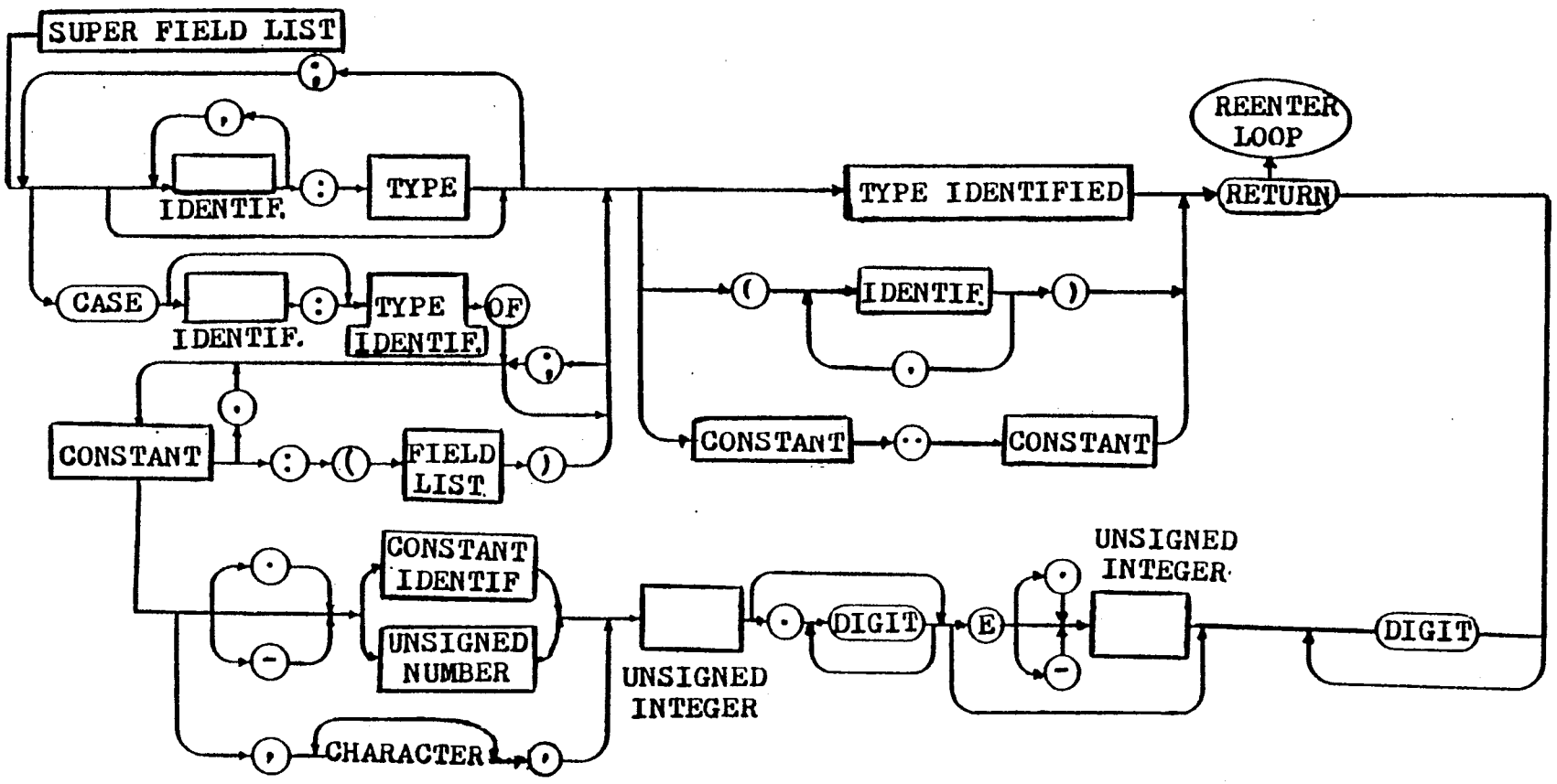
Figure 108B:
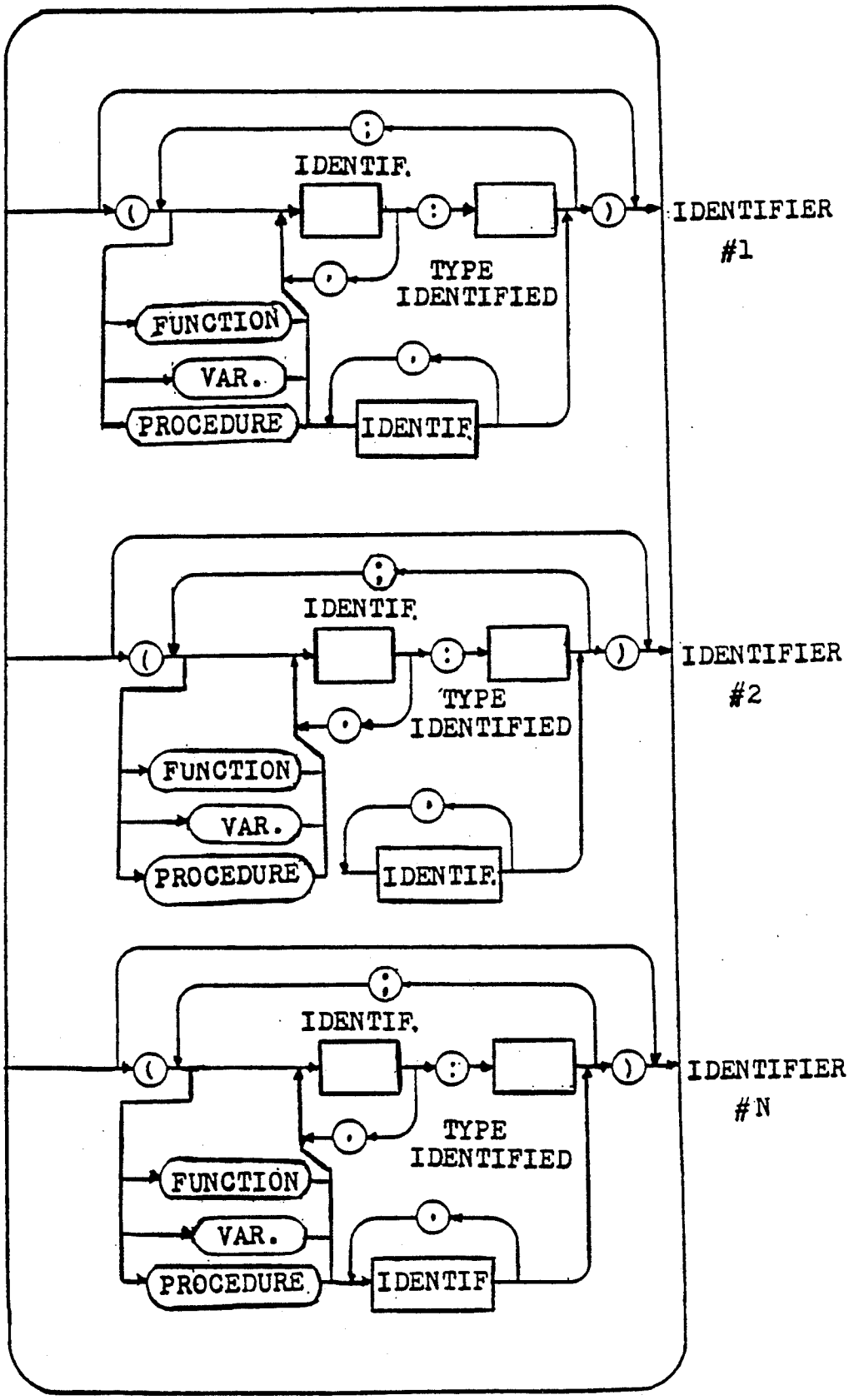
Figure 108C:
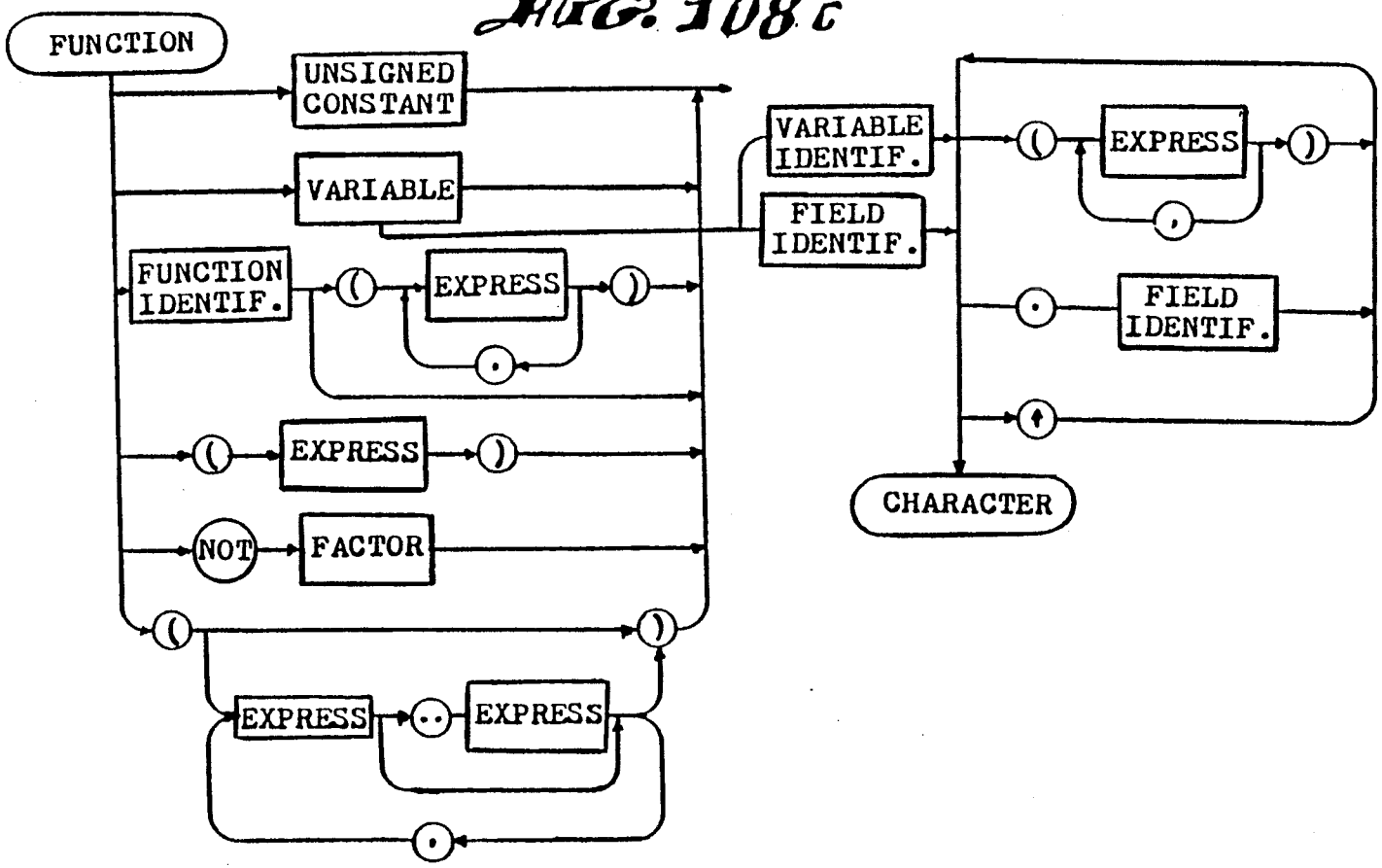
Figure 108D:
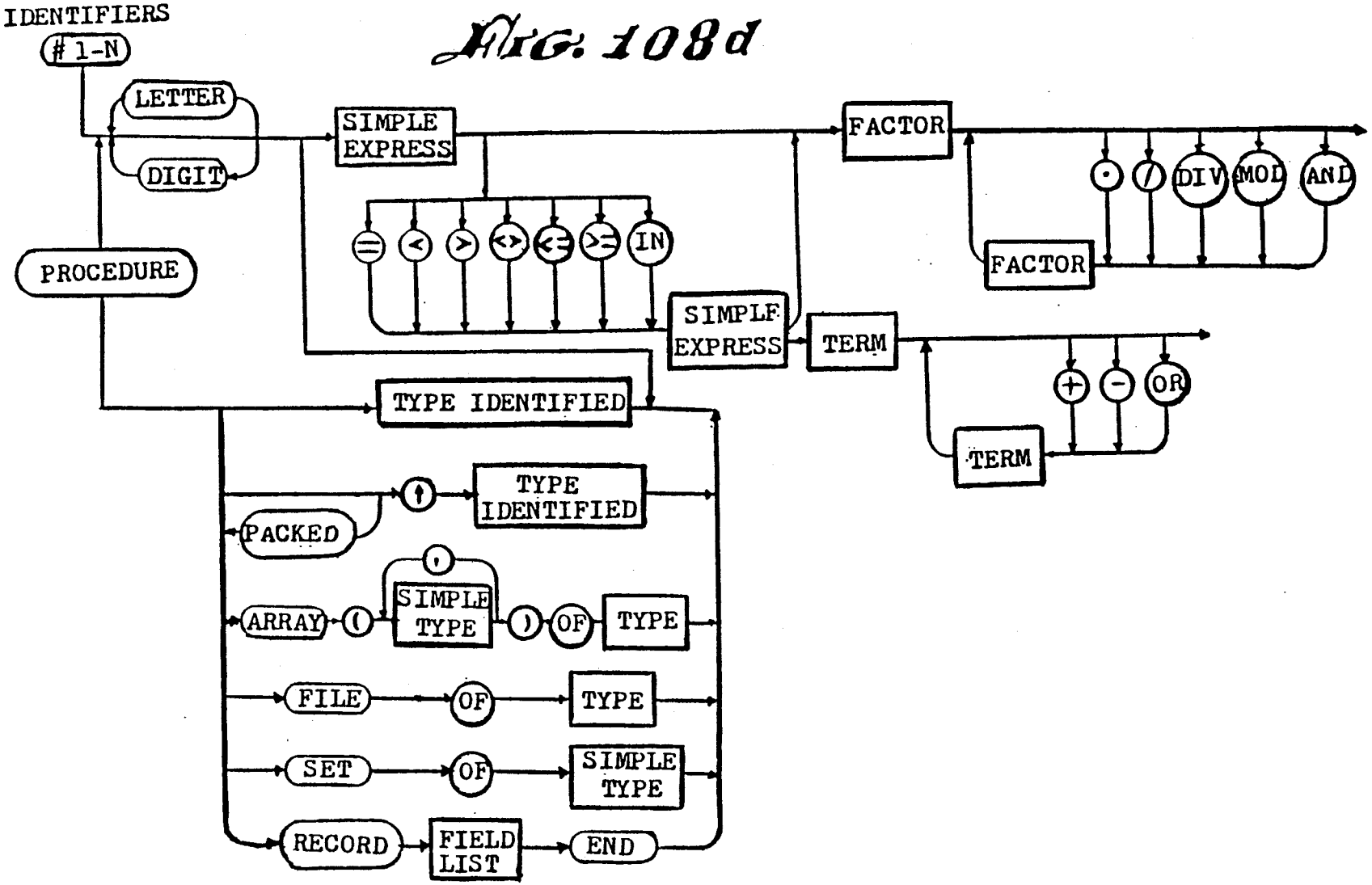
Figure 114A:
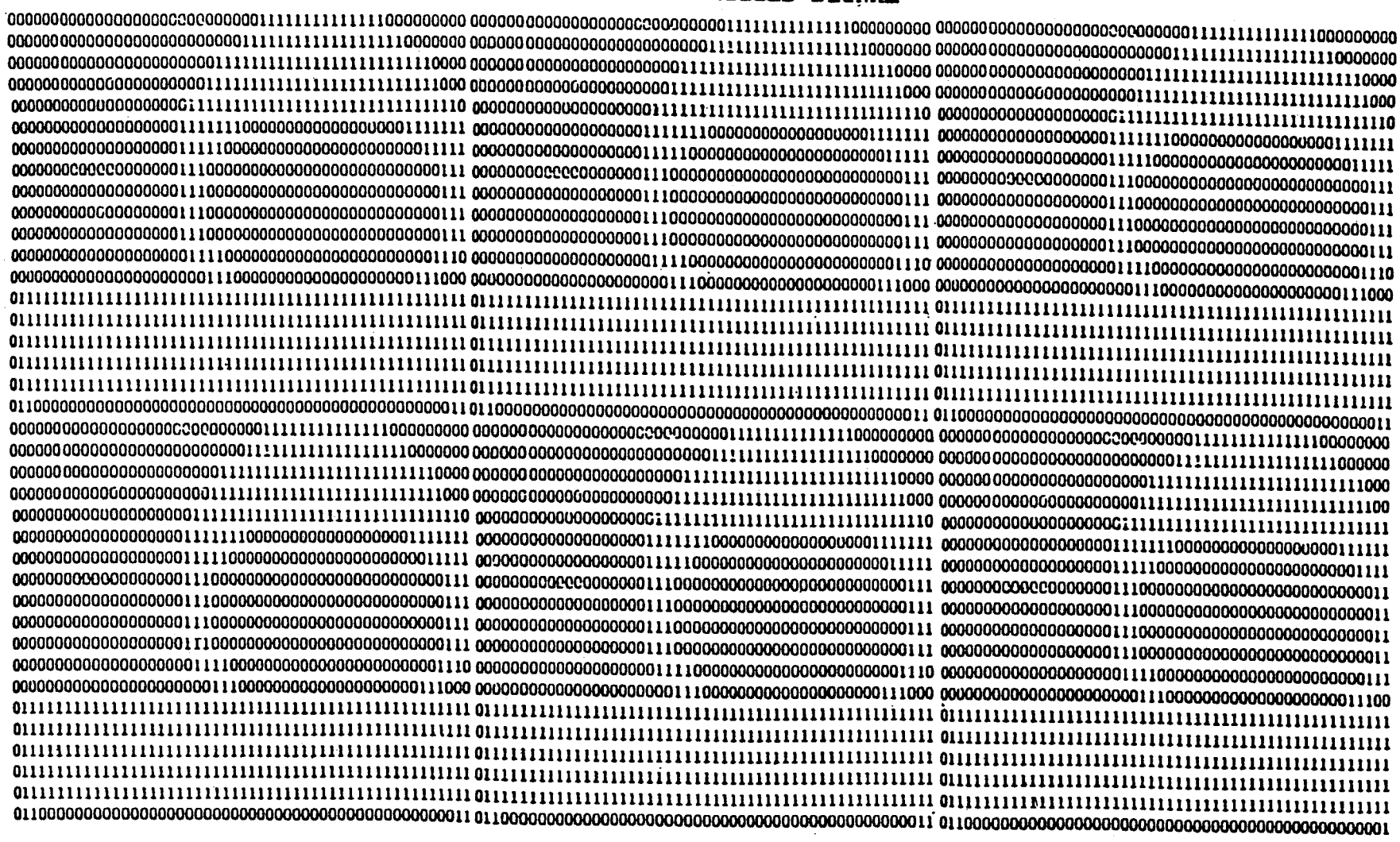
Figure 115B:
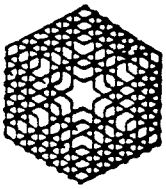
Figure 115A:
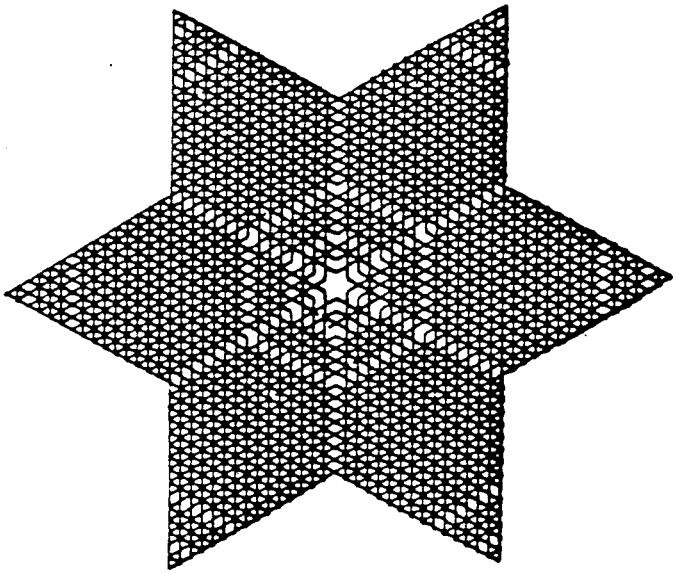
Figure 115:
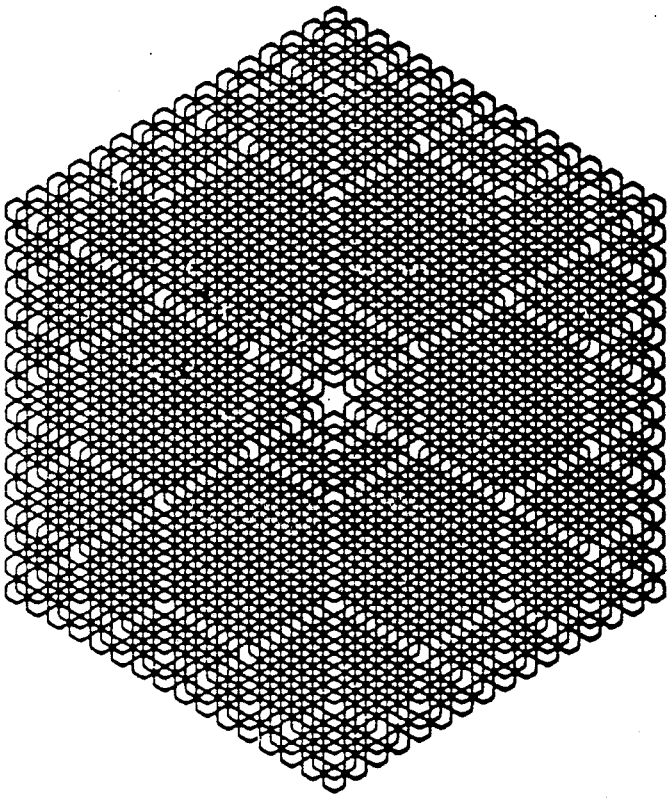

FIG. 84 denotes a unique subminiature solid state electron tube which is the mainstay of a backup system that is completely resistant to the effects of EMP;

FIG. 85 is a simplified combination block diagram and schematic representation of one of several optical electronic analog/digital converter feedback units embodied within said device;

FIGS. 86 through 86*d* are pictorial representations of one of the composite materials utilized for radiation shielding;

FIG. 87 denotes a simplified block diagram which explicitly shows the effective position of both a tone generator and speech synthesizer unit in relation to an interactive computer system;

FIG. 88 designates in an illustrative manner both the failures experienced and the mean time per failure plotted against the execution time of the varrious operative electronic component systems of said device;

FIGS. 88*b*, 88*c* are a graphical representation and legand for projection of a reflective surface from said device to direct beams;

FIGS. 89, 89*a* depict an auxiliary fiber optics laser gyro-system deployed in the piezoelectric means, conduit arm and other systems;

FIG. 90 is a flow chart for the program governing characteristics of sonic emissions produced by the acoustical generator means;

FIG. 91 is a representative flow diagram for an emissive fiber optics element and a given target;

FIG. 92 is a block diagram which discloses the main control center CPU for the MALKE device;

FIGS. 93 through 93" disclose in part an abbreviated flow diagram summarizing the operation of the MALKE device;

FIG. 94 concisely discloses in part the programming format implementing systems operation of one or more systems embodied within the MALKE device;

FIGS. 95 through 96" entail the programming formats executed by one of several equivalent mirror means embodied within the MALKE device;

FIGS. 97 through 99 detail programming formats typical of those employed to selectively govern selective emissivity and reestablishing the functional integrity of reflective elements of automated mirror means;

FIG. 99 discloses in part the flow chart controlling the programming format for a single, piezoelectric complement controlling a single piezoelectric focusing element;

FIGS. 100 to 101 disclose flow diagrams and partial circuit emboding the programming format and means by which target acquisition is assisted by the magnetic levitation means;

FIGS. 102, 102*a* discloses in an illustrative manner the formation of a tree hypothesis, the generation of information branches for said tree and a corresponding matrix;

FIGS. 103 and 104*a* describe the hypothesis matrix taken after the third scan while subjecting said matrix hypothesis to the introduction of data reduction techniques, such as the introduction of pruning techniques;

FIGS. 105, 105*a* illustrate the effects of both pruning and combining hypotheses and then clustering the aforementioned hypotheses;

FIG. 106 describes the implementation of a system deploying an array of different sensors and said system is further disclosed as operating in accordance with the MTT theory;

FIG. 107 represents in an illustrative manner a modified high level flow chart of the multiple hypotheses track algorithm;

FIGS. 108 through 108*d* exemplify in detail the structure, disposition and the subsequent implementation of interactive programs embodies within expert programs encoded within the CPU and microprocessor elements of the M.A.L.K.E. device and ancillary systems;

FIG. 109 denotes an concise program illustrating one type of syntex, language and structure of the type of programming format disclosed by FIGS. 108 through 108*d*, inclusive;

FIG. 110 describes concise mathematical comparisions of continuous-time and discrete-time transforms implementing programs embodied within CPU and/or microprocessor elements of the MALKE device and ancillary systems associated with information processing;

FIGS. 111, 111*a* describes in detail the autocorrelation function for continuous signals emitted or otherwise acquired from designated targets;

FIG. 112 describes a well understood abbreviated program and mathematical formulas embodied within said program for calculating standard deviation;

FIG. 113 describes a well known program by which data accumulated during the acquisition process for designated targets can be identified upon reduction to be placed in a second-order curve-fit;

FIG. 114 describes in concise detail the three stages by which a single digitized signal emitted by a designated target is isolated, identified by comparison and repetition and subjected to data reduction techniques;

FIG. 115 is a pictorial representation of the data reduction process within a single optical field element of the MALKE device;

FIG. 115*a* is an pictorial illustration of a unlocking code exemplary of the type used to actuate the very first MALKE device;

FIG. 116 entails a concise digitized description of a single three dimensional time vector occupied by a single designated target within an arbitrary real time frame of ten microseconds;

FIGS. 117 through 117*c* describes a well known modification of a cooley-Tukey Radix- 8 DIF FFT program which exemplifies in part and those types of programs used to implement data aquisition programs embodied with the CPU and/or microprocessor elements of the transector device and ancillary systems.

FIGS. 118 through 122 consist of a series of well defined diagrams and equations describing parameters of missile tracking and engagement.

DETAILED DESCRIPTION OF THE INVENTION

FIGS. 1 through 8 are pictorial representations of four perspective views of the Mobile Assault Logistic Kinetmatic Engagement Device also known as the M.A.L.K.E. Device. Said views briefly describe the front, aft, top, bottom and side elevation of said device. The corresponding numeric values assigned to each of the aforesaid figures are equivalent and therefore what is applicable to one said figure is applicable to the next said figure. Numerals 01, 02, 03 and 04 of FIG. 1 describe the M.A.L.K.E. Device, a recharging reservoir for chemical and other types of lasers embodied within said device and ancillary solar stacks coupled to an alternate battery power source. Numerals 05, 06, 07 and 08 describe the outer hull, an external optical window optically and physically transparent to emissions generated by energy weapons embodied within said device and the external structure of two out of four Mass Action Driver elements emitting ultra velocity projectiles traveling in excess of ten times the speed of sound. Elements 09, 010 and 011 define the external structures of a plasma reservoir suppling plasma to said Mass Action Driver and other systems, a rotating turret structure whereby the structures 02 through 09 are elevated, declined and rotated, the turning column for rotating and mounting elements 02 through 09 and one of two mechanical manipulators. Structures 013, 014 and 015 designate tanks storing plasma for engines, not shown here; whereas structure 012 embodies a pump element by which said tanks can be recharged from external sources including the atmosphere surrounding said device. Element 016, 017, 018 and 019 describe one of two tracks for terrean, one of two concentric rotating tracks and two of four externally exposed wheels with deformable reams, allowing the device to advance in either direction with or without the presence of said tracks. Additionally, numeral 020 in FIGS. 3, 6 denotes the second of two said mechanical manipulators. Further alpha numeric values 021 through 021*i* of FIGS. 3, 6 and 7 designate ten equivalent plasma engines utilized for horizontal and vertical deployment. Element 016*a* in FIGS. 3, 4, 6 and 7 denotes the companion track to element 016. Elements 07*a*, 08*a* of FIGS. 4, 5, 6 and 8 correspond to alternate M.A.D. devices.

Figure 1:
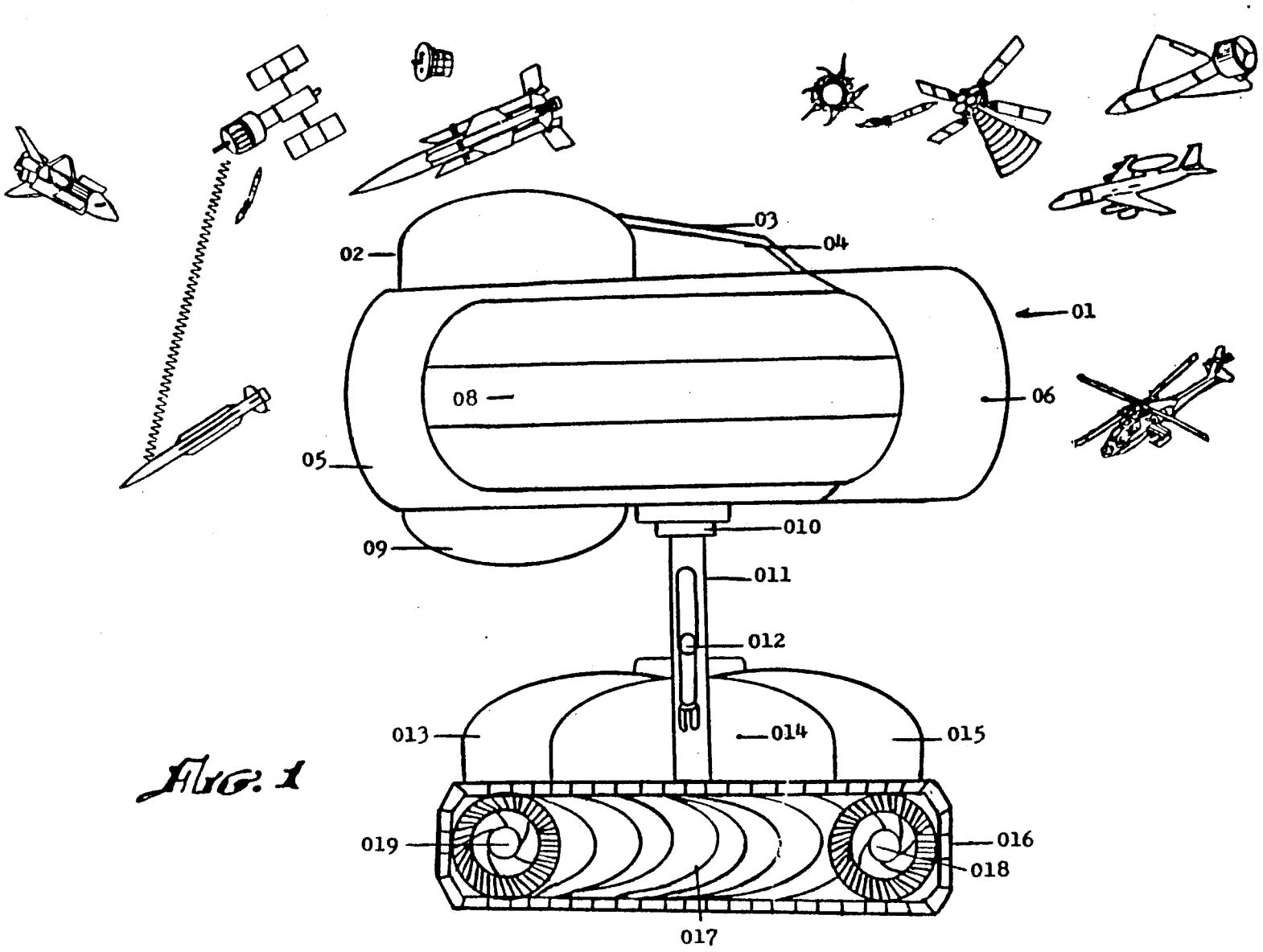
Figure 2:
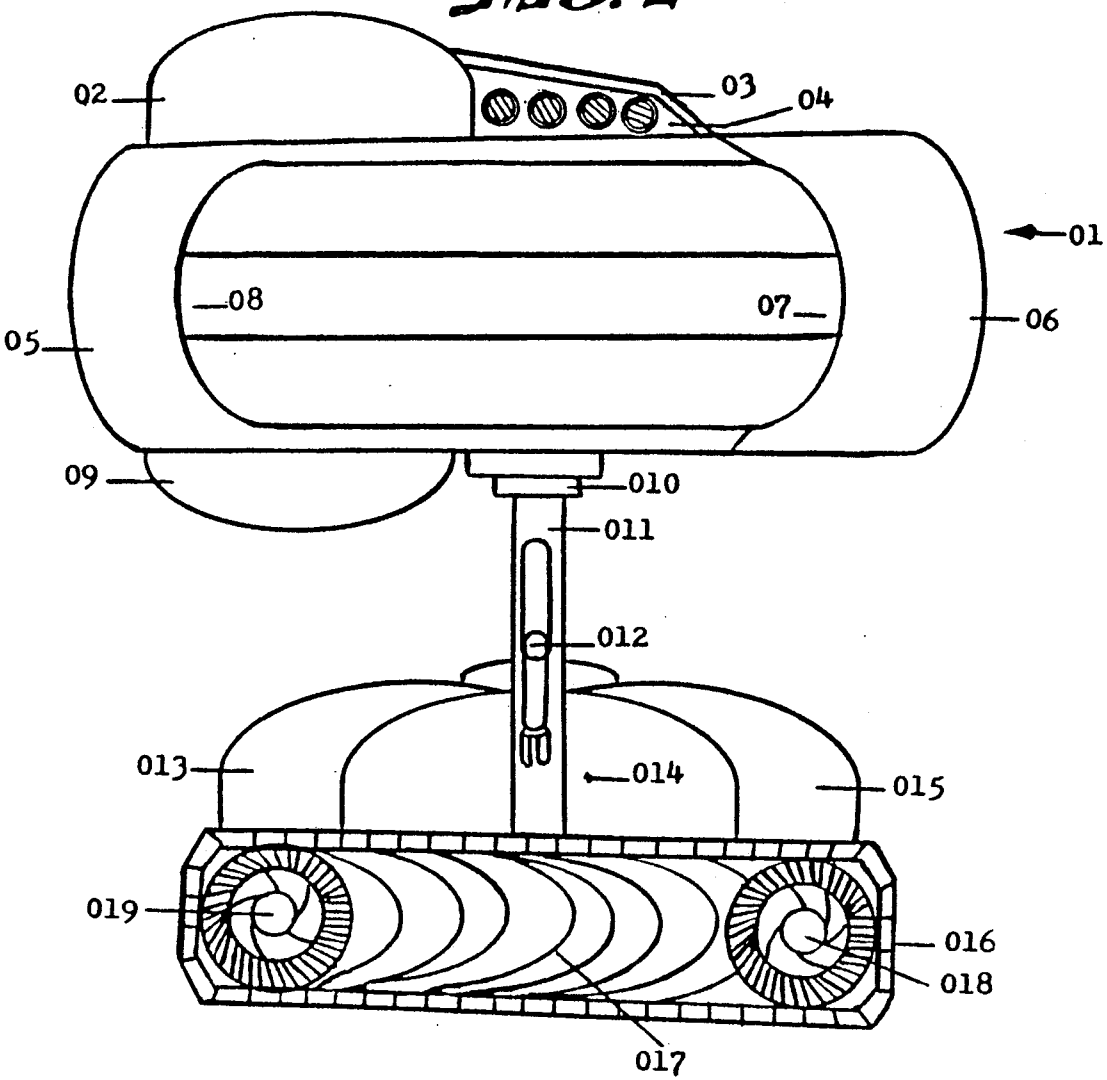
Figure 9:
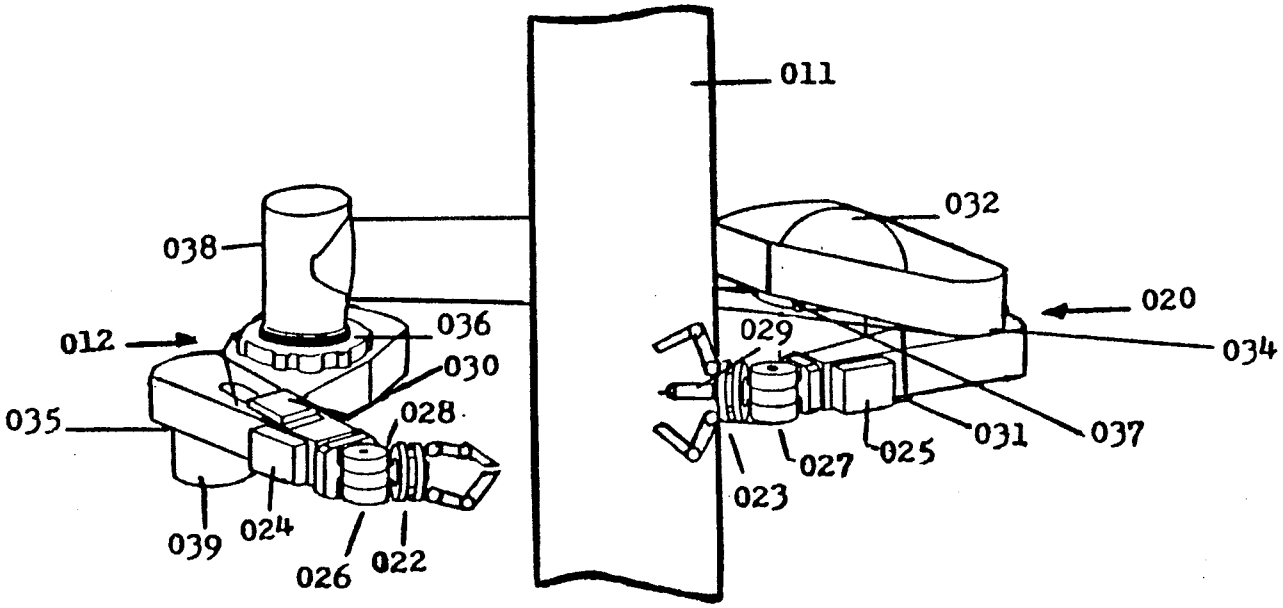
FIGS. 9, 9*a* are detailed pictorial representations of the mechanical manipulator elements embodies within said device.
Figure 9A:
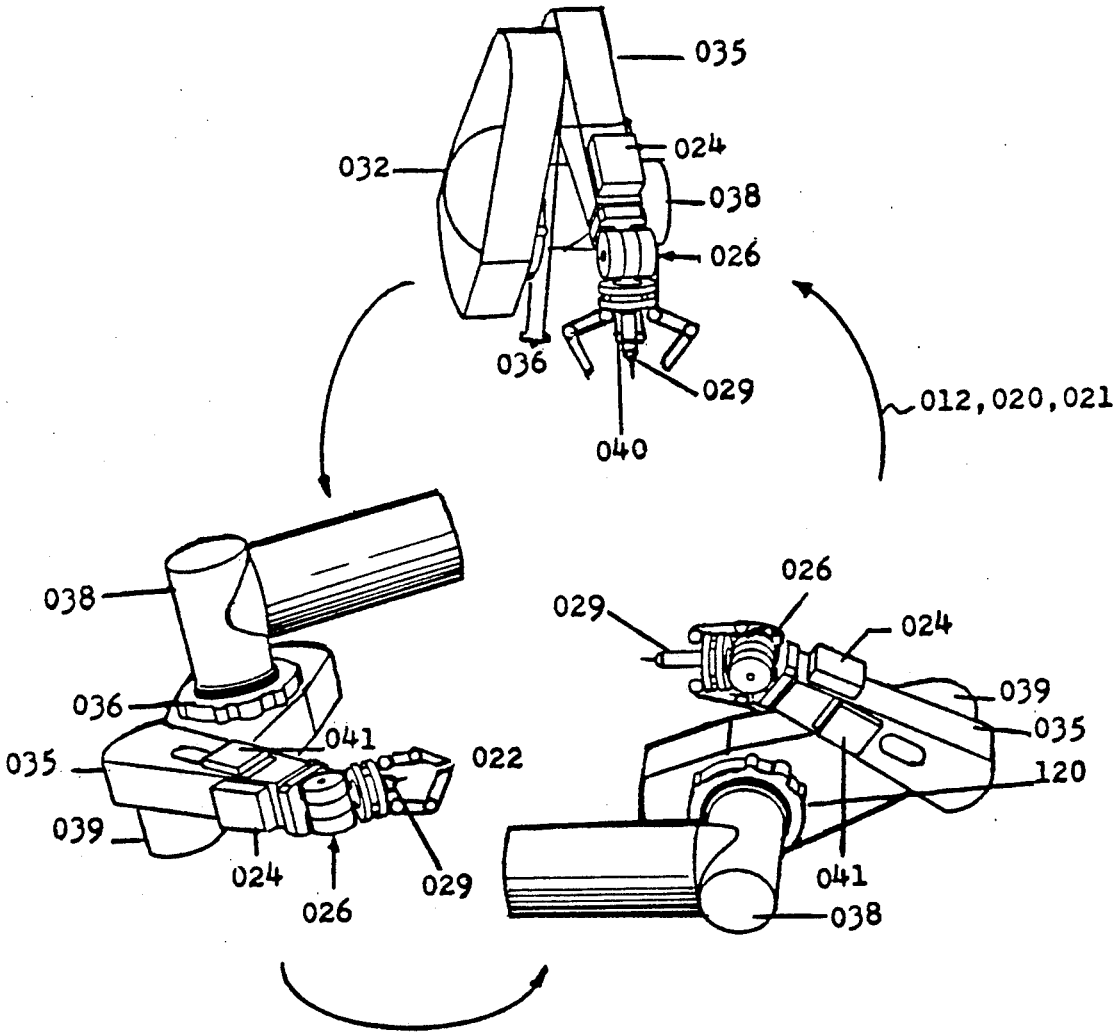
Figure 10:
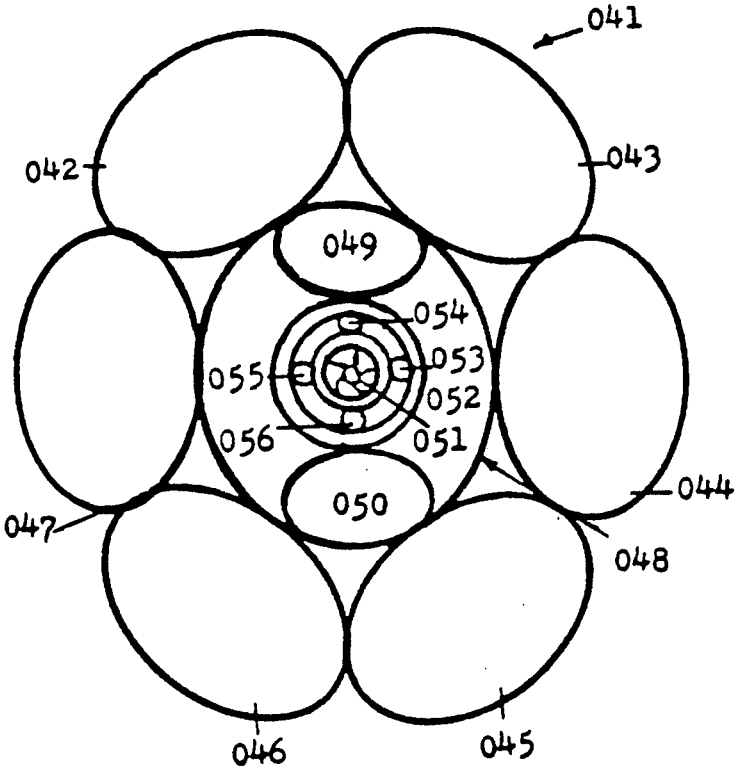
FIGS. 10, 11 entail external pictorial perspective views of a single plasma engine.

FIGS. 9, 9*a* are detailed pictorial representations of the mechanical manipulator elements. Said mechanical manipulating elements described by numerals 012, 020 are mounted on turret structure 010. Manipulators 012, 020 provide a means whereby objects in the immediate area of the device can be moved, examined or modified for some purposeful behavior. In FIGS. 9, 10 numerals 022, 023 are indicative of manipulators containing articulating wrists and articulating fingers or phalanges. Said manipulator means are powered by a piezoelectric engine means described by numerals 024, 025. Elements 024, 026 provides 360 angular rotation for articulating wrist means 027, 028 component parts for variable ion torch, element 029 is embodied within compartments described by numerals 030, 031. Fuel reserves for said torch element is embodied within compartments 032, 033. A second rotating joint, described by numerals 034, 035 provides 360° horizontal rotation for arms 036, 037; whereas vertical rotation for said robotic arm means are additionally provided by motivators 038, 039. Said ion torch element, number 029 is encapsulated within a retractable hydraulic sleeve element, described by numeral 40, which automatically retracks when not in use.

Figure 11:
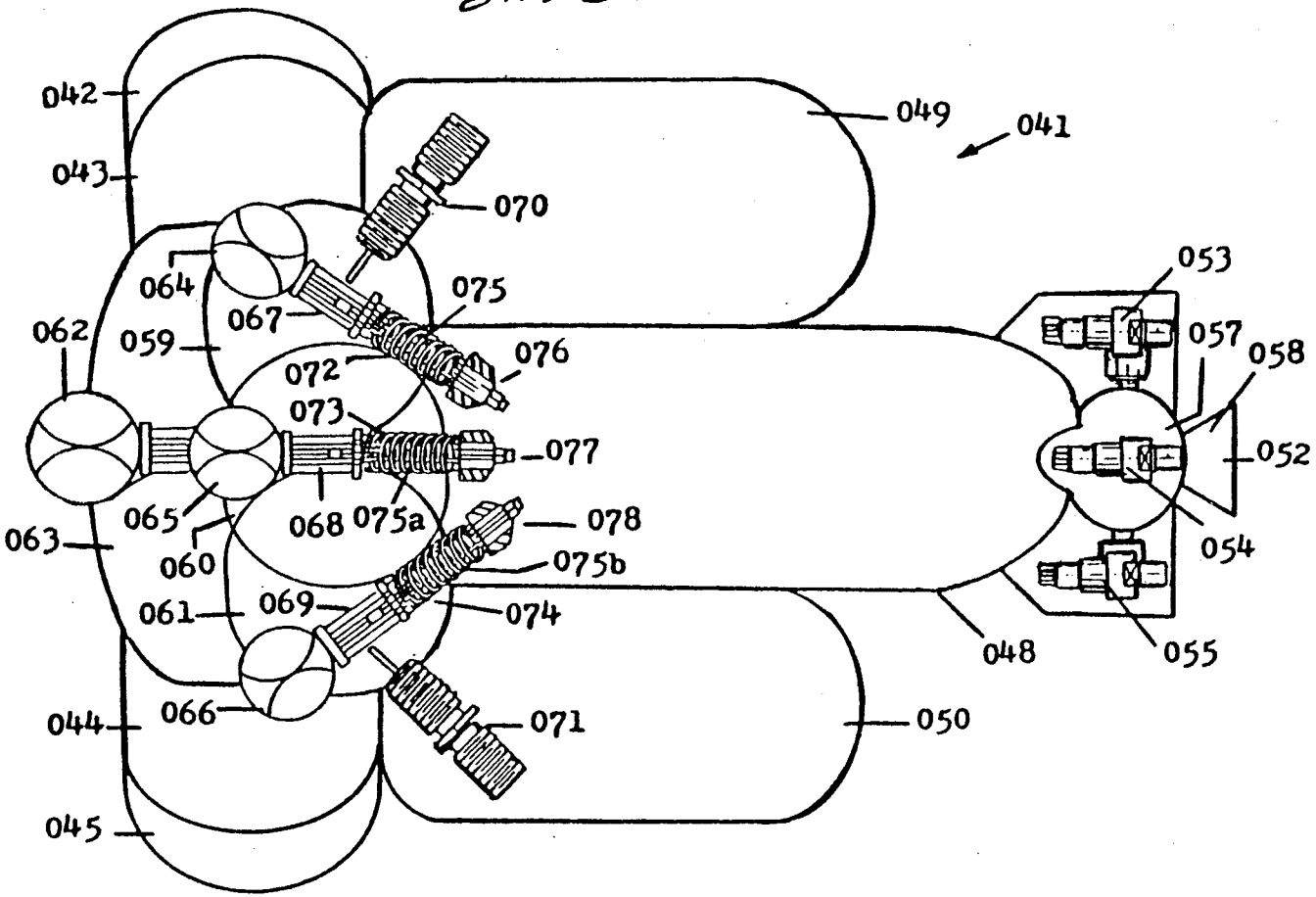

FIGS. 10, 11 entail external pictorial perspective views of a single plasma engine. Plasma engine 41 as described in FIGS. 10, 11 illustrates a aft view and side elevation and is a representative form of the ten plasma engines embodies within the M.A.L.K.E. device. Numerials 042 through 047 of FIG. 10 describe six storage reservoirs circumferentially disposed around external engine hull 048, which houses the entire plasma structure. Numerals 049, 050 of FIG. 10 designates two equivalent bearingless and piezoelectric engines providing motion to turbine element 051 when sonic and subsonic speeds are required by said device. Numeral 052 and elements 053 through 056 designate the rotating nozzular element and four equivalent miniature piezoelectric motors for orientating said nozzular structures to provide in-course or in-flight corrections. Elements 041 through 055 of FIG. 11 are equivalent to the same said elements disclosed in FIG. 10. Numerals 057, 058 of FIG. 11 illustrate the external casing for the ball and socket rotating turret for nozzular means 052. Numerals 059, 060 and 061 designate secondary reservoirs wherein volatilized plasmitiable gases undergo excitation from emissions generated by excismer lasers, not shown and thermal excitation from radio frequency elements shown in part by numerals 062, 063. Plasmitize gases may be introduced from secondary reservoirs 059, 060, 061 or three other equivalent reservoirs, not shown, into a central ignition cavity, not shown, to provide additional trust to the aforesaid turbines. Additionally provided are an auxillary reservoir and pump means 062, 063, which function to retrieve gaseous mixtures existing from the atmosphere or the ambient environment surrounding said device to replenish existing primary reservoirs. Said plasmitizible gases are introduced from structures 064, 065 and 066 into chambers 067, 068 and 069 wherein said gases are subjected to radio-frequency excitation by elements 070, 071 prior to being conveyed down their respected tubular structures described by 072, 073 and 074. Structures 072, 073 and 074 are encapsulated by coiled excitation elements 075, 075*a* and 075*b* which function to uniformly subject said gases to microwave excitation prior to being conveyed to Tesla coil means 076, 077 and 078. High voltage-high amperage-current from said Tesla coil elements convert all gaseous substances not already in a plasma state into charged plasmoids traveling at a velocity which exceeds ten percent the speed of light. The plasmoids exit sequentially from said tesla elements into the aforementioned central ignition cavity. Elements 059 through 078 are representative of equivalent structures, not shown, in FIG. 11, but numbering no less than six equivalent structures.

Figure 12:
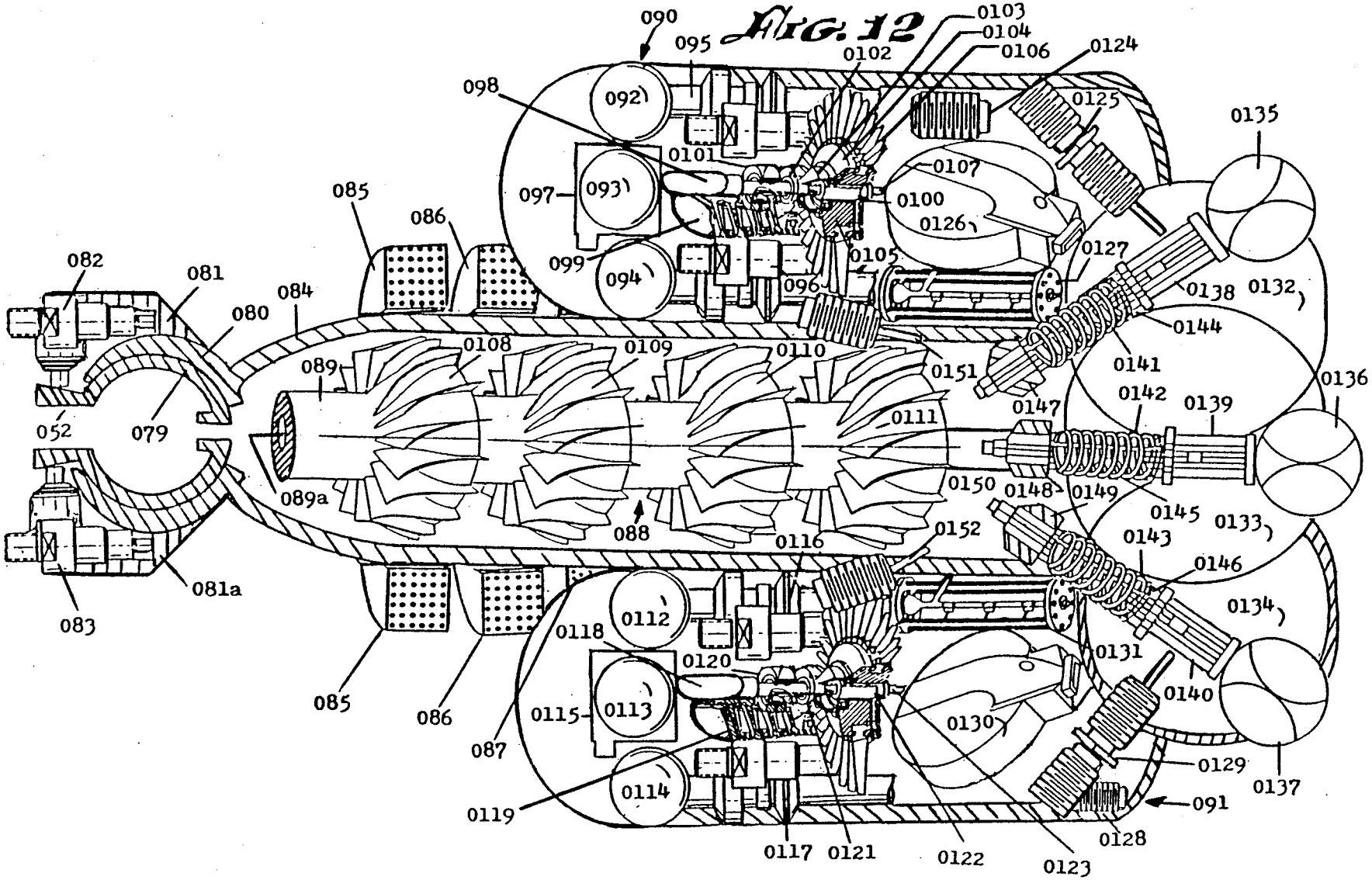
FIG. 12 discloses a detailed cross-section of a single engine as described in FIGS. 10, 11.

FIG. 12 discloses a detailed cross-section of a single plasma engine as described in FIGS. 10, 11. Nozzle element 052 is continuous with rotating ball element 079, which is circumferentially desposed to rotate within sleeve structure 080, forming the ball and socket means described in FIG. 11. Motivator element 082, 083 consists of miniature piezoelectric motors, which rotate said nozzular element with one end of each said motor abutting up against element 079 and the other respective ends embedded within wing structures 081, 081*a*. Wing structures 081, 081*a* and sleeve element 080 is continuous with inner hull structure 084. Plasma exiting along turbine complex 088 is focused by circular induction magnets described by numerals 085, 086 and 087. Turbine complex 088 is disposed linearily along rotating shaft means 089 which has a hollow bore number 089*a*, wherein coolant is circulated to reduce the extreme temperature conveyed to the blades and shaft of said turbine complex generated by the exiting plasma, as said plasma is conveyed along said turbine blades to its ultimate point of discharge from said nozzular structure 052. The aforesaid turbine blades and rotating shaft are composed of silicon nitride impregnated with such metal additives as aluminium and other metallics. Said blades are sintered to allow plasmoids of smaller diameters to pass uniformly through the blade structure, preventing excessive wear and vaporization of individual turbine blades. The structures and physical parameters of said silicon nitride blades are disclosed in FIG. 12*a*. Structure 090, 091 are partially sectioned to expose two equivalent bearingless piezoelectric motors, which drive shaft 089, until the revolutions per second exceed the maximum output of said motors wherein automatic disengagement is instituted with said engagement usually accompanying the introduction of focused beams of plasma. Numerals 092, 093 and 094 are assigned to reservoirs containing recyclable coolants that are conveyed to cryogenic pump elements 095, 096 which conveys said coolant to samarian cobalt magnets and related structures. Numeral 097 defines a piezoelectric transformer element and controller means to regulate voltage. Numerals 098, 099 and 0100 represent the electro-magnetic suspension system, an infusion cylinder, wherein a conducting medium of liquid sodium is conducted, a rotating cylindrical rod providing rotation and ancillary support structures. Elements 0101, 0102 denote two of a complement of cylindrically disposed samarian cobalt ceramic magnets. Numerals 0103, 0104, and 0105 designate multiple graduated cylindrical magnetic elements superimposed over one another and coupled to rotary element 0106, which is coupled to the aforesaid rotary rod element ending in terminus rotor element 0107. Element 0107 transmits power and rotational velocity to the drive train element, not shown driving said turbine complex, described by elements 0108, 0109, 0110 and 0111, inclusive. Numerals 0112 through 0123 are equivalent to elements 092 through 0107. Elements 0124, 0125, 0126 and 0127 denote a capacitance band and sequencer means, a radiofrequency element, microwave generator and excismer laser element. Numerals 0128, 0129, 0130 and 0131 are equivalent to elements 0124 through 0127. The microwave generators and excismer laser transmit emissive energy through secondary reservoirs 0132 to 0134 and each said secondary reservoir is equivalent to every other said reservoir. Reservoir 0133 is coupled to a radio-frequency element, microwave generator excismer laser, not shown. The contents of secondary reservoirs 0132, 0133 and 0134 are conveyed to pump elements 0135, 0136 and 0137 which transmit their contents to chambers 0138, 0139, and 0140 wherein said gases from said reservoirs are subjected to radio-frequency waves generated by radio-frequency generators. Numerals 0141 through 0149 correspond to microwave generators conducting conduits and Tesla ignition means previously described in FIG. 11. Numeral 0150 designates the centrally located ignition chamber wherein plasmoids are sequentially conveyed to the turbine complex. Numerals 0151, 0152 denote radio-frequency elements which transmits power to chamber 0150.

Figure 12B:
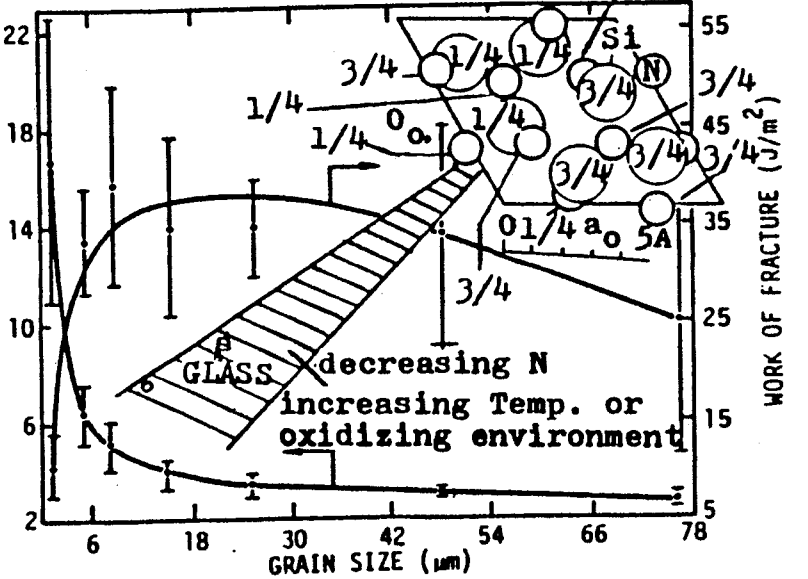
FIGS. 12*a*, 12*b* and 12*c* entail graphical representations of physical properties of the silicon nitride composite material forming the structure of turbines, the exhaust nozzle and ancillary structures.
Figure 12A:
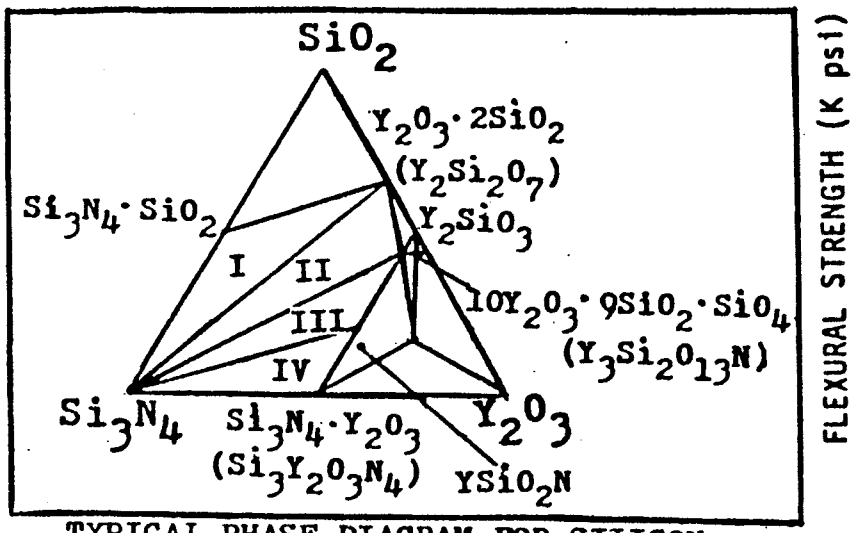
Figure 12C:
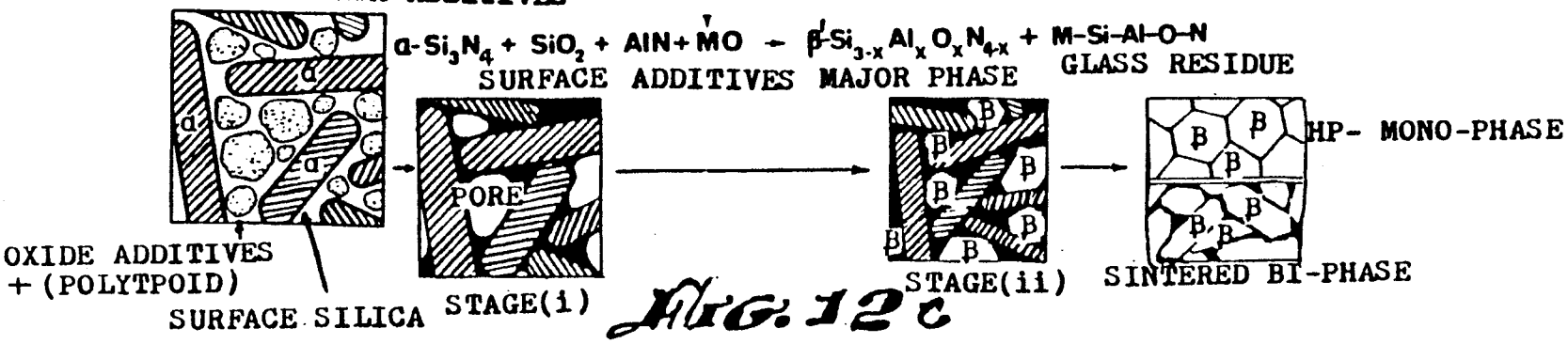

FIGS. 12*a*, 12*b* and 12*c* entail graphical representation of flexural strength, fracture resistance and structural configuration for the silicon nitride composite material forming the structure of the turbine complex, rotating turbine shaft, nozzular element and other structures subjected to tremendous heat and pressure. FIG. 12*a* graphically describes the variance in flexural strength in kilo-pounds per square inch verses the structural composition of rare earth additives combined with silicon nitride and is a typical phase diagram for said materials. FIG. 12*b* is a graphical representation computing grain size ($\mu$m) of the aforesaid silicon nitride material against resistance or the work of fracture in the number of joules (j/m$^2$). FIG. 12*c* describes pictorially the chemical composition and structural features of silicon nitride, as determined in stages prior to, during and after being sintered.

Figure 13:
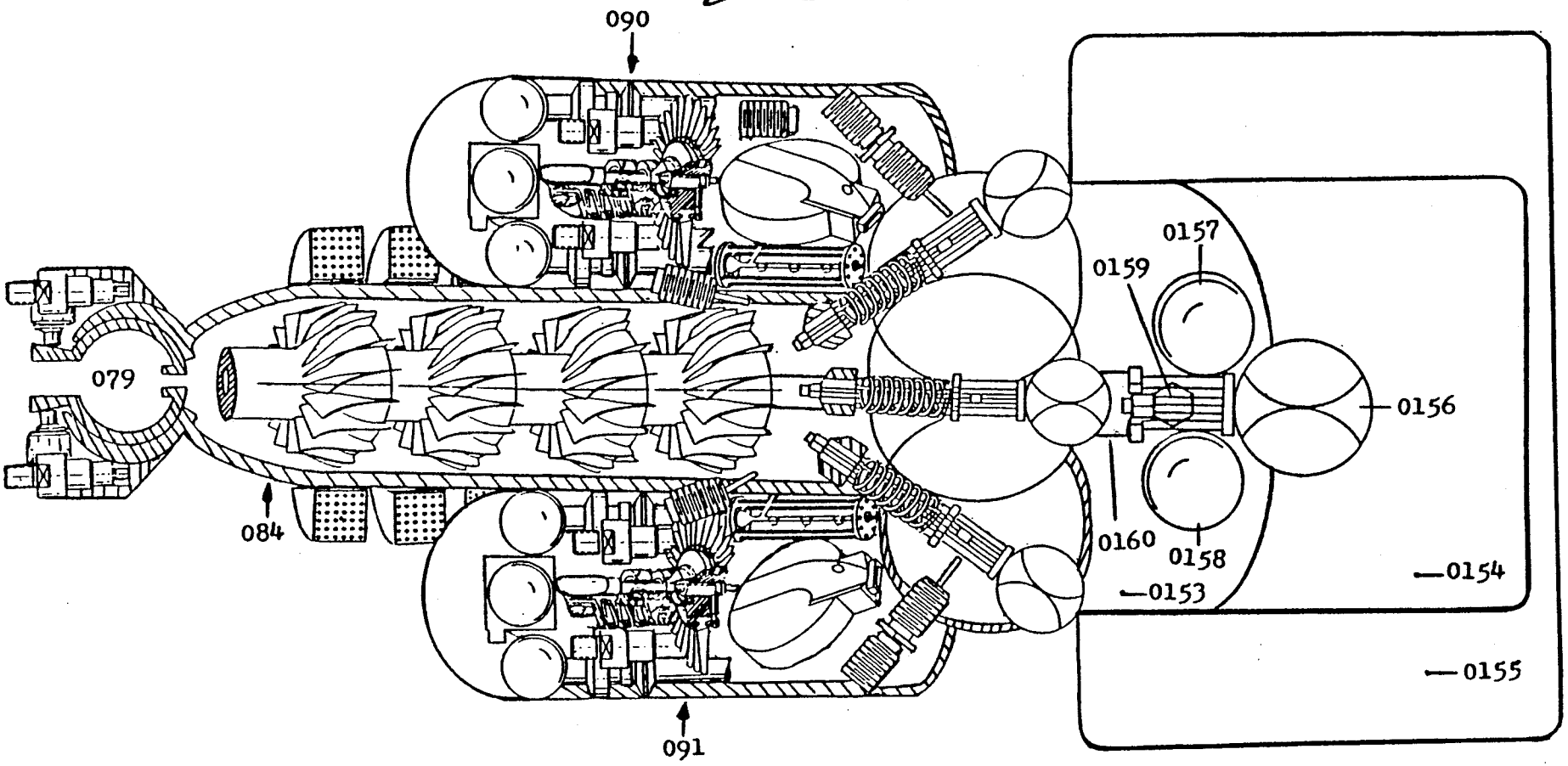
FIG. 13 is a detailed sectioned view of said plasma engine previously described in FIG. 12 including ancillary structures.

FIG. 13 is a detailed cross-section of a single plasma engine, as described in FIG. 12 including other ancillary structures. The plasma engine described pictorially in FIG. 13 is one of the main engines adjacent to the closed system magnetic hydrodynamic element, the internal turbine generator and nuclear reactor element, described by numerals 0153, 0154 and 0155 respectively. The magnetic hydrodynamic system, turbine generator and nuclear reactor will be described in detail later on in the specifications. Reliable continuous high voltage-high amperage current from said nuclear reactor and ancillary systems supply electrical energy to operate, said plasma engines, the energy weapons, the Mass Action Drivers and ancillary support systems embodied within the M.A.L.K.E. device. Numerals 0156, 0157 and 0158 of FIG. 13 discloses a primary cycle pump and two regenerator elements to recharge secondary vessels from plasmitizable substances obtained from the immediate area surrounding said M.A.L.K.E. device. Elements 0156, 0157 and 0158 are coupled to compressor and voltalizer elements 0159, 0160, respectively. Elements 0159, 0160 function to concentrate vaporize and/or rarify gases substances prior to their subsequent introduction into the aforementioned secondary reservoirs, described in the preceding figures.

Figures 14, 14A, 14B:
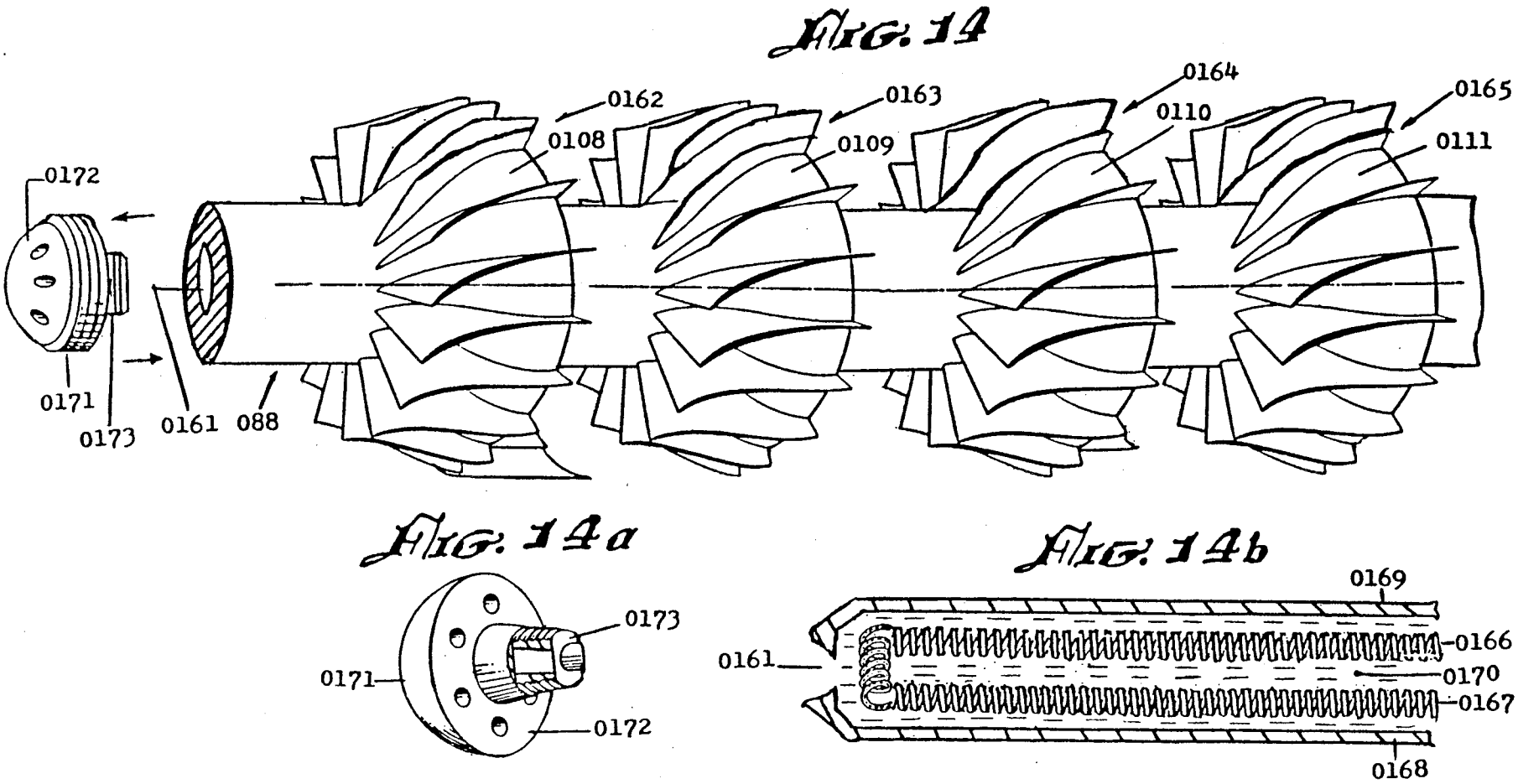
FIG. 14, 14*a* and 14*b* are pictorial views of the rotating shaft, turbine complex and internal coolant system for said structures.
Figure 17:
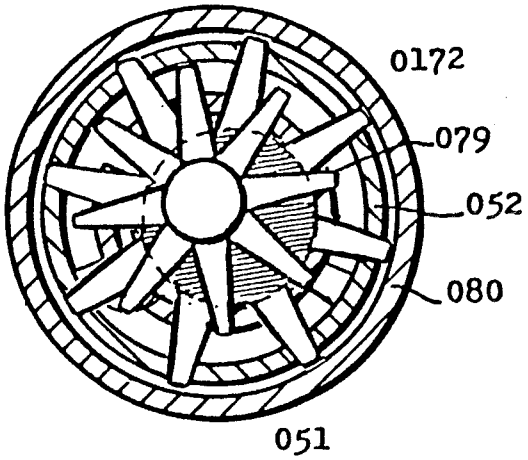
FIGS. 16, 17 illustrates the elliptical or eccentric rotation of said rotating shaft coupled to the aforesaid turbine complex.
Figure 16:
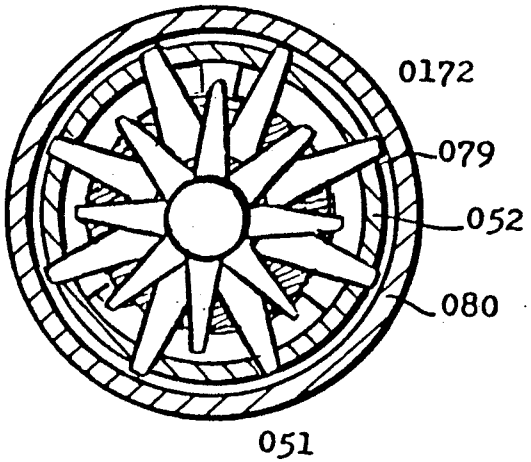

FIGS. 14, 14*a* and 14*b* represent pictorially the rotating shaft, turbine complex and internal coolant system for said structures. When high-velocity-plasma streams are injected along the curviture of blades forming the turbines, numbers 0162 to 0165. The heat exchange from blades of said turbines to the coolant system embodied within the rotating shaft elements prevents said turbines from superheating. In order to prevent vaporization or fracturing said blades are sintered and impregnated with metallics, which uniformly disperse heat from said blades to a centrally located rotating shaft element. The aforesaid rotating shaft element, number 080 has a hollow bore, number 0161, which contains coiled heat exchangers elements described by numbers 0166, 0167 of FIG. 14. Said heat exchangers 0166, 0167 are embodied within an internal conduit structure described by numbers 0168, 0169 and embedded in a liquid sodium conducting medium described by numeral 0170, wherein the heat conveyed from said shaft and said turbines is transmitted from the liquid sodium conducting medium to the aforesaid coiled heat exchanger elements. Heat absorbed by said heat exchanger elements is conveyed by an internal coolant embodied within said coiled structures. The coolant contained within said heat exchangers is preferrably liquified metal such as mercury, sodium or other suitable substances. Heat conveyed from the coiled heat exchangers is conveyed back to an accumulator, which is coupled to either a stirling engine means or magnetic hydrodynamic system, not shown in said figures but described later on in the specifications. Numerals 0171, 0172 and 0173 of FIGS. 14, 14*a* describe the terminal ratar cap, graduated head and threaded coupler elements, which lock said terminal rotor cap into said shaft structure allowing an elliptical or eccentric rotation of the terminal portion of said shaft as illustrated in FIGS. 16, 17 of the disclosure.

Figure 15A:
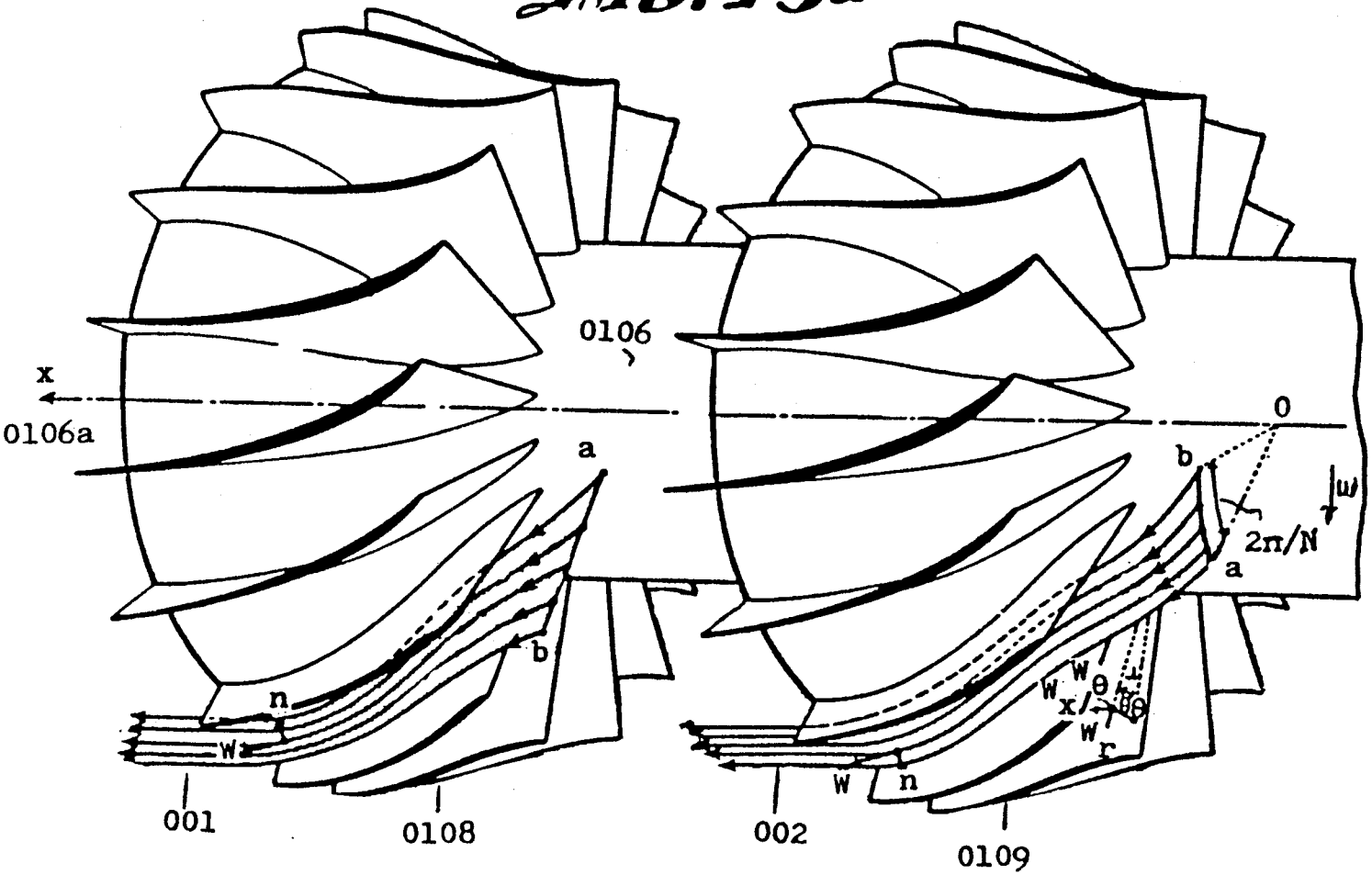
FIG. 15*a* described in an illustrative manner the flow of plasma over the blades of said turbines.
Figure 15:
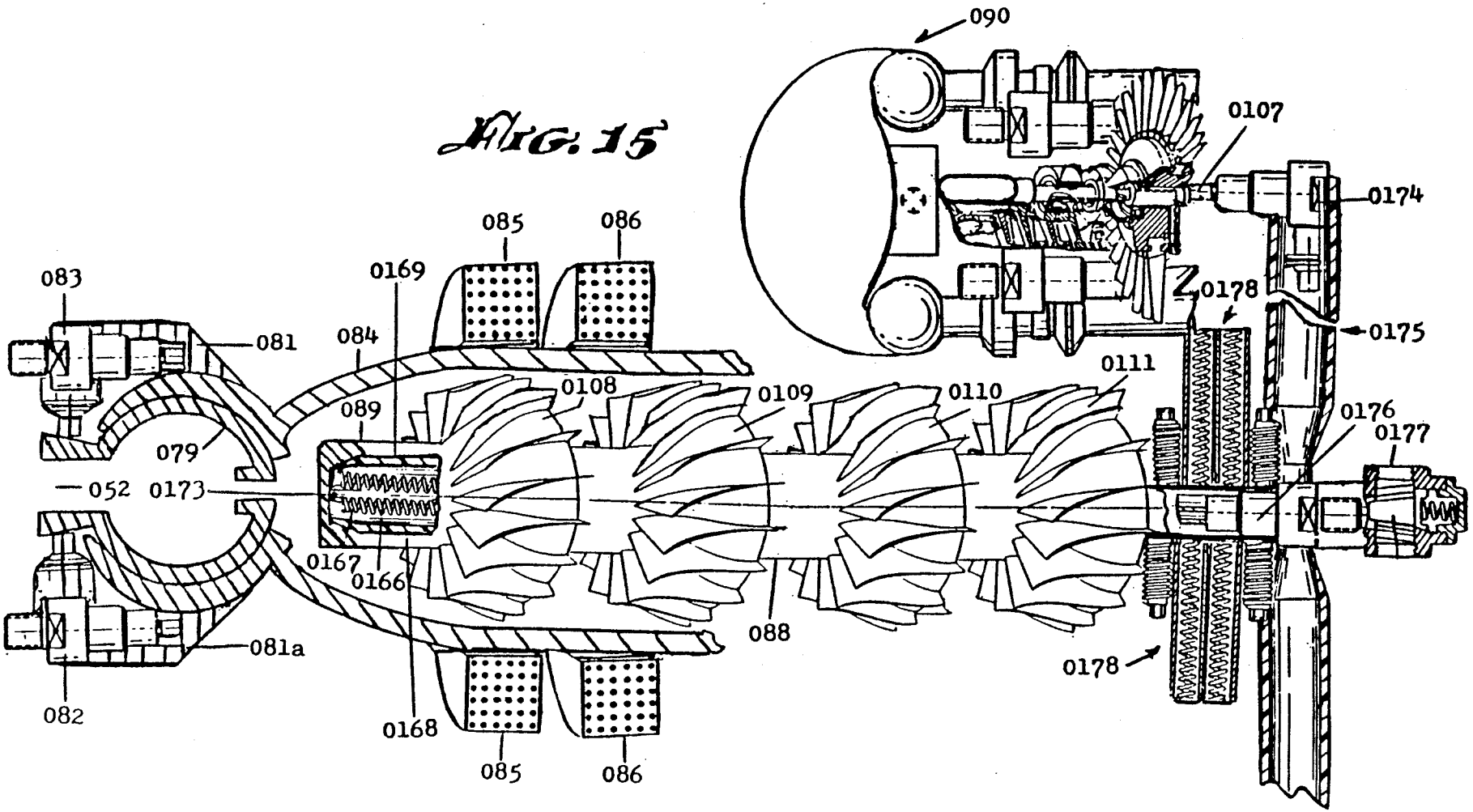
FIG. 15 is a partial sectioned view of the turbine complex rotating shaft, motor assembly and drive train means.

FIG. 15 is a partial sectioned view of the turbine complex, rotating shaft, motor assembly and drive train means. Numerals 052 through 0173 of FIG. 15 are identical to the same numbers in the preceding figures. Additionally shown is one of two equivalent angular drive mechanisms employing bearingless discs and magnetic levitation described by numeral 0174. Element 0174 is interdisposed in between coupler element 0175 and power train means 0176. A more detailed description of said bearingless disc system as disclosed in FIG. 15*a*; however at higher speeds magnetic levitation is preferred. Power train element 0176 transmits power from one or more said drive mechanisms. Said power train is engaged at lower speeds when sonic or subsonic flight is required and disengaged at higher speeds when plasma is discharged into the aforementioned cavity. One of several automated high speed soleniods defined by number 0177 engages or disengages paid power train element to allow the aforementioned rotating shaft coupled to the said turbine to freely rotate. Number 0178 of FIG. 15 discloses a thermal accumulator means coupled to rotating shaft 088.

FIG. 15*a* describes in an illustrative manner the flow of plasma over the blades of said turbines. The numbers assigned to the turbine structures correspond to the previous structures described in the preceding figure. Turbine structures 0108 and 0109 are mounted and fused to common shaft means 0106 which are contained within nozzular structure 080. A plasma stream derived from the surrounding sea is directed down back towards the turbine structures. Turbine 0108 acts as a compressor means having a rotation, which directs the aforementioned flow as illustrated by numeral 001 where it travels aft and is pressurized before encountering secondary turbine means 0109. Here the turbine behaves in an operative manner consistant with the operation of their conventional jet counterparts. The stream of plasma number 002 is compressed and moves circularly down towards one or more blades of turbine 0109. The central axis x of the rotating shaft numeral 0106 is described by element 0106*a* and its rotation, which is described by value w. The angular stresses placed on each blade are collectively indicated by values a, b, n, and are associated by tangental values $W_1$ through $W_e$, inclusive. The rotating shaft, turbines and subsequent turbine blades are composed of a special variation of a readily commerically available silicon nitride fiber reinforced composite means. (Metallic versions of the shaft, turbine and blade structures were found to deform, fracture, or disintegrate upon prolonged use). Some of the physical properties of the silicon nitride are briefly illustrated herein below by a typical phase diagram with rare earth additives, a structural atomic spatial orientation image and a brief axial graph of stress verses temperature, as described in FIG. 15*a*.

Figure 15B:
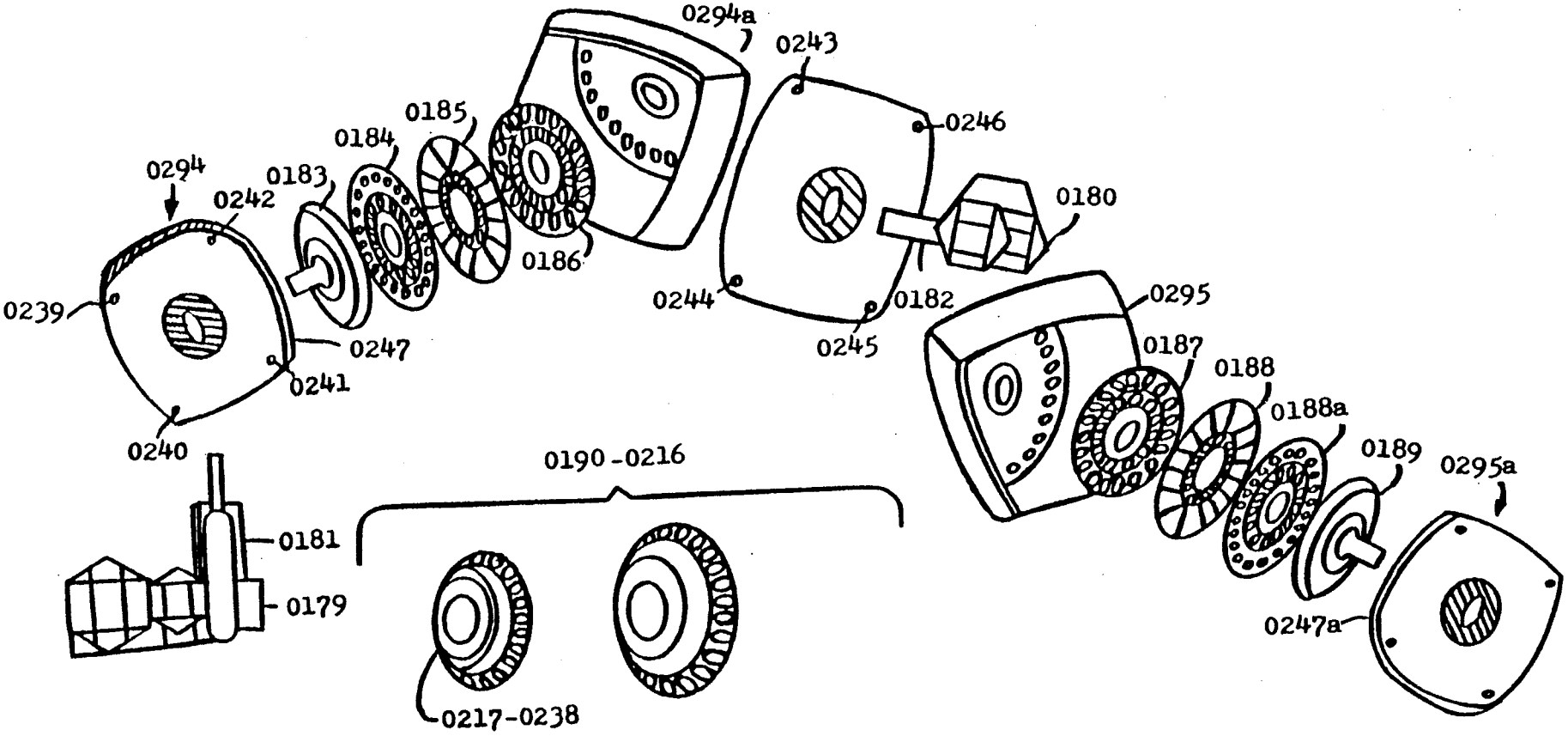
FIG. 15*b* entails a detailed exploded perspective view of a single gearless rotating shaft typical of the types employed to to drive the power train and robotic manipulator means.

FIG. 15*b* entails a detailed exploded perspective view of a single gearless rotating shaft with articulating joints equivalent to those incorporated in the robotic manipulator means. All structures disclosed in FIG. 15*a* are of a synthetic origins with the functional units being constructed from composites rather than exclusively of metallics. A single portion of the gearless rotating shaft is indicative of the type utilized in the rotating shaft means which powers the turbine complex. FIG. 15*a* is a detailed exploded view of the typical antifriction disc drive means employed by the robotic manipulators and automatic conduit system of the turbine system proper. Numerals 0179, 0180 of FIG. 15*a* depicts two self contained adjustable powered synchronous joints. Each motorized unit is provided with a flexible articulating shaft described by numbers 0181 and 0182 which provides the system with rapid percise angular motions that can be exacted. Rotary motion and torque are transmitted between the disc plate structures, as denoted by numbers 0183 through 0189. Each plate structure is separated from one another by jeweled ball bearing elements as indicated by numbers 0190 through 0216. Each ball bearing element is contained within its own complementary matching receptacle. The raised surfaces or curvatures located on the disc structures are of a spiral retrograde nature which are described by numbers 0217 through 0238. The rate of speed exacted by the drive shaft may either be reduced or increased; as well as increasing the torque value by altering the dimensions of the raised spiral curvature, which exists on two of the four interfacing plates. (The aforementioned parameters of the discs and ancillary structures such as the overlapping hubs providing variable ratios.) The system is so constructed as to provide at any given time that forty-five to fifty percent of the jeweled ball bearings are in the driving mode. The action of the disc system in the driving mode is diametrically opposed to gear systems, which at any given time have the entire output load riding on only a few gear teeth. The gearless antifriction disc systems is virtually devoid of backlash or slipage. A synthetic high polymer graphite lubricant, which is not shown, increases the drive efficiency and wearing properties of the ball bearing system. The outer casing denoted by numerals 0294 and 0295 like all materials composing the disc drive system is composed of a laminated multilayer non-metallic composite material well known by those skilled in the art. Each of the shells of the outer casing structures are secured to one another by eight securing bolts described in part by precision bore sites numbers 0239 through 0246, with sealing washers or gaskets, as denoted by numerals 0247, 0247.

FIGS. 16, 17 illustrate the elliptical or eccentric rotation of the aforementioned rotating shaft coupled to the aforesaid turbine complex. Experimental evidence indicates that a nine percent greater yeild in thrust can be realized over equivalent turbine rotating systems with a circular motion rather than an eccentric or elliptical motion.

Figure 18:
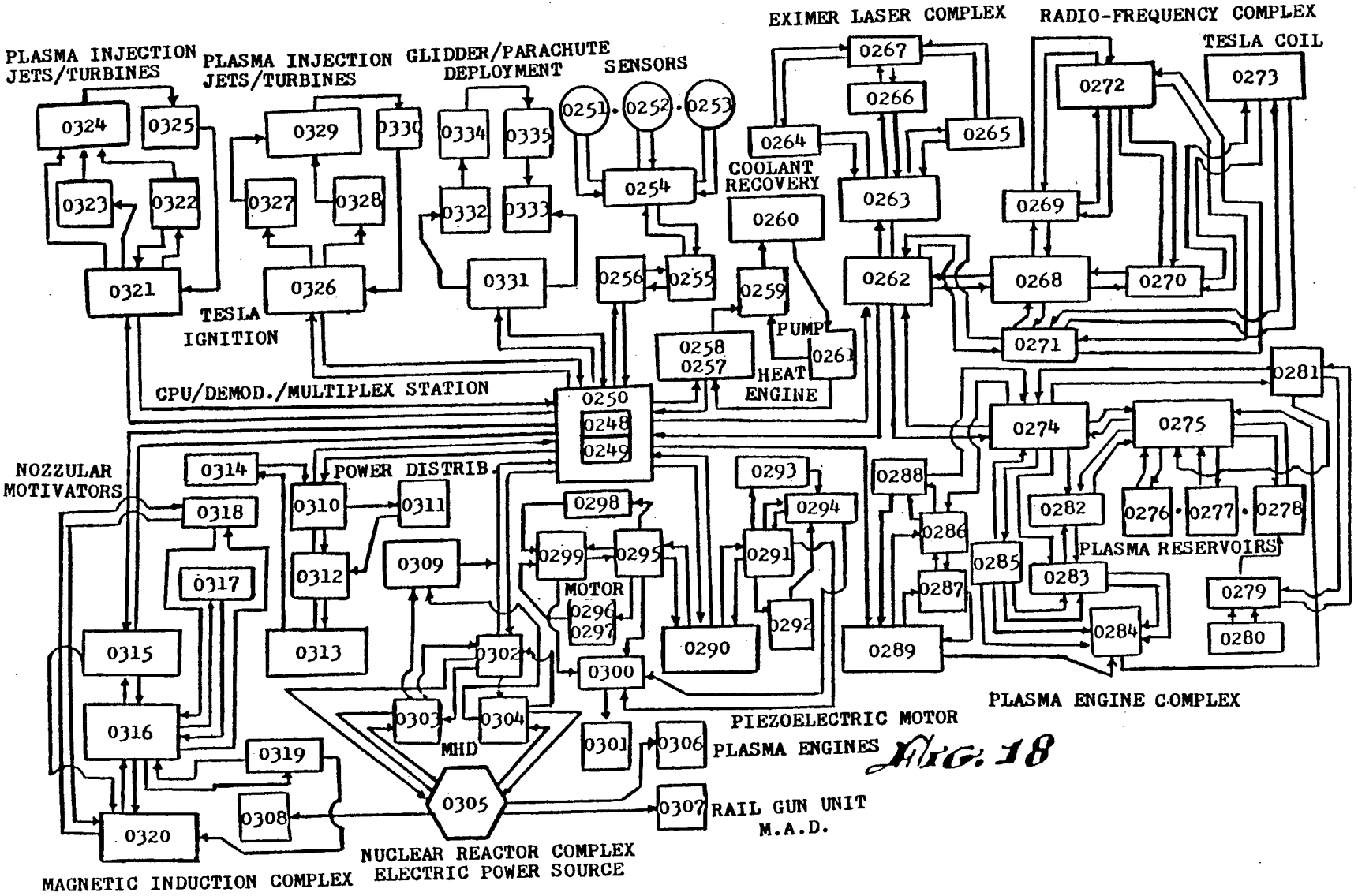
FIG. 18 is a block diagram summarizing the operations and subsequent interaction of subsystems embodied within a single plasma engine.

FIG. 18 is a block diagram summarizing the operations and subsequent interaction of subsystems embodied within a single plasma engine. There may be as few as two said engines or more than ten equivalent engines. The operation of each engine is synchronized by command signals executed by a master CPU: however each equivalent CPU can command more than one plasma engine. Numerals 0248, 0249 0250 of FIG. 18 designate a CPU coupled to a demodulator multiplexer station which is in turn coupled to a bidirectional electro-optical bridge element. The CPU receives information from sensors, subordinate systems, other CPU's and command signals from a master CPU. The aforesaid information is processed than acted upon so that command signals from said CPU can synchronize the operation of its plasma engine with the output of other equivalent engines. The electro-optical bridge interfaces both signals entering and exiting CPU 0248 with demodulator/-multiplexer means 0249 with exiting external systems and interval subordinate subsystems. Data from sensors 0251, 0252 and 0253 are integrated by signal compiler 0254, which conveys said signals to be filtered and enhanced by element 0255 prior to being applified by unit 0256. Data from amplifier 0256 is conveyed through bridge element 0250 and demodulator/multiplexer means 0249 prior to entering CPU 0248. Sensors are fine tuned through the reverse of said process described in the previous sentence. Passive stirling engines recover heat loss from the nuclear reactor, plasma exhausted down the turbines and other regions and convey coolant back and forth. Stirling engine 0257 recovers heat from heat exchangers coupled to accumulator means 0258. The aforesaid coolant is than conveyed to circulator pump 0259, which conveys said coolant to a recovery vessel additionally described by numeral 0260. Said coolant is conveyed from element 0260 to condensor 0261, prior to being recycled through the system; wherein accumulated heat absorbed from said system is discharged to said heat exchanger, number 0258. Command signals are conveyed to sequencer means 0262 which transmits both power and instructions to controller element 0263. Power and command signals are conveyed from controller 0263 to automated frequency element 0264, wavelength selector means 0265 and power output module 0266. The combined simultaneous outputs from elements 0264, 0265 and 0266 adjusts the wavelength, frequency wave characteristics and other parameters, including the power in joules per second of excismer laser element 0267. The status of said laser system and subordinate systems are monitored by sensors and reconveyed back from said systems through the sequencer element, number 0262. Sequencer element 0262 engages controller means 0268 which simultaneously engages elements 0269 through 0271. Element 0269 controls the electrical polaraity of radio-frequency means 0272. Elements 0271, 0270 controls the output power and field strength of radiofrequency generators 0272 and Tesla coil means 0273. The feedback systems regarding internal status or operational readiness for the Tesla coil systems and radiofrequency generators which are equivalent to those of the excismer laser means. Sequencer 0262 additionally engages controller element 0274 which engages gas compiler 0275. Gas compiler 0275 obtains plasmitizable gases from storage sources 0276, 0277 and 0278 which represents the primary and secondary reservoirs to some finite value n. Numeral 0279, 0280 and 0281 represent a pump generator element to extract plasmitizable substances from the environment surrounding the M.A.L.K.E. device, source generating means or gasifier and a regenerator element to restructure recovered gaseous plasmitizable substances. Processed materials from element 081 are conveyed to sequencer 0274 for redistribution to gas compiler means 0275. Sequencer means 0274 controls automated electromagnetic piezoelectric servos which acts as governor values to open and close inlet and outlet junctures. Gases from element 0275 are distributed to mixer means 0282, upon commands conveyed from sequencer 0274 to elements 0275, 0282. Mixer means 0282 conveys its contents upon commands from sequencer 0274 to gasifier unit 0283; once sensors indicate that the gases mixed in element 0282 are determined to have the correct chemical composition. Gasifier element 0283 volatilizes said gases and sends commands from sequencer 0274 transfers its contents to discharge means 0284, wherein said volatile gases are dispersed to secondary reservoirs and Tesla means. Sequencer 0274 engages said solenoid means controlling inlet and outlet governor values described by input/output sequencer 0285. Sequencer 0274 engages automated compression pump means 0287 to compress said volatilized gases and to superheat said gases from energy derived from the heat exchanger coupled to the nuclear reactor source, as described by numeral 0287. Element 0286 engages elements 0287 and 0288, which reclaims any unused gases. Elements 0286 through 0288 are conveyed to reprocessing plant 0289. Sequencer 0290 interfaces with elements 0250, 0249 and receives commands from CPU 0248 to power one or more piezoelectric motors embodied within said plasma engine for low speed maneuvers. Sequencer 0290 engages controller 0291, which in turn engages 0292, 0293. Element 0292 controls the field polarity and power of piezoelectric motor 0294; whereas element 0293 controls the magnetic field strength or flux of the smarian cobalt electro-magnets providing levitation for the rotating shaft element of said motor 0294. Sequencer 0290 engages controller 0295, which engages element 0296, 0297 and 0298 which corresponds to element 0292, 0293 and 0294, respectively. Elements 0292, 0293 and 0294 engages piezoelectric motor 0299 which is equivalent to said piezoelectric motor 0291. Either one or both of the aforesaid piezoelectric motors, numbers 0291, 0299 engages power train element 0300 and said power train element engages the rotating shaft coupled to the turbines of the aforementioned plasma engine, described by numeral 0301. The aforesaid plasma engines, subsystems and other systems must receive a reliable said continuous source of electrical energy. The nuclear reactor power source, described by element 0305, powers magnetic hydrodynamic system 303 and generator 304 which are interfaced with controller element 302. Controller 302 distributes power to all component subsystems embodied within said plasma engines and through command signals from CPU 0248 the output of elements 0303, 0304 are adjusted to specified parameters. Nuclear reactor 0305, additionally, powers other generators and magnetic hydrodynamic systems (MHD) powering other said equivalent plasma engines and other systems embodied within the M.A.L.K.E. device, as indicated by elements 0306, 0307 and 0308, respectively. Power in the form of electrical energy is transmitted from elements 0303, 0304 to distributor means 0309, wherein power is dispersed to other component systems embodied with said plasma engine means. Data regarding status of subsystems 0310 to 0313 are conveyed from controller element 0309 to CPU 0248 and command signals from CPU 0248. Controller 0319 engages elements 0310, 0311, which controls the polarity and regulates the power conveyed to sequencer means 0312. Sequencer means 0312 engages nozzular motor elements, which are collectively described by numeral 0312. The nozzular motor elements collectively described by numeral 0313 orientate the direction of the nozzle structures to provide in flight course adjustments for the M.A.L.K.E device as indicated by feedback element 0314. The flow of plasma exiting the nozzular structure is further focused by a series of magnetic induction elements extending from the aft turbine structures to the first nozzular constriction corresponded to the ball and socket rotating element described previously in the specifications. Numerals 0315, 0316 describe the sequencer and controller elements. Upon instruction from the CPU, number 0248, sequencer 0315 engages controller 0316. Controller 0316 engages elements 0317, 0318 and 0319 which controls the polarity, power and field strength of magnetic induction elements 0320. The introduction and movement of plasma is monitored by electro-optical sensors which conveys data to CPU 0248 which determines whether to engages or disengages said magnetic induction element 0320. The sequence of discharging high velocity plasma from the terminal portions of the aforementioned Tesla coil apparatuses is regulated by sequencer 0322, which receives command and relay status reports to controller element 0321. The adjustment in the rate of firing coinciding with plasma discharge is controlled by regulator element 0323. The output of elements 0321, 0322 and 0323 are conveyed to an array of plasma jets circumferentially disposed around the rotating shaft and facing the obverse blades of the turbines. The array of said plasma jets is collectively described by element 0324. The output of element 0324 is monitored by feedback system 0325, which conveys the status of element 0324 back to controller element 0321. The data received by controller 0321 is then conveyed back to CPU 0248 for analysis. Elements 0326 through 0330 correspond to elements 0321 through 0325; with the exception that another ancillary system is actuated rather than an array of plasma jets. The M.A.L.K.E device is equipted with a combination glider parachute system for high and low altitude deployment. Data from gyroscopic systems relayed to CPU 0248, actuates controller element 0331, which engages deployment means 0332. Deployment means 0332 either actuates a solenoid/spring release mechanism or gas injection means to inflate the aforesaid glidder element. Element 0332 then engages parachute and/or glidder dispersal means 0333, which ejects said glidder and/or parachute means. The status of deployment are monitored by sensors embodied within feedback system 0334, which conveys data to controller element 0331 and if necessary directly engages a motorized re-deployment recovery element, described by numeral 0335 to recover or reclaim glidder or parachute means for future use.

The structure, design and combination of said plasma engines allows the M.A.L.K.E. device to take off and hover at extreme speeds simultaneously from the vertical and horizontal position. Additionally, sharp 90 and 180 degree turns are negotiated at speeds hereto not achieved by present existing systems. Further, said sharp angular turns are readily executed by the turbines coupled to the output of one or more piezoelectric engines in the absence of plasma; when the introduction of plasma from said engines would subject said device to attack from heat-seeking weapons.

Figure 19:
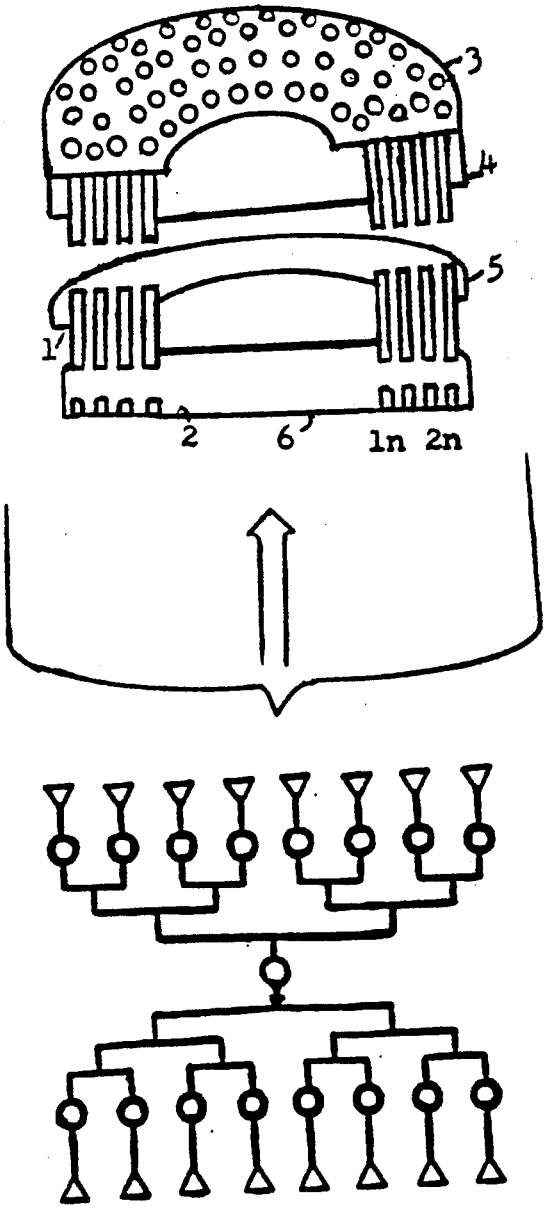
FIG. 19 is indicative of a partial cross-sectioned view of the inner and outer hull structure of the Mobile Assault Logistic Kinetmatic Engagement (M.A.L.K.E.) Device.

FIG. 19 is indicative of a partial cross sectional view of the outer and inner hull structure of the M.A.L.K.E. device a phased array antenna means. The type and structural configuration of the hull provides virtually a 360 degree limited range phased array synthetic aperture radar means. The outer and inner hulls of the device compose a three dimensional telemetry system extending 360 degrees in all directions. Elements 1 to 1*n* represents separate coherent continous wave radiofrequency transmitters and element 2 to n 2*n* denotes separate compatable receiver coupled filter means. The outer hull is indicated by numeral 3 and numbers 4 and 5 denote internal spacers. The inner hull of the device is described by numeral 6. The multitude of electronic junctures and switching elements and structural configuration provides the basis of synthetic aperture radar.

Figure 19A:
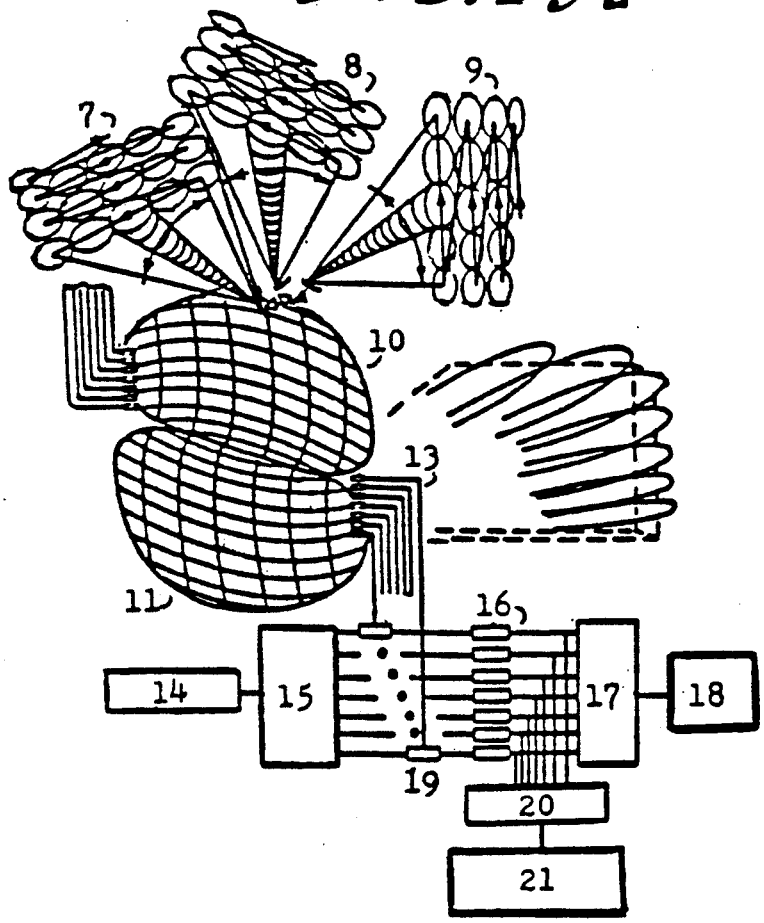
FIG. 19*a* schematically described a three dimensional scanning radar taken in real time.

FIG. 19*a* schematically describes in a block diagram format a typical three-dimensional scanning radar telemetry with additional azimuth rotation and elevation sequencers in real time. Three separate planes of azimuth rotation 7, 8, and 9 are described eminating from their respective hull surfaces denoted by elongated shields 10 and 11. Subminiature feedhorns are embedded in the hull, as indicated by element 12. Numerals 13, 14 and 15 indicate the transmitter, power divider and receiver filter units, respectively. The summator, PPI display and duplexers are denoted by elements 16, 17, 18 and 19, temporal spacial differencing is indicated by element 20 and the range and height are tabulated by element 21.

Figure 19B:
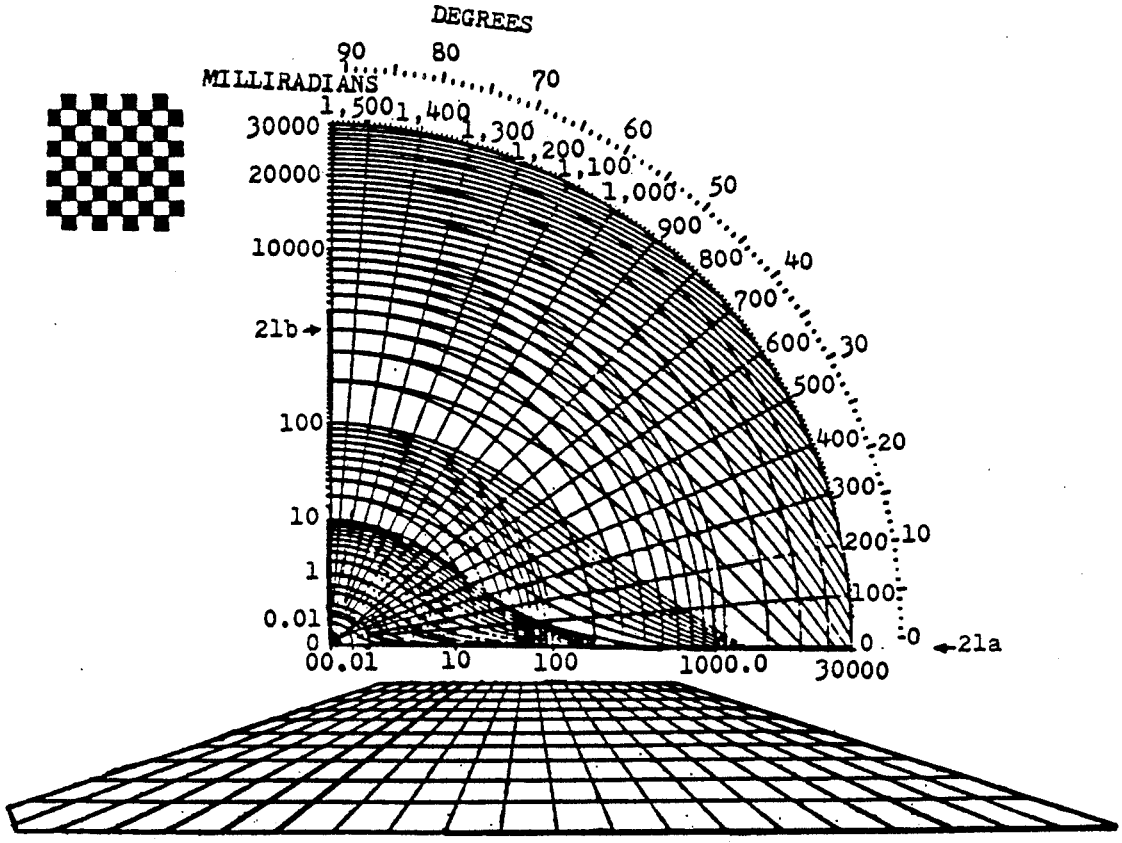
FIGS. 19*b* through 19*g* are graphical representations of range, transmission of CW sequences and the effects of main lobe clutter regarding the phased array antenna forming said hull structure embodied within said device.

FIG. 19*b* denotes grapically a typical extended range height angle chart for targeting various centroids in the immediate vicinity of 30,000 kilometers. Numeral 21*a* describes the height in kilometers which describes the y axis and numeral 21*b* describes the range in kilometers circular arcs which describe the x axis.

Figure 19C:
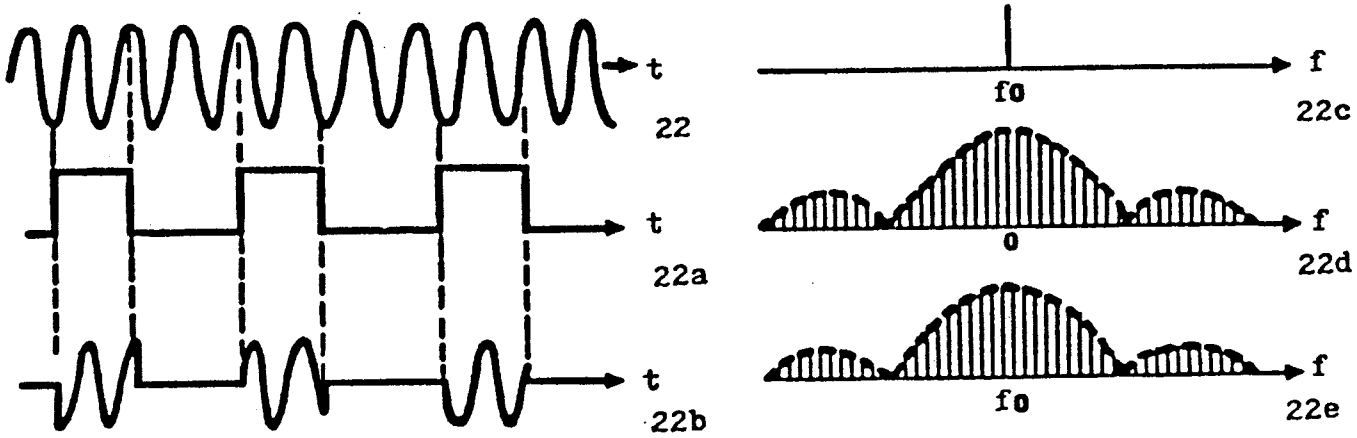

FIG. 19*c* is a typical simplified graphical version denoting the continuous wave mode phenomenon of a single coherent transmission sequence. Typical CW video and rf are indicated by numbers 22, 22*a*, and 22*b* as are their typical frequency patterns. Numerals 22*c*, 22*d* and 22*e* denote the typical frequency and line fluctuation.

Figures 19D, 19E:
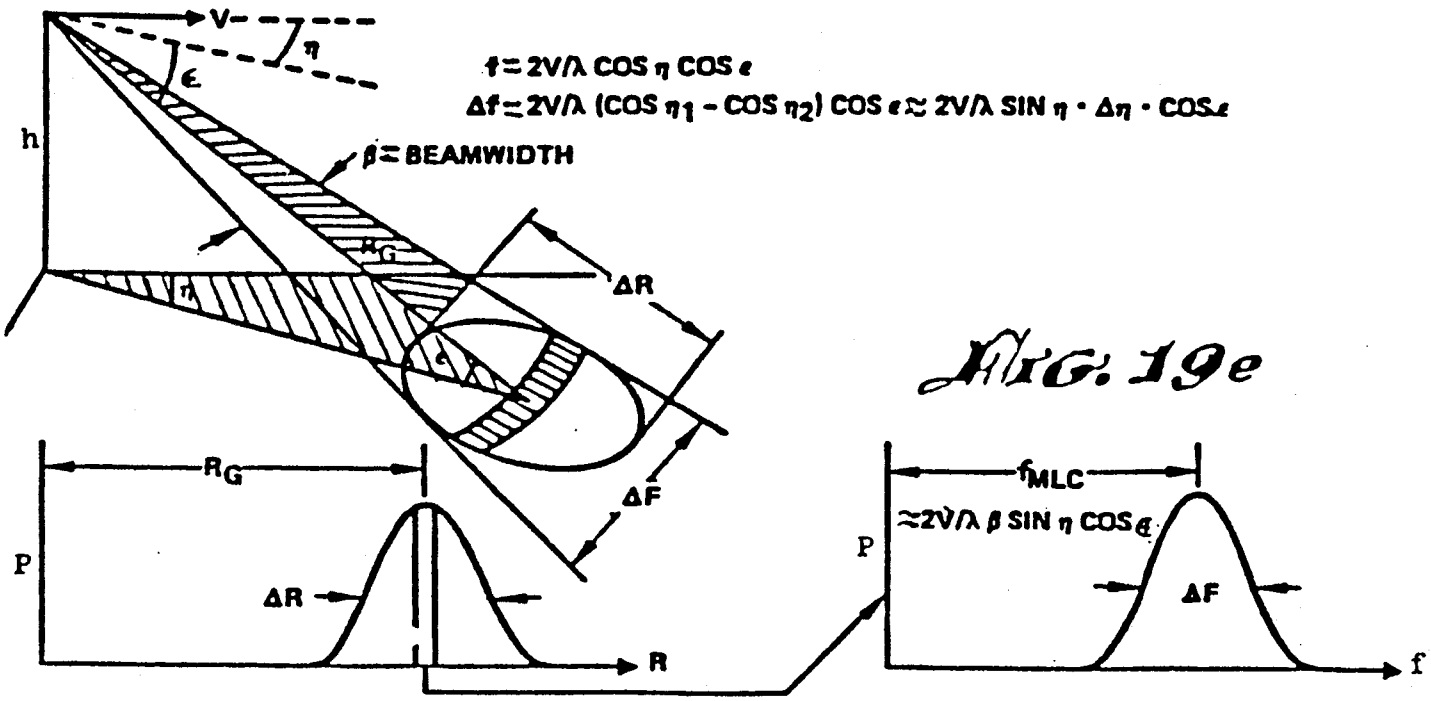

FIGS. 19*d*, 19*e* denotes in an illustrative manner a main lobe clutter. As is the usual case both the range and angle with respect to amplitude is determined by the cross section and frequency with the angle across a given ground patch. Numerous equations for radar operations have been advanced in the past few years, some of which are briefly described herein below;

RADAR RANGE EQUATION $$R^4 = \frac{O^T F}{4\,\Omega\ ZkT_S L} P_A A_E$$

R = RADAR RANGE
O = TARGET RCS
$T_F$ = SEARCH FRAME TIME
Ω = SOLID ANGLE SEARCHED
Z = REQUIRED POWER SNR
k = BOLTSMANN'S CONSTANT
$T_S$ = SYSTEM TEMPERATURE (NOISE)
L = SYSTEM LOSS FACTOR (L 1)
$P_A$ = AVERAGE TRANSMITTER POWER

RADAR TRACKING ACCURACY EQUATIONS $$O_\theta 2 = \frac{K\,\Omega\,R^4\,k\,T_S\,L}{\sigma T_F}\ \frac{\lambda^2}{P_A\,A_E^2}\ \text{(TWS)}$$

$$O_\theta 2 = \frac{K\,R^4\,k\,T_S\,L}{\sigma T_D}\ \frac{\lambda^4}{P_A\,A_E^3}\ \text{(SPOTLIGHT)}$$

$O_\theta^2$ = MEAN SQUARED TRACKING ERROR (NOISE COMPONENT)
K ≈ 2 (DEPENDS UPON APERTURE ILLUMINATION TAPER)
λ = RADAR WAVELENGTH
$T_D$ = TRACKER DWELL TIME

MTI PERFORMANCE MEASURES $$\text{MTI IMPROVEMENT FACTOR I} = \left(\frac{S_O/C_O}{S_I/C_I}\right)\text{AVERAGE}$$

SUBCLUTTER VISIBILITY SCV = $(C_I/S_I)$ ALLOWED AVERAGE
CLUTTER VISIBILITY V = $(S_O/C_O)$ REQUIRED
CLUTTER ATTENUATION CA = $(C_I/C_O)$

I = SCV × V = CA × $(S_O/S_I)$ AVERAGE

In the radar equation, if we make the bandwidth B equal to 1/pulselength (which is usually true and is an approximation to a matched filter), and the number of the pulse summed equal to the time-on-target divided by the PRI, then the signal to noise ratio depends on average power.

$$\frac{P_S}{P_N} = \frac{P_{PEAK}\, G^2\lambda^2\sigma}{(4\pi)^3 R^4 KTBF} \text{ per pulse}$$

$B$ MADE $= 1/r$ ($r$ = PULSE LENGTH)
NUMBER OF PULSES ADDED $= N = \frac{TOT}{PRI}$ $$\frac{P_S}{P_N} = \frac{P_{PEAK} r TOT\, G^2\lambda^2\sigma}{PRI(4\pi)^3 R^4 KTF} \quad \frac{(P_{PEAK})r}{PRI} = P_{PEAK\,(DUTY\ FACTOR)} = P_{AV}$$

TYPICAL RANGE EQUATION $$\frac{P_R}{P_N} = \frac{(P_{AV}\, TOT)G^2\lambda^2\sigma}{(4\pi)^3 R^4 KTF} \quad P_R = \frac{P_T G A_e \sigma}{(4\pi)^2 R^4} = \frac{P_T G^2\lambda^2\sigma}{(4\pi)^3 R^4}$$

also, since $G = \frac{4\pi}{(\theta_B)^2} = \frac{4\pi A_e}{\lambda_2}$ $\quad P_R = \frac{P_T\lambda^2\sigma}{4\pi R^4(\theta B)^4} \quad \frac{P_T A_e{}^2\sigma}{4\pi R^4\lambda^2}$ The antenna consists of multitude of voltage sources which are distributed along its length at spacing dX Each source contributes $VdXe^{j2}\,(fot + \theta X)$ to the sum, which become $$\text{output} = \sum_{X=D/2}^{X=D/2} VdXe^{j2\pi(fot+\theta X)} = Ve^{j2\pi fot} \sum_{-D/2}^{D/2} e^{j2\pi\frac{\theta X}{\lambda}}\, dX$$

represent this by an integral: $Ve^{j2\pi fot} \int_{-D/2}^{D/2} e^{j2\pi\frac{\theta X}{\lambda}}\, dX$ $$\text{output} = Ve^{j2\pi fot}\frac{\text{SIN}\,\frac{\pi\theta D}{\lambda}}{\frac{\lambda\theta}{\lambda}}$$

for the case of equality: $\frac{\text{peak output power}}{\text{output noise}} = \frac{\text{input signal energy}}{N_o/2}$ ↑ independent of input waveform

SOME GENERAL INPUT-OUTPUT RELATIONSHIPS FOR LINEAR TIME-INVARIANT SYSTEMS $$\frac{X(t)}{n_1(t)} \quad \frac{H(w)}{h(t)} \quad \frac{y(t)}{n_2(t)}$$

↑
white noise, density
$N_o/2$ watts/Hz $$y(t_o) = \int_{-\infty}^{\infty} h(to - \tau)X(\tau)d\tau \text{(convolution)}$$

$$= \frac{1}{2\pi}\int_{-\infty}^{\infty} H(w)X(w)e^{jwto}dw \text{(transform: } Y(w) = H(w)X(w))$$

$$\text{peak signal power: } y\,(to)^2 = \left[\frac{1}{2\pi}\int_{-\infty}^{\infty} H(w)X(w)e^{jwto}dw\right]^2$$

$$\text{average noise power: } n_2(t)^2 = \frac{N_\sigma}{4\pi}\int_{-\infty}^{\infty} |H(w)|^2 dw$$

THE INPHASE AND QUADRATURE COMPONENTS OF RECEIVER NOISE CAN BE TREATED AS INDEPENDENT, GAUSSIAN, ZERO MEAN AND EQUAL VARIANCE $$p(n_1,n_Q) = \frac{1}{2\pi\sigma^2}\, e^{\frac{-(n12+nQ2)}{2\sigma 2}}$$

the probability of envelope $V$ of noise exceeding a threshold $V_o$ $\quad -\frac{1}{\sigma^2}\int_{V_o}^{\infty} Ve^{\frac{-V2}{2\sigma 2}}\, dV = e^{\frac{-Vo2}{2\sigma 2}}$ -continued is given by $$V > \quad V_o \frac{1}{2\pi\,\sigma^2} e^{\frac{-(n_1 2 + nQ^2)}{2\sigma 2}} dn_1 dn_Q$$

OPTIMAL RECEIVER

INPUT $V(t) = \sqrt{E_b}\ S(t) + H(t) \quad 0 \leqq t \leqq T\ H_i$ $= W(t) \quad 0 \leqq t \leqq T\ H_0$ where $\int_0^T S^2(t)dt\ e\ 1$ SIGNAL ENERGY OUTPUT $A_0 = \int_0^T S(t)W(t)dt = W(t) \rightarrow H_0$ $A_1 = \int_0^T S(t)\{\sqrt{E_b}\ S(t) + W(t)\}dt = \sqrt{E_b} + W \rightarrow H_i$ $E\{A_0|H_0\} = 0 \qquad E\{A_1|H_1\} = \sqrt{E_b}$ $\mathrm{VAR}\{A_0|H_0\} = \mathrm{VAR}\{A_1|H_1\} = N_0$

APPLYING THE SCHWARTZ INEQUALITY TO THE FILTER INPUT-OUTPUT RELATIONSHIP

For input noise spectral density $= \frac{N_o}{2}$ (white noise)

$$\underbrace{\left[\frac{1}{2\pi}\int_{\infty}^{\infty} H(w)X(w)e^{jwto}dw\right]^2}_{\text{peak output signal power}} \leqq \underbrace{\frac{1}{2\pi}\int_{\infty}^{\infty} |H(w)|^2 dw}_{\frac{2}{N_o} \times \text{ output noise}} \underbrace{\frac{1}{2\pi}\int_{\infty}^{\infty} |X(w)|^2 dw}_{\text{input signal energy}}$$

equality if and only if: $H(w) = \alpha X^*(w)e^{-jwto}$ time reversal ($\alpha$SCALAR)

CONSTANT SIGNAL IN NOISE MODEL (MARCUM)

$$\text{Signal} = S\ \mathrm{SIN}\ (\omega t + \theta)$$

$$= \underbrace{S\ \mathrm{SIN}\ \theta\ \mathrm{COS}\ \omega t}_{\text{"1" component}} + \underbrace{S\ \mathrm{COS}\ \theta\ \mathrm{SIN}\ \omega t}_{\text{"Q" component}}$$

$$\text{Noise} = n_1(t)\ \mathrm{COS}\omega t + n_Q(t)\ \mathrm{SIN}\omega t$$

$$\text{Signal Plus Noise} = V = [S\ \mathrm{SIN}\ \theta + n_1(t)]\mathrm{COS}\omega t + [S\ \mathrm{COS}\ \theta + n_Q(t)]\ \mathrm{SIN}\ \omega t$$

$$\text{Total signal and noise power} = S^2\ \mathrm{SIN}^2\ \theta + n_1{}^2 + S^2\ \mathrm{COS}^2\ \theta + n_Q{}^2$$

$$= S^2 + n_1{}^2 + n_Q{}^2$$

THE DISCRETE FOURIER TRANSFORM GENERATES A COMPLETE DOPPLER FILTER BANK

Figure 19F:
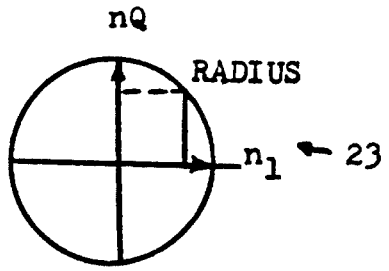
Figure 19G:
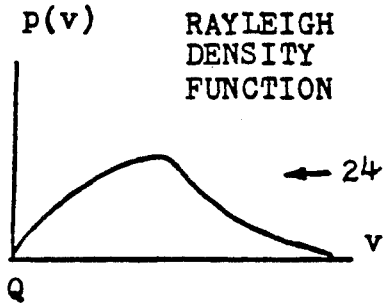

Let $Y_K = X_K A_K$ and $W = e^{\frac{j2}{N}}$ then $F_1 = \sum_{K=i}^{N} Y_K W^{IK}\ 0 \leqq 1 \leqq N$ constitute the $N$ - point discrete Fourier Transform of the sequence $Y_1, Y_2, \ldots Y_N$ FIGS. 19*f*, 19*g* disclose graphical representations for the ranging equations, Raleigh Density Function and related parameters for tracking. FIG. 19*e* denotes a simple circular graph describing the relationship of nQ to $n_1$. FIG. 19*e* is assigned a single numeric value defined by number 23. FIG. 19*h* is a graphical representation of the aforementioned Rayleigh Density Function descibing the relationship between parameters p(v), Q and V. The fact that the M.A.L.K.E. device is equipted with a double hull phase array radar system is inconsequential, since many such systems are known to exist in present technology. The speed and accurracy of phase array systems in relation to systems coupled to mechanical motivators is a net gain of several orders of magnitude even where resolution and cost are not a consideration in the deployment of said systems.

Figures 20, 20A, 20B:
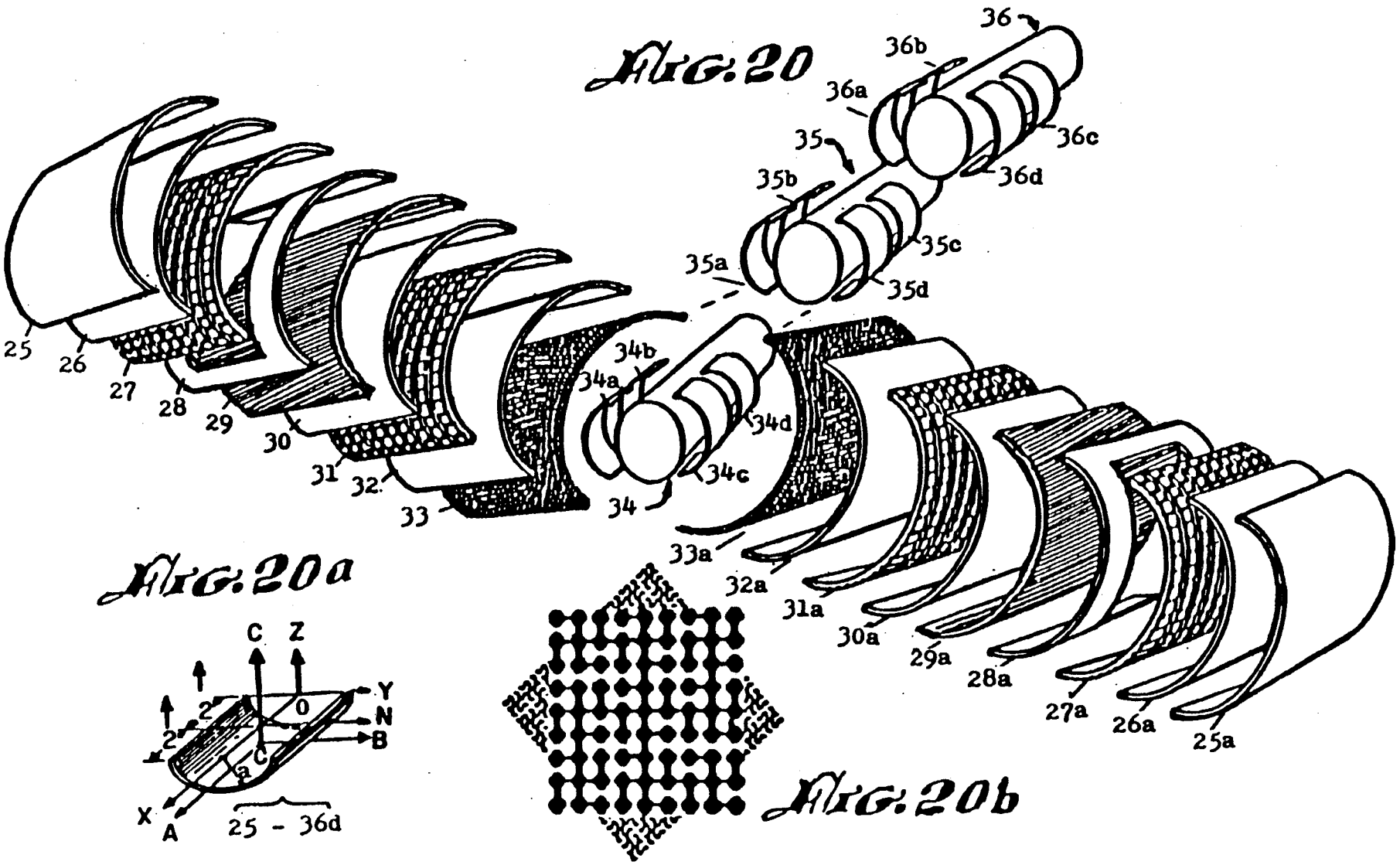
FIGS. 20, 20*a* and 20*b* are detailed structural views of the tubular assembly of cylindrical overlapping structures forming the muzzle of a single Mass Action Device embodied within the M.A.L.K.E. unit.

FIGS. 20, 20*a* and 20*b* describe a more detailed view of the tubular assemblage of cylindrical overlapping and interlocking plates arranged to form the muzzle of the device. The outer casing of the device, 25 and 25*a* is composed of light weight epoxylated alloy of chromium, titanium and magnesium, which is preceded by an elastic ceramic composed of boron nitrate, elements 26 and 26*a*. Structures 27, 27*a*, 31, and 31*a* are constructed from a fibrous mesh of a polymorphic silicon, such as commerically available Kalvar or other similarly suitable materials. Lamination sheets, 28 and 28*a* are interdisposed between elements 27, 27*a* and 29, 29*a*, the later consisting of a highly resilient stainless steel alloy. Elements 30, 30*a*, 32 and 32*a* are composed of a commerically available alloy of molybdenum tungsten halide, which is affixed or laminated to structures 33 and 33*a*, which are composed of a tridirectional synthetic carbon or graphite reinforced epoxylated medium. Circumferential tubular structures 34, 35 and 36 are geometrically graduated, such that, each can insert into the other preceding structure, wherein each is laminated to the other. Ancillary structure defined by elements 34*a* through 34*d*, 35*a* through 35*d* and 36*a* through 36*d*, respectively are equivalent to structures 25 through 33. Hence each tubular structural unit is equivalent to the next which provides a single unitary perpendicularly reinforced assemblage of complementary multivariant structures, each of which is bounded, fused, or laminated to the other.

Figure 21:
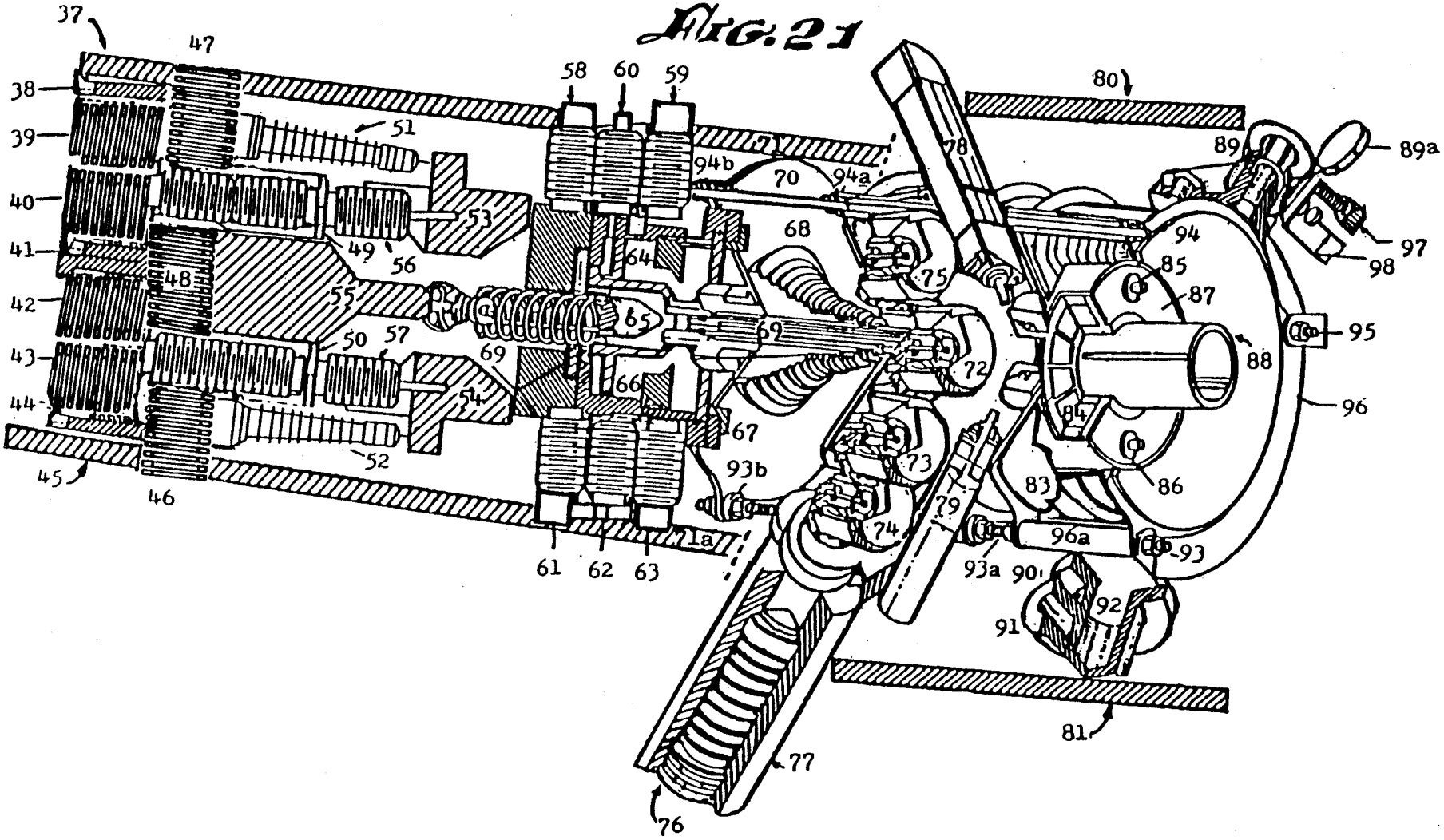
FIG. 21 is a detailed cross-sectioned view of the main body of the hybrid M.A.D. unit disclosing the three major launch systems which provides thrust for projectiles.

FIG. 21 affords a detailed cross-sectioned view of the main body of the M.A.D. device. Numerals 39, 40, 42, 43, 46, 47 and 48 define in part a capacitance bank and light weight feroceramic transformers, which are stacked in the aft section of the device in a radial manner. Elements 38, 41 and 44 are indicative of non-conducting spacers. Numbers 37, 45, 80 and 81 are illustrative of angular cylindrical support structures. Numerals 49, 50, 51 and 52 are voltage acceleration coils leading to common anodes, defined by numerals 53, 54, 56 and 57. The common body of the cathode structure are defined by elements 55, 65 and 65*a*. Structures 58, 59, 61 and 63 denote in part a portion of the closed system coolant means, which is deployed to cool the anodes, cathodes and other structures. Numbers 60 and 62 are additional voltage acceleration coils conducting high voltage charges leading from a series of external charging capacitors and charging coils. Elements 68, 69 are the extended portions of the cathode and anode means, whereas 67 represents a non-conducting structural support strut or stay means. Numerals 70, 71, 66 and 71*a* are enlarged support bushings and two of at least four support struts. Structures 72, 73 and 74 are cannisters bearing wafers of a suitable solid plasmoid (cesium, copper, mercury, teflon etc.) and internal locking cathode/anode means. Numeral 76 contains a multitude of cannister structures; whereas numeral 75 is indicative of a faulty cannister means, which has been placed in an exclusion chamber, ready to be ejected from the main frame of the device. Structure 77 reveals in part the loading chamber and autofeed means for the aforementioned cannister elements 72 through 76. Numerals 78 and 79 reveal in part portions of the Tesla coil complex, which adds both additional arcs and secondary surge of plasmoids. Numbers 80 and 81 refer to a previously mentioned cylindrical support plates. A complex of primary induction magnetic coil 82 and 83 structure placed circumferentially along the primary launch tube 88 provide an additional source of propulsion and prapagation of motion. Extended charging rail structures denoted by number 84 provide a secondary means of propulsion for projectiles interjected into the central chamber of structure 88. Numerals 85 and 86 are two of four structures which conduct or circulate coolant to reduce the temperature of the launch tube 88 and the d.c. rail housing denoted by number 87. Numerals 89, 90, 91, and 92 are interlocking chambers leading to launch tube 88 for expelling explosive and armor piercing projectiles, respectively. Locking bolts are provided for all support struts, three of six which are indicated by elements 93 through 95. A locking plate 96 is provided for interlocking bushings, one of which is illustrated by number 96*a*, which acts as tubular guides for the support strut means. An orifice closure mechanism numeral 89 operated by bidirectional loading solenoids 97 and 98 opens and closes to allow each projectile to be emitted, allowing a machined precision stopper top 89*a* to slide over means 89.

Figure 22:
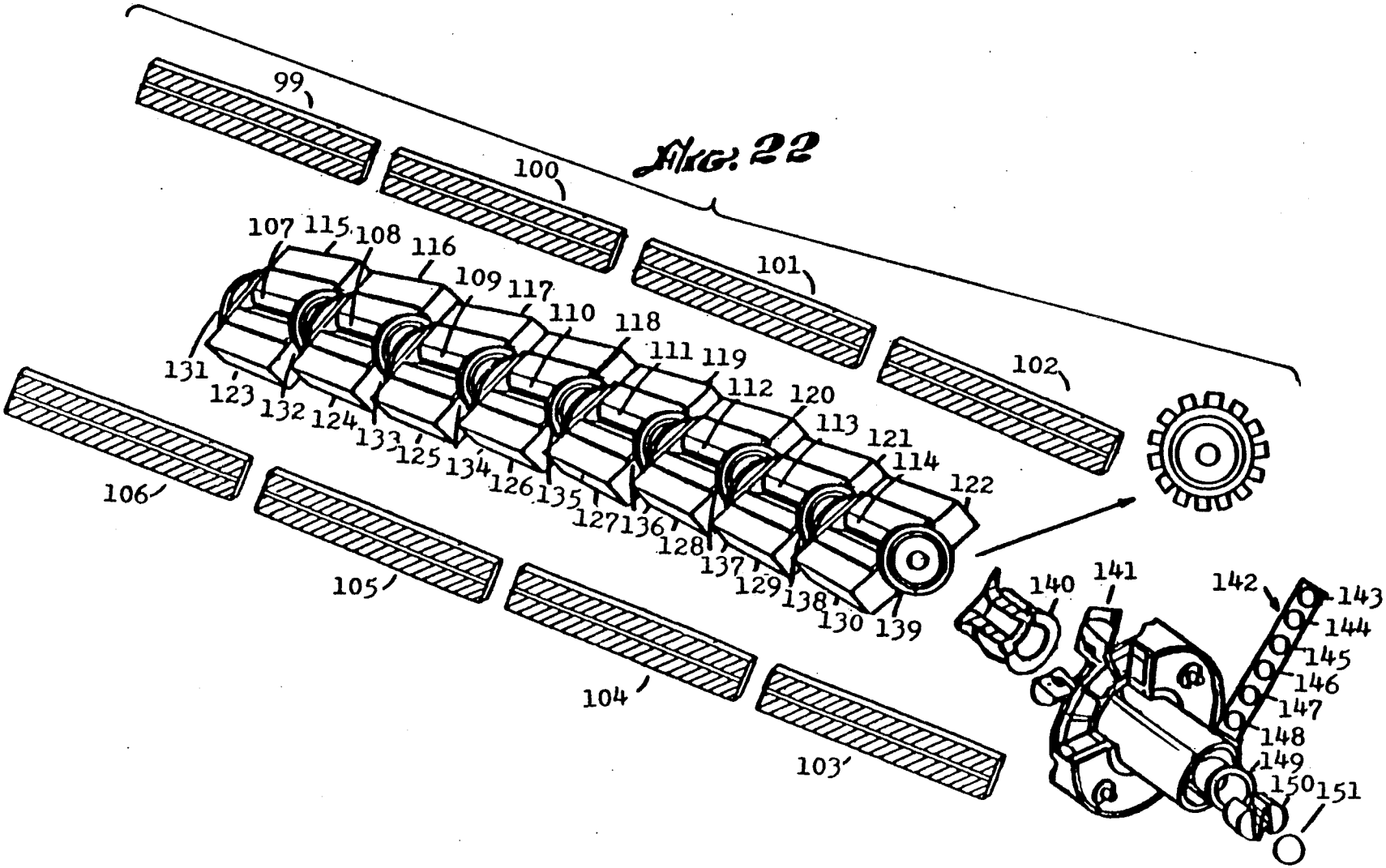
FIG. 22 is a detailed perspective view of the modified rail gun assembly.
Figure 22A:
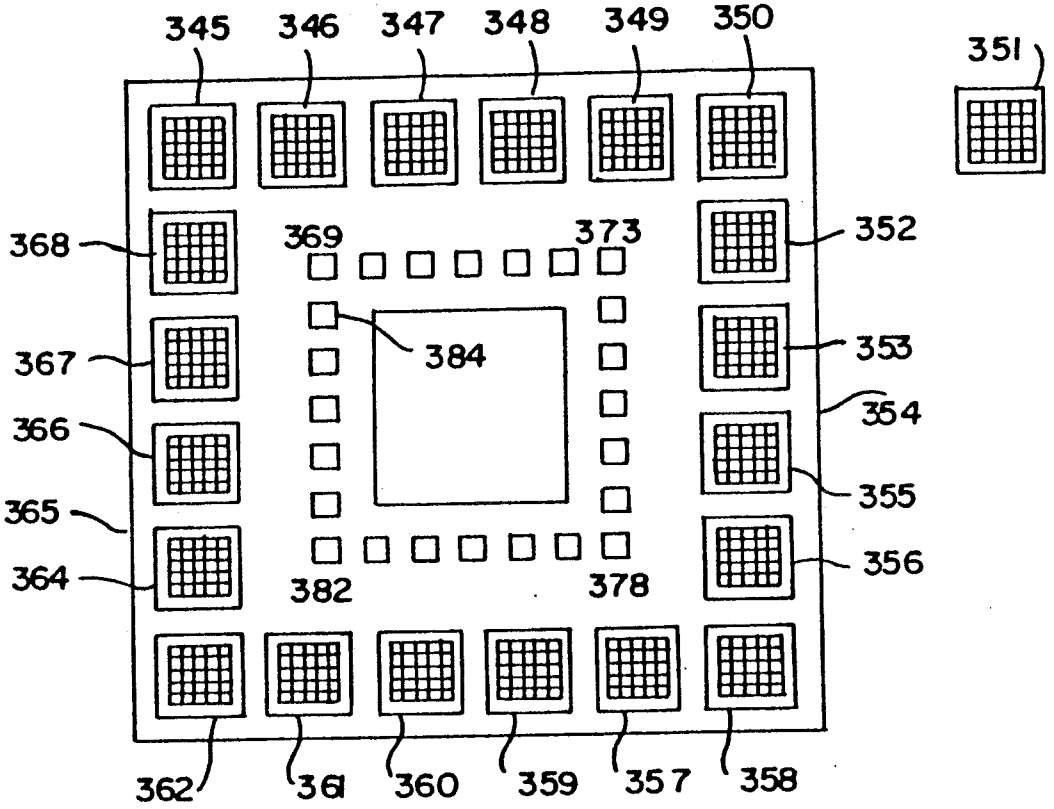
FIG. 22*a* is a detailed cross-sectioned perspective of the multiple rail assembly.

FIGS. 22, 22*a* provides an additional cross-sectioned perspective view of the d.c. rail system, the launch orifice and the projectile loading means. The d.c. rails are described in part by numerals 99 through 106 and insert into central loading orifices designated by numbers 107 through 114. Numerals 115 through 130 reveal in part the external housing for the rails and orifice slide means described earlier. Elements 131 through 139 are the interlocking mechanisms for each section of the conducting orifice. Numerals 140 and 141 illustrates in a sectional manner a single interlocking means, which leads to the central launch tube. Element 142 houses projectiles 143 through 148. Numerals 149, 150 and 151 are chargeable metallic insert tubule and container means housing projectile 152.

FIG. 22*a* reveals the rectangular array of d.c. rails each separated from the other by non-conducting elastic ceramic material. The aforementioned d.c. rail means are designated by numerals 177 through 192, whereas the separate elastic boron nitride silicon ceramic elements are defined by numerals 153 through 176.

The aforesaid non-conducting mechanism consisting of silicon borate and silicon nitride is a composite material. Said composite material is rendered sintered or poreous by methods of radial bombardment with an alpha emitter, chemical etching, or other means in order to reduce the effects of extremes in temperature and pressure. The effects of temperature and pressure allude to irreversible structural deformation and fracturing of the lattice structure. Extremes in temperature and pressure are more readily dissipated and/or compensate for by sintered ceramic structures than solid ceramic structures composed of similar materials. Further the aforesaid ceramic material is embedded within an elastic matrix, which renders the overall structure resilient and compressible, retarding fracturing or related processes.

The dimensions and parameters discussed herein below relate to a device of the invention with an effective bore size of 10 mm; however it is to be understood that the aforesaid parameters and ancillary systems will vary directly with the size of said device and should not be construed in a limiting sense. Each rail of the complement is equivalent to every other rail of said complement being 20 mm in height, having a length of 80 mm per segment with a radial or circumferential spacing of 20 mm from each said equivalent rail element. The charge per rail element is equivalent to 80 KA/mm which is the maximium perimeter current density to said rail segment cooled by a cloud system liquid nitrogen Stirling system. The aforesaid rail segments are composed of a metallic glass alloyed of tugsten, Titanium silicon carbide. Said metallic glass segments have a typical elastic strength of $10^6$ psi and are coated or electroplated with an alloy of silver platium and palladium. The operation of the device generates temperatures and pressures momentarily exceeding 5000° K and $10^5$+psi, respectively. Repetitive sequential firing initiates deterioration of said rails alluding to the ablation of layers of conducting regions exposed to plasma and assisting electrical propagation. The rate of said deterioration aforesaid rail surface is uniformely 10 percent per minute at maximium output. The rate of deterioration varies directly with the power level and/or the interval of times the device is operated. A decrease of 15 percent in applied current effectively doubles the life of the materials coating the surface of said rail structures, which proceeds until 40 percent is attained, wherein no significant increments in operative life of said structures are incurred according to tests conducted on the aforementioned device. The problem of deterioration of conductive surfaces including exposed anodes, cathodes, rail elements and Tesla means is effectively obviated by the aforementioned closed loop cooling system and an automated system, which literally recoats or resurfaces said conducting surfaces with additional conducting materials, also known as conductants. Expended conductants are replenished from readily accessible reservoirs, which upon an automated signal discharge a precisely metered portion of their contents. Said discharged contents of conductants are then linearily electroplated along the rail elements or other aforesaid structures by lower currents, differentially delivered to said conducting structures during intervals of inactivity. Said intervals of inactivity occuring prior to or after launching cycles or firing of projectiles.

Figure 22B:
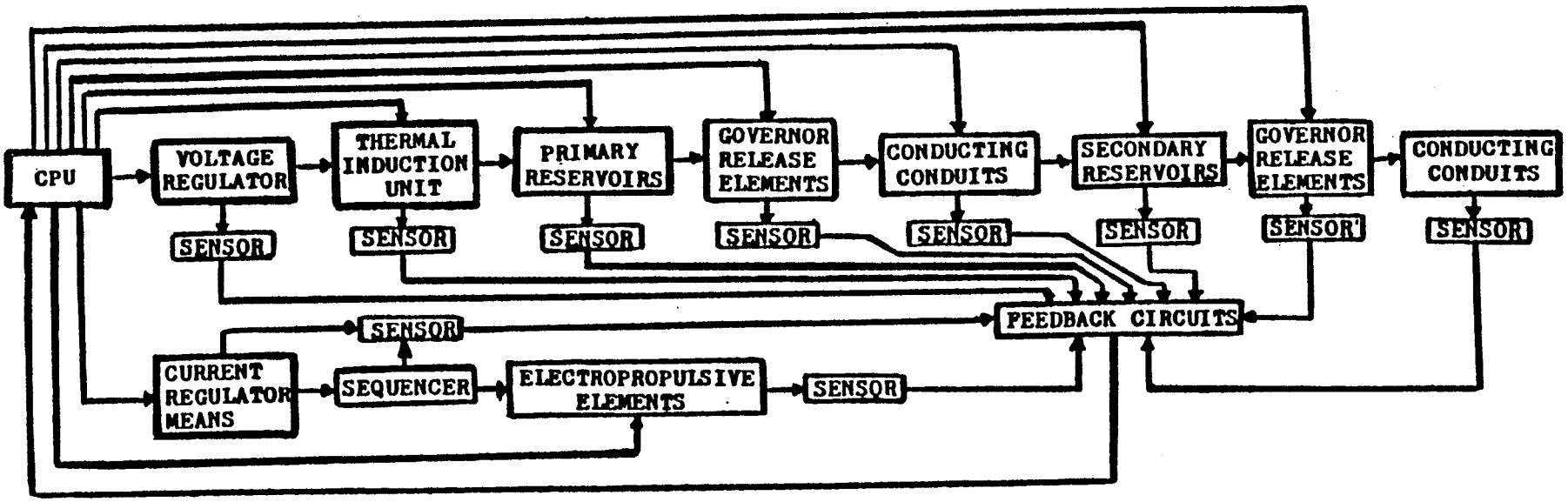
FIG. 22*b* is a block diagram detailing the operation of the mechanism by which conductive surface of the electropropulsive elements are restored.

FIG. 22*b* is a block diagram detailing the operation of the mechanism by which conductive surfaces of electropropulsive elements are restored. The explination previously given regarding restoration of the aforesaid rail elements are applicable to the conducting surfaces of anodes cathodes, arcing elements of Tesla means and other electropropulsive systems. The separate blocks forming said block diagram are not assigned numeric values because they are readily straight forward to those skilled in the art. The command governing the operation of the entire compliment of systems embodied within FIG. 14*b* originates in instructions provided by the CPU. The CPU engages a voltage regulator element which provides current to a thermal induction unit. Conducting heating elements or filaments are disseminated from said thermal induction means to the primary, secondary reservoirs, regulating governors and to conducting conduits dispersing the electrical conductants. The primary function of the thermal induction unit is to generate heat transduced from electrical energy and convey said heat to aforesaid thermal filament. It is the function of the thermal heat elements or filaments to conduct the precise amount of heat necessary to volatilize a sufficient quantity of the aforesaid conductants. The electrical conductants are emitted from the primary reservoirs to secondary reservoirs. The precise quantity of said conductants released from the primary reservoirs are controlled by impulses sent by the CPU to governor release elements. The electrical conductants are conveyed from the governor release elements to various release conduits which assist dispersal of said conductants. Command signals are conveyed from the CPU to the current regulatory means which actuates apparatus governing the electroplating processing of electrical conductants. The power required for electroplating is differentially applied to sections or segments of electropropulsive element to correspond to the subsequent timely release of electrical conductants. The combined actions of mechanisms releasing the aforesaid conductants and those mechanisms involved in the electroplating process cooperate to evenly coat or plate said electropropulsive elements, which are indicated by sensors to have undergone deterioration. The condition or status of each subsystem involved in the release of electrical conductants, the plating process and the operative condition of the electropropulsive elements themselves are essentially monitored by an array or network of sensory elements. The signals from the aforesaid sensory network are pooled and collectively sent to various feedback circuits, which reconvey said signals back to the CPU. The CPU assess data retrieved from sensors and act appropriately to compensate for deterioration incurred during continuous operation of the mass action driver device. Once the conditions responsible for a loss of conductivity have been appropriately compensated for or rectified by the restoration of electrical conductivity to said electropropulsive elements, then the CPU terminates the operation of apparatus concerned with the recoating or resurfacing process. The resurfacing, recoating or electroplating of electrical conductants usually proceeds linearily from the aft of the electropropulsive element to the most proximal terminal end optimally proceding from the breech of the device to the terminal bore of said device. Electrical conductants are plated during intervals of relative inactivity occurring prior to or after the launching of projectiles, when the device is in a standby mode. A more detailed explination of the electroplating process and the release of electrical conductants are presented later on in the specification in various flow charts and block diagrams.

FIG. 22*c* entails an exploded view of the Mass Action Driver device (M.A.D.). Said exploded view details the assembly of structures disposed in FIGS. 21, 22.

Figure 23:
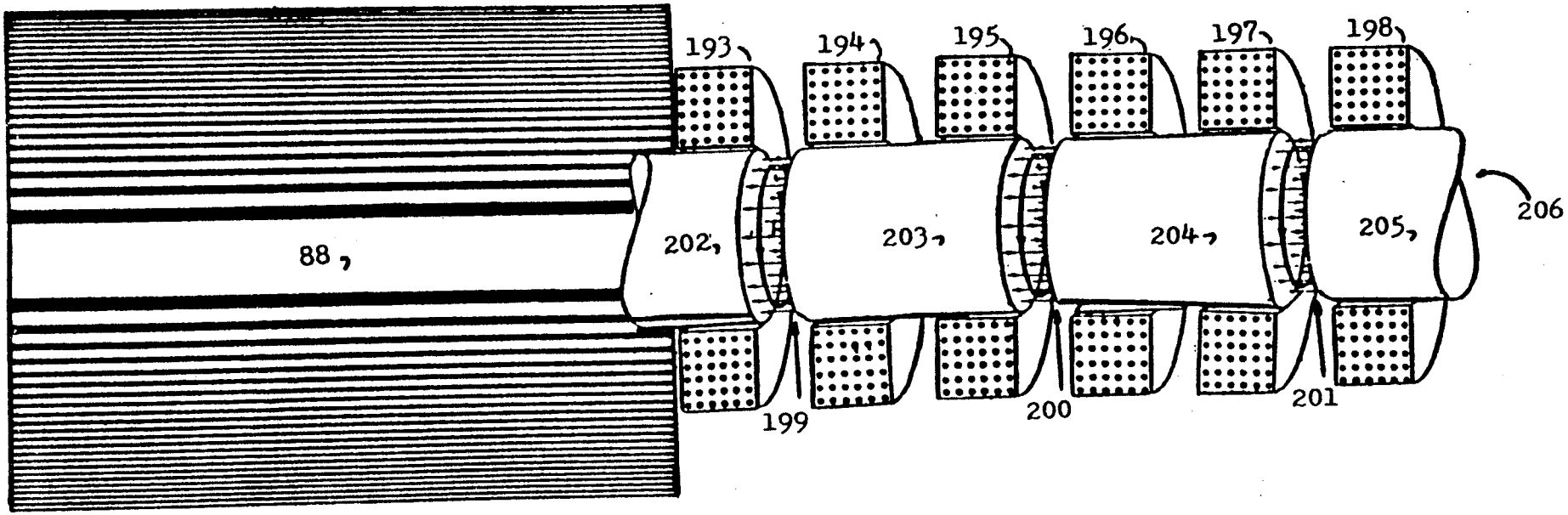
FIG. 23 is a detailed partial view of the special feroceramic magnetic induction coils and plasma flow through the cylindrical launch tube interlock.

FIG. 23 is a detailed schematic sectioned perspective of a portion of the magnetic induction means. Each magnetic induction ring is described in part by numerals 193 through 198, formed from a light weight commerically available feroceramic material. The ionized plasmoids expand radially forward and are denoted by numerals 199 through 201, portions of the primary guide or launch tubule 88 and rail elements are described by elements 202 through 205. Number 206 of FIG. 15 depicts in part feroceramic material embodied within the construction of said magnetic induction elements are similar to the types of material utilized in piezoelectric transformer. The electrical conducting material coiled around said magnetic induction elements is perferrably composed of an alloy of silver, platium, titanium and nobelium. Samarium cobalt is considered to be a feroceramic material or a substance, which can be incorporated into various ceramic magnetic induction means.

Figure 23A:
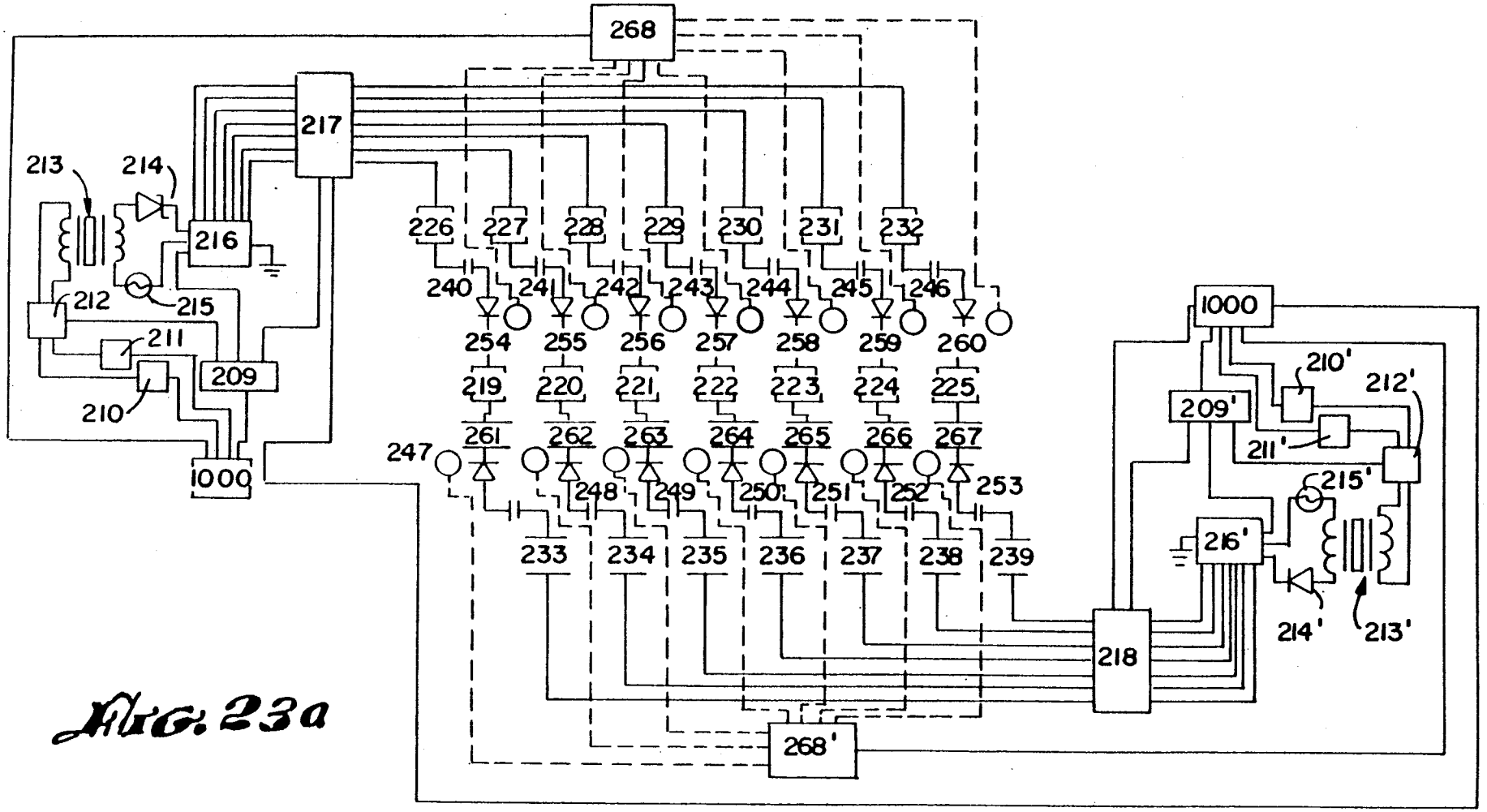
FIG. 23*a* is a concise electrical schematic illustrating the operative structure of the magnetic induction elements.

FIG. 23*a* is a concise electrical schematic illustrating the operative structure of the magnetic induction elements. The aforesaid magnetic induction element are located towards the forward bore or proximal end of the mass action hybrid device. The aforementioned magnetic induction element cooperates in a precise and specific fashion to assist in the focusing of plasma and the levitation and/or positioning of projectiles along the central axis of the bore. A finite number of separate and distinct magnetic induction elements are circumferentially disposed around the central bore of the aforesaid device. The magnetic polarity, field strength and other properties of each said magnetic induction element are not fixed but variable subject to command impulses from a controller element subservant to number command signals generated by the CPU. CPU controller element 1000 controls the polarity, the intensity and duration through command impulses conveyed to voltage regulator 212, polarity element 209 and sequencers 210, 211, respectively. Regulator means 212 controls the current delivered to piezoelectric transformer number 213. Rectifier element 214 prevents said current from trickling back to transformer element 213 and automatically reseting circuit breaker element 215 which prevents overload to said transformer means. The polarity of each of the aforesaid magnetic induction elements is set and/or reversed by polarity unit 216. Numerals 217, 218 are sequencer means which determine the exact order, in which each of the aforementioned magnetic induction elements are to be actuated and the precise time interval each of the said magnetic induction elements are to be actuated prior to the execution of a given command sequence. The command sequence or the order in which each said magnetic element is actuated and the duration or temporal period of actuation is contingent on the position of the aforementioned projectile and its mass in relation to the velocity, force and shape of the advancing or exiting plasma. The sequencers 218, 218' engage induction elements 219 to 225, which then delivers current to electronic variable capacitor means 226 to 239 which conveys or discharges their current through blocking diodes 240 to 253. Each of the said block diodes are preceded by a unidirectional latching means, described by elements 254 to 267, which operates to allow current to flow in only one direction, wherein said circuit is latched closed. If polarity is reversed said latching elements open breaking the circuit; however said latching elements each embody a mechanism which automatically closes or recompletes the circuit when the direction of the current flow is re-established to a given magnetic induction means. The aforesaid latching means are disposed adjacent to each magnetic induction element, which is to be energized and operate, such that, no two latching elements servicing a given magnetic induction element are simultaneously actuated at any given time. The polarity, sequencing or other properties of the magnetic induction elements are channeled through the aforementioned latching elements. Numerals 219 to 226 are assigned to the entire complement of magnetic induction elements, as previously indicated representing elements 1 to n. The status of various electronic sybsystems or components contained therein are monitored by feedback elements 268, 268', which are associated with the array of sensory elements collectively described by numeric values 268*a*, 268*b*.

Figure 23B:
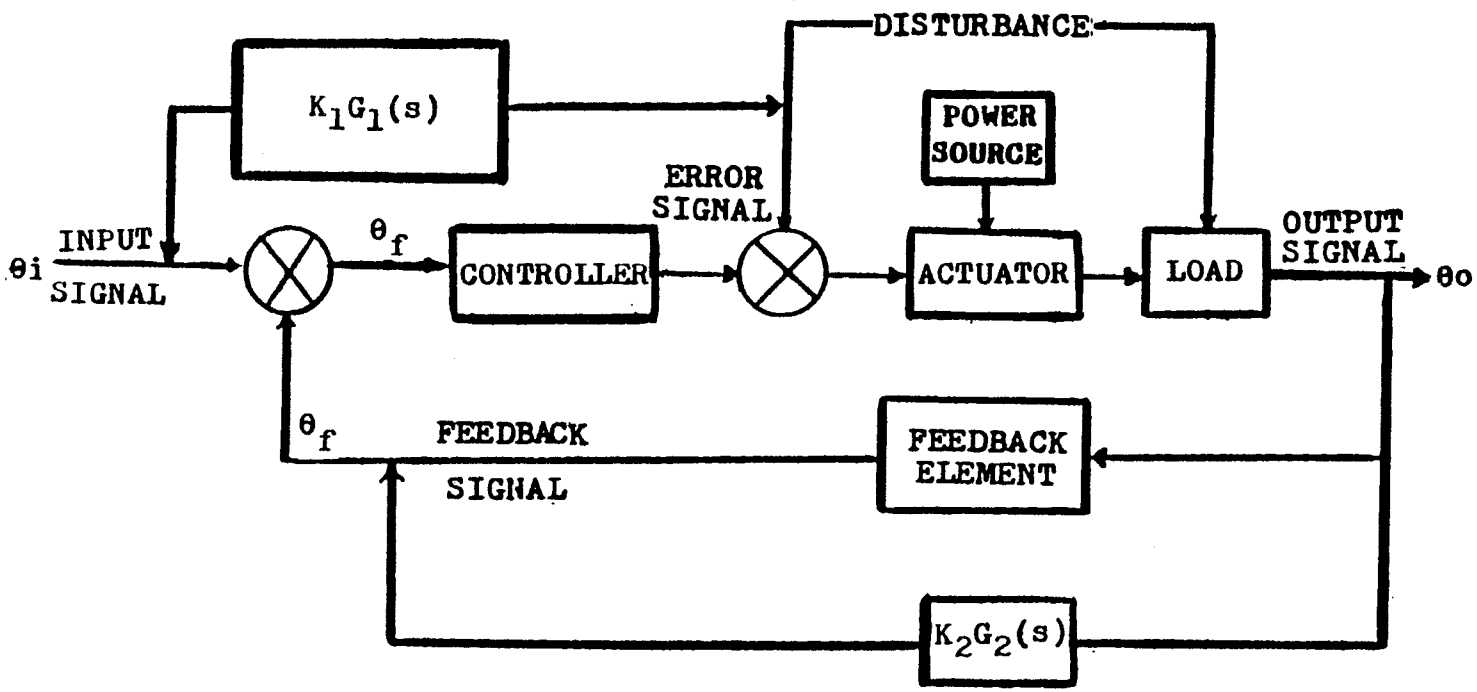
FIGS. 23*b*, 23*c* are block diagrams describing the basic disposition of solenoid means incorporated within automated servo mechanism systems associated with feedback loops embodied within the aforesaid mass action driver device.

The aforementioned schematic disclosed by FIG. 23*a* represents numerous equivalent circuits servicing the aforesaid magnetic induction elements. Said circuits are sequentially actuated by command impulses conveyed from the CPU. The disclosure of a single circuit element by the aforesaid schematic disclosed all equivalent circuits in the array of magnetic induction elements The basic design of the automated servomechanism system contained within the feedback loop can be best illustrated by the block diagrams disclosed in FIGS. 23*b*, 23*c*.

A discripency of disturbance is generally detected by sensors, $\theta i$; which sends their digitized signals to a comparator means, which acts as an error detector. The error signal, $\theta\epsilon$, is sent to a controller means which elicits an actuator means (which is provided with a power source and) generates a load leading to an output signal, $\theta o$. Additional information is being supplied and the output signal, $\theta o$, generates additional data impulses, which enters a feedback element relaying in this case perhaps the position of the turret in relation to a target vector, which then exacts a feedback signal, $\theta f$. The feedback signal, $\theta f$, is reassessed against an error detector, which reenters and completes the loop. Further contained herein below are a series of standard simplified equations describing in general the control system transfer functions ranging from open loop to closed loop transfer functions listed in part herein below:

The forward transfer function is defined by the equation:

$$\frac{\theta o(s)}{\theta\epsilon(s)} = K_1G_1(s)$$

The forward transfer function $K_2G_2(s)$ is defined by the expression:

$$\frac{\theta f(s)}{\theta o(s)} = K_2G_2(s)$$

The open loop transfer function, the product of the forward and feedback transfer function is defined by the expression:

$$\frac{\theta f(s)}{\theta\epsilon(s)} = K_1K_2G_1(s)G_2(s)$$

The error transfer function is designated by the espression:

$$\frac{\theta\epsilon(s)}{\theta i(s)} = \frac{1}{1 + K_1K_2G_1(s)G_2(s)}$$

Closed loop transfer function is illustrated by the equation:

$$\frac{\theta o(s)}{\theta i(s)} = \frac{K_1G_1(s)}{1 + K_1K_2G_1(s)G_2(s)}$$

Logic circuits containing comparator elements compare and contrast digitized signals obtained from sensors with digitized values stored in said comparator means. Logic circuits comparator chips or microprocessor elements and a global memory system will be described in detail in FIGS. 40, 40*a*, 40*b*, 46*e* and 64. It should be reitterated that the above mentioned equations are general and standard and only in part briefly outlined in the feedback loop employed in this patent disclosure.

For extended periods of operation the M.A.L.K.E. (MALKE) vehicular device must expend copious quantities of energy. The vehicular unit must operate independently of external support systems under covert conditions and therefore it becomes necessarily incumbent for the said device to automatically regenerate its own power reserves. The initiation of a priority expert system is necessary in order to evade enemy detection and the subsequent implementation of an automated feedback loop to monitor energy expenditures and act in a compensatory manner to replenish the said expended energy reserves. An array of commercially available sensory elements continuously monitors both the external environment surrounding the vehicular unit and the internal status of the energy load factor. The energy load factor is defined as an internal operative function of current flux (volt/ampers), electrolytic balance (concentrations of electrolytes), the evolution of water and gasses, the ratio of specific gravity of solutes and thermal gradients associated with related operative processes. All signals generated are sent to a number of comparator circuits, wherein the signals are compared against encoded norms (preprogrammed digitized values), which also measure error/signal ratios. Once the signals are compared and evaluated they are sent to a controller means associated with various operative functions, which act in a prescribed compensatory manner to offset any discrepancies with an appropriate action, which occurs within the operative framework of a feedback loop. An appropriate action to excessive current discharge initiating depleted fuel cells is directed by the onboard microcomputers causing the MALKE device/craft to surface and to distend or erect the solar stacks in a position to utilize the sun, as a solar energy source provided no enemy surface crafts are detected. If enemy crafts are detected the microcomputers are preprogrammed to recharge the fuel cells through less efficient wave action, as previously mentioned in this disclosure. Obviously, the device is programmed with an expert system capable of diserning between friendly forces and the signals generated by those forces construed as being either neutral or those of enemy vessels.

The embodiment of feedback loops in virtually every operative system of the aforesaid vehicular device is of primary importance in reducing the load factor of data entering the CPU. The delegation of other tasks to secondary CPU's, microcomputers, or microprocessing arrays, controller elements and/or other means increases the overall efficiency of the vehicular device. The primary function of the primary CPU is to utilize a number of expert programs to determine which of any complexed actions are to be executed by the MALKE vehicular device, in regards to the acquisition pursuit and/or engagement of one or more specified targets. The primary CPU no matter what its storage capacity and absolute real time mean computational speed, will only be able to make best means estimates on events requiring between one to ten Gigabytes per second. The one to ten Gigabytes per second is the estimated influx of data and output of command signals necessary to sustain said vehicular device under a full scale battle scenario. It is therefore advantageous to relegate programming for system operations of units within said vehicular device to secondary CPU's and other systems, in order to avoid overloading the primary CPU.

Figure 24:
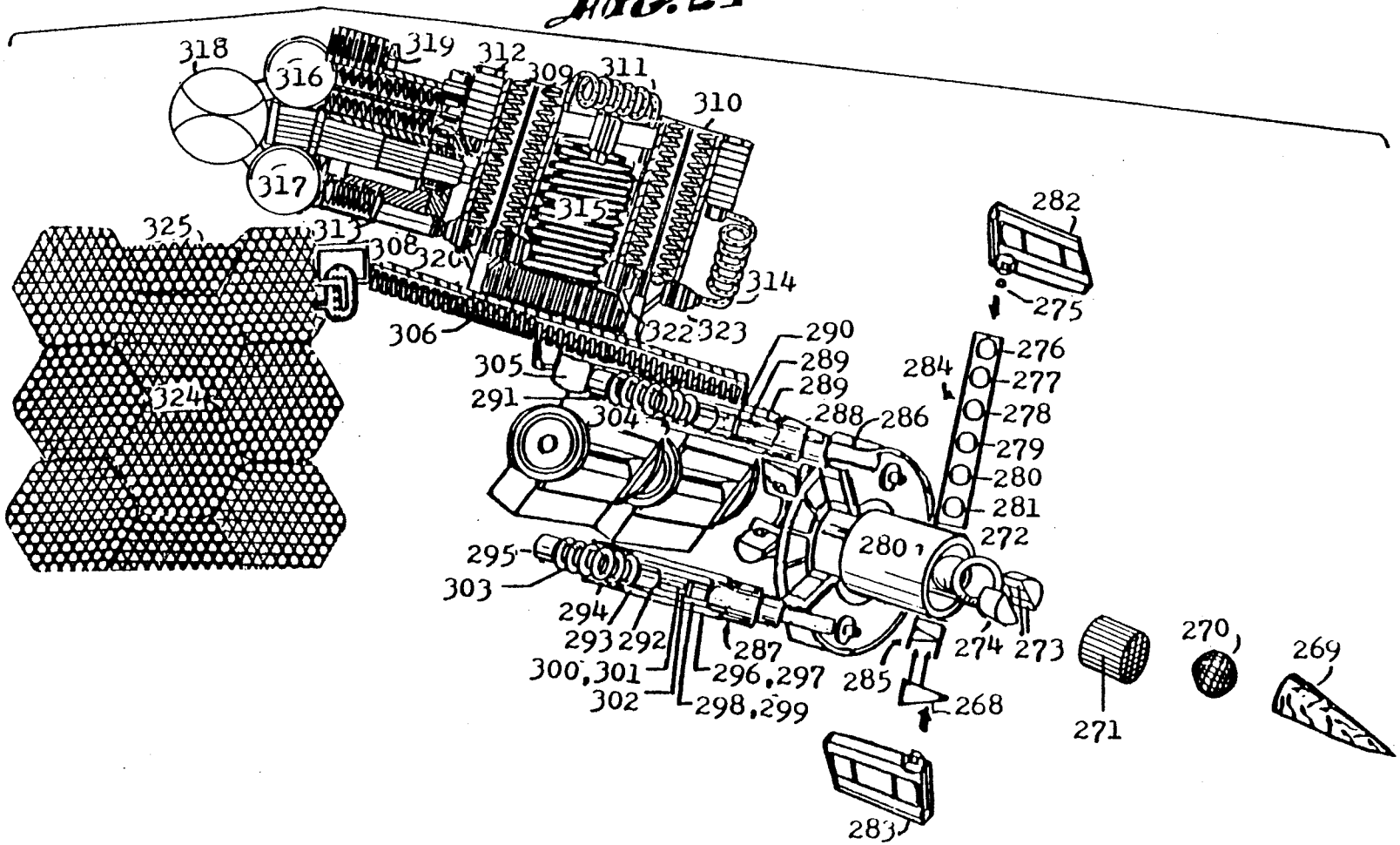
FIG. 24 is a detailed perspective view indicative of the closed loop coolant system, cycling and heat exchanger means, and projectile insertion launch means.

FIGS. 24, 24*a* and 24*b* give a detailed longitudinal perspective of the closed circuit cooling system, some of its component parts and the loading assembly. Numerals 268, 269 of FIG. 24 represent a single aerodynamically stable armor piercing projectile which is followed immediately by a spherical explosive means 270, which is housed in a fragmentizing cylindrical shell casing denoted by element 271 until resistance is encountered. Each shell or explosive cylinder means maybe housed in chargeable metallic insert tubule 272 and container means described by cross sectioned means 273, 274. Projectiles 275 through 281 are side loaded from magazines 282, 283 along linear autofeed segments described duly by elements 284, 285. The coolant tubule elements 286, 287 are provided with heat conducting shells designated by numerals 288 through 297 each of which is interfaced with a separate commercially available thermal graduated medium described by numerals 298 through 304. Each tubule elements 286 and 287 are provided with a helical coiled heat exchanger means, 305, 306 assist to equilibrate thermal parameters. Element 307 denotes an internal pressure release valve associated with a helical exchange tube 308, which cools the peripheral elements of the device. Numerals 309 through 312 are counter current heat exchanges, whereas elements 313 through 316 provides heat or thermal condensor means. Numeral 317 is indicative of one of several passive Sterling type heat engine or pump which recycles expended coolants to a variety of heat exchanger means. Extra coolant is contained in reservoirs 318, 319 which can be cycled by an active pump unit number 320 to sites within the device. Additional condensors and heat exchangers designated by numerals 321 through 325. A schematic view of a cycling reservoir and exteriorized heat exchanger grid provided aft of the main launch mechanism, numeral 10000 are described by elements 326, 327, respectively.

FIG. 24*a* denotes a detailed view of a single element pair 328, 329; which form the heat exchanger grid 264. Heat exchanger plates are designated by elements 328 through 343. Each plate means is associated with a linear array of microcoiled heat exchanger means indicated in part by numerals 344 through 409.

FIG. 24*b* describes in greater detail an array segment of the forementioned microcoiled heat exchanger means depicted in FIG. 24*a* Elements 410, 411, 412 and 413 are of a commercially available type and are provided with a suitable coolant wick.

Figure 25:
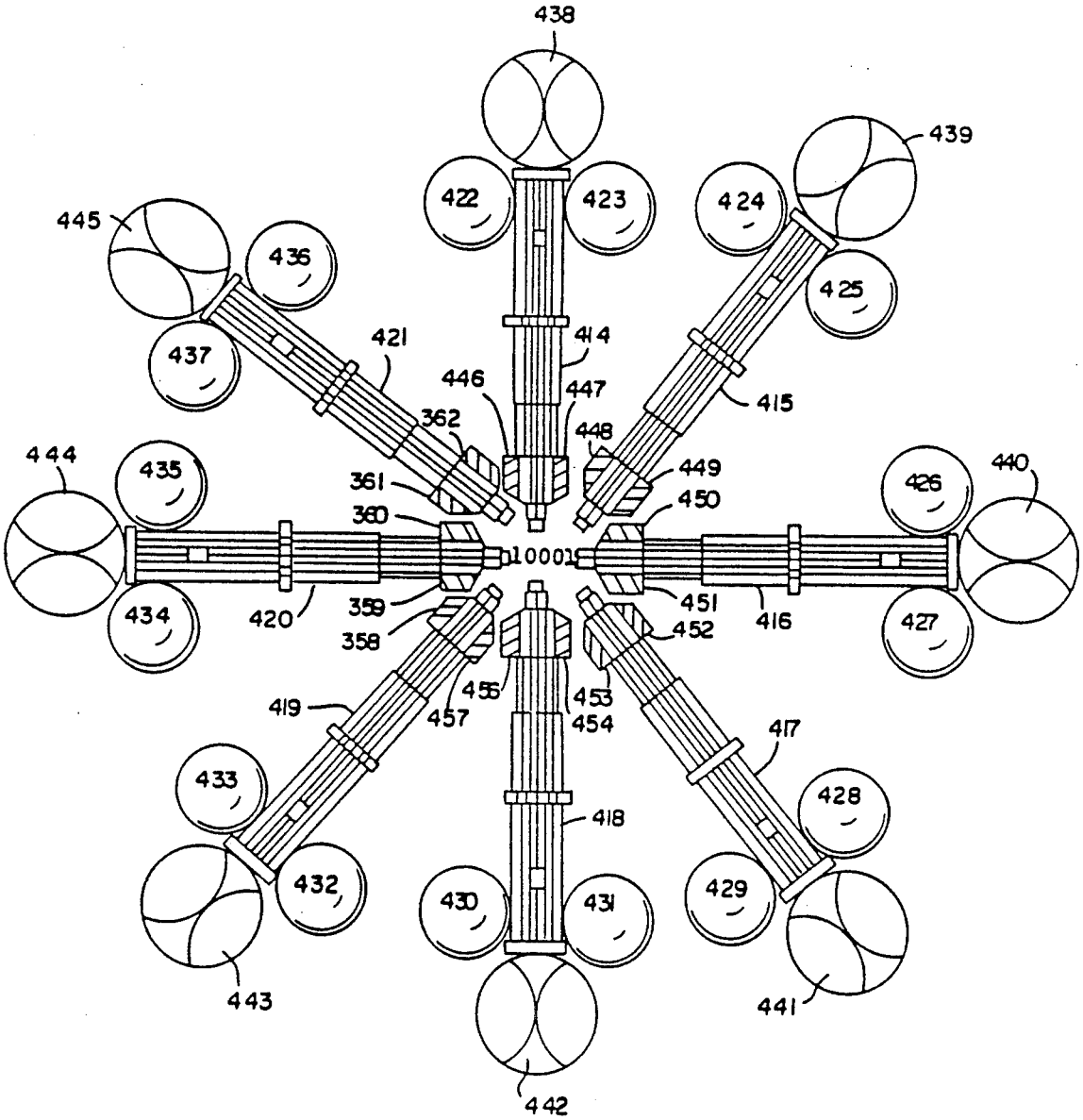
FIG. 25 is a partial spatial perspective of the circular Tesla coil plasmoid injection complex.

FIG. 25 is representative of a detailed perspective view of outer structural encasement for the array of Tesla coils and plasmoid injection means. Only a fraction of the above mentioned Tesla plasmoid injection means is illustrated herein for reasons of simplicity and clarity. Each entire unit of the complement is assigned a numeric value represented by elements 414 through 421. Each unit has within its embodiment a pair of equivalent storage reservoirs, elements 422 through 438 and compensatory pumps aft of each unit which are defined by elements 439 through 445. All units of the complement are assigned additional arcing pairs, which are located above the exit orifice of each unit, described by structures 446 through 462. All exit orifice structures are placed in a hermetically sealed cavity collectively defined by number 10002.

Figure 26:
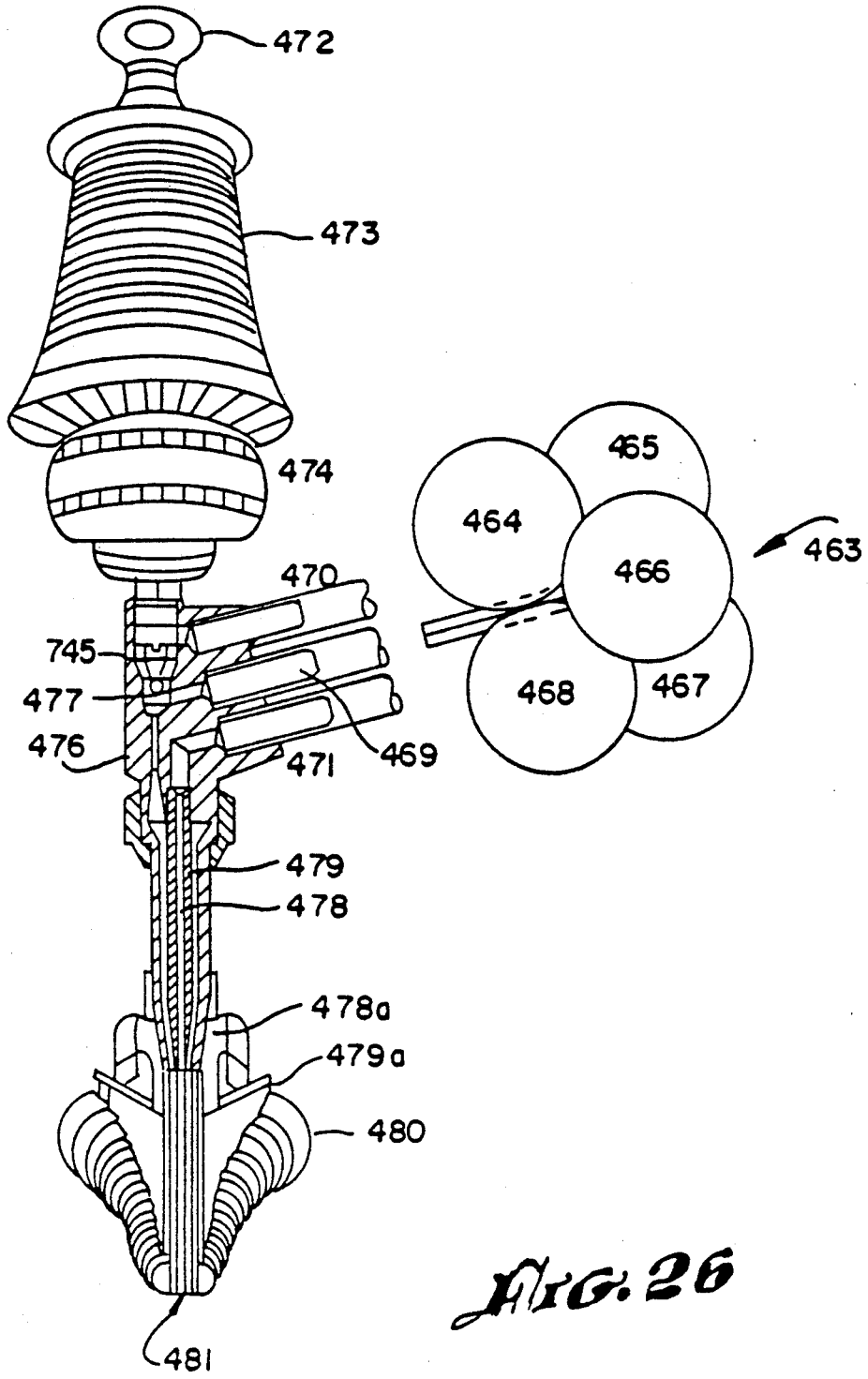
FIG. 26 is a detailed cross-sectional and perspective view of a single Tesla coil plasmoid injection complex.

FIG. 26 defines in detail a single Telsa plasmoid injection unit. The plasmoid reservoirs are described by a single numeric element, 463 for external units aft of the device, while each subunit is assigned a separate value 464 through 468, inclusive. The feed lines 469 and 470 supplying the unit with an accessible quanity of plasmoids; whereas tubular unit 471 conducts or circulates coolant to and from the entire structure to reduce overall temperature of internal structures. Voltage is input from element 472 to Tesla coil means 473 and the arcing is adjusted by a adjustable attenuator means described by element 474. The primary cathode and anode means are described by elements 475, 476, respectively; whereas secondary anode and cathode means are defined by elements 479, 479*a* and 480 respectively. A non-conducting plate 478 and 479*a* separates structures 478*a* from 480. The point of primary arcing embarkation is designated by numeral 477; wherein the plasmoids are ionized and continuously propagated until they pass through the charged exit orifice described by element 481. A variety of suitable plasmoids such as vaporized cesium or mercury, hydrogen, nitrogen and inert gases including xenon krypton, or argon are commercially available and well known by those skilled in the art.

Figure 26A:
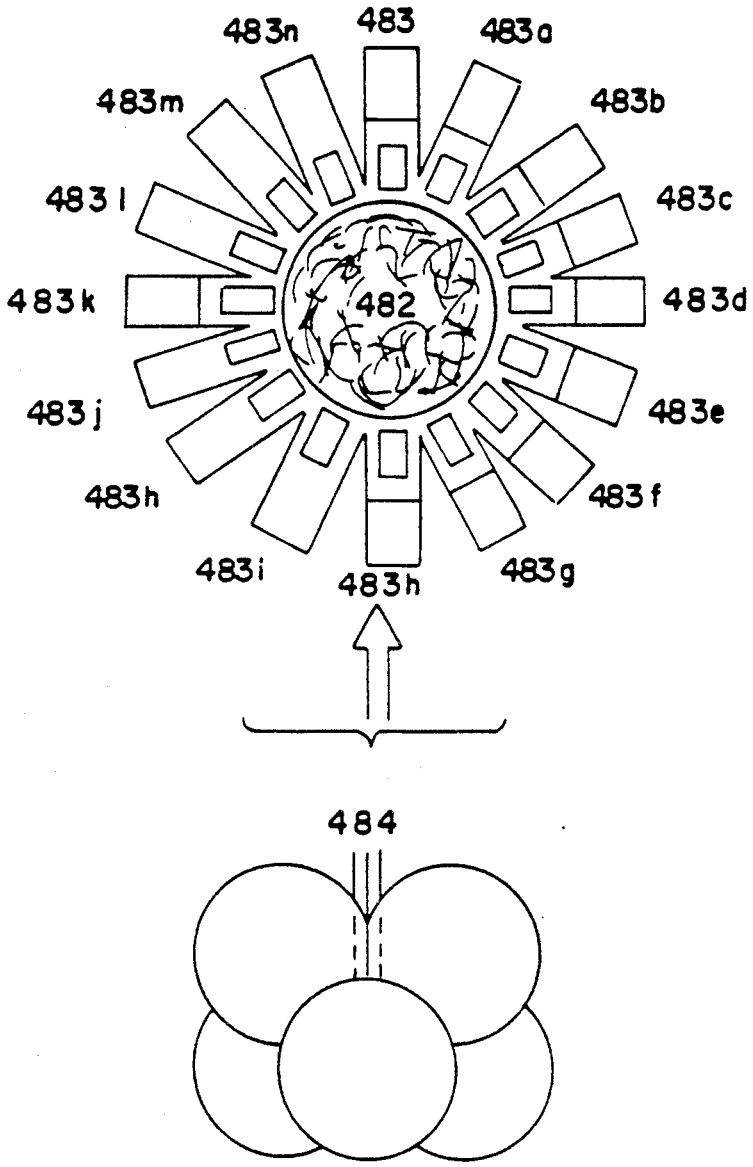
FIG. 26*a* is a pictorial representation of the Tesla array or complex.

FIG. 26*a* is a simplified pictorial representation of the entire Tesla complex yielding a circumferential axial perspective of said complex. The entire Tesla complex is assigned the numerical value of 483, whereas the external reservoirs of tanks are assigned the value 484. Complex 482 consists of sixteen subunits described herein by numerals 483 through 483*h*, inclusive.

Figure 26B:
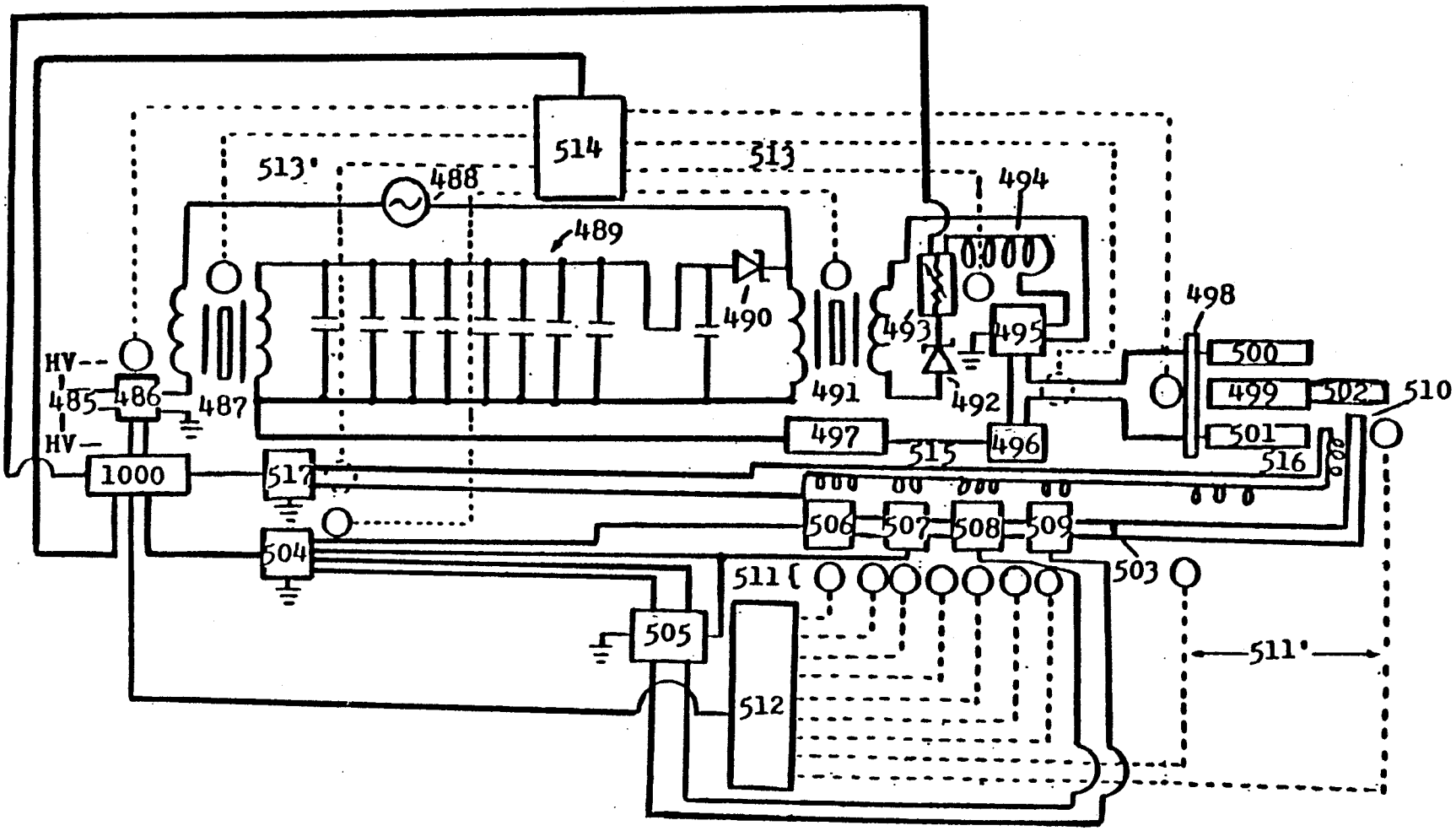
FIG. 26*b* is a concise schematic diagram of a single Tesla element equivalent to the Tesla structures forming the aforesaid Tesla array of complex described by FIG. 26*b*.
Figure 27:
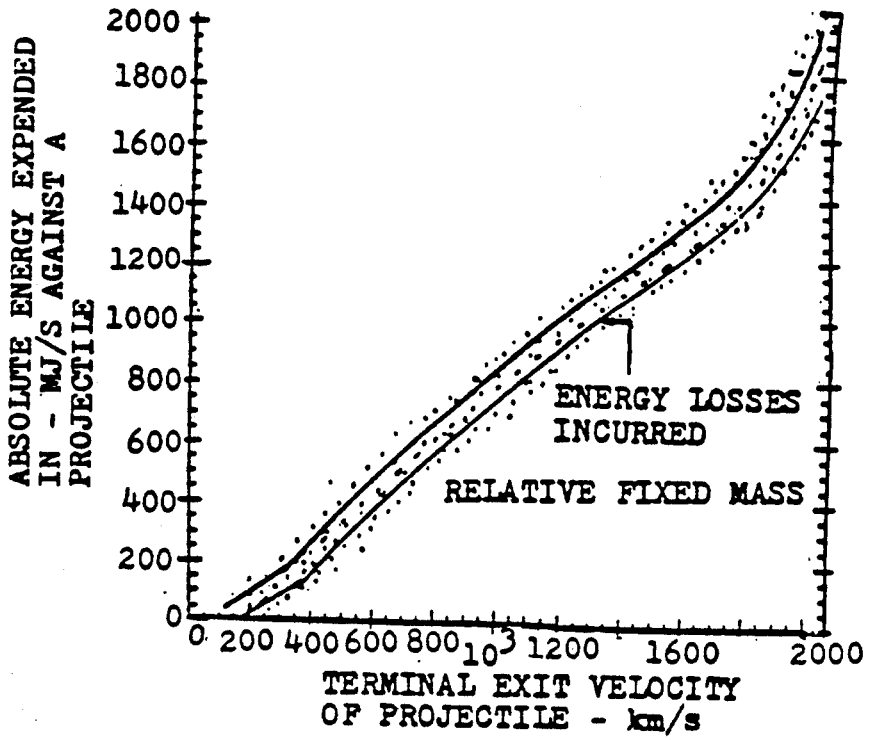
FIG. 27 is a graph equating exit velocity of a projectile against the absolute energy applied to said projectile in the form of electromotive force.

FIG. 26*b* is a concise schematic diagram of a single Tesla element; which corresponds to one said element of an array of equivalent Tesla elements. The aforesaid array consisting of radially disposed Tesla coils having their discharge ends positioned in a common cavity coupled to and following said firing chamber in the direction of said bore. Operative instructions from CPU 1000 actuates regulator element 486, which distributes power to high voltage source 485. The current generated by high voltage source 485 is conveyed to primary transformer element 487 engages both circuit breaker 488 and capacitance bank 489. Power from capacitance bank 489 is initially prevented from flowing back after discharge by rectifier bridge element 490. Current from capacitance bank 489 is conveyed from said bank to secondary transformer element 491. Current flow is prevented from returning to secondary transformer element 491 by rectifier 492. Current passes from rectifier element 492 to electronicly actuated variable resistance means 493 and from said means to amplification coil means 494. The length of the arc its intensity and other properties can be altered electronically by the resistance electronically adjusted by said CPU. Current from said amplification coil 494 is conveyed to pulse circuit 495, which is under the control of sequencer element 406. Said sequencer element 496, is under the control of the CPU, number 1000; whereas pulse circuit means 495 passes current to polarity switch 497. The aforesaid polarity switch number 497 conveys current to spark coil 498. Spark coil 498 conveys current to anode means 500 and cathode means 501 which forms spark gap 499. Anode 500 and cathode 501 convey current to electrode discharge means 502. The switching of polarity only becomes important in relation to the charge bias of other equivalent Tesla units in close proximity to said unit. The spark gap, numeral 503 is formed collectively from elements 500 to 502

The quantity of plasmas discharge, the sequence of said discharge and the frequency, at which said discharge occurs is the course interdependant on the arcing process of the Tesla means. CPU, 1000 controls the operation of regulator means 427, 505 which actuates governor valves 506, 507. Governor valve 507 consists of a solenoid mechanism, which controls the flow of volatile plasmids from secondary reservoir 509 to conduit 503. Conduit 503 delivers the volatilize plasmids to exit orifice 510. Exit orifice 510 delivers said volatile plasmids in close proximity to discharge electrode 502. It if is determined by sensor means 511 that the aforesaid secondary reservoir is either depleted or exhausted then governor valve 506 is actuated by regulator means 504 to release the content of the primary reservoir described by numeral 508 to fill or replenishes those contents expended by secondary reservoir 509. Numerals 511 to 511' denote collectively an array of sensory means consisting of electro-optical sensors, mechanical pressure transducers and flow sensors, which monitor the status of the aforementioned reservoirs governor elements, conduits and related structures. Digital electronic impulses are conveyed from the aforesaid sensors to a feedback circuit collectively defined by elements 512, 514, which reconveys data back to the CPU for analysis. The plasmids depending on the type of plasmids dispersed, the intrinsic or ambient temperature and consisting of same must be volatilized prior to delivery. Thermal induction elements 515 to 516 provide the heat necessary to volatilize said plasmids. The aforesaid thermal induction elements are electronically controlled by regulator circuit which is collectively assigned the numeric value 517. The regulator circuit receives command impulses from CPU, numeral 1000, compensates for differences in the consistancy of the aforesaid plasmids which are registered by said sensory means described by numerals 511 to 513.

PROJECTILE ACCELERATION EQUATIONS

The acceleration, A, of projectile, p by the mass action hybrid device, having a gram mass, Mg, from a static or arbitrary fixed position or initial velocity of zero to a velocity, U is described by the equation herein below:

$$AMg \int_{\text{vel. } 0 \to U}^{\text{init. vel.} = 0} \int_{K.E.ModnP}^{K.E._i = 0} = \int_0^W \frac{\hat{I}\, d\hat{w},\ \hat{B}_{po\uparrow}\ \Sigma\ Pn_{f\uparrow}}{M} \left( \frac{MUg}{\Sigma j} \right)$$

where, I is the current by the initial arcs
W is the rail spacing
B is the magnetic field intensity
po ↑ is the polarity of the magnetic field
EPn$_f$↑ describes the collective sum of the force generated by the entire complement of plasmas, Pn, exerting a absolute vector force, f ↑, on a projectile with mass Mg.

Mod n Pg describes the approximate scaling involved in an accelerator device embodying a plurality of discharge modules K.E. denotes the kinetic energy term or component and the subexpression MUg/Ej denotes the gram mass component accelerated to velocity Ug and Ej is the efficiency with which electrical energy is transferred from an electrical storage system (i.e. capacitance bank) to the aforesaid kinetic energy of said projectile.

If the accelerator has a length in meters L from breech to exit bore and L is related to the final velocity U then said velocity at which the projectile exits and is described by the term $$\int_{K.E.}^{K.E._i} L \frac{U^2}{2g} - \Sigma\ R\ \text{atm} - \Sigma\ R\text{drag} - \Sigma\ \text{friction}$$

wherein Σ R atm, −Σ Rdrag and −Σ friction are accumulated loss in kinetic energy incurred by resistance of projectile to atmospheric gases, the sum of loss in kinetic energy due to internal and external drag and the losses in kinetic energy as the projectile encounters friction.

Additionally the mean velocity of the projectile, V is by the expression $$\overline{V} = \int_{f\Delta s}^{i\Delta s} A \frac{dt}{dx}$$

wherein t is the time needed to transverse a discrete distance, dx, from an initial starting position, Zi, and the acceleration, A, in the absence of an applied electromagnetic field is effected by loss in kinetic energy due to entropy ΔS from the initial state of acquiring momentum to the termination of free flight.

The position $Z_i$ is given by the equation $$Z_i = \int vdt.$$

The voltage $V_I$ resulting from the time variation of the current and inductance, L, of the rail complement is typically given by the expression $$V_I = \frac{d(LI)}{dt} = L\frac{dI}{dt} + I\frac{dL}{dt},$$

$$\text{since } L = L_1 Z, \text{ then } \left(\frac{dL}{dt}\right) = L_1 V.$$

The voltage described by the term VR along n number of rails is defined by the equation $$VR_e = \eta \int_o^Z IRdz,$$

where R is the resistance of each rail and using Kirchhoff's law yields the expression $$O = I\,Ro + Lo\frac{dI}{dt} + IR + I\frac{dL}{dt} + L\frac{dI}{dt} + VA$$

by which both current and voltage are readily tabulated. The terms Ro, Lo embody both stray circuit resistance and inductance.

The following equations are typical to description of electromotive forces and other parameters typical of rail systems.

The instantaneous energy, Ec in capacitance banks, storage coils and the like is conveniently described by the equation.

$$Ec = \frac{LoI^2}{n}.$$

The inductive energy, $E_I$, existing between the aforesaid rails is described by the equation $$E_I = \frac{ZL_1I^2}{n}.$$

The energy loss, $E_A$, in the plasma arcs are determined by the expression $$E_{Am} = \int_{n-\Delta x}^{n} VA\,Idt.$$

The energy loss, $E_R$, in the fixed elements and rail means are embodied within the equation $$E_R = \int I^2\,Ro\,dt + n\int I^2\,Rdt$$

and the near instantaneous kinetic energy K.D.p of said projectile is described by the expression $$K.E.p = \frac{mv^2}{n}.$$

Preliminary tests consisting of one hundred trials, were conducted on mockups of the invention to measure the intrinsic exit velocity or projectiles. The intrinsic exit velocity of a projectile is the absolute velocity at which a projectile exits the bore of the ignoring atmospheric resistance and the other external factors. FIGS. 27 to 30 graphically represent in part data accumulated from one hundred trial runs and appear to summarize four interrelated events regarding projectile exit velocity and related parameters. The first of the said events is that the exit velocity of a projectile varies directly with the net absolute energy generated in the form of electromotive force which is applied against a projectile of a relative fixed mass according to FIG. 27. The absolute energy in Mega Joules (M.J) expended per second by electropropulsive generating means (rails, arc sources, the array of Tesla elements and related structures) less loss incurred due to energy exhausted as heat, energy dissipated during the transduction of plasmids and/or related parameters, which amounts to approximately 12.0 percent. (100.00→12.00±2.00 percent). The term relative fixed mass is defined as the mass in grams per cubic centimeter less the average mean loss in gram mass incurred by the aforesaid projectile upon exiting the bore of the device. Losses in gram mass are incurred due to ablative forces generated by a super-heated plasma, internal resistance of the atmospheric gases contained within the central bore forces alluding to drag and/or related processes.

Figure 28:
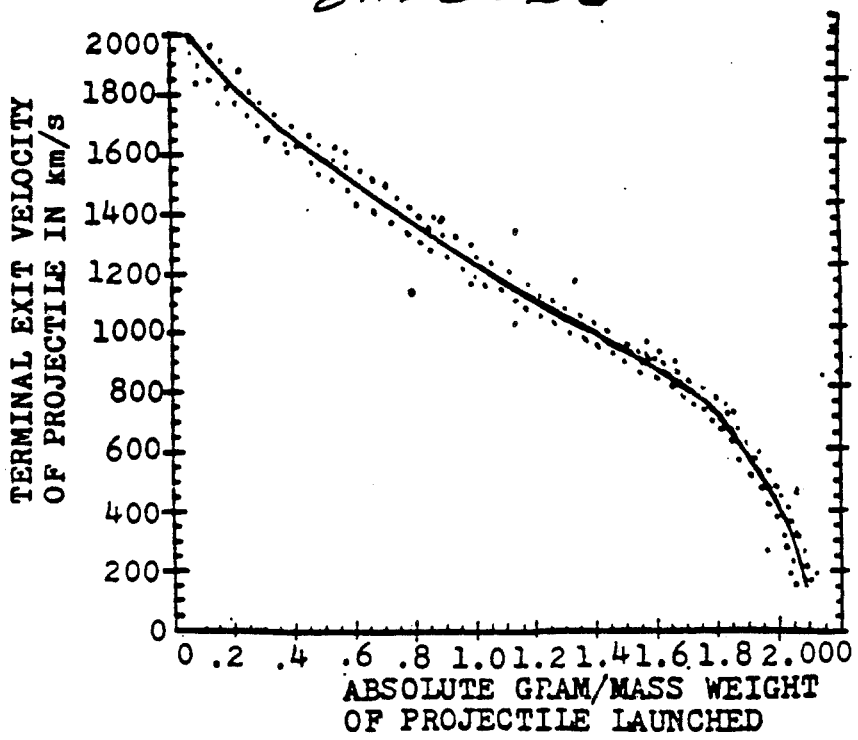
FIG. 28 is a graph assessing the effects of projectile mass against the exit velocity of said projectile.

The second said event regarding exit velocity is that the aforesaid exit velocity appears to vary inversely with the absolute relative mass of a projectiles, as indicated by FIG. 28. The gram mass of projectiles is not fixed but variable in increments of 0.10 grams up to 10.00 grams and is the independent variable; whereas exit velocity is the dependent variable in FIG. 28. All other parameters of the aforementioned device remains constant in FIG. 28 in order to assess the effect of gram mass upon exit velocity.

Figure 29:
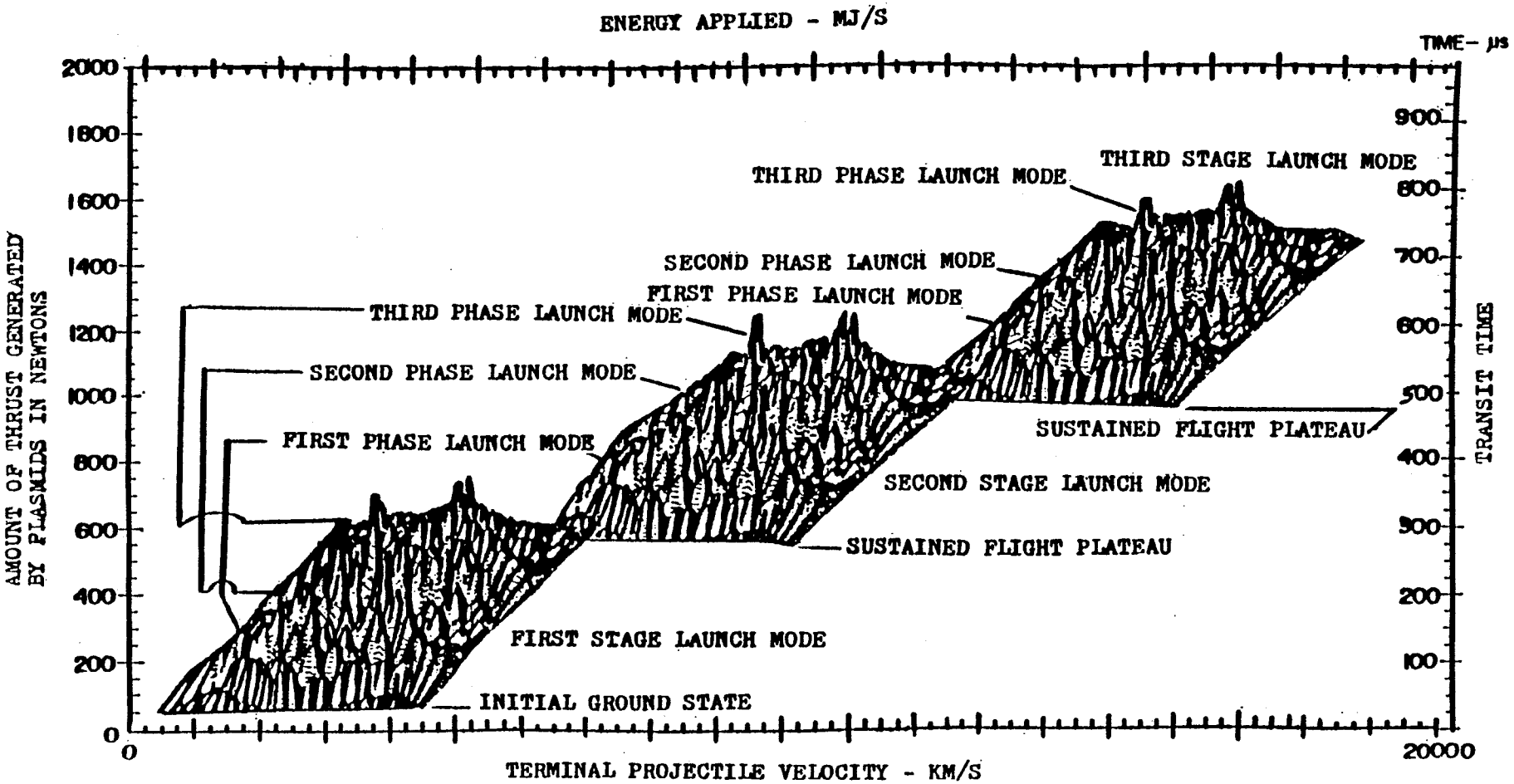
FIG. 29 is a graph describing the relationship between the thrust generated by plasmids and the exit velocity.

FIG. 29 discloses the third said event; wherein if all other parameters are constant or invariant the exit velocity is directly proportional to the thrust generated by the plasmatization of plasmoids with the central bore of the device Plasmids of different compositions are as stated earlier introduced serially in successive stages. The extent to which plasmids undergo plasmatization depends on the mass state conversion of said plasmids in relation to the electromagnetic energy expended to energize the aforesaid plasmids to a high velocity plasma. The thrust parameters of plasmids assessed ignoring the minute losses incurred when said plasmid must be encapsulated or packaged by other material to form wafers. The incapsulation of measured quantities of mercury into convenient packages or wafers by a thin layer of aluminium, tin, celophane or other substances with the thickness of said packaging averaging several hundred micrometers. Those skilled in the art can readily understand and appreciate that the negligible extend to which the material diminishes or impedes the plasmatization process.

Figure 30:
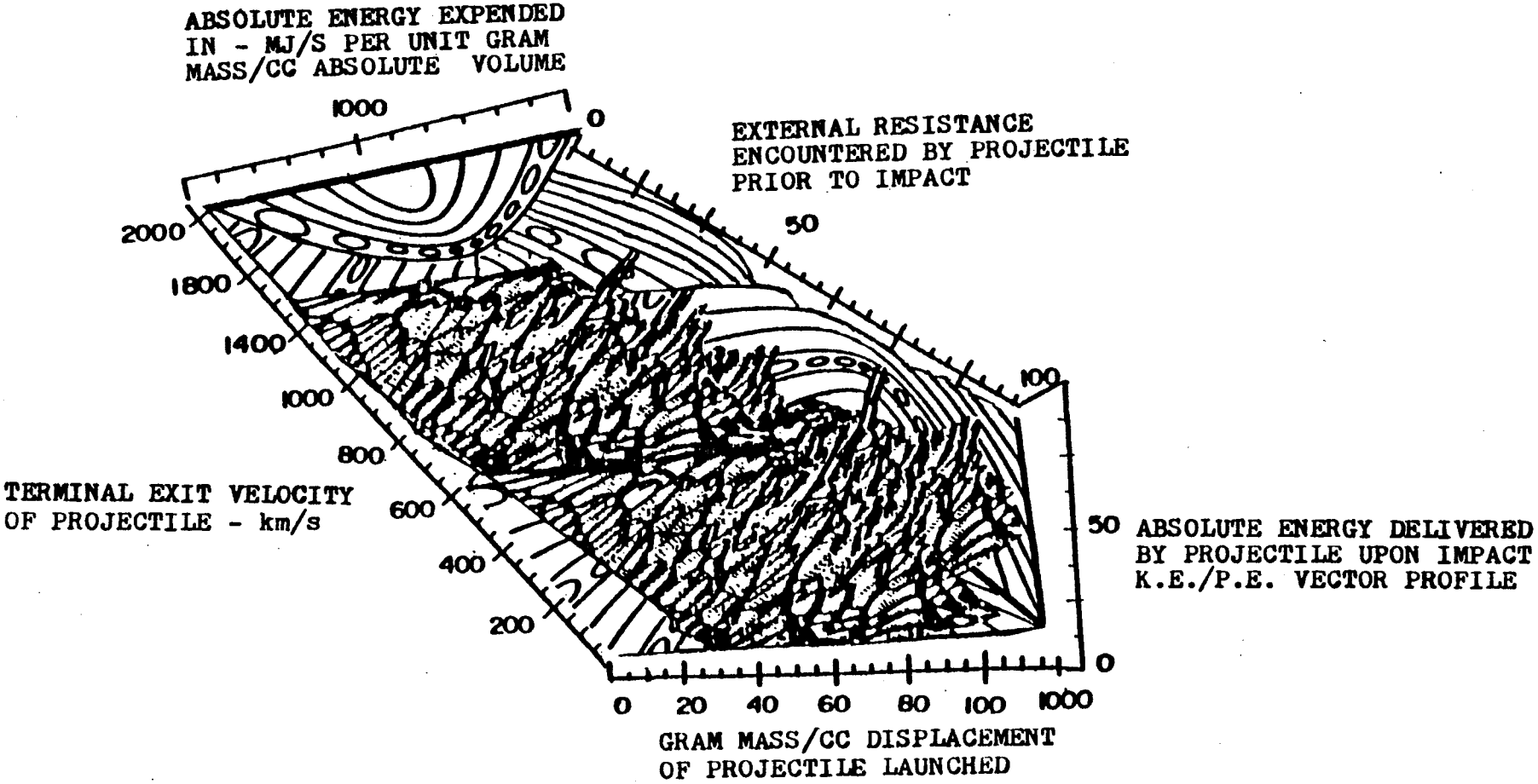
FIG. 30 is a graph detailing the effect of resistant forces upon projectile acceleration.

The exit velocity of a give projectile appears to vary logarithmically in relation to the absolute mass of said projectile relative to resistance encountered by said projectiles prior to target impact. The resistance encountered by said projectiles includes but is not limited to atmospheric or medium resistance, drag, friction, gravity, the forces of inertial and/or other obstacles encountered by said projectiles. FIG. 22 graphically illustrates the abovementioned logarithmic relationship between exit velocity of a projectile, the mass of a projectile and the resistance encountered therein. It is graphically detailed in FIG. 22 by a dashed line the effects of rapid successive firings of projectiles. Projectiles fired in rapid succession within an optimum range effectively clears a rarified corridor between the bore of said device and the specified target. Said corridor in effect disperses and/or displaces the medium which has existed prior to the firing of the first projectile. It is additionally important note to the extend to which a corridor is cleared is a function of the density of the medium which is to be displaced, the linear length or distance which the projectile has to transverse between the bore of the device and said target, the cohesive forces generated by elements composing said medium and other related parameters. FIG. 30 then describes what is termed the fourth event describing resistive forces impeding the motion or acceleration of projectiles in flight towards specified target sites.

Further trials conducted on the device embodied within the invention and other similar such devices inconclusively indicates that there are maximum operative limits. The aforesaid trials conducted to determine the maximum operative limits were greater than five but did not exceed ten; and therefore can not be weighted with the same statistical significance as those tests conducted, wherein one hundred trials had been completed to establish operative norms. Preliminary evidence based on sparse trials indicate that irregardless of the size, power, number of stages embodied within the aforementioned devices and/or other related parameters, that the exit velocity will level off and eventually reach a plateau. The aforesaid plateau relates to the maximum exit velocity attainable by a projectile, the effects of the medium in which the said projectile is to traverse and the effects of gravity, inertia or the speed of said projectile in relation to the speed and distance of said targets.

The aforementioned multiple launch stages, as previously indicated consist of three separate and distinct phases or stages. The first said stage or phase consists of the serial introduction of plasmid material in the form of wafers obtained from cannisters which are plasmatized by an intense arcing source. The second said stage consists of an array of Tesla means circumferentially disposed and tilted so as to lie in the surface of a virtual core which is coaxial with the bore of the mass action driver device with the discharge ends situated forward providing additional thrust in the direction of said plasmids previously introduced in the aforesaid first stage. Additionally plasmids are radially introduced and plasmitized by arcs introduced by electrode elements of said Tesla coil. Rail elements circumferentially disposed around the central bore of the aforesaid device and provide electrical propagation of said plasmids introduced in the first and second stages. Magnetic induction elements provide the third stage of electropropulsive thrust.

The introduction of repetitive stages consisting of multiples of the aforesaid three stages is within the scope of the invention. The implementation of multiple launch phases consisting of multiples of the three aforesaid launch stages or phases when taken in succession can increase the velocity and mass of projectiles dispersed; substantially; however there are practical operating limits.

The implementation of multiple launch phases consisting of multiples of the three aforesaid launch stages phases when taken in succession can increase the velocity and mass of projectiles dispersed substantially; however there are practical operating limits. There are additional limits which must be imposed on the electronics and electro-optical systems embodied within the aforesaid device. The CPU originally embodiment within the device consisted of ten cards of Intels SDK-86 module.* The electro-optical modules and component systems were obtained from subsidiaries of Hewlett Packard, I.B.M. and Hatachi. The voice recognition synthesizer means, feedback circuits and secondary logic circuits where initial purchase and customized from subsidiaries of I.B.M., Fairchild and Sinclear. There are present presently more sophisticated systems either available or under development from companies previously mentioned and other sources. The limitations initially reside in the computational power of each unit, the number of computations needed per a interval of time and the type of target acquisition interphased with the mass action driver device.

Figure 31:
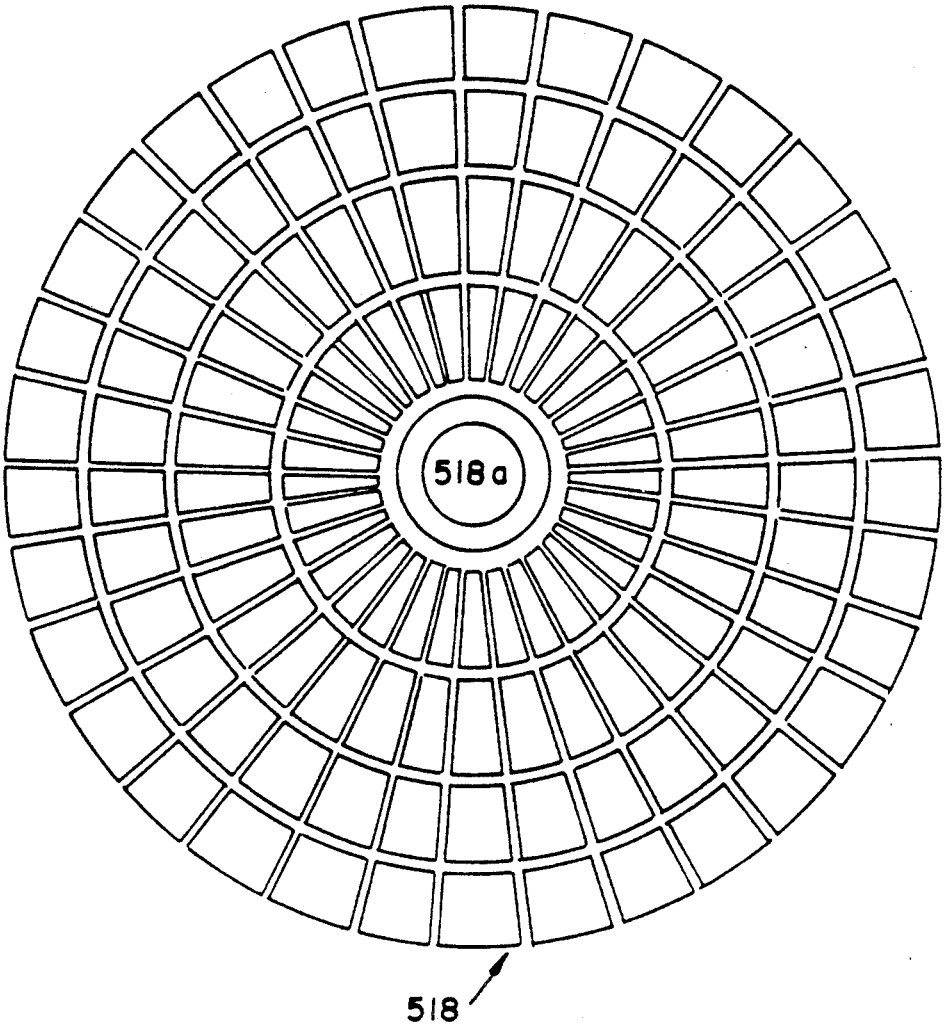
FIG. 31 is a pictorial description of the outer impact aborptive ceramic shell incasing the body of the explosive device.

FIG. 31 is a greatly simplified pictorial representation of the encapsulated exterior portion of the spherical explosive means. Each plate means of which there are thousands is laminated to the one adjacent above and below it consisting of a composite material which is both an ablative and an effective absorptive of kinetic stress. The entire complex of plates are assigned the numeric value 518. The explosive center or centroid of the structure is designated by number 518*a*. Suitable ablatives such as nylon phenolic quartz acrylic compounds and plates of boron and nitrogen impregnated silicon ceramic or kinetic absorptive was obtained commercially and shaped in a pressurized mold via techniques well known and practiced by those skilled in the art.

Figure 23C:
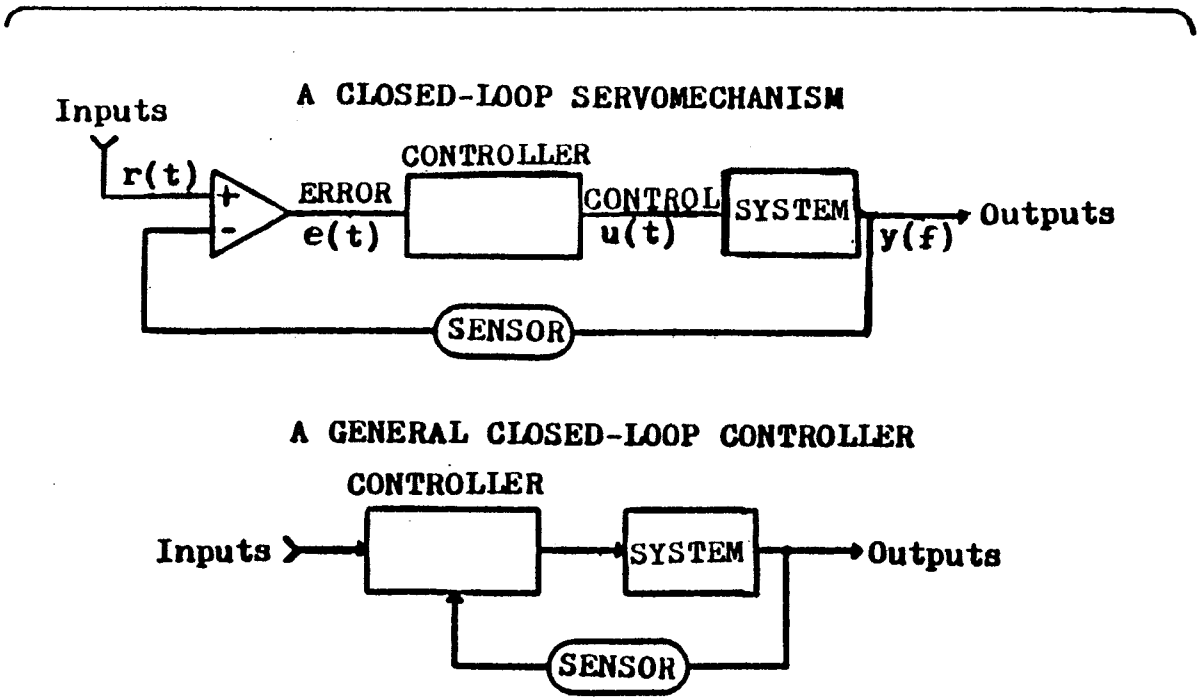
Figure 31C:
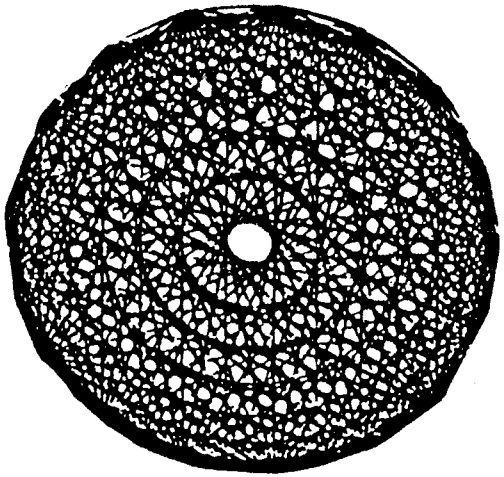
FIG. 31*c* is an additional perspective view of the same said equivalent synthetic structures described in FIG. 31*a* and FIG. 31*b*, however the density or number of winds is greatly increased.
Figure 31B:
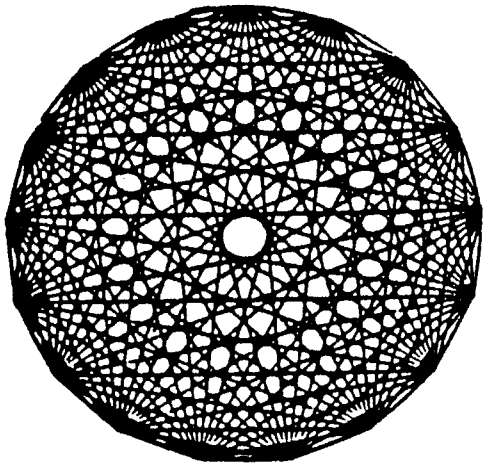
FIG. 31*b* is a higher density wind of he same said synthetic thread depicted in the preceding FIG. 23*a;*
Figure 31A:
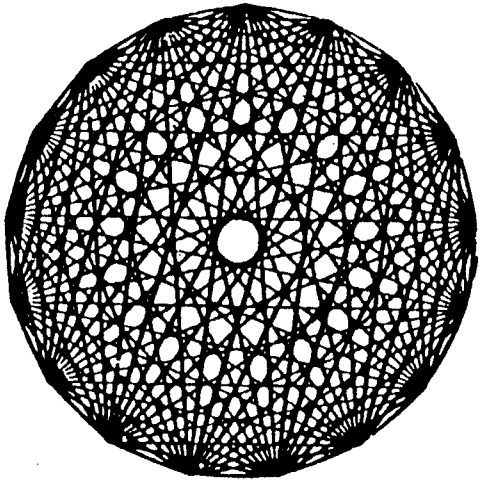
FIG. 31*a* is an illustrative view of the spun or woven extruded synthetic thread wound around the explosive means to insulate it against heat and to lessen the kinetic perturbation produced by extremely high g-factors and impact effects.
Figure 3:
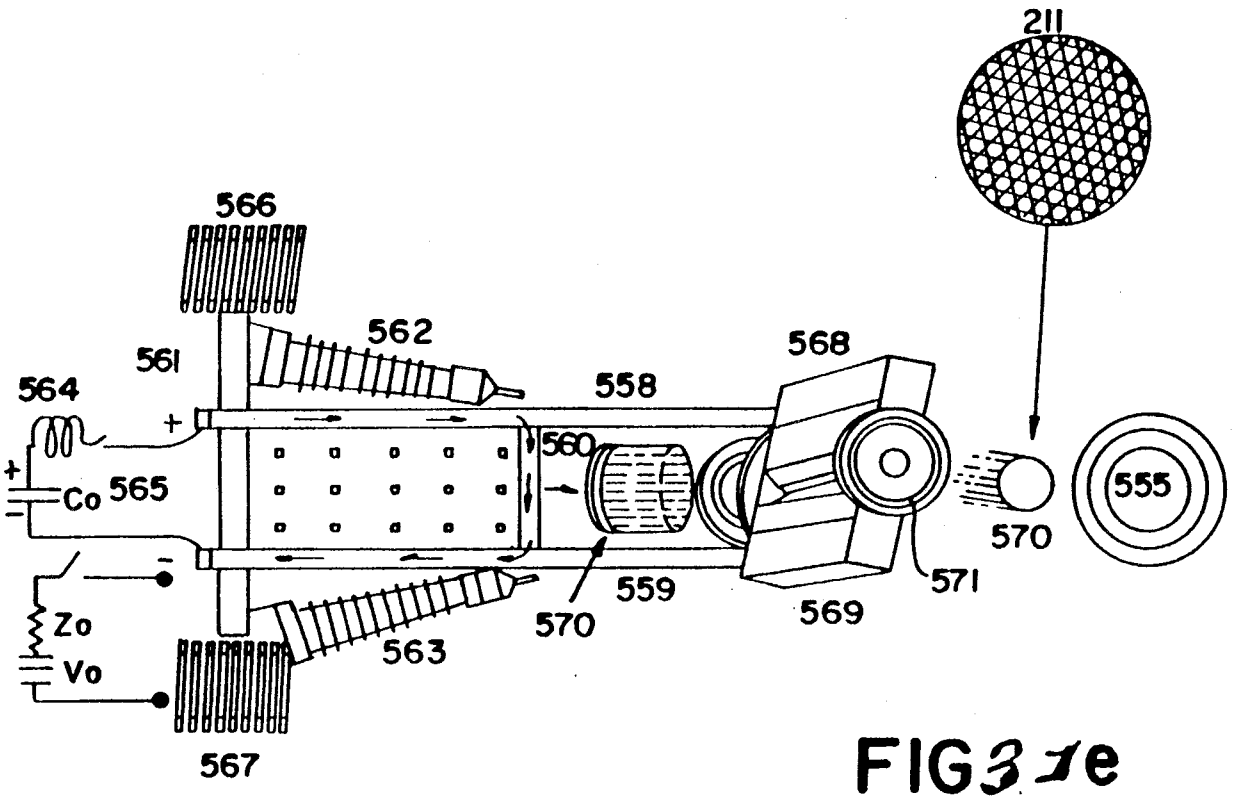

FIGS. 31*a*, 31*b*, 31*c* are pictorial representations of the spun synthetic fiber encasing the explosive device and laminated to the ceramic structure 518 which pulverizes into a fine powder upon impact due to a absorption of kinetic energy approaching or in excess of 98.5 percent. Each figure is assigned a single numeric value differing from one another only in increments of density. FIG. 23*a* is assigned numeric value 519, FIG. 31*b* is assigned numeric value 520 and FIG. 23*c* is assigned the numeric value 521.

The impact of the armor piercing boring projectiles is sustained or prolonged rather than transitory as with the explosive device; wherein a kinetic ceramic absorptive material absorbs approximately 98.5 percent of the energy of impact prior to being pulverized into a fine powder. The inner most operative components of the explosive device are embedded in a supportive extruded matrix woven from synthetic silicon (Kalvar) and graphite expoxylated laminated tendrils or fibers such as Celion GY70/epoxy Modmor 11/epoxy, Scotchply/1002 Thornel 300/epoxy and or similar such materials which also form the secondary outer protective shell encasing the entire explosive means as described earlier.

It now becomes necessarily incumbent to describe some operational field equations concerning impact, structural deformation and transferral of kinetic energy or the like of a moving projectile encountering a relatively solid resistive static force. Equations proposed by Chao, Greszczuk, Husman, Sun, Young and others appear to be valid upon experimentation even though obverse or opposite conditions exist wherein a metal or steel slug was fired into a beam of composite material rather than having the projectile composed of composite reinforced material piercing material such as earth, granite, quartz, or other materials.

The energy imparted from a sphere to a laminate during the period of impact can be computed on the basis of work done by the contact force as indicated in the simplified equations herein below;

$$K.E.\ \tfrac{1}{2}m_s(\dot{w}_o^2 - \dot{w}_f^2)$$

or $$K.E. = \int_0^{w_f} F\,dw$$

where $\dot{w}_o$ and $\dot{w}_f$ are the initial velocity and final velocity, respectively, and $w_f$ is the displacement of the projectile when the contact ceases. The quantities $\dot{w}_o$ and $\dot{w}_f$ are part of the finite element solution. Then a numerical integration scheme can be used to evaluate the integral. Of course, one cannot expect these elastic solutions to compare favorably with the experimental results. The reason appears obvious.

The total amount of work done by the projectile on the laminate in the loading process is $$K.E._T = \int_0^{w_{max}} F\,dw$$

where $w_{max}$ is the displacement of the sphere at $F=F_{max}$. It should be noted that $w_{max}$ is not the maximum value of w.

The classical Hertzian contact law for an elastic sphere pressed into an elastic isotropic half space which is given as $$F=K\alpha^{\frac{1}{2}}$$

where F is the contact force, $\alpha$ is the indentation depth, and K $$K = \frac{4}{3}\ \frac{R_s^{\frac{1}{2}}}{\dfrac{1-v_s^2}{E_s} \dfrac{1-v_b}{E_b}}$$

is the rigidity associated with the deformation. The above $R_s$ is the radius of the sphere; $V_s$, $E_s$ and $E_b$ are the Poisson's ratios and the Young's noduli of the sphere and the half space, respectively. The Hertzian law $$k = \frac{4}{3}\ \frac{R_s}{\dfrac{1-v_s^2}{E_s} + \dfrac{1}{E_T}}$$

where $E_T$ is the transverse Youngs's modulus of fiber composites.

Since not all the work done by the projectile is dissipated in the contact zone, the total amount of imparted energy $K.E._T$ cannot be used directly to account for the amount of damage received by the laminate. A more pertinent quantity is the damage energy defined by $$K.E._D = \int_0^{\alpha_{max}} F\,d\alpha$$

where $\alpha_{max}$ is the maximum indentation. The integration also can be carried out numerically by using the finite element solutions. The rest of the work done by the projectile is stored in the form of vibrational energy give by $$K.E._v = K.E._T - K.E._D = \int_0^{v_{max}} F\,dv$$

where $v_{max}$ is the displacement of the beam at the contact point when $F=F_{max}$.

If the response histories of the contact force, the indentation, and the displacement of the projectile are obtained according to the true dynamic contact law, the damage energy can be computed from the equation $$K.E._D = \int_0^{\alpha_{max}} F d\alpha + \int_{\alpha_{max}}^{\alpha_T} F d\alpha$$

where $\alpha$ is the indentation depth at which the contact force vanishes. The total work done by the projectile is given by $$K.E._T = \int_0^{w_{max}} F dw + \int_{w_{max}}^{w_T} F dw$$

where $$\alpha_\theta = \tfrac{1}{2}h\epsilon_\theta$$

and $$\epsilon_\theta = Y/E_T$$

where Y is the transverse strength of the fiber composite. The total displacement recovered at the contact point is given by another approach to the impact response of composite structures entails the determination of the time-dependent surface pressure distribution under the impactor, time-dependent internal stresses in the target caused by the surface pressure, and failure modes in the target caused by the internal stresses.

The final expressions for the maximum surface pressure, $q_o$, major and minor axes of the area of contact, a and b, respectively, maximum deformation under the impactor, $\alpha_1$, and impact duration, $t_o$ are $$q_0 = \frac{1}{\pi^{4/3}}\left\{\frac{(3/2\pi)^{1/3}N^{2/15}(\beta)^{1/5}}{mn[(k_1+k_2)]C_R^{2/3}}\right\}$$

$$\frac{b}{n} = \frac{a}{m} = \left[\frac{3\pi}{2}(k_1+k_2)C_R N^{2/5}(\beta)^{3/5}\right]^{1/3}$$

$$S = \left\{\left[\frac{9\pi^2(k_1+k_2)^2}{256C_R}\right][N^{4/5}][\beta]^{6/5}\right\}^{1/3}$$

$$t_o = \frac{2.94a_1}{V}$$

where $$\beta = \frac{5V^2 m_1 m_2}{4(m_1+m_2)}$$

$$N = \left[\frac{256C_R}{9S^3\pi^2(k_1+k_2)^2}\right]^{1/2}$$

$$C_R^{-1} = \frac{1}{R_{1m}} + \frac{1}{R_{2m}} + \frac{1}{R_{1m}} + \frac{1}{R_{2m}}$$

$$V = V_1 + V_2$$

where subscripts 1 and 2=impactor and the target, respectively, $R_{1m}^{-1}$ and $R_{1M}^{-1}$=principal curvatures of the impactor, $R_{2m-1}$ and $R_{2M}^{-1}$=principal curvatures of the target, $V_1$ and $V_2$ =approach velocities of the impactor and the target, respectively, $m_1$ and $m_2$=masses of the impactor and target, $k_1$ and $k_2$=parameters (defined later) that take into account properties of the impactor and target, and m, n, and S=parameters that are a function of $R_{1m}$ $R_{1M}$ $R_{2m}$, $R_{2M}$ given in Tables as a function of $\theta$ where $$\theta = \arc\cos\left\{C_R\left[\left(\frac{1}{R_{1m}} - \frac{1}{R_{1M}}\right)^2 + \left(\frac{1}{R_{2m}} - \frac{1}{R_{2M}}\right)^2 + 2\left(\frac{1}{R_{1m}} - \frac{1}{R_{1M}}\right)\left(\frac{1}{R_{2m}} - \frac{1}{R_{2M}}\right)\cos 2\phi\right]^{\frac{1}{2}}\right\}$$

The pressure distribution under the impactor is given by $$q = q_0\left\{1 - \left(\frac{x}{a}\right)^2 - \left(\frac{y}{b}\right)^2\right\}^{\frac{1}{2}}$$

where x and y are the coordinate axes in the directions of the axes of ellipses a and b, respectively; whereas, the total force from impact is $$P = \frac{2\pi ab}{3} q_0.$$

The pressure $q_i$ and the approach velocity $V_i$ at any given time can be obtained from equations given in the references. The terms $k_1$ and $k_2$ appearing in the preceding equations and take into account mechanical properties of the impactor and target. For an isotropic impactor $$k_1 = \frac{1 - V^2}{\pi E};$$

whereas for the case of planar isotropic composite target the expression for $k_2$ can be derived from results given in references. The final expression for $k_2$ is $$k_2 = \frac{\sqrt{A_{22}}\,\{(\sqrt{A_{11}A_{22}} + G_z)^2 - (A_{12}+G_z)^2\}^{\frac{1}{2}}}{2\pi\sqrt{G_z}\,(A_{11}A_{22} - A_{12}^2)}$$

where $$A_{11} = E_z(1 - V_r)\Omega$$

$$A_{22} = \frac{E_r}{E_z}\left(\frac{E_z - V_{rz}^2 E_r}{1 + V_r}\right)\Omega$$

$$A_{12} = E_r V_{rz}\Omega.$$

Approximate relationship between impact velocity and impact force in a flexible orthotropic plate.

$$1 = \frac{\sigma_{11}^2}{F_{11}^2} + \frac{\sigma_{22}^2}{F_{22}^2} + \frac{\sigma_{33}^2}{F_{33}^2} + \frac{\sigma_{12}^2}{F_{12}^2} + \frac{\sigma_{13}^2}{F_{13}^2} + \frac{\sigma_{23}^2}{F_{23}^2} - \left(\frac{\sigma_{11}}{F_{11}}\right)\left(\frac{\sigma_{22}}{F_{22}}\right)\left[\frac{(1+2V_{21}-V_{23})E_1 + (1+2V_{12}-V_{13})E_2}{\{(2+V_{12}+V_{13})(2+V_{12}+V_{23})E_1E_2\}^{\frac{1}{2}}}\right] - \left(\frac{\sigma_{11}}{F_{11}}\right)\left(\frac{\sigma_{33}}{F_{33}}\right)\left[\frac{(1+2V_{31}-V_{32})E_1 + (1+2V_{13}-V_{12})E_3}{\{(2+V_{12}+V_{13})(2+V_{31}+V_{32})E_1E_2\}^{\frac{1}{2}}}\right] - \left(\frac{\sigma_{22}}{F_{22}}\right)\left(\frac{\sigma_{33}}{F_{33}}\right)\left[\frac{(1+2V_{23}-V_{21})E_3 + (1+2V_{32}-V_{31})E_2}{\{(2+V_{21}+V_{23})(2+V_{31}+V_{32})E_2E_3\}^{\frac{1}{2}}}\right]$$

where $\sigma$=impact-induced normal and shear stresses,

F=allowable strength properties of material associated with the three orthogonal directions, and E and $\nu$=Younds's moduli and Poisson's ratios.

FIG. 31*d* is a detailed sectional view of internal structural components of a proposed hyperatomic mechanism. Single element versions of the explosive means were constructed utilizing a special commercially available two element impact plastic explosive gelatin instead of fissionible material, wherein an impacter is accelerated at extreme velocity instead of an initiator and or high velocity neutron emitting sources. Element 522 is a partial view of the outer shell casing of the explosive means consisting of numerous plates of impact absorptive ceramic material mentioned earlier in the disclosure. Numerals 523 through 528 are indicative of high voltage source generators with exiting filaments or charging inlets associated with external energizers. Numerals 529 through 535 denote the miniature mass action driver means utilized to accelerate projectiles into the explosive centroid designated by numeral 555. The combination of charging coils and capacitor banks is illustrated by elements 536 through 542. Additional high voltage generators are depicted by electrostatic generator or voltage acceleration coils 543 through 552 of which only ten of twelve elements are shown. Structures 553, 554 are a partial representation of only two of six radiofrequency units deployed to irradiate the central explosive mass important in devices involving nuclear charges. The radiofrequency devices are believed to increase the mass density pressure of the non-critical nuclear mass by a slight but significant degree of 2.5 to 5.0 percent prior to engagement of said mass by a fast moving neutron source. Numerals 556, 557 are an electro-optical/electronic timing sequencer and a partial visual perspective of the woven synthetic support strut structures, respectively. The woven synthetic support matrix 557 consists of a spun fiber polymorphic polycrystalline silicon and or a high carbon fiber polyester of a commercially available type, wherein all structural component systems are embedded and stabilized prior to and after the initial impact.

FIG. 31*e* is in brief an illustrative simplified pictorial sectional view of the initiator/alpha emitter capsule heading for its intended target centroid. The mass action unit consists of a modified d.c. rail gun type of assembly. The d.c. rail assembly is described herein by numerals 558, 559 and 580 which consists of a positive rail structure, a conducting plasmoid disc which upon ionization provides the forward thrust and a negative d.c. rail completing the circuit. The support bar number 561 is flanked on either side of the assembly by two voltage acceleration coils depicted by numerals 562 and 563. Numerals 564, 565, 566 and 567 are indicative of the charging capacitance bank, switching elements and ancillary charging coil. The forward thrust occurs as the plasmoid disc 560 undergoes ionization driving either an initiator and or alpha emitting source 570 into a linear trajectory pattern. Additional rails are provided, numerals 568 and 569,. The ultra high velocity projectile 570 exits the rail gun element through orifice 571 towards its intended target centroid element 555 which contains either a conventional explosive or a fissionible mass. Hence two projectiles are fired head on from two equivalent rail gun devices; such that one impactant is composed of a suitable initiator such as beryllium and the other advancing projectile is a suitable alpha emitter. The subsequent impact occurs in the center of the fissionible mass releasing copious quantities of fast moving neutrons which bring about the formation of a critical mass from a non-critical mass value conducive for the initiation of a chain reaction process. The primary reactants, a suitable initiator, an alpha emitter, Polonium, etc. is placed in close proximity with the aforementioned neutron source generator; such as beryllium in a manner indicative of the Chadwick reaction. Since the aforementioned reaction occurs at the centroid of the subcritical fissionible mass composed of U235, Pu239 or other suitable material wherein the critical factor $K<1$, becomes drastically altered to a state in which $K>>1$, at which point a chain reaction is elicited and subsequently propagated as the secondary reactants, the neutrons and the heavy isotope U235 or Pu239 reaching some critical or maximum density factor in accordance with reactants propelled into one another which is in accordance with the scope of the invention and set forth herein below by several greatly simplified nuclear field equations:

$$_4Be^9 + 2He^4 \rightarrow {}_6C^{-} \rightarrow {}_6C^{12} + ON^1.$$

The Chadwick reaction provides one source of neutrons as the above equation indicates prior to initiating a chain reaction described by the equation herein below:

$$on^1 + {}_{92}U^{235} \longrightarrow {}_{92}U^{236} \longrightarrow {}_{56}Ba^{141} + {}_{36}Kr^{92} + 3\ {}_0n^1$$

$$1.0087u + 235.0439u \longrightarrow 140.9139u + 91.8973u + 3.0261u$$

$\Sigma_m$ reactants 236.0526u — $\Sigma_m$ products 235.8373u $\Sigma_m$ reat $-$ $\Sigma_m$ prod. $= 0.2153u$
1 atomic mass unit $\cong 1.66 \times 10^{-24}$ gm
$\therefore$ mass converted $\cong 3.57 \times 10^{-25}$ gm $$\text{Energy released} \approx \begin{cases} 3.57 \times 10^{-25} \times (3 \times 10^{10})^2 & = \dfrac{3.21 \times 10^{-4}\ \text{erg}}{1.60 \times 10^{-12}\ \text{eV}} \\ 3.21 \times 10^{-4}\ \text{erg} & = 2.01 \times 10^8\ \text{eV}. \end{cases}$$

If fissionable material is encased by a shell of fussionible material such as, lithium deuteride, deuterium or any other suitable material, than the energy derived or released from the nuclear reaction will initiate a thermonuclear reaction or fusion process described in brief herein below:

$$_1H^2 + {}_1H^2 \longrightarrow {}_1H^3 + {}_1H^1 + 4\ \text{MeV}$$

$$_1H^2 + {}_1H^2 \longrightarrow {}_2H^3 + on^1 + 4\ \text{MeV}$$

$$_1H^3 + {}_1H^2 \longrightarrow {}_2He^4 + 2on^1 + 11\ \text{MeV}$$

$$_1H^3 + {}_2H^2 \longrightarrow {}_2He^4 + on^1 + 18\ \text{MeV}$$

$$\text{ionization energy of hydrogen} \left\{ \begin{array}{l} = 2.18 \times 10^{-11}\ \text{erg} \\ = \dfrac{2.18 \times 10^{-11}}{1.60 \times 10^{-12}} \end{array} \right\}$$

or 13.6 eV

Alternate variations of fusion processes describing the thermal nuclear ignition are standard and indicated herein below:

$$D + T \rightarrow He^4(3.5\ \text{Mev}) + n(14.1\ \text{Mev})$$

The above reaction, once initiated will subsequently detonate secondary reactions:

$$D + D \rightarrow T(1.01\ \text{Mev}) + p(3.02\ \text{Mev})$$

$$D+D \rightarrow He^3(0.82\ Mev)+n(2.45\ Mev)$$

The resulting tritium originating from said preceeding secondary reaction, $$D+D \rightarrow T(1.01\ Mev)+p(3.02\ Mev);$$

whereas a lower yield of $He^3$ from reaction $$D+D \rightarrow He^3(0.82\ Mev)+n(2.45\ Mev),$$

will undergo fusion by reaction $$He^3+D \rightarrow He^4(3.67\ Mev)+0\ p(14.67\ Mev).$$

Other possible reactions can additionally formed by neutrons (n, 2n generated by such nuclides as, D, $Be^7$, $Bi^{209}$, $Li^7$ and other nuclides. It is believed by Marwick and others, as cited in the prior art, that even though a majority of neutrons have a high probability of being absorbed by fissionible or fissile actinides such as $Pu^{239}$, $U^{233}$, or related materials such as reactions as, $$n+Li^6 \rightarrow T(2.74\ Mev)+He^4(2.06\ Mev)$$

and $$n+He^3 \rightarrow T(0.19\ Mev)+p(0.57\ Mev),$$

respectively.

$$\frac{1}{2} MVa^2 = \frac{3}{2} Kt$$

$$\int_{K.E._{Z2}}^{K.E._{Z1}} MVa^2 \rightarrow 3\ Kt$$

$$Z_1 + Z_2 \rightarrow \text{dist.}R \text{ If } R = 10^{-12}\text{cm}$$

$$Z_1\ Z_2\ e^2/R$$

$$3\ KT = \frac{Z_1 Z_2\ e^2}{R}$$

$$T = \frac{Z_1 Z_2\ e^2}{3\ KR}$$

$$T = \frac{Z_1 Z_2 (4.8 \times 10^{-10})^2}{(3)(1.38 \times 10^{-16})(10^{-12})}$$

$$T = 5.5 \times 10^6\ Z_1 Z_2\ ^\circ K.$$

Figure 32:
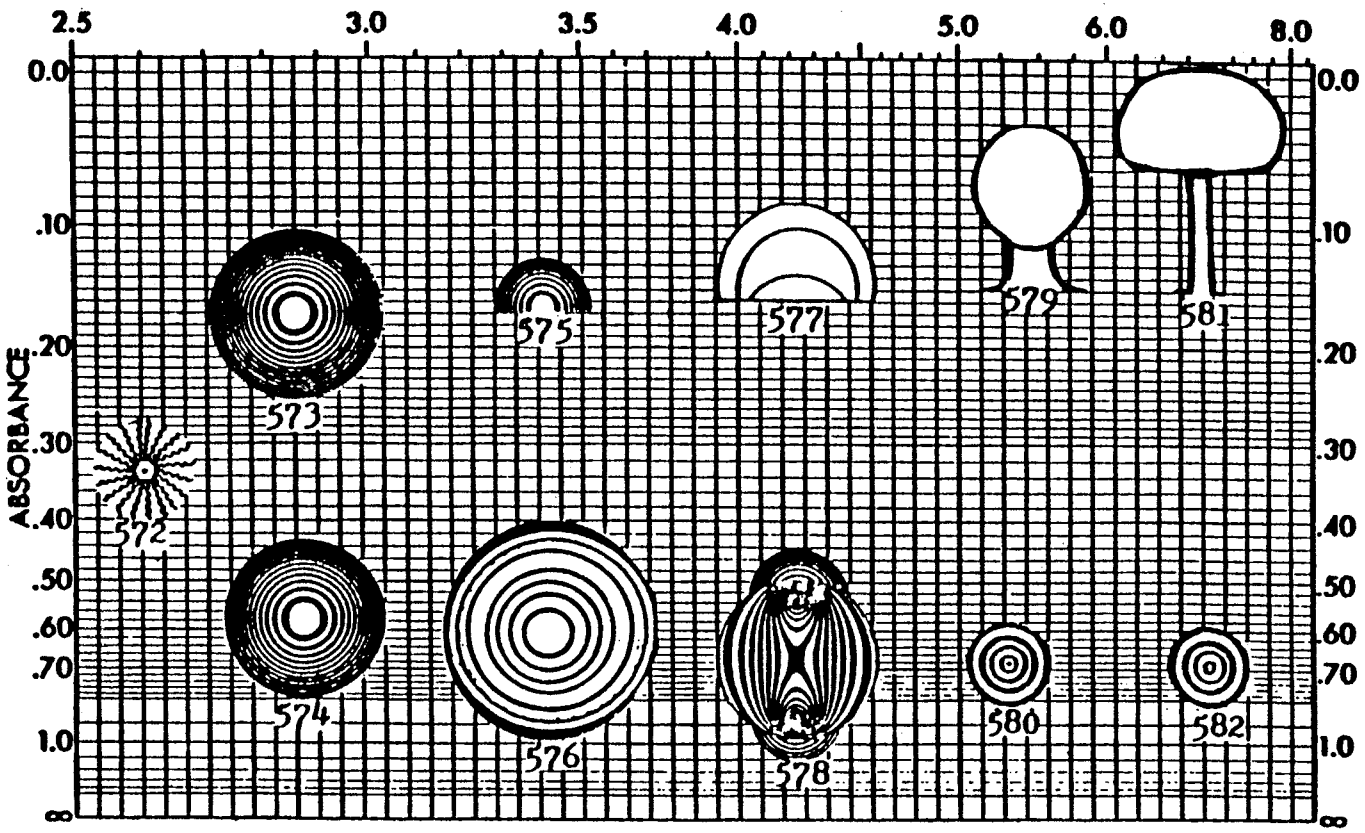
FIG. 32 is a graphical illustration depicting the thermal kinetic evolution of an above and below ground detonation.
Figure 33:
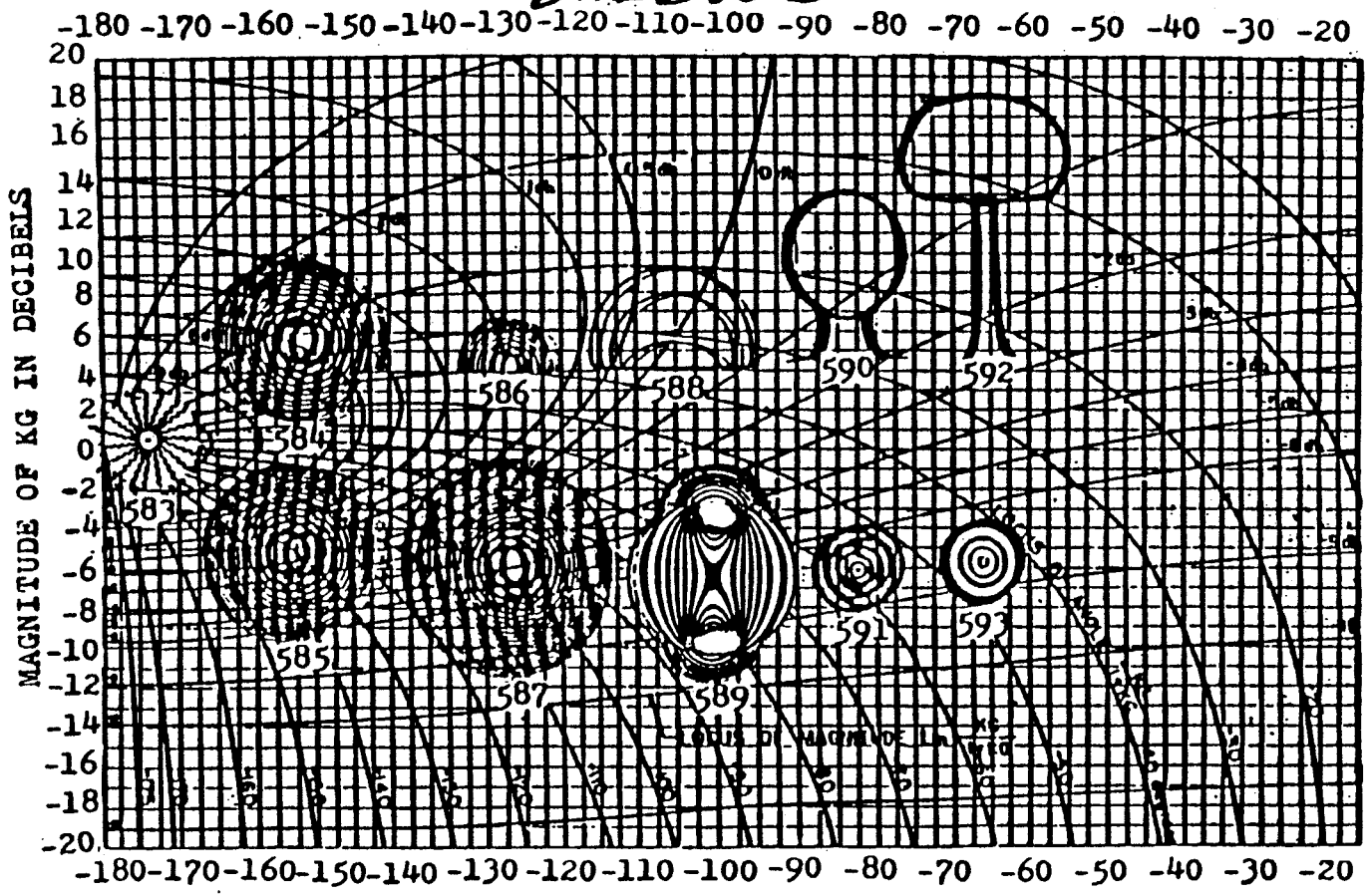
FIG. 33 is an equivalent graphical representation of the same said explosive evolution as denoted in FIG. 32, here however compressional considerations are emphasized.
Figure 39A:
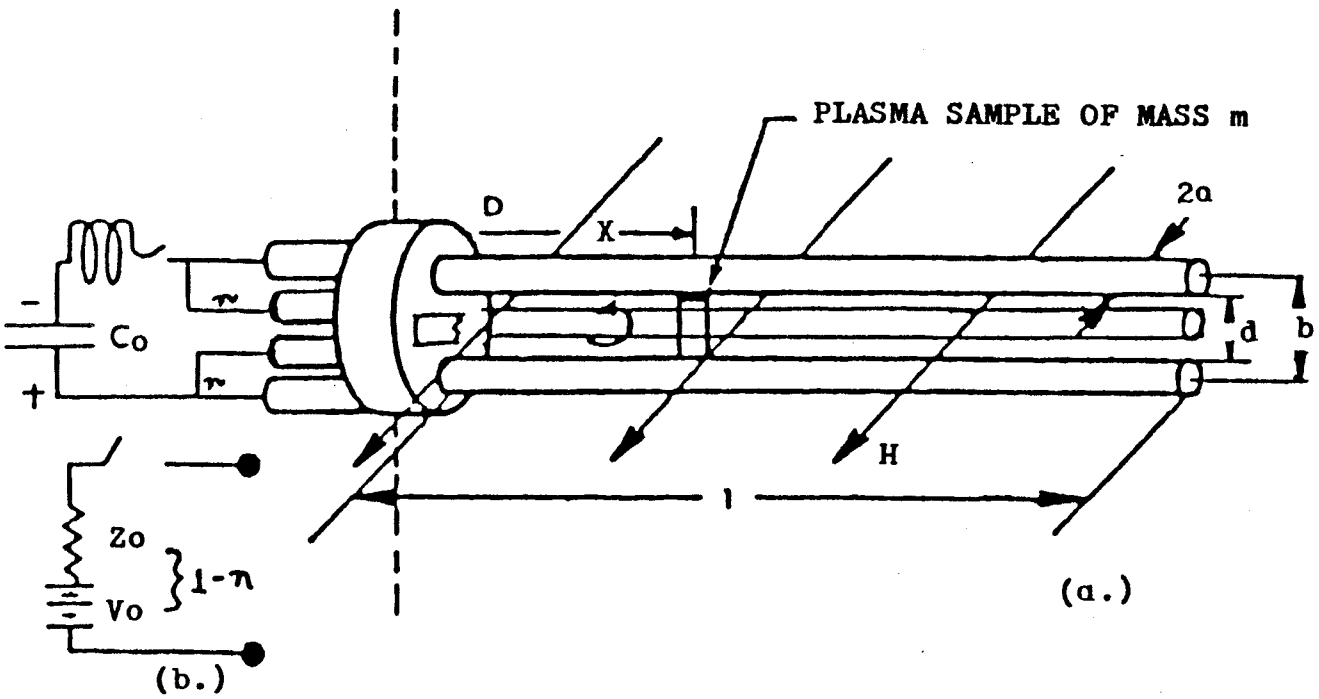
FIG. 39 is in effect a combination block diagram and schematical representation in which only one of several optical electronic analog/digital converter units deployed by the M.A.D. unit.

FIGS. 32 and 33 are concise pictorial representations describing the evolution of explosive forces above and below ground level. Numeral 572 of FIG. 32 the actual detonation occurring approximately 10 microseconds after K>>1. Numerals 573, 574, 575, 576, 577 and 578 denote the expansive thermal kinetic forces 50–100 microseconds, 10–50 milliseconds and 100 milliseconds after initial detonation. Numerals 579, 580, 581 and 582 depict the thermal kinetic shockwave patterns one second and ten seconds to one minute after the initial onset of the explosion. Numerals 573, 575, 577 579 and 581 are illustrative of the thermal kinetic shockwave progression of the explosion above ground level; whereas numerals 574, 576, 578, 580 and 582 are indicative of the explosive event within the same time frame occurring below ground level.

Numerals 583 through 508 of FIG. 33 corresponds to the exact time frame of the above and below ground detonation, however the graphical representation here is from the perspective of compressional forces generated by the explosion. The above ground detonation forces are illustrated by values 584, 586, 588, 590 and 592 respectively; whereas the corresponding below ground detonations are illustrated by values 585, 587, 589, 591 and 593, inclusive.

The Mass Action Driver Device (M.A.D.) system is in effect a special variation of a series-shunt type plasma engine or motor provided with a secondary plasma infusion and a ternary magnetic induction means. The consequence of the M.A.D. structural design provides a fascile means in which to calculate and therefore predict the parameters concerning projectile thrust, velocity vector, trajectory and impact. The above mentioned parameters and others are readily deduced from basic field equations formulated on the basis of similar such devices and a necessary consequence of the functional design of the launch cavity and employed in accordance with the invention which is set forth herein below.

A magnetic field H is increased such that the current, i, in the sample is flowing, so that the force accelerating the sample is given by the expression contained herein, such that $$f = i\ (Hav + H)\ d/10$$

as described in FIG. 33*a*. FIG. 33*a* is a concise schematic representation of the electric field applied to a rail system projecting a projectile with a mass m. All terms disclosed in FIG. 33*a* are well known to those skilled in the art and described in more detail in the foregoing equations.

The velocity is given by $$v = \int_0^t \frac{f}{m}\, dt \simeq \frac{d}{10m} \int_0^t i \left[ \frac{2i}{10d} \ln(b/a) + H \right] dt =$$

$$1/10m \int_0^t i \left[ \frac{i4.6 \log_{10} b/a}{10} + Hd \right] dt$$

The back emf $V_x'$, due strictly to the motion v in (Hav+H), is $$V_x' = \frac{V \times (H + H_{av}) \cdot 300d}{c} \simeq v \left( H + \frac{2i}{10d} \ln b/a \right) d/10^9,$$

and again another term must be added to obtain the total back emf at x. However the back emf measured at the point x=0 is $$V_{x=0} = \hat{L}x \frac{di}{dt} + \hat{L}\ i\ dx/dt + (Hd/10^9)\ dx/dt$$

and the energy input at the point x=0 is $$E_{in,x=0} = \int V_{x=0}\ i\ dt = \int_0^t \hat{L} \times i \left( \frac{di}{dt} \right) dt +$$

$$\int_0^t \hat{L}\ i^2 \left( \frac{dx}{dt} \right) dt.$$

To evaluate $E_{in}$ for a power source the simplification of having i be equal to a constant value.

$$v = (1/10m)\left(\frac{2I^2 \ln b/a}{10} + I\,Hd\right)t$$

$$= (1/10m)\left(\frac{4.6\,I^2 \log_{10} b/a}{10} + I\,Hd\right)t$$

$$V_{x=0} = V_{x=x} = [\hat{L}\,I + Hd/10^9]\frac{dx}{dt}$$

$$= [0.92(\log_{10} b/a)10^{-8}\,I +$$

$$Hd/10^8](d/10m)\left(\frac{4.6\,I^2 \log_{10} b/a}{10d} + IH\right)t,$$

such that, $$E_{in} = \int_0^t V_{x=0}\,i\,dt = [0.92(\log b/a)10^{-8}I + Hd/10^8](d/10m)$$

$$\left(\frac{4.6\,I^2 \log_{10} b/a}{10d} + IH\right)\frac{It^2}{2}$$

if the simplifying artifice of the circuit is utilized, the equation can be written in terms of $$V_0 \approx Z_0\,i + Z_{load}\,i = Z_0\,I + Z_{load}\,I,$$

where $$Z_{load} \approx [0.92(\log_{10} b/a)10^{-8}I +$$

$$Hd/10^8](d/10m)\left(\frac{4.6I\log_{10} b/a}{10d} + H\right)t.$$

Modification of equations proposed by Byers and others at the 14th International Electric Propulsion Conference Oct. 30 through Nov. 1, 1979 and more recent procedings by the inventor of said device which further elucidates the aspects of acceleration propagation and thrust summerized herein below:

$$\oint_{0\leftarrow x}^{0\rightarrow x} \frac{\Sigma_n e^{Zo}}{dt}\;\frac{\Sigma_n P\phi}{dt}\;\frac{\Sigma\oint Zo/I}{dt} = M_f - \left(\frac{\Delta dxdydzMd}{dt}\right)$$

$$(e^{VM/Ispg} - 1)(Ispg)\,1.16 \times 10^{-5}$$

wherein o→x is some fixed discrete interval maximum, $\Sigma ne^{Zo}$ represents the total effect of all d.c. rail element with a specific charge taken over some discrete time interval dt. The expression $\Sigma nP\phi$ denotes the total summated effect of the propellant P taken in avogadros $\approx 6.02\times10^{23}$ times the product of the specific reactivity of propellant or body of plasmoids. The expression $\Sigma\oint Zo/I$ represents the propulsive output provided by the energization and subsequent discharge of a series of magnetic induction elements exterting field Zo/I. All three of the aforementioned expression determines the effects of thrust on a moving projectile of a known mass. In the expression $$Mf - \left(\frac{\Delta dxdydzMd}{dt}\right),$$

Mf is indicative of the final dry means mass in kilograms of a given projectile which is differenced against the loss in dimensional mass due to atmospheric resistance, ablation and the like in three dimensions taken over a specific discrete time interval. The term VM is the velocity increment of acceleration taken to be in meters per second. The term Isp describes a specific electrical impulse s and g is some gravitational constant 9.8 m/S$^2$.

The propellant mass is evaluated by the expression $MP=M_f(e^{VM/Ispg}-1)$ in keeping with Byers original equation and the trust per unit area of an acceleration grid are described by the values T/A, PT/A $$\frac{T}{A} = (v)(5.2 \times 10^{-9})\frac{VB^{2.75}}{R^{2.25}}$$

and in ohms per meter, PLOSS describes the transmission line dissipated power in KW, VL is equated with the transmission line voltage, V and L is the length of the transmission line in meters associated with FV the so called transmission line factor. ΩL denotes the resistivity of the said transmission line described in ohm/m, and PL, $\alpha ps+\alpha HR$ are all equivalent to the values previously mentioned in the foregoing expressions.

If electromagnetic flux is spread or smeared radially along the interior surface S as in the case of magnetic induction elements to minor contribution to dynamic flux or propulsion can be considered as a scaler flow vector with function F through a close surface S which is equal to the integral of $\overline{V}\cdot F$ over the value V bounded by S in a typical manner such that;

$$\oint_S^{\Delta dt} F\cdot dS = \int_V^{\Delta dt} \overline{V}\cdot F\,dV$$

or closed surface integral=a closed volume integral in terms of the cartesian equivalent $$\oint_S F\cdot dS = \iint_{\Sigma yz} Fxdydz + \iint_{\Sigma zx} Fydzdx +$$

$$\iint_{\Sigma xy} Fzdxdy =$$

$$\iiint_{\Sigma xyz}\left(\frac{\partial Fx}{\partial x} + \frac{\partial Fy}{\partial y} + \frac{\partial Fz}{\partial z}\right)dxdydz$$

reducing the closed volume integral to a closed surface integral or equivalent terms where applicable.

$$\frac{PT}{A} = \frac{3.6 \times 10^{-8}}{\sqrt{M}}\left(\frac{VB}{R}\right)^{2.25} VB + EV + \frac{PF}{A}$$

A is indicative of the active ion acceleration area of a designated thruster, M$^2$, T denotes the effective output of a single thruster, N. Where $N=N^1+EX$ and Y described a beam divergence loss contribution to Y taken from values of data obtained from propellants, such as, cesium or mercury vapor, xenon, krypton, argon, nitrogen or other substances.

The mass and dissipated power in various transmission lines are given by Byers $$ML = \frac{10^2\ FVPL}{VL}\ [\Omega PL(\alpha PS + \alpha HR)]^{\frac{1}{2}}$$

and $$PLOSS = \frac{LFV}{VL}\ \sqrt{\frac{\Omega LPL}{\alpha PS + \alpha HR}}$$

ML is equivalent to the transmission line mass in kilograms FL, PL and VL are indicative of the transmission line factor, power dissipation in KW the transmission line voltage. $\alpha$PS denotes the specific mass of a given power source expressed as $Kg-w^{-1}$ whereas $\alpha$HR is equivalent to the specific mass of transmission line thermal control for a given system also expressed in terms of $Kg-w^{-1}$. The term PL describes the density of a given transmission line in terms of $Kg-M^{-3}$, whereas $\Omega$ is the resistivity expressed.

Figure 34:
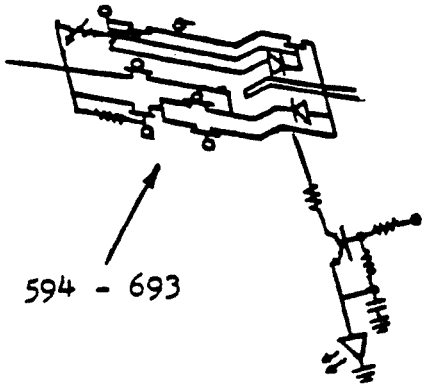
FIG. 34 is a greatly simplified schematic representation of a single modified optical electronic integrated circuit constructed on a single substrate.

FIG. 34 is a detailed schematic representation of only one of numerous optoelectronic integrated circuits (OEIC) on a three dimensional single substrate deployed within the electronic embodiment of the M.A.D. device. The modified circuit of a prototype worked on by subsidiaries of IBM and Hitachi. Numerals 594 through 693 represent the 100 equivalent structures embodied within the mainframe and ancillary structure of the device. The high speed gighertz operation, low noise ratio coefficient and stability to extremes in temperature and pressure, provide the added necessary field operations to complete acquisition of target and firing sequences of the three stage propulsion means mentioned previously in the foregoing text.

Figure 35:
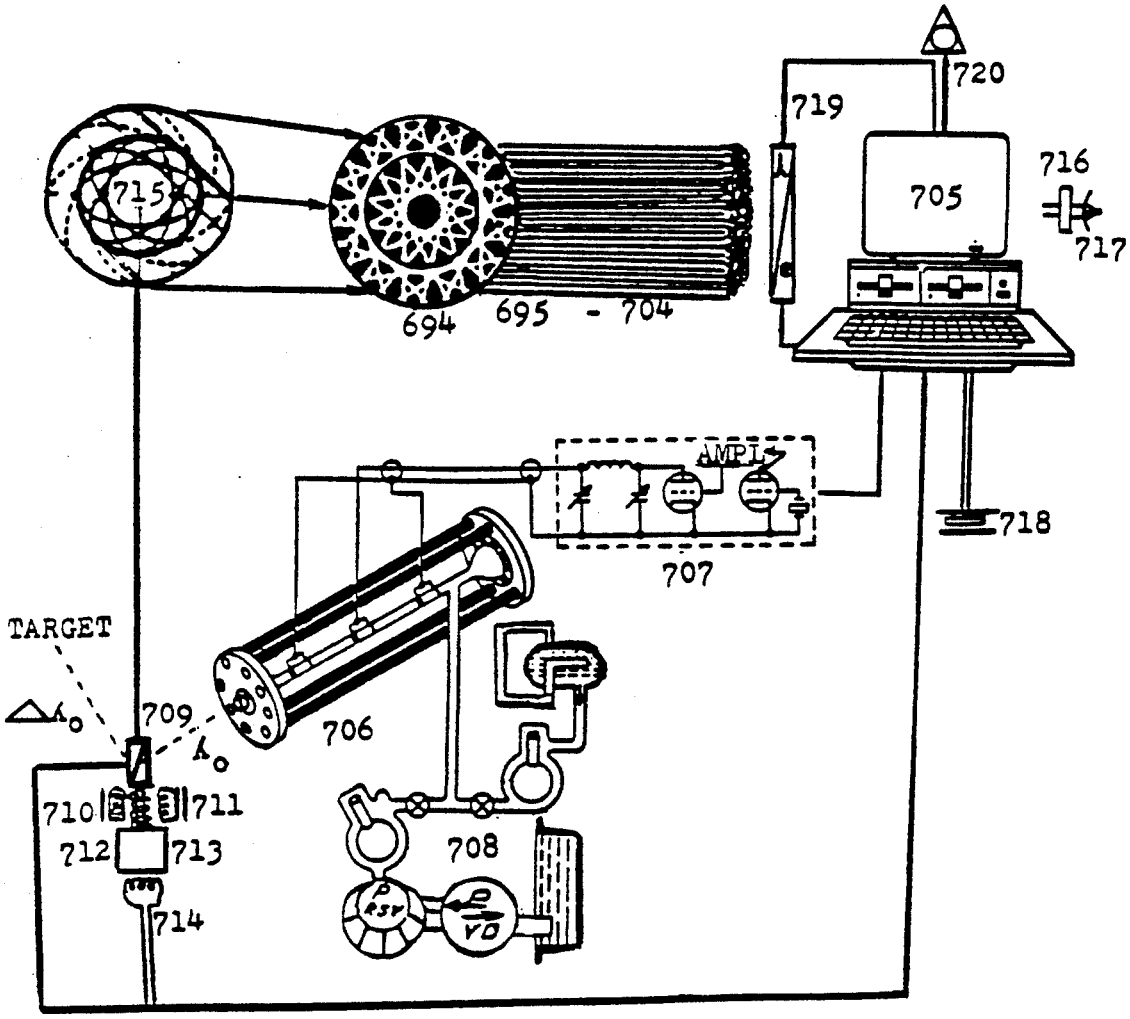
FIG. 35 is an illustrative perspective view of the laser target acquisition bidirectional fiber optic array.

FIG. 35 is a concise pictorial representation of the cylindrical muzzle embodied with fiber optical phallic target acquisition means and ancillary targeting system. There are several thousand bidirectional self focusing fiber optics designated by elements 694 situated circumferentially around the periphery of the muzzle of the main launch device. The spatial configuration of the array described collectively by elements 695 through 704 which are mutually disposed to form a series of partially overlapping optical or visual fields which can be electronically digitized prior to being sent to and processed by the main microcomputer complex represented herein by numeral 705. Direct laser target acquisition occurs by the sequential beaming of a conventional ion laser described by numeral 706, radio-frequency excitation circuit numeral 707 an gasifier pump complex described by element 708 which may emit visable wavelength region such as an argon laser or generate wavelengths in the invisible infra-red region of the spectra as that produced by a variety of $CO_2$ laser sources. An automated beam splitting means number 709 is provided with bidirectional or duel transmission foci areas which is retracted and or errected by an assembly solenoid elements 710 through 714 into and out of the central axis numeral 715 of the main launch cavity. The term phallic optical sighting system is utilized to described the insertion and subsequent retraction of the beam splitting element 709 along the central axis numeral 715 prior to and after firing of projectiles. The optical data received from said beam splitting means is compared and correlated with the data received from the peripheral fiber optics system. Elements 716, 717 described an ancillary radar tracking and receiving means for tracking the in flight progress of projectiles; whereas elements 718 through 720 are assigned to other tracking means such as sonar or telemetry.

Figure 36:
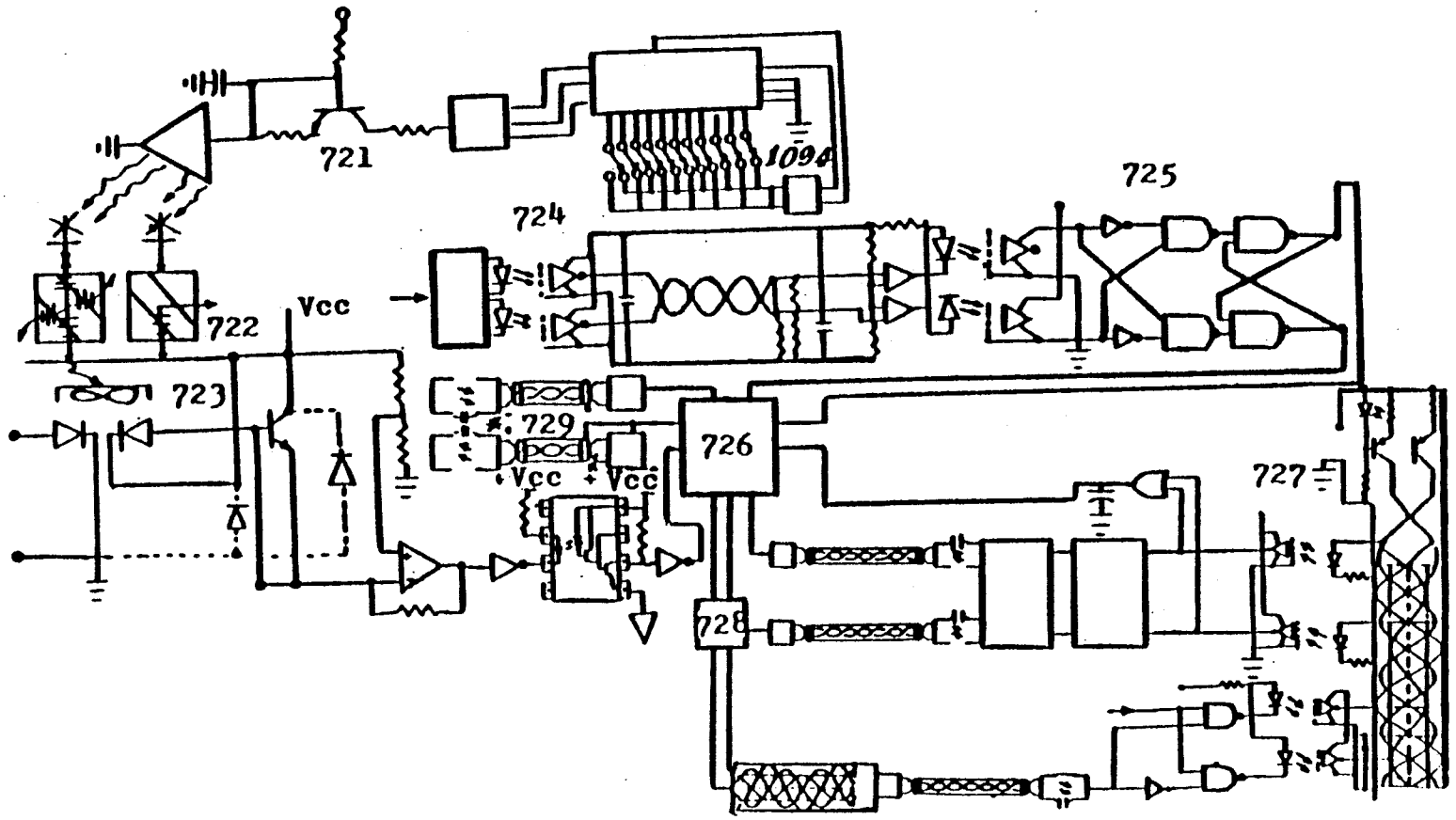
FIG. 36 is indicative of a concise simplified block and circuit diagram of a laser actuated tracking means.

FIG. 36 is indicative of a concise simplified block and circuit diagram of the system specifically keyed to track the exact wavelength and frequency oscillation of a coded laser diode means. Here the optical electronic means governs the intercept of a designated emission by given fiber optics elements associated with projectiles pursuit or otherwise. Numerical values will be assigned to various simplified subsystems rather than their commercially available component parts for the sake of simplicity. Numerical 721 of FIG. 28 describes a typical laser diode, whereas elements 722, 723 designates a PGL Q-switch and reflective tracking means. The split phase driver unit is depicted by numeral 724 and the line signal electro-optical flip-flop means is denoted by element number 725. A high speed commercially available electro optical microcomputer designated by numeral 726 acts as a high speed comparator and tracker which is being keyed to home in not only on the specified laser wavelength and frequency but on a specific coded oscillation rate in order to negate the possibility of reacting to spurious signals. The optical electronic transmission lines provide signals to be recessed and send to explicit feed back systems, which are not shown. Numeral 728 denotes a simple servo-mechanism such as the articulating arm bearing the conduit system which receives and sends laser impulses to the command unit element 727. Numeral 729 designates a typical laser gyro system equivalent to that contained within the column of the piezoelectric means, and both elements 726 and 729, respectively.

Figure 37:
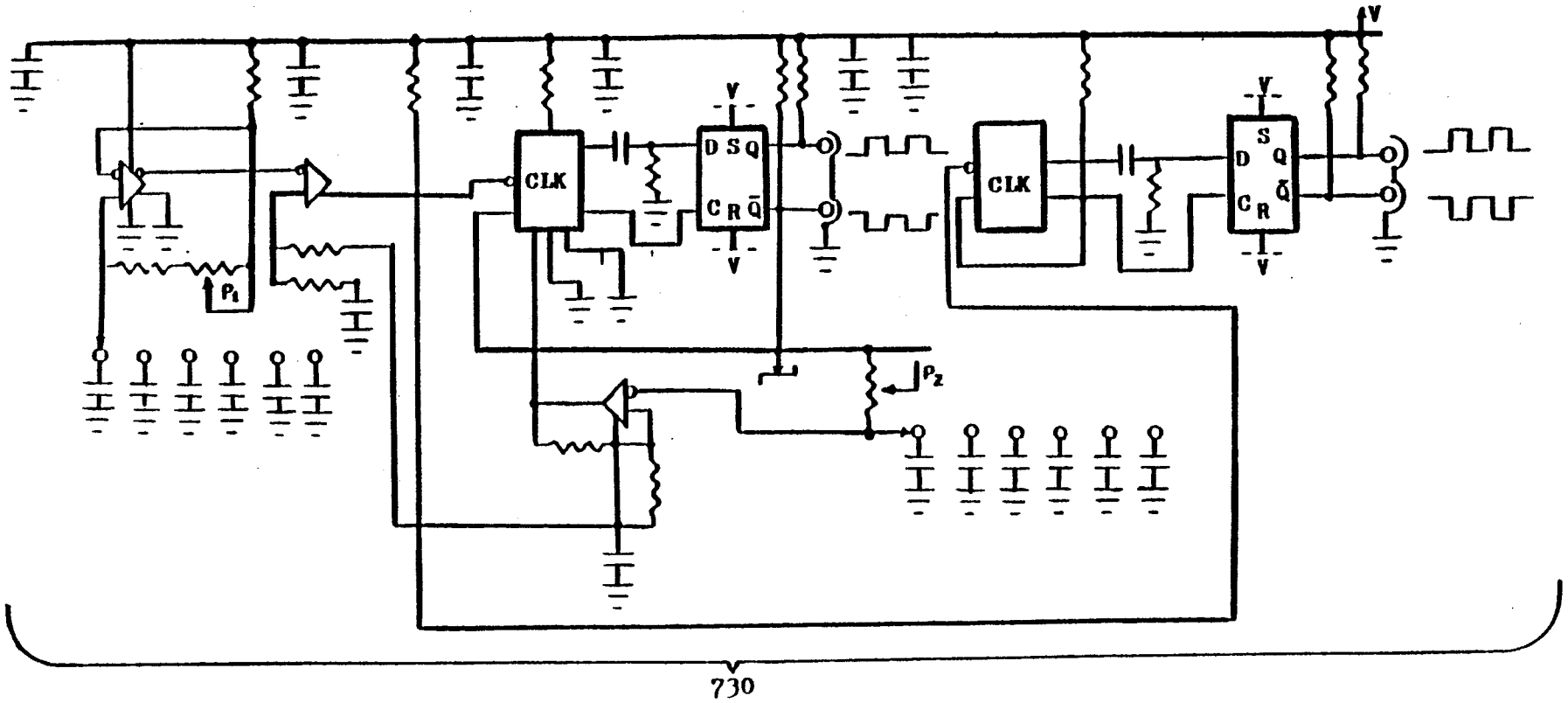
FIG. 37 is a simplified electronic schematic of an ancillary timing sequencer.

FIG. 37 represents in part a simplified and modified circuit diagram of one of the ancillary timing sequencers. Here a commercially available sequencer is modified with additional electrooptical oscillators and monostable multivibrator means. The circuit disclosed within FIG. 37 herein is composed exclusively of commercially available electronic components. The sequencer disclosed herein above is designated entirely by a single numeral number 730 for simplicity sake, and it has varying pulse widths which ranges from 10 milliseconds to less than several nanoseconds.

Figure 38:
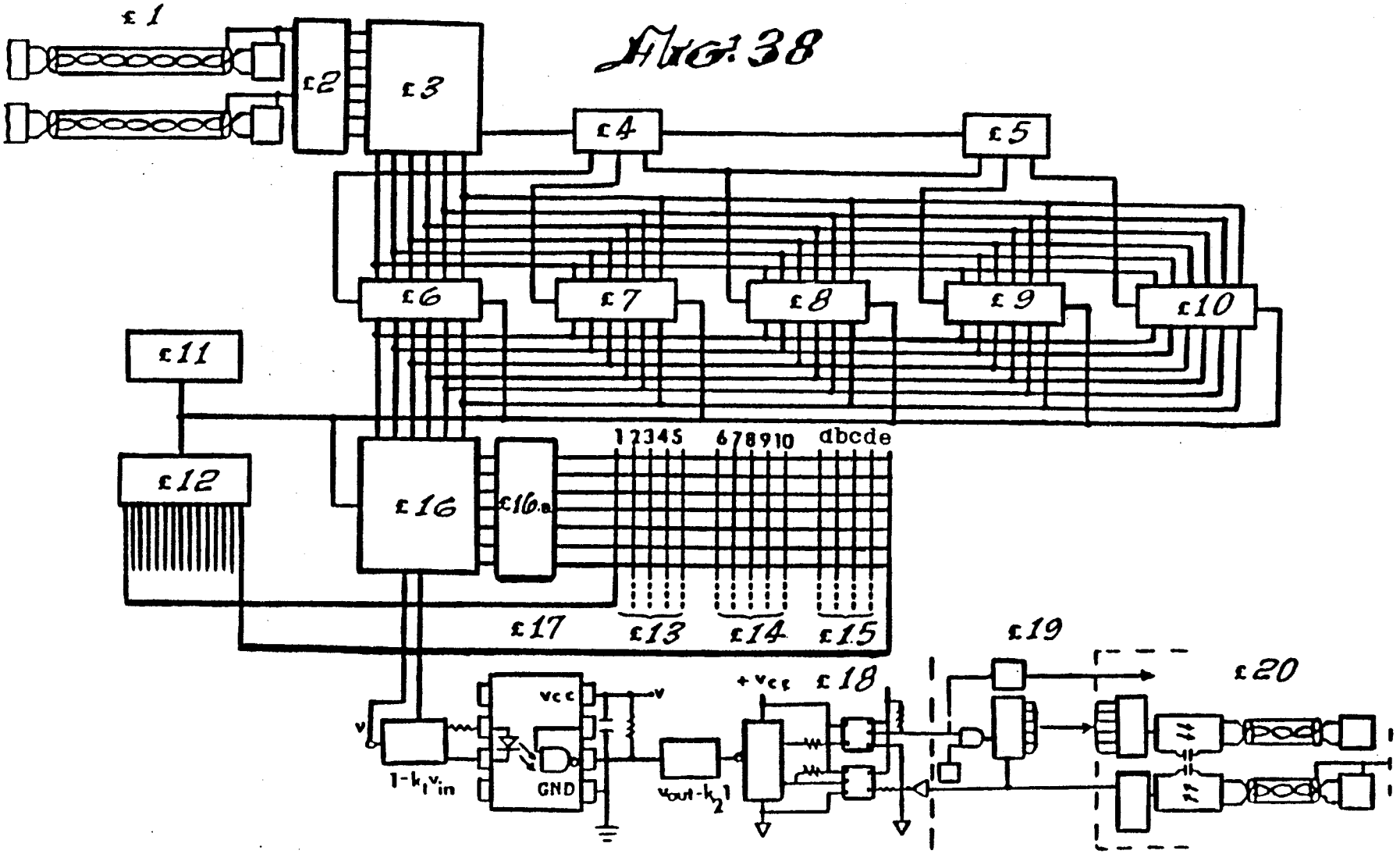
FIG. 38 is a greatly simplified combination block diagram and schematical representation of optical electronic analog/digital converter feedback unit employed by the M.A.D. unit.

FIG. 38 exemplifies a simplified combination block diagram and schematical representation of only one of several optical electronic analog/digital converter feedback units employed for sensory updates, servo-scans and the like. Alpha numeric values are assigned to each subsystem in order to more clearly define a few basic component systems. Elements £1, £2 and £3 are indicative of the optical electronic sensory array, optical electronic encoder, and analog/digital interfacing and keying means. Alpha numeric values £4, £5, and £6 through £10 designates array selectors and a full complement of input storage buffers. Element £11, £12 and £13 through £15 denote a clock/timing means, column drivers and display terminals. Elements £16 collectively described a VLSI chip containing data input transfer, a column selector, comparator encoder/decoder signal outflow means. Elements £17, £18, £19 and £20 designate a voltage to frequency converter, monopulse multivibrator drive means and a line driver/line receiver bidirectional means.

Figure 39:
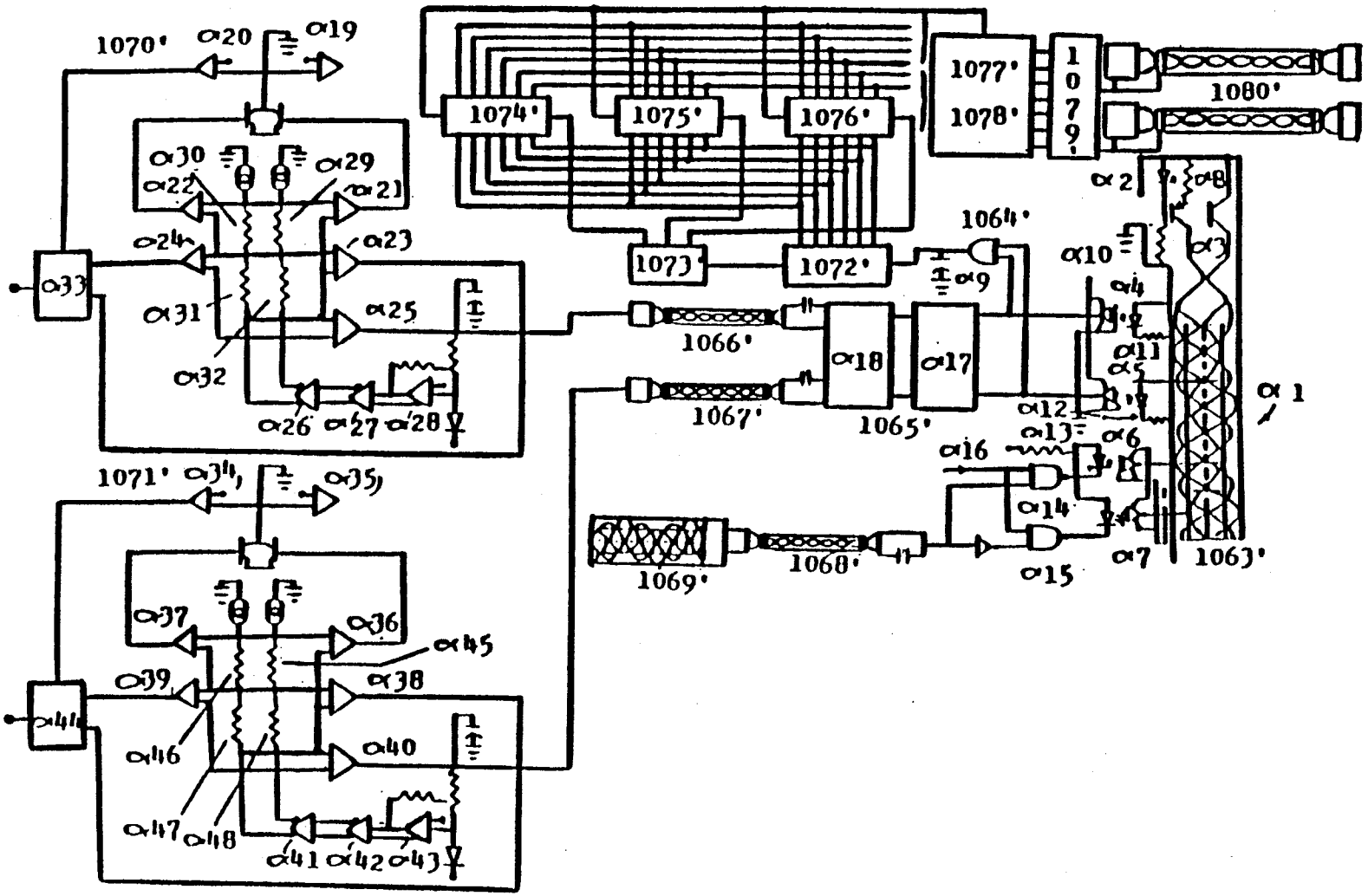

FIG. 39 is a combination block diagram and a simplified schematic representation of only one of several equivalent optical electronic multiplexing stations associated with the preferred embodiment. Each electronic subsystems will be assigned a numerical equivalent and all pertinent component parts will be designated an alphanumeric value. Each and every component structure or equivalent structure is readily available commercially from such sources as Hewlett Packard, Texas Instruments or other suitable manufactures. A generalized version of a multiplex station is illustrated by 1063', 1064' denotes a logic gate. α1 is descriptive of a typical signal line, α2 defines the transmission line supply. Alphanumeric symbols α4, α5, α6 and α7, α3 collectively denote open collector outputs. α8 through α13 describes various resistive elements. The data is inputed via line α14 and α15 denotes an enable segment. The line status is denoted by α16. Numeral 1065' consists of two mutually exclusive or Flip-Flop subsystems, as denoted by α17 and α18. Incorporated α17 is an independent wave interrupt sequence, whereas α18 consists of an exclusive or Flip-Flop system with a Kalman filter. Numerals 1066' and 1067' consist of specially encoded optical electronic data output channels. Numerals 1069' and 1068' are indicative of a data influx channel with element 1068' being a data compression undergoing compression prior to systems entry. Numerals 1070' and 1071' describe two separate but equivalent block diagrams of a four chip hybrid receiver means, each of which act as separate wave discriminaters. Each digitized signal is analyzed on the basis of electronic wave characteristics α19 denotes the link monitor output VREF whereas α20 describes the ALC Amp and VREF, α21 is indicative of negative peak comparator, whereas α22 is indicative of a positive peak comparator. The logic low and logic high comparators are denoted by α23 and α24. The differental amplifier stage and the gain control stage are described by α25 and α26. The bias voltage preamp described by α27 and α28 explains the D.C. restorer amp. Elements α29 through α32 depict resistors. The element α33 is representative of an R-S Flip-Flop data output means. Numeral 1071', as previously noted is equivalent to numeral 1070' and therefore elements α19 through α33 are equivalent to elements α34 through α48. The present status of each signal enters element 1072', a mainline sequencer which sends its input data to a clock means, which is denoted by numeral 1073'. The data processed by numerals 1072' and 1073' are collectively sent to numeral 1074' through numeral 1076', which consists of three equivalent short term storage multivibrator means. Numeral 1078' consists of a Kalman filter encoder means. Numeral 1079' depicts a biphasic line. The digitized electronic signals are converted into their optical electronic binary equivalents, and is then sent to the main computer complex for further analysis, as noted by numeral 1080'.

Figure 40:
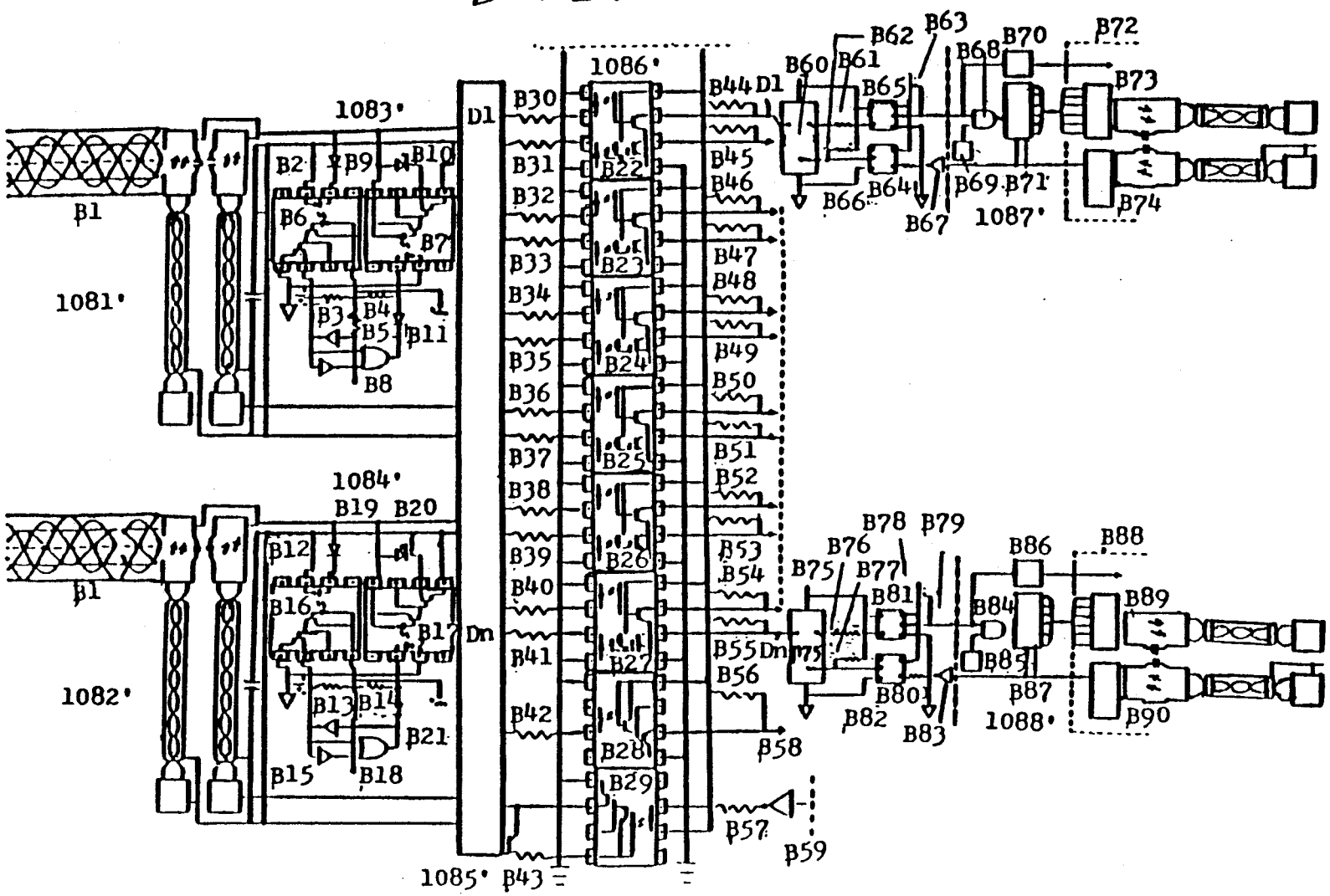
FIG. 40 depicts a partial schematical representation and block diagram of another exemplary form of optical electronic analog/digital converter unit contained within the embodiment of the M.A.D. structure.

FIG. 40 depicts a combination block diagram and a partial schematic of an exemplary form of a single optical electronic analog/digital converter unit. FIG. 40 like that of FIG. 39 is composed entirely of commercially available components, each of which is assigned an alphanumeric value. Subsystems 1081' and 1082' are equivalent optical line driver and receiver means that receive a given transmission wavelength and or its reference beams. Numerals 1083' and 1084' are equivalent and indicative of common optoisolators. The resistor elements of 1083' are denoted by β 1 through β 5. The accompaning optical electronic IC means is described by β 6 and β 7 respectively. The effective ground and logic element is described by β 8. β 9, β 10 and β 11 describe other diode means, which are associated with the subsystem. Numeral 1083' is equivalent to numeral 1084', therefore all components of numeral 1083' are equivalent to those of 1082', such that components β 1 through β 10 are equivalent to components β 11 through β 21. Numeral 1085' represents an analog/digital converter means IC β 22 through β 29 of numeral 1086', which describes the isolated analog/digital in terms of parallel data outputs. Components β 30 through β 57 denote resistor elements of numeral 1086' for the respective data outputs denoted by Di through Dn. β 58 denotes the start converter process, whereas β 59 describes the termination of the converter process. Each data output is received by a digital/analog isolator system, two of which are denoted by numbers 1087' and 1088'. Numeral 1087' and 1088' are equivalent to one another, and to all similar such units. A multivibrator means of numeral 1087' is denoted by β 60. The resistive elements of subsystem 1087' are described by the alphanumeric values β 61 through β 64. There are two equivalent IC's denoted by β 65 and β 66. β 67 is indicative of a logic inverter, β 68 depicts a oscillator and β 69 denotes a logic AND gate. The one shot means is denoted by β 70 and the clock counter means is described by β 71. The microprocessor system is described herein by β 72 with an input port denoted by β 73 and an output port indicated by β 74 component elements β 75 through β 90 of numeral 1088' are equivalent to those elements β 60 through β 74 of numeral 1087'.

Figure 41:
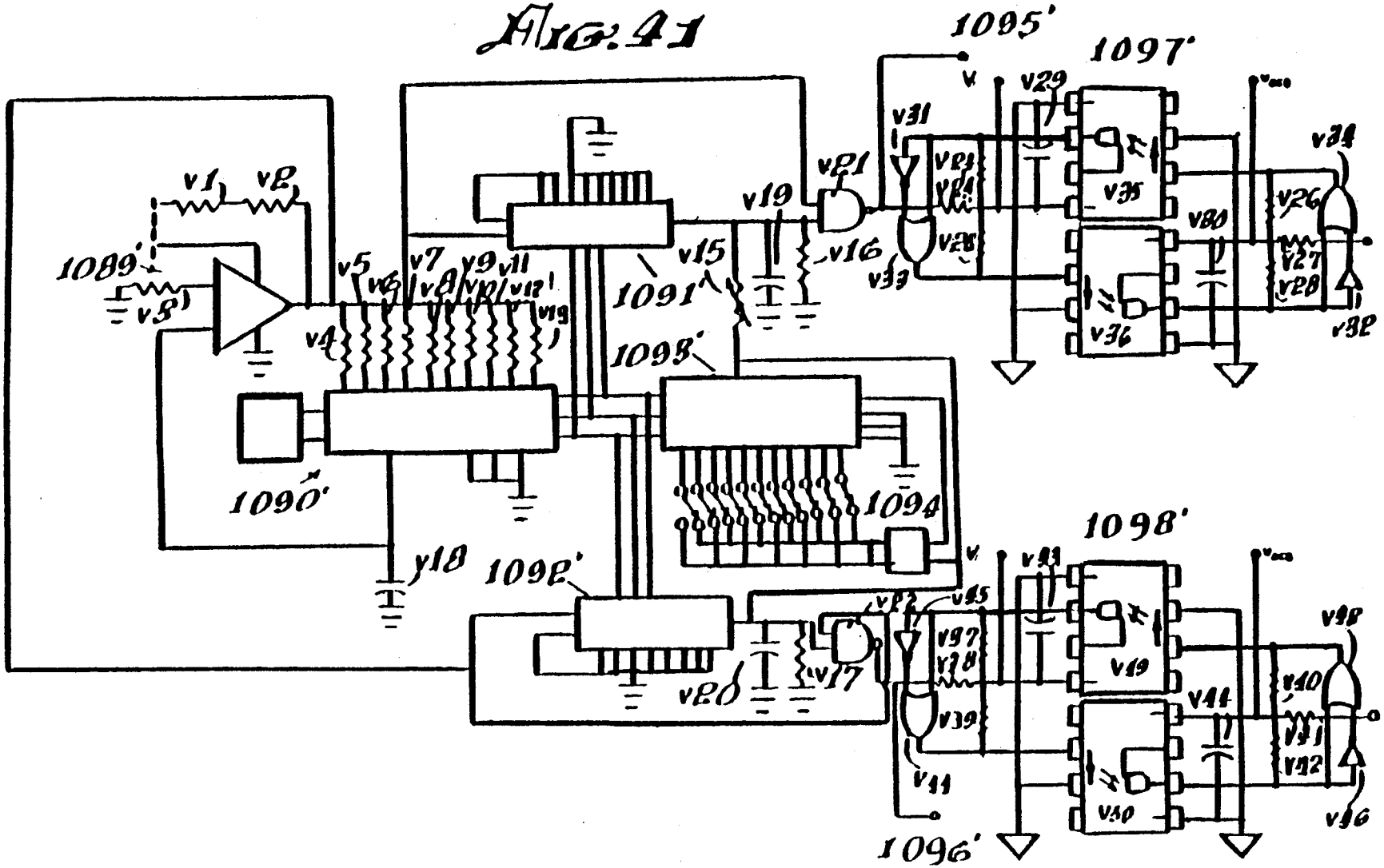
FIG. 41 is a generalized schematic of a simple multiple tone generator means.

FIG. 41 is a generalized schematic representation of a multiple tone generator typical of one of several deployed by the M.A.D. device. All component parts depicted in FIG. 41 are commercially available. Numeral designations of the tone generating system proper are as follows: a basic voltage regulator or governor is indicated by numeral 1089'. An analog multiplexer is described by numeral 1090' and two binary counters are indicated by numeral 1091' and 1092' respectively. The tone frequency generating IC is indicated by numeral 1093', which is adjacent to the key or switching elements, denoted by number 1094'. The resistor elements are denoted by alpha-numeric values ν 1 through ν 14 and the capacitors ν 15 and ν 16, ν 17. The typical NAND (inverting AND) gate is denoted by ν 18 and ν 19. The frequency generated tone sequence can enter any one of four or all of the following systems denoted by numerals 1095' through 1098, which terminate in either a speaker system or equivalent piezoelectric means for audio sound to be perceived by the user. Normal tonal sequences are conducted through lines 1095' and 1096'; whereas alternate tone sequence or tonal sounds are provided by high speed duplex systems, if specified by either the user or the main computer, via the keying means. Subsystems 1097' and 1098' are equivalent units. Numeral 1097' resistive elements are described by ν 20 through ν 25, whereas ν 26 and ν 27 denote the capacitance means. The invert means are defined by ν 28 and ν 29, whereas the logic or gate is designated by ν 30 and ν 31, respectively. The controlling IC's of 1097' are prescribed by ν 32 and ν 33. As mentioned earlier 1097' and 1098' are equivalent subsystems, therefore component ν 20 through ν 33 are equivalent to components ν 34 through ν 47.

Figure 42:
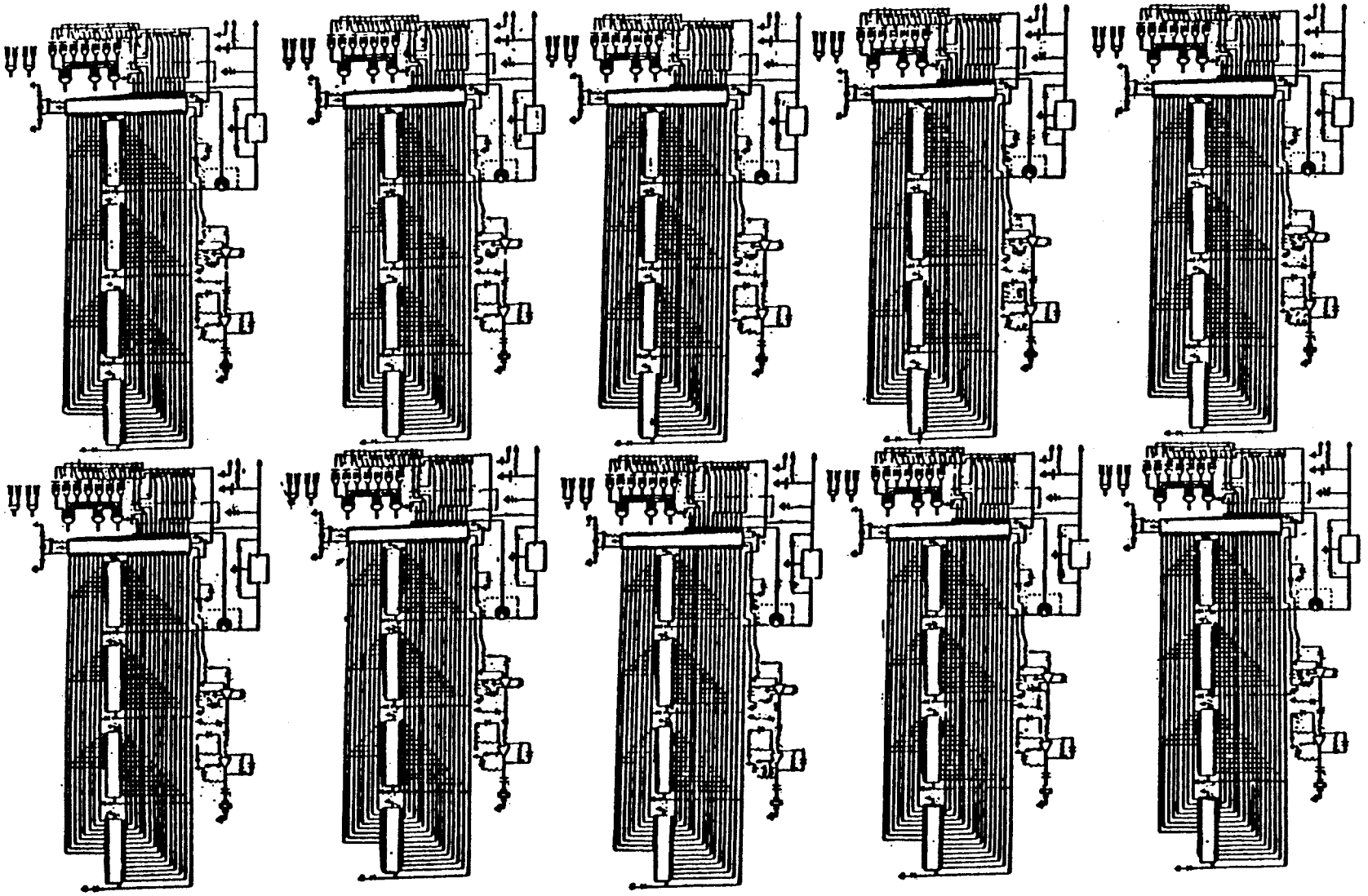
FIG. 42 is representative of a basic circuit diagram disclosing the structural disposition of electronic speech synthesizer means etched onto a single card.

FIG. 42 is a concise circuit diagram describing the structural design of a modified speech synthesizer unit typical of the type embodied within the mass driver device. Numeric values are not assigned to components of repetitive circuit elements, which are described in detail in FIG. 45. The above mentioned circuit diagram represents a single insertable card element. There are optimally ten equivalent cards containing speech synthesizer elements associated with an equivalent number of speech recognition elements, which are interfaced with an internally based CPU embodied within the mass action device. An extended vocabulary of over ten thousand words more than 200 phrases in various languages, dialects and/or genders can be synthesized by each of the aforesaid cards. The number of phrases, the type of dialects and the different genders employed are contingent on number and type of digitized signals encoded into each microprocessor embodied within the aforesaid speech synthesizer card. Digitized signals encoded from the voices of human donars are the simplest, most direct and the least expensive technique presently available to obtain different dialects, languages, genders.

Figure 43:
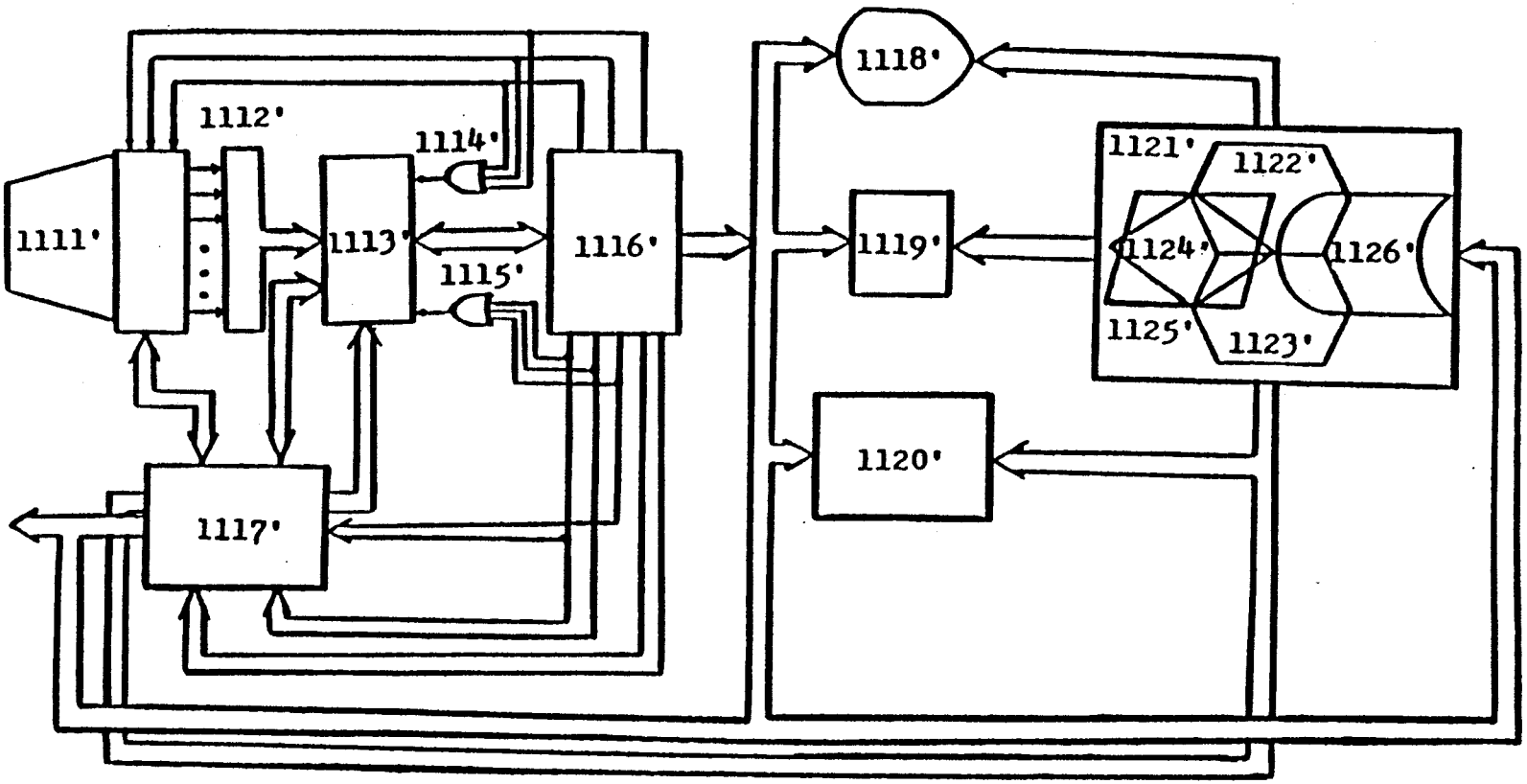
FIG. 43 denotes a simplified block diagram explicity showing the effective position of both the tone generator and speech synthesizer relative to a mediator computer means.

FIG. 43 denotes a simplified block diagram which explicitly shows the effective position of both the tone generator and speech synthesizer relative to an interactive computer complex. Numeral 1111' denotes a key matrix, numeral 1112' describes an encoder means and number 1113' indicates a multiplexer unit. Numbers 1114' and 1115' are illustrative of logic gates, whereas numeral 1116' describes a common signal condensing microprocessor means. Numeral 1117' defines a commercially available ROM, RAM and EEPROM means, such as a modified SDK86 and or its equivalent as described earlier in this disclosure. Numerals 1118', 1119' and 1120' describe a interactive graphics display terminal, a tone generator and a speech synthesizer as previously indicated in the body of this disclosure. Numeral 1121' through 1126' depicts the entire ancillary portion of the computer complex as denoted by numeral 1121', which has operative subunits described therein by numerals 1122' to 1126'; which provide for a totally interactive expandable system, with a voice recognition and voice actuated computerized command program. The operative subunits overlap each other partially. Numerals 1122' and 1123' depict preparatory functions where the data is processed. The data enters and exits the computer complex as illustrated by number 1124'; whereas numeral 1125' is indicative of a decision process. The online storage means of the computer complex is described by numeral 1126'.

Figure 44:
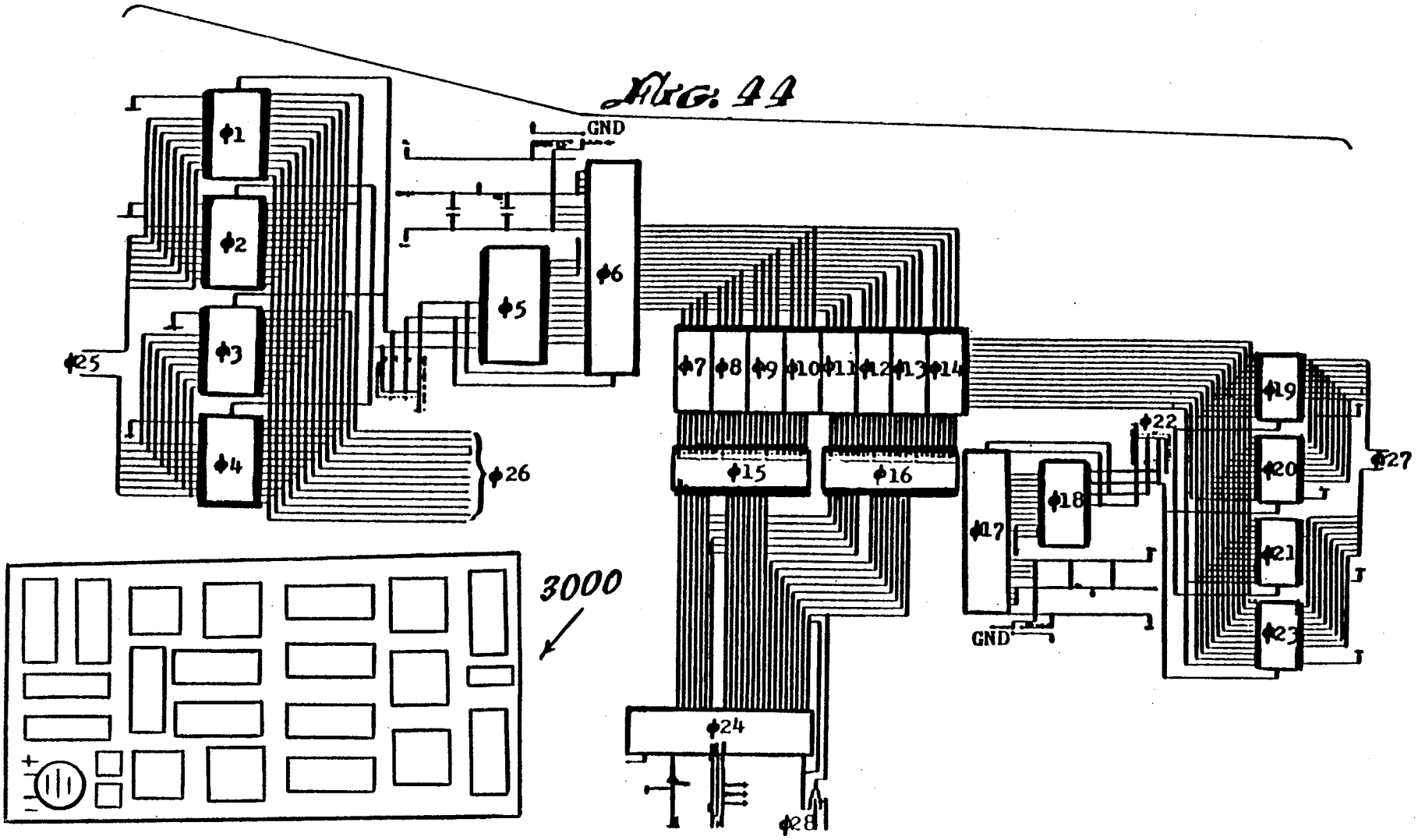
FIG. 44 is a greatly generalized schematic portion of a VLSI logic circuit for the embodiment of target acquisition, thrust parameters and the I/O like processes.

FIG. 44 is indicative of a concise simplified schematic representation of a small portion of the logic circuit forming the basic embodiment of a single microcomputer means. The vital portion of the circuit employed as denoted in FIG. 44 is equivalent of a multitude of similar such circuitry utilizing VLSI/VISHIC technology. The separate I.C. elements are so constructed as to be repetitive, providing a reliable microcomputer with an increased ability to calculate and implement target acquisition, thrust parameters, pursuit vectors and the like. The I.C.'s are disposed on a single portion of the VLSI card which is replaceable in itself as well as each integrated circuit(I.C.)means. Each integrated circuit is designated by its own alphanumeric value and there are twenty four I.C.'s depicted in the figure herein. The I.C.'s are listed by elements $\phi$1 through $\phi$24 with elements $\phi$15 and $\phi$16 acting as interrogators for logic elements $\phi$7 through $\phi$14. Comparator means for data are indicated in part by elements $\phi$1 through $\phi$4 and elements $\phi$19 through $\phi$23. Alphanumeric values $\phi$25, $\phi\approx$, $\phi$¢and $\phi$28 are indicative of origins of embarkation wherein data either enters from other circuits or leaves from the portion of the circuit depicted in FIG. 44 bound for other circuits. The other portions of the partial circuit diagram depicting circuits. Numeral 3000 of FIG. 44 collectively designates a single card element of the aforesaid microcomputer means.

Figure 45:
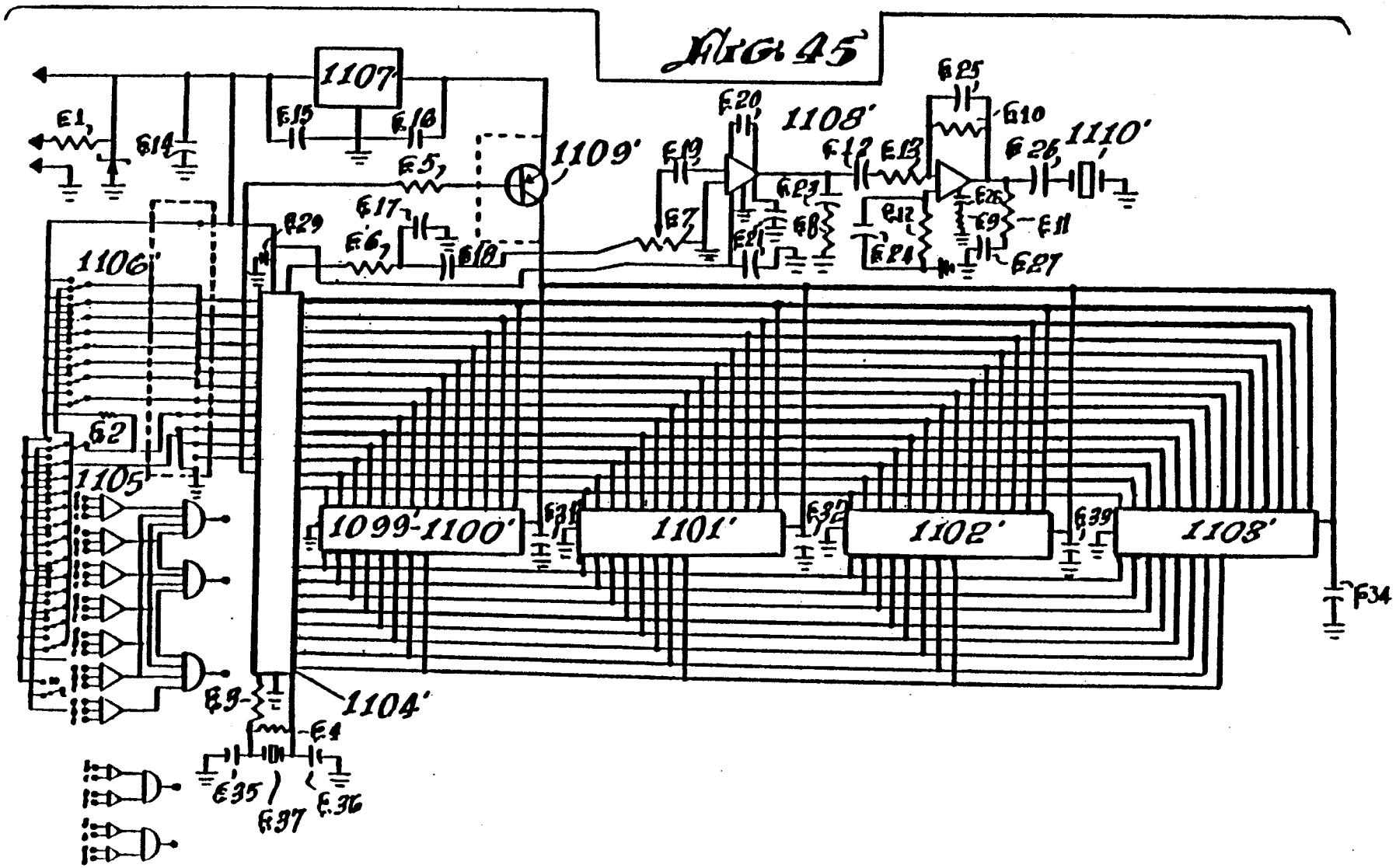
FIG. 45, 45*a*, 45*b* and 45*c* describe concisely the filter topologies embodied within the speech processing elements and block diagram of the operative systems embodied within said speech processing element.

FIG. 45 is representative of a basic schematic of a modified electronic speech synthesizer, which is embodied within the aforesaid device. The extended vocabulary is in excess of 1,000 words, and more than 20 phrases, which is announciated in either a male voice, a female voice of both voices. As with preceding figures all components are commercially available by such manufactes as Intel, IBM, National Semiconductor and others. Numerals 1099' through 1103' depicts equivalent speech ROM IC's which contain relevant speech data, where as the IC denoted by numeral 1104' represents the actual speech processor. An encoder signal digitizer and auto-keying complex is described by numeral 1105' and the manual keying sequencer is indicated by numeral 1106'. The systems resistor elements are denoted by alphanumeric values $\epsilon$1 through $\epsilon$13 and the various capacitor components are noted by $\epsilon$14 through $\epsilon$35. Numerals 1106', 1107' and 1108' describes a typical voltage transistor element. $\epsilon$36 denotes a crystal oscillator, whereas numeral 1110' describes a piezoelectric wafer which is utilized as a speaker unit. Analog to digital conversion of analog signals are necessarily performed during speech recognition and synthesis of speech by the aforesaid unit. Signals converted into digital impulses must be prefiltered to remove frequency components above what is defined by those skilled in the art, as the half sampling frequency; inoder to eliminate ambient white noise generated from the environment, which can distort information to be processed or otherwise acted upon by the CPU. The most fundamental talking integrated circuits are digital to analog converters, which upon receiving an appropriate sequence of commands from the CPU playback digitized and speech stored in the memory of one or more microprocessors. It is perferred, but not critical to the function of the aforesaid unit that microprocessors with sorted verbal commands, instructions and tones be embodied within the aforesaid device. Microprocessors equipped with stored verbal commands or instructions are preferred because presently they sound more natural, have a higher reliability or lower incidence of fault and are more versatile then conventional synthetic language systems. The preferred microprocessor elements embody digitized signal equivalent of analog speech or voice patterns derived from encoded signals obtained from one or more human hosts. Since several hosts can be encoded on a single microprocessor element several different voices, genders, languages or dialects can be embodied within a single microprocessor unit, as previously indicated in the specifications.

Figure 45A:
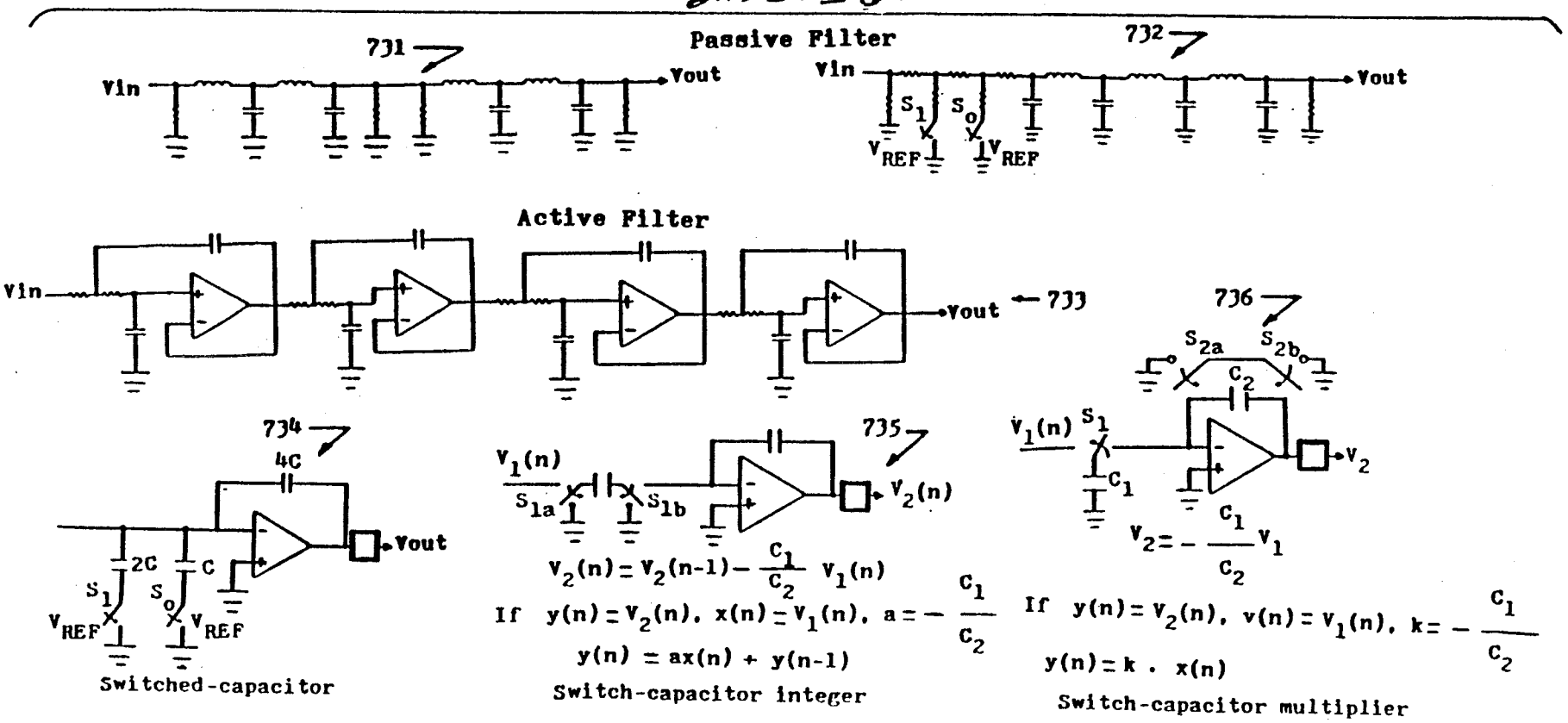

FIG. 45*a* discloses briefly in part various filter topologies equivalent to the type of units embodied within the speech processing elements of the aforesaid device. Six separate and distinct filter types are disclosed in FIG. 37*a* and each said filter type is assigned a single numeric value. Numerals 734 through 736 collectively designate the basic circuit designs from which the active, passive and switch capacitor types of filter elements; which implemented the speech processing unit of the aforesaid device. Since the design function and implementation of the aforementioned filter types are standard separate numeric values are not assigned to separate component parts of each circuit. The integrated circuit units, capacitors, ground resistive and switching elements are obvious and readily understandable to those skilled in the art. the system operation of the speech processing element of the aforesaid unit. Analog verbal input is introduced, as indicated, by numeral 737 to piezoelectric transduction element 738, which transmits the data to an analog then to digital converter element 739, which samples the incoming data. Information processed by element 739 is conveyed to comparator means 740, which compares incoming signals with stored values and transfers the data to process 741; which performs successive approximations and functions as a logic register element. Data acted upon by element 741 is divergently sent to digital-/analog converter element 742, which reenters comparator means 740 for reprocessing and a number of successive filter elements operating collectively as a filter bank, indicated by number 133. Data filtered from element 743 enters CPU element 743 to be acted upon. The CPU unit collectively defined by number 744 embodies; a parameter extractor, numeral 745, a comparator bank with stored data statistical parameters, numeral 746, an expert system, number 747, a short term storage process, 748, global memory element described by 749, an additional storage access element defined by number 750; and a process wherein decisions regarding speech recognition and synthesis are conducted.

Once decisions regarding recognition of speech input have been implemented by element 751 or CPU 744, then process 752 is actuated. It is within process 752 where the appropriate response to verbal inquires or voice commands elicited by the user or others are implemented by engaging the proper synthesizer format to be accessed by the CPU. Element 757 engages Address Bus 758, which in enable mode enlists ROM element 759, RAM element 760 and is engaged by Addresss Arithmatic unit 761. Elements 759, 760 interface with Data Bus 762, which engages either simultaneously or in succession a number of separate and distinct chip or microprocessor elements containing the necessary vocabulary to synthize the appropriate verbal respond, as indicated by numeral 781. The Data Bus described by number 762 is additionally implemented by elements 763 through 782. Elements 763, 764 and 765 entail a clock means, program counter and EPROM unit, respectively. The ROM address is enlisted, as process 764 enlists process 765. EPROM process, 765, is implemented both from a verbal key processor and manual key pad element, not shown in the figure. Process 765 additionally enlists RAM element 766, Barrel Shifter means 767 and ALU element, as described in numeral 768. Process 768 enlists on Over Flow Detection means 769, which reenlists RAM process 766. Element 768 additionally enlists the operation of accumulator element 770 which engages Scaler process 161, which in turn engages Data Bus means 762. Element 762 engages processes 712 781 which contains an optimium number of chips or integrated circuit elements, 1—n, encoded with a sufficient quantity of digitized signals to compose a large variety of verbal responses, in the form of complete sentences in the event of a medical emergency, to answer inquiries or to reply to commands from the user or others in the immediate vicinity of the user. The proper syntax, grammer and sequencing of complete sentences in the synthesized response are coordinated by element 782, which is designated as a synthetic speech collater unit. Process 782 enlists I/O controller element 783, which engages Data Registor process 784. Element 784 enlists DAC digital/analog converter means 785, which actuates the output MUX process, described by number 786. The analog output is conveyed to a piezoelectric emitter unit described by number 787, which transduces the speech output signals into analog pressure waves to be heard by the user or others in the immediate vicinity of the user.

Figure 45B:
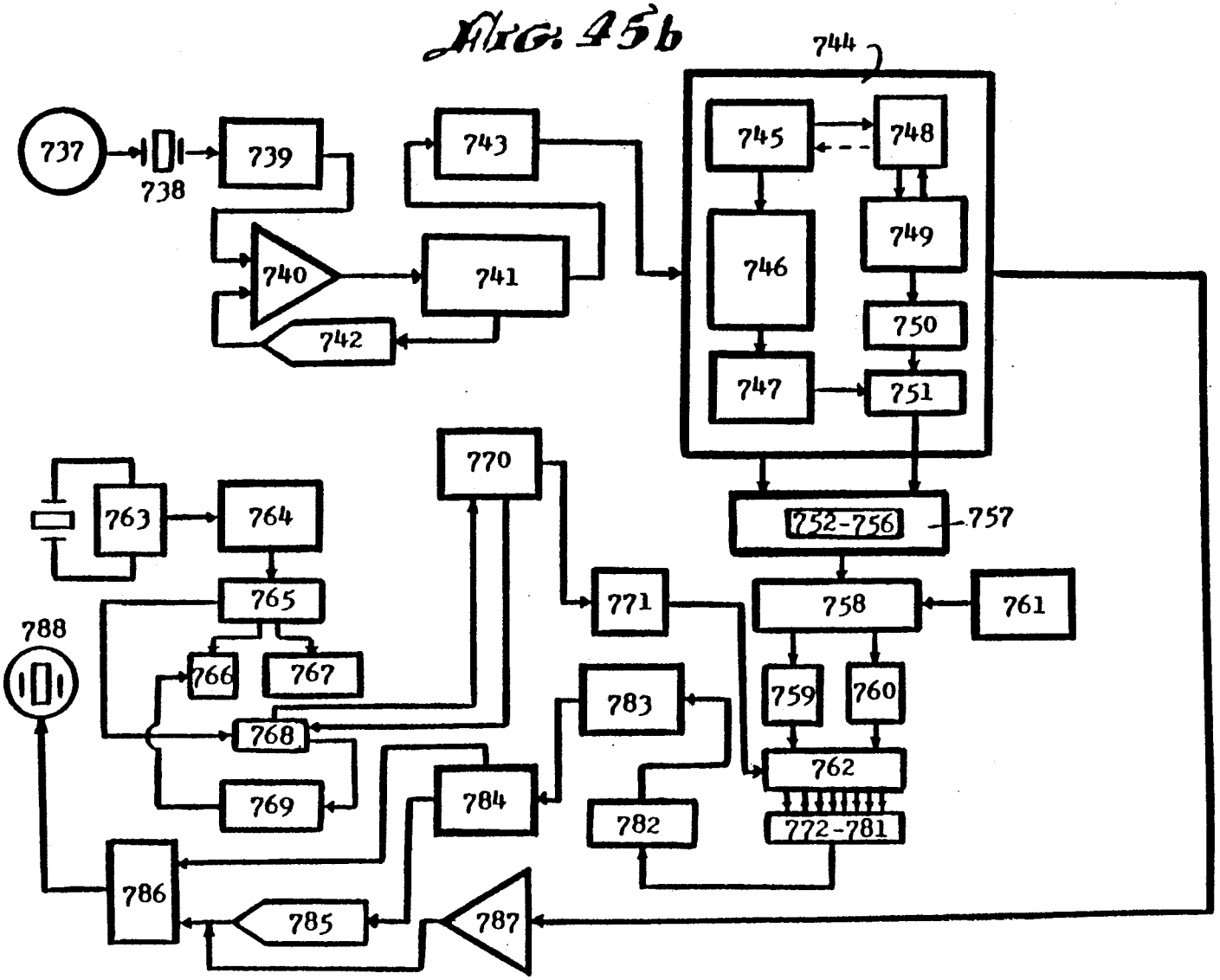
Figure 45C:
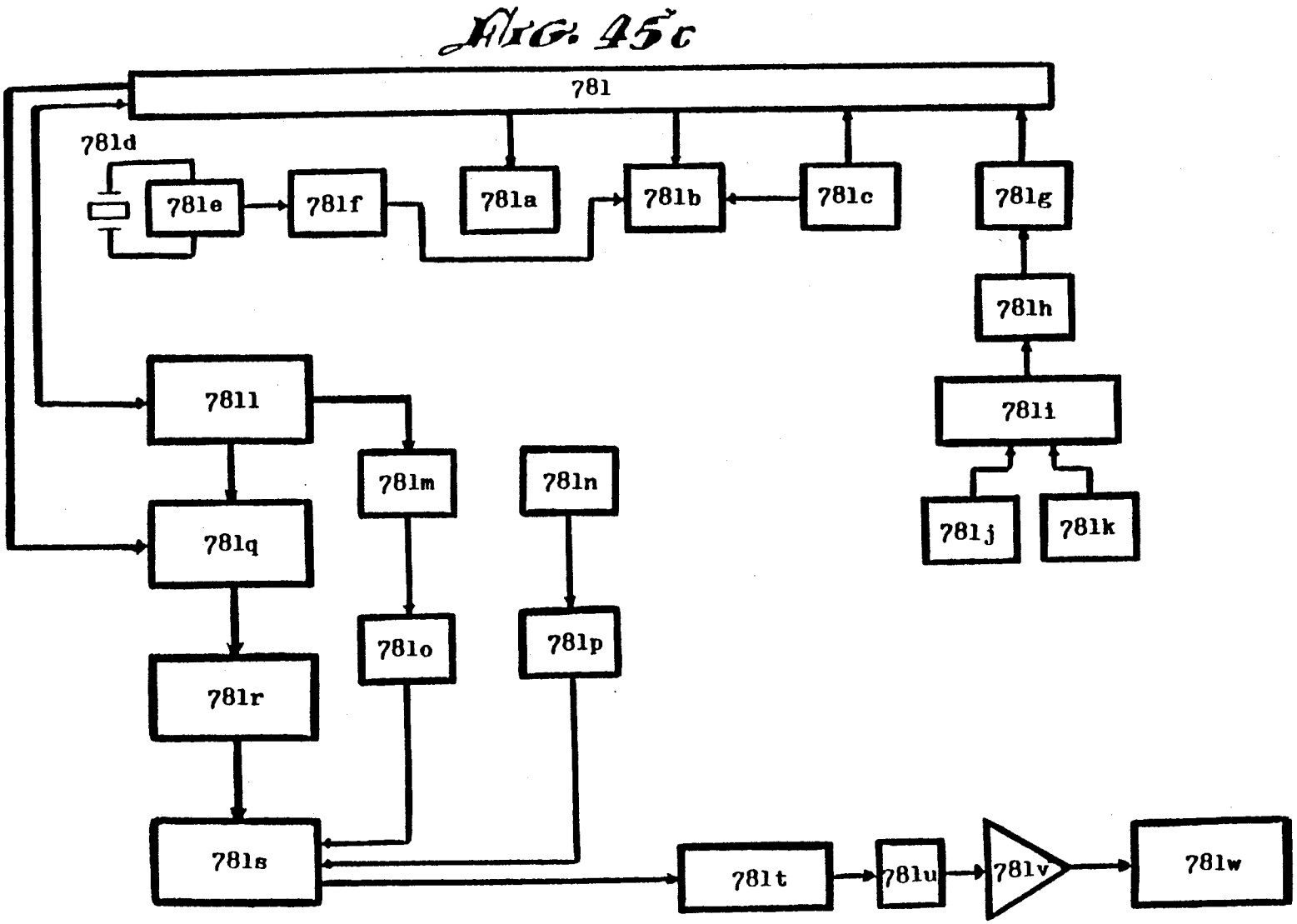

FIG. 45*c* is a block diagram briefly illustrating the operation of a single integrated circuit or microprocessor element described by element 781 of FIG. 45*b*. Numeral 781 of FIG. 45*b* embodies an optimium of number of separate and distinct equivalent chips or integrated circuit elements. Each chip or integrated circuit element operates exactly the same as the other microprocessor element; however each said chip element is encoded with a different complement or text of digitized signals entailing a different set of instructions or information embodied within the chip element. The Data Bus disclosed by numeral 762 enlists word decoder element 781*a*. Speech ROM Control element 781*b* and is assisted by ALU Control and Interpolation element 781*c* of the given chip. Each chip is additionally supplied with a ceramic oscillator, number 781*d*, a clock and Power Down Control element, as described by 781*e* and Auxillary Counter Means designated by 781*f*. Element 781*e* enlists element 781*f*, which acts on the Speech Data ROM Control element 781*b* of the chip. The Data Bus 762 interfaces with the Speech Data ROM, 781*g*, which is addressed by Address Register 781*h*. Alphanumeric values 781*i*, 781*j* and 781*k* describe a Message Latch and Control element, Select Lines and Control Lines, respectively. A Pitch, Gain and Interpolation RAM element described by element 781*l* and Bandcenter and Bandwidth Coefficient RASM means defined by element 781*q* interfaces with Data Bus element 762. Process 781*l* engages Pitch element 781*m*, which enlists Filter Process 781*o*; whereas Noise Generator 781*n* enlists Filter Process 781*p*. Element 781*q* engages process 781*r* which is a coefficient Lookup ROM element containing 256×10 bits. Elements 781*r* enlists process 781*s*, which entails eighteen second-order sections 10×15 bit multipliers. Element 781*m*, 781*n* through filters 781*o*, 781*p* engage process 781*s* at separate addressible interface points. Process 781*s* enlists Pulse Width Moduation D/A element 781*t* and the data signals processed by element 781*t* are conveyed to Smoothing Filter 781*u*. Signals transmitted from element 781*u* are enhanced by Power Amplifier 781*v*. Data from element 781*v* sequentially enters process 782, the Speech Collator unit, along with data taken in turn from other equivalent Power Amplifier elements associated with other chips, as described earlier in FIG. 45*b*.

When processing a signal for analysis, recognition or for some other purpose, the spectrum and/or content of the signal at different frequences must be evaluated in the real world. Since the CPU for purposes in a linear discrete arithmatic logic unit it is reasonable to evaluate a discrete portion of data within a finite period of time and infinite intergrals are evaluated as linear discrete processes, in order to yield first and second order approximations of data within a finite real time interval. The process of windowing allows linear discrete evaluation of a spectrum of data with marginal losses in temporal accumulation of information or evaluation of data. Optimal evaluation of a spectrum of a segment of a signal is briefly described in the equation herein below:

$$X_s(f) = \int_{-\infty}^{\infty} w(t)x(t)\, e^{-jsin2\pi ft}\, dt$$

$$= \int_{-\infty}^{\infty} w(t)x(t)(\cos 2\pi ft - j \sin 2\pi ft)dt$$

$$= \int_{-\infty}^{\infty} w(t)x(t)\cos 2\pi ft\, dt - j \int_{-\infty}^{\infty} w(t)w(t)\sin 2\pi ft\, dt$$

where $X_s(f)$ = spectrum at frequency $f$
$x(t)$ = time function
$w(t)$ = window.

If w(t) is evaluated as zero outside some given interval from $t_1$ to $t_2$ then the expression can additionally be expressed, as $$X_s(f) = \int_{t_1}^{t_2} w(t)x(t)\cos 2\pi ft\, dt - j \int_{t_1}^{t_2} w(t)x(t)\sin 2\pi ft\, dt.$$

Where spectral magnetudes are generated for storage as perceptually salient features, a discrete temporal approximation or DPT (discrete Fourier transformation) embodying a window function is required. To store a finite amount of frequency amplitudes and to analyze a finite quantity of speech values within a discrete interval of time requires a DFT implemented with a window function similar to the type expressed herein below:

$$X_s(k) = \sum_{n=0}^{N-1} w(n)x(n)\, e^{-j(2\pi nk/N)}$$

$$= \sum_{n=0}^{N-1} w(n)x(n)\left(\cos \frac{2\pi nk}{N} - j \sin \frac{2\pi nk}{N}\right)$$

$$= \sum_{n=0}^{N-1} w(n)x(n)\cos \frac{2\pi nk}{N} - j \sum_{n=0}^{N-1} w(n)x(n)\sin \frac{2\pi nk}{N}$$

where K is the frequency index, n is the time index, N is the quantity of points in the time sequence and normalization of the scale of frequency is instituted, such that, the frequency $2\pi$ corresponds to the frequency that the original time wave form is sampled; yielding an effective measure of the spectral content of each analyzed segment.

Filtering of discrete time signals as for linear filtering, where the output of the system is dependent on the present, on past inputs and past outputs if recursive, as indicated by the following expression $$y(t)=f[x(t-u),\ y(t-v)]$$

where
y=output signal
x=input signal
$0 \leqq u < \infty < v < \infty$
u,v=time variables indicating memory of system with regard to past inputs and outputs (respectively)
a resistor and a capacitor with a perfect impulse at the input yields $y(t)=e^{-MRC}$ for $t \geqq 0$ at the output.

however in general filtering computations are in the form described herein below $$y(n) = \sum_{k=1}^{N} b_k y(n-k) + \sum_{k=0}^{M} a_k x(n-k).$$

Figure 46:
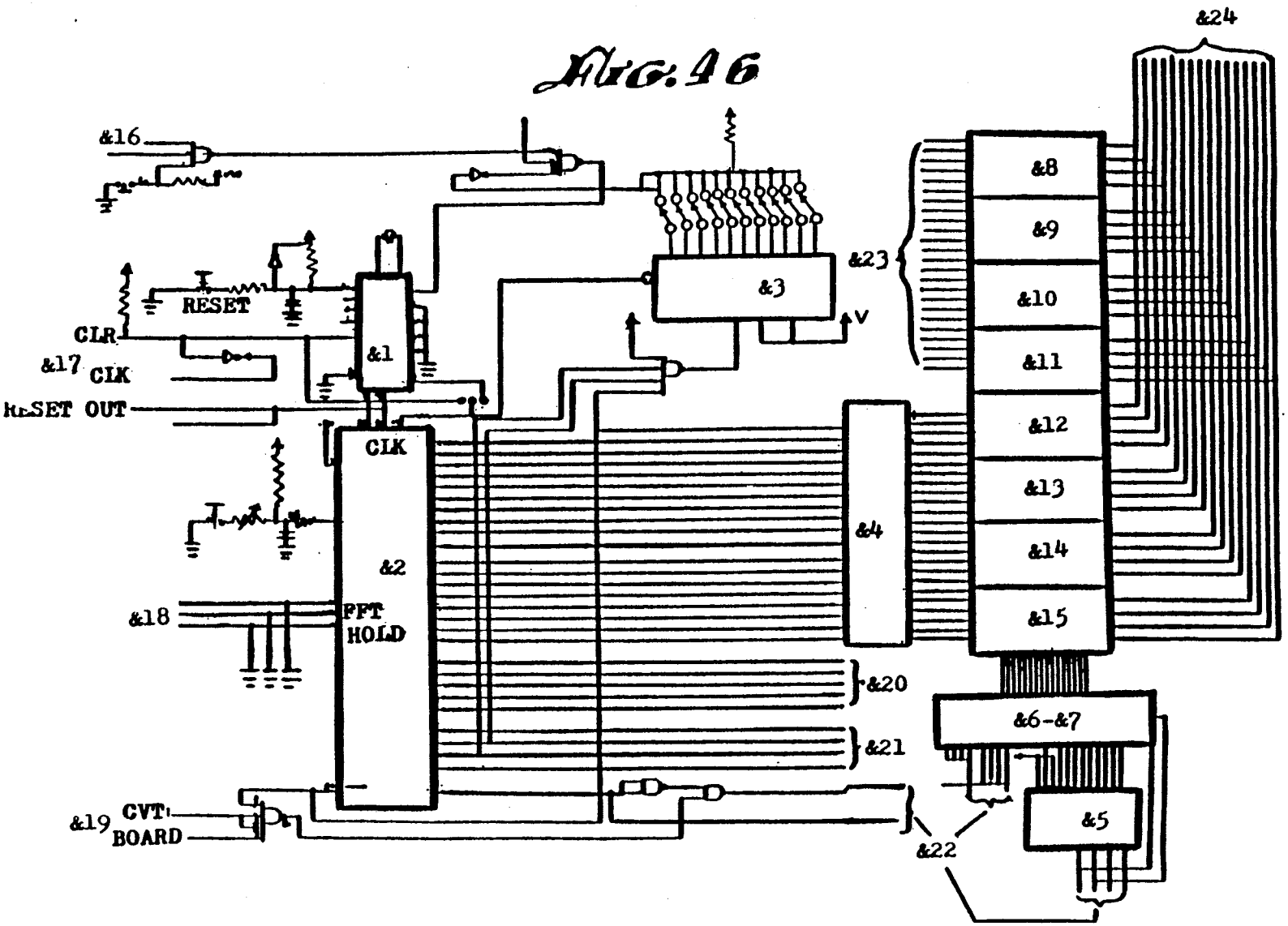
FIG. 46 is an over simplified timing sequencer, controlling projectile dispersal, thrust parameters of injection of plasmoids and parameters governing the transmission of power.

FIG. 46 describes in part one of only several timing oscillator circuits or sequencer means deployed by the device. The partial design schematic depicted in FIG. 46 is a basic variation of a commercially available circuit, which can be provided by companies such as Intel, I.B.M. or others. The circuitry disclosed in FIG. 46 predisposes the operation of the logic circuit depicted in FIG. 44. The key integrated circuits in FIG. 46 are assigned the alphanumeric values &1 through &15. Elements &16 through &24 are indicative of I/O from other circuits. The capacitance diode, resistive elements are readily understandable by those skilled in the art and are not assigned to alphanumeric values.

Figure 47:
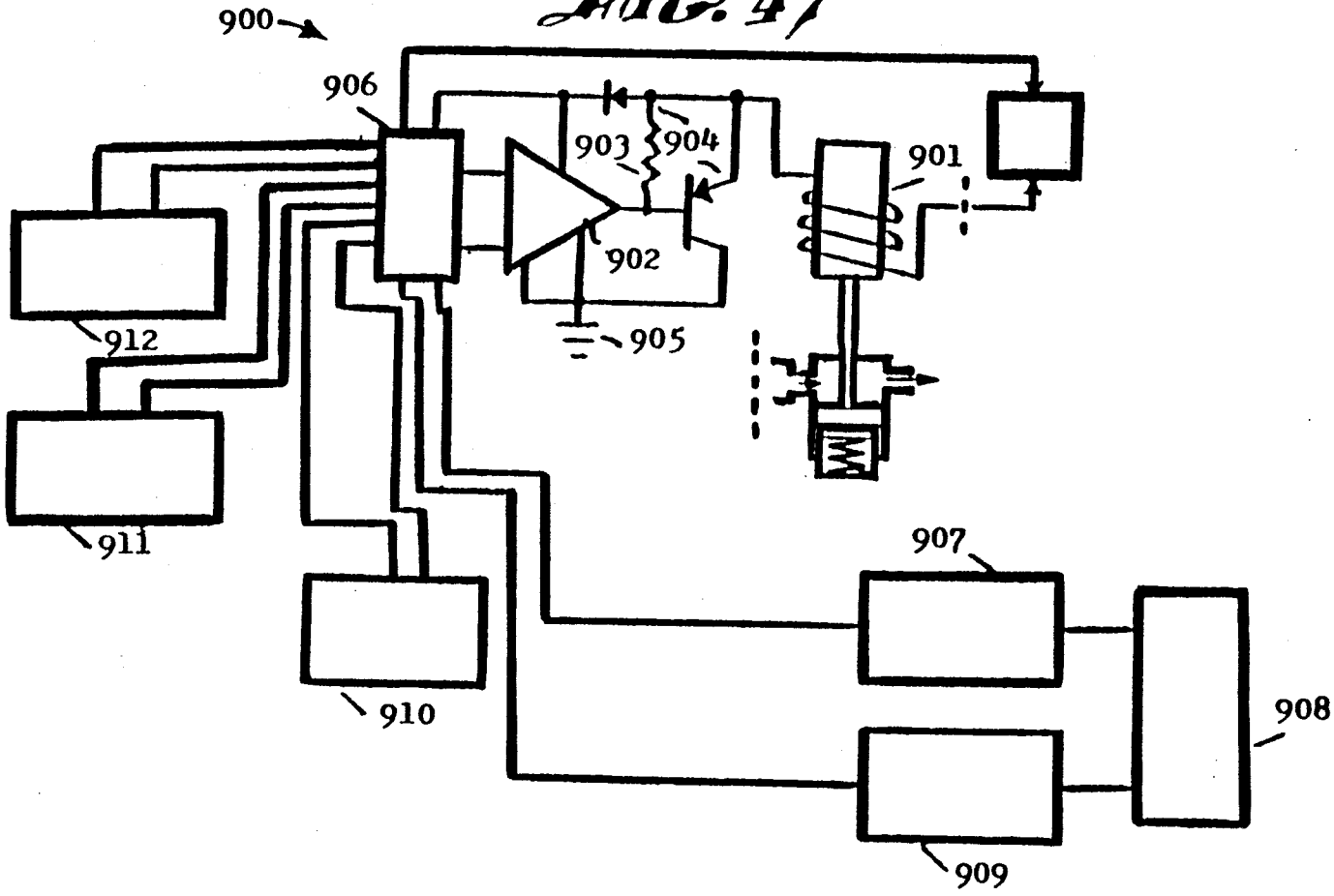
FIG. 47 is a combination circuit and block diagram disclosing the operation of an automated solenoid motivator means equivalent to those elements embodied within said device.

FIG. 47 is a concise circuit and block diagram essentially describing the operation of one of several equivalent solenoid means embodies within the mass action driver device. Numeral 900 of FIG. 47 is assigned to collectively describe the entire solenoid structure which are typical of the motivator means utilized with position projectiles into the firing chamber, or to rotate or open and close governor valves in order to emit or exclude the introduction of plasmids into the central cavity or breech of the device. Numerals 901, 902, 903 and 904 designate one of several equivalent solenoid units, as integrated circuit, diode and resistive elements and a suitable ground means, respectively. Namely 905 defines a combination control unit and sequencer means. Numeral 906 operates to control the input delivered to the solenoid circuit, the output delivered by said circuit and the sequence in which one or more solenoids are to be actuated in odor to perform a given specified function. The pressure or force generated by a bolus of plasma, released for plasmitization, the position of wafer or cannister elements in relation to the loading and/or firing chamber, sensory data supplied by electro-optical systems, electrical contact elements or other sensory data is processed by elements 907. The position of projectiles are specified by means 908, which additionally receives data from elements 907, 909. Element 910 defines a single mode rapid scan electro-optical array; which not only verifies the position of the projectile but the type of projectile based on identifying the holographic code or encrypton pattern etched on the surface of the aforesaid projectile. Numeral 911 designates a counter latch and decoder unit for a signal processing and the locking mode; whereas measurements are processed by unit 912.

Figure 48:
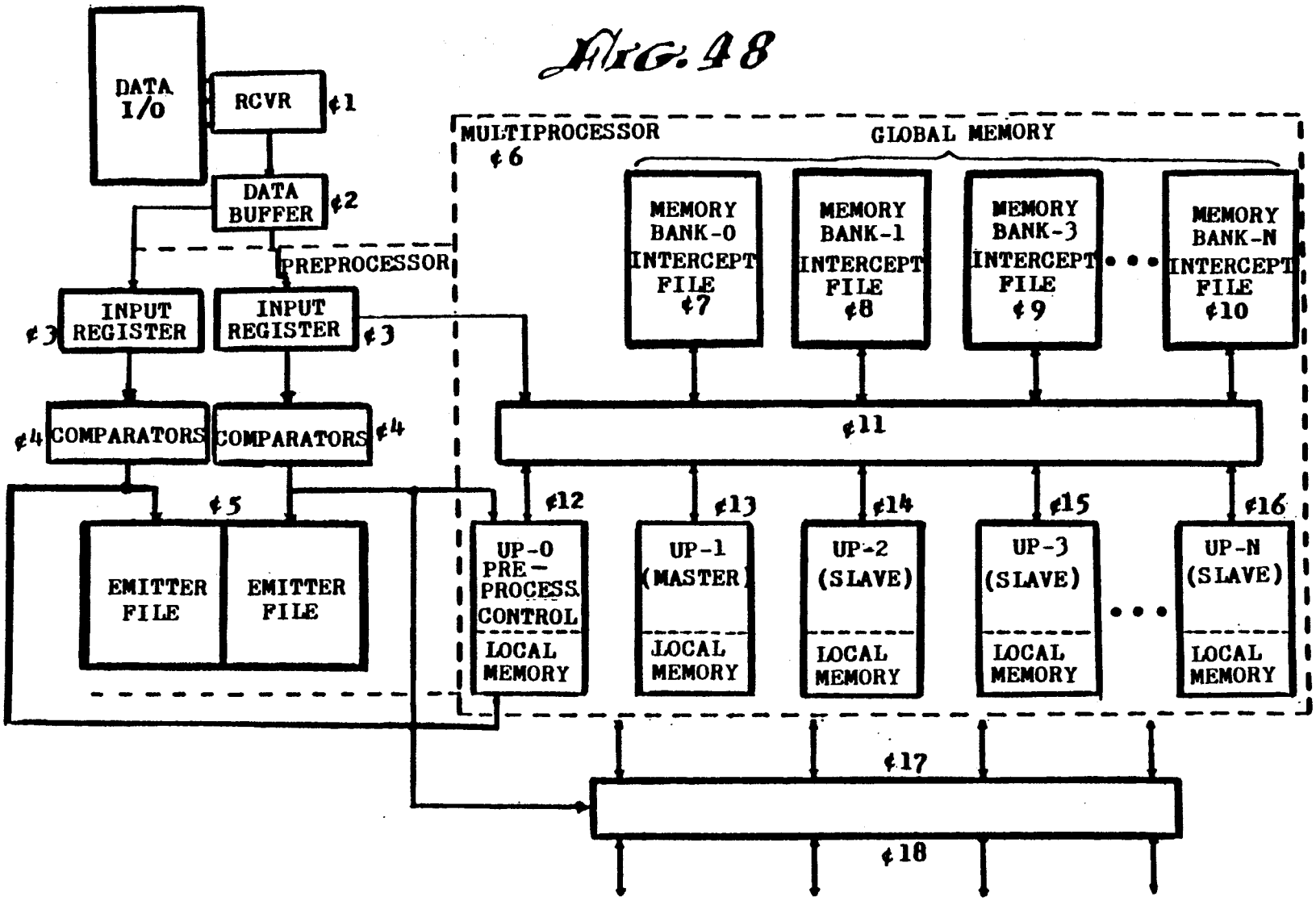
FIG. 48 is illustrative of a block diagram perspective denoting only one of the equivalent microcomputer array processor elements deposited on the VHSIC card.

FIG. 48 entails a simplified schematic block diagram illustrating in brief the operations of a global memory system. The simplified block diagram described in FIG. 40 illustrates in an examplary fashion a microcomputer array processor element disposited on a single VHSIC card. Information is received and encoded by element ¢1, which sends the data to be buffered by ¢2. The data obtained from ¢2 is then conveyed to a series of serial input registers, as denoted by element ¢3. The data from ¢3 is sent to a comparator bank, described by ¢4, which either processes the data by sending it to an emitter file ¢5 or to a series of interrogator circuits. The microcomputer array processor means is designated by value ¢6, which is contained within the embodiment of elements that are defined by a series of memory bank elements and intercept files denoted by elements ¢7 through ¢10;

wherein element ¢10 is a memory bank consisting of a number of subelements carried out to some desired element and all the elements ¢7 through ¢10 form what is losely known, as a global memory. Element ¢11 forms a typical memory request logic interrogator means and elements ¢12 through ¢16, which forms a preprocessor control local memory interrogator, a master control local memory and a series of slave memories with EEPROM capabilities. The processed data and preprocessed data are both entered directly into the systems computer controller means, as defined by embarkation point ¢17 and ¢18.

Embodied within the structure of the global memory system are integrated circuits or microprocessors which are responsible for manipulating the data fed into the microcomputer, in accordance with the operative set of instructions provided here by the user. The instructions are keyed by the user and are provided within the operative framework of a digitized list or sequence forming a program, which is encoded and stored into the memory elements of the microcomputer. Each instructional element of a sequence of instructions consists of a specified number of bits averaging 256 bits of information, which is stored in one or more registers collectively called a memory address. The number of addresses of instruction sequences to be employed by the system is stored in order for the proper sequence in a program counter. A controller means usually receives the address of the new set of instructions from the program counter, which obtains the digitized data stored in the aforementioned memory address and transfers the said data to the instruction register. The way by which data is conveyed is by three separate and distinct communication channels, as designated by the address bus, the control bus and the data bus, respectively. The instructional address placed in the program counter is entered in the address bus which readies the storage means to yield or transmit the instructional data. A digitized signal or electrical impulse on the control bus enables the data to be transferred to the data bus means. An additional control signal conveyed to the instruction register is held, while the controller means decodes it and issues further digitized control signals to perform the given set of instructions. The instructions pertain to data stored in the data buffer and may be initiated by either some input device or in and from the memory. If the instructions perform a given operation the results of the said operation may be stored temporarily in the accumulator means; wherein upon completion of the same said operation the results are sent back to the specified memory address. The ALO and accumulator means are associated with a set of condition codes also known as flags, which function as single bit registers with each unit indicating something about the results about a given operation held in the accumulator means. When subprogram and frequent subroutines are embodied within a given program which requires several instructions in the same sequence are conveyed to adjacent memory addresses collectively defined as a stack means, which enhances the speeds in a given operation. The memory addresses forming the stack are separately addressed, as if only a single memory location and the address accessed is stored, in a means defined as the stack pointer. The stack pointer functions in a specific fashion as to allow the controller use only a single address to call for the entire stack.

Figure 48A:
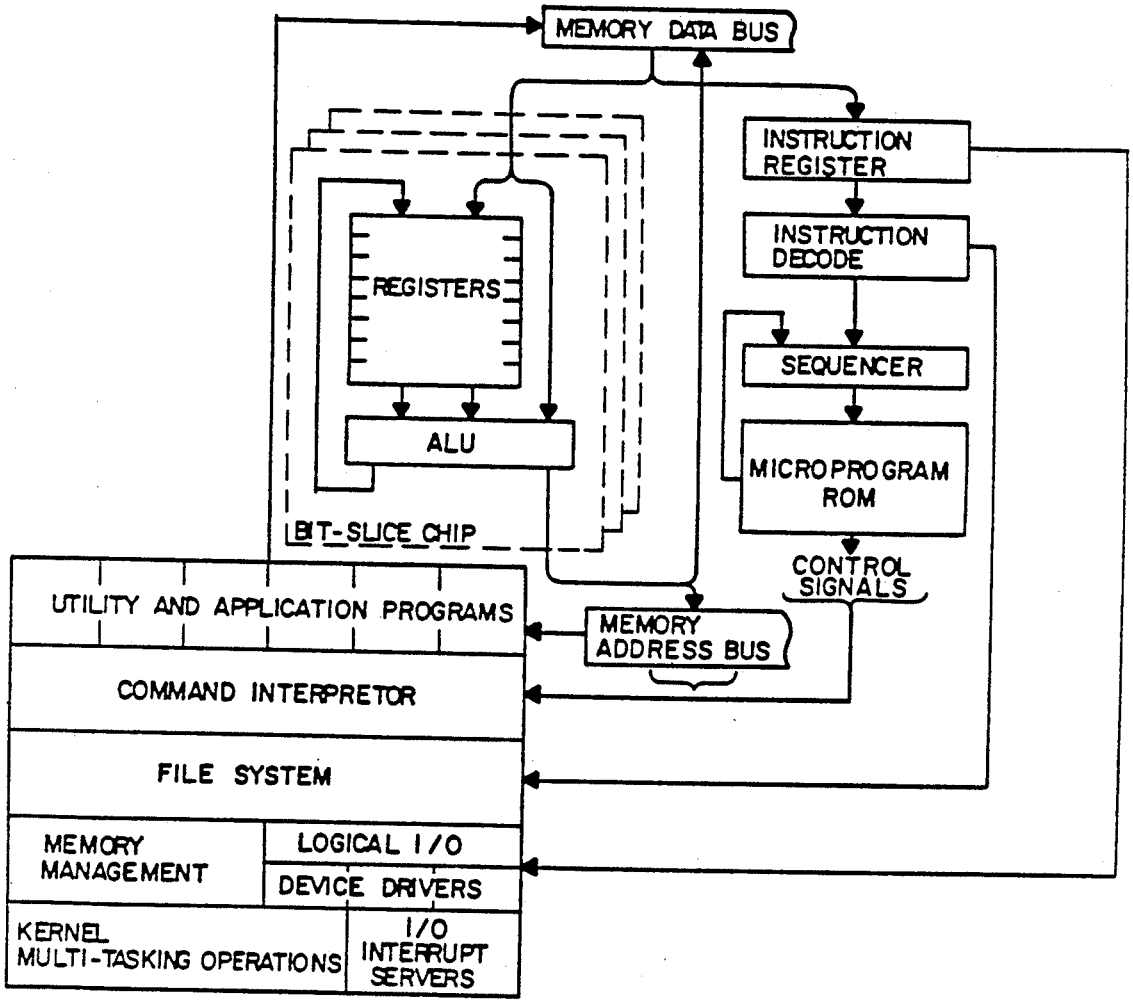
FIGS. 48*a*, 48*b* are concise block diagrams illustrating the operation of the CPU and ancillary systems.
Figure 48B:
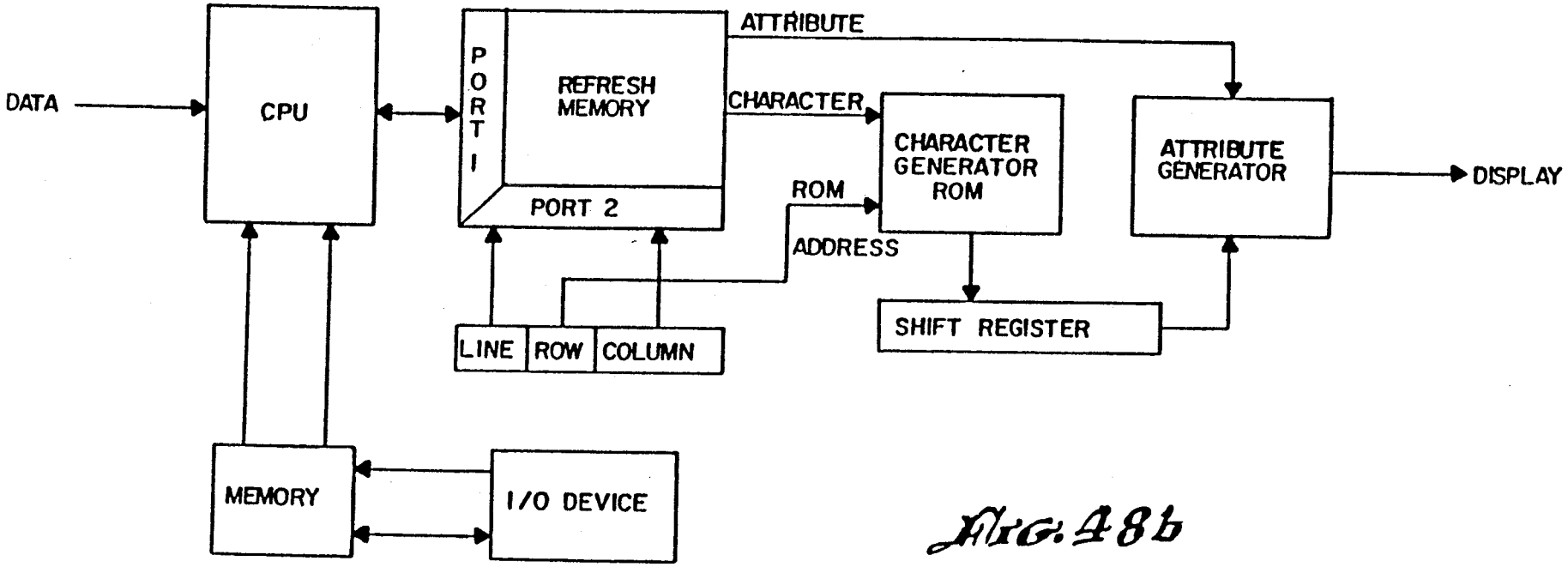

A series of other ancillary registers known as general purpose registers, which are used as required. The ancillary registors have or consist of a exact finite number of register elements n, begining with an accumulator and ending with a high order byte register and a lower order byte register means. Other means are disposed in the form of external connections including a clock, power supply, data input/output means, analog/digital converters and other means. The CPU is implemented with secondary memory devices, which are defined by such means as read only memories (ROM's). Random access memories (RAM), charged coupled devices (CCD's), or other equivalent means, embodied within such means as I.C.'s are etched or imprinted on a card along with the microprocessor. The above aforementioned operations of the central processing unit CPU and how the CPU transfers data are illustrated schematically by FIGS. 48*a*, 48*b*. Numeric values are not assigned to the elements in the figures because each element is clearly defined and straight forward, consistant with the operation of conventional computer systems.

Figure 48C:
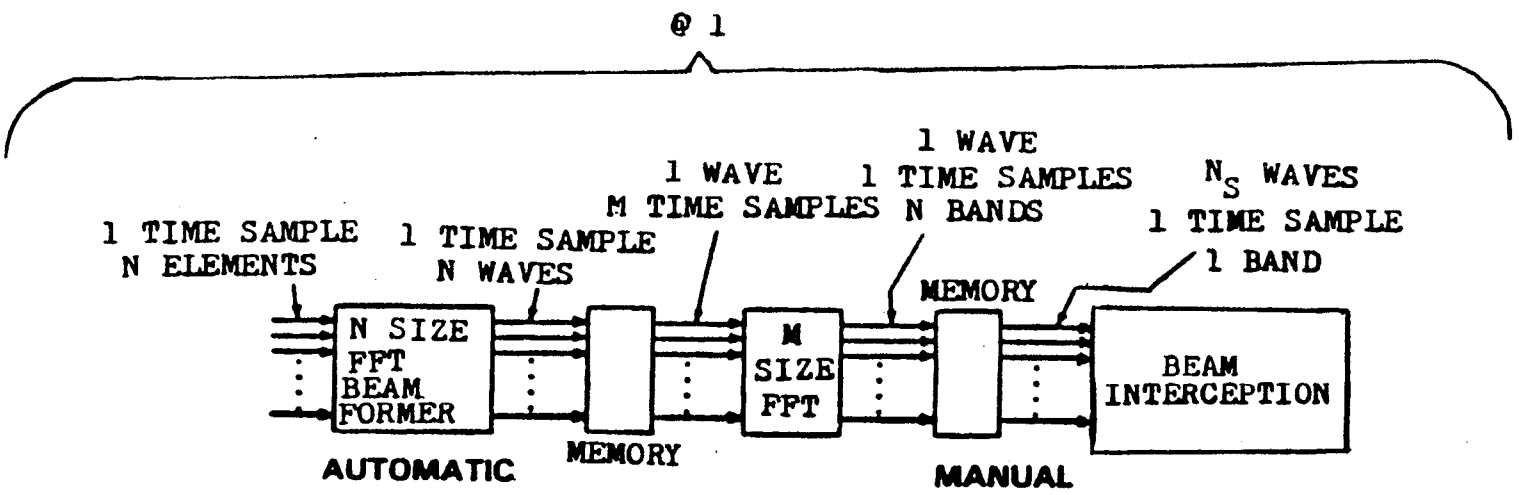
FIGS. 48*c* to 48*c*" disclose in a concise block diagram fashion the procurment of data obtained by sensors relative to programming.
Figure 48C:
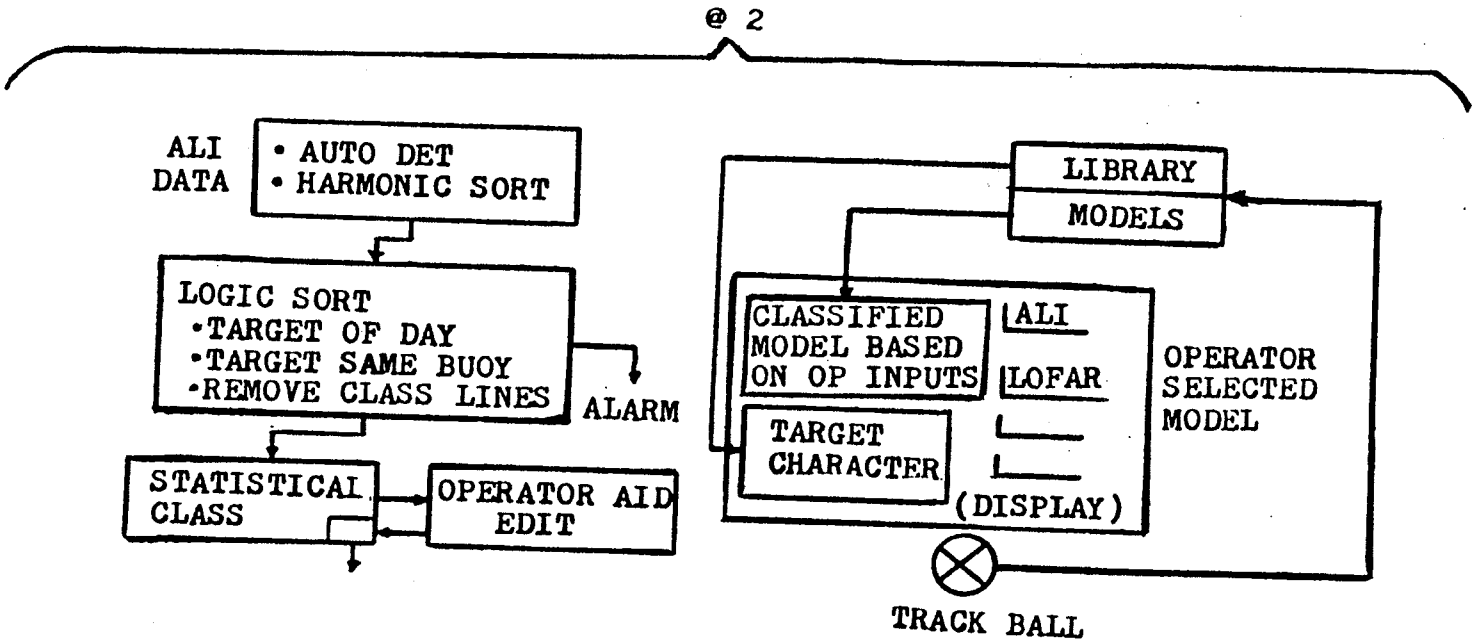

FIG. 48*c* illustrates in a concise block diagram fashion the procurment of data obtained from sensors relative to the implementation of programming. Data entering the system from sensors is continuously updated and the programmed actions are implemented on the basis of orthagonality Fast Fourier Transformations (FFT) or equivalent equation $@_1$. Vehicular operation readily interphases with existing systems such as ALI, LOFAR or others to provide additional instructions to the vehicular unit, $@_2$. The purpose and use of tactical ESM is provided within the operative framework of exiting programs $@_3$. FIG. 48*c* is subdivided into three separate and distinct levels of interaction, which are inter-related to one another. Manual interface between user and the aforementioned vehicular device is indicated in $@_2$ of said figure. Manual interface includes manual key board/joystick or mouse implementation. CPU/light pen/touch interaction voice actuated speech recognition/synthetic speech, synthesis and/or other means of interfacing with the CPU of said vehicular device. Data samples are obtained periodically from sensory elements. Said data samples are broken down into discrete segments which are processed by higher order logic functions, which determines the type, power and characteristics of emissions utilized to illiminate targets. Vessel to vessel target specifications on a daily and moment by moment basis classification of model targets based on attributes or characteristics of said targets are compared against digitized reference contained within a reportori or library of memory elements. The operator may select manually a variety of models or target types and/or delete or edit other said types out based on methods of statistical inference. Target illumination acquired by assigned sensory elements predisposes the time required to determine the bearing of said target to the emitter prior to detection by hostile or potentially hostile forces. Attributes of targets determined to be hostile are conveyed along with other data to provide tactical assessment of resources available to neutralize enemy forces. Said assessment additionally entails the disposition/composition of said forces, the state of readiness, available options and the actual attack event.

Figure 49:
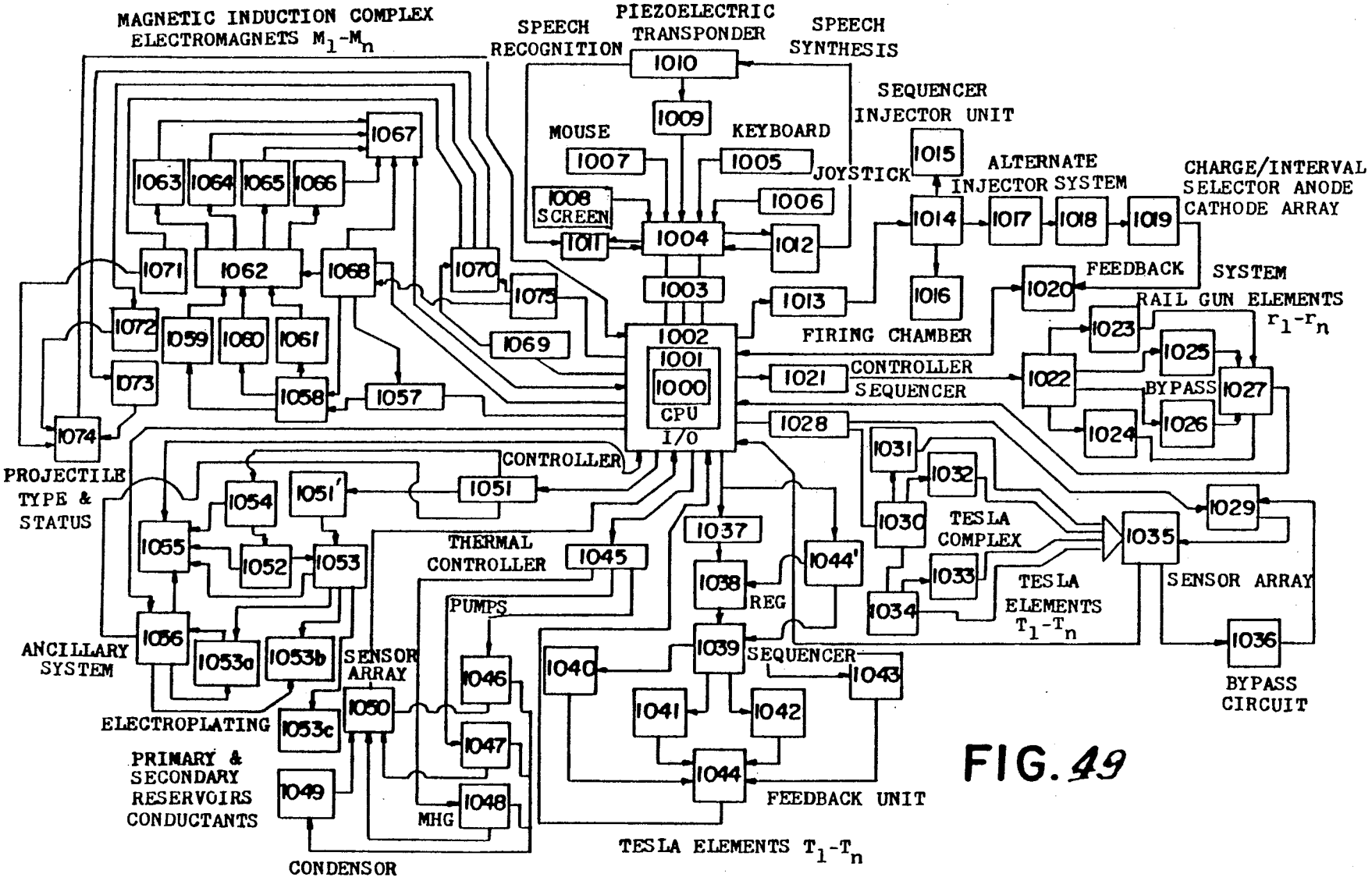
FIG. 49 denotes a block diagram entailing the basic operation of subsystems embodied within the invention.

FIG. 49 denotes a block diagram entailing the basic operation of subsystems embodied within the invention. Numerals 1000, 1001 and 1002 designate the centrally located CPU, a translator unit for encoding instructions from said CPU and decoding signals transmitted from aforesaid subsystems and an input/output fiber optics bridge whereby electro-optical impulses are conveyed into and from the CPU. The interface between the user and the CPU, number 1000, is conducted through secondary processing element 1003 which is engaged by interperture means 1004. Manually keyed operations are processed through keyboard element 1005, joystick 1006, mouse element 1007 and interactive screen unit 1008. Voice commands from the user are initially serially introduced into speech processor 1009. Data commands introduced by the user through piezoelectric transponder element 1010, which transmits digitized signals to speech recognition unit 1011, wherein the signals are compared against known digitized values until a match is instituted. Speech synthesizer 1012 produces appropriate verbal response to the user which accompanies an appropriate action. Controller element 1013 controls the power and transmits codified instructions to the primary launch mechanism governing plasmatization of wafer elements housed in various cannister means. Numeral 1014 is a sequencer element which delivers the proper electronic impulses to operative systems 1015 to 1019. Element 1015 describes as injector unit which loads wafer means from a specified cannister and injects said wafers into the firing chamber. Once loaded into the firing chamber or in route to said firing chamber system 1016 is actuated, emitting said wafers and then seals the firing chamber prior to detonation of aforesaid wafer elements. Numeral 1017 describes an alternate ejector mechanism, which is actuated if either cannister means or wafer elements embodied within said cannister jams, is static or is not plasmatizable. If a suitable wafer element is not presently available then alternate system 1018 is enlisted to compensate for various deficiencies existing in the primary launch system. The appropriate charge, interval of said charge is delivered to anode and cathode elements and charge biases are determined by element 1019. Element 1019 energizes the anode and cathode means responsible for producing the arc component plasmatizing the aforementioned wafer elements. Data from elements 1015 to 1019 regard the operative readiness of said elements are conveyed to processor 1020. The status of systems 1015 to 1019 is conveyed back to the CPU, number 1000, by process 1020. Numeral 1021 designates a controller unit, that regulates the power desiminated to the entire complement of rail elements and such related parameters as current, electrically charge or other properties. Energy is conveyed from element 1021 to sequencer means 1022 wherein said energy is distributed to separate rail elements $r_1$ to $r_n$ described by numbers 1022 to 1025, respectively. The status of rail element 1022 to 1025 is interpreted by element 1027, which monitors said elements including unit 1026 and conveys the data back to the CPU, number 1000. Number 1026 defines an automated bypass circuit which is actuated if systems failure develops in either the aforesaid rail elements or ancillary support means.

The secondary stage providing thrust or propulsion consists of the Tesla complex. Controller 1028 regulates signals conveyed to release mechanism or governor 1029. Governor 1029 regulates the flow of gaseous or liquified plasmids from the primary reservoir to secondary reservoir accompanying each Tesla element of said Tesla complex. Electronic signals are additionally sent from controller 1028 to sequencer mean 1030, wherein metered amounts or quantities of plasmids are released from the aforesaid secondary reservoirs leading to conduits surrounding each said Tesla element. As the metered plasmids are sequentially discharged from their respective conduits said plasmids are detonated by intense arcs produced by Tesla coil elements from each Tesla element of the complex. Numerals 1031 to 1034 described in part the number of Tesla elements $T_1$ to $T_n$ forming the aforementioned complex. The status of Tesla elements is monitored by element 1035, which reconveys data back to the CPU. Bypass circuit, number 1036 is enlisted if it is determined by element 1035 that one or more governors or solenoids controlling the flow of plasmids from said reservoirs or ancillary structures are inoperative. Parallel circuitry governing the power distribution of electrical charge and temporal limits are administered to Tesla elements of the said complex. Controller element 1037 actuates power regulator element 1038 which conveys power uniformly to sequencer element 1039, which distributes said power. Sequencer 1039 conveys power to Tesla elements $T_1$ to $T_n$ as described by numbers 1040 to 1043, respectively. The operative readiness of elements 1040 to 1043 is monitored by unit 1044 which reconveys data back to CPU, number 1000, which engages bypass means 1044. Element 1044 embodies a variety of programs, subprograms and routines which either boasts the signal to various inoperative Tesla elements and/or engages alternate systems to compensate for those elements determined to be inoperative.

The conducting layers subjected to intense electrical discharge, electrical propagation, extremes in temperature and pressure introduced by the discharge of plasma deteriorates during the operation of the [redacted] device. Excessive deterioration is averted by active and passive coolant systems; whereas deterioration is compensated for by resurfacing means, which restores expended conductants along the electrical conducting surface. Thermal controller element 1045 simultaneously actuates active coolant pump, number 1046, passive coolant pump 1047 which consists of a modified sterling heat engine and a magnetic hydrodynomic means, number 1048 to recover the 10 to 12 percent energy loss through the dissipation heat exhausted by the arc generator means, rail elements and other systems embodied within the device. Regulator apparatus for systems described by numerals 1046, 1047 and 1048 are necessarily embodied within same said systems. Processes from 1046, 1047 and 1048 enter condensor element 1049, wherein coolant are condense and recycled to maintain the structural integrity of structures where intense heat is generated. Data concerning the operational readiness of systems 1046 to 1049 are monitored by sensory array 1050, which reconveys data back to CPU, number 1000. Controller 1051 mediates electronic impulses governing the thermal volatilization of conductants to replenish those expended during the operation of the device, as described by number 1052. Numerals 1052, 1053 denote primary and secondary reservoirs which supply conductants. The primary reservoir 1052 recharges secondary reservoirs once their supply of conductants are exhausted. The conductants are distributed to regions wherein the conducting materials are subjected to conditions which bring about deterioration. The means of distribution for said conductants reside in a series of conduit elements, 1053*a*–1053*n*. The propagation of conductants resides in the electrical propagation of said conductants differentially along the surface of rail structures, Tesla arcing rods, discharge anodes or cathodes and other structures which conduct electric current. Electroplating element 1054 embodies peripheral elements which differentially change regions of the aforementioned electrical conducting structures and receives conditional instruction from controller 1051; said instructions being exclusively dependant on the flow of conductants from said reservoirs and the indication that the M.A.D. device is in an inoperative mode with regards to launching projectiles. The operative readiness of systems 1052 to 1054 are monitored by elements 1055, which access data derived from said systems and reconveys the information back to the CPU number 1000. The CPU will enlist a battery of ancillary system 1056 in the event a systems failure of any kind develops in the system responsible for recoating or replacing conductants.

Magnetic induction means interactively shape the force of plasma flow and assist the positioning of certain specified projectiles into the central bore of the device. Controller 1057 engages regulator 1058, which enlists elements 1059, 1060 and 1061. Means 1059 determines the polarity of said magnetic elements, numeral 1060 determines the magnetic flux of said m magnetic elements and element 1061 determines the power emitted in gases for said magnetic elements. Sequencer 1062 delivers current to aforesaid electromagnetic induction elements with properties determined by elements 1059, 1060 and 1061, respectively. Sequencer 1062 alters the parameters of magnetic induction elements or electromagnets $M_1$ to $M_n$ described by elements 1063, 1064, 1065 and 1066. Monitor means 1067 reconveys information concerning the operative status of elements 1063 to 1066 to CPU number 1000, which institutes alternate systems 1067 in the event of a systems failure developing in systems 1057 to 1066, which either overrides or replaces the aforementioned systems, as indicated by number 1068.

The specification of the type of projectiles loaded into the central bore, the rate at which said projectiles are loaded and other parameters are governed by controller 1069. Controller 1069 engages sequencer element 1070, which institutes the rate and sequence in which projectiles are to be inserted into the plasma stream conducted through the bore of the device. Numerals 1071, 1072 and 1073 specify whether or not the projectiles dispersed are armor piercing, contain an explosive warhead or some other type. The status of projectiles is determined by monitor 1074. Monitor 1074 conveys data concerning status of projectiles such as the types, the number of projectiles available, the operative condition of means deployed to insert said projectiles or any other parameters regarding said projectiles to both the CPU and auxillary computational facility 1075. Element 1075 corrects any deficiencies existing in the projectile launch phase such as re-amplification of the command signal conveyed by controller 1069, actuates alternate systems to by-pass those suffering a systems failure or actuates backup systems, as indicated by numeral 1075 to compensate for those systems rendered inoperative.

Figure 50:
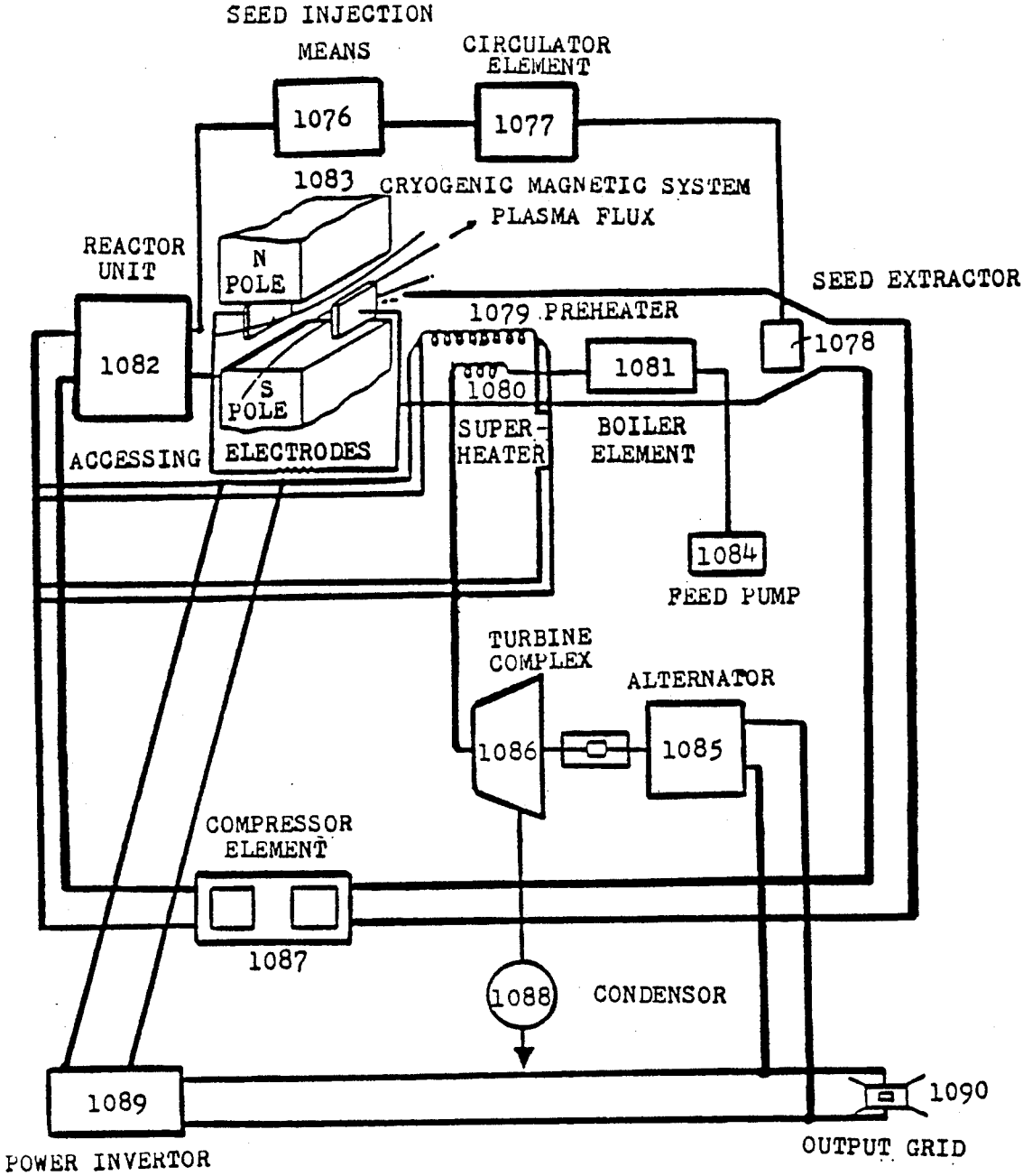
FIG. 50 described in a concise block diagrammatic fashion the operation of a magnetohydrodynamic power generator means utilized to recover energy exhausted as heat by said M.A.D. device.

FIG. 50 describes in brief a block diagram outlining the operation of the magnetohydrodynamic power generator means MHD employed to recover energy lost or dissipated as heat by the operation of the M.A.D. unit or device. Numeral 1076 designates a seed injector means, whereas numeral 1077 describes a circulator element and means 1078 collectively defines a seed extractor. The preheater element of the MHD system is defined by numeral 1079, whereas the superheater element and boiler means are described by numerals 1080, 1081, respectively. Numeral 1082 of FIG. 50 designates a reactor unit and numeral 1083 is assigned to a cryogenic magnetic system with an accessing array of electrodes at the head of the MHD generator. The feed pump means, alternator and turbine complex which are collectively assigned numeric values 1084, 1085 and 1086. The compressor element and condensor element are described by units 1087, 1088, respectively. Numerals 1089, 1090 are assigned to a power inverter and output grid means.

In practice and principle in high velocity electrical conducting fluid consisting of sodium, potassium, mercury or another suitable medium intersects a magnetic field and electrical current is transduced therein. The operative mode of the MHD can be expressed by a simple set of well known equations contained herein below $$\overline{E}=\mu\cdot\overline{B}$$

A jet of conducting fluid with velocity u, moves through a magnetic field of flux B at right angles creating a electric field E. The implacement of electrodes placed in proximity and in contact with the advancing jet, such that energy can be extracted and delivered to some external load. The system is in effect thermaldynamically equivalent to a turbine with electromagnetic braking of the turbine blades. If it can be assumed that the working fluid behaves as a typical electric conductor of the conductivity o, the current density j is given by the following expression, $$J=\sigma(E-\mu B)$$

The electrical power output per unit volume of duct is described by the following expression;

$$-j\,E=\sigma E\,(\mu B-E)$$

The ratio of load resistance to the total resistance described by the value K such that, $$K=E/\mu B$$

and the electrical power generated per unit volume of duct is noted by the following expression, $$W=-j\,E=K\,(l-K)\,\sigma\mu^2B^2$$

The power is essentially obtained by work done as the jet or moving stream encounters a body force such that, $$J\,B=(-l-K)\,\sigma\mu B^2$$

and the work done by the stream is equivalent to, $$-B\,u=(l-K\sigma u^2B^2)$$

the ohmic heating in the fluid is described by the expression, $$(l-K)^2\sigma u^2B^2$$

which is obtained by differencing W against $-j\,B\,\mu$.

Computational variances in the acquisition of targets in relation to internal parameters of the aforesaid devices are under the control of the CPU. The internal parameters of the M.A.D. device or means entails the quantity of thrust departed to specific projectiles, the elevation, longitude, distance and relative motion between said targets and the aforementioned device. External parameters, such as atmospheric resistance, projectile drag, the effects of gravity and related parameters encountered prior to impact are evaluated by the CPU. Information concerning the effects of impact, penetration, engagement of said targets is assessed by the user based on CPU in relation to ancillary targeting systems. The aforementioned ancillary targeting systems consist of but are not limited to laser designation, radar, sonar, various forms of enhanced telemetry, thermal detection and spectral analysis.

Figure 51:
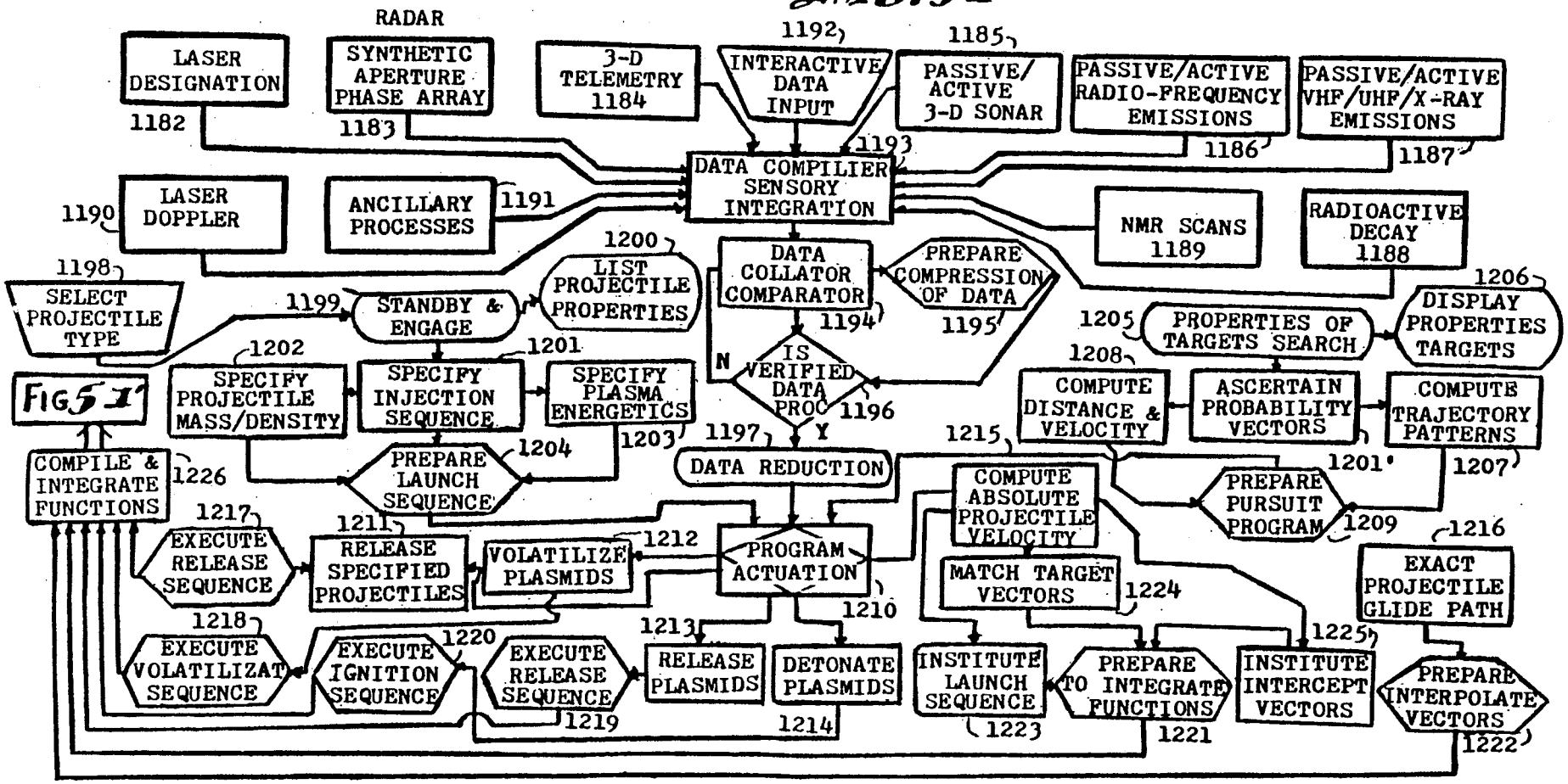
FIGS. 51, 51' and 51" disclose flow diagrams summarizing the operation of the M.A.D. device.
Figure 51:
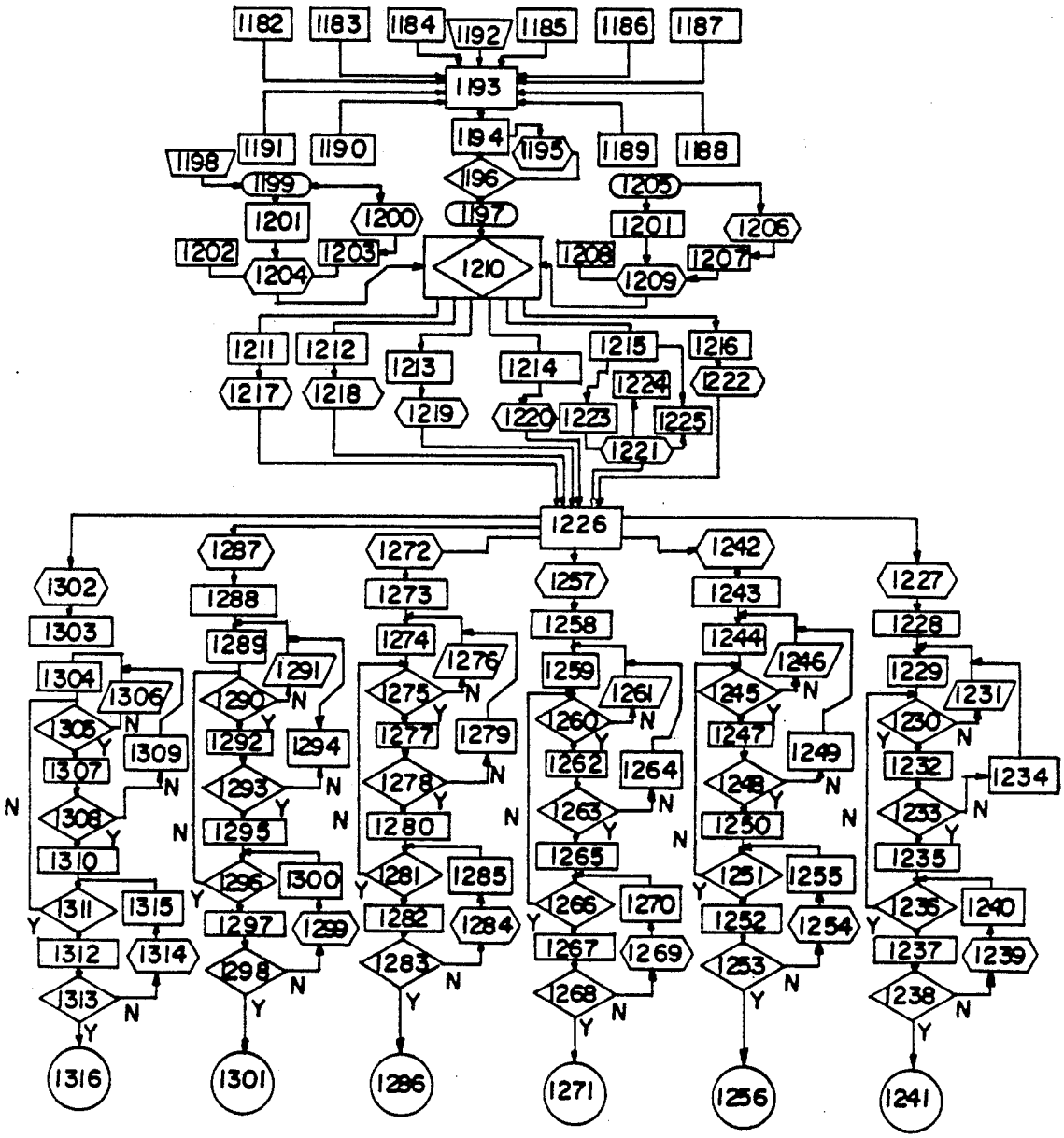

FIGS. 51, 51' disclose in part an abbreviated flow diagram summarizing the operation of the M.A.D. device. The extent to which operation is conducted within each system and subsequent interaction initiated between systems and subsystems is sufficiently summarized for one skilled in the art to readily understand the operation of the M.A.D. device. Numerals 1182 through 1191 of FIGS. 51, 51' disclose complexed and variable separate and distinct subprograms deployed by aforesaid means to identify, acquire and pursue designated targets. Disclosed earlier in the specifications where various equations and/or programming formats deployed to illiminate and track numerous targets exhibiting complexed and variable behavior ranging from multiphase radar means to spectral shifts provided by doppler laser analysis. Single numeric values are assigned to each subprogram rather than reiterating the complexity of each subprogram. Numeral 1191 embodies the programming formats disclosed in part by the preceding figures. Subprograms entailing laser designation, multiple phase radar and three dimensional telemetry systems are disclosed by numerals 1182, 1193 and 1184. Elements 1185, 1186 and 1187 accesses emissions generated by sonar, radiofrequency and transmission alluding to VHF, UHF and other bands. Numerals 1188, 1189, 1190 and 1191 are assigned to subprograms encompassing radioactive decay, nuclear magnetic resonance, laser doppler analysis of emitted chemical species and other ancillary processes. Numerals 1192, 1193 define manual interrupt processing systems or override means and associated keying operations. Manual means 1192 consists of but is not limited to voice command/-voice recognition systems, manual key stroke or touch access control, light pen cursor designation and or other means. Elements 1182 through 1193 collectively input into subprogram 1194 wherein data is collated, target acquisition and target pursuit are initiated prior to engaging preparatory process 1195. Preparatory process provides compression of collated data derived from program 1194. Decision process 1196 determines whether or not the compression of data is sufficient and whether or not target acquisition and/or pursuit is adequate enough to enlist engagement of said target(s). If target acquisition pursuit and the like are adequately prepared then the system is placed on standby momentarily, while data is transferred by element 1197 to element 1210. If it is determined by decision process 1195 that data compression has been inadequate, or that the signals have been significantly distorted or that signals from two of the detection means remain uncorrelated then filter and auto-correlation process 1190 is engaged to reprocess the information. The information reprocessed and filtered by process 1196 is reconveyed to preparatory process 1194. Subprogram elements 1199 to 1204 are equivalent in function to elements 1205 to 1209; wherein separate data inputs undergo interrogation and analysis. Data from subprogram elements 1197 through 1209 enter program elements collectively defined by numeral 1210; which enlists processes 1211 through 1216 which determine the projectile type, the absolute energy in MegaJoules delivered to said projectile, the mass of the projectile and related parameters. Elements 1217 to 1222 engage program 1226, wherein commands are executed and channeled to their proper designated actuation programs. Six equivalent actuation subprograms are disclosed in FIGS. 51', 51''; however a fully automated device may have a minimum of twenty actuation programs to a maximum of one hundred depending on the number of emissive systems. Element 1226 enlists the actuation programs 1227 through 1302, inclusive. Since the actuation programs are equivalent then the disclosure of one discloses the operation of the remaining five said programs. Numeral 1227 is a preparatory process, wherein incoming complexed data transmissions undergo signal processing and demodulation. Numerals 1228, 1129 entails the means whereby the energy supplied to a given system(s) and the duration of operation of the said are specified and appropriately executed. Decision process 1230 assesses whether or not the functions are correctly dispatched from elements 1228, 1229. If it is determined by 1230 that all functions regarding power output and the duration of the output are correct than process 1232 is engaged. If however, it is determined that either the power or durational interval of delivery (is) are improperly executed, but present, then clerical operation 1231 is imposed on the data from 1230 and the revised data is reconveyed to element 1229 to be collated with incoming impulses. Process 1232 exacts or accesses subprograms for the emission of specified wave characteristics and/or beam type. In the case of electropropulsive units, irregardless of the type of plasma the amplification of electromagnetic fields alluding to such properties as field strength, wave characteristics embodied within said fields, the temporal occurrences and polarity of said fields. Decision process 1233 verify the selection of the field properties accessed by process 1232. Single or multiple field properties are verified by element 1232. If positive verification by process 1233 is established then secondary temporal sequencing means are enlisted, as indicated by numeral 1235. Unverified wave characteristics from process 1233 are conveyed to process 1234 wherein the data is filtered, reprocessed and reintroduced to element 1229. The duration or interval of time specified wave characteristic(s), spectral line(s) or other properties contained within on or more emission is (are) presented is controlled by process 1236. Decision process 1236 verifies the duration in time said wave characteristics, spectral lines and the like processes are presented with unsubstantiated resultant data which is reconveyed along with incoming data to deterministic process 1230 for analysis. If verification by decision process 1236 is exacted then subprogram 1237 is enlisted; wherein ancillary, auxiliary and primary support systems are provided with sufficient instructions to be actuated. Decision process 1238 determines whether or not the proper command have been issued and received by the aforementioned system. If insufficiency exists in the instructions necessary to actuate said systems then preparatory process 1239 is enlisted, which amplifies and filters the exiting signals. The signal prepared by process 1239 are conveyed to process 1240 for further enhancement and restructuring prior to being submitted with data entering determinant process 1236. If positive confirmation is exacted by decision process 1238 then the data is transferred from the actuation program emboding elements 1227 through 1238 to the program governing system implementations; wherein the respective systems are called upon to execute the entire complement of commands, as indicated by numeral 1241. As stated earlier the six actuation programs specified in FIG. 51 of the disclosure are equivalent; therefore numerals 1227 through 1241, 1242 through 1256, 1257 through 1271, 1272 through 1286, 1288 through 1301 and 1302 through 1316 are all equivalent. Numerals 1241, 1256 and 1271 are equivalent to 1286, 1301 and 1316 wherein data is transferred from the respective actuation programs. The aforesaid programs are collectively described by FIGS. 52 through 52*e*, respectively.

Figure 52:
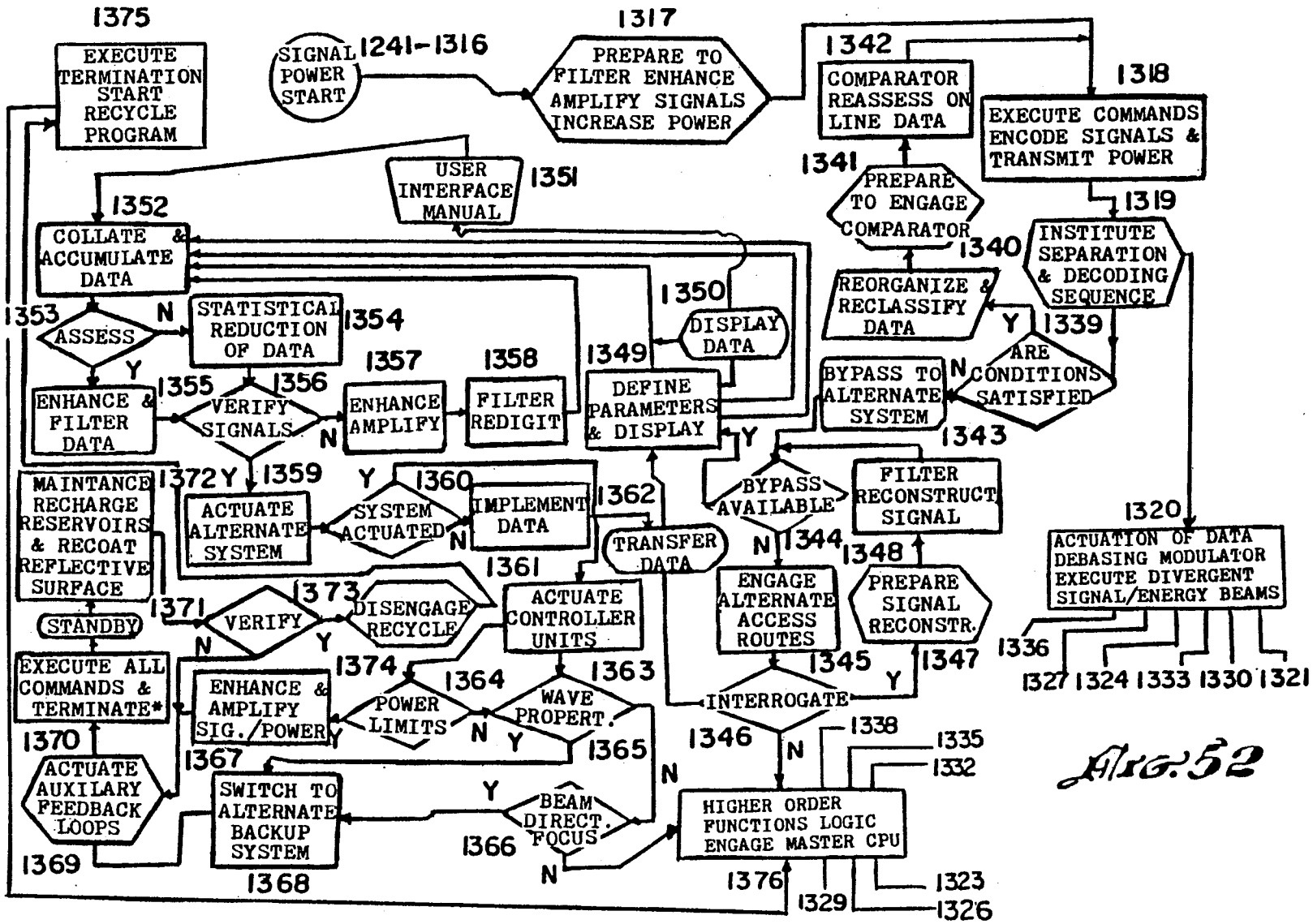
FIGS. 52 to 52*e* disclose concise programming formats, which implements system operation for systems embodied within said M.A.D. device.
Figure 52:
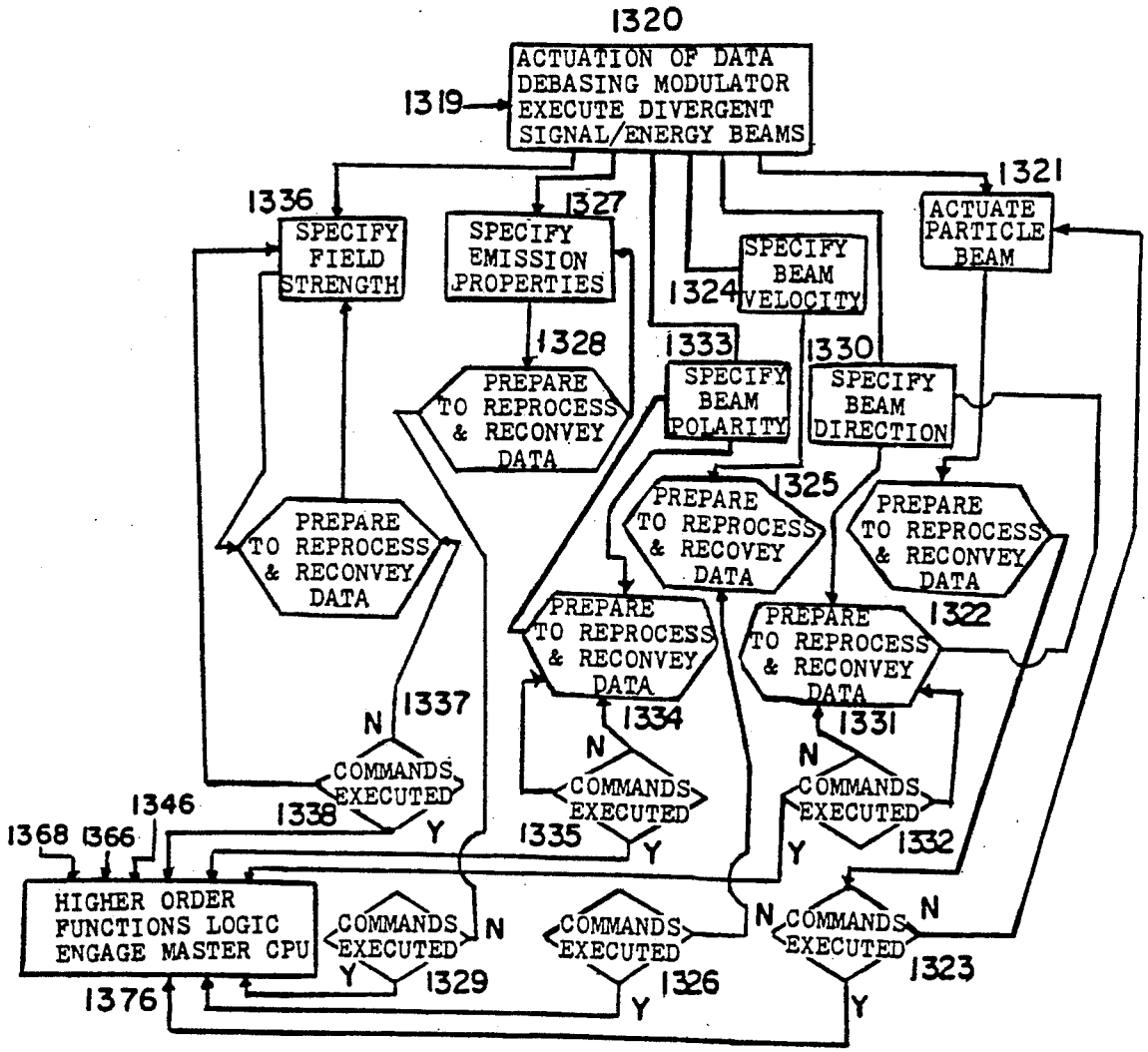
Figure 52A:
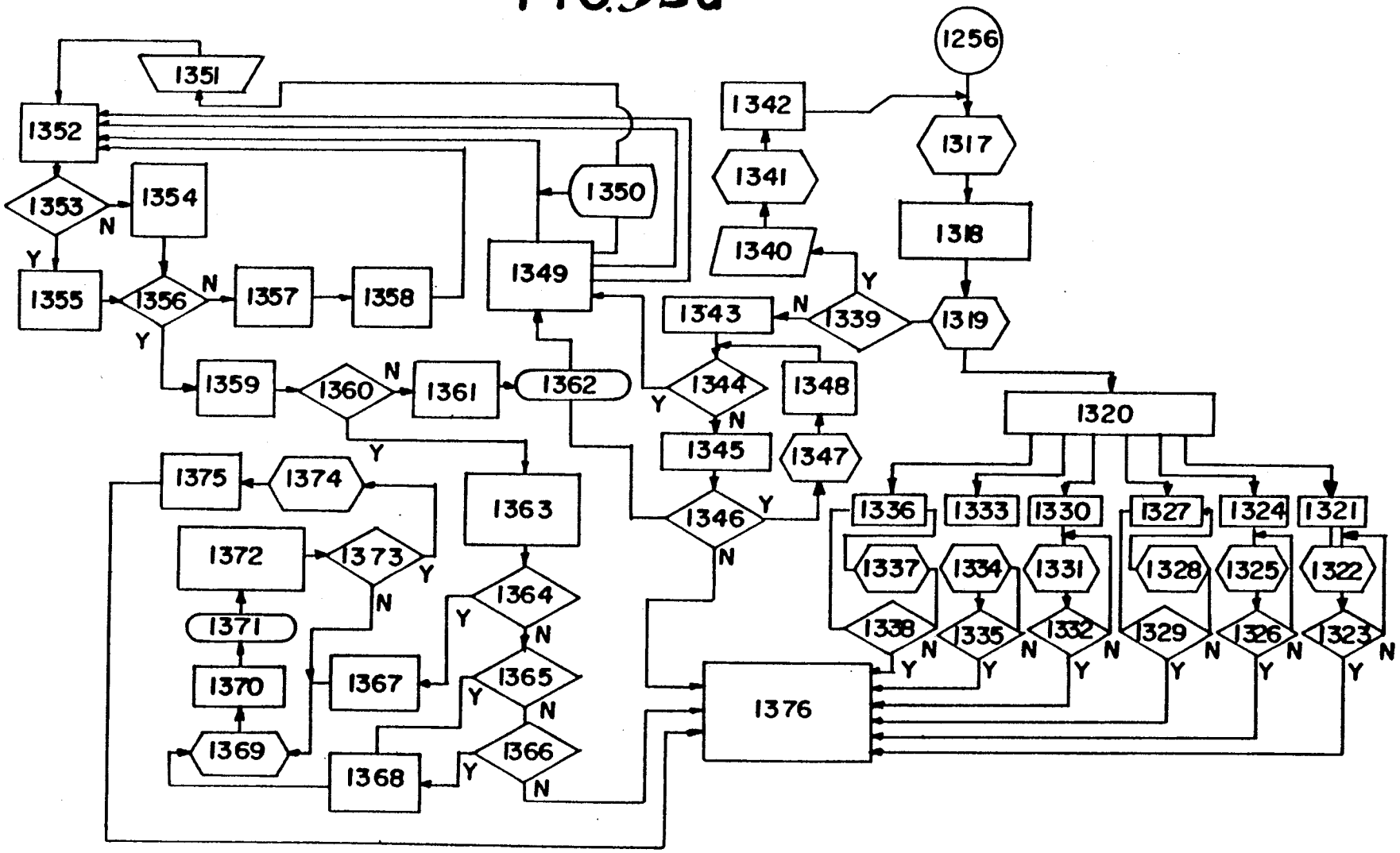
Figure 52B:
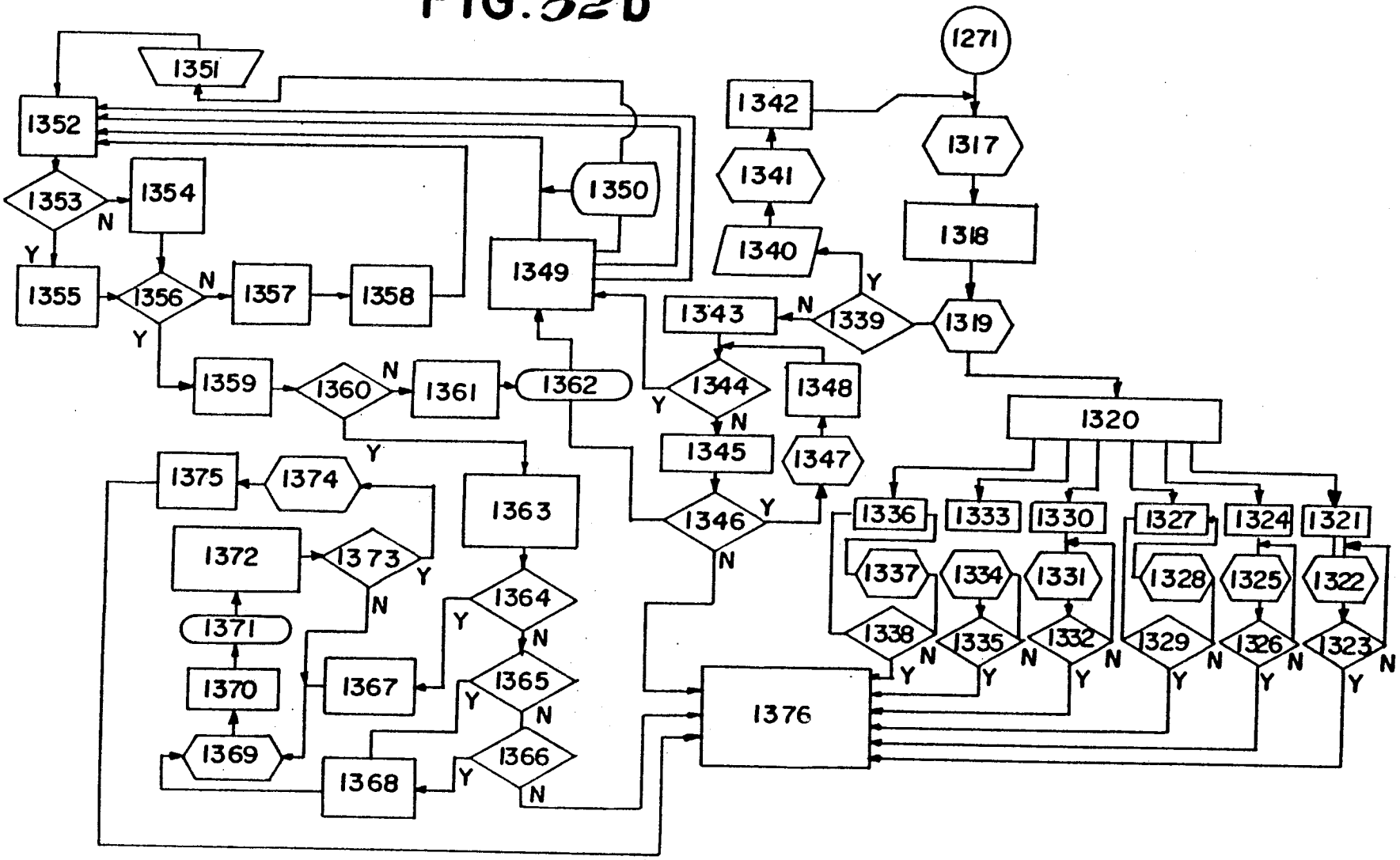
Figure 52C:
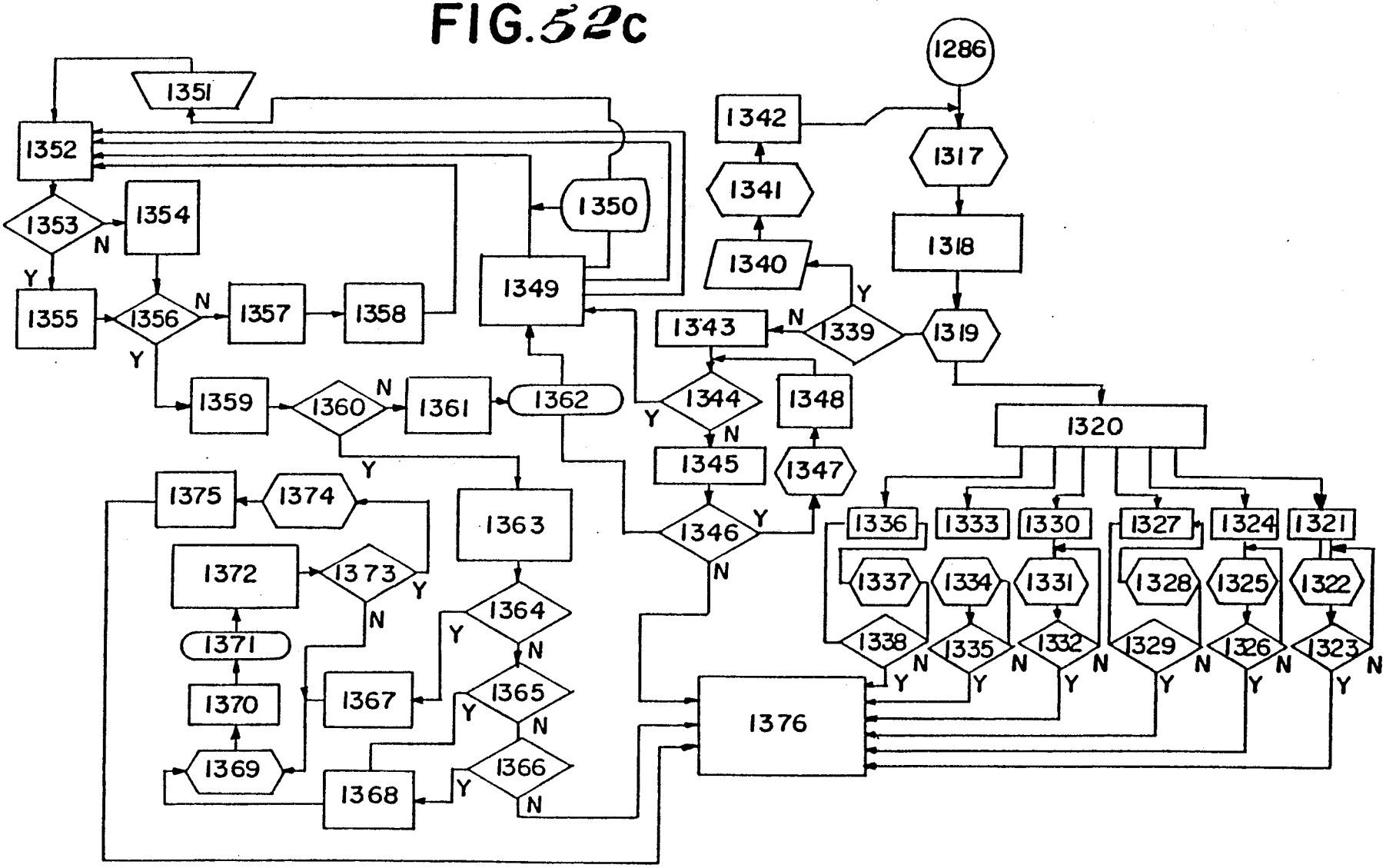
Figure 52D:
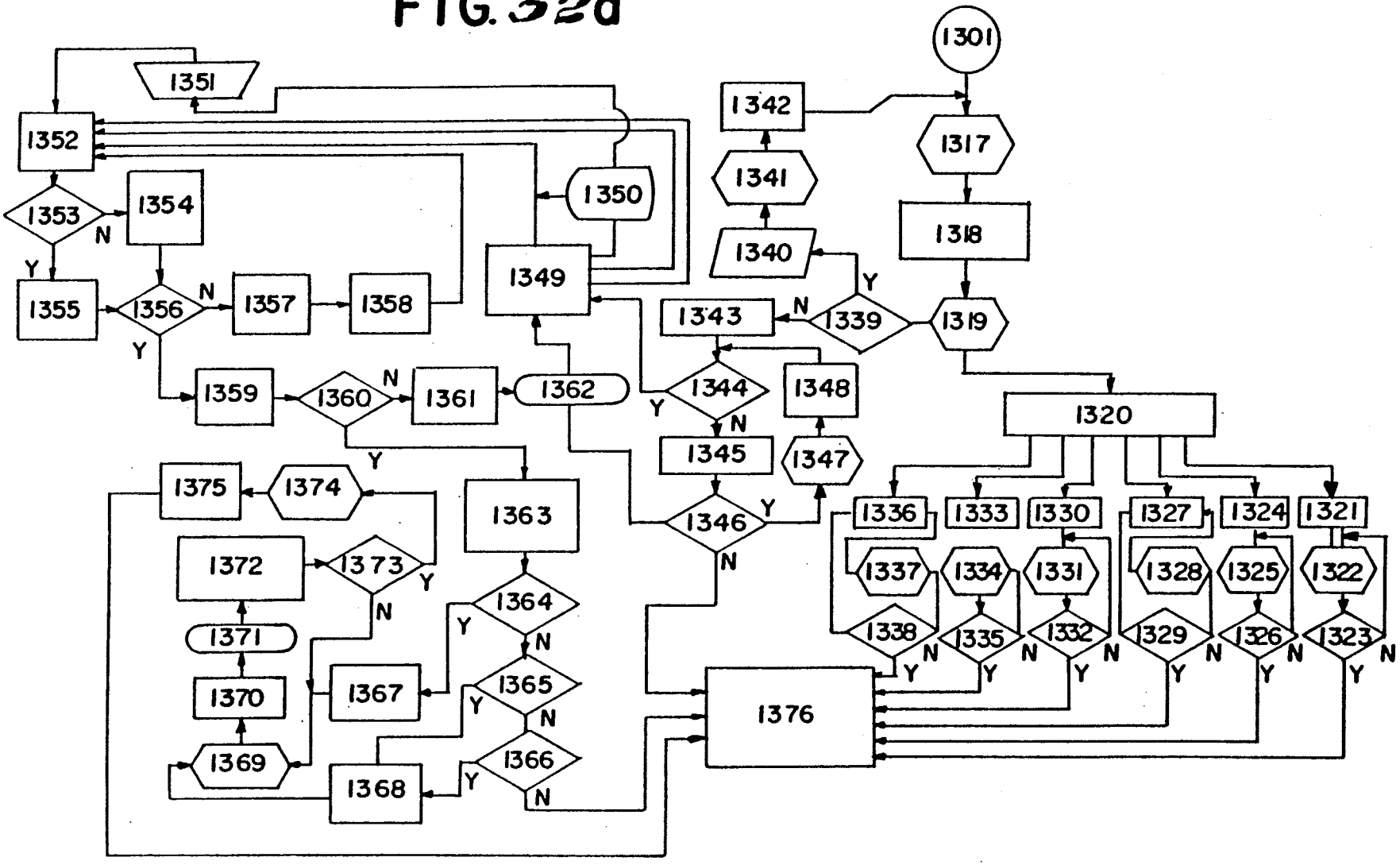
Figure 52E:
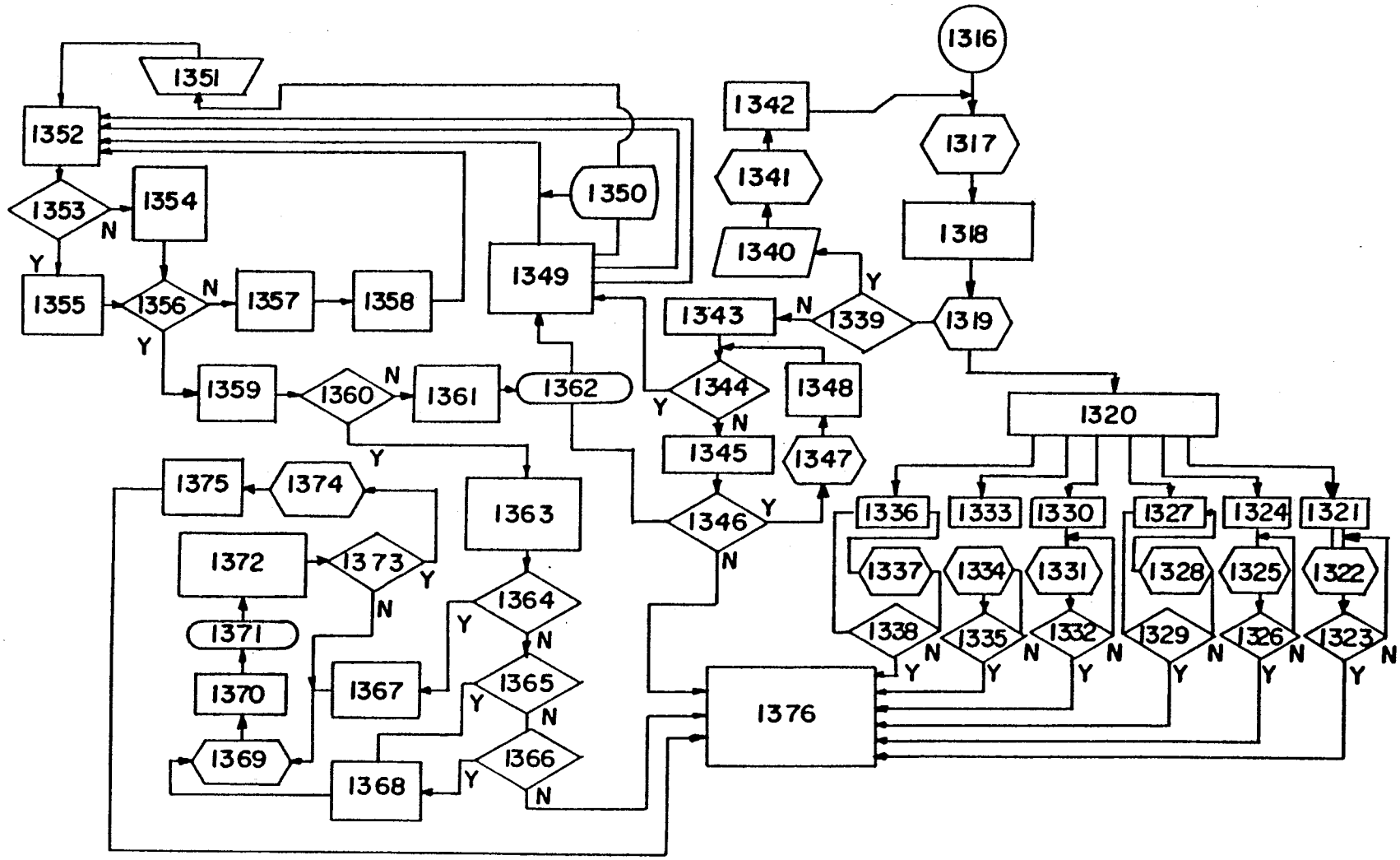

FIGS. 52 through 52*e* disclose in part the programming format which implements systems operation for the one or more systems embodied within the M.A.D. device. It is within the implementation process wherein either one or more operative systems are actuated and or viable alternative systems are inacted in the event of a systems failure or some other fault developing which renders the selected or specified system(s) inoperative or unavailable to the user. Transfer processes 1241 through 1316 collectively define equivalent subprograms enlisted collectively by the six equivalent transfer points, 1241, 1256, 1271, 1286, 1301 and 1316, respectively. Data from transfer points 1241 through 1316 actuate preparatory process 1317 which encodes the signal and transmits said signal to process 1318, which filters and amplifies the signal; prior to engaging preparatory process 1319, wherein a separation and decoding sequence occurs. The information prepared by element 1319 is conveyed to deterministic process 1339 to debasing modulator element 1320; wherein the signal is converted into at least six divergent transmission beams with portions of said transmissions, being conveyed to at least six separate and distinct loci or logic centers controlling separate subsystems considered the electromotive device or system consisting of a multitude of smaller subsystems. The type of particle or source beam(s) utilized is executed by subprogram 1321. The rate of acceleration of said particle beam(s) is determined by subprogram 1324. The confinement of field strength, which shapes the characteristics of said beam(s) as wavelength characteristics, spectral lines and related properties are executed by subprogram 1327. Subprograms 1330, 1333 and 1336 actuate mechanisms responsible for directing, diverging and focussing the source beam(s). Determinant processes 1323, 1326 and 1329 are equivalent in function to 1332, 1335 and 1338. The said deterministic processes are associated with separate and distinct sensor based feedback loops to determine whether or not the instructions of the subsystems are appropriately executed. If the respective subprograms instructions are impeded or are partially implemented then preparatory processes 1322, 1325, 1328 1331, 1334 and 1337 reprocess the data and reconveys the information to the respective subprograms. If however, the subprograms are properly executed in turn then the positive signals sent by the deterministic processes are collective acting as forcing function actuating high order functions assigned numeric value 1376. As disclosed previously the data from preparatory process 1319 is diverged and sent to both process 1320 and deterministic process 1339. If it is determined that the prepared data is insufficient to properly activate do to deficiencies in the processing of signals then the data is conveyed to elements 1340 through 1342 which reprocesses the information and reengages process 1318. Clerical operation 1340 wherein data signals are reorganized and reclassified prior to being sent to process 1341. It is within process 1341 where the data is prepared to re-enter the main sequence of the program. Preparatory process 1341 engages comparator element 1342, wherein the reprocessed data is conveyed along with new data to update data not sent to preparatory process 1317. If however, decision process 1339 determines that the data is sufficient to actuate the specified system(s) but said system(s) are inoperative then alternative system(s) must be activated. As indicated by subprogram 1343 a bypass switches to the next available operative system. Decision process 1344 determines whether or not a bypass system is available. If it is determined that an alternative source or system(s) are unavailable due to impeded access routes then alternative access routes are engaged, as indicated by process 1345. If however, an alternative source is available then subprogram 1349 is enlisted by decision process 1344. Subprogram 1345 entails statistical formats, which completes partially deleted garbled or jammed signals. Process 1345 enlists decision process 1346, which determines whether or not the function of the signals can be properly identified. If proper identification is established then preparatory and filter process 1347, 1348 are inacted and the data is summated with incoming data from 1343 to be re-evaluated by decision process 1344. If a negative response is enlisted by process 1346 then higher order functions 1376 are engaged. Subprogram 1349 displays the data, numeral 1350, which alerts the user and provides for manual intervention, as indicated by number 1351 and engages process 1352. Process 1352 is a subprogram wherein data pooled from other processes undergo integration. Once data has been pooled and undergone integration decision process 1353 determines whether or not data integration is properly executed. If positive affirmation of integration is determined by decision process 1353, then process 1355 is enlisted and if not the data is conveyed to process 1354. Process 1354 is a subprogram which subjects data to statistical analysis to eliminate signal distortion; whereas process 1355 enhances and filters the data signals. Data retrieved from elements 1354, 1355 are entered into deterministic process 1356, wherein verification of signal clearity is established. If signal clearity is not confirmed then the signal undergoes further enhancement redigitized and filtered as indicated by elements 1357, 1358, respectively. If positive confirmation is substantiated by process 1356, then process 1359 is engaged, wherein the alternative system is fully actuated. Decision process 1360 determines whether or not the alternative system is fully actuated and if a negative response is elicited then process 1361, 1362 are engaged. Data from 1360 is implemented by process 1361 whereby the said system(s) is (are) placed on standby and data is transferred or reconveyed back to element 1349, as indicated by element 1362. Positive affirmation of the actuation process is confirmed by process 1360 then subprogram 1363 governing a controller mechanism is activated. Each emissive system and the like is formed from the operative interaction of several subsystems and subprogram 1363 which collectively keys the actuation and sequencing of said subsystems. Decision processes 1364, 1365 and 1366 determine the operative viability of each subsystem, in relation to the overall operation of the entire system. Decision process 1364 determines the sufficiency of power limits assessed deliverable to specified subsystems. Decision process 1365 is enlisted upon positive confirmation of an adequet power source which determines if special properties, such as wave characteristics are selected. Decision process 1366 determines whether or not emissive beam(s) *generated are properly focused and/or directed to points of utilization. Negative responses elicited from decision processes 1364, 1365 and 1366 are appropriately dealt with by conveying the data to processes 1367, 1368 and 1376, respectively. Processes 1367, 1368 institute routines and subroutines which amplify signals and switch to auxiliary backup systems in the event of a systems failure. Preparatory process 1369 receives impulses from means governed by elements 1367, 1368 and actuate various feedback loops associated with the operation of said auxiliary backup systems. Process 1370 entails a subprogram which is responsible for the execution of all commands wherein upon termination the subsystems are temporarily placed in a standby state, as indicated by numeral 1371. Process 1372 is a subprogram requiring the initiation of maintenance mechanisms including but not limited to the recharging of reservoirs, restoration of reflectivity to a surface undergoing rapid deterioration and discharge of excess residual heat or the byproducts of the emissive source beam generators. Deterministic process 1373 verifies whether or not maintenance has been properly effected on subsystems. If it can be positively affirmed that the specified systems have all undergone appropriate maintenance then preparatory process 1374 is engaged; whereas preparatory process 1369 is reenlisted if a negative response is indicated by process 1373. Preparatory process 1374 and termination element 1375 shutdown all operative subsystems and transfers the remaining data to be acted upon further by higher order functions, as indicated by numeral 1376. The programming format for the entire complement of subsystems embodied within the M.A.D. device is replete with subprograms governing bypass processes for subsystems with redundant or repetitive functions.

*Electromagnetic wavelengths are shaped into narrow fields or beams.

Figure 53:
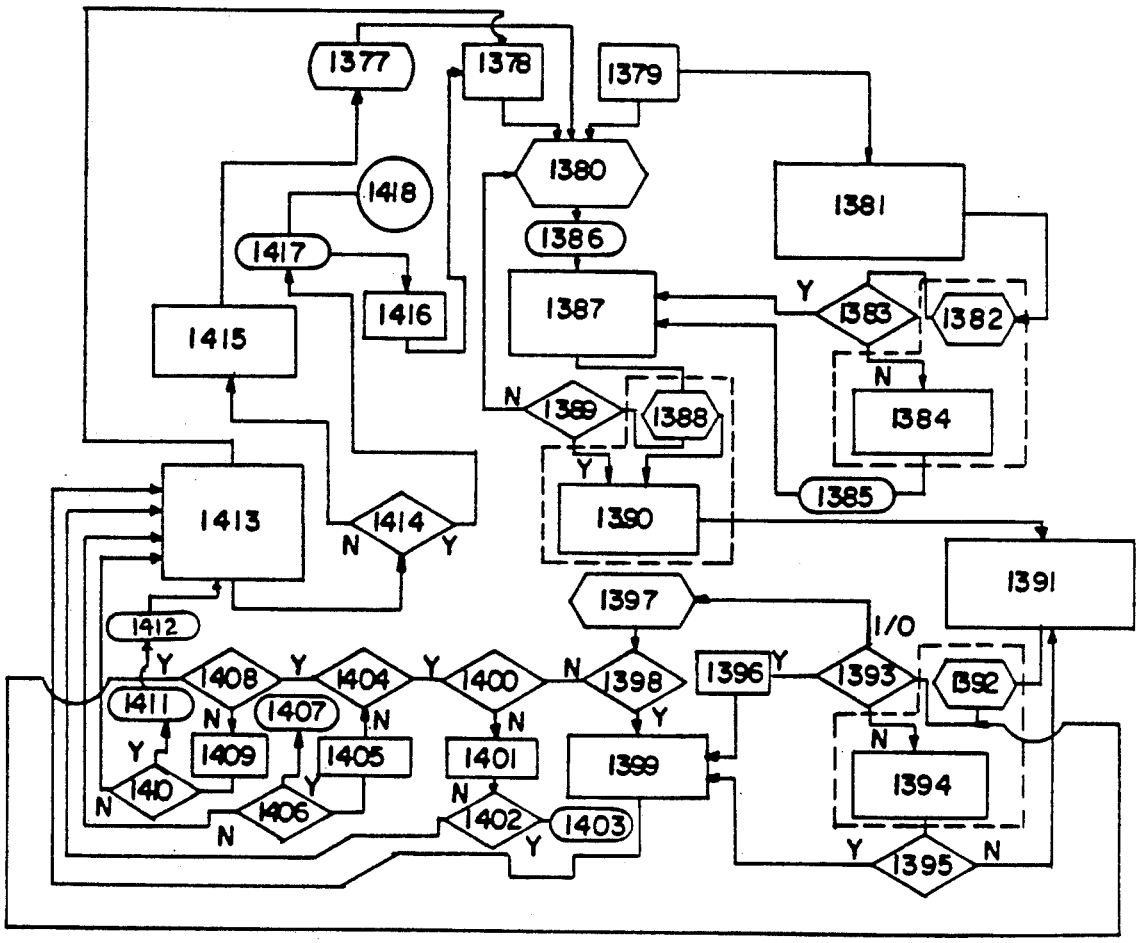
FIGS. 53, 53" are flow diagrams briefly illustrating the operative programming by which electropropulsive elements are sequentially actuated in relation to other electropropulsive elements.

FIGS. 53, 53" are equivalent flow diagrams illustrating the operative programming by which electropulsive elements are sequentially actuated in relation to similar or equivalent electropulsive elements. FIG. 53 denotes a format equivalent to the type of programming formats deployed to actuate the primary arcing mechanism, rail elements, the array of Tesla units, the entire complement of magnetic induction elements, and/or any ancillary support means utilized to augment said electropulsive units. Since FIG. 53 consists of a number of equivalent reiterative steps an explanation of the format governing one electropropulsive element is sufficient to define all similar such or equivalent electropropulsive means. Numerals 1377, 1378 and 1379 of FIG. 53 collectively describe the manual keying element, the CPU program initiator and the secondary system program initiator. Manual keying element 1377 is a user based system, which allows the aforesaid user through manual key instructions to actuate a specified number of electropropulsive elements in a precise order and/or intercede the operation of the CPU or other subordinate systems. The CPU program initiator number 1378 automatically institutes the precise sequence in which the aforesaid electropropulsive elements are to be actuated and the precise interval of time for each said electropropulsive elements is to be energized. The secondary system program initiator element, as described by numeral 1379 is a program initiator instituted by an ancillary microcomputer means, which is subordinate to the CPU, but has the equivalent computational capacity of said CPU at the level of said CPU. Numerals 1377, 1378 and 1379 convey their full complement of instructions to preparatory process 1380. Secondary initiator elements 1379 simultaneously actuated subprogram 1381. The response time of the microcomputer means governing the program embodied within subprogram 1379 has several orders of magnitude less circuitry to control than the CPU and has an comparable advantage over said CPU in response time. Subprogram 1381 specifies or sets the power level and/or field strength of the entire complement of electropropulsive elements. Data from subprogram 1381 is conveyed to preparatory process 1382 where the instructions are amplified and enhanced. Determinant process 1383 determines whether or not the power output of the aforementioned electropropulsive elements coincides with the upper limits specified by subprogram 1381. A positive affirmation that the power levels for said electropropulsive elements coincides with those specified by process 1381 as determined by sensors associated with decision process 1383 which conveys data directly to program 1387. A negative assessment by decision process 1383 enlist routine 1384, which actuates alternate circuits, to compensate for those circuits which are inoperative. Data from element 1384 is then conveyed by process 1385 to program 1387. Data from preparatory process 1380 is collated and enhanced prior to being conveyed by transfer process 1386 to program 1387. It is within program 1387 wherein the sequence or order in which each electropropulsive elements of a given specified subsystem embodied within the aforementioned M.A.D. unit or device. Program 1387 additionally specifies the temporal interval or duration of time each of the aforesaid electropropulsive elements or to be energized or activated once the power level or field strength have been established by elements 1381 to 1384. Program 1387 further specifies the status or operative readiness of the entire complement of said electropropulsive elements. Data from program 1387 enters preparatory process wherein the data regarding the operative status of every said electropropulsive element of a given specified complex is collated and compared against the operative norms of alternate equivalent ancillary system. The operative status of the aforesaid electropropulsive means is assessed by determinant process 1389, as data is conveyed from preparatory process 1388 to said determinant process and subprogram 1390, respectively. A negative assessment decision process 1389 re-enlists preparatory process 1380; whereas positive confirmation by decision process 1389 enlists subprogram 1390. Subprogram 1390 executes all previous commands and enlists subprogram 1391, which controls the quantity, rate of injection and ignition of plasmids. Subprogram 1391 upon completion of its tasks enlists preparatory process 1392, which runs a systems check on tasks performed and reintegrates said data. Data from process 1392 is conveyed to determinant process 1393. Determinant process 1393 assess whether or not the plasmids are properly dispersed and properly plasmatized. Positive confirmation by decision process 1393 regarding the disemination of said plasmids enlists process 1396, whereas a negative determination engages subprogram 1394 and in the event no determination is attainable then preparatory process 1397 is engaged. Subprogram 1394 immediately enlists the full complement of alternate circuits, bypass systems and ancillary means to compensate for systems failure and/or inadequencies incurred by systems governing the dispersal and ignition of said plasmids. Internal sensors embodied within circuits and bypass systems of said device monitor the status of various components and through determinant process 1395 assess whether or not subsystem 1394 has adequately compensated for deficiencies of said plasmid dissimination means. A negative assessment by process 1395 reenlists subprogram 1391; whereas a positive assessment by process 1395 enlists program 1399. Program 1399 is engaged by data compression element 1398.

Preparatory process 1397 provides sensory means with a mechanism by which commands can be appropriately handled by interrogotor element 1398, 1400, 1404 and 1408, respectively. The above mentioned interrogator elements determines the operative status of each electropropulsive element continuously after repeated firings of the aforesaid device and allows through ancillary processes modifications within the program. Determinant process 1398 interrogates electropropulsive elements 1—n after x number of successive firings to determine whether or not 100% of the specified operative capabilities of said electropropulsive means exist. If upon interrogation of impulses derived from feed circuits and comparator means process 1398 determines that the operative parameters of said electropropulsive means approaches or exceeds 100% than process 1399 is enlisted to exact a delta vector on the reserves of conductants and availability of electroplating mechanisms. Said delta vector being the shortest access route to a given data file containing the whereabouts of the most accessible reservoirs of electrical conductants. Once subprogram 1399 has execated its task, CPU program 1413 is engaged to assess and act upon the data. A negative evaluation by determinant process 1398 enlists determinant process 1400, which interrogates elements of the electropropulsive system to determine whether or not said electropropulsive elements have undergone sufficient deterioration to warrent the actuation the actuation of electroplating means and the release of conductants to recoat or resurface said electropropulsive elements. Significant deterioration of the aforesaid electropropulsive element is deemed at an operative loss evaluated at between 75 to 85 percent optimum functioning capacity. If decision process 1400 indicates that overall efficiency is diminished by 15 to 25 percent than process 1481 is enacted to compensate for said deficiencies by restoration of the electrical conducting surface. Subprogram 1401 is elicited by decision process 1400 and enlists subprograms, routines and subroutines which actuates mechanisms that restores the conducting surfaces of said propulsive elements; whereas upon completion of said tasks enlists determinant process 1402 verifying whether or not subprogram 1401 has appropriately executed instructions regarding restoration of said electropropulsive means. The process of restoration entailing the release of electrical conductants from reservoirs, the distribution of said conductants to points of dispersal and the subsequent dispersal process; wherein mechanisms by which dispersal are actuated, such as electroplating units release conduits and or ancillary support means. Positive confirmation that the electrical conducting capacity of said electropropulsive elements have been restored according to acceptable operating norms then said restoration process is terminated and the system is placed on standby, as indicated by numeral 1403. A negative evaluation by determinant process 1402 enlists CPU program 1413 for analysis, re-evaluation and so that alternate measures may be inacted by said CPU to compensate for known deficiencies. Steps initiated and executed by process 1400 to 1403 are equivalent to repetitive processes 1404 to 1407 and 1408 to 1411, respectively. Processes 1400 to 1411 service equivalent electropropulsive means from a single element to some finite number n. Once the entire complement of said electropropulsive elements have been properly serviced then the entire system is placed momentarily on standby, as indicated by number 1412. Standby process 1412 eventually enlists the program engaging the CPU, described by element 1413 which similarily engages processes 1399, 1402, 1406 and 1410, respectively. Program 1413 upon completion of its tasks enlists both determinant process 1414 and element 1378. Determinant process 1414 indicates whether or not program 1413 and the preceding processes have completed their prescribed functions.

If it is determined by process 1414 that all functions of program 1414 and existing processes 1377 to 1413 then the entire system is placed on standby, and the CPU is flaged to go to other electropropulsive systems embodied within aforesaid M.A.D. device, as prescribed by number 1417. Additionally element 1416 reactuates the entire program sequence as indicated by process 1418, for the next firing of projectile elements. Element 1414 upon a negative determination actuates subprogram 1415 which interfaces with the user and reengages process 1380 through manual keying process 1377, inclusive.

Figure 54:
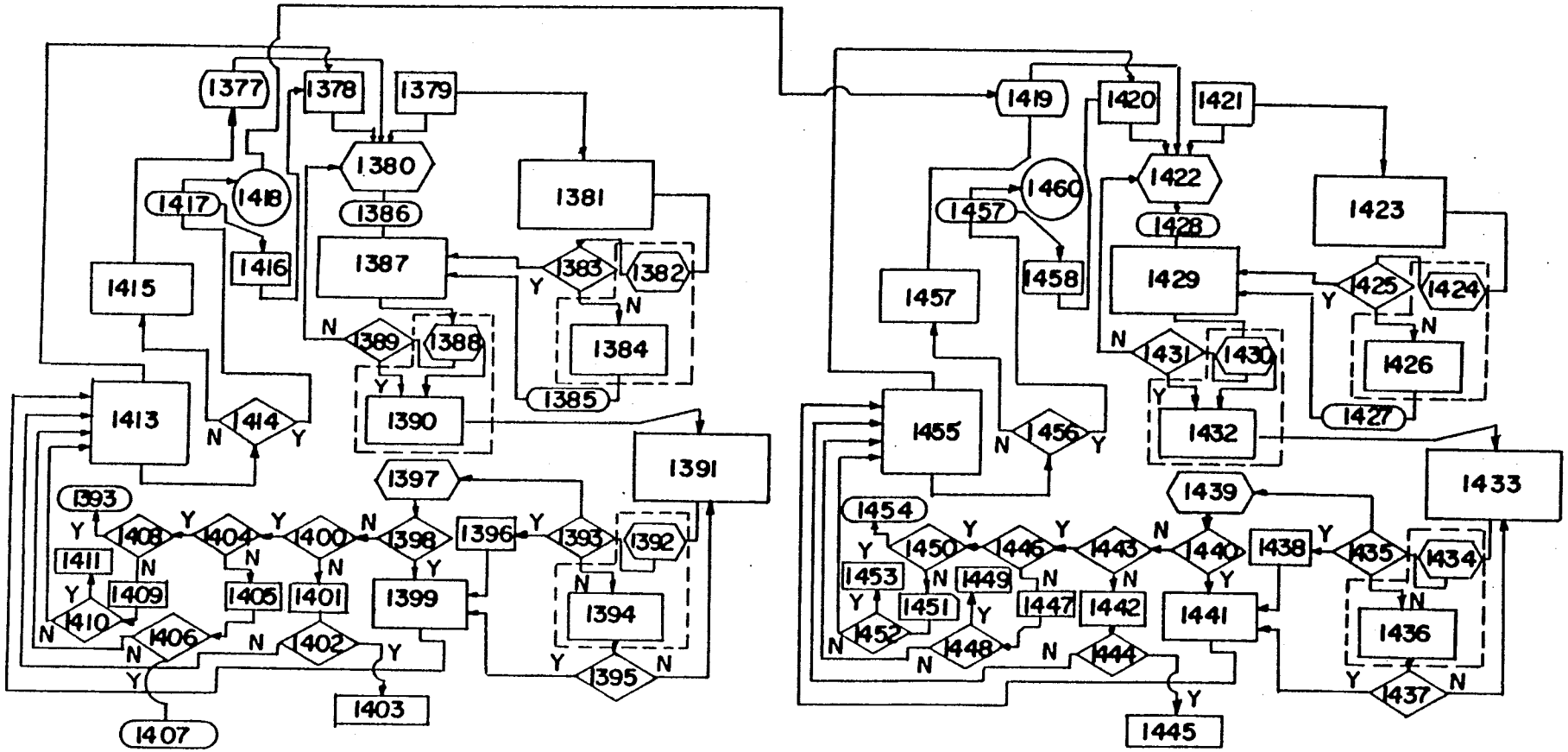
FIG. 54 is a concise flow diagram describing the operative programming of electropropulsive element systems embodies within the aforesaid device.
Figure 54A:
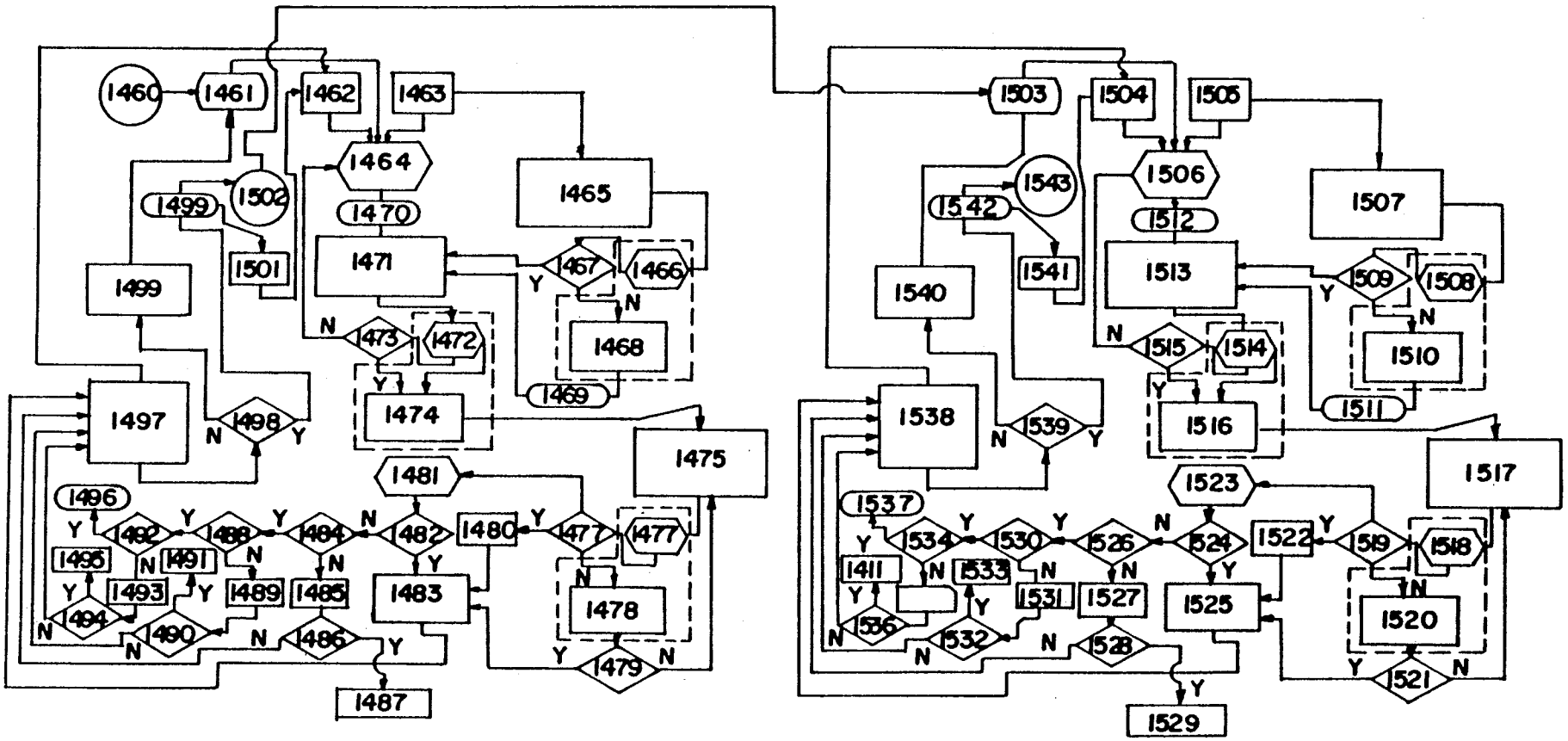
FIGS. 54*a*, 54*b* are continuations of the flow diagram represented in FIG. 54 describing the operative programming of electropropulsive systems embodied within the aforesaid device.
Figure 54B:
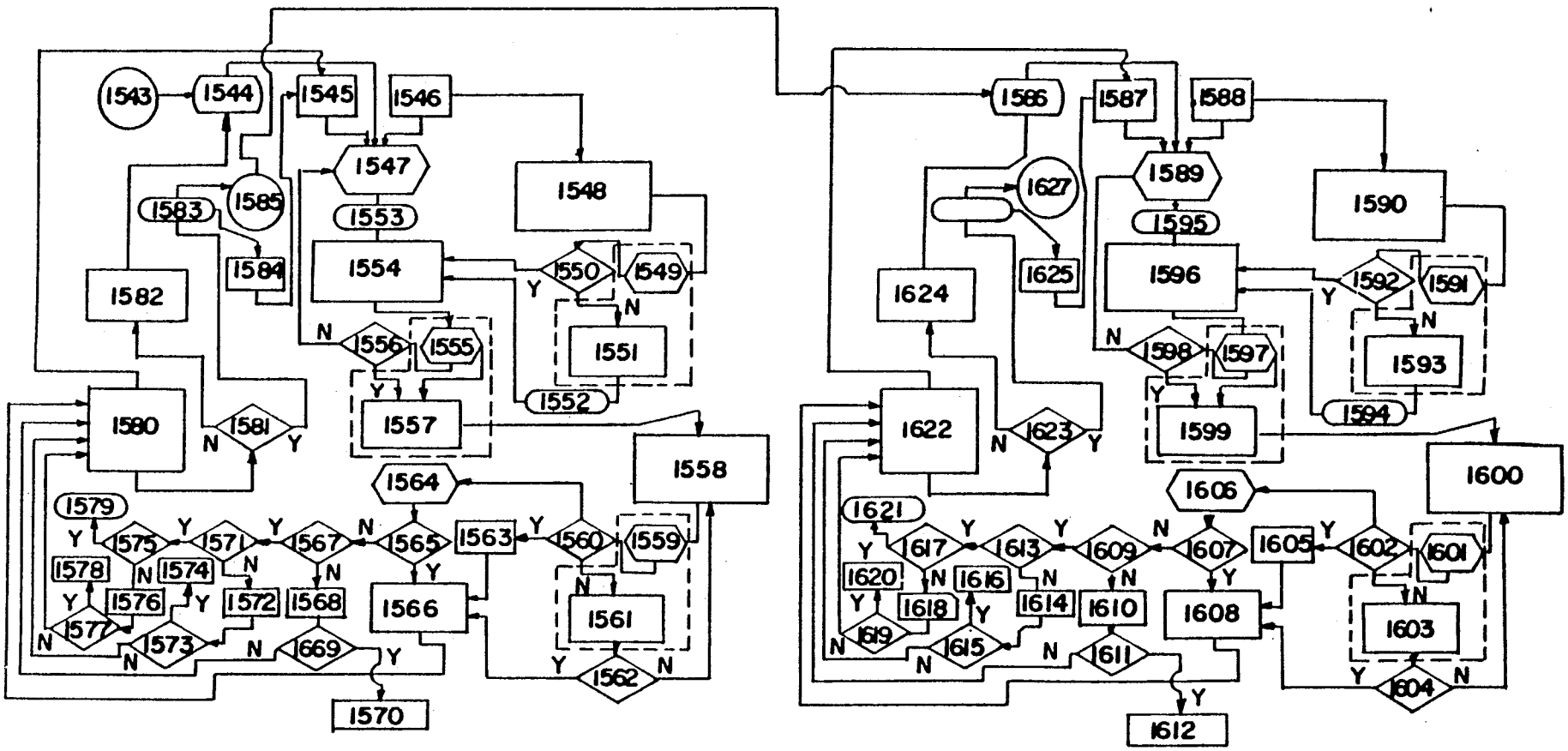
Figure 54C:
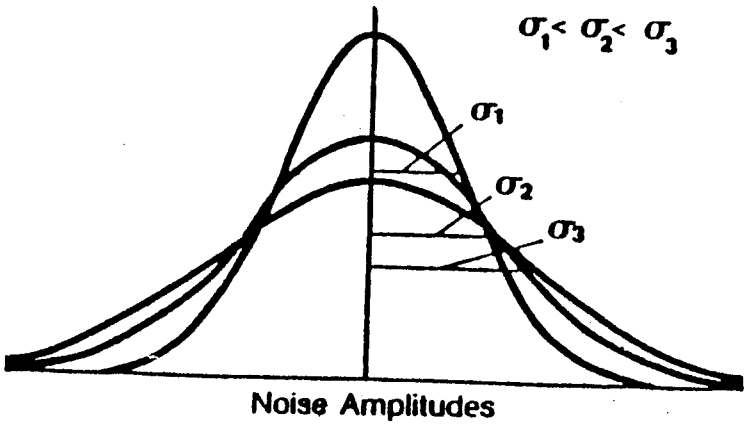
Figure 54E:
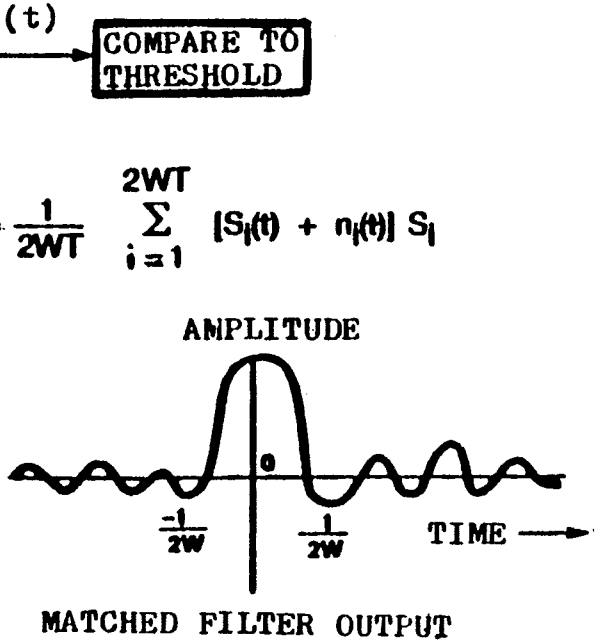

FIG. 54 is a concise flow diagram describing the operative programming of electropropulsive elements embodied within the aforementioned M.A.D. unit or device. Processes 1317 through 1418 are equivalent to processes 1419 through 1459, which are equivalent to processes 1460 through 1501, which are repetitive but applicable to other separate and distinct electropropulsive systems. Processes 1460 through 1501 are equivalent to processes 1502 through 1542 which are equivalent to processes 1543 through 1584 and processes 1585 to 1625, respectively. Processes 1585 to 1625 are repetitive and equivalent to processes 1317 to 1584; however processes 1585 to 1625 are indicative of the program for the terminal or finite electropropulsive system embodied within the aforesaid device. FIGS. 54*a*, 54*b* entail programming steps which are equivalent those described in the preceding FIG. 54. FIGS. 54 through 54*b* are equivalent to FIGS. 53, 53".

FIG. 54*c* to 54*h* describe the properties of white noise, the ambiquity function, the output of coherent and multi-element line array detectors and active/passive system performers associated with full linear wave detection, respectively. FIGS. 54*b* through 54*f* are clearly labeled and readily understandable to those skilled in the art.

Figure 55:
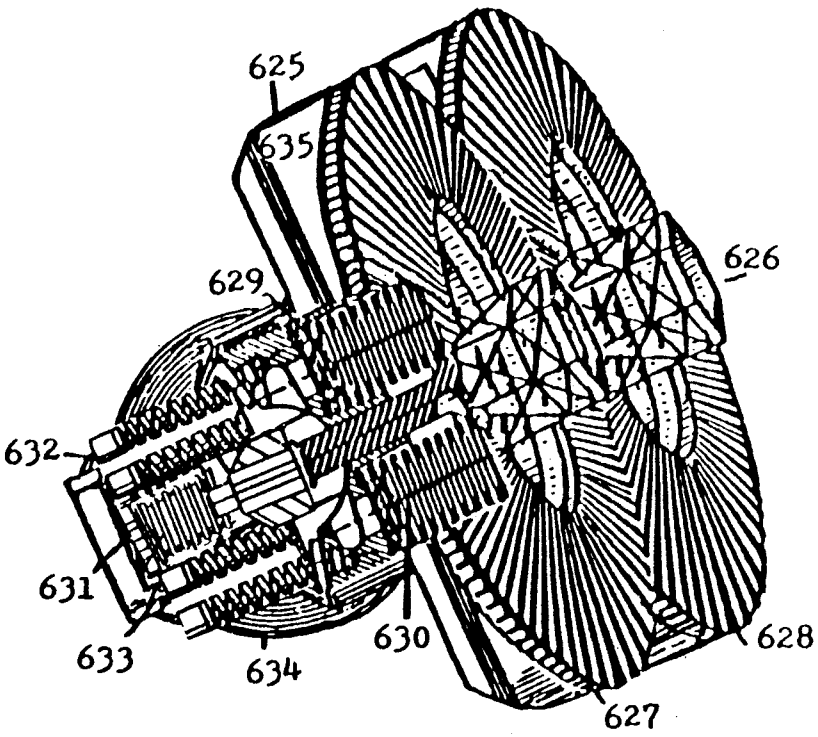
FIG. 55 exemplifies one of several piezoelectric sonic dispersal units utilized for echo/detection and target decoy simulation.

FIG. 55 is a detailed sectional view of the sonic resonating cavity of a single acoustic generating means. The operative parameters of the sonic generating means is designated by numeral 1626. Operation of unit 1626 can be effectively illustrated by several simplified field equations. It has now become necessary to recite some basic field equations which are related to the conduction or transmission of sound. They are discussed only in part in the mathematical expression contained herein below:

Far field sound pressure generated by a source is described in terms of radiated acoustic power Pa such that, $$P^2(r,\phi,\theta \int_{0-\infty}^{0-\pi} \frac{pcPaDiR(\phi,\theta)}{4\pi r^2}$$

$P^2$ (r,$\phi$,$\theta$) is the mean square acoustic pressure in pascals; and r, $\phi$, $\theta$ is equivalent to spherical coordinates. r is meters, whereas pc is equivalent to the product of density of the speed of sound of a given medium. In other words the acoustic impedance of the medium in (N)5/$n^3$; R($\phi$, $\theta$) a normalized pattern function. Di is equivalent to the directivity factor of a source which is defined as, $$\frac{1}{Di} = \frac{1}{4\pi r_o^2} \int\int \frac{P^2(r,\phi,\theta)}{Po^2} dS$$

Po is defined as distance $r_o$ in the direction of maximum response, and the value dS is equivalent to the element of surface area on a spheriod having a radius $r_o$.

Normalized beam patterns may be deduced graphically by the plotting of 10 log $P^2$ ($\phi$, $\theta$k) versus $\theta$ for a particular value of $\phi=\theta$k by dividing or factoring the equation $P^2$ (r,$\phi$,$\theta$) by the square of the input impedance $r^2$ such that, $$\frac{P^2(r,\phi\theta)}{I^2} = \frac{PcDiR(\phi\theta)}{4\pi r^2} Re \frac{Pa}{Pe}$$

Pe is equivalent to the electrical input power administered to the transducer means in Watts, Re is equivalent to the electrical input resistance of the transducers and both are related to the intrinsic vibrational frequency of the said transducer means.

The current transmitting response which is denoted by 20 log So, is expressed in the mathematical expression herein below:

$$20 \log So = 10 \log Re + 10 \log Di + 10 \log Nea + 170.8$$
(dB re 1 $\mu$Pa/A at 1 ml.

10 log Di describes the directivity index ND, or the gain of the transducer, whereas Nea=Pa/Pe.

If the reaction of a medium is on the moving surface of the transducer it is assumed that the vibrating surface has a velocity $\mu$, and that the surface exerts a force Fr on the transmit medium (i.e. water, air or a lattice configuration) on the moving surface of the source is −Fr, the radiation impedance Zr can be expressed such that, $$Zr = \frac{-Fr}{\mu} = Rr + j\,Xr$$

Rr describes the radiation resistance and Xr is equivalent to radiation reactance. Upon simplification in a linear system consisting of a continuous, the value of Zr is frequency dependent and is a constant at a constant frequency.

If the radiation impedance can be exacted the mathematical estimate of acoustic power can be expressed as, $$Pa = \tfrac{1}{2} U^2 \text{ peak } Rr = U_{rms}^2 \, Rr$$

The radiation impedance for a simple ridges piston, or radius a, in a infinite baffle can express its radiation impedance as, $$Z = \pi a^2 pc \left[ 1 - \frac{J1\ 2Ka}{Ka} + J \frac{S_1\ (2\ Ka)}{Ka} \right]$$

where J denotes a Besel function and S is equivalent to Struve function.

If a spheroid of radius a, is the source radiator then the radiation impedance can be described by the expression $$Z = \frac{4}{3} \pi a^2 pc \frac{(Ka)^2 + jKa}{1 + (Ka)^2}$$

$$Z = \frac{4}{3} \pi a^2 pc \frac{(Ka)^4 + jKa(1 + K^2 a^2)}{4 + (Ka)^4}$$

The nature of equations governing piezoelectric materials in regards to transduction has already been described earlier by the following equations, $$S = S^E T + dE$$
$$D = dT + \epsilon^T E$$
$$S = S^D T + gD$$
$$E = -g^T + B^T D$$
$$d = \left(\frac{\partial S}{\partial E}\right)_T = \left(\frac{\partial D}{\partial T}\right)_E$$
$$g = \left(\frac{-\partial E}{\partial T}\right)_D = \left(\frac{\partial S}{\partial D}\right)_T$$

Numeral 1627 designates a metallic quartz crystalline piezoelectric generating means. Numerals 1628 and 1629 represent two separate and distinct charging plates. The charging coils for the plates 1628 and 1629 are denoted by elements 1630 and 1631. Numeral 1632 denotes a pulse generator means, and many suitable commercially available units can be acquired. Numerals 1633 and 1634 describe cross sections of electro-optical transducers and proportional coolant means. Element 1635 designates an articulating joint socket means, which is capable of rotating the entire unit 360 degrees of arc in any one of three directions. Numeral 1636 designates an outer peripheral parabolic dish structure for concentrating the amplified sound means towards a target loci.

Figure 55A:
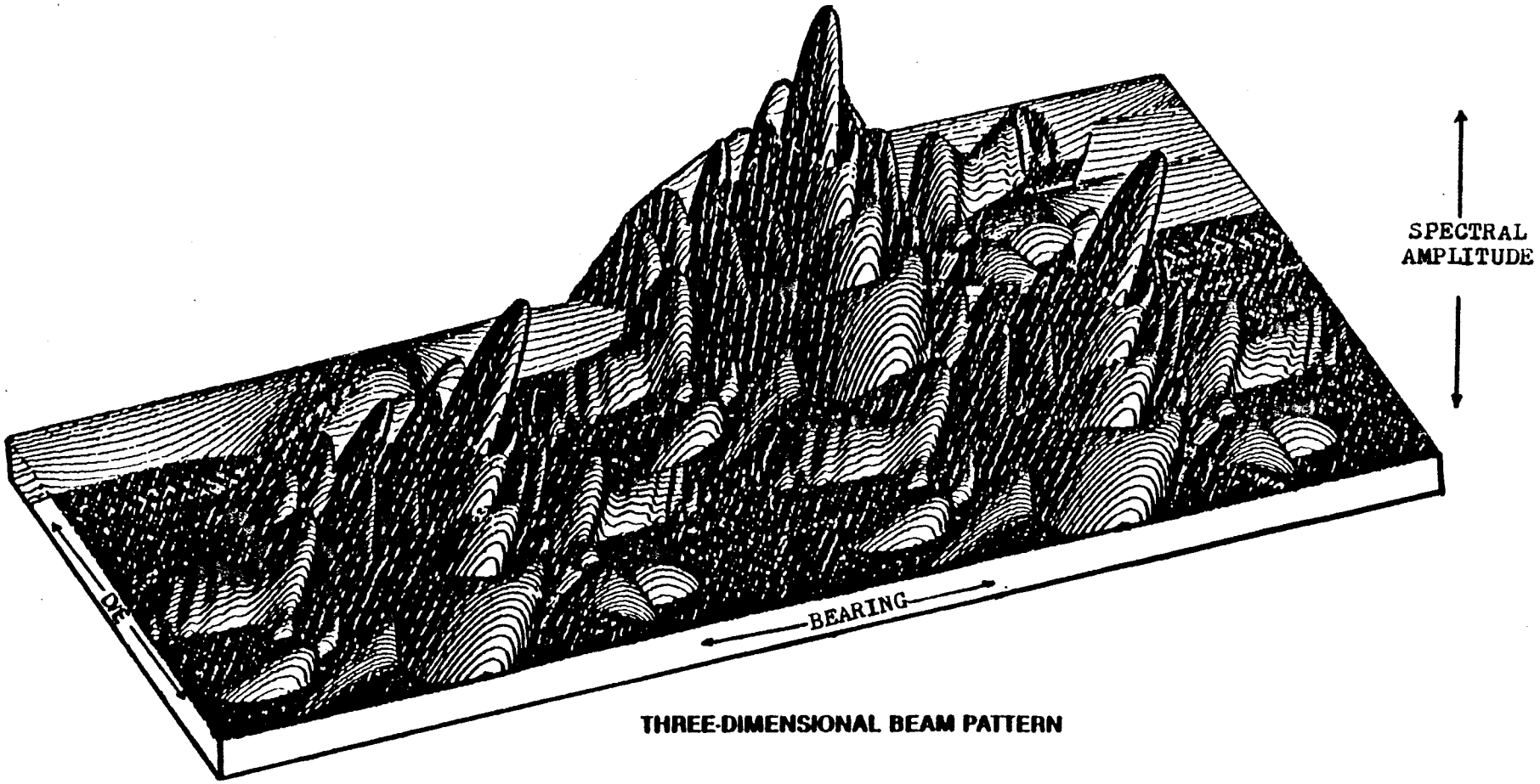
FIG. 55*a* is indicative of a three dimensional beam generated by the above mentioned sonic dispersal unit.

FIG. 55*a* indicative of a three dimensional beam pattern generated from the piezoelectric unit described in FIG. 55. The distance, speed, size and type of target can be precisely ascertained by the confirmation, size, inclination and separation of the peaks and vallies generated by the said target. Sound waves are generated in a typical manner and returning signals reflected from an object are processed in a manner well understood by those skilled in the art wherein Fast Fourier transformation, the central limits theorem and general principles of orthagonality are applicable. A number of properly placed equivalent acoustical units can similarly be utilized to generate and subsequently project acoustical images of easily recognizable vessels in an effort to either evade or confuse enemy detection. Phantom acoustical profiles are exacted from a repertory of stored information contained within the basic embodiment of the microcomputer complex. Both sound imaging and acoustical projections are readily understood and practiced to some extent by those skilled in the art and familiar with the central limits theorem, Fast Fourier transformations and principles of orthagonality. The numeric values which would otherwise be assigned to each one of the three dimensions of the acoustigram depicted in FIG. 55*a* are intentionally removed, in order to perserve a sense of generality. A fraction of the equations necessary to formulate audio acoustical imaging are briefly defined by the simplified equations contained herein below;

Laplace transform: $g(t)$, a time function $$G(s) = L[g(t)] = \int_0^{\infty} g(t)\ e^{-st}dt$$

$s = \sigma + jw$ (a complex variable)
Fourier transform, if it exists:

$$G(w) = F(g(t)) = \int_{-\infty}^{\infty} g(t)\ e^{-jwt}dt$$

Inverse Fourier transform:

$$g(t) = \frac{1}{2\pi} \int_{-\infty}^{\infty} G(w)\ e^{-jwt}dt$$

Fourier Series (periodic data):

$$g(t) = \sum_{-\infty}^{\infty} C_n\ e^{-j2\ nt/T} \quad -\infty \leqq t \leqq \infty$$

$$n = 0 \pm 1, \ldots$$

where:

$$C_n = \frac{1}{T} \int_{T/2}^{T/2} g(t)\ e^{-j2\ nt/T}$$

$T$ = period of repetitive signal
$Z$ Transform (Discrete Data Set $g(kT)$)

$$G(Z) = Z[g(kT)] = \sum_{k=-\infty}^{\infty} g(kT)\ (e^{-sTk}).$$

The substitution $e^{-sT}=Z$ maps the complex variable s into the complex variable Z, and $$G(Z) = \sum_{k=-\infty}^{\infty} g(kT)Z^{-k}.$$

Then, to find the frequency response, set $Z=e^{-jwT}$ $$G(Z - e^{jwT}) = \sum_{k=-\infty}^{\infty} g(kT)\ (e^{-jwTk})$$

To compute the sampled spectrum directly, set $w=2r\pi f$ and note that $T\Delta f=1/N$. Then the Sampled Discrete Fourier Transform is expressed as:

$$G(r) = \sum_{k=0} g(kT)\ (e^{-j\frac{2\ rk}{N}}$$

where $w = \frac{2\pi r}{NT}$ and

-continued $$r = 0, 1, 2, \ldots N - 1.$$

Figures 56, 56A, 56B, 56C:
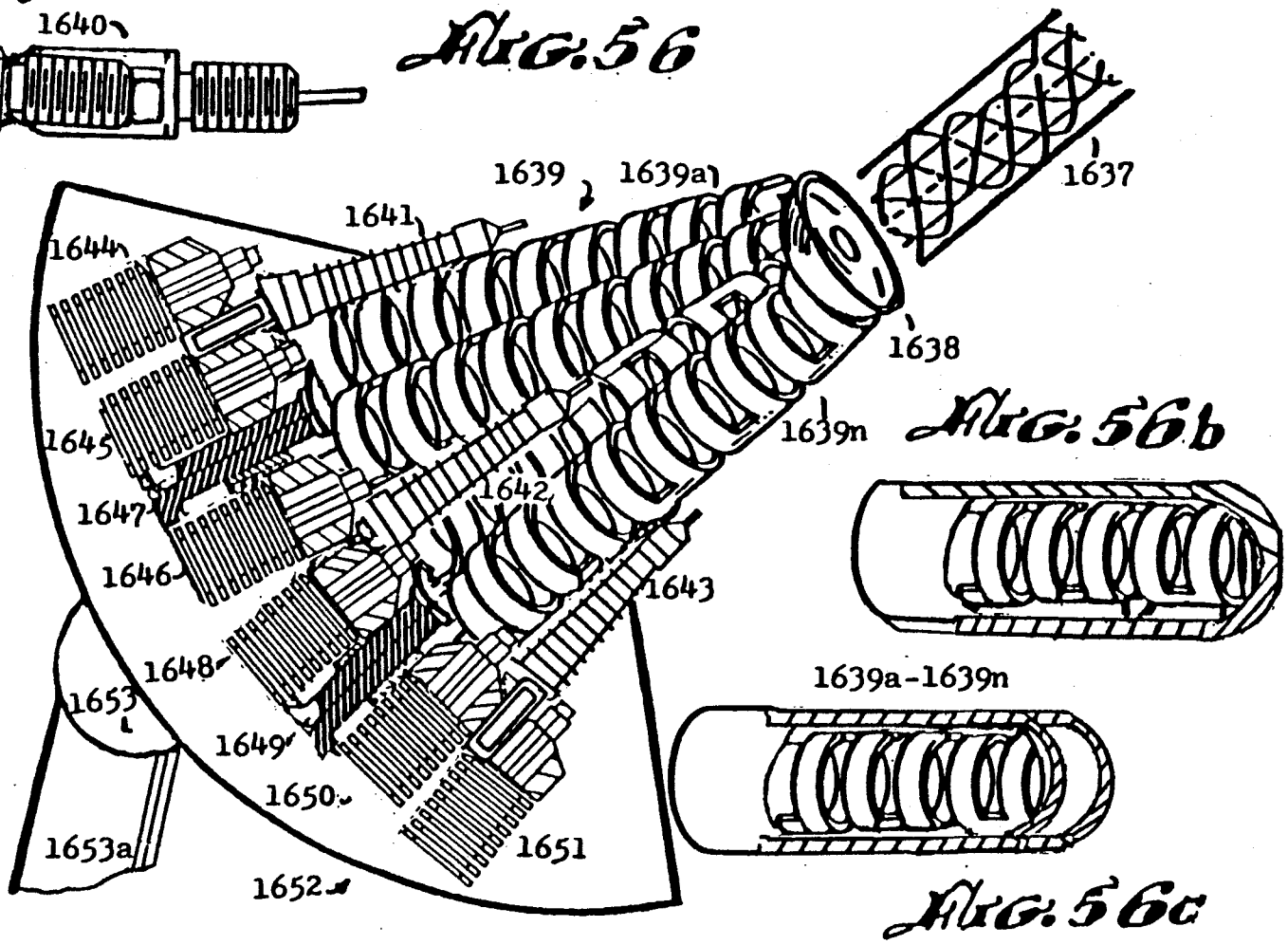
FIG. 56 entails a concise sectioned perspective of a single radiofrequency means utilized for thermal induction.

FIGS. 56 through 56*c* are detailed sectioned views of a high energy (ehf) radio-frequency device. Emission 1637 is emitted from targeting centroid dish element 1638 which aids the collimate source generations traveling in a series of wave guides as described collectively by numeral 1639. Numerals 1639*a* through 1639*n* are equivalent wave guide means arranged in a specific geometric manner as to project a tight beam emission. Elements 1641, 1642 and 1643 are representative of separate individual radiofrequency coils, each with a distinct terminus located along the central axis of each separate wave guide. Numeral 1640 designates a single radiofrequency coil with an extended terminus. Numerals 1647 and 1649 denote internally structural support means for parabolic dish structure 1652. Elements 1644, 1645, 1646, 1648, 1650 and 1651 denote separate charging coils for the radiofrequency coil means. Numeral 1653 describes a single articulating socket joint means which is in between support column 1653*a* and dish 1652 which provides the necessary 360 degree rotation in three directions which are needed by means 1652 to further orientate emission 1637. Some commercially available oscillators provide for Sine wave oscillations in either one of two ways which can be described by the greatly simplified circuit equations contained herein below;

$$\left(\sqrt{\frac{L}{C}}\ \frac{1}{Riv} + 2\right) > \sqrt{\frac{C}{L}} > R > \left(\sqrt{\frac{L}{C}}\ \frac{1}{Riv} - 2\right)$$

$$\alpha = -\frac{1}{2}\left(\frac{1}{Riv\ C} + \frac{R}{L}\right)$$

and $$w = +\sqrt{\frac{R + Riv}{Riv\ L\ C} - \alpha^2}$$

for oscillator build up $\alpha>0$ for stable oscillator amplitude $$a=o$$

for delaying oscillation or for $$\left(\sqrt{\frac{L}{C}}\ \frac{1}{R} + 2\right) > \sqrt{\frac{C}{L}}\ Rit > \left(\sqrt{\frac{L}{C}}\ \frac{1}{R} - 2\right)$$

$$\alpha = -\frac{1}{2}\left(\frac{1}{RC} + \frac{Rdc}{L}\right)$$

$$w = +\sqrt{\frac{R + Ric}{R\ L\ C} - \alpha^2}$$

From the Aperture Admittance Theory the normal input admittance of the general aperture antenna can be expressed as, $$y = g + jb = c \int_0^{\infty} [F_{TE}(\beta)\, GTE(\beta) + F_{TM}(\beta)\, G_{TM}(\beta)]_{\beta d\beta}$$

T E and T M refers to part of the solution which is derived from a single transverse electric or transverse magnetic field vector potential in an external medium.

$F_{TE}(\beta)$ and $F_{TM}(\beta)$ are Fourier transformations of the aperture field. Functions $G_{TE}(\beta)$ and GTE $(\beta)$ are normalized solutions to the wave equations in an outside media.

Surface Waves concerning dielectric along axis $\beta$, wherein dielectric covered antennas for variable wave guides are available and may be symbolically denoted as $$\begin{aligned} y &= (gr + gs) + ibr \\ &= C \int_{\beta=0}^{\beta=1} F_1(\beta) d\beta + C \int_{\beta=1}^{\beta=N} F_2(\beta) d\beta + \\ &\quad C \int_{\beta=N}^{\beta=\infty} F_3(\beta) d\beta \end{aligned}$$

The region inside $\beta$ is evaluated by using the theorem of complex variable theory and the poles are given by the values $$TE \text{ modes: } j\sqrt{N_2^2 - \beta n} = \sqrt{N_1^2 - \beta^2 n}\, \cot(Kod\sqrt{N_1^2 - \beta^2 n})$$

$$TM \text{ modes: } -jN_1^2\sqrt{N_2^2 - \beta n} = \sqrt{N_1^2 - \beta^2 n}\, \tan(Kod\sqrt{N_1^2 - \beta^2 n})$$

and as a result of losses incurred by the dielectric so that the radiation aperture conductance gr, the aperture susceptance br, and aperture surface wave conductance gs can be described by the following mathematical equations $$gr = C \int_{\beta=0}^{\beta=1} F_1(\beta)\, d\beta$$

$$gs = C\pi i \Sigma \text{ residues}$$

$$br = C \int_1^N F_2(\beta) d\beta + C \int_N^{\infty} F_3(\beta) d\beta$$

Figure 57:
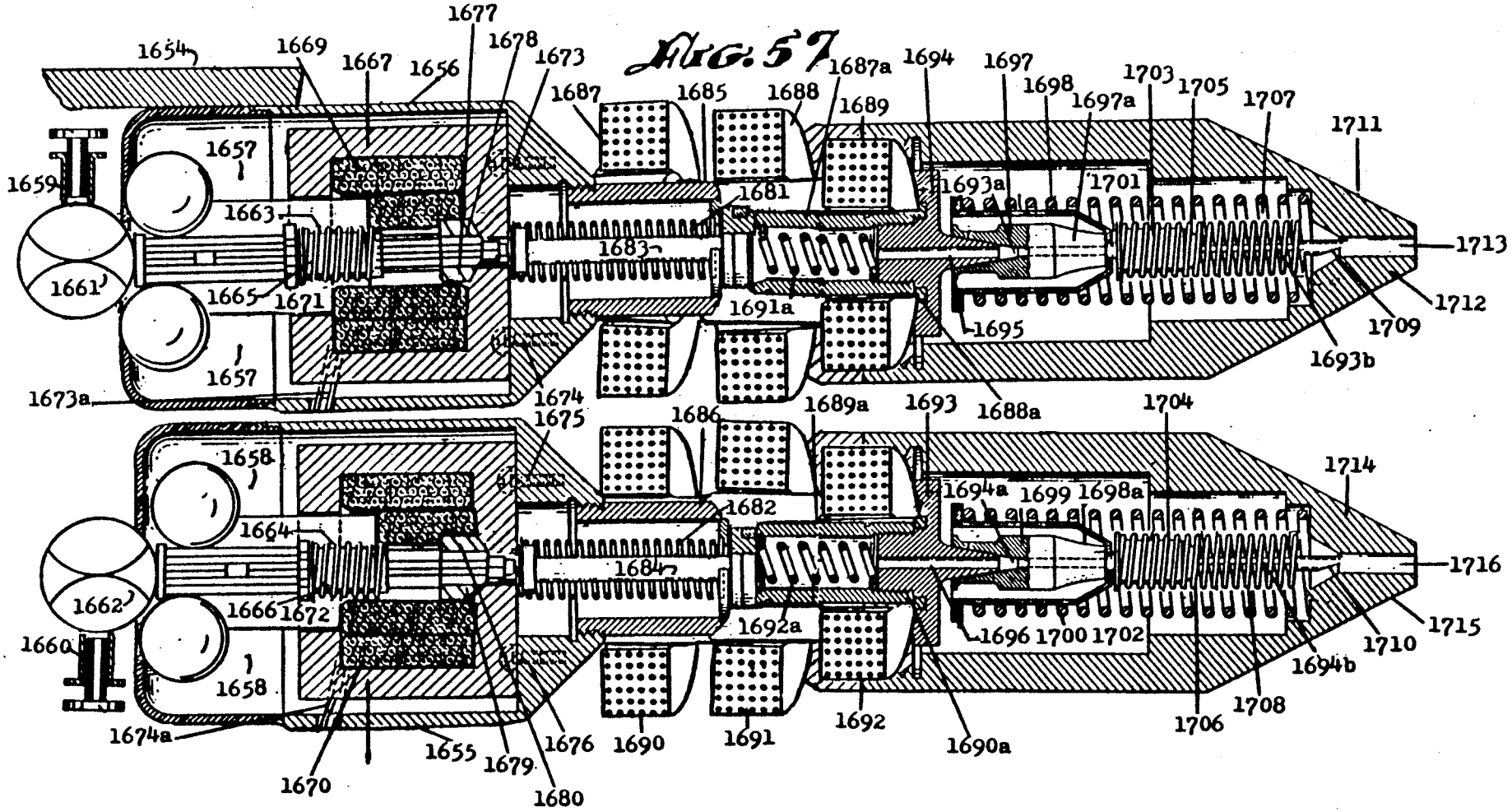
FIG. 57 entails a concise detailed cross-section perspective view of a Plasma Discharge Weapon.

FIG. 57 entails a concise detailed cross-section-perspective view of a Plasma Discharge Weapon. Said Plasma Discharge Weapon, also described as P.E. Weapon is an energy matter state beam generator projecting one or several beams of charged plasma, which intersects within centroids initiating a point exothermic explosion within said centroids. The aforesaid exothermic explosion occuring within said centroid resulting from kinetic impact, thermal dispersion and charge particle annihilation. The region surrounding said target centroids undergoes radial distruption as said point explosion denotes radially outward. Numerals 1654, 1655 and 1655 and 1656 of FIG. 57 denotes the outer and inner casing of the P.D. Weapon. The separate reserviors supplying plasmitizible substance are described by numerals 1657, 1658 and said reserviors are coupled to secondary supply reserviors, now shown, by automated inlet valular elements 1659, 1660. Said inlet valves are coupled to automated pump means 1661, 1662; which are additionally coupled to circumferential radiofrequency elements 1663, 1664. The aforesaid automated pumps 1661, 1662, concentrates the plasmatizable substance into a compressed stream passing through tubular elements 1665, 1666 are superheated by radiofrequency coils 1663, 1664 prior to exiting said tubular. Numerals 1667, 1668 corresponds to two sumarian cobalt piezoelectric transformers which deliver current to Tesla coils 1669, 1670, which are circumferentially disposed around electromagnetic cores 1671, 1672. Cables 1673*a*, 1674*a* supply power transformers elements 1667, 1178. Positive and negative terminals from transformers 1667, 1668 are designated by numerals 1673, 1674 and 1675, 1676 respectively. Terminals 1677, 1678 and 1679, 1680 are cathods and anodes which produce the electrical arc which converts said plasmatizible substances into plasma. Electromagnetic coil means 1681, 1682 depending on its polarity converts the individual plasmoids of the aforesaid plasma into a charged stream of either positive or negative ions, which travel down channels 1683, FIG. 57 entails a concise detailed cross-section-perspective view of a Plasma Discharge Weapon. Said Plasma Discharge Weapon, also described as P.D. Weapon is an energy matter state beam generator projecting one or several beams of charged plasma, which intersects within centroids initiating a point exothermic explosion within said centroids. The aforesaid exothermic explosion occuring within said centroid resulting from kinetic impact, thermal dispersion and charge particle annihilation. The region surrounding said target centroids undergoes radial distruption as said point explosion denotes radially outward. Numerals 1654, 1655 and 1665 of FIG. 37 denotes the outer and inner casing of the P.C. Weapon. The separate reservoirs supplying plasmitizible substance are described by numerals 1657, 1658 and said reservoirs are coupled to secondary supply reservoirs, not shown, by automated inlet valular elements 1659, 1660. Said inlet valves are coupled to automated pump means 1661, 1662; which are additionally coupled to circumferential radio-frequency elements 1663, 1664. The aforesaid automated pumps 1661, 1662, concentrates the plasmatizable substance into a compressed stream passing through tubular elements 1665, 1666 are superheated by radio-frequency coils 1663, 1664 prior to exiting said tubular. Numerals 1667, 1668 corresponds to two sumarian cobalt piezoelectric transformers which deliver current to Tesla coils 1669, 1670, which are circumferentially disposed around electromagnetic cores 1671, 1672. Cables 1673*a*, 1674*a* supply power transformers elements 1667, 1668. Positive and negative terminals from transformers 1667, 1668 are designated b numerals 1673, 1674 and 1675, 1676 respectively. Terminals 1677, 1678 and 1679, 1680 are cathods and anodes which produce the electrical arc which converts said plasmatizible substances into plasma. Electromagnetic coil means 1681, 1682 depending on its polarity converts the individual plasmoids of the aforesaid plasma into a charged stream of either positive or negative ions, which travel down channels 1683, 1684. Elements 1677 through 1684 are embodied within casing elements 1685, 1686 which act as extended cathods or anode elements respective to said electromagnetic coil means 1681, 1682. Numerals 1687, 1688 and 1689 and 1690, 1691 and 1692 are sumarian cobalt electromagnetic elements circumferentially disposed around said channels and casing 1685, 1686. Said electromagnets function to assist in constructing the field surrounding charged streams of plasmoids and thereby to concentrate or focus on said streams. The flow of said plasma is further constricted by deflection plate 1687, 1688, 1689*a*, 1690*a* and circular deflection coils 1691*a*, 1692*a* respectively. Channels 1683, 1684 open into channels 1693, 1694, which are encapsulated by non-conducting elements 1695, 1696 and circular deflection coils 1697, 1698, 1699 and 1700. The bore of said channels 1693, 1694 is physically constricted by channels 1693*a*, 1694*b* and circular deflection coils 1697*a*, 1698*a*. Secondary Tesla coil means 1701, 1702 provide additional means by which said plasma is sustained and propagated in an energetic state. The plasmoids flow from 1693*a*, 1694*a* into compression chambers 1703, 1704 which are coupled to channels 1693*a*, 1694*a* distally and 1693*b*, 1694*b* proximally. Radio-frequency means 1705, 1706 are circumferentially disposed around said compression chambers 1703, 1704 and channels 1693*b*, 1694*b*. Elements 1693*a* through 1706 are circularly disposed within induction coils 1707, 1708 which provide radial excitation to said plasmoids being accelerated linearly towards exit bore 1709, 1710. Numerals 1711, 1712 denotes two of four automated deflection plates linear and circumferentially disposed around exit bore 1709 and in common with the muzzle element described by 1713. Numerals 1714, 1715 denote two of four automated deflection plates linear and circumferentially disposed around exit bore 1710 and in common with the muzzle element described by numeral 1716. Said automated deflection plates function to deflect beams of positive and/or negative charged plasma exiting from bores 1709, 1710 to intersect at some predetermined points disposed within specified target centroids or adjacent to said controls.

The remainder of this patent disclosure will deal with targeting, energy weapons and the secondary logistics of collimating, focusing and direction beams generated by said energy weapons onto one or more target centroids. Said energy weapons will includes but not be limited to Chemical combustion lasers, Excismers, Megapulsars and synchrontron devices. Automated photon and charged beam focusing elements are the aforesaid secondary logistics and will be discussed in the foregoing disclosure.

Figure 58:
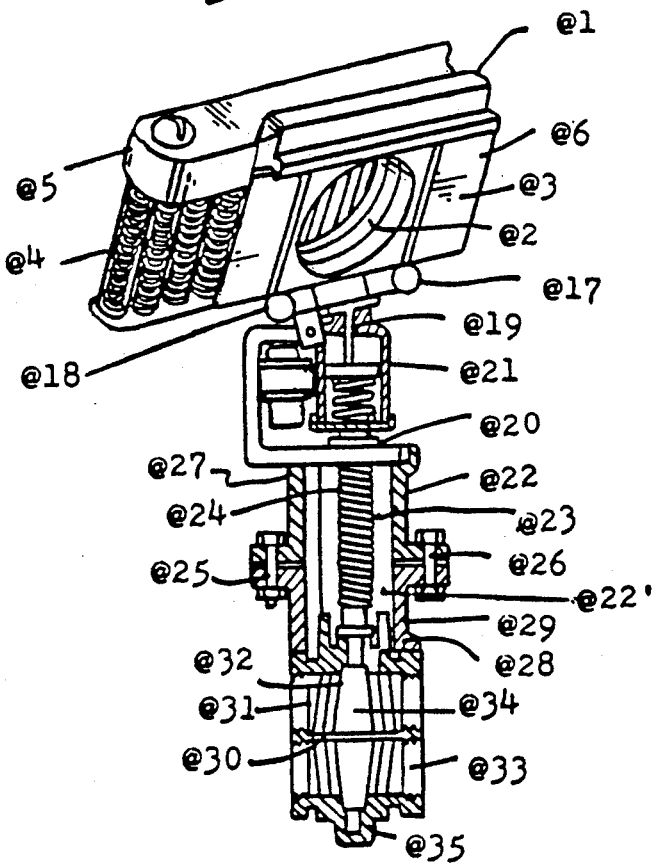
Figure 58:
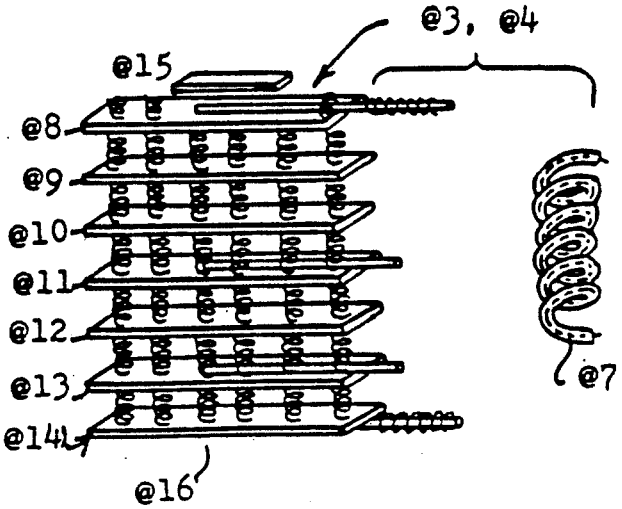

FIGS. 58 through 58*a*′ are cross-sectioned views of one of several automated beam splitter units deployed to direct one or more emission beams. Unit @1 includes a prisimatic dielectric mirror element @2 and a pair of thermal conveying plates @3 and @4. Mirror @2 is coated with suitable dielectric compound well known to those skilled in the art, capable of altering optical opacity to a slight degree and being selectively emissive. The wavelength characteristics of mirror @2 are selectively adjustable based on the coating and dielectric charge in contrast to conventional beam splitters having fixed characteristics. The thermal plates @3, 169 4 are composed of suitable thermal material that have the capability of transmitting heat from element @2 along its circumferential rim to layered plates @5, 169 6 comprising heat dissipation means formed of microcoiled miniature helical tubules functioning as heat exchangers. Each helical tubule @7 transverses the length and breadth of plate elements @3, 169 4 and elements @11 through @16 comprising a plurality of microplates and helical microtubules forming heat exchange elements, as disclosed in FIG. 58′.

Dielectric mirror @2 is chargeable to increase optical opacity by a capacitance unit @17 and undergoes decreases in optical opacity when discharged by capacitance unit @18. A vertical angular socket joint @19 is provided to rotate the entire plate housing holder @1 vertically through 180 degrees of arc. A rotating shaft element @20 rotates the unit @1 horizontally through 360 degrees of arc and is secured to a sleeve @21 in which it is inserted through an outer casing @22.

Outer casing @22 includes a threaded rotational channel @22′ in which a threaded member @23 turns shaft @24. Bolts @25, @26 fasten the outer casing halves @28, @29 and a common gasket @30 together. A chamber @31 is filled with a suitable low friction lubricant to decrease wear on a rotating ball bearing system @32. Ball bearing system @32 is attached to the internal mainframe by a series of stationary sleeves @33 acting for stabilizing the rotating shaft @20. A miniature synchronous D.C. motor @34 is reversible and programmed through a moderator @35. The software and sensor systems (not shown) (for the beam splitter means are preferably of a commerically available type well known by those skilled in the art.

Experimental results obtained from the operation of separate automated mirror elements indicate that under maximum laser bombardment there is an extreme propensity to undergo rapid deterioration. The average means operative life for a given mirror component is between 18,000 minutes to 24,000 minutes when subjected to a maximum bombardment of coherent radiation specifically from the short or long spectrum (i.e. 6–10 watts). The means operative life of a mirror element is defined as the duration of period of time in which the reflectivity is greater than or equal to 90.0 percent of the incident beam transmission. The reflectivity of a given mirror element undergoing deterioration is diminished by a factor of between 74.8 to 86.7 percent of its established norm. The process of deterioration here is defined as, the uneven wearing or pitting of surface structures extending to but not limited to the fracturing of the crystalline lattice structure. Fracturing of the lattice structure was almost eliminated by replacing the ridge lattice structure of quartz with a more amorphous configuration formed from a commerically available silicon nitride composite material. The composition of the composite material was varied in accordance with the type of coherent radiation and the intensity of the laser emission characterizing the incident beam. The advantages of utilizing the amorphous material is the property of the material to undergo annealing of fractures when subjected to intense radiation.

The reflective element of each automated mirror unit is provided with a means to automatically replace or renew reflective coating, which are decompensated by energetic coherent emissions. Mirror means subjected to rapid deterioration are automated to recoated and are resurfaced by several automated mechanisms and variations therein. The first means by which the reflective surface of a given mirror element is restored is by the electronic dispersal of charged reflective material, which are electroplated onto an otherwise optically emissive surface. The second method by which a decompensated reflective surface is restored requires the uniformed coating of reflective material from a circumferentially located collection channeled onto a differentially charged surface.

The mirror means defined by numeral @36, FIG. 58*a* consists of three or more elements which are designated by numbers @37, @38 and @39. The mirror means, number @36, consists of two outer chargeable layers @37, @38 which are circumferentially disposed abutting against a transparent insulatory layer defined by number @39. The reflective mirrored surface can be continuously replenished from materials contained within reservoirs as described by @40, @41, respectively. The primary reservoirs @42, @43 convey their contents through conduits @44, @45 into secondary reservoirs @46, @47. Solenoids @48, @49 release the highly reflective metallic coating medium formed from a suitable dielectric; whereas solenoids @50, @51 supply a flux element which assists the aforementioned dielectric medium to adhere to the surface. The reflective dielectric coating medium and said flux medium are designated by numerals @52, @53. If a solid based alloy of chromium is employed in the dielectric flux medium then the medium must be super-heated prior to flowing into a mixing channel described by element §54. Heating various metallic dielectric flux medium is accomplished by radiofrequency elements @55 through @56; which supplies heat directly to the casings of the reservoirs defined by means @57, @58 through @59. The contents from the secondary reservoir is emitted by flow channels @60, @61, which are controlled by flow governors @62, @63, respectively. The flow governors are valvular means controlled by solenoid means; not shown here, but described in FIG. 58*b*. The content from flow channels @65, @65', are released into mixing and distribution channel @66, which is a undirectional emittance slot or grove disposed circumferentially around the mirror element. A series of circumferentially disposed grids begin where channel @67 terminates. Elements @68 through @69 designate separate and distinct charge distribution grids, each unit being separated from the other by an insulatory element and specifically arranged to differentially charge portions of the reflective surface area. It is necessary to charge only certain portions of the surface area to be coated to provide an electro-motive force to the reflective medium allowing said medium to uniforly coat the surface against gravity or in conditions where zero gravity exists.

FIG. 58*a'* entails a cross-section of element @36, which consists of a grid, dielectric coatings and a suitable quartz emissive surface described by elements @67', @68 and @69, respectively.

Figure 58B:
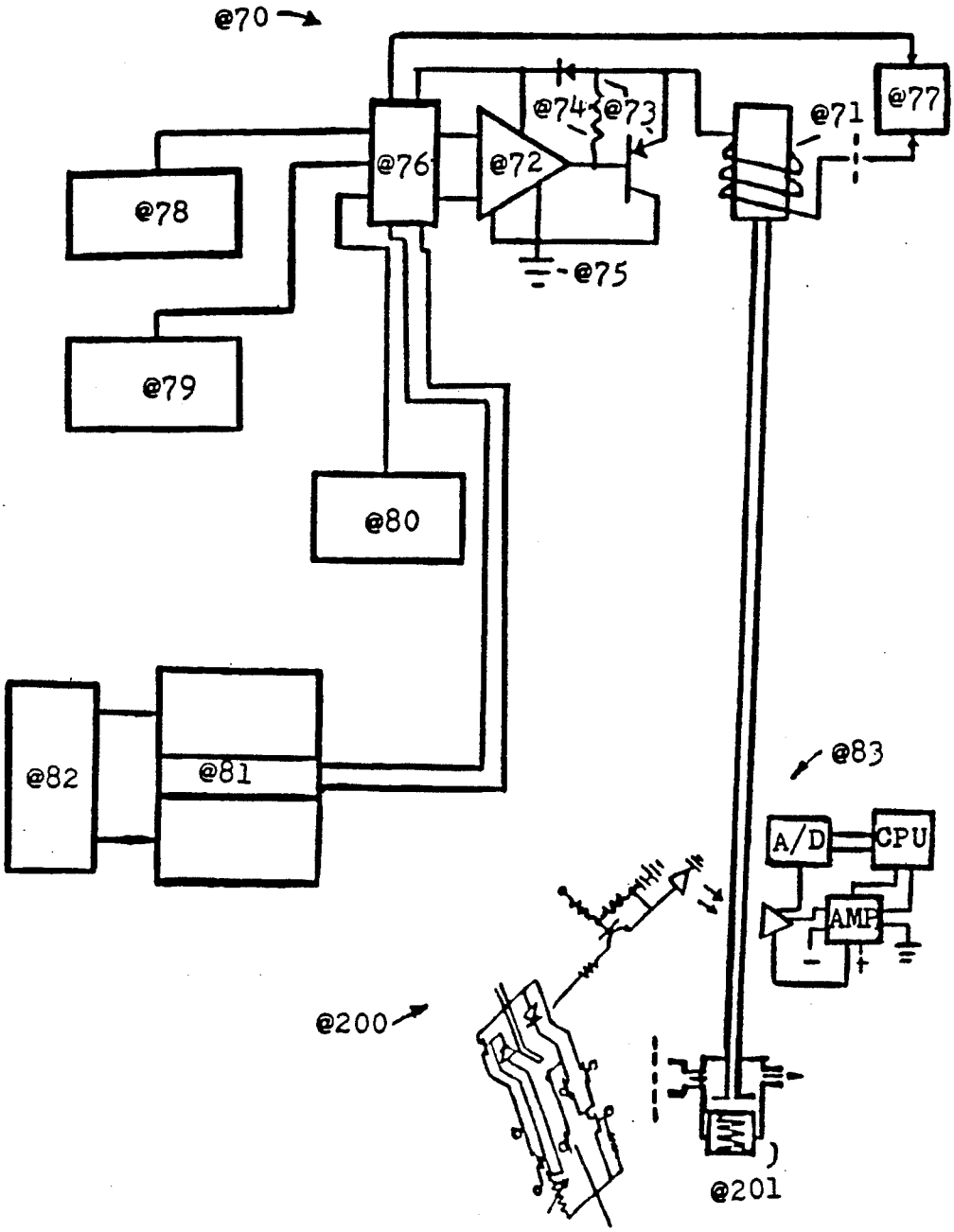
FIG. 58*b* discloses a mechanism by which restoration of decompensated reflective coatings are initiated within the automated mirror means.

FIG. 58*b* describes schematically the operation of the solenoid element controlling the flow of dielectric and flux through the said governor means. The entire circuit is assigned a single numeric value, defined by number @70. Numerals @71 through @75 designate one of several solenoid means, an integrated circuit means, a typical diode, resistive element and a ground means, respectively. A control and sequencer means, number @76 controls the input delivered to the solenoid circuit, the output delivered by the said circuit and the sequence in which one or more solenoids are actuated in order to perform a specific function. Other equivalent solenoid means of the sequence are illustrated by element @77. The position of fluid and solenoids indicated by element @200 as specified by laser diode, sensors and electrical contact means @201. The position of specified projectiles are provided by means @80 which also receives data from elements @78, @79. Element @81 is defined as a single mode static scan electro-optical array, which verifies the type of projectile by identifying the holographic encrypton pattern or code etched on the surface of the said projectile. Numeral @82 designates a counter latch and decoder unit for signal processing and locking mode. The internal scale factors alluding to logistics, range, dispersal patterns and other parameters are set by user based automode element @83.

Figure 58C:
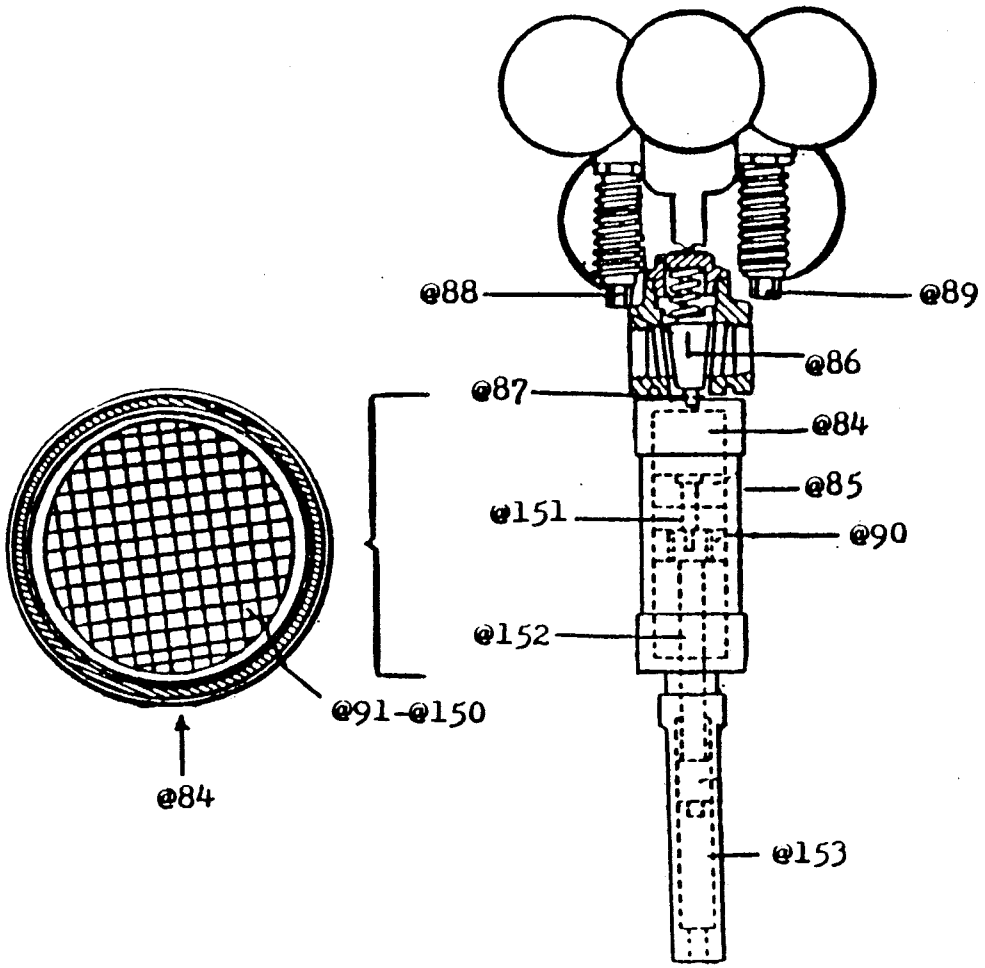
FIG. 58*c* described schematically the operation of the solenoid element regulating the flow of dielectric and flux.

FIG. 58*c* describes another mechanism by which the depleted or damage surface coating are replenished. The mechanism wherein a reflective coating is redistributed is a variation of an automated electroplating process. The mirror element @84 enclosed by an evacuated chamber means defined by element @85 and having incorporated within its case a miniature pump means described by numeral @86. The vacuum pump means @86, may or may not be attached via conduit @87 to a larger ancillary pump unit. A cathode and thermal induction means described by elements @88, @89 supply sufficient heat and current to a given reflective metallic, such as chromium to uniformly vaporize and disperse the said metallic onto charge surface @90. Elements §91 through @150 feed into a matrix grid @151 of anode means @152 to provide for fine electronically controlled distribution or dispersals of the reflective metallic onto surface @153 to be coated. Surface acts as the anode means in the electroplating process, which is irreversable. Remunants from the decompensated surface are either reformed or evacuated during the coating process. A laser scanning means defined in FIG. 58*c* determines whether or not substantial loss of reflectance has occurred or not. The laser means and sensory system are incorporated within the contexts of an automated feedback loop to be described later on in the specifications. The entire circuit for the sake of simplicity is assigned a single numeric value defined by @151, The laser emitter, and laser diode means are collectively described by numeral @152. The circuit disclosed herein is experimental, typical of a single substrate deposition; however similar such circuits are available from subsidiaries of Hitachi, Fairchild, Texas Instruments and others.

Figure 59:
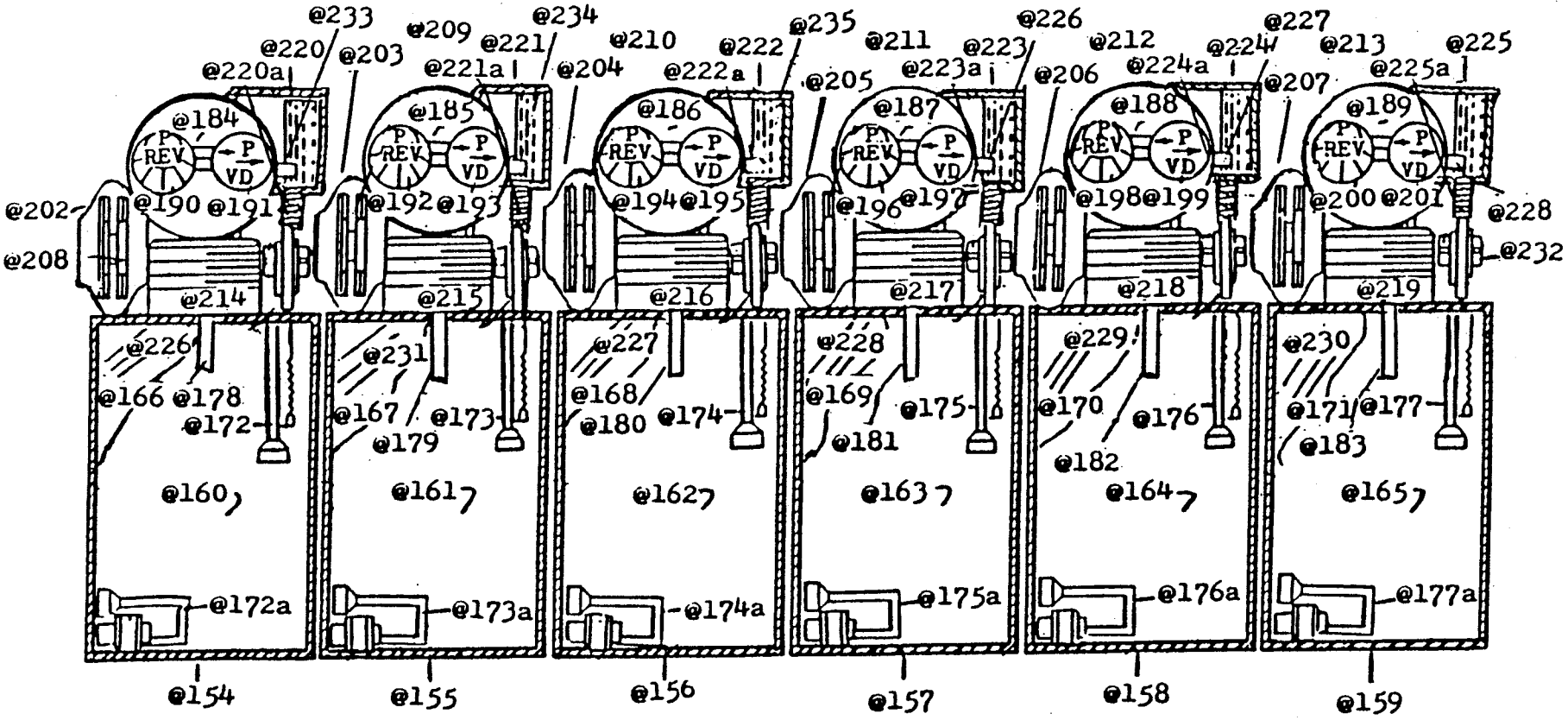
FIG. 59 entails a partially sectioned representation of a single composite kerr cell element detailing structure.

FIG. 59 entails a partially sectioned representation of a single composite kerr cell element detailing its structure. One or more of the aforesaid kerr cell elements are centrally disposed along the central axis of each emissive source. Said kerr cells operate on laser beam emissions and other optical emissive sources to alternate, modulate the frequency and alter the wavelength of the said beam source. Each composite kerr cell consists of electronically controlled channels filled with dyes which depend on which electro-optical switches are triggered within said kerr cell structure and which dye channels are illuminated by said beam. Each of the said channels include multiple optical fibers doped with trace substances so constructed as to alter the wavelength of said emissive beams by doubling its frequency of shifting spectral characteristics of the same. Each composite kerr cell element consists of no less than six dye cell channels as indicated by numerals @154 to @159. Each said channel is coupled with a optical switching cell described by units @160 to @165 respectively. Each said switch consists of a transparent quartz envelope numerals §166 to @171, containing a solution of nitrobenzene or a equivalent solution which when subjected to an electrical charge becomes optically opaque as in the case of nitrobenzene or optical emissive when other said substances are employed. A pair of charging electrodes described by elements @172 to @177*a* act as a cathode and anode element of each said cell. Each of the aforesaid switching cell element are coupled to and disposed aft of each channel element. Each of the aforesaid channels consist of a dye envelope, numerals @178 to ⅛183 are composed of quartz and a suitable dye cell medium. Trace additives or dopants such as, $Ba_2NaNb_5O_{15}$, lithium iodate can double or triple the wavelength frequency; whereas organic dye solutions or mediums can selectively shift the wavelength spectrum in a manner consistant with those well known by those skilled in the art. The aforesaid dye solutions are commerically available containing but not limited to p-Terphenyl in Cyclohexene having a lasing wavelength of 3410 Å, 7-Hyroycoumarin in $H_2O$ with a lasing wavelength of 4600 Å, Rhodamine 6 G is enthanol with a lasing wavelength of 5900 Å and/or similar dye solutions with either different or equivalent emissive wavelengths which are also commerically available and well known by those skilled in the art.

Numerals @184 to @189 of FIG. 59 describe the centrifugal pump element which functions to charge, circulate and replenish expended dye cell solutions contained within the aforesaid cells. Said pump elements consist of a forward and aft circulating section as described by elements @190 to @201. Units @202 to @207, designate stirling heat engine element which passively operates the aforesaid pump element previously described by units @184 to @189 and by the energy transduced from the heat absorbed directly from said dye solutions during laser bombardment. Heat exchanger plates §208 to @213, which conveys heat obtained from said dye cell solutions to accumulator elements @214 to @219 which conveys the thermal energy to said stirling heat engine wherein the thermal energy is converted into kinetic energy to operate said pump element. Expended dye solutions subjected to heat decomposition chemical breakdown or other factors during prolonged operation are pumped to holding receptacles @220 to @225 by conduits @220*a* to @225*a*. The content receptacles @220 through 225 are eventually conveyed through said conduits to a central regenerator unit described by numbers @226 to @232, wherein said dye solutions are reactivated by additives and catalytic substances well known to those skilled in the art prior to being reconveyed to their respective reservoirs described by elements @233 to @238. The aforesaid reservoirs convey or discharge their contents through conduits, which flow into the aforementioned dye cell channels. Solenoids, not shown, are the elements by which inlets and outlet valves are motivated to open and close for recharging, circulating, and discharging said dye cell solution from reservoirs, separate and distinct channels of said dye cells, circulating pump elements and regenerator means described previously in the specifications. The solenoid elements will be described in detail later on in the specifications are operated based on data derived from a feedback system consisting of sensors, a controller element a comparator means and logic circuits embodied within a microprocessor element which is well known and practiced by those skilled in the art. The aforesaid feedback system will be described further in detail later on in the specifications. A single automated beam splitter centrally disposed along the lasing central axis deflects the emissive beam to incident upon one or more dye cell channels of the aforesaid kerr cell elements. The aforesaid kerr cell elements are centrally disposed in between the initial automated beam splitter which directs said incident beam onto one or more channels of the aforesaid kerr cell and secondary automated beam splitter elements which direct, focus or collimates said beams onto separate and discrete surface embodied within linear arrays contained within the aforementioned focusing and/or directing element.

Figure 59A:
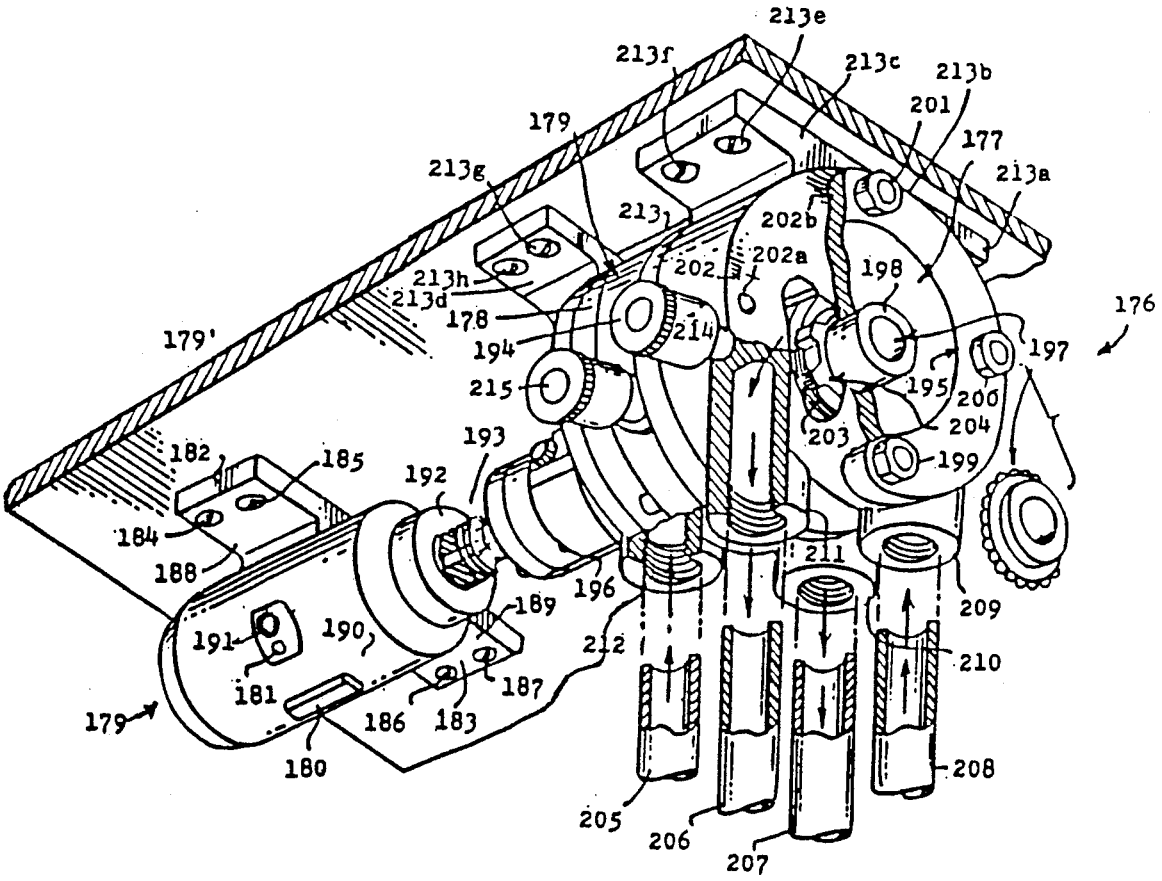
FIG. 59*a* is a detailed sectioned view of a centrifugal circulating pump.

FIG. 59*a* is a detailed sectioned view of a single pump element equivalent to the centrifugal pump means described by numerals 116 to 121 of FIG. 59. FIG. 59*a* depict s a more detailed view of centrifugal pump means 176. Pump comprises two cycling units 177, 178 operated by a stirling heat engine 179. Said engine 179 is of a commercially available type including capacitor means 180 and regulator means 181. Said engine 179 is fastened to platform 182 by two platform feet 182, 183 held in place by screws 184, 185, 186, 187. The foot members are formed from stablizing rocker brackets 188, 189 welded to the outer casing 190 to the aforesaid engine described by numeral 179.

An online feedback and control mechanism 191 is connected to a feedback and control system of conventional type (not shown). An outer coupling 192 in connected to the stirling engine 179 which rotates a shaft 193. An outer coupling 194 of the motor shaft 193 extends through a cam of separate pump means 194, 195 of the dual pump means 176. Shaft 193 passes through a hermetically sealed plate 196 and through both pump means , terminating at a hermetically sealed ball bearing and sprocket 197 at the opposite end of pump means 176.

A ball bearing system 197 is welded to a hermtically sealed plate 198 secured to pump mainframe 192 by four bolts (three of which are shown; 199, 200, 201). The pump mainframe 202 includes a threaded aperture 202*a* for the fourth bolt (not shown). A sealing gasket 202*b* is provided to prevent seepage of infusate from chamber 203, as a conical vane member 204 is rotated by shaft element 193, which is slotted and a coupling 194 is provided an optical electronic rotational monitor (not shown). Flow channels 205, 206, 207, 208 include electronic magnetic flow sensors 209, 210, 211, 212, which are employed to measure the flow rate and which are of conventional type. Each of the centrifugal pumps are isolated from one another and mounted to platform 182 by their own mounting bracket 213 formed from the pump mainframe 202. Bracket 213 is secured by four support feet 213*a* through 213*d*, three of which are depicted. Each foot accommodates two securing bolts (four of which are depicted). (Two bolts 213*e* and 213*f* of foot 213*c* are shown in the figures as are bolts 213*g* and 213*h* of foot means 213*d*). Conduit 214 conveys the infusion of fresh dye medium from a reservoir (not shown) to centrifugal pump 194, a valve 215 governs inflow of an aspiration dye medium into centrifugal pump 195 from another reservoir (also not shown). The pumps are equivalent to each other except that pump 195 has a higher torque output valve, as required for purposes of aspiration.

Figure 60:
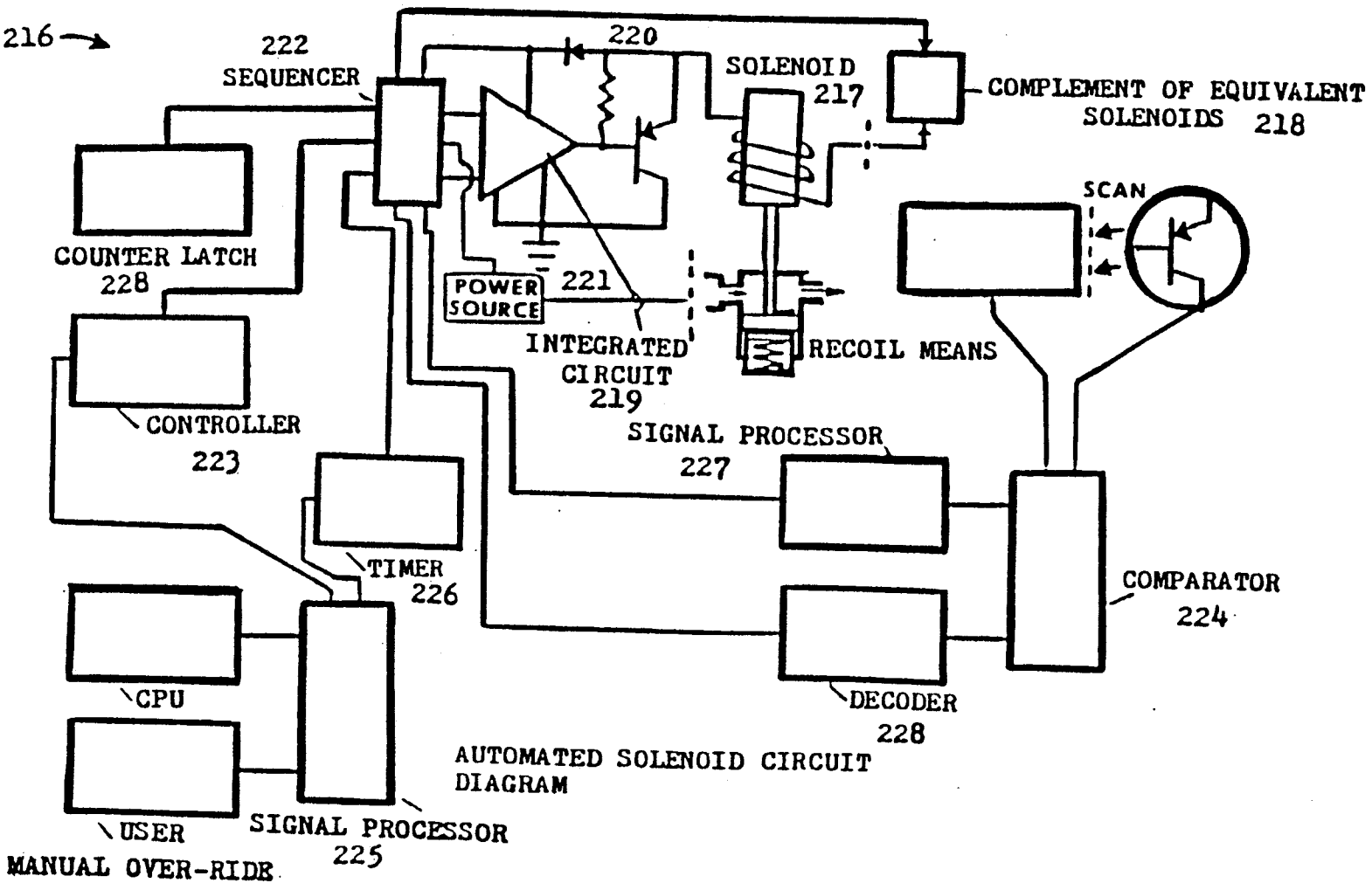
FIG. 60 schematically described the basic operative structure of the solenoid means which actuate valvular elements.

FIG. 60 schematically describes the basic operative structure of the solenoids embodied within subsystems of said device constructed to actuate various valvular means and employed to motivate other elements. The entire concise circuit diagram or circuit schematic and block diagram described in FIG. 60 is collectively assigned the numeric value 216. Numerals 217, 218, 219, 220 and 221 designate one of several solenoid elements of a group of equivalent elements, an integrated circuit means, typical or commerically available diodes and resistive elements and a suitable group means, respectively. Numeral 222 is assigned to the control and sequencer element. The control sequencer element denoted by numeral 222, controls the input delivered to the solenoid, the output of the entire circuit and the sequence in which one or more solenoids are actuated in order to perform a specific function. Other equivalent solenoid means which can be actuated in sequences are controlled collectively by numeral 223. The position of a needle switching element valvular means in relation to the solenoids are calculated by comparator element 224. Data is accumulated and collated from other sensory elements such as electrical contact elements, as described by element 225. The specific speed and force or torque generated by the solenoid elements are regulated by elements 226, 227. Numeral 228 designates a counter latch and decoder unit for signal processing of data and setting the temporal interval for the said locking mode. The calculation of internal scale factors alluding to position the solenoid elements in relation to the means, which said solenoids are motivating or driving, or information regarding resistance, flow, parameters and related processes obtained from sensory elements embodied within a cluster of feedback loops.

Figure 61:
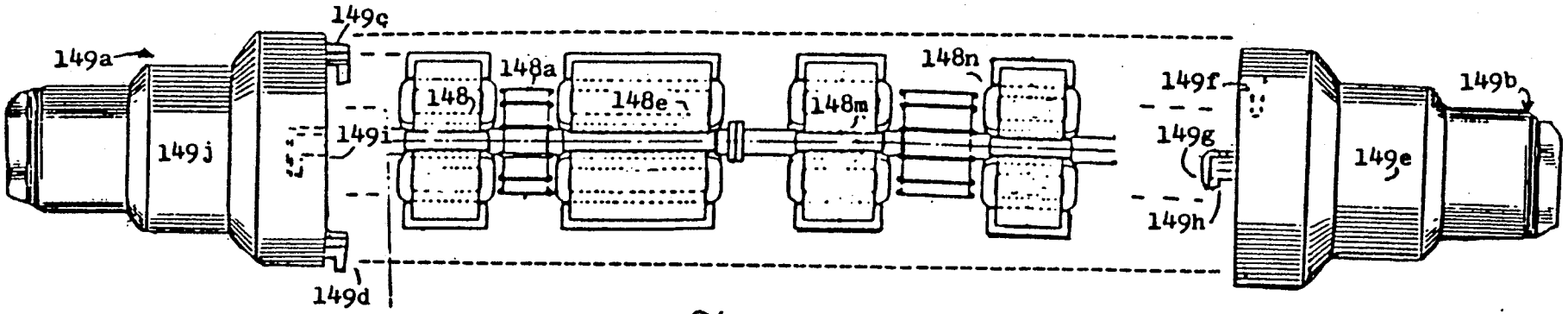
FIGS. 61 and 61*i* are sectioned views of the Ying Yang type of magnetic focusing element for charged beam generators.
Figure 61A:
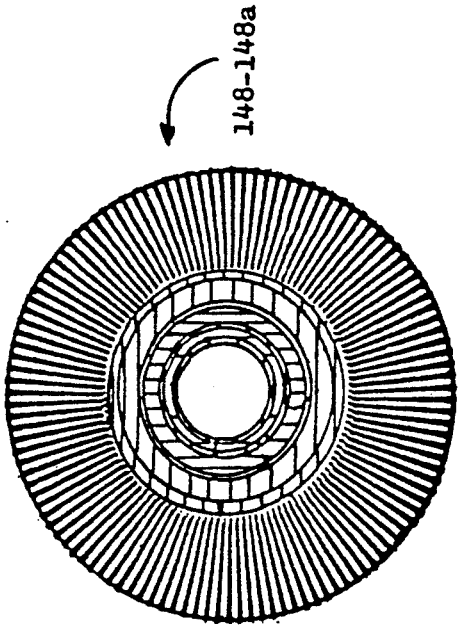
Figure 61C:
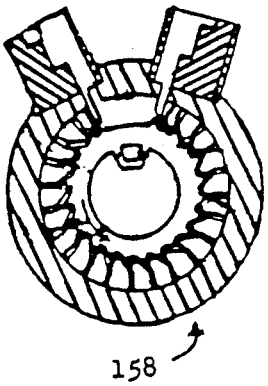
Figure 61D:
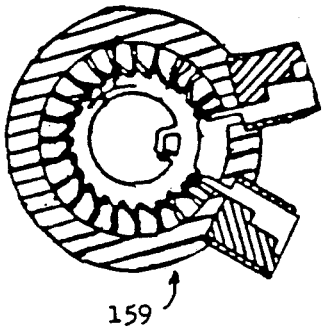
Figure 61E:
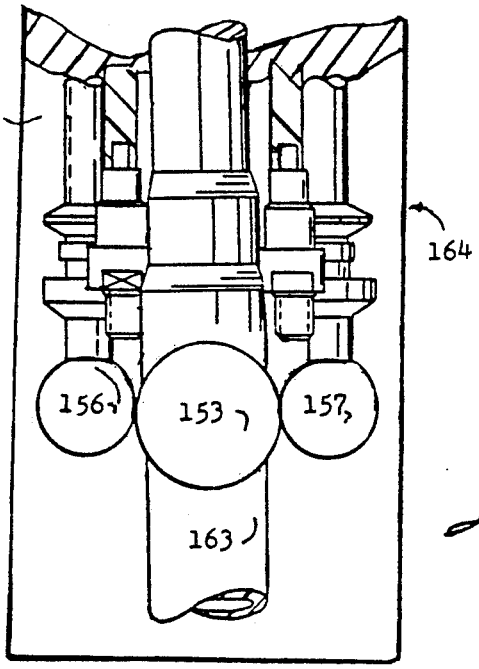
Figure 61F:
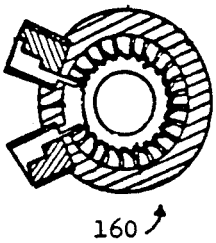
Figure 61G:
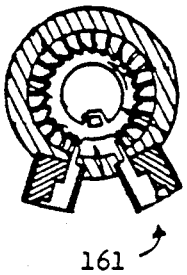
Figure 61B:
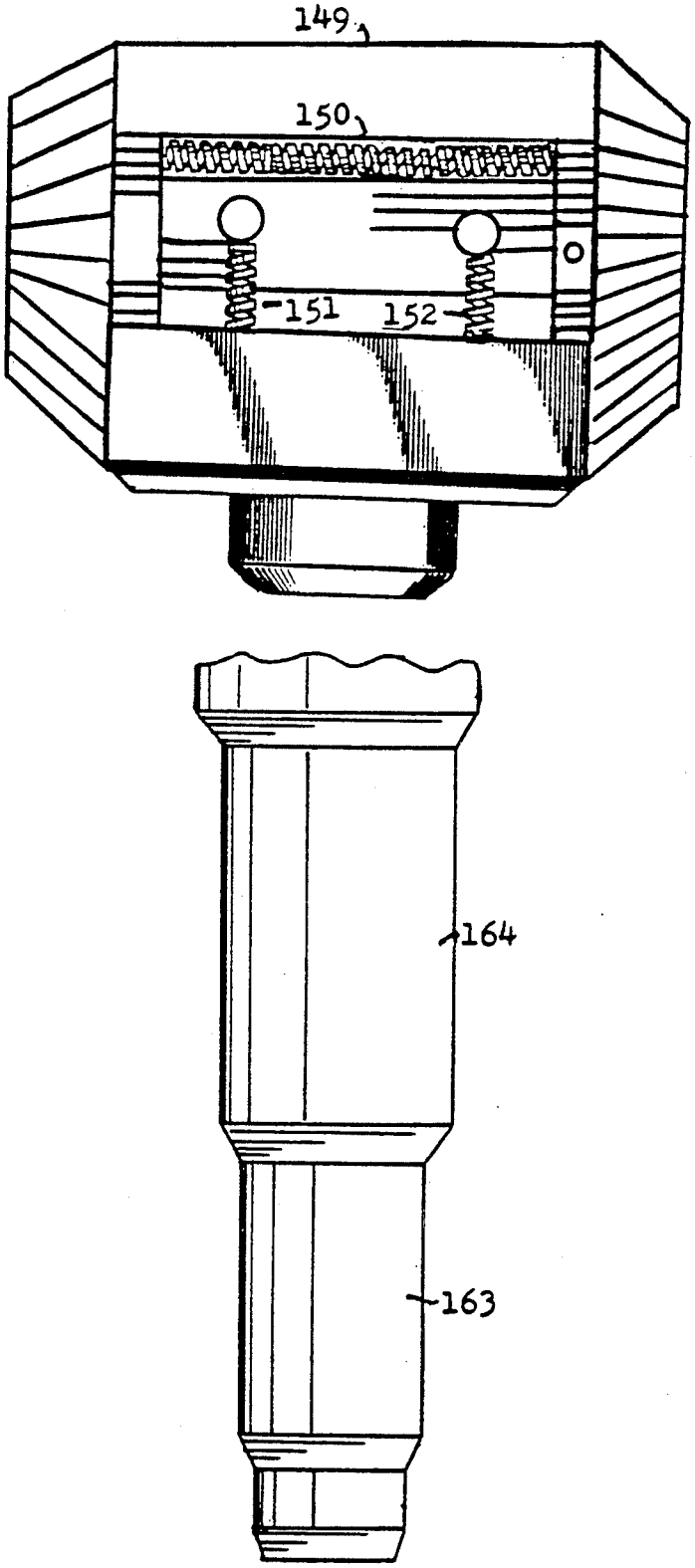
Figure 61I:
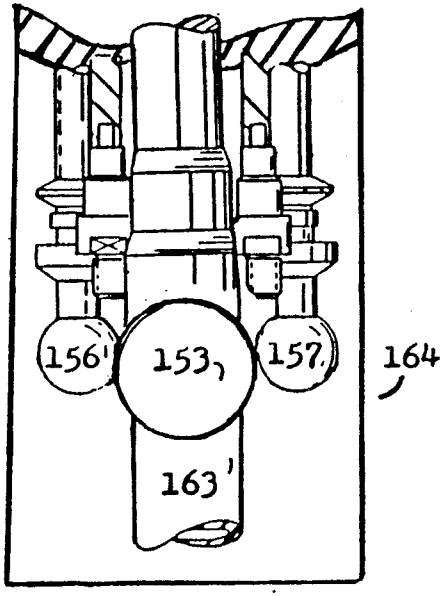
Figure 61K:
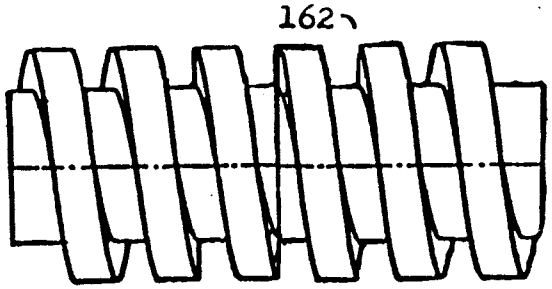

FIGS. 61 through 61*a* are sectioned views of the ying yang magnetic focusing system deployed by the M.A.L.K.E. device. The main sequence of focusing coils are composed of nobelium and titanium super conducting alloys consisting of a number of concentric distinct and separate concentric deflection coils denoted by numerals 148 through 148*n*, which overlap one another in a specific manner as to produce an extremely tight electromagnetic central focus. Each magnetic coil unit is encapsulated in its own cryogenic unit. The entire deflection coil system is further hemetically sealed in a cryogenic bomb assembly denoted by unit 149. The outer casing of the bomb assembly is composed of a series of thermal insulatory layers and consists of two separate interlocking cylindrical portion, as described by elements 149*a* and 149*b*. The interlocking male prong assembly depicted by structural element 149*c* and 149*d* of 149*a* insert into female slots 149*e* and 149*f* of element 149*b*. Male prong structural elements of 149*b* described by 149*g* and 149*h* inset into the female slots 149*i* and 149*j* of structural element 149*a*. A simple clockwise turn locks unit 149*a* and 149*b* together via a taper threaded means and a synthetic sealing gasket providing an air tight seal for the metallic quartz jacket of the bomb chamber. Beneath and lining the interior of casing 149 lies a series of microcoiled heat exchanger units revealed in part by element 150. Numerals 151 and 152 denote a cryogenic outlet and inlet means leading to a special cryogenic refrigeration unit described by element 156 and a cryogenic pump circulator element 157, respectively. Elements 153 depicts a Dewar vessel containing a suitable coolant medium such as liquid helium or liquid nitrogen or similar such medium. A filling inlet is described by number 154 which cools the main deflection coils directly. The main focusing yoke or deflection coils described by numerals 158, 159, 106 and 161. The inner cryogenic chamber housing the main deflection coils is illustrated by element 162. A secondary internal isulatory chamber is denoted by numeral 163, whereas numeral 164 denotes the outer tubular mainframe of the units support column.

Figure 62:
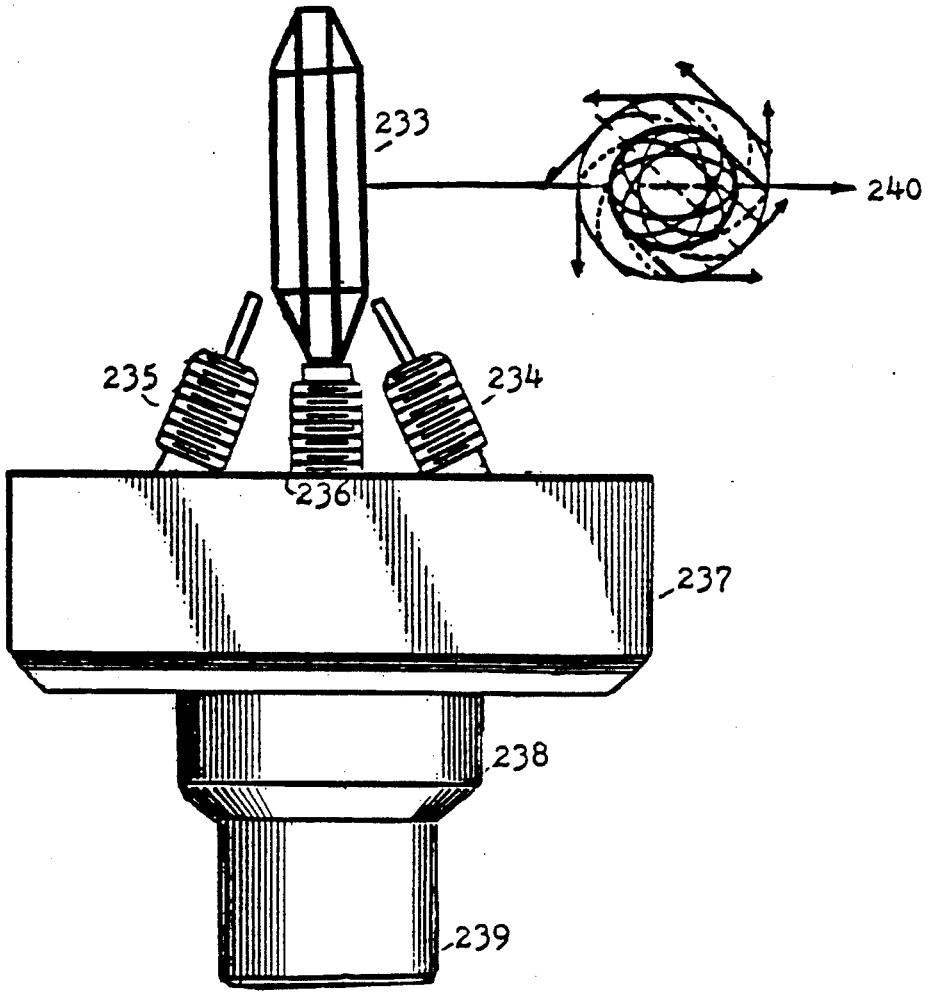
FIG. 62 denotes a solid state quartz Kerr Cell unit.

FIG. 62 denotes a solid state quartz type Kerr Cell means. The actual solid state Kerr Type pulse structure is denoted by numeral 233. The associated pulsation structures are described by radiofrequency coils 234 and 235, respectively. The necessary rational for electro-optical modulation demodulation can be described herein by several simplified equations reciting only a few basic laws.

$$\sin\theta = \frac{m\lambda}{2\lambda}$$

for acoustical shutters and the like defines the geometry or input angles at which the Bragg modulation takes place.

$\theta$=angle between the propagation direction of the input optical and planar acoustic wavefronts. $\lambda$ denotes the optical wavelength in the medium. $\Lambda$=acoustic wavelength in medium, $m=\pm1,\pm2,\pm3, \ldots$ and $m\theta$ defines the angle between the propagation direction of the output optical beam and the planar acoustic wavefronts. The following three greatly simplified mathematical expressions relate to the optical intensity transmission of modulator configuration $$\frac{Io}{Ii} = 1/2\,(1 - \cos\phi).$$

Io is equivalent to the optical output intensity, Ii is equivalent to the optical input intensity, and $\phi$ is equivalent to the differential phase shift between the rapid and slow axis.

The differential phase shift is linearly related to applied voltage in the Pockels effect; whereas in the Kerr effect it is related to the voltage squared. Pockels effect is simply described in the following relation $$\phi = \pi\frac{V}{V}$$

whereas the Kerr effect can be fundamentally described by the basic expression $$\phi = \pi\left(\frac{V}{V}\right)^2.$$

In the two fundamental expression denoting the Pockels and Kerr effects V is equivalent to the modulation voltage. V is sequivalent voltage to produce $\pi$ rads differential phase shift. The case where $\phi=\pi/2$ the most linear region of a typical modulation curve and in some instances a quarter wave plate was often added in series with the electro-optical material in order to initiate a fixed biased at $\pi/2$. Rapid radiofrequency Q-switch techniques can under certain conditions uniformly clip or sample the emission spectrum within the contexts of a sinosoidal modulation similar to PWM and or PPM specified recitation by the following generalized expression contained herein below $$x(t) = 1/2 + \frac{1}{\pi T}\sum_{m=1}^{\infty}\frac{1}{mfo}\cos\left[2\pi mfot + \frac{\pi}{2}(2m-1)\right] +$$

$$\frac{1}{\pi T}\sum_{m=1}^{\infty}\frac{1}{mfo}Jo(2\pi Amfo)\cos\left(2\pi mfot - \frac{\pi}{2}\right) +$$

-continued $$\frac{1}{\pi T}\sum_{n=1}^{\infty}\frac{1}{nfs}Jn^2\pi Anfs\cos\left[2\,nfst-(n+1)\frac{\pi}{2}\right]+$$

$$\frac{1}{\pi T}\sum_{\substack{m=1\\n=1}}^{\infty}\left\{\frac{1}{mfo+nfs}Jn\,[2\pi A\,(mfo+\right.$$

$$nfs]\cos\,[2\,(mfo+nfs)t-(n+1)\frac{\pi}{2}\Big]+$$

$$\frac{1}{nfs-mfo}Jn\,[2\pi A\,(nfs-$$

$$\left.mfo]\cos\left[2\pi\,(nfs-mfo)t-(n+1)\frac{\pi}{2}\right]\right\}.$$

A more concise from of the fundamental sinusoidial expression can be denoted by the following relation $$x(t)=$$

$$\frac{1}{T}\sum_{\substack{m=\infty\\n=\infty}}^{\infty}(-j)^nJn[2\pi A(mfo+nfs)]P(mfo+nfs)\,e^{j2\pi(mfo+nfs)t}.$$

where P(f) describes the Fourier transformation of the pulse shape p(t) and $$x(t)=\frac{1}{2}+\frac{1}{T}\sum_{\substack{m=\infty\\n=\infty}}^{\infty}j2m-1\,\frac{e^{j2\pi mfot}}{2\pi mfo}-$$

$$\frac{1}{T}\sum_{\substack{m=-\infty\\n=-\infty\\|m|+|n|\neq 0}}^{\infty}(-j)^{n+1}\frac{Jn[(2\pi A(mfo+nfs)]}{2\pi(mfo+nfs)}\,e^{j2\pi(mfo+nfs)t}.$$

Figure 63:
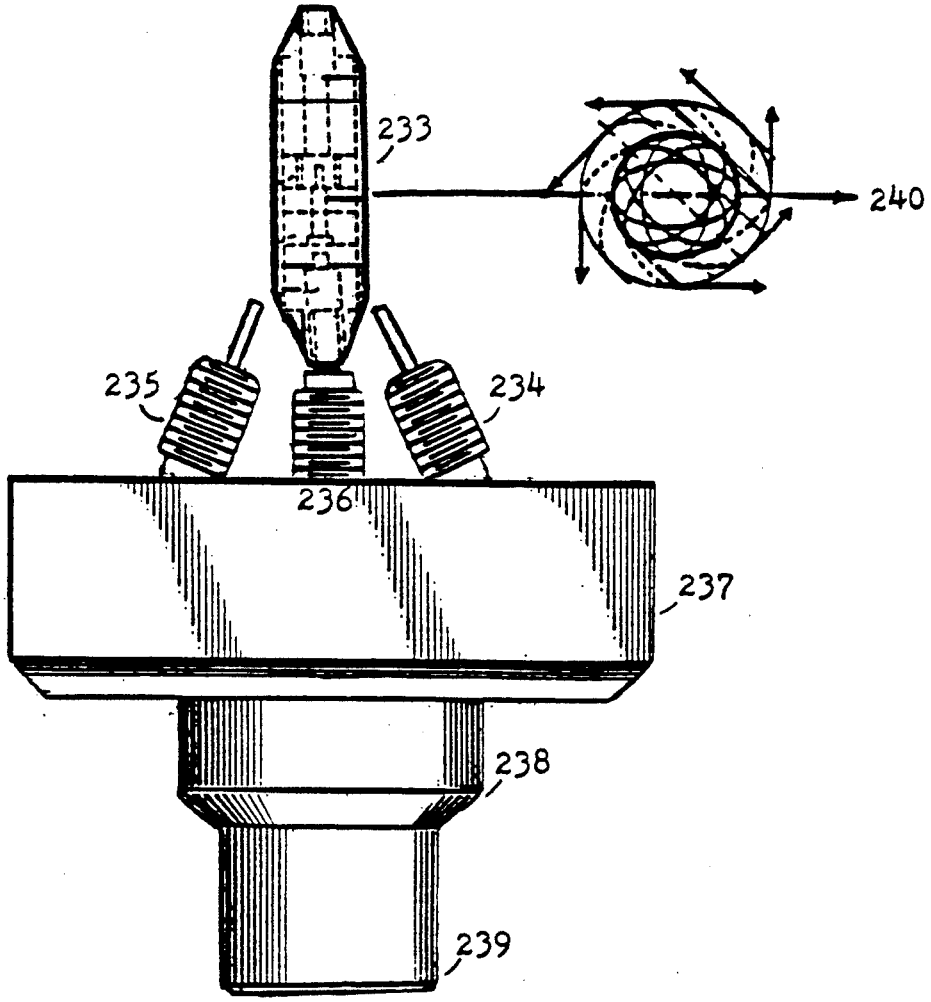
FIG. 63 denotes a combination heat exchanger and central support structure for said Kerr type structure.

Numeral 236 or FIG. 63 denotes a combination heat exchanger and central support structure for the solid state quartz Kerr Type structure. Numeral 237 depicts the outer casing housing the internal operative components for the radio frequency device. A plurality of microcolied heat exchangers, heat sinks and or other typical thermal dissipation units are well known by those skilled in the art. Numeral 238 denotes the outer housing structure for the pump means and numeral 239 a tubular support column for the entire unit. Element 240 represents an altered or otherwise modulated beam transmission.

Figure 64:
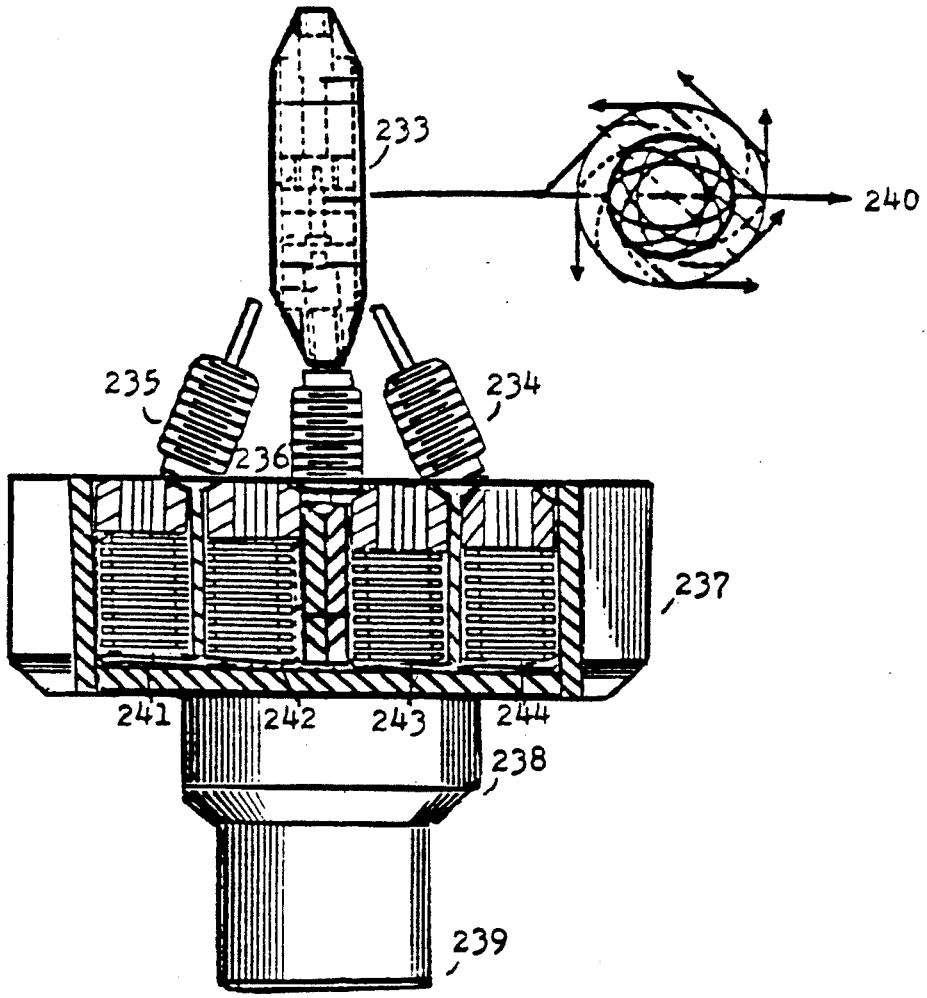
FIG. 64 is a sectioned representation of the inner casing disclosing internal structures, including radio frequency means.

FIG. 64 is a partial detailed sectional representation of the inner casing of structure 237. A series of radiofrequency coils are depicted by elements 241 through 244, with amplified control and modulate electronic discharges leading from elements 234 and 235. Since wave oscillations generated the radiofrequency coils can be typically defined by the expressions herein below:

$$\left(\sqrt{\frac{L}{C}}\;\frac{1}{RiV}+2\right)>\sqrt{\frac{C}{L}}\;R>\left(\sqrt{\frac{L}{C}}\;\frac{1}{RiV}-2\right)$$

$$\text{here}\alpha=\frac{-1}{2}\left(\frac{1}{RiVC}+\frac{R}{L}\right)\text{and}w=+\sqrt{\frac{R+RiV}{RiVLC}-a^2}$$

C is the equivalent to the circuit capacitance and the active element capacitance and $$\left(\frac{L}{C}\;\frac{1}{R}+2\right)>\sqrt{\frac{C}{L}}\;Ric>\left(\sqrt{\frac{L}{C}}\;\frac{1}{R}-2\right)$$

$$\text{where }\alpha=-1/2\left(\frac{1}{RC}\;\frac{Ric}{L}\right)\text{and}$$

$$w=+\sqrt{\frac{R+Ric}{RLC}-\alpha 2}\,.$$

The oscillator build up in both cases $\alpha<o,\alpha=o$ for stable oscillator amplitude and $\alpha>o$ for decaying oscillations. L is equivalent to both the total circuit inductance and the active element inductance. A typical admittance and Hybrid Parameters maybe formulated in terms of Z or Y parameters such that, $$Yin=y1\,\frac{y12y21}{y22+yL}$$

$$Yout=y22-\frac{y12y21}{y11+ys}$$

$$GT=\frac{4Re(ys)Re(yL)|y21|^2}{|(y11+ys)(y22+yL)-y12y21|^2}$$

yL is equal to the load admittance, ys is the source admittance, y-in describes the input admittance, y-out is equivalent to the output admittance and GT is the transducer gain. Other numerous field equations are available and well known by those skilled in the art.

Figure 64A:
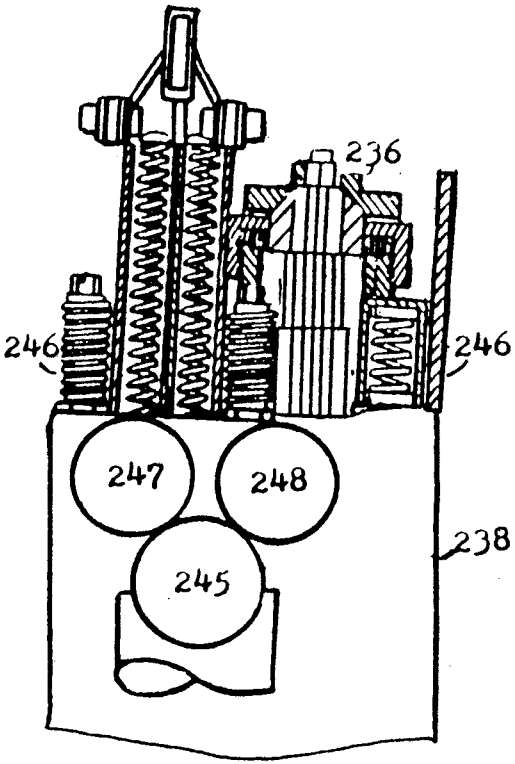
FIG. 64*a* describes a detail a cryogenic refrigeration unit and circulating pump means.

FIG. 64*a* is a detailed partial description of a cryogenic refrigeration unit incorporating the typical cyclic pump denoted by numeral 245. Numeral 245 describes a Gilford Mc Mahon type of cryorefrigeration unit forming inpart column 236. Additional condenser units carry exhausted refrigerant medium back to a regeneration unit as denoted by numeral 246. Element 247 denotes a typical Dewar vessel which has its content renewed by means 246 and sends its contents to a cyclic pump means 248. The contents are cycled over the electronic circuitry proper, not shown here which provide rapid oscillation rates equivalent to those of Q-switching means also well understood and deployed by those skilled in the art.

Figure 65:
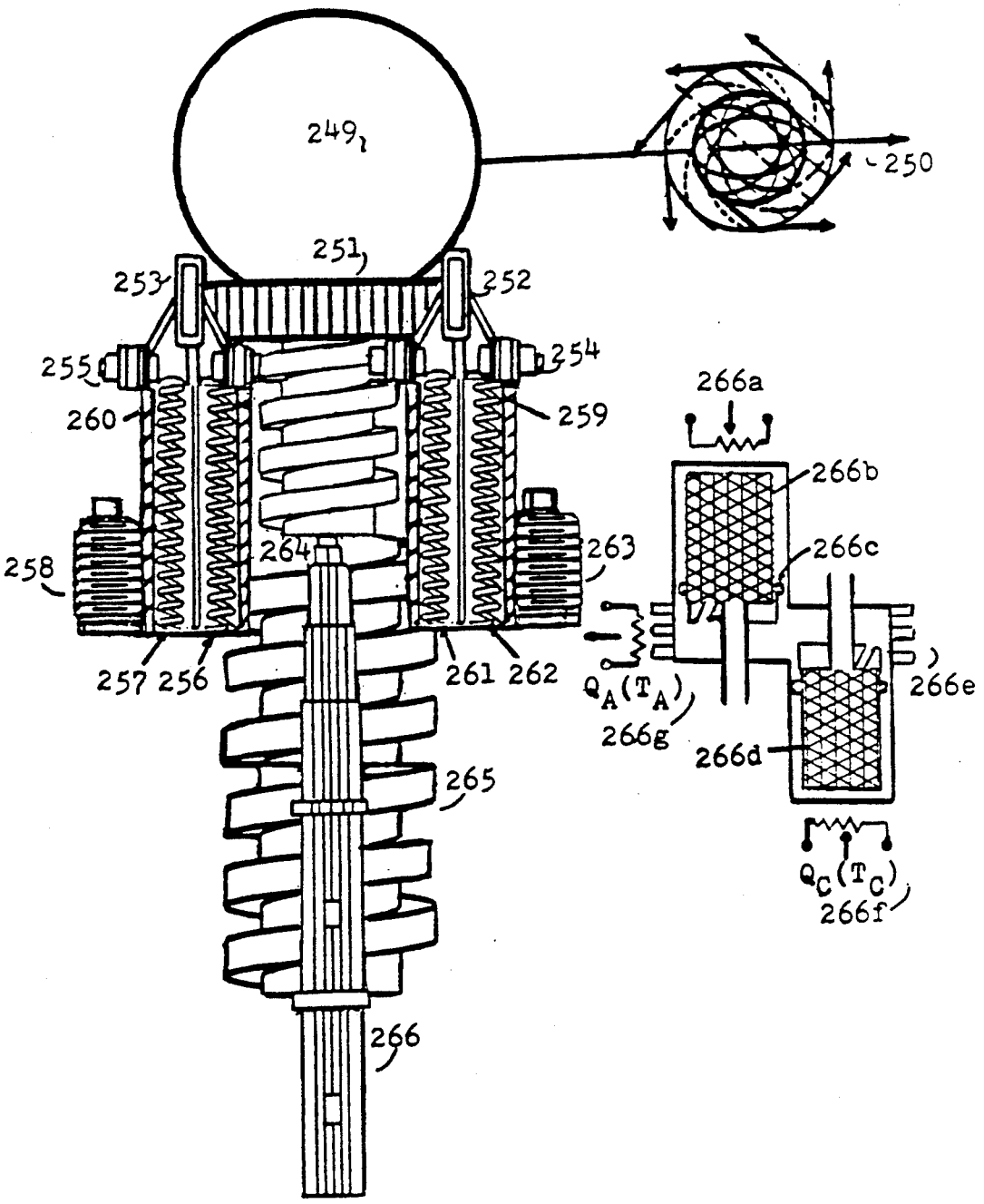
FIG. 65 depects a concise sectioned view of a globe dye cell vessel.
Figure 65A:
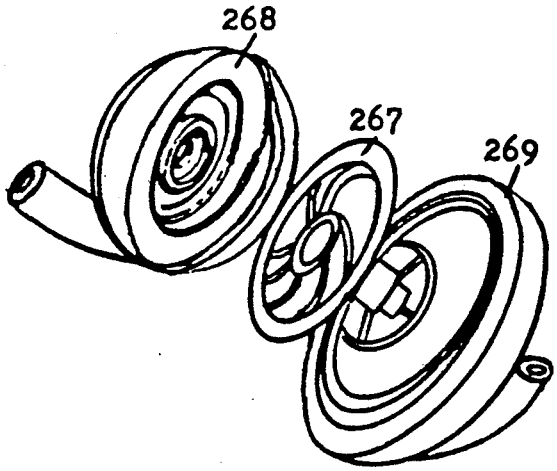
FIG. 65*a* is a detailed partial view of the main centrifugal drive pump.
Figure 65B:
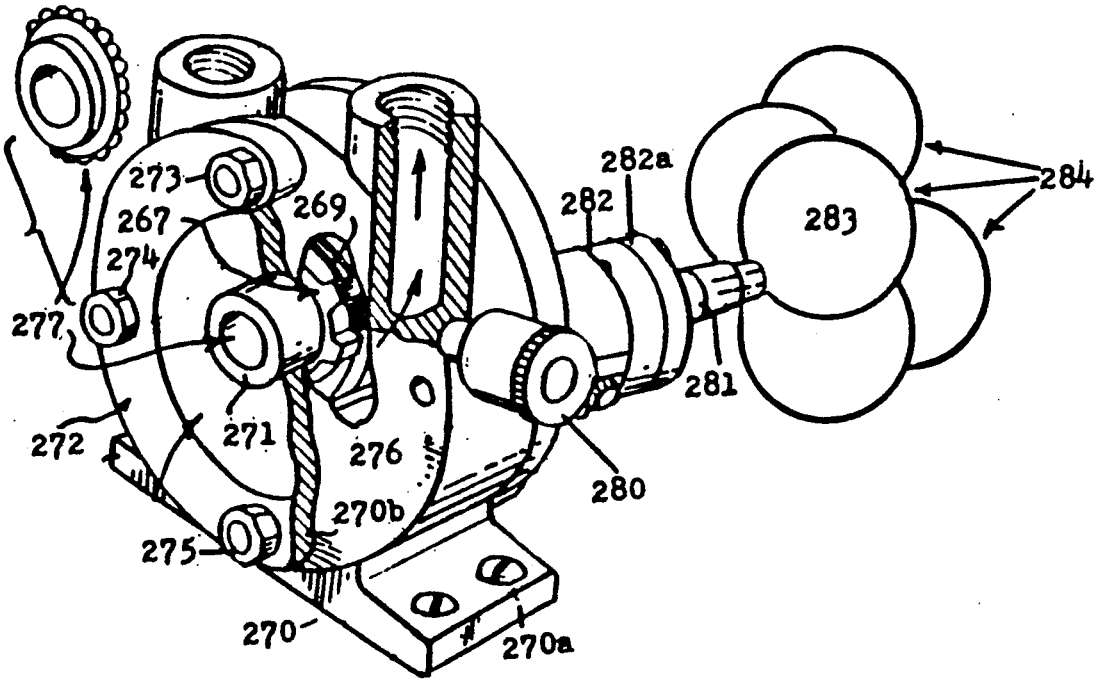
FIG. 65*b* denotes a partial sectioned view of said pump disclosed in FIG. 65*b;*

FIG. 65 depicts a concise sectioned view of the common dye cell vessel. The transmission globe or cell where the laser pulser beam first incidented on is denoted by numeral 249. Element 250 describes the altered beam exiting the vessel, numeral 249. Thermal dissipation means for the vessel are implicitly collectively by element 251. Operative inflow and outflow inlets are denoted by elements 252, 253. The outflow inlet parameters of number 253 are controlled by solenoid means 254 and 255, which separates the outflow into two distinct streams leading to conduits 256 and 257 where the streams undergo further thermal dissipation. The high pressure content of conduits 256, 257 collectively feed into an inter-mixing chamber described by element 258. Numeral 259, 260 represent the duel solenoid configuration control, the inflow of a fully activated dye medium and or purging medium such as gaseous nitrogen or certain titrating medium to nullify acidity or basicity of certain solvents and the like employed in various dye mediums. A suitable dye medium is provided, dissolved in its respective solvent. The dye medium operates cojointly with a specific set of selectively emissive mirrors to shift the given wavelength by selectively emitting only one set of spectrum lies presented by a given emission source. The present lasing wavelengths employed range from 3410 Å to 10,000 Å, the dyes utilized and their solvents, ranged from p-Terphenyl dissolved in cyclohexance to 1,1 Diethyl-4,4-quinotricarbocyanine iodide dissolved in acetone. The days are all commerically available and readily understandable to those skilled in the art. Conduits 261 and 262 are feed into unit 251 and element 263 describes an intermixer means equivalent to unit 258. Column 265 acts as a support unit for the entire dye cell complex and active heat exchanger pump means for the heat exchanger unit 251. Numeral 266 is a segmented section housing a special Vuilleumier cycle refrigeration unit which is further described schematically by elements **266*a* through 266*g*. Element 266*a* describes the thermal energy input, 266*b* indicates the thermal displacer regenerator, and 266*c* illustrates a typical seal. Element 266*d* is indicative of a cold displacer regenerator means its seal is provided by 266*e*. 266*f* describes the cooling load, whereas QA (TA) is described by 266*g***.

FIG. **65*a* is a detailed partial view of the main dye cell minding cham and centrifugal agitator turbine disc. The multiple blade turbine is described by 267, whereas the inner and outer cham structures are described by element 268 and 269**.

Figure 66:
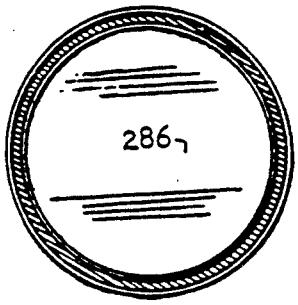
FIGS. 66, 66' denote a pictorial view of the piezoelectric electronic deflection means, levitation unit and hydraulic means.
Figure 66:
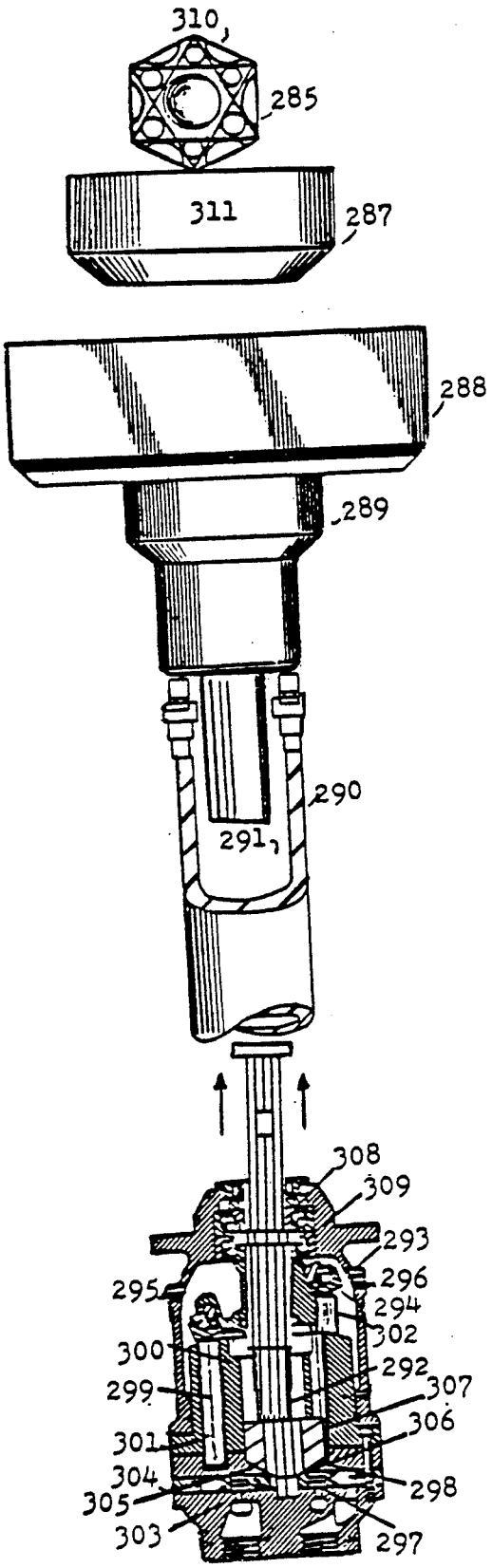

FIG. **65*b* denotes a partial sectional view of the main centrifugal drive pump means deployed to circulate multiple dyes. The entire pump means described by numeral 270 is composed of a special high pressure silicon borate material resistant to wear and relatively impervious to all corrosives. Numerals 270*a* and 270*b*, which are not shown are locking brackets, which secure the entire structure by bolts to the secondary platform which are also not shown. Numeral 271 is indicative of the outer motor seal which holds the cham and turbine means. Numbers 273, 274, and 275 are indicative of three of six locking bolts, which secure element 271 to pump means 272. Each bolt means inserts into their specific threaded orifices; six of which are present and one of which is indicated by numeral 276. Element 277 consists of a special composite ball bearing encasement, which houses the outer stem or extended shaft of the turbine disc means as denoted by numeral 267. Two cycling ports are described by numerals 278 and 279. Number 280 is indicative of both an electronic controller and a solenoid means for pump unit 270 and mixing chamber 282, which is secured to the pump mount by a series of bolts and a sealing gasket, which is described by numerals 282*a*, and 282*b*, 282*a* represents one of three securing bolts two of which are not shown. Numeral 281 is indicative of a multiple conduit system axial located with each conduit penetrating its respective dye containing reservoir. Each reservoir has its flow rate governed by its own separate an distinctive solenoid means, none of which are shown. The entire complex of reservoir vessels are depicted by numeral 284. The complete dye complex is mobile and is mounted on a secondary platform which is moved into or out of the laser field when lowered energies are employed by a series of opposing solenoids not shown here, 283. FIGS. 66, 66' are concise pictorial views of the piezoelectric electronic deflection means, the levitation unit and a sectional view of the auxiliary hydraulic means. Numeral 285 of FIG. 66 denotes the entire automated piezoelectric focusing complement. Element 286 of FIG. 66' denotes a typical parabolic focusing dish of the piezoelectric complex. Numeral 287 denotes the fixed made magnetic flux emitter, whereas element 288 contains a full complement of separate magnetic acquistion coils. Compartment 289 houses a cryogenic pump means and miniature optical electronic laser gyroscopic means, which is not shown. A combination support and hydraulic lift column denoted by numeral 290 is elivated by tubular lift sleeve, which is described by numeral 291. The hydraulic lift is deployed int he event of a generalized systems failure which occurs in the magnetic levitation means. The hydraulic means also has the capacity to raise, lower and or rotate the entire piezoelectric, however platform 287 must be secured to the larger platform 288 and the entire process of directing emissions towards one or more target centroid. Numeral 292 denotes a miniature hydraulic pump means which is sectioned in order to reveal its operation. Numeral 293 denotes the exterior cham shaft, which is secured to the outer casing and internal interlock system 294 via an array of securing bolts, collectively described by elements 295 and 296. The upward or downward rotation is produced by the hydraulic lift and descent assembly, which is held in alignment by a series of stabilization rockers collectively indicated by numeral 297. An auxiliary torsion release hinge 298 and pressurized fluid reservoir contained within the fluid interlock input tubule 299, which is a necessary element in the advent the hydraulic pump fails in that the pressurized contents allow the entire system to be operative for short transits in the event of either a systems failure do to loss of power or fluid leakage in one or more of the lines. Element 300 denotes an internal separator which divides or separates the interior inlet element 301 from the exterior outlet means as denoted by element 302, which leads from a subminiature pump means numeral 303. An auxiliary pair of combination stabilizers and lifts or declinator means as described by number 304, provides a smoother motion during the operation of the hydraulic pump means. A special rotational means described by element 305 is located on the rim of the turbo-threaded assembly, described in brief by numbers 306 and 307. Thirty jeweled ball bearings are located in the vertical and horizontal gimble, elements denoted by numeral 308 and 309**. Each gimble element turns in its own slotted suspension system, not shown providing precision movement in regards to elevation declination or rotation. Prior to discussing the magnetic levitation system it becomes necessary to recapitulate the mathematical formulations which form the basis of systems operations. The magnetic levitation means consists of a series of variable and fixed magnetic emitters which are exclusively automated to, tilt, rotate and levitate the piezoelectric complex at near relativistic speeds for targeting of one or more targeting centroids. The following mathematical equation are well known by those skilled in the art and describe in brief the properties of the magnetic emitter or field generators that are employed in accordance with the invention set form herein below: Electromagnets generate increments of force between parallel currents which yield elements that can be expressed in the form d(dF) such that, $$d(dF) = \frac{\mu I_1 dl_1 I_2 dl_2}{4\pi r_{12}^2} \sin\theta,$$

$I_1$, $I_2$ are values of steady currents in conductors whose element of length are $dl_1$ and $dl_2$. $r_{12}$ is the straight line distance disposed between $dl_1$ and $dl_2$, $\mu$ is a physical property of the medium wherein the current carrying conductors reside and $\theta$ is the angle between the direction of $r_{12}$ and the perpendicular form a specified current element, and the direction of the parallel conductors. Variations of the Biot-Savart/Ampere-Laplace Law, wherein the force produced by currents closed paths can be expressed by simply integrating the expression for d(dF) over the total path lengths $I_1$ and $I_2$ such that, $$F = \oint \left( \oint \frac{\mu I_1}{4\pi r_{12}^2} dI_1 \right) I_2 \sin\theta dI_2$$

A more useful form of the equation for describing F takes into consideration the element contained $N_1$ and $N_2$ turns with the currents $I_1$ and $I_2$, such that the initial force must be multiplied by $N_1$ and $N_2$. The force equation F takes the form of $$F = \oint \left( \oint \frac{\mu N_1 I_1}{4\pi r_{12}^2} dl_1 \right) N_2 I_2 \sin\theta dl_2$$

$$= \oint B_1 N_2 I_2 \sin\theta dl_2$$

the field vector describing the magnetic flux density can now be described by the value $B_1$ such that, $$B_1 = \oint \frac{\mu N_1 I_1}{4\pi r_{12}^2} dl_1 = \frac{\mu N_1 I_1 I_1}{S}.$$

The value $s=4\pi r^2$ is defined as the spherical surface of radius r along each element of length of conductor $I_1$ so that $B_1$ denotes a surface density of the magnetic field produced by current I flowing through Nn turns of the conductor each of length $I_1$ and is related to force F. The magnetic permability and magnetic susceptibility of suitable materials depends exclusively on the properties of the medium in which they are located. This is especially true of fixed mode magnetic field generators. The proper effects can be generated by ferromagnetic materials composed of iron alloy of nickel, cobalt and like materials. The most suitable material for the purposes of both fixed and variable field generators or emitters is a commerically available blend of Samarium Cobalt. The magnetic permability of a substance and the permability of free space is given by the simple expression $\mu=\mu o \mu r$. $\mu o=\mu\pi\times10^{-7}$ henry per meter (H/m) of a given specified material and $\mu$ may be also expressed in the form $\mu=\mu o\ (1+xm)$ in which xm is equivalent to the magnetic susceptibility, which is simply a measure of the alignment of atoms or molecules in a magnetic material.

Numerous fields of opposing magnetic flux generate the main mode of levitation between the piezoelectric based focusing unit numeral 285, 287 and a logistical or magnetically active base means, which is described by numeral 288. Therefore it is important to describe the magnetic flux density in terms of properties of the current carrying conductor originating from the magnetic field in a specific manner as to express force generated by the first current element $N_1I_1dl_1$ exerts a second adjacent current element described by $N_2I_2dl_2$ such that, $$B_1 = \left( \frac{dF}{N_2 I \sin\theta dl_2} \right)_{max} = \frac{dF\max}{N_2 I_2 dl_2}$$

Here Fmax. is the maximum force exacted on the adjacent current element for which the Biot Sarvart law $\sin\theta=\sin 90°=1$ Now interpreting the magnetic field produced by a current element $N_1I_1dl_1$ the magnetic flux density may be assessed as, $$B_1 = \oint \frac{\mu N_1 I_1 dl_1}{4\pi r^2} = \frac{M N_1 I_1 l_1}{S}$$

The magnetic effects of the current may be similarly defined in a quanity, which is described as the magnetic field strength H. Wherein $H=F\phi$. The force generated by certain specified fluxes, produced by current and carrying conductors is described herein below as, $$F = \frac{\phi_1\phi_2}{4\pi r_{12}^2 \mu} = \frac{\phi_1\phi_2}{S\mu}$$

there S is considered to be an area of a closed sphere encasing each element of flux which is produced such that, $$H = \frac{\phi_1\phi_2}{\mu S \phi_1} \quad \frac{\phi_2}{\mu S} \quad \frac{B}{\mu} \quad \frac{NI}{l}.$$

Other well known equations are available and known to those skilled in the art, but the basic recitation of these same said equations are not needed to further elucidate the scope of the present invention.

Figure 66A:
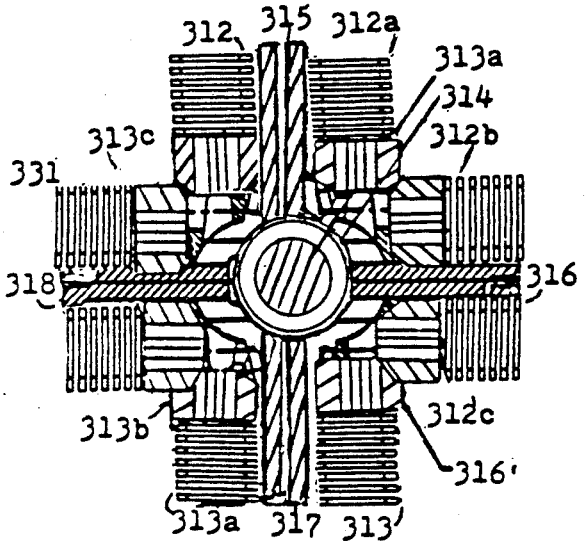
FIG. 66*a* is a detailed cross-sectioned view of one automated electromagnetic unit responsible for levitation of the piezoelectric means.

FIG. 66*a* is a detailed cross-sectioned view of only one of many automated electromagnet units responsible for primary levitation and rotation of the piezoelectric means and its platform which are denoted by 310 and 311, respectively. The electromagnet consists of eight charging coils described by numerals 312 through 313. The charging coils essentially transfer their accumulative properties to a single central magnetic focusing disc 313*a*. A special ferrous ceramic yoke means is indicated by numeral 314. Four miniature induction coils composed of a nobelium and titanium are in contact with the yoke structure numeral 314 and are denoted by elements 315 through 318. All elements are structurally embedded in a non-metallic commerically available medium described by element 316 which provides electrical and thermal insulation from other adjacent electromagnets or extremes in ambient electrical or thermal conditions. Numeric values 312 through 317 collectively define a single magnetic levitation singlet. Each said singlet, of which there is a multitude of, is separate and distinct from every other equivalent singlet. The yolk and magnetic focus disc 313*a* of each singlet's structure inables each singlet to focus or narrow the field of magnetic flux rather then allowing the field to spread peripherally outward along lines of magnetic flux dispersed from opposing magnetic poles. Additionally, the magnetic polarity of the magnetic focusing disc can be intensified. diminished, or reversed by the type of electrical biased placed on anyone of eight charging coils. The electrical charged biased, the amount of current generated and the duration of time current is supplied to the charging coils and ancillary structures are controlled by electronic impulse generated from a CPU and or an ancillary electronic subsystem. The singlets are automated an circumferentially disposed around the the piezoelectric structure number 310 embodied within the platform structure, number 319. Additionally a full complement of separate and distinct singlet structures are circumferentially disposed in a separate means described as the central ring of electromagnets assigned the numeric values 319, 320 and 321. Levitation or ascent, descent, pitch yaw and angular rotation is accomplished through the magnetic flux generated by each singlet. The suspension of the aforementioned platform structure above the base is initiated by opposing flux generated by singlets with like polarity of pulls. The pitch, yaw and or angular rotation of the platform structure is achieved by the near simultaneously actuation of singlet pairs some of which have like polarity and other specified singlets with opposing magnetic field tilting the entire platform a specified number of degrees, minutes and seconds. The entire platform structure can rotate 360 degrees about the central axis by alternately varing the field strength of intensity of the magnetic flux generated and or the polarity of the magnetic fields omitted by separate and distinct singlet circumferentially arranged both around the base and said platform structure. Targeting of one or more emissive beams(s) at a near simultaneous rate and or the switching to and from various piezoelectric reflective mirror means is accomplished by the complex of independently actuated singlet elements.

Figure 66B:
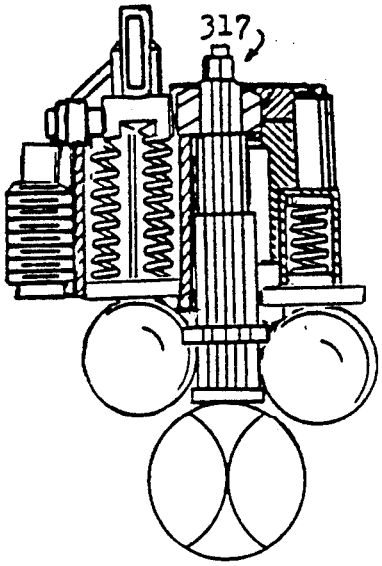
FIG. 66*b* consists of Dewar vessel and cryogenic cooling pump means for the electromagnetic means.

FIG. 66*b* denotes a typical cryogenic pump with is structurally equivalent to that which was presented in FIG. 64 and is deployed to cool the electronic circuitry and primary magnetic elements in the entire complement of electromagnet structures, and therefore will be issues only a single number, 317. The function and structural disposition of cryogenic pump means 317 is equivalent to the type described by 245.

Figure 66C:
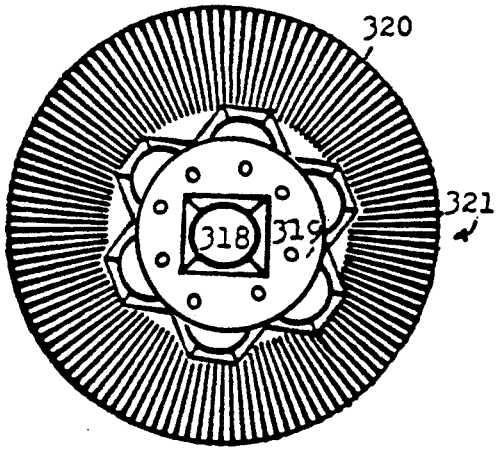
FIG. 66*c* is a pictorial view of the lower complement of automated electromagnets indicating eight centrally located units and a full complement of peripheral units.

FIG. 66*c* is a pictorial view of the lower complement of automated electromagnets which indicate eight separate and distinct centrally located units and full complement of peripherally located electromagnets. A hydraulic spacer is described by a numeral 318, and the central ring of electromagnets are denoted by numeral 319, 320 and 321, respectively.

Figure 66D:
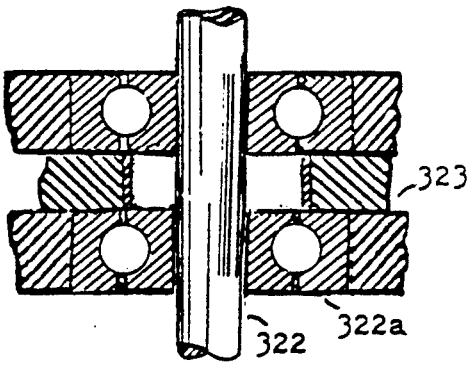
FIG. 66*d* is a cross-sectioned view of the floatation rocker assembly employed by the hydraulic means.

FIG. 66*d* is an enlarged sectioned portion of the ball bearing system and rotating turret of the hydraulic pump means described by numeral 322. The rotating turret is described by element 321 and the separate coupling are illustrated by numerals 322*a* and 323.

Figure 67:
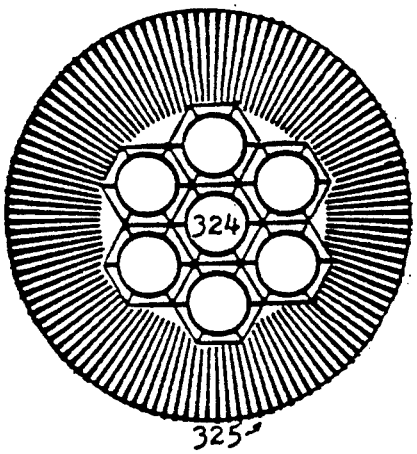
FIGS. 67, 67*a* are detailed perspective views of a single parabolic focusing means which is subtended by a schematic representation of the piezoelectric trilayer which provides a insulatory layer and an isolated highly reflective dielectric coating capable of being selectively charged.
Figure 67B:
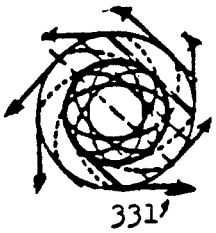
FIGS. 67*b*, 67*c* are concise pictorial views of incident beams and the atomic focusing alignment of the piezoelectric lense element.
Figure 67C:
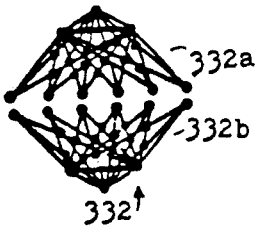
Figure 67A:
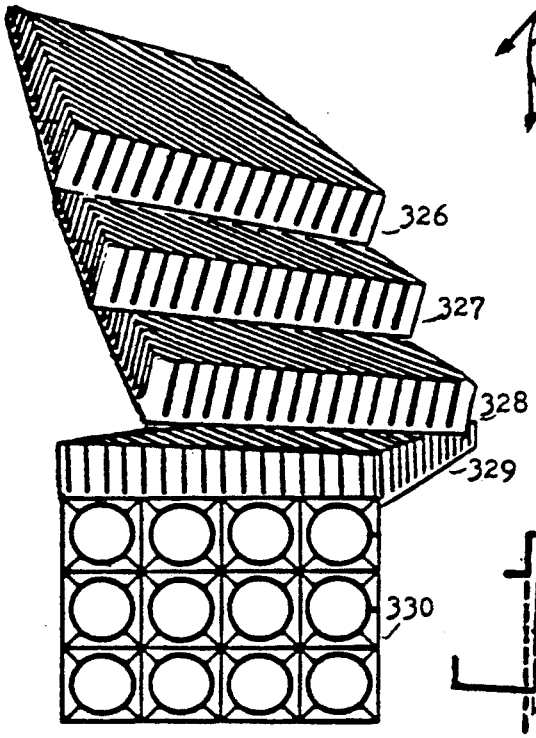

FIGS. 67, 67*a* are detailed perspective views of one of several parabolic piezoelectric focusing means which are employed in the focusing beam transmissions. Here the view s subtended by a schematic representation of the piezoelectric trilayer which proceeds the insulatory layer and an isolated highly reflective dielectric coating which is capable of being selectively charged. The actual piezoeloectric elements that are illustrated here have several centrally located focusing elements which is described collectively by numeral 324. A concentric peripherally located piezoelectric disc forms the outer focus of the parabolic lense structure and is denoted by numeral 225. Numerals 326 through 328 denote the piezoelectric trilayers of each piezoelectric focus. Numeral 329 represents a layer of thermal and electrical insulators and element 330 is a schematic representation of the crystal lattice structure, which provides both a dielectric charging means and a nearly perfect reflective surface for deflecting various photon emissions either singularly or simultaneously towards a given target loci, as described in FIG. 67*a*. *FIGS. 67b*, 67*c* are indicative of a single incident beam and the atomic focusing alignment of the piezoelectric lense element. The electromagnetic incident beam is illustrated by element 331, whereas the atomic alignment structure of the piezoelectric lense element is illustrated by numeral 332. The charge or discharging of the electric field provides movement or sliding of lattice plates 332*a* and 332*b* either away or towards one another, as described in FIG. 67*c*.

Figure 67D:
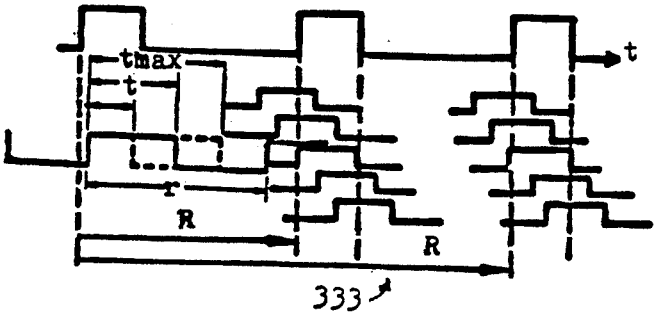
FIG. 67*d* is indicative of a typical electronic pulse generating sequence employed by a single focusing element of the piezoelectric focusing unit.

FIG. 67*d* is a typical electronic pulse generating sequence which is employed by a single focusing element of the piezoelectric focusing unit and is described by the numeral 333. The current in both dielectric or insulating materials can be described in a variety of ways, as indicated by the equations contained herein below and they are applicable, when describing the charged surface of the piezoelectric means. A time varying electric field is applied across a dielectric and the displacement current in the dielectric can be expressed by the following expression $$I\,dis = \frac{d\Psi}{dt} = \frac{d(DS)}{dt} = S\frac{dD}{dt} = S\frac{d(\epsilon E)}{dt} = S\epsilon\frac{dD}{dt}$$

$\Psi$ is described as being the electric flux displaced in the dielectric, D is the electric flux density, S denotes the surface area of the dielectric subject to displacement, $\epsilon$ is the premittivity of the dielectric, and E is the intensity of the applied electric field with dt denoting the specific time internal. The simple electromechanical nature of piezoelectric materials are well known and documented by those skilled in the art and they are recited herein below;

$$\left.\begin{aligned} S &= S^E T + dE \\ D &= dT + E^T E \end{aligned}\right\}\text{stress and electric field are considered independent variables}$$

$$\left.\begin{aligned} S &= S^D T + gD \\ E &= -gT + B^T D \end{aligned}\right\}\text{stress and charge density or electric displacement are considered independent variables.}$$

Here S=strain, T=stress, E=electric field, D=electric displacement, and SE is the elastic compliance at a constant electric field. $S^D$ is the elastic compliance at constant electric displacement, $E^T$ is equivalent to the dielectric constant at a constant stress, $B^T$ is equal to dielectric inpermeability at a constant stress and d and g are piezoelectric constants which are defined as $$d = \left(\frac{\partial S}{\partial E}\right)_T = \left(\frac{\partial D}{\partial T}\right)_E$$

$$g = \left(\frac{-\partial E}{\partial T}\right)_D = \left(\frac{\partial S}{\partial D}\right)_T.$$

Figure 68:
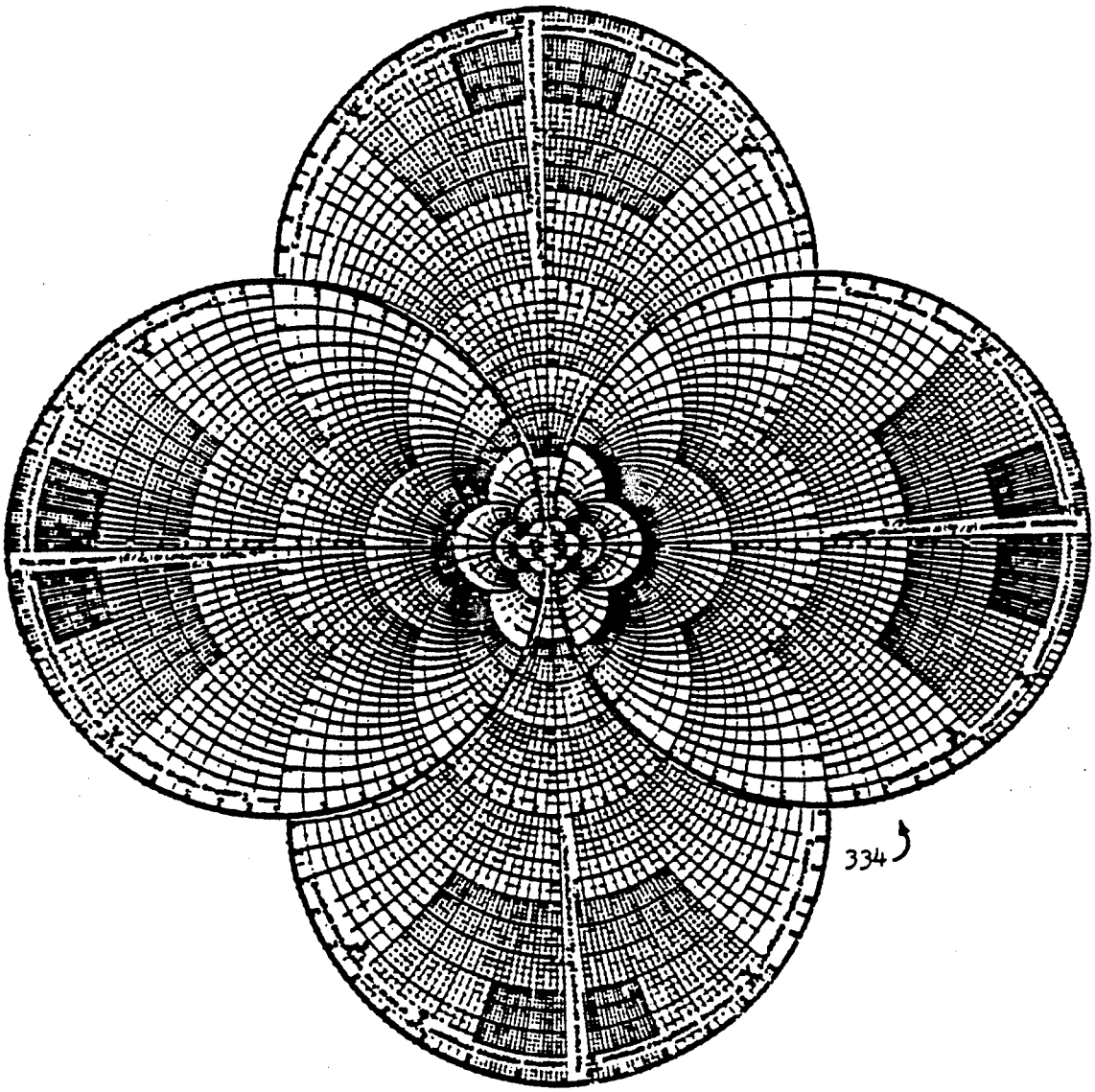
FIG. 68 describes graphically the deflective and reflective focusing dish of a single piezoelectric parabolic focusing lense.

FIG. 68 is a simplified graphic illustration of the deflective and reflective focusing dish of a single piezoelectric parabolic focusing lense. The single numeral 334 describes what appears to be the overlapping of no less than four overlapping Smith charts with an irregular central focus.

Figure 68A:
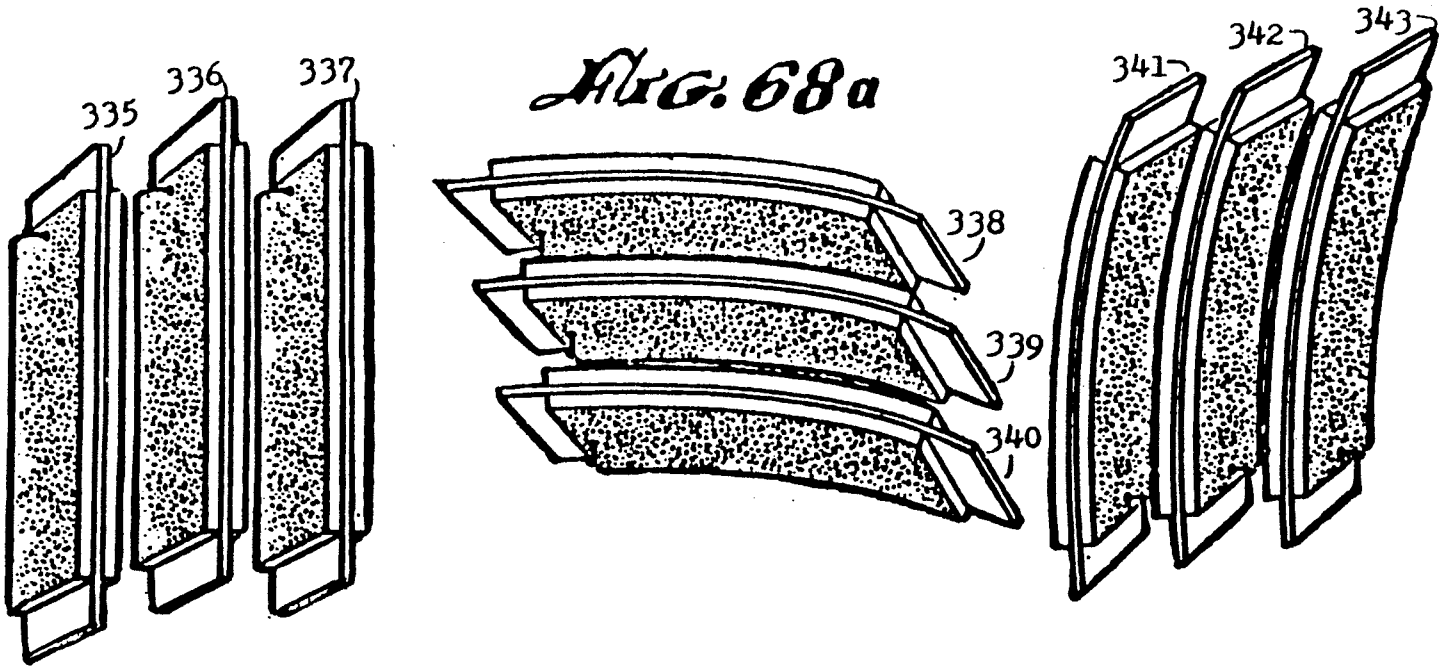

FIG. 68*a* represents the structural configuration of the underlying piezoelectric focusing elements which consists of a series of mutually exclusive overlapping plates. The plates are formed from a laminated trilayer composed of a suitable medium such as lead zirconate titanate or an equivalent compound well known by those skilled in the art. Numerals 335 through 343 denote an assemblage of separate piezoelectric plates. Numerals 335 through 337 depict the plates in their ambient uncharges states. Numerals 338 through 340 as well as 341 through 343 depict a series of antagonist and protagonist plates which are interdisposed in a crisscross or patched matrix design which provides rapid movement of a single focusing element in three dimensions.

Figure 69:
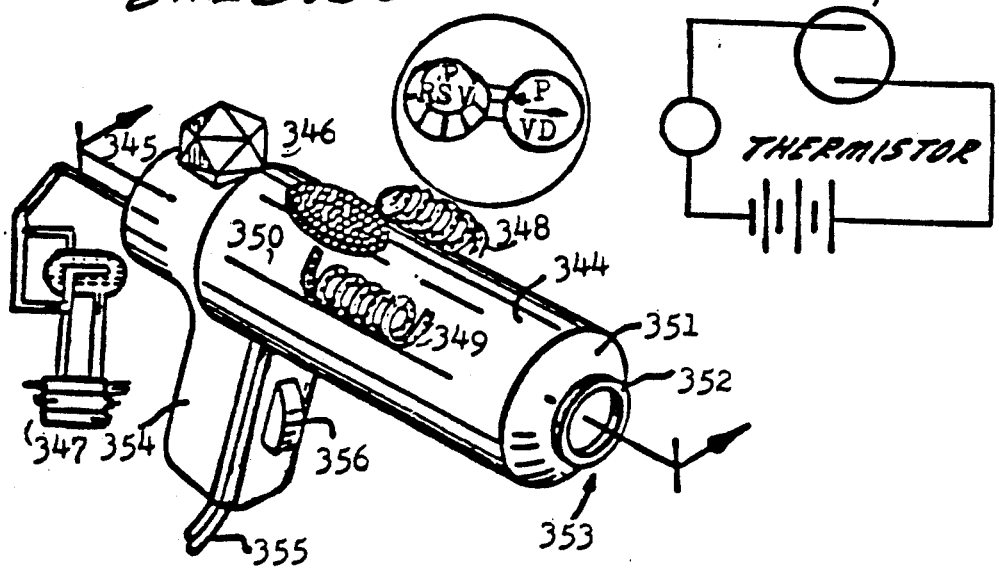
FIG. 69 is a pictorial view of the laser pulsar device.

FIG. 69 is a pictorial view of the laser Pulsar device which has only a slight modification in the basic design features of subsystems over the Portable Laser Device U.S. Pat. No. 4,276,520 issued to the inventor hereof. Numeral 344 describes a cylindrical body which terminates in a smaller graduated rear or aft port, as described by numeral 345. A full complement of heat exchangers and coolant recycling means are denoted by numerals 346 through 350. Numeral 346 denotes an active contrifugal pump means, refill vessel and coolant regenerator means. Numeral 247 illustrates a secondary coolant reservoir and heat exchanger means. Elements 348 and 349 describes passive lateral heat exchangers and condensors for the coolant means. Numeral 350 illustrates a full complement of passive thermally operative selectively directional microvents which are equivalent to those represented by 350, but not shown here. The front taper of the device is illustrated by numeral 351. Numeral 352 depicts the outer focusing system and the emission axis, as described by numeral 353. A pistal grip insertion, coaxial powered cable and manual switch element are noted by numerals 354, 355 and 356. A typical simplified thermal feedback sensor is illustrated by numeral 357.

Figure 69A:
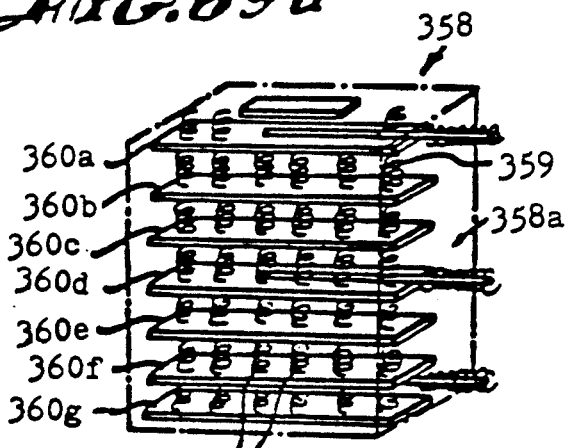
FIG. 69*a* is a detailed view of the heat dissipating cube structure at the rear of the device.
Figure 69A:
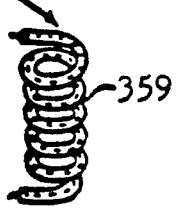

FIG. 69*a* is a detailed view of the heat dissipating cube structure located aft of the device. Numeral 358 denotes a solid state cube structure heat transfer and dissipation means. The cube has an outer thermal dissipation medium composed of a special nylon phenolic quartz acrylic compound numeral 358*a* which remains solid until thermally activated, where it sublimates into a gaseous substance at a controlled finite rate. Numeral 359 denotes one of a plurality of microcoiled super heat exchangers employed to conduct and or transfer heat between a series of conducting plates described by numerals 360*a* through 360*g* and the thermal dissipation medium.

Figures 69B, 69C, 69D:
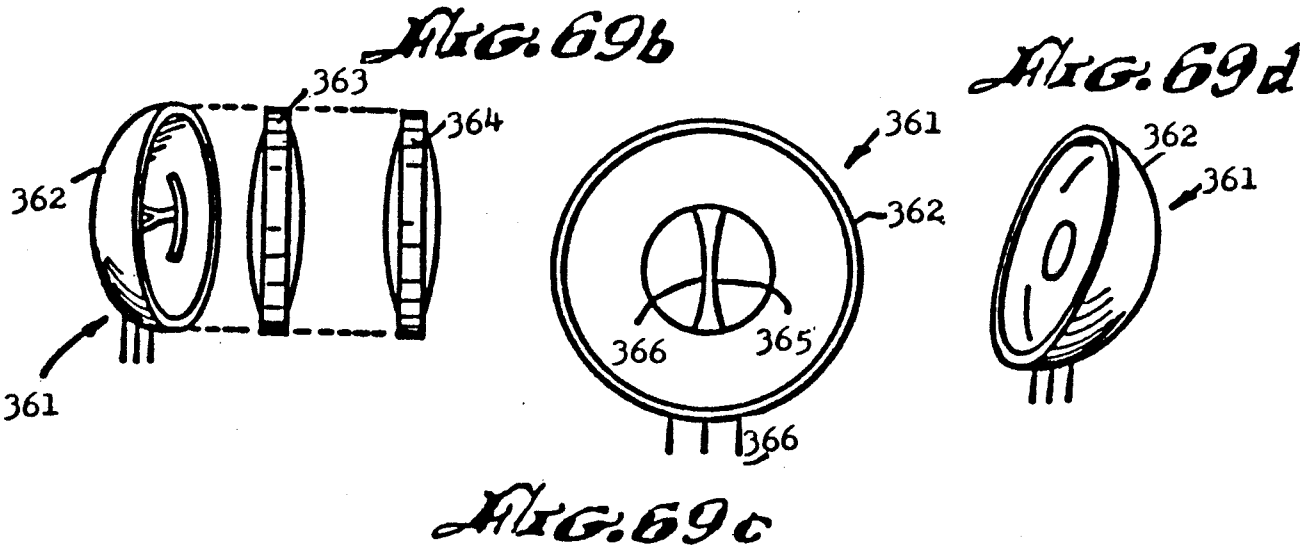
FIG. 69*b* and 69*d* are schematic detailed views of the parabolic reflector and photon emission diode source.

FIG. 69*b* describes a high energy emissive diode and parabolic reflection and selectively emissive mirror means. Numeral 361 denotes the entire parabolic diode system. Numeral 362 describes the parabolic reflector and positioned at the center of the parabolic reflector are electrodes described by numerals 365 and 366, which denote a separate anode and cathode means that when energized produces an intense arc and then the device constitutes a light emissive diode. Numeral 363 designates a light transparent lens member, which forms the face of the photon emission source. Numeral 364 designates a polorized mirror means which reflects the resonate light, which is produced in the lasing rod proper and selectively allows the diodes emission to freely be transmitted.

FIGS. 69*c*, 69*d* denotes a simplified perspective view of the emission diode means.

Figure 69F:
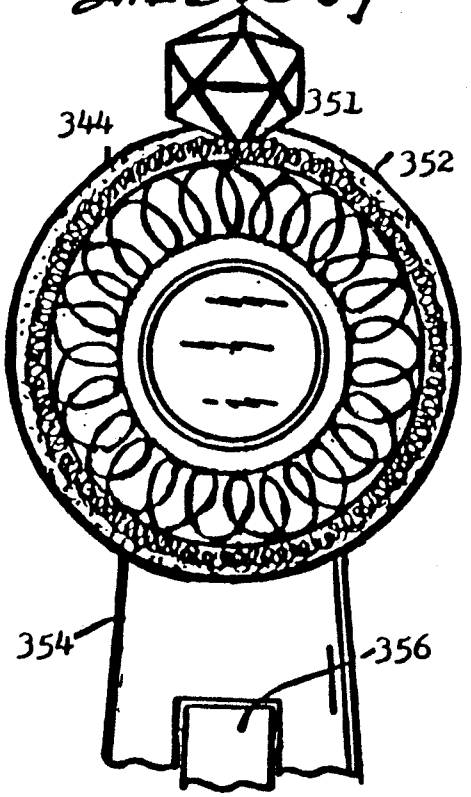
FIG. 69*f* is a front view.
Figure 69E:
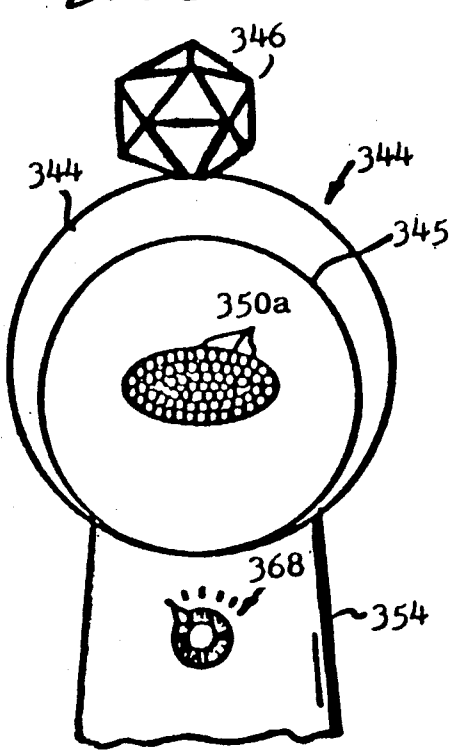
FIG. 69*e* is a rear view of the device.

FIG. 69*e* is a rear perspective view of the Pulsar device. Numeral 350*a* denotes an additional unidirectional microvent structure equivalent to those of numeral 350. It is deployed to relieve any additional pressure which may build up in the body of the device due to an increase in the thermal kinetic parameters of the unit. The function of the microvent structure is to allow ultra high pressure gas vapors and excess residual heat to escape from the laser system eliminating a forced chamber reaction which can cause the unit to explode. Excesses in the thermal conductivity and vapor then exit through the microvent via a pressure gradient. Numeral 368 designates a rotary switch means which control a group of resistive elements.

FIG. 69*f* describes a partial pictorial view of the front of the device less the ancillary support structures.

Figure 69G:
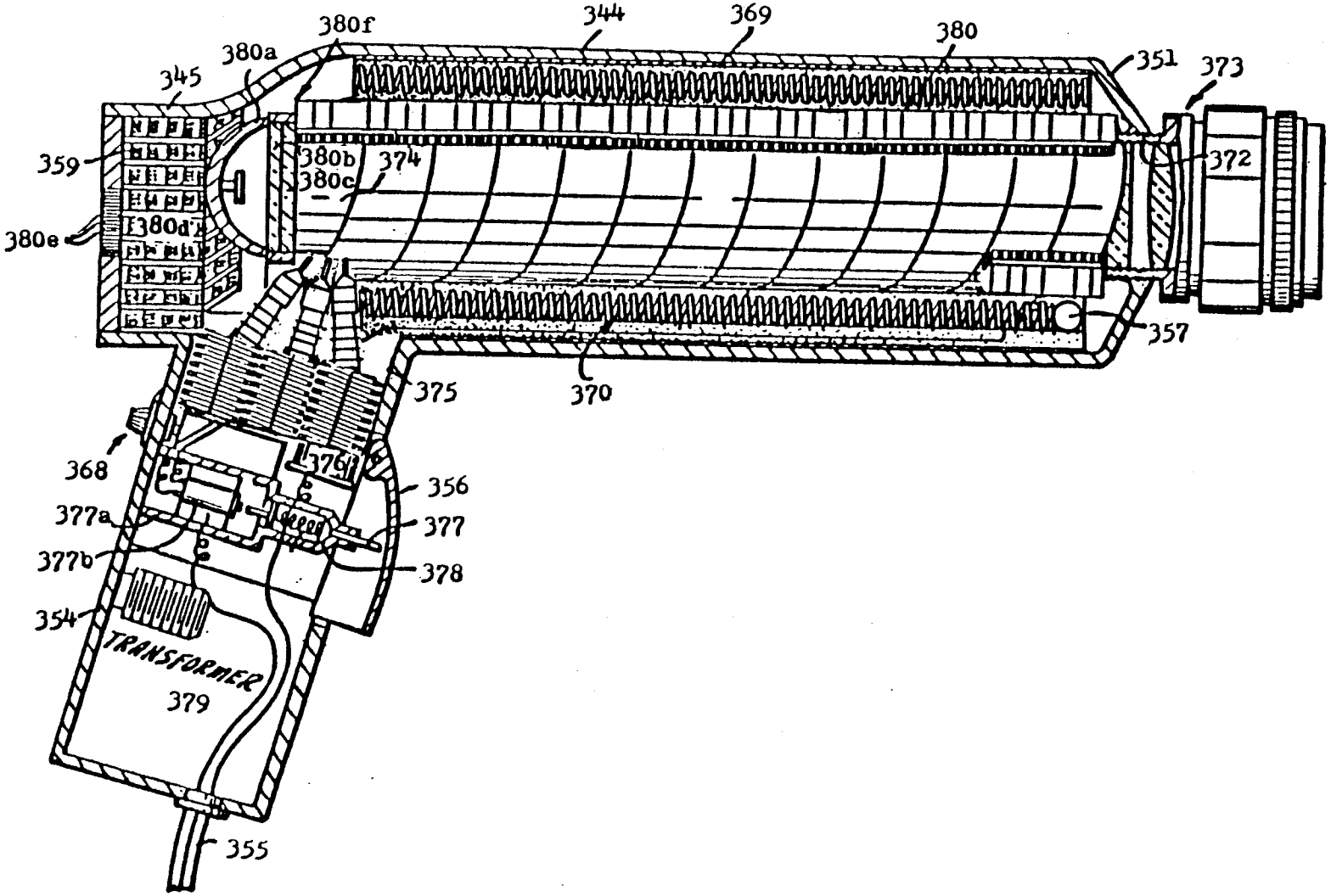
FIGS. 69*g*, 69*h* are sectioned views of the device.

FIG. 69*g* is a sectional view of the Pulsar device with all structures listed from the previous figures excluding the ancillary support systems. Additional elements are listed and depicted in numerals 369 through 380. Numeral 369 describes a light reflective inner jacket lining composed of suitable material, such as a chromium alloy which is preferable. Numeral 370 denotes a plurality or network of longitudinally extending microcoils, each of which forms a helical heat pipe denoted by numeral 371. At the front of the unit is an automated/manual focusing device, numeral 373 which is comprised of lenses that are relatively moveable, angularly and axially for focusing purposes. Numeral 372 designates a circular track and a complementary glide means in which a forward or backward circular motion provides focusing. Numeral 373 denotes an outer view of the automated focusing turret means. Numerals 374 designates the laser active rod which is composed of a suitable lasing medium, such as neodymium doped yttrium aluminum garnet (Nd:YAG) Lanthanam beryllate or other suitable lasing mediums well known by those skilled in the art. The flash tube is illustrated by numeral 380 and it has a closely packed helical design. The coiled flash tube is the type which has a wavelength and a pulse frequency which corresponds to the absorption bands of the laser rod element. This initiates an elevation in the population inversion levels which approach the threshold valve for a desired mode. The dimensions of the rod element is so constructed as to have, provide and maintain an acceptable loss gain ratio, (length to diameter ratio). In the case of (Nd:YAG) or similar such material there is a 1:9 ratio while other more preferable ratios apply to other suitable rod components. The phase and frequency modulation of emission beams can be described in a simplified expression relating the change in cavity length to the change in frequency which is noted herein below;

$$\Delta f = \frac{C}{L} \frac{\Delta L}{\lambda}.$$

$\Delta f$ denotes the change in optical frequency, L is equivalent to the laser cavity length. $\lambda$ describes the optical wavelength of laser output and C is equal to the velocity of light in the laser cavity.

Numeral 375 of FIG. 69*g* denotes a triad of radiofrequency elements and voltage generating coils which are employed to provide additional electronic excitation to the laser active rod element decreasing the temporal interval of population inversion within the laser active material, and also provides more peak transit intervals which are spaced closer together and are readily understandable and known to those skilled in the art. Numeral 376 denotes an oscillatory means. Numeral 377 designates a microswitch mounted in housing 377*a* and numeral 377*b* which describes a high voltage ignition means. A simple spring means is denoted by numeral 378. Numeral 379 describes a secondary transformer and automated ignition system. Elements 380*a*, 380*b*, and 380*c* designate the emissive diode, transmission, and the partially emissive partially reflective mirror means. Elements 380*d*, 380*e* and 380*f* designate the solid state cube, microvent and the aft section, as described in FIG. 69*h*.

Figure 69I:
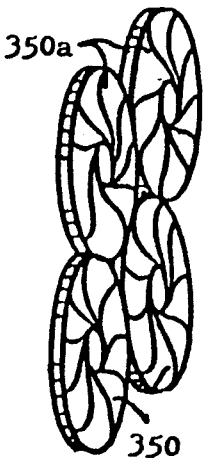
Figure 69H:
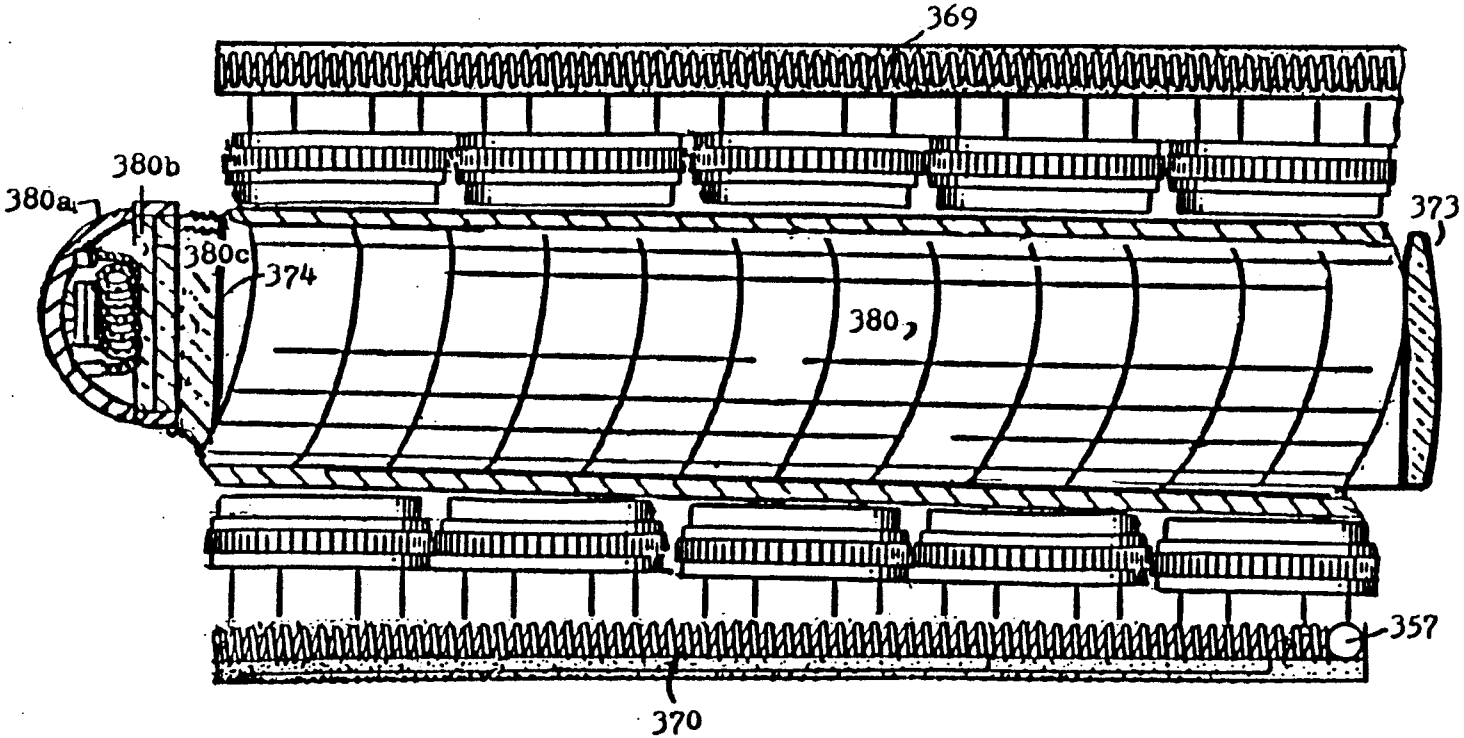

FIG. 69*i* describes in an illustrative manner the microvents 350 and 350*a*.

Figure 69J:
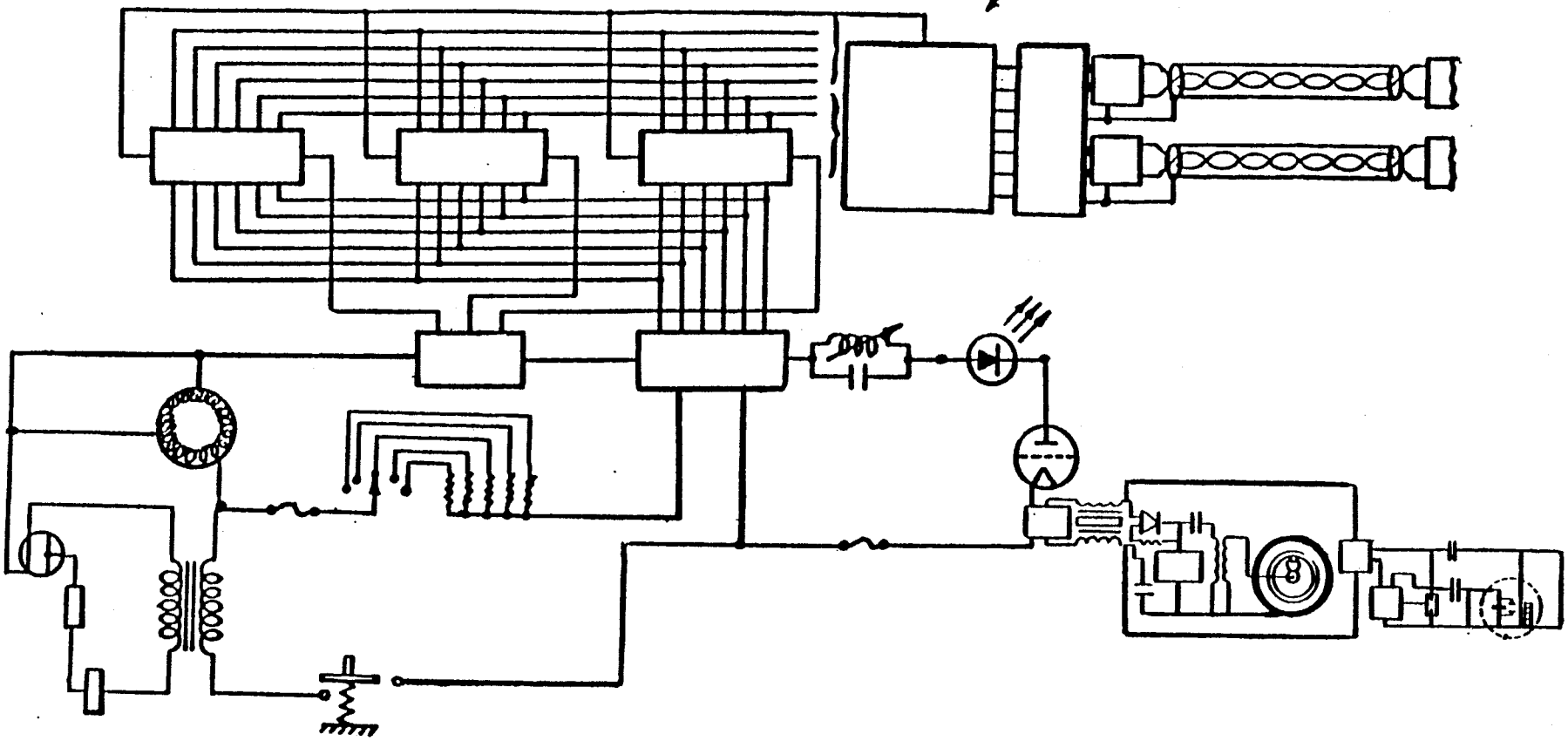
Figure 70:
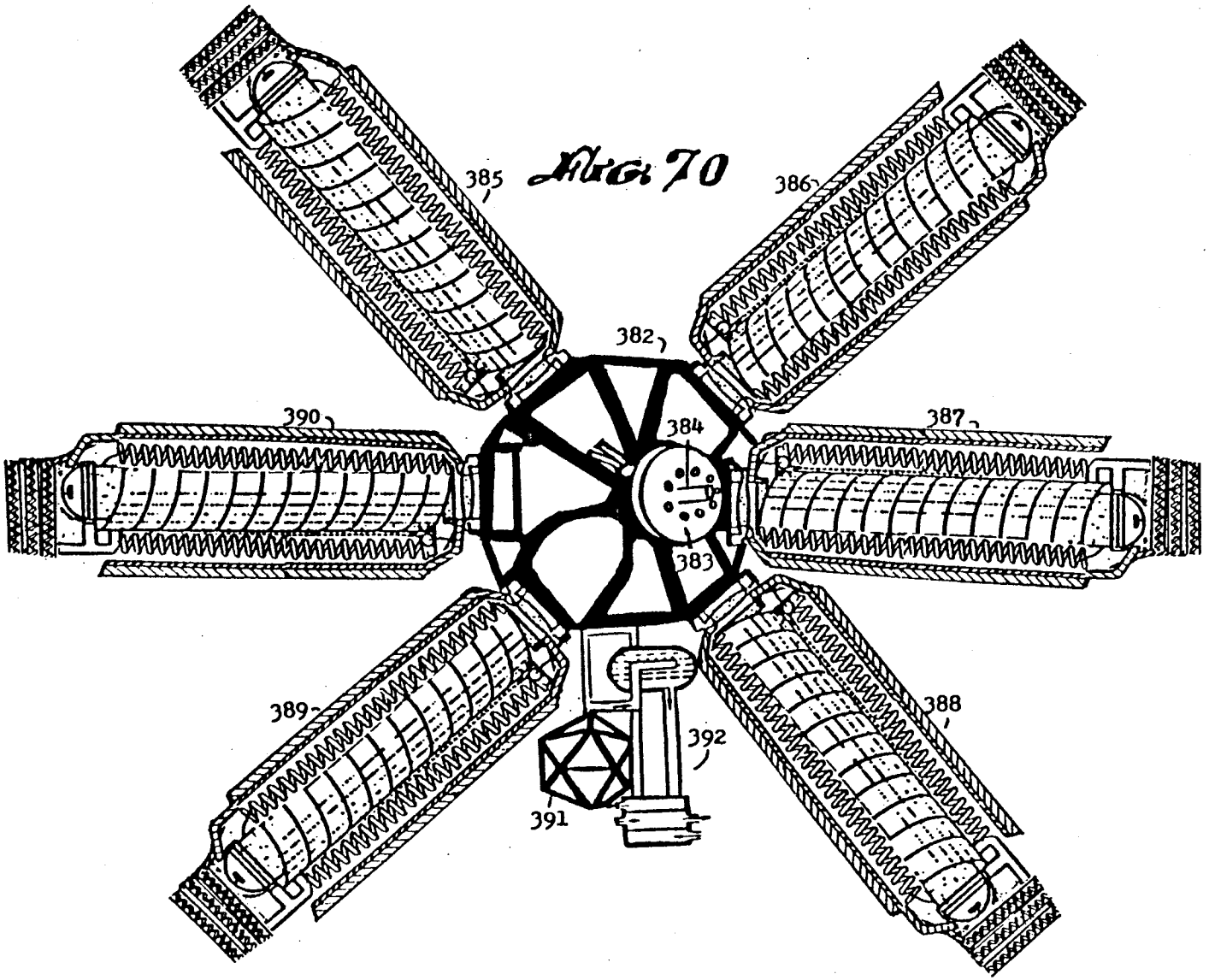
FIG. 70 is a sectional view of the entire outer resonant cavity and main focusing dish for one of two Megapulsar devices.

FIG. 69*j* describes only in part an extremely simplified version of a circuit diagram which governs the flash tube and the diode means described collectively by numeral 381.

FIG. 370 designates a sectioned topographical overview of the entire resonant cavity focusing dish and the like of one of two Megapulsar means. The basic operative pumping element for the Megapulsar is the Pulsar device, a modified version of the Portable Laser Device, previously patented by the inventor herein. Numeral 382 denotes the central resonant cavity. Numeral 383 describes the main focusing dish and numeral 384 describes the exposed portion of the primary resonant lasing rod, which also happens to be the central focus of the entire unit. Numerals 385 through 390 are a partial sectional presentation of the full complement of Pulsar generators. Each Pulsar designate represents three equivalent Pulsar devices which are arranged in series; such that each accumulatively pulses the others as will be shown in the next two figures. Numerals 391 and 392 denote an active pump/coolant reservoir heat exchanger means for the device.

Figure 71:
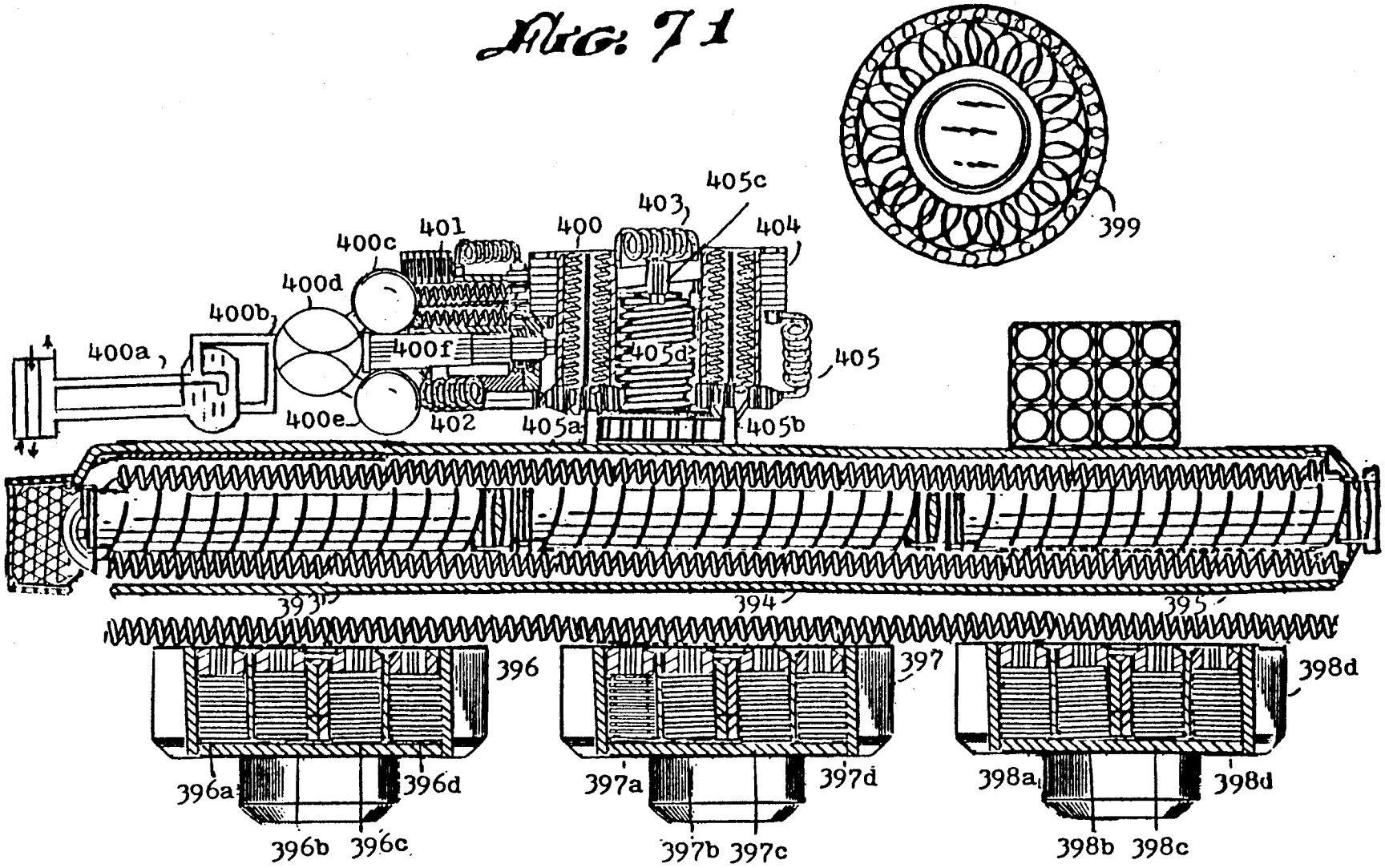
FIG. 71 is a detailed sectional view of one of six multiple pulsar triads which are arranged around the periphery of the Megapulsar.

FIG. 71 is a detailed sectioned view of one of six multiple triads which comprising eighteen separate and equivalent Pulsar units employed to collectively pump the central or primary resonant cavity of the Megapulsar device. Numerals 393, 394 and 395 describe the laser triad with each successive laser unit pumping the other as well as lasing independently of each others laser means. Numerals 396, 397 and 398 denote the separate but equivalent radiofrequency units which accompanies each Pulsar unit. Within each cavity from each radiofrequency unit are a series of modulating and charging coils which are denoted by elements 396*a*, 396*b*, 396*c*, 396*d*, 397*a* through 397*d* and 398*a* through 398*d*. Numeral 399 designates in part the highly reflective sheet encasing the outer periphery of the entire triad. Each triad denotes an extreme amount of thermal radiation, in order to prevent melt down or an explosion of the resonate core elements. A automated pump means is provided in order to circulate additional coolant which is both supplied by a reservoir and regenerated from coolant which is already expanded. Numeral 400*a* denotes a passive heat exchanger means. Numerals 400*b* and 400*c* depict a secondary and primary coolant reservoir, respectively. Numerals 400*d*, 400*e*, and 400*f* denote an active centrifugal cycling pump unit. Elements 400 through 404 are a series of microcoiled heat exchanger expanders, condensers and regenerative means. Elements 405 through 405*d* designates a combination Sterling heat engine and refrigeration means, which are utilized to supply auxiliary energy to the pump unit.

Figure 71A:
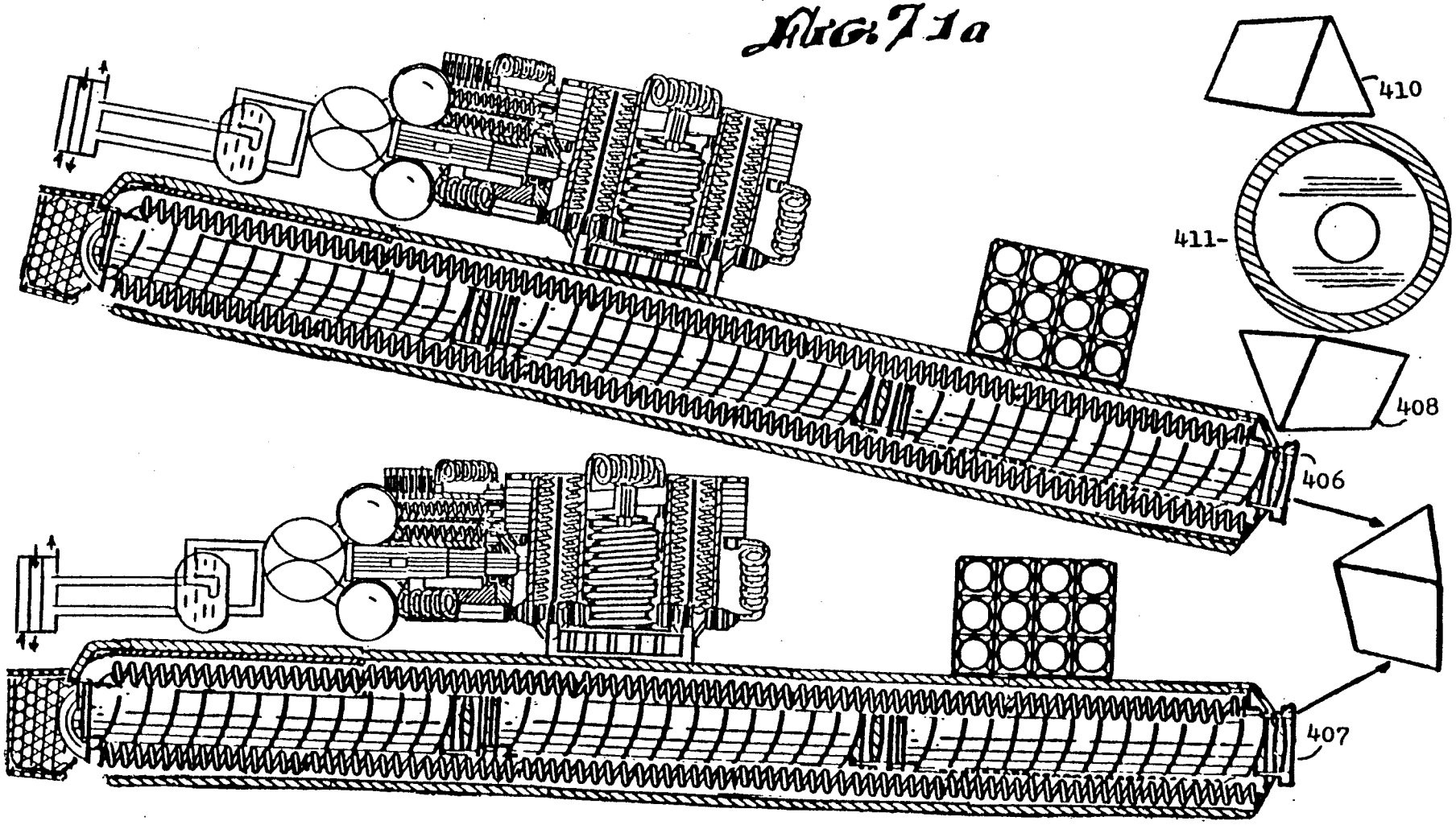

FIG. 71*a* is a detailed sectional view depicting a single pair of triads. Here two laser triads, numerals 406 and 407 are critically angled to accumulatively incident on a prism element which is denoted by numeral 408. Each prism element of which there are three is described by numerals 408, 409 and 410 incident on a single primary parabolic focusing dish which is denoted by numeral 411. Each prism means is composed of a suitable lasing material and both the prisms elements 408 to 410 and the primary internal parabolic mirror means numeral 411 are actively cooled by an array of coolant systems equivalent to those previously mentioned but not shown specifically in FIG. 71*a*.

Figure 72A:
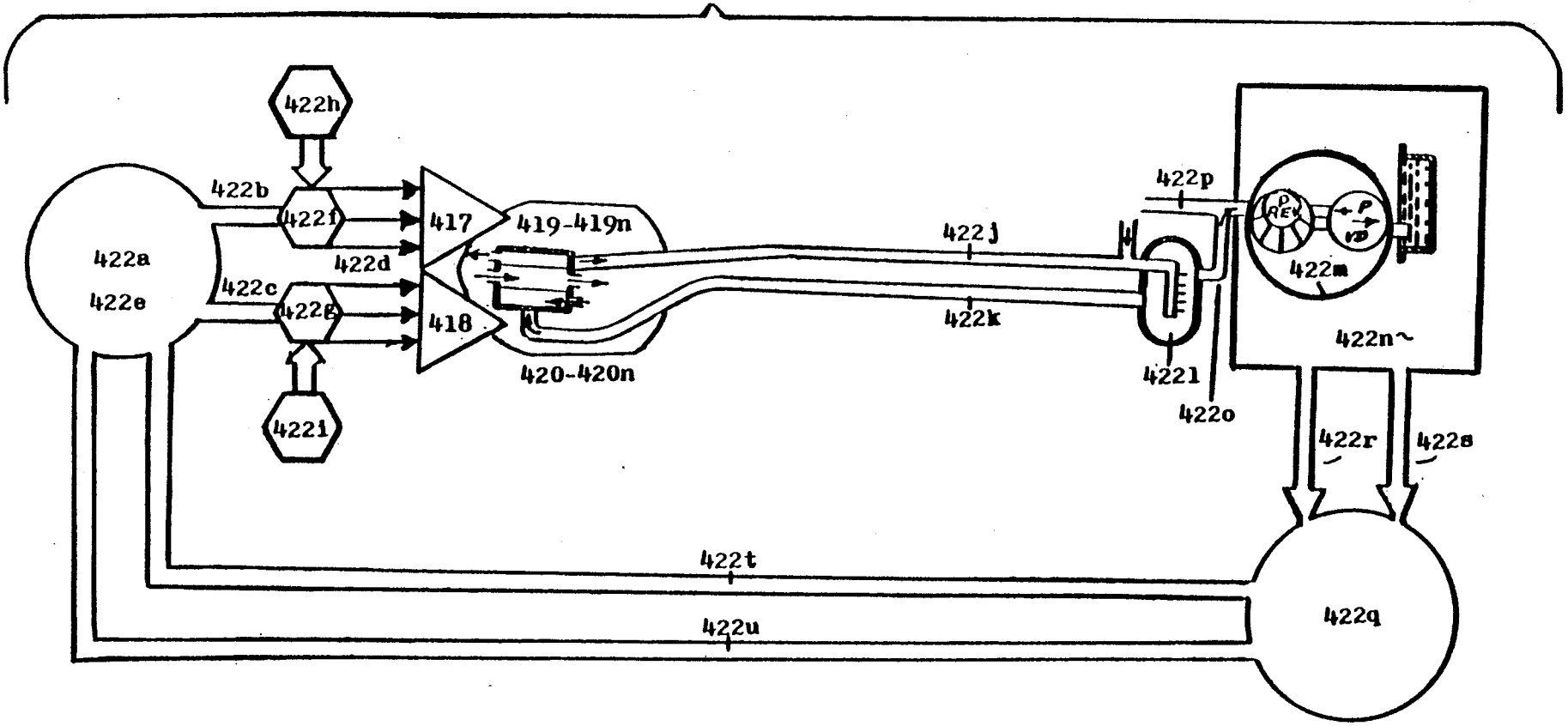
Figure 72:
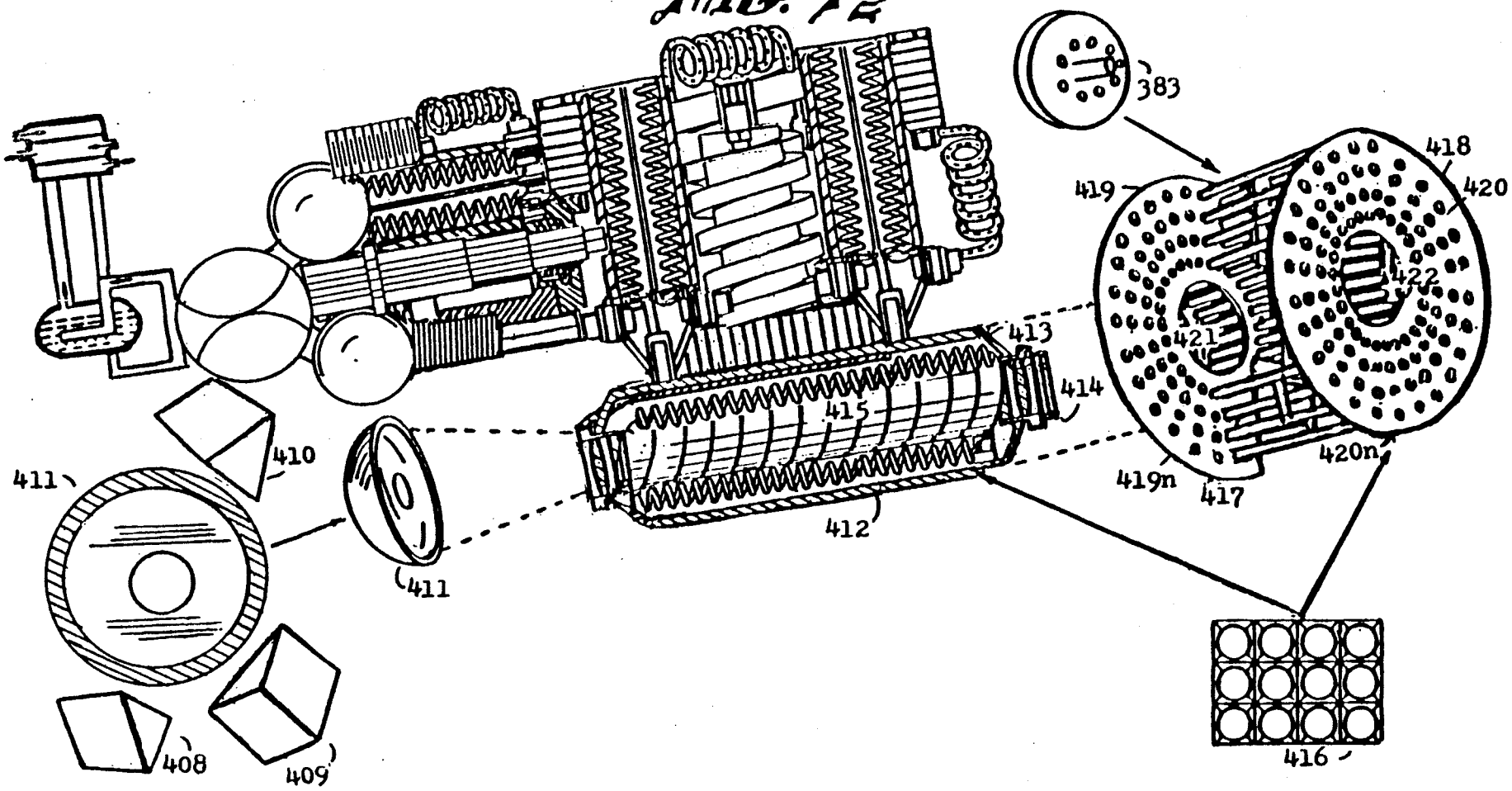

FIG. 72 is a detailed schematic and exploded view of the main resonant cavity and the primary focusing dish for the Megapulsar unit. The basic configuration of the resonant cavity described by numeral 412 conforms to that of the Pulsar device with the exception that eighteen separate and distinct Pulsars pump the internal resonant cavity through element 411. The energy is then focused onto a secondary collimating means designated by numeral 413, which supplies a specially controlled dielectric mirror means, which is described by element 414. The rod is composed of a suitable lasing material such as Alexandrite or its equivalent designated by element 415. Alexandrite is a synthetic material commercially available from Allied Chemical and other commercial sources. Alexandrite has some unique properties in that by altering the frequency modulation rate, field strength, intensity, and other parameters of the resonant cavity, selectively having the capacity to alter the specific exit emission leaving the cavity. The operation of (Nd:YAG), lanthanum beryllate, and Alexandrite are well known and practiced by those skilled in the art. A sectional view of the primary focusing dish is denoted by numeral 383. The outer most component of dish 383 is composed of a highly reflective chromium tungston titanium alloy, which is designated by numeral 416. Two concentric heat exchanger plates numerals 417 and 418 provide the mainframe of the focusing dish. Each of the underlying or internal heat exchanger plates 417 and 418 are perforated with and fitted with a circular array of tubular structures collectively designated by numerals 419 through 419*n* and 420 through 420*n*, respectively. Each tubular structure circulates a coolant which is supplied by a suitable pump means, coolant reservoir and auxiliary means which was described previously in regards to the main resonant chamber. A portion of resonant rod enters and exits the main focusing dish through orifice 421.

The assemblage of components governing the distribution of the coolant medium to and from the primary focusing dish means is described in part by FIG. 72*a*.

Numeral 422 designates collectively reservoirs containing the coolant or heat exchanger medium which is formed from a suitable metallic liquid or modified aqueous medium. Suitable metallic heat exchanger medium or coolant means consisted of but were not limited to amalgamations of liquified sodium, potassium and mercury. A large number of aqueous coolants are heat exchanger were deployed ranging from glycernated water and alcohol to liquid synthetic graphite mediums. The average mean transit recycling period for aqueous coolants varies from a factor of four to one order of magnitude which intern varies directly with the power of the duty cycle. Here the duty cycle is a function of the incident energy retained within the lattice structure of the primary focusing mirror means in the form of heat which is available for absorption by the said coolant medium regardless of the heat capacity of the given coolant medium. The process or mechanism by which the coolant is recycled will be discussed briefly in the following sentences. The coolant medium from the secondary reservoir is continuously replenished from common return lines leading from a primary reservoir. The content of the secondary reservoir are conveyed through undirectional tubules or conduits structures which feed into a multitude of narrow channels contained within the internal structure of the primary focusing unit. The full complement of narrow channel element collective form a network wherein coolants circulate and absorb excess residual heat. The superheated coolant medium moves passively from the network of internal channels to a collection vessel wherein the accumulated superheated coolant medium is conveyed by conduits to the MDH system. The heat absorbed by the coolant medium is discharged through said MDH system and the energy contained within the high pressure superheated coolant is transduced to electrical energy by conventionally driving turbines associated with various generator means and the like. The coolant after dissipating its heat by ancillary conduit means wherein the cycle is repeated continuously over the duration in which the primary focusing element is actively engaged. The coolant medium contained within the confines of secondary reservoir 422*a* are conveyed to conduit 422*b*, 422*c* leading to a network of internal flow channels described collectively by numeral 422*d*. The dispersal of said coolant medium designated by numeral 422*e* is controlled by governor outlet values 422*f*, 422*g*, respectively. The release of coolant from the governor means are controlled by elements 422*h*, 422*i* which disclose the action of either automoniated solenoids, a passive release system actuated by thermal parameters and or a manual overide system not shown; which operates within the confines of a conventional feedback system. The feedback system schematically shown herein below entails a signal processing and comparator means, an error detector mechanism sensory array and systems exerting either positive or negative forcing function on an operator means.

The mechanisms of conventional open and closed loop feedback systems are well known by those skilled in the art, are straight forward and therefore will not be discussed in any great detail.

The fine network of channels described by numeral uniformly convey coolant to concentric heat exchanger plates 417, 418 of focusing dish 383. The coolant medium is conveyed to exchanger plate means 417, 418 through the aforementioned array of tubular structures designated collectively by elements 419 through 419*n* and element 420 through 420*n*. The aforementioned tubular structure defined by element 419 through 420*n* allows heat exchanger plates 417, 418 to communicate with one another via the uniformed flow of coolant through said tubular elements. The coolant continues to flow through the tubular elements of the heat exchanger means eventually terminating at retrieval ports described collectively by elements 422*j* to 422*k*. The retrieval ports transfer the superheated coolant medium into a common collection channels which intern conveys its contents to a combination collection vessel and passive heat pump means designated by numeral 422*l*. The superheated coolant and or heat exchanger medium is upon exiting unit 422*m* conveyed to the MHD system numeral 422*n* by return conduits 422*o*, 422*p*, respectively. The superheated coolant once in the confines of the MHD system discharges the excess residual heat which is recovered by the system and converted or transduced into electrical energy. Ancillary generators driven by turbines contained with secondary closed systems are utilized as secondary or backup systems in the event of the MHD system suffers a system failure and or is overloaded. The expended coolant recovered from the MDH system is transferred from said system to a primary reservoir means 422*q* by recovery conduits 422*r*, 422*s* wherein the reclaimed coolant or heat exchanger medium is ready to be recycled once again.

The contents of the primary reservoir means defined by numeral 422*q* are passively conveyed through conduits 422*t*, 422*u* to the aforementioned secondary reservoir means previously defined by numeral 422*a*. It should be remembered that while the coolant is no longer superheated; it is however under a considerable amount of pressure relative to the pressure contained within the vessel of the secondary reservoir means and it is the pressure gradient which enables the coolant to passively move from the primary to the secondary reservoir means.

Thus far the Pulsar resonant cavities has been discussed within the contexts of a solid crystalline laser active media, however non rigid and non crystalline laser active medias alluded to earlier have some distinct advantages. One distinct advantage of a gaseous ion plasma laser active media over a solid crystalline configuration is that during an acquired lasing sequence the crystalline resonate media, over extended periods of operation has a tendency to fracture, whereas plasma or ion laser cavities are self healing. Another distinct advantage of plasma mediums is that they are continuously renewable providing recharging reservoirs with the necessary volatile constituents. Still another distinct and obvious advantage of deploying a free flowing plasma laser active media is that such medias are particularly susceptible to undergoing prolonged stimulated emissions when subjected to radiofrequency oscillations. The basic configuration of a laser Pulsar or Megapulsar system remains basically the same as previously indicated with the exception that various recharging reservoir, not shown, are presently along with various inlet and outlet structures, which are also not shown here. Many such high energy laser active plasma medias are available such as deuterium floride, hydrogen floride and other more suitable medias. The typical overall efficiency rate of absolute energy input to initiate lasing and emissive output for plasma or ion systems runs from 10–25%, whereas the same rating for solid state lasers runs from only 1–2%.* There is one further point which needs to be mentioned, only in passing, a $CO_2$ folded laser was constructed and subsequently deployed for target acquisition (laser doppler radar) and it had a maximum continuous duty cycle of slightly more than 100 watts. A typical Md:YAG or similar such device would generate high power increments in the kilowatt or gigawatt range, however it is restricted to a pulse effective duty cycle ranging from several pico seconds to several nanoseconds. The laser Pulsar or Megapulsar devices are in a separate category than the aforementioned conventional laser system; however the same basic laws and conditions governing the systems operations apply to the set systems. Contained herein below are a few typical field equations reciting only in part some of the basic laws concerning output, internal resonance and the like.

*refers to a crystalline laser media.

Typical laser output power as is computed by $$P_{OUT} \frac{sAr_1^{\frac{1}{2}}t_2\,[goL - \ln[(r_1r_2)^{-\frac{1}{2}}]]}{(r_1^{\frac{1}{2}} + r_2^{\frac{1}{2}})(1 - (r_1r_2)^{\frac{1}{2}})}$$

SATURATION INTENSITY = $I_S$
EFFECTIVE BEAM CROSS SECTION = $A$
MIRROR REFLECTIVTIES = $r_1$, $r_2$
OUTPUT MIRROR TRANSMISSION = $t_2$
SMALL SIGNAL GAIN = $go$
ACTIVE GAIN LENGTH = $L$

Gain, loss, and coupling difference for gas lasers and the like $$\Delta v = \Delta v_h \left[ \frac{goL}{\mathrm{Ln}(r_1r_2r_3)^{-\frac{1}{2}}}\ 1/2 - 1 \right]^{\frac{1}{2}}.$$

Length dependence
$\Delta v = C/4L$

FREQUENCY SEPARATION BETWEEN MODES

Frequency separation between modes is $$\Delta v = \frac{C}{2L} = \frac{1}{T}$$

DOPPLER WIDTH

For thermal (Maxwellian) motion, intensity distribution caused by Doppler effect is $$1(v + \Delta v) = lo \exp(-\Delta v^2/\delta =)$$

where $\delta = (2kTv/Mc^2)^{\frac{1}{2}}$
Doppler line width

If laser operation occurs in more than one temporal mode but in only one spatial then all temporal modes must be at different wavelengths. The laser oscillation can occur only when there are an integral number of half wavelengths between the end mirrors.

Wavelengths, $\lambda = 2L/q$, where q = number of electric field nodes in resonator, or number of half wavelengths.

RESONANT CAVITY LOSSES

-continued $$Q = 2\pi \frac{\int_{-\dim}^{+\dim} f(x)c\,\frac{xy3dx}{dt}}{\int_{n-1}^{n} f(x)(T_{ABS}Q_{ABS})(T_{DIFF}Q_{DIFF})(T_{REFL}Q_{REFL})} = -2\pi \frac{E}{T(dE/dt)}$$

$T$ = time interval $\frac{1}{f}$

Losses:
passive absorption and scattering ($T_{ABS}$, $Q_{ABS}$)
diffraction ($T_{DIFF}$, $Q_{DIFF}$)
imperfect reflection ($T_{REFL}$, $Q_{REFL}$).

FIG. 72 depicts sectional views of a single Megapulsar device as well as the specific design of the main resonant cavity. This includes the main focusing parabolic reflector, focusing dish and laser active materials. Numeral 423 designates a perspective view of the Megapulsar device. Numeral 424 describes the prism and main parabolic reflector alignment, whereas numeral 425 diagrammatically depicts the primary resonant cavity. Numeral 426 defines a perspective view of the primary resonate cavity and the main or primary focusing dish.

Figure 73:
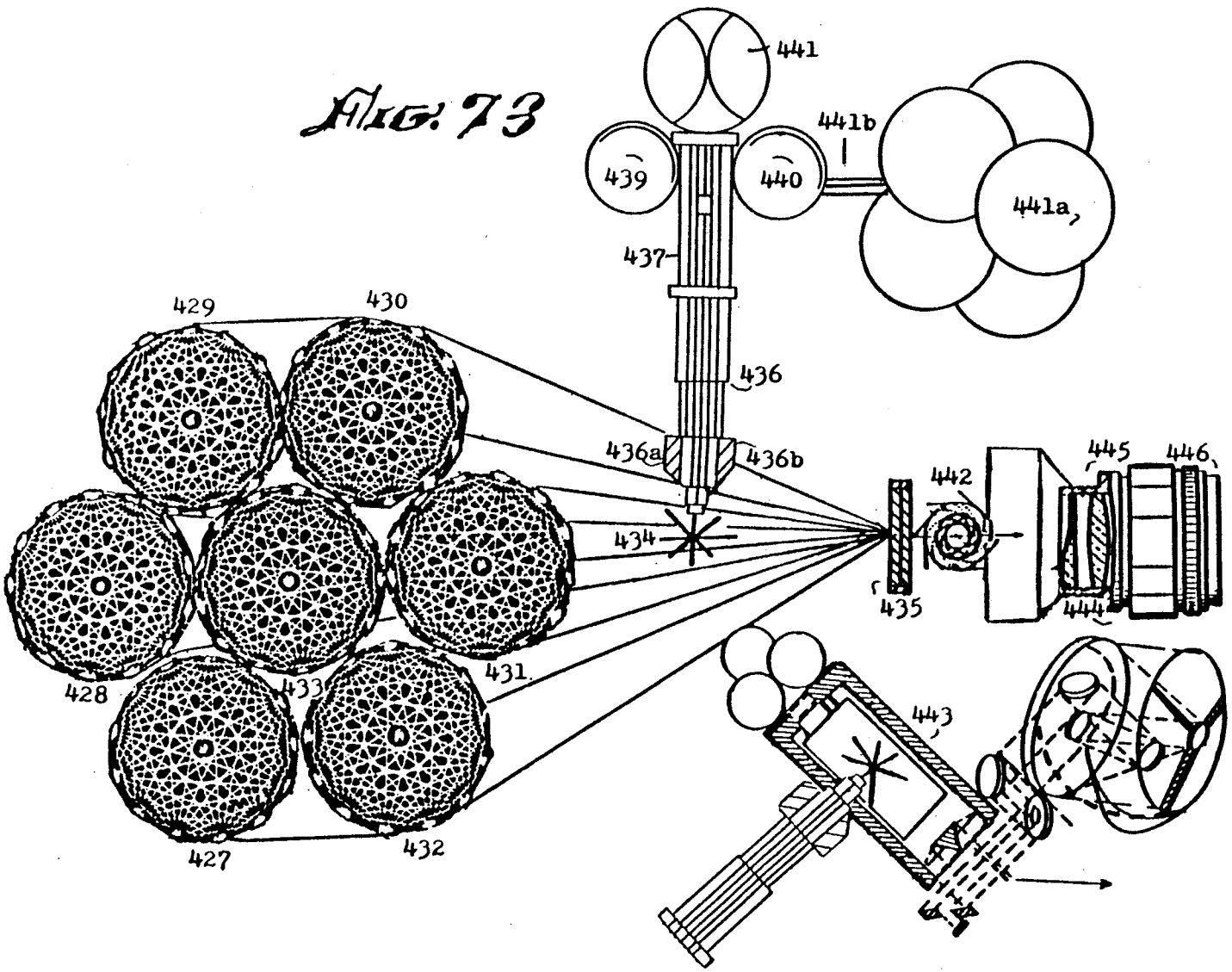

FIG. 73 denotes a greatly simplified schematic representation of a chemical combustion type laser. Combustion lasers are readily manufactured and basically consist of combustable fuel and oxidant which chemically combines under a prescribed ignition sequence, within the context of a resonate cavity. The excitation of atomic structures produce the typical population elevation and inversion necessary to initiate a typical lasing sequence. The central resonate cavity consists of an array of automated mirrors which are depicted by numerals 427 through 433 which collectively focuses the atomic excitation sequence, which is produced by a point detonation indicated by numeral 334 towards a partially emissive, partially reflective mirror means, denoted by numeral 435. The photon emission oscillates back and forth until the population elevation is achieved and then surpassed, initially producing the laser sequence. Numeral 436 designates a fuel oxidant flow channel which terminates in a nossular projection. Elements **436*a* and 436*b* denote electronic ignition coils which are sequentially actuated in a manner as to ignite and subsequently detonate the fuel mixture at regular and finite intervals. Numerals 437 and 438 is a typical cooling column and separator means that maintain the separate integrity and flow status of the fuel and oxidant. Numerals 439, 440 and 441 describe a cryogenic pump and restraining vessels for the fuel and oxidant mixtures. Numerals 441*a* and 441*b* designate the fuel tank reservoirs and carrier means. The exiting beam transmission is indicated in an illustrative manner by element 442. The entire chemical combustion laser unit is encased in a explosion resistant containment cavity described in part by element 443. Numeral 444 and 445 denote a circular guide and track means which rotates to focus the exiting beam via a compound lense assembly, which is described in part by element 446**. Suitable fuels are available including hydrogen peroxide, hydrazine, nitrous oxide or numerous other fuels and oxidant mediums. The basic advantage of the chemical combustion laser is that it remains operative in the vent of a power failure, requiring only a minimum of battery power to initiate ignition. The disadvantages of the chemical combustion type of laser are that the combustibles are potentially explosive, also it is relatively inefficient when compared to other laser systems of the M.A.L.K.E. device and it is also relatively bulky.

Figure 74:
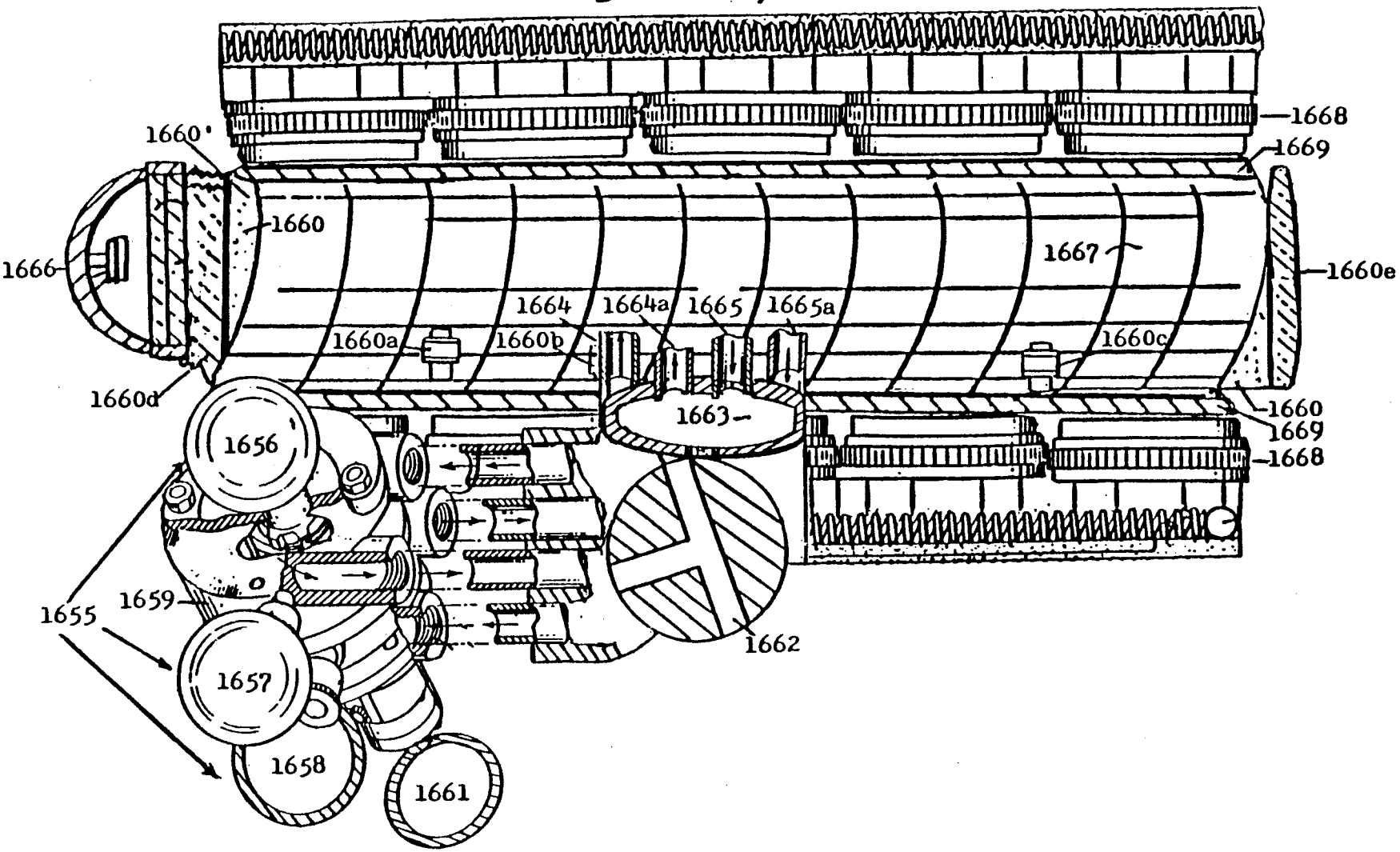
Figure 74A:
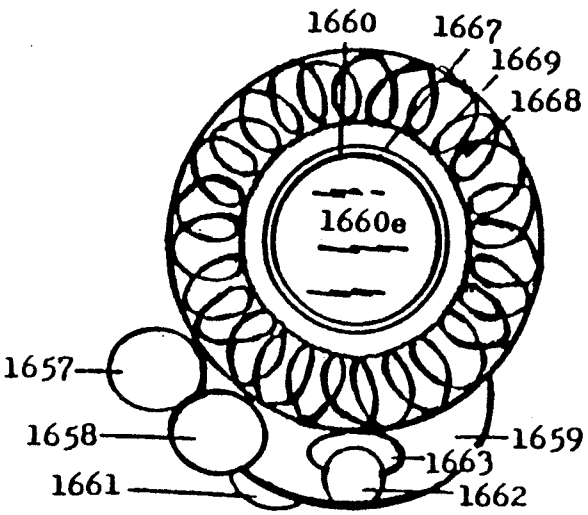

FIGS. 74, 74*a* illustrate in a concise schematic manner variations of the resonant cavity. The minor deviations in the structural configuration of the pulsar and megapulsar resonant cavities are necessarily implemented where a gaseous, liquified or plasma laser active media are employed rather than a crystalline laser media. Numerals 1655 through 1665 disclose a plasma discharge envelope wherein the laser active media is subjected to excitation and a recharging reabsorption facility. The recharging reabsorption facility collectively defined by numeral 1655 consists of storage reservoirs 1656, 1657 and 1658 wherein the laser active media and nitrogen purging units are stored, an bidirectional reversible pump number 1659 allows the plasma discharge envelope number 1660, to be recharged, purged or evacuated, a recovery reservoir number 1661 wherein expended laser medea is stored, an automated three-way valve number 1662 which meters the release of contents emitted by the reservoirs, into a mixing chamber indicated by numeral 1663. The contents of the mixing chamber 1663 enters the plasma discharge envelope 1660 by way of inlet tubules 1664, 1665 and expended contents are conveyed through outlets 1664*a*, 1665*a* recycled through mixing chamber 1663 to pump element 1659 for storage in recovery reservoir 1661.

The diode element and flash coil unit are typical in the pulsar and megapulsar lasers which deploy a crystalline laser active media undergoing extensive modifications. The diode is replaced by photolytic source emitter 1666 and the flashcoil is replaced radial or coaxial photolytic source circumferentially disposed around the plasma discharge envelop.* Element 1666 is a high energy emissive source generator utilizing an electric discharge arc and suitable source material for arcing and a shell encasement to emit ionizing radiation which is dispersed longitudinally along the central axis of the laser unit. Element 1667 is a photolytic excitation element equivalent in function to the flash coil providing excitation circumferentially along the central axis of the laser device inducing significant increased in the frequencies or rate of reemission generated by so called population inversions instituted by the laser active media and subsequently reducing the transit periods required to achieve said population inversions. Element 1667 is circumferentially disposed around plasma discharge envelope 1660 and is composed of an optionally emissive container composed of a quartz pryrex base housing a suitable ionizing gaseous medium, electrode complement and a secondary bombardment grid consisting of source plates and arcing electrodes also formed from suitable materials, shown schematically in part, but not numbered. Element 1667 is adjacent to and abuts up against two structures the plasma discharge envelope 1660 and an array of coaxially disposed radiofrequency coils collectively designed the value 1668. The radiofrequency coils provide excitation to the laser active media 1660', contained within the plasma discharge envelope 1660. Radiofrequency waves pass unimpeded through element 1667 into the resonant cavity. Element 1667 is coated with a metallic ceramic shield, which is unnumbered, that reflects the ionizing emissions generated within said ionization element and the emissive energy generated with the aforementioned, while remaining substantially emissive to radiofrequencies emissions, as indicated previously in the preceding sentence. The assortment of coaxial elements, described by numeral 1668 is encased in a reflective shield which is described by element 1669. Shield 1669 is circumferentially disposed and adjacent to said radiofrequency element 1668. A circumferential array of discharge electrodes are internally within envelope, number 1660 and numerals 1660*a*, 1660*b* and 1660*c* collectively define in part the said electrode array. The array of discharge electrodes are energized in a specific sequence to initiate lasing and the firing sequence is determined directly by the type, concentration and other properties of the laser active medium. Additionally elements 1660*d*, 1660*e* designate mirror means.

*The coaxial photolytic source emits 'invisible' ultra-violet of other shorter wavelengths rather than white light to induce excitation.

A modified excismer* lasing unit embodying X-ray preionization and e-beam technology was constructed and implemented to fall within the 0.2–2 MeV range. The excismer system like the other emissive source beam generator means is but one of a number of emissive systems embodied within the extended resonant cavity of the MALKE device. The e-beam excitation embodied within the excismer means consists of variations in radial or coaxial excitation which is supplemented with longitudinal excitation initiated along the central axis to enhance the uniformedy high power densities ($>10^2$ Mw/cm$^3$). The presence of a Samarian cobalt magnetic induction encasement insure the supply of intense localized alternating or pulsed magnetic guide fields required to increase lasing efficiency. The quantity of beam energy disposed within the laser volume is related directly to the excitation geometry of the eximer device. Excitation of rare gas buffers approaches an efficiency of fifty per cent in regards to the conversion of electrical energy into said excited states; however the excited state population density according to current gain data has an upper limit approaching $10^{-16}$ cm$^{-3}$. Direct positive increments of e-beam current is directly proportional to increase in the electron density which in the case of e-beam pumped rare gas halide mixture is proportional to increases in the plasma level. A negative side effect of increasing the power or current of e-beam(s) beyond the level of optimization results in a significant increase+(10→25%) deactivation in both the excimer and the timer components due to electron quenching which impede lasing efficiency, regardless of the high efficiency of the aforementioned excited state. Stimulated emissions are additionally delayed by broad band absorption by atomic species which is also effected by a large number of intense absorption lines. Broad band absorbers have long been known and are identified as being molecular in origin with a mean cross-section of $\sigma a \leqq 5\times10^{-17}$ cm$^2$ in the visable and ultra-violet spectra due to positive ionic states and or photo-ionization exemplified by $Ar_2+$, $Kr_2+$, $Xe_2+$, $Ar_2$*, $Kr_2$* $Xe_2$* states. The absorbing excited molecules are initially created by e-beam excitation and have a mean average life expectancy with a lower limit of between ten to twenty nanoseconds and a upper maximum limit of inexcess of 100 nanoseconds. As indicated earlier absorption greatly limits the efficiency of lasing, which necessarily occurs in the so called after glow regime of the e-beam pulse. The upper limits often involve excited atomic species, such as rare gas metastables, examplified by Xe*, Kr* and the like, which survive of hundreds of nanoseconds, giving rise to discrete absorption lines involving transition to what is termed in the field as excited Rydberg states. The absorption lines previously mentioned reduce the total laser efficiency, hence power output and inhibits or impedes continuous tunability of wavelengths. Often in the case of xenon metastables in rare gas halide mixtures the introduction of nitrogen acts as a quencher to minimize the number of said lines. The Rydberg state absorption lines have been identified at lower power increments to be originating from the $6s^3PoXe^*$ metastable state at 9.5 eV and it has been determined that the same said atomic metastable absorption lines are effectively quenched by the rapid introduction of $N_2$ when used as a buffer, during photolytic excitation at 172 nanoseconds and or in the implementation of e-beam excitation. In the case of $Xe_2Cl$ fluorescence and or stimulated emissions laser output was increased from a factor of 2.5 to 3.0, by increasing the introduction of molecular nitrogen as an additive by 150 to 200 Torr. The negative effects of quenching have previously been indicated, as well as its benefits.

*excismer a modified form of eximer laser.

The optical resonant cavity of the excismer is so constructed as to accomodate a variety of laser active media. Electron-beam (e-beam) pumped broad band triatomic excimer, diatomic excismers or those consisting of metal oxides and or any suitable excismer laser active mediums are compatible within the operative parameters of the excismer device. Dramatic overall gains in lasing are achieved by the optimization of gas mixtures, variations in preionization, dumping of absorptive lines, the minimization of quenching collisions of excited species with rare gases and competing B→X transitions. Additionally, supersonic flow e-beam stabilized discharge excitation dispersed in the optimized gas mixtures under pressure, appreciably lowers excimer quenching and losses incurred by absorption. The implementation of all the above aforementioned processes are embodied within the construction of the aforementioned laser eximer device, as will be disclosed in the foregoing.

Figure 75:
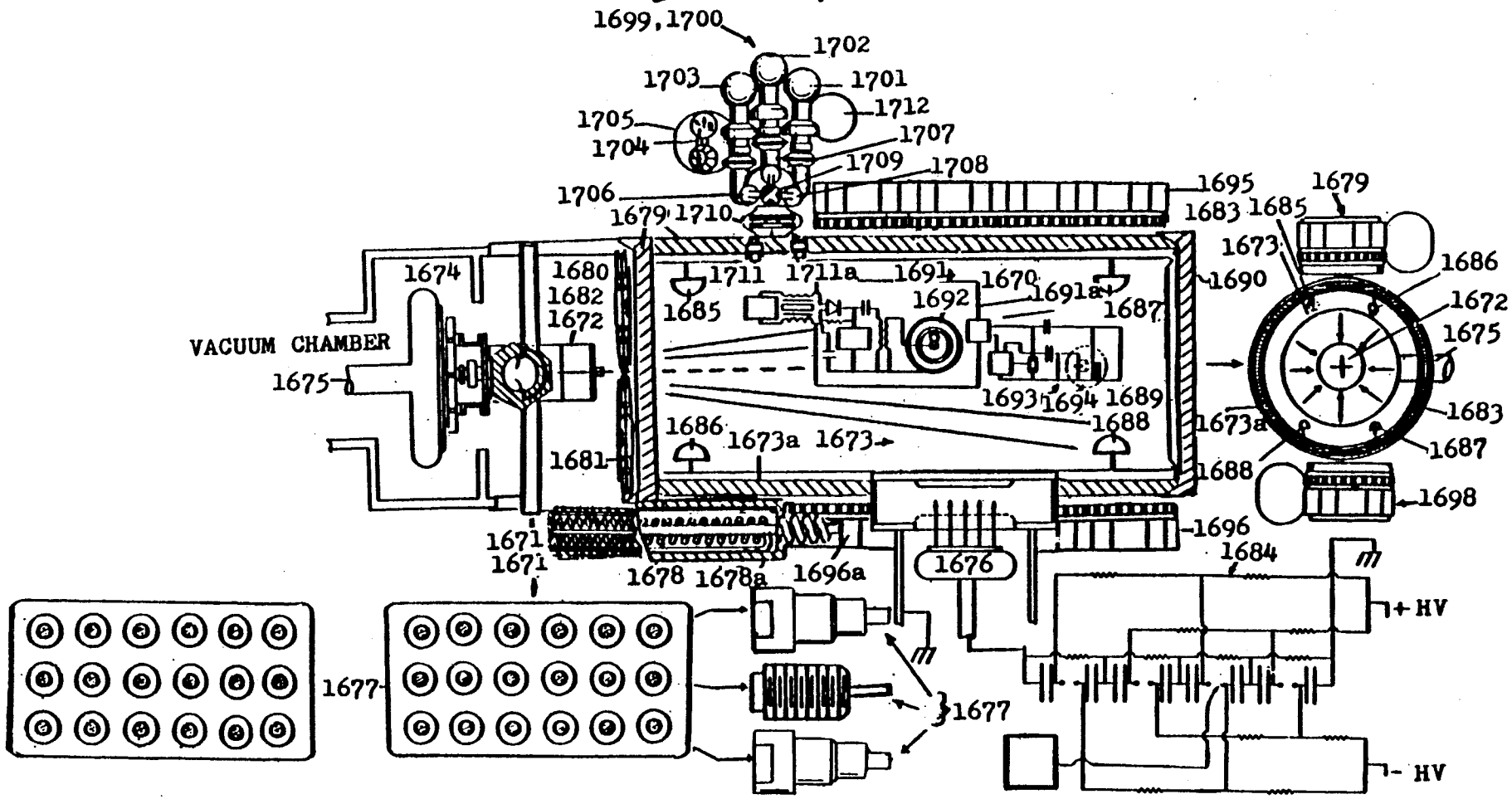

FIG. 75 concisely illustrates in a greatly simplified schematic fashion the structural configuration of the excismer (eximer) unit embodied within the extended resonant cavity of the MALKE device. The specific geometry and types of the e-beam generator means, 1670 preionization unit and composition of the laser active media are constructed and implemented in a manner to optimize the lasing efficiency of the optical resonant cavity embodied within the excimer unit; in accordance with the operational parameters disclosed in the preceding paragraphs. Longitudinal excitation or pumping is indicated the energization and subsequent dispersal of charged particles by primary anode 1671 and cathode element 1672 into the resonant cavity 1673. The cathode 1672 is housed within vacuum chamber 1674 is mounted on the cathode support structure 1675 and is energized by pulse source generator 1676. Primary anode 1671 additionally houses an array of electron dispersal units or guns 1677 which disperse a charge beam of electrons either sequentially or simultaneously towards the aft portion or emissive end of the resonant cavity. Numeral 1678 denotes the diode adaptor coil and number 1678*a* describes its housing. A electronically tunable mirror element, with an operative means and diffraction gradient is collectively disclosed by numeral 1679. Solenoid units 1680, 1681 adjust the critical angle of mirror element 1682 to assist the optical tunning of emissive within the resonant cavity, number 1673. A secondary anode is circumferentially disposed around optical resonant cavity and is formed from separate and distinct Ti-anode sections allowing separate circular or radial sections to be energized and negatively biased at specified time intervals by element 1683, which conveys high voltage output through mark type generator circuit means disclosed collectively by numeral 1684. Mark generator is typical and is used here to power aft electron beam generators or guns of the excismer unit. Elements 1685 through 1688 disclose schematically four separate laser electrodes and elements 1689, 1690 define analogs to an outcoupler unit and partially emissive optical mirror, whereby stimulated emissions exit the resonant cavity. The electrodes can be charged separately at different time intervals to enhance charge differentiation along the internal periphery of the resonate cavity. The preionization elements and circuitry are designated collectively by numerals 1691, 1691*a* through X-ray preionization is conducted by circuit and emitter or source generator 1692; whereas U.V. preionization is implemented by circuit 1693 and U.V. emitter or source generator 1694. Numerals 1695, 1696 are assigned to the large number of smarian cobalt magnetic induction element which are circumferentially disposed around the forementioned resonate cavity and generate an intense localized pulse magnetic guide fields longitudinal along the central axis of the excismer device. The array of electromagnetic elements defined by numerals 1696, 1696*a* are either alternately sequentially or simultaneously charged from pulse means 1697, 1698. The enclosure of the resonant cavity 1673 is indicated by number 1673*a*. Optimal mixtures of excismers are dispersed by an automatic dispensor means, described by numerals 1699, 1700. Embodied within dispensor means 1700 are reservoirs containing excismers and a nitrogen purging liquified gas, as disclosed by numbers 1701, 1702 and 1703, respectively. The contents of the reservoir are pressurized and may be dispersed or withdrawn by a reversible centrifugal pump mechanism which is disclosed by unit 1704. The expended content of the resonant cavity may be withdrawn by pump unit 1704, the contents of which are placed in ancillary reservoir 1705 prior to undergoing a nitrogen purge, which is followed by recharging the resonant cavity with laser active excismers from said reservoirs. Directional flow of excismers, purging agents and the like are controlled by pump means 1704. Emittance of excismers, purging agents and the like are controlled by automated release mechanisms 1706, 1707 and 1708. The flow of excismers, purging agents and the like are metered by an automated three way valve described by unit 1709. The optimal quanties of mixtures are combined in mixing chamber 1710 and subsequently released by valvular inlets 1711, 1711*a* into the said resonant cavity; which also serves as exit ports by which expended excismers contents are conveyed back for recovery to storage vessel 1712.

Figure 75A:
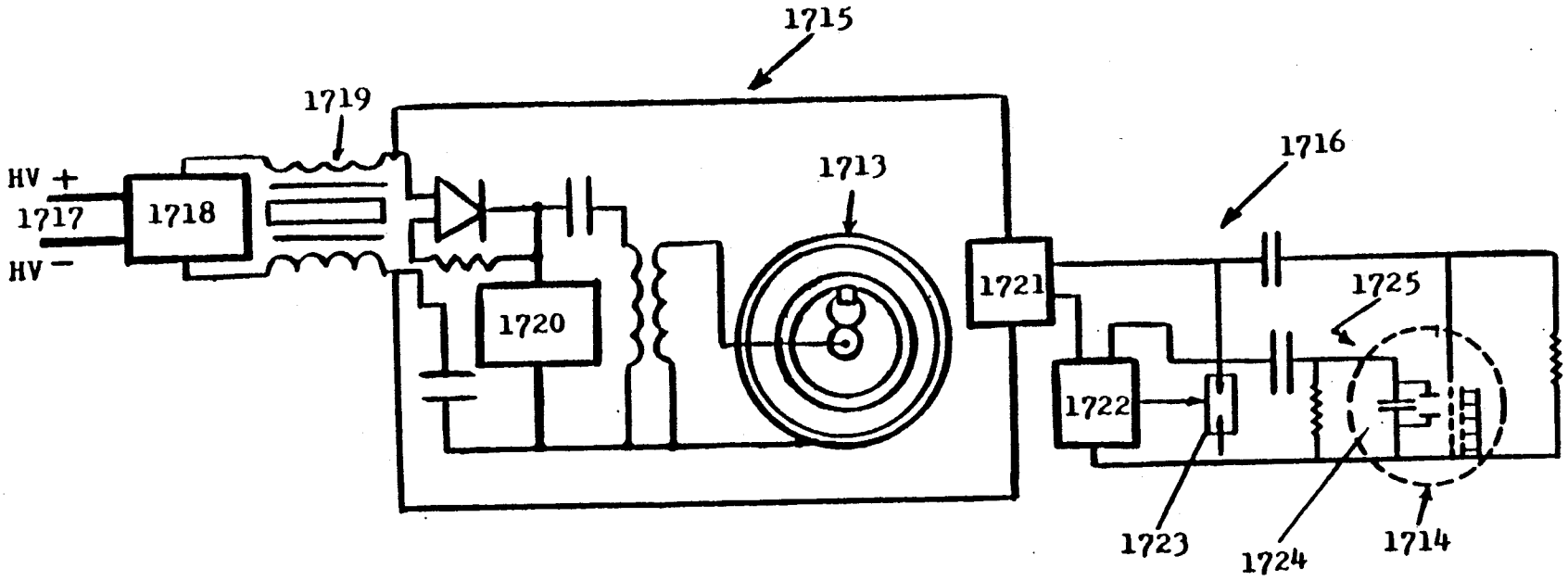
Figure 75C:
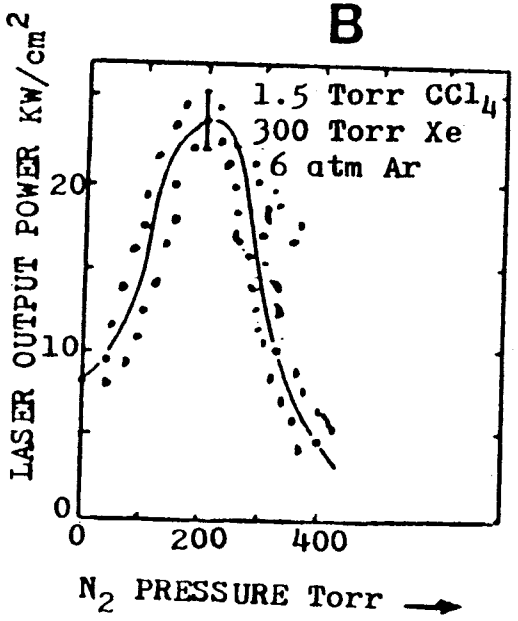
Figure 75B:
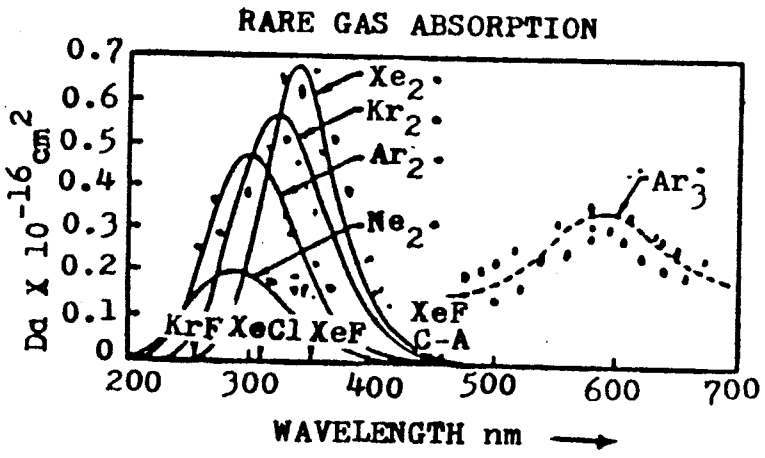
Figure 75E:
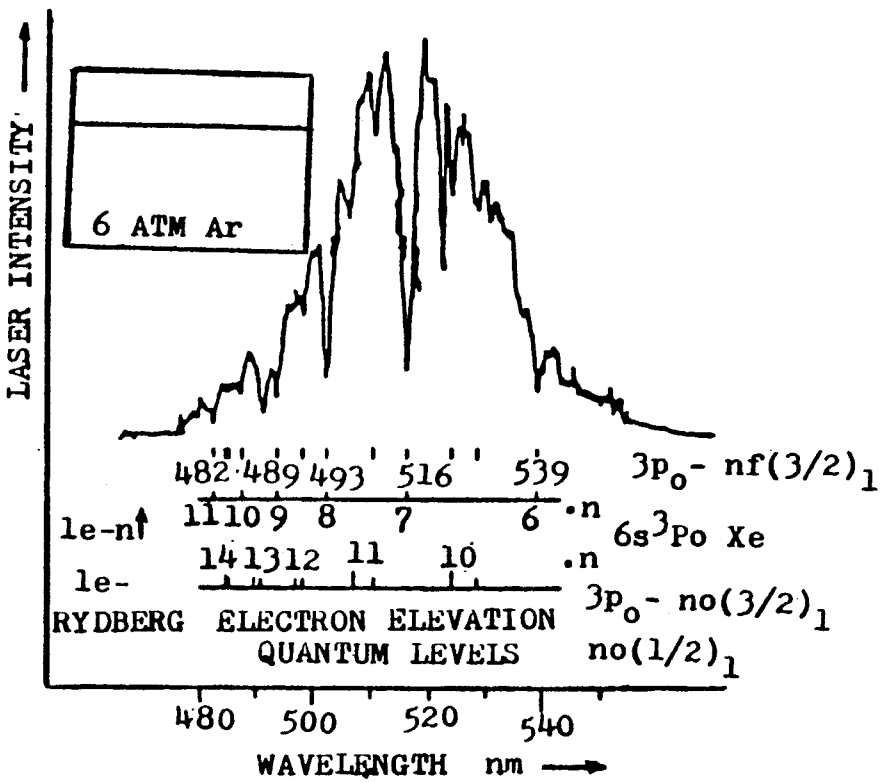
Figure 75D:
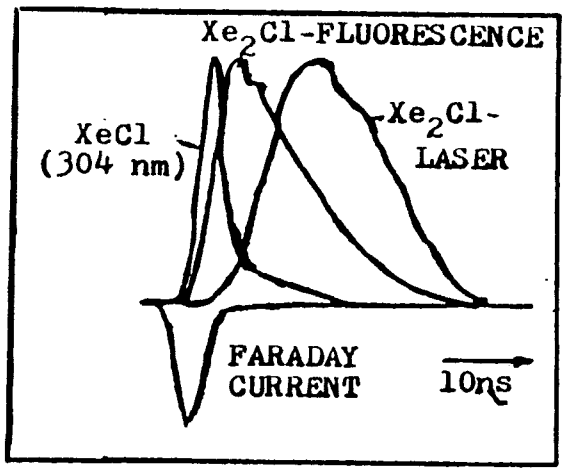

FIG. 75*a* illustrates in a concise schematic fashion the preionization mechanism. There are two types of emissive source generators emitting two forms of ionizing radiation, X-ray and ultra-violet emission, respectively. The X-ray source emitter is schematically defined by element 1713; whereas the U.V. source emitter is described by element 1714. The high voltage power source common to both source emitter circuits 1715, 1716 are assigned the value 1717. The power from element 1718 is stepped up or otherwise conveyed to circuits, 1715, 1716 by a common piezoelectric transformer unit number 1719. The pulse circuit for the X-ray source emitter is indicated by element 1720; whereas the pulse generator means for the U.V. emitter is assigned number 1721. Numerals 1722, 1723 and 1724 are assigned to a timer circuit, trigger mechanism and avalanche generator component embodied within circuit 1725 of the U.V. source beam generator. The capacitance and resistive elements, diodes and induction means are clear and straight forward and therefore are not assigned any numeric values.

The facilitate to differentially sequentially charge sections of the resonant cavity within predetermined time intervals and to alternate of said charge between anodes and cathodes significantly enhances the incidents of stimulated emissions while simultaneously limiting the transitory periods associated absorption, population inversion and other related processes. The narrowing of emissive laser bandwidth, tunability and the like are precisely implemented by the actuation of intracavity apertures, diffraction gradings prisms, optimization of excismer constituents and ancillary structures, such as, etalons. The intensity and duration of stimulated emissions are directly dependent on the properties of the excismer such as absorption characteristics, the quantity of power delivered during the excitation interval, the geometric disposition of excitation means utilized to pump the resonant cavity and related processes. The operative principles of the excismer are well understood by those skilled in the art, who will readily understand and appreciate the novel design features embodied within the excismer device disclosed in the specifications herein. Additionally, included in the foregoing are graphical representations obtained by experimental observations regarding: graph A a calculated dimer ion absorption coefficients plotted against wavelengths, graph B the effects of the $N_2$ addition on the incident output of e-beamed-pumped $Xe_2Cl^*$ excismer and graph C, a normalized pulses indicating the temporal characteristics of $Xe_2Cl$ fluorescence/laser emission XeCl (B→X) fluorescence and 3-beam excitation pulse and graph D a high resolution XeCl* laser spectrum indicating intracavity absorption features due to transitions between $^3P_o$ xenon metastables and elevated Rydberg states. The above mentioned graphical representation are in close agreement with the results obtained by Huestis and others. Actual observations experimentally obtained by the applicants are included in said graphical representations indicated herein below as points in and near slopes contained within the graphical representations, disclosed by FIGS. 75*b* through 75*e*.

Excismer lasers are more effective when deployed in target acquisition, data transmission and when utilized against targets composed of organic materials. The variable wavelengths and widely tunable frequency range allow the excismer a wide range of operations within the submegawatt range. The types of gases and composition of said gases undergoing excitation and lasing within the cavity of said excismer may vary. The number, type and design of the pre-ionizing units may vary with the excitation frequency of said gases contained within said cavity. Said excitation frequency corresponds to the optimum population inversion state for species composing said gaseous lasing medium.

Figure 76:
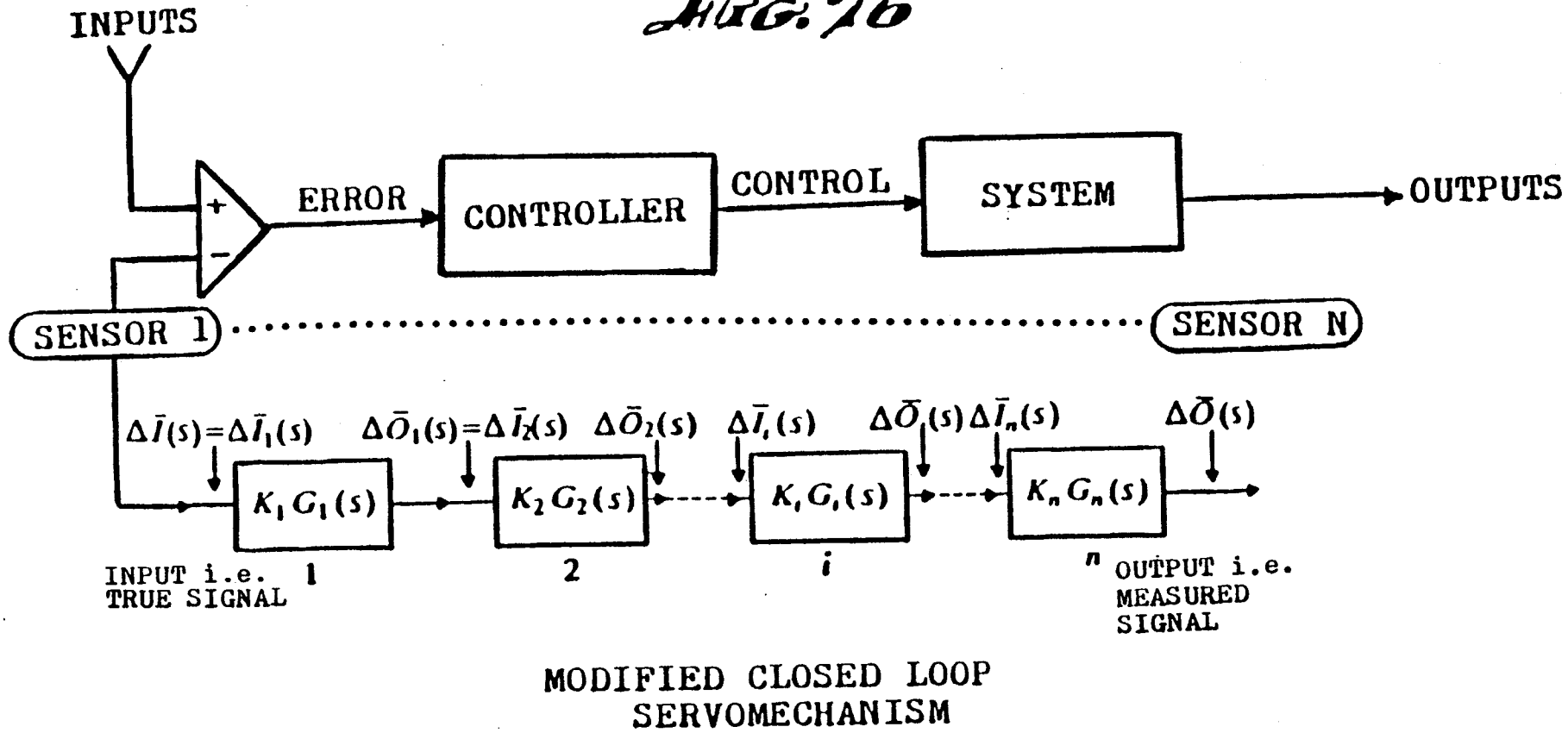
FIGS. 76 and 76*a'* are block diagrams of feedback loops equivalent to those systems embodied within the device.
Figure 76A:
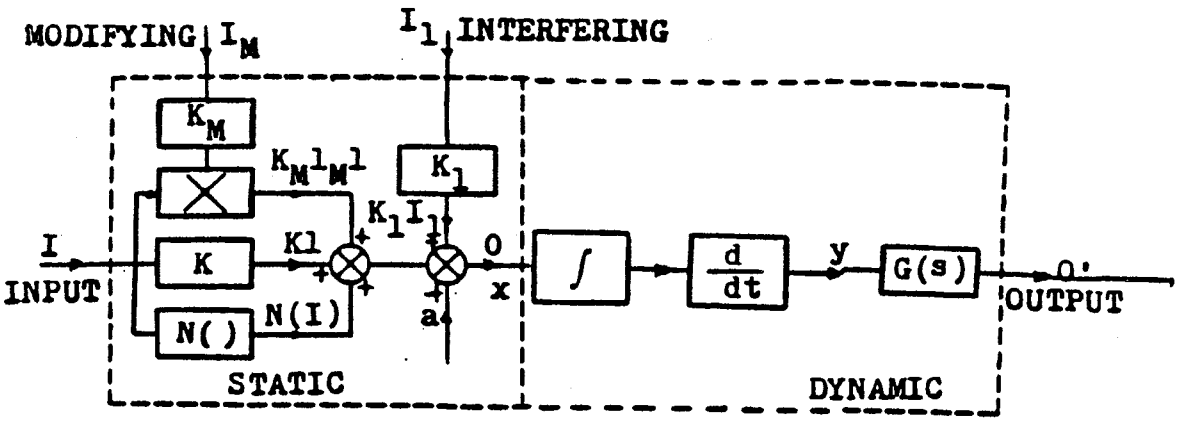
Figure 76A:
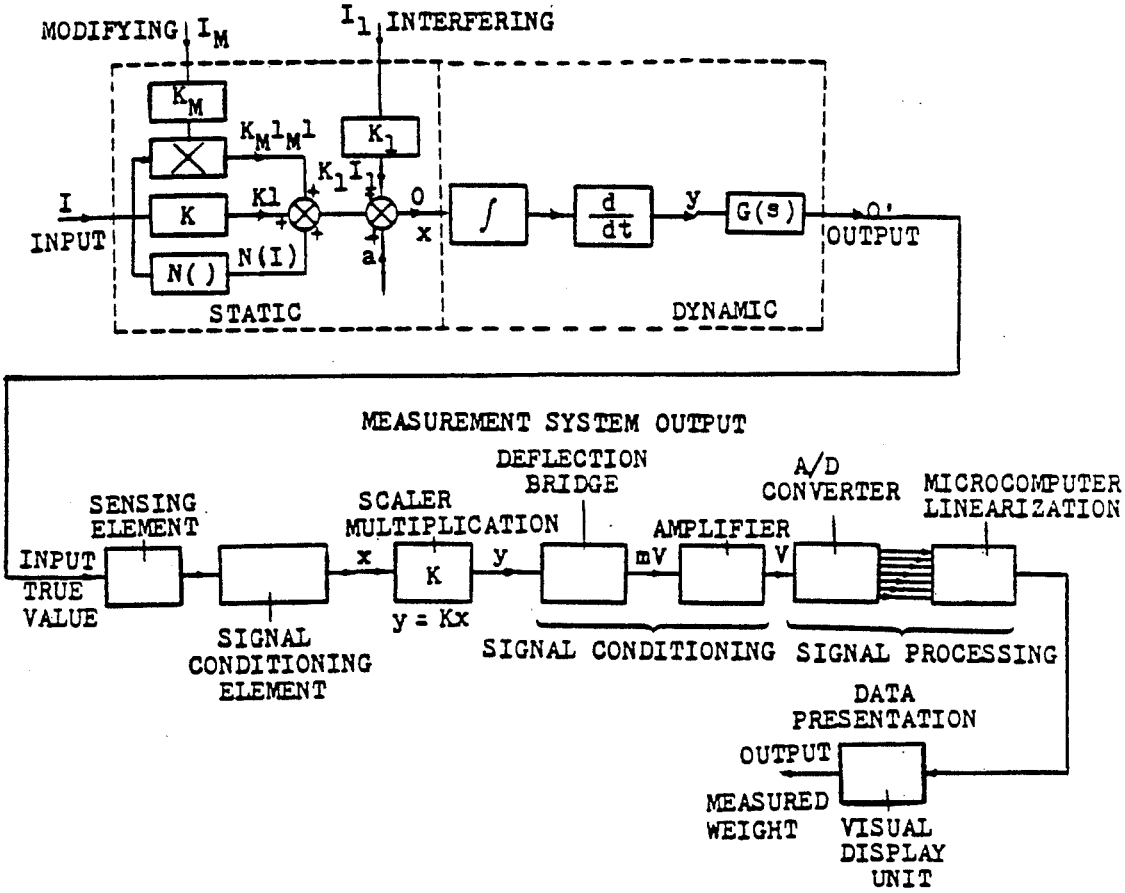

FIGS. 76, 76*a'* are block diagrams of feedback systems embodied within said MALKE device. FIGS. 76 though 76*a'* differ from the feedback loops previously disclosed in the specifications in that they interface the CPU with higher level operations. The operation of each element and its subsequent interaction with other elements is clearly detailed and labeled in the aforementioned Figures and readily understandable to those skilled in the art.

Figure 77:
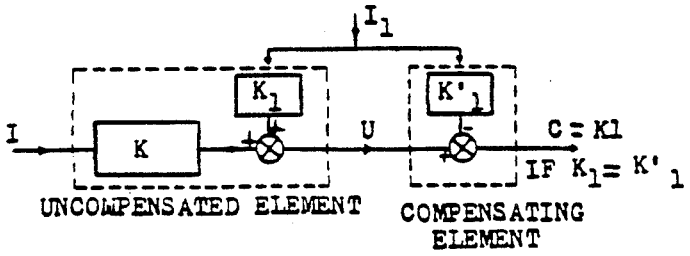
FIG. 77 denotes in block diagram fashion the operation of a single servo means within the contexts of a feedback loop.

FIG. 77 is a block diagram describing the operative servo-mechanism embodied within the invention and within the contexts of a feedback loop. Said figure discloses in part a means whereby compensation is exacted by introducing environmental parameters to an open system. FIG. 77 is coupled to the dynamic component described in the preceding figure allows said servo-mechanism to operate in a state of dynamic flux, useful in targeting centroids when both the aforesaid platform and said centroids are in motion.

Figure 78:
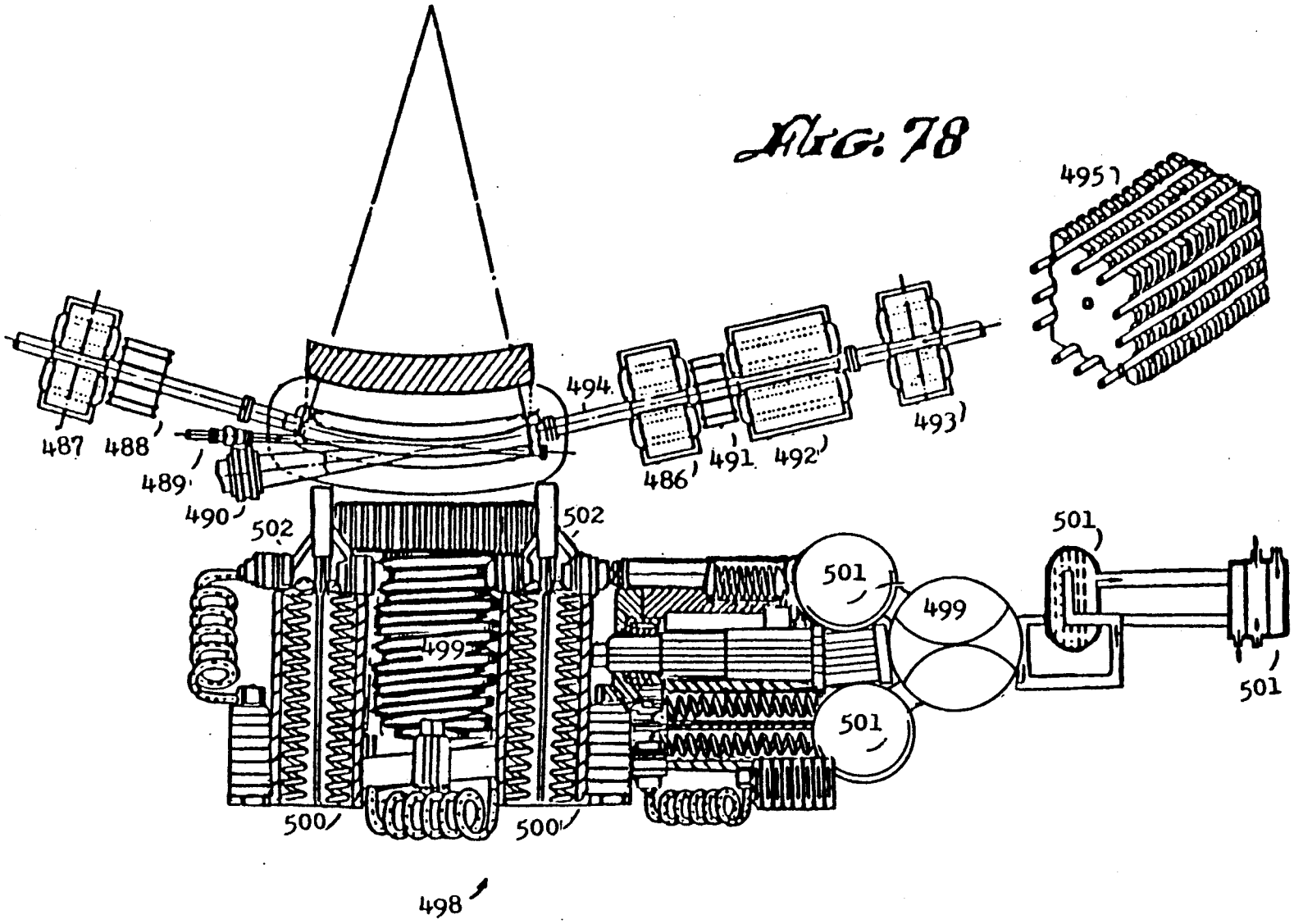
FIG. 78 is a detailed sectioned view of only one of a multitude of equivalent control channels emitting high energy synchrontron radiation.
Figure 78A:
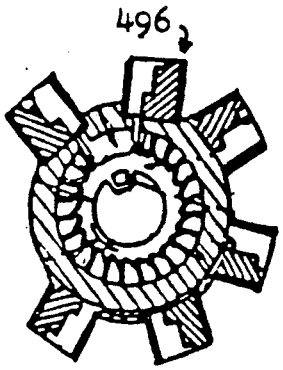
FIG. 78*a* is a cross-section of a multilayered magnetic yoke means.
Figure 78B:
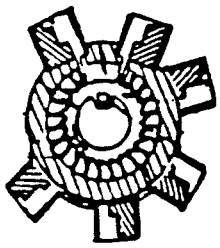
FIG. 78*b* fundamentally illustrates a diagrammatic sectioned view of a typical sextupole means.
Figure 78C:
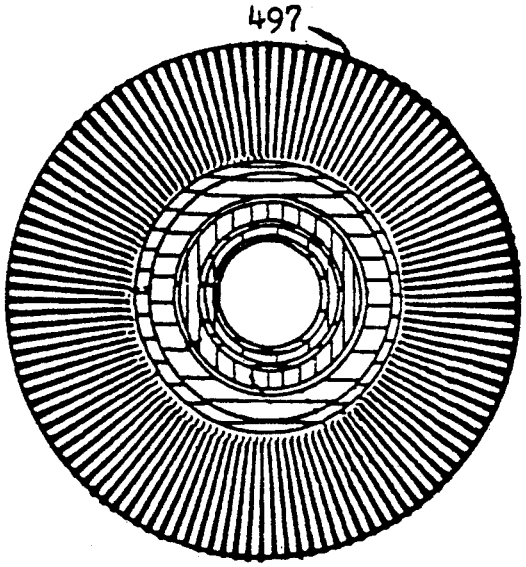

FIGS. 78 through 78*c* are sectioned views of only one of several equivalent control channels emitting a high energy synchrotron and electron particle beams. The basic design and explicit operations of a single component synchrotron control channel is equivalent to present state of the art synchrotron systems, however it is the overall structural design of the synchrotron device and separate disposed emissive control components wherein the novelty resides. Numerals 486 through 493 denote typical sychrontron components of a normal storage ring and light ports. Element 486 describes a typical bending magnet, while numerals 487 and 493 describe defocusing sextupoles. Numerals 488, and 492 provide octupole corrections. Elements 489 and 490 designate emissive light ports in the VUV (40 m r d+) X-Ray (120 m r d+) region of the spectrum. Element 492 designates a focusing sextupole. While elements 494 and 495 specify the circular glide path wave guide which the electron beam transverses. A multilayer of repetitive Samarium Coblat laminated plates 495 are disposed in between a series of charging elements and cryogenic heat exchangers. Numeral 496 is a sectional view of a single sextupole element which is represented schematically by illustration 497. Numeral 498 represents the entire cryogenic cooling unit, whereas numbers 499 through 502 denote the cryogenic cooling means. Elements 499, 500, 501 and 502 denote a cryogenic pump, a coolant reservoir thermal exchanger means, a condensor and a regenerator means all of which are equivalent to the cryogenic means previously mentioned earlier with regards to the Pulsar and Megapulsar means.

Figure 78D:
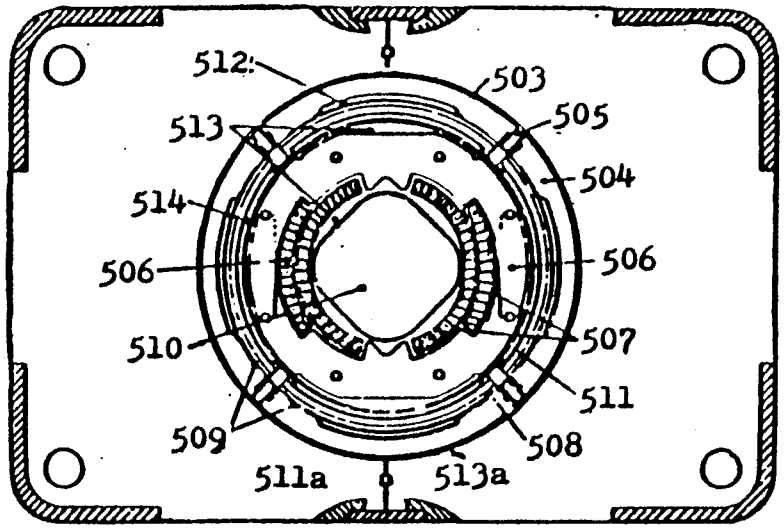

FIG. 78*d* describes a typical cross section of elements 495 and 496. Liquid nitrogen is pumped along flow channels and it is denoted by element 514; whereas a single phase helium and two phase helium are described by elements 513 and 514, respectively. The vacuum elements are denoted by numeral 503 which is the outer vacuum tube and numeral 504 which denotes the cryostat vacuum space which is constructed of a multiple layered insulatory means. Elements 506 and 511 describe coil clamp lamination and a primary deflection coil means. The insulation and thermal ventilation channels are described by element 507. A roller suspension means and a so called off mounting ring are designated by element 505 and 508. Numeral 510 designates the centrally located beam vacuum orifice or channel; whereas numeral 509 designates a continuous shield element. Elements 512, 513*a* and 511*a* designate liquid nitrogen circulating channel, lamination and a charged titanium nobelium coil array.

Figure 78E:
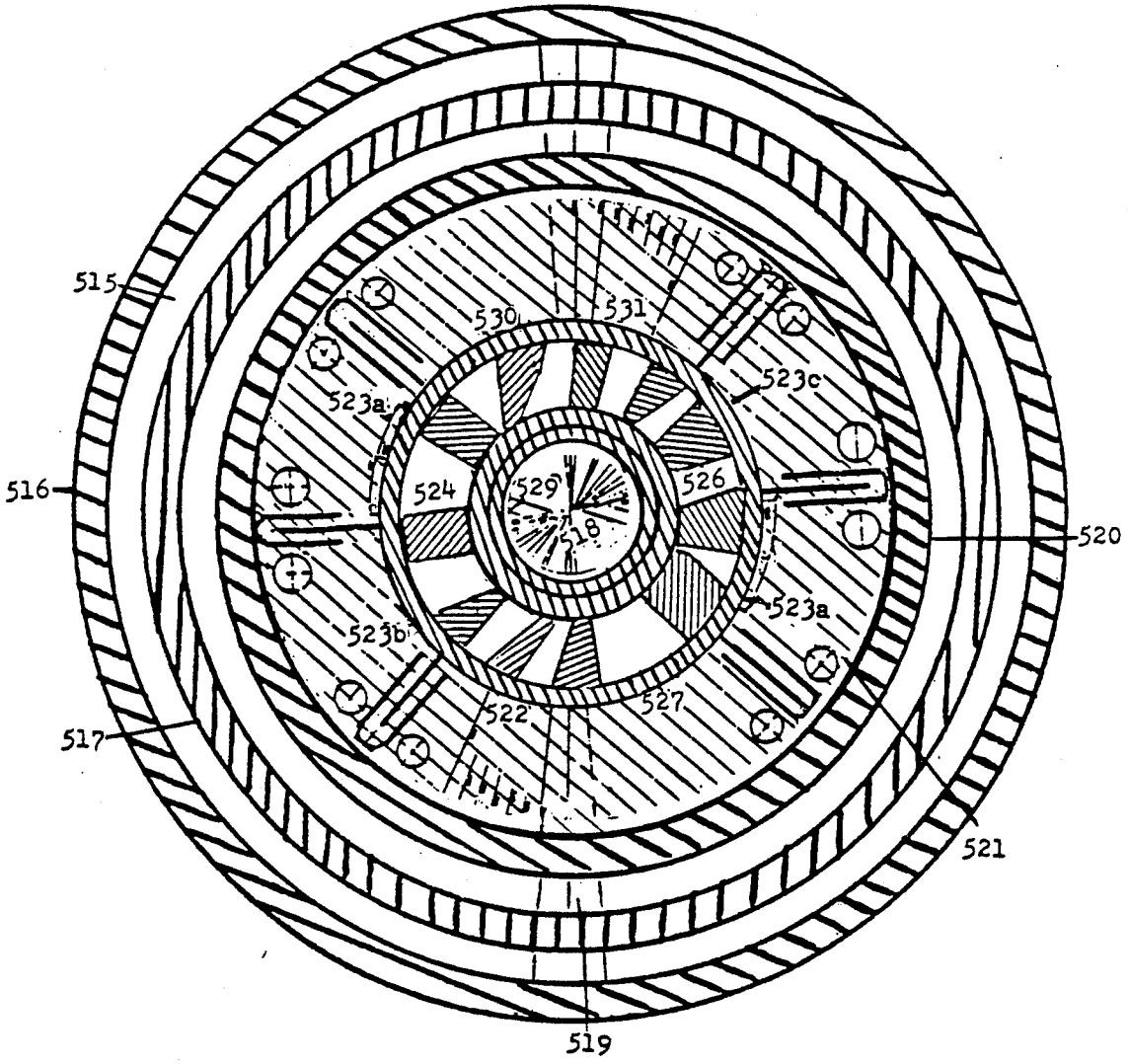

FIG. 78*e* fundamentally illustrates a diagrammatic view of a typical sextupole means. The design mode of the sextupole conforms with present American and European experimental design configurations of a quadrupole with elements deviating only in the materials composition and the numbers of operative elements. Materials such as Samarium Cobalt laminations replace iron in the formation of the outer yoke means. The vacuum means are denoted by element 515 and 516 the vacuum tank means, 519 describes a vacuum means, whereas element 531 is a vacuum chamber. Numeral 517 and 527 denote super insulation, while element 530 designates evacuated thermal insulation. Numeral 528 describes a cryogenic inner wall. Numerals 520, 524, 526 and 529, 518 describe an extended helium passage or conduits, a cold conduit and correction wind. The laminated yoke is denoted by numeral 521 and the main deflection coils are designated by elements 523*a* through 523*n*. Numerals 522 and 525 designate spacers and an aluminium type of support bandage, respectively.

Figure 79:
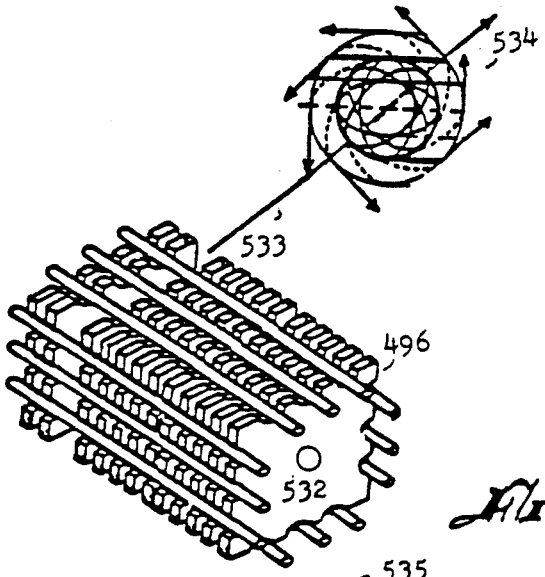
FIG. 79 is a partial sectioned view of the concentric synchrontron track array and emissive ports.
Figure 79A:
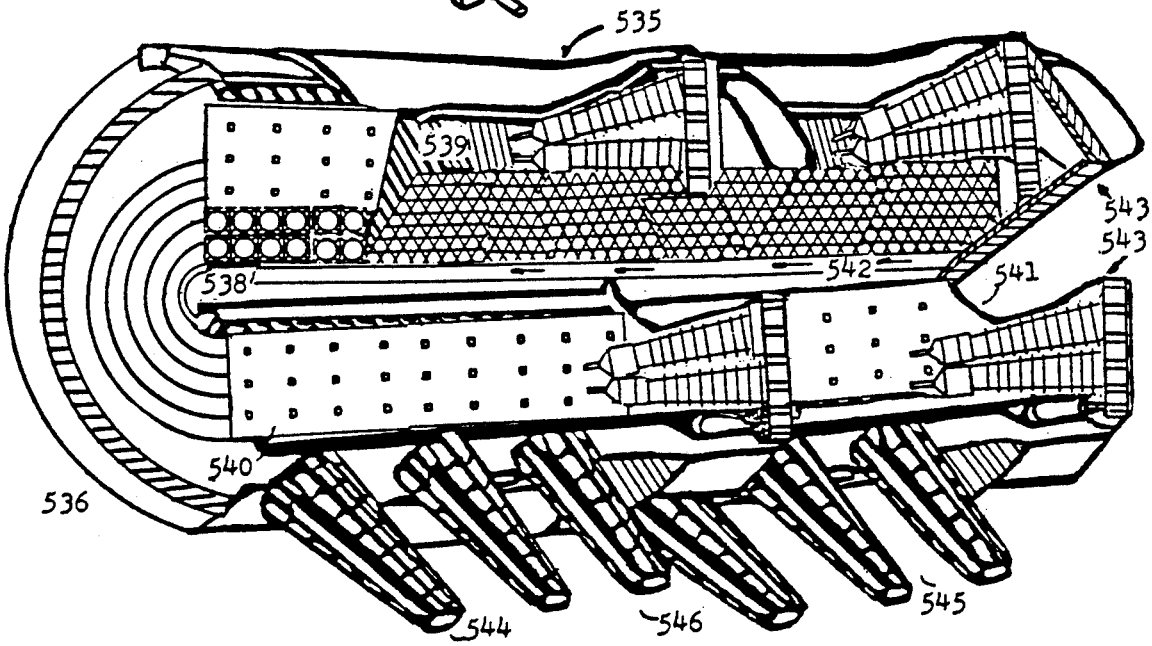
FIG. 79*a* is a representative form of a typical synchrontron emissive source beam.

FIGS. 79, 79*a* describe a concise partial sectional view of a multiple ring concentric synchrontron track array and emissive port complement. Numeral 532 denotes a simplified sectional view of the Samarium Colbalt plate lamination which were described earlier by element 496. A partial view of the emissive port means or orifice is denoted by 533 and its generated emission is described by element 534. The actual synchontron device less the power source is designated in part by numeral 535. The outer casing of the synchrontron device is denoted by numeral 536. The concentric layers of excitation rings are described in part by numeral 537 which is a novel design that increases the field strength, acting on the stream of charged particles and closes to the central axis of the synchrontron device 535, wherein a coolant circulates in a longitudinal heat exchanger means which is designated by element 538. The separate conduits which form the lattice cells of each storage ring unit are collectively denoted by matrix elements 539, 540 and 541 which explicitly shows them from different perspective or angular views. Several radiofrequency charging coils and ancillary means are denoted by numerals 542 and 543 forming in part a much larger complex of equivalent charging means. Numerals 544, 545 and 546 denote in an arbitrary manner the three adjacently disposed optically emissive light ports which have slits that are constructed to emit wavelengths of coherent polorized radiation of a specific wavelength. The optically emissive wave guide represents in part only a fraction of those ports available, but not shown in the figure herein, for the sake of simplicity.

Figure 79B:
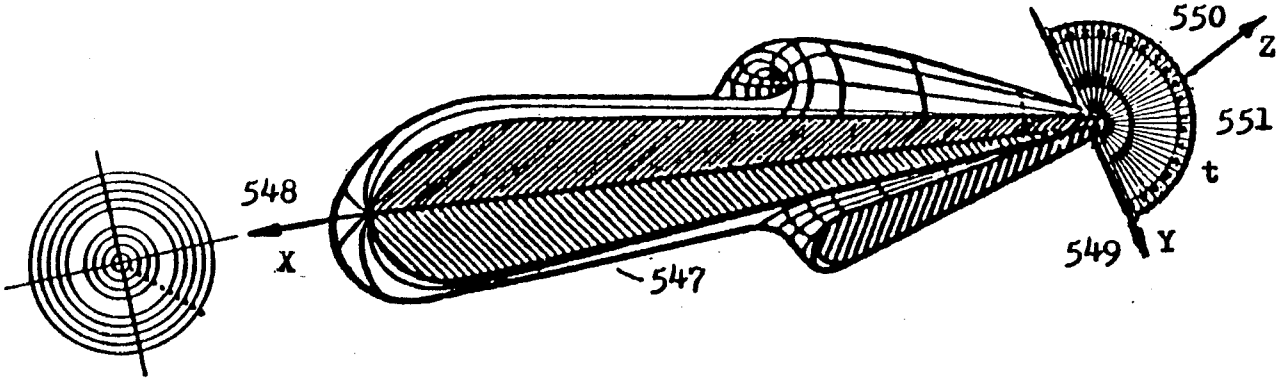

FIG. 79*b* is a sectioned perspective of a single typical synchrontron emissive source beam. The instantaneous distribution of synchrontron radiation intensity, wherein one quarter of the spatial figure formed by operative function, of, is sectioned as it was first described by Bargrov, Kulikov and other authors. The sectional perspective of the beam is designated numeral 547. The spatial temporal axis are designated, as follows, elements 548, 549 and 550 denote the X, Y, Z axial vector components, whereas numeral 551 describes the temporal vector in real time. The synchrontron beams contain monochromators in some cases allowing an operative range in emissive wavelengths which is tunable from 1 Å to 2000 Å. A descriptive formula for the angular distribution of instantaneous distribution of intensity takes the specific form of, $$W = \frac{e^2\beta^4 C}{32\pi R^2} \int fod\Omega$$

such that $$fo = \frac{8(\beta - \cos\alpha)^2 + (1 - \beta^2)\sin^2\alpha\sin^2\psi}{(1 - \beta\cos\alpha)^6}.$$

The radius vector is denoted by R. The analysis of function of taking the explicit form for the ultra relativistic case $(1-\beta^2<<1)$ indicates that the distribution of radiation intensity is symmetric with respect to the XY and XZ planes, with of having its maxima at $\alpha=\text{arc cos}[(3\beta^2-1)/2\beta]$ and minima at $\alpha=\pi$ and $\alpha=\text{arc cos}\,\beta$ in the plane with orbit $\psi=0$. The subsequent analysis of of, as indicated by FIG. 79*a* is that a minute fraction of emissive radiation is directed opposed to the electron motion in addition to an emissive maxima in the direction of motion. The field intensity of the fraction mentioned herein above approaches the value 9/32 $(m\,c^2/E)^4$ of the entire radiation intensity. There are of course three maxima in the virtual plane of the electron orbit which are typical of the near instantaneous angular distribution of the radiation intensity.

$$R = \frac{\beta E}{eH},\ W = 2/3\,\frac{ce^2\beta^4}{R^2(1-\beta^2)^2} = 2/3\,\frac{ce^2}{R^2}\left(\frac{E}{mc^2}\right)^4$$

where R is the radius of a changed particle, moving circularly related to the magnetic field intensity H, and electron energy E.

$$E=m\,c^2\,(1-\beta^2)^{\frac{1}{2}}$$

m is the rest mass of the electron, c is the velocity of light and $\beta=V/C$ where V is the electron velocity and e is the charge on the electron.

Synchrontron radiation has an angular intensity distribution which can be essentially described by a pronounced directionality along the vector of near instantaneous particle velocity in the case of relativistic electrons. For the circular motion of electrons at an absolute arbitrary velocity the expression for the intensity emitted in the entire spectrum within the solid angle $d\Omega$ is depicted herein below:

$$W = \frac{e^2\beta^4 c}{8R^2}\left[1 + \cos^2\theta - \frac{\beta^2}{4}\sin^2\theta(1 + 3\beta^2)\right]\frac{d\Omega}{(1 - \beta^2\sin^2\theta)^{7/2}}$$

$\theta$ is of course the angle between a line drawn from a point of observation of the emission to the center of the electron orbit and a perpendicular to the plane of the same said orbit. When considering polarization of emissive radiation as $\theta$ is derived from an electron moving in a circular orbit it is denoted implicitly by the Scott formula.

The well known expression for the spectral and angular distribution of radiation intensity in the solid angle d $\Omega$ and $\int$ is the factor which characterizes the polarization of radiation.

$$W(V\theta\ ) = \frac{ce^2\beta^2}{2\pi R^2} V^2[\int \sigma\beta Jv(v\beta\sin\theta] - [\cot\theta Ju \int vB\sin\theta]^2 d\Omega$$

which is of little consequence, but if the angular dependence of synchrotron radiation intensity is summed over the spectrum the corresponding formulas for so called ultra-relativistic electrons are to be specified by the following terms:

$$W(\theta,\int) = \frac{ce^2\beta^4 f_i(\epsilon)d\Omega}{32\pi R^2(1-\beta^2)5/2}.$$

The spectral and angular distribution of radiation intensity in the solid angle d $\phi$ has the form $$W(v,\theta,\ ) = \frac{ce^2\beta^2}{2\pi R^2} V^2[\ \ {}_o\beta Jv(v\beta\sin\theta) - \ \ {}_\pi\cot\theta Jv(v\beta\sin\theta)]^2 d\Omega$$

where 1 is a factor which characterizes the polarization of the radiation. If $_\sigma$=1 and $_\pi$=0, the formula expresses the radiation intensity for the o component of polarization; if =0 and $\pi$=1, it expressed the intensity for the $\pi$ component.

$(\cos\theta/|\cos\theta|)=\pm\pi/2$ between these components of the linear polarization of the radiation. If $\theta=\pi/2$, the radiation is completely linearly polarized because the intensity of the $\pi$ component is zero. $_\sigma=\ \ _\pi=1/\sqrt{2}$ for right circular polarization and $\downarrow_\sigma$=-($_\pi=1/\sqrt{2}$ for left polarization. Angular dependence of synchrotron radiation intensity corresponds to the formula for ultra relativistic electrons and is depicted in the following equation $$W(\theta,\ ) = \frac{ce^2\beta^4 f_i(\xi)d\Omega}{32\pi R^2(1-\beta^2)^{5/2}}$$

where $$\xi = \cos\theta/\sqrt{1-\beta^2},\ f_i(\xi) = \frac{7}{(1+\xi^2)^{5/2}}\ \ {}_\sigma{}^2 + \frac{5\xi^2}{(1+\xi^2)}\ \ {}_\pi{}^2 - \frac{64\xi}{\pi\sqrt{3}\ (1-\xi^2)}\ \ {}_\sigma\ {}_\pi.$$

The polarization properties of synchrotron radiation have been studied as a function of the emitted harmonic v (spectral distribution). The integration of the angle $\theta$ and approximated the Bessel functions J, and J by cylinder functions K of fractional order. Circular polarization vanishes in the integration over the angle $\theta$ because the term proportional to $_\sigma\pi$ goes to zero. The formula expressing the polarization and spectral properties of synchrotron radiation (radiation intensity in the harmonic range dv)

$$W(v,1) = \frac{2}{3}\ \frac{e^2c}{R^2}\left(\frac{E}{mc^2}\right)^4 \psi i(y)dy,$$

where $$\psi i(y) = \frac{9\sqrt{3}}{16\pi} y\left[(\ \ {}_a{}^2 + \ \ {}_\pi{}^2)\int_y^\infty K_{5/3}(x)dx + (\ \ {}_\sigma{}^2 - \ \ {}_\pi{}^2)K_{2/3}(y)\right],$$

-continued $$y = \frac{2v}{3}\left(\frac{mc^2}{E}\right)^3$$

takes on the values $\sigma$, $\lambda$, and 0 with $_\sigma$=i and 1$\pi$=0 for i=$\sigma$; $_\sigma$=0, $\pi$=i for i=$\pi$; for i=0, $\phi$o (y)+$\phi\pi$(y). Curves of $\phi$i(y) as a function of y (i.e., as a function of the order v of the harmonic).

Integration over all possible radiation frequencies, I thereby obtain the total intensity of polarized radiation:

$$W_\sigma = \frac{7}{8}\left[\frac{2}{3}\ \frac{e^2c}{R^2}\left(\frac{E}{mc^2}\right)^4\right],$$

$$W_\pi = \frac{1}{8}\left[\frac{2}{3}\ \frac{e^2c}{R}\left(\frac{E}{mc^2}\right)^4\right].$$

These equations indicate that synchrontron radiation has strong linear polarization with the electric vector being directed predominantly along the radius of the electron orbit in the accelerator and the intensity of this component of polarization ($\sigma$component) being $\frac{3}{4}$ of the total intensity of the synchrotron radiation.

The instantaneous angular distribution of synchrontron radiation is the polarization components $[\sigma,\pi]$ shows even greater divergence when compared to the time-averaged radiation intensity. This is seen particularly clearly in the case of the $\sigma$ component of polarization. The instantaneous angular distribution for this component is characterized by the existence of four radiation maxima which are identical in magnitude. According to the angular distribution function of the $\pi$ component goes to zero in the planes $\psi=0$ and $\psi=\pi/2$.

The function reaches a maximum at $$\psi = \arcsin\sqrt{\frac{23}{53-1}}\ \ \frac{\pi}{4}$$

and $$\alpha = \arcsin\left(\frac{1}{23}\ \sqrt{\frac{53-1}{1+\beta}}\ \sqrt{1-\beta^2}\right)\frac{1}{\sqrt{2}}\ \sqrt{1-\beta^2}$$

with the ratio between the naxima for the total radiation intensity and for the $\pi$ component being approximately $45.6\beta^2$.

Synchrontron radiation can be obtained by other protron particles, such as positrons and neutrons. The radiation from a neutron moving in a special magnetic field has the same polarization components as the synchrontron radiation from an electron, and the radiation intensity for these components is very close to the radiation intensities of the polarized radiation from an electron. For a neutron, $W_\sigma$=43W/48, $W_\pi$=5W/48, and for an electron, $W_\sigma$=42W/48 and $$W_\pi = 6W/48,$$

where

-continued $$W = \frac{2}{3} \frac{e^2c}{R^2} \left( \frac{E}{mc^2} \right)^4 .$$

Figure 80:
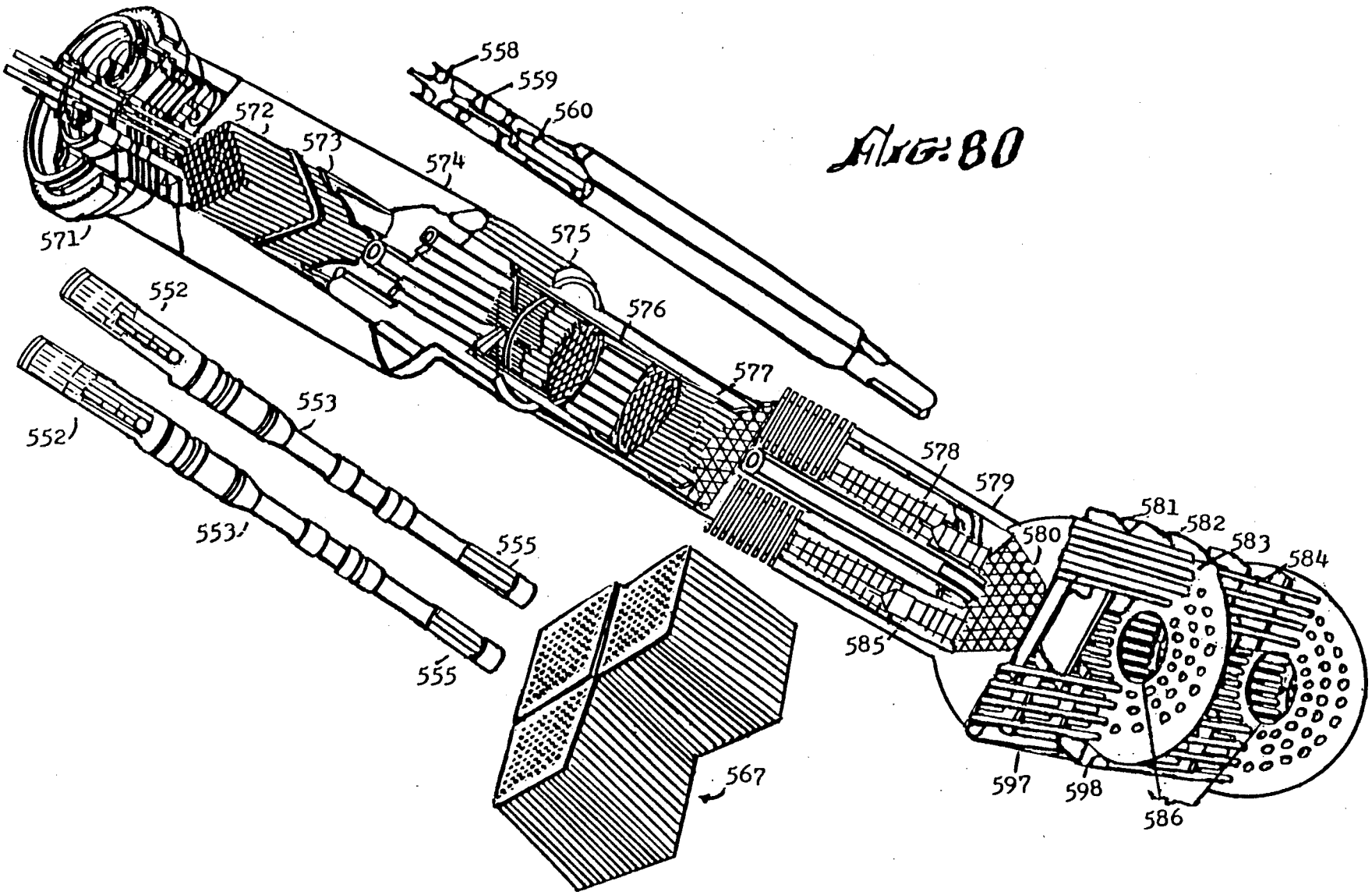
FIGS. 80, 80' are a detailed sectioned and exploded view of a typical reactor core.
Figure 80:
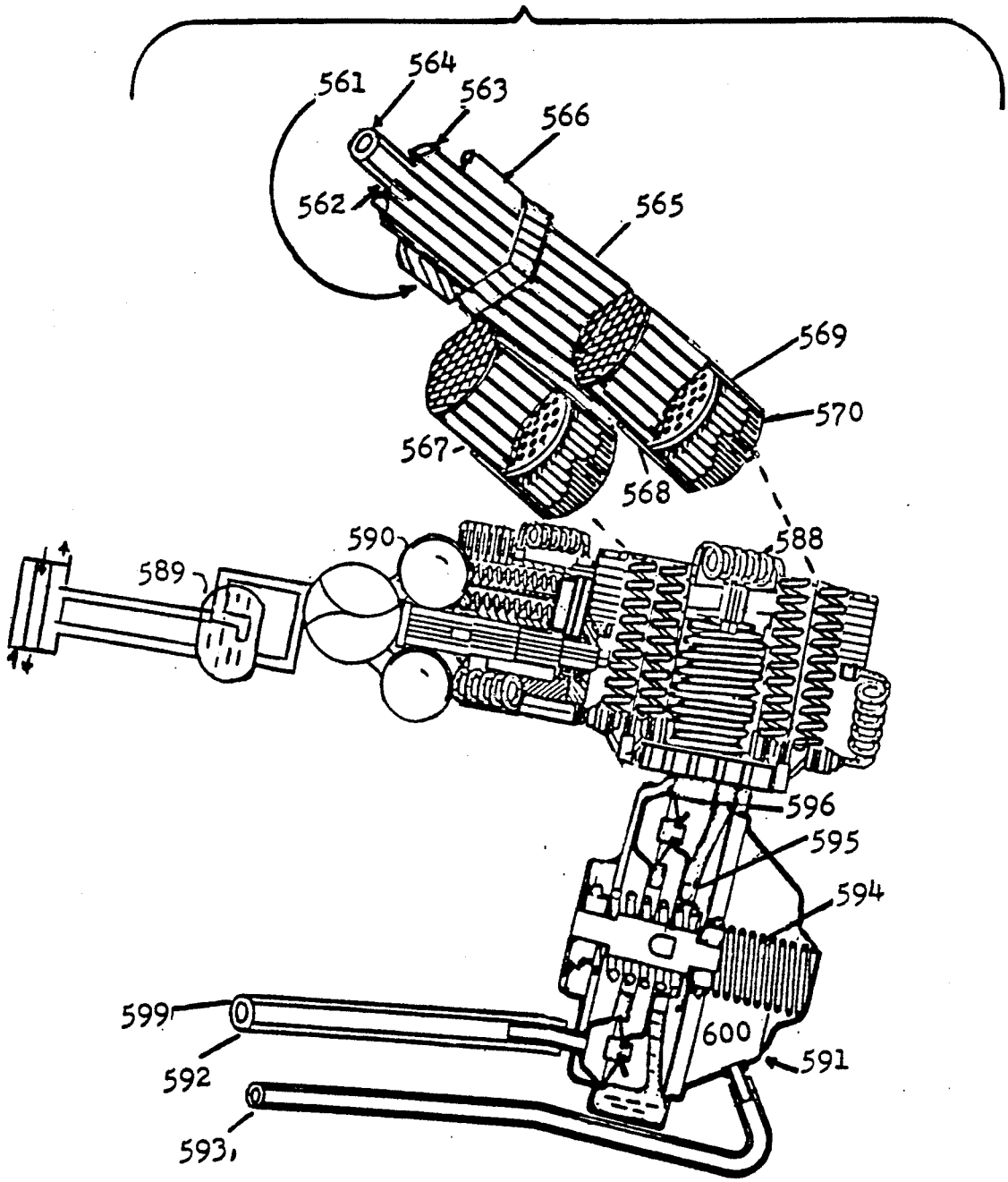

FIGS. 80,80′ denote a detailed sectional and exploded view of a modified nuclear reactor which is utilized to power the high energy lasers, synchrontron unit and other subsystems. The Pulsar, Megapulsar devices have an operative efficiency ratio in excess of 85%; however in order to attain this value the fore mentioned units must be pumped to and maintained at a constant level equivalent to the energy value wherein lasing occurs. A constant reliable source of energy is needed in order for all systems to operate continuously with peak efficiency. The nuclear reactor is a closed system, portable, light weight (approximately 500 kilograms) and fuel efficient, operating in excess of 65 percent. The entire M.A.L.K.E. XL - 10 device including power reactor is built to suit the other systems, such that the entire device can be placed in a series of vehicular support units ranging from a fixed position mode to a satellite based system. Two typical fuel rod elements are depicted by numeral 552, a full complement of which then insert into their respective blanket bundles, numeral 553, which forms element 556. Numeral 554 designates the zirconium alloy plug individual fuel pellets, which are composed of a suitable blend of uranium oxide or its equivalent, which provides the material and numeral 555 serves a simple spring means. Numerals 557, 558 denote a typical control rod shroud tube, element 559 describes the coolant ports and number 560 is the actual fuel rod element. A typical PWR fuel assembly based on a modified Westinghouse design is described by numeral 2561 and is preferred by the user. Numeral 562 designates the control rod assembly, number 563 describes the rod absorber and element 564 denotes the top nozzle. Numeral 565 describes a typical grid assembly, whereas fuel rods are designated by numerals 556,567. The absorber rod guide thimble is designated by numeral 568. The so called dash pot region is described by number 569 and numeral 570 denotes a typical bottom nozzle. The reactor core and vessel are disclosed by numeral 571 through numeral 2600. Numeral 571 denotes a typical support ring and numeral 571′ indicates a portion of the outer reactor vessel wall. Individual control rod units are described by numeral 572 and a rod containment collar is indicated by number 573. Tubular element 574 describe fuel ports, whereas numeral 575 describes an insulatory blanket means. Elements 576 and 577 are indicative of fuel rod glide elements. Numerals 578, 579 and 580 designate the enriched fuel plate assembly, blanket fuel assembly and coolant baffle plate means to equalize the flow of a pressurized coolant reactor medium. The design of a baffle bomb chamber which adjusts flow of the coolant to a series of turbines which is shown and indicated by elements 581, 582 and 583, which are supported by tubular means 584. The thermal reactive core assembly described by numeral 585 inserts through orifice 586 in a manner as to conduct heat radially outwards. Numerals 588, 589 and 590 designates a high energy coolant cycling pump, a heat exchanger and coolant reservoir means and a thermal condensor means. The base of the boiler means is described by numeral 591. The outflow tubule leading to the turbine complex is described by numeral 592, whereas numeral 593 designates a coolant inflow means, wherein expended coolant is returned from the turbine means. Located within the aft portion of the boiler are a series of flow coils denoted by numeral 594 and 595 which lead from a high pressure flow tubule described by 596. The inner coolant medium is carried to the turbines; whereas a secondary vessel structure illustrated by numeral 597 is filled with a secondary thermal transfer medium, such as that found in an MHO system, which is not shown here. Numerals 598 and 599 are sectional views of peripheral insulation, whereas number 600 illustrates the outer protective covering of the primary boiler unit.

Figure 81:
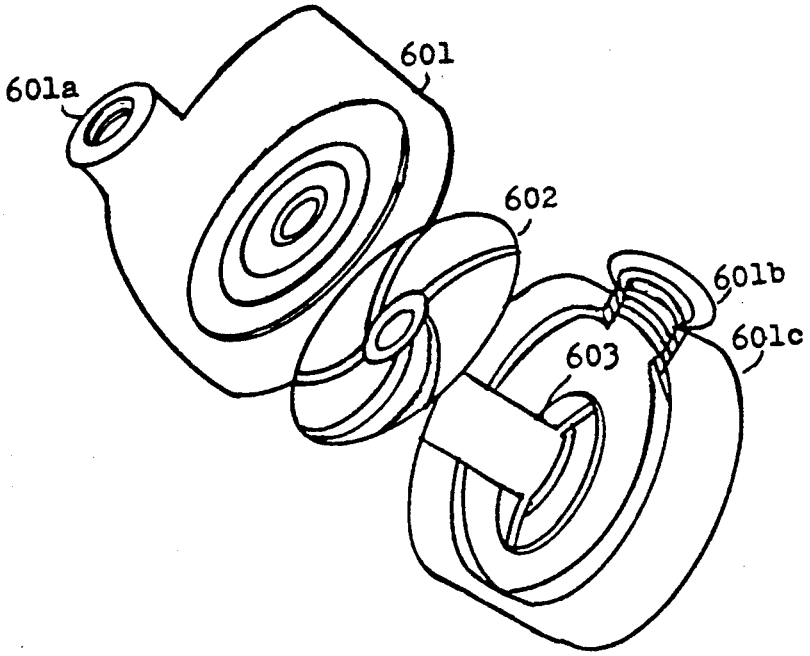
FIG. 81 is a partial sectioned view of a turbine system which accompanies the nuclear reactor, electrical generating systems, including a Closed Cycle Nuclear Magnetohydrodynamic Power Generator.
Figure 81A:
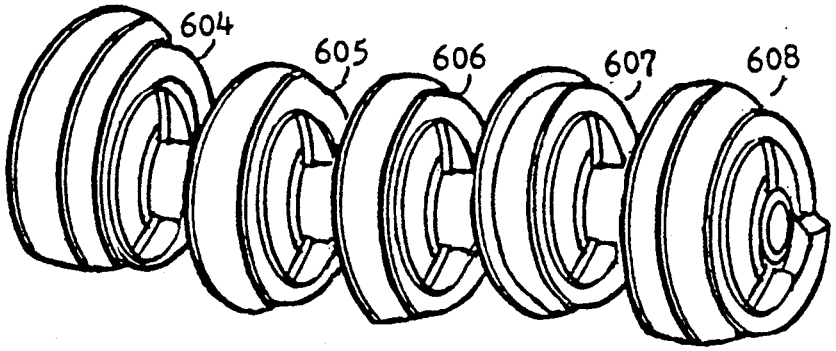
Figure 62:
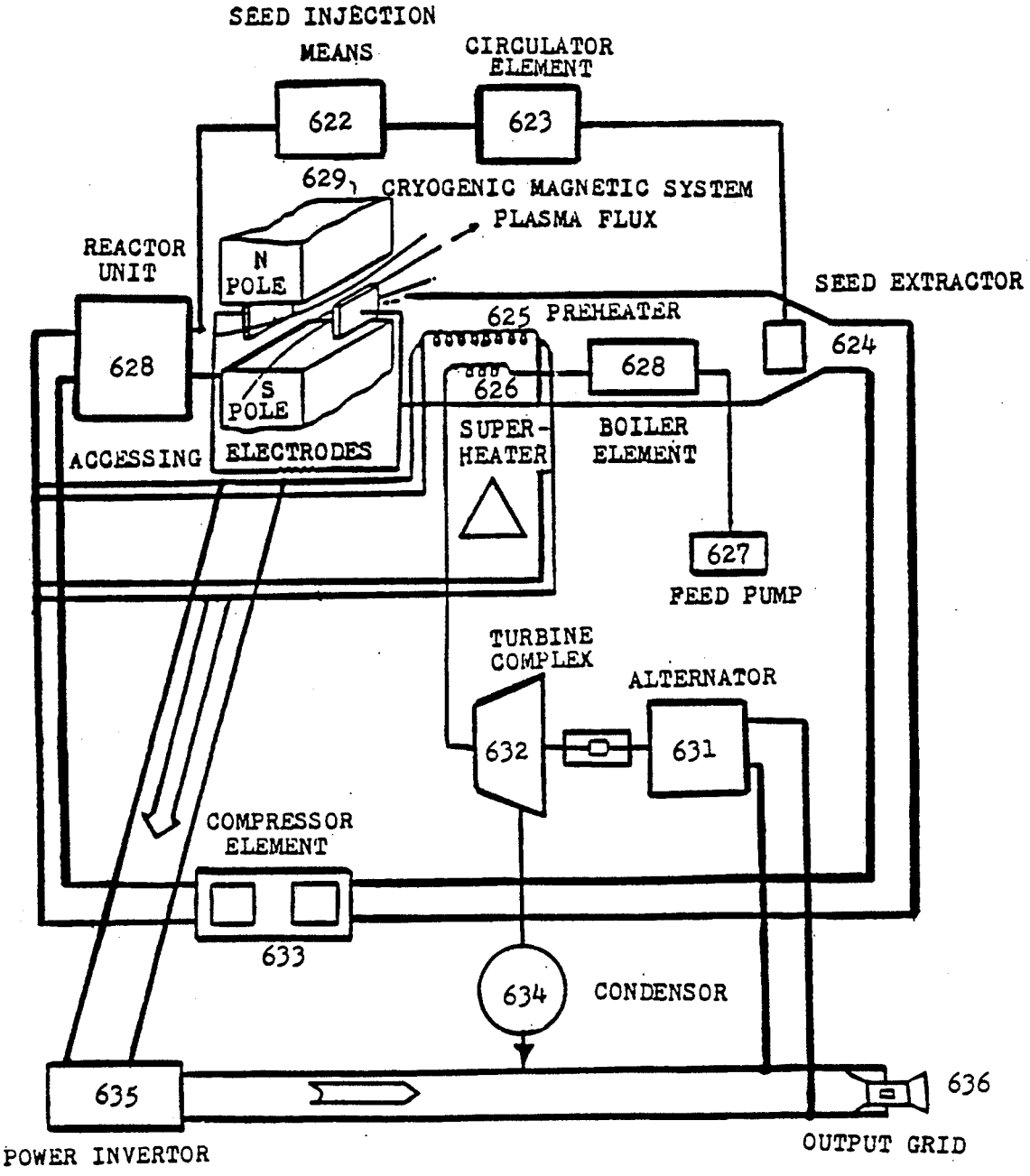

FIGS. 81 through 81*c* entail sectioned views only in part the turbine elements, a section of the magnetic induction coils which form in part the generator means and a simplified cross sectional area of a Magnetohydrodynamic power generator (MHD). The outer encasement for the most anterior turbine is denoted by numeral 601, followed closely by a multivane spiral centrifugal disc turbine described by unit 602. Each turbine has a concentric shaft numeral 603 which turns a generator means that is not shown. With the exception of the inlet orifice which is described by numeral 601*a* and the outlet orifice denoted by numeral 601*b* each turbine disc is isolated from every other turbine unit, such that unit 601 is hermetically sealed to unit 601*c*. All turbine means in the housing are made up of a metallic composite material which is resistant to wear, heat and corrosives. Twenty (20) turbine disc means or more may operate in parallel with one another. All turbine means are equivalent and numerals 604 through 608 denote five turbine enclosures. Numerals 609 and 610 are simplified sectionals of the main electric induction coils which form in part the generator units. The MHG system is briefly shown by numeral 611. The complement of Samarium Cobalt magnets are indicated by numeral 612, the seed injector is denoted by numeral 613 and the circulator is described by element 614. Numerals 615, 616, 617 and 618 designate the circulator means, compressor unit, outflow outlet and the inflow inlet to and from boiler means 618. The line from the fuel pump means leading to the boiler is denoted by numeral 619. Numerals 620 and 621 designate the superheater element and the preheater element, respectively.

In practice and principle a high velocity electrical conducting fluid consisting of sodium, potassium, mercury or another suitable medium intersects a magnetic field and electrical current is transduced therein. The operative mode of the MHD can be expressed by a simple set of well known equations contained herein below:

$$\overline{E} = \overline{\mu} \cdot \overline{B}$$

A jet of conducting fluid with velocity u, moves through a magnetic field of flux B at right angles creating a electric field E. The implacement of electrodes placed in proximity and in contact with the advancing jet, such that energy can be extracted and delivered to some external load. The system is in effect thermaldynamically equivalent to a turbine with electromagnetic braking of the turbine blades. If it can be assumed that the working fluid behaves as a typical electric conductor of the conductivity o, the current density j is given by the following expression, $$J = \sigma(E - \mu B)$$

The electrical power output per unit volume of duct is described by the following expression;

$$-j\,E=\sigma E(\mu B-E)$$

The ratio of load resistance to the total resistance described by the value K such that, $$K=E/\mu B$$

and the electrical power generated per unit volume of duct is noted by the following expression, $$W=-j\,E=K(1-K)\sigma\mu^2B^2$$

The power is essentially obtained by work done as the jet or moving stream encounters a body force such that, $$J\,B=(-1-K)\sigma\mu B^2$$

and the work done by the stream is equivalent to, $$-\mathrm{B}\ \mathrm{u}=(1-K\sigma u^2B^2)$$

the ohmic heating in the fluid is described by the expression, $$(1-K)^2\sigma u^2B^2$$

which is obtained by differencing W against $-j\ B\ \mu$.

FIG. 82 describes in brief a block diagram outlining the operation of the magnetohydrodynamic power generator means MHD employed to recover energy lost or dissipated as heat by the operation of said M.A.L.K.E. device. Numeral 622 designates a seed injector means, whereas numeral 623 describes a circulator element and means 624 collectively defines a seed extractor. The preheater element of the MHD system is defined by numeral 625, whereas the superheater element and boiler means are described by numerals 626, 627, respectively. Numeral 628 of FIG. 42 designates a reactor unit and numeral 629 is assigned to a cryogenic magnetic system with an accessing array of electrodes at the head of the MHD generator. The feed pump means, alternator and turbine complex which are collectively assigned numeric values 630, 631 and 632. The compressor element and condensor element are described by units 633, 634, respectively. Numerals 635, 636 are assigned to a power inverter and output grid means.

Figure 83:
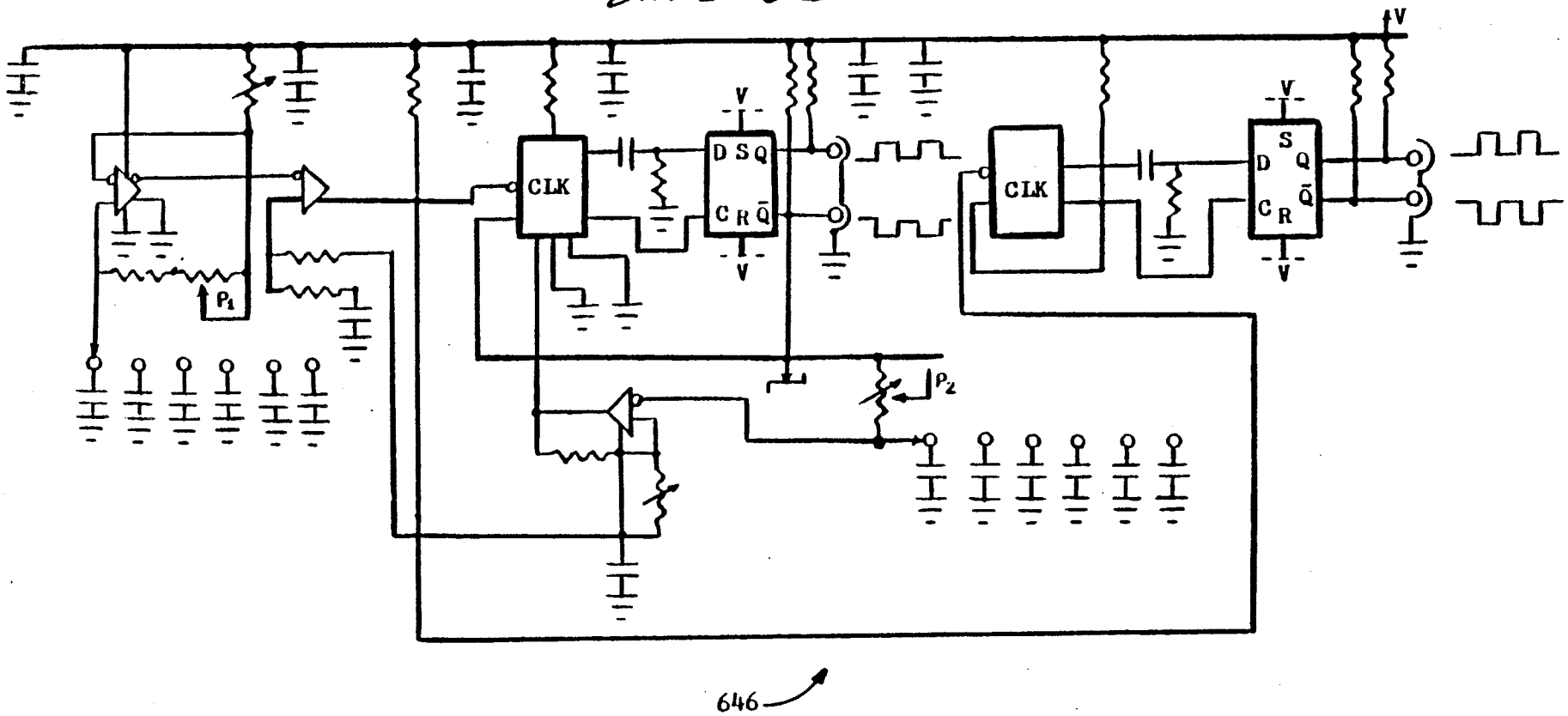

FIG. 83 represents a partial simplified and modified circuit diagram of one of the ancillary timing sequencers. Here a commercially available sequencer is modified with additional electro-optical oscillators and monostable multivibrator means. The circuit disclosed within FIG. 83 herein is composed exclusively of commercially available electronic components. The sequencer disclosed herein above is designated entirely by a single numeral, number 646 for simplicity sake, and it has varying pulse widths which range from 10 milliseconds to less than several nanoseconds.

Figure 84D:
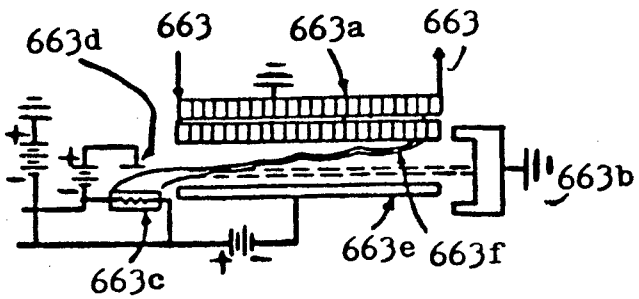

FIGS. 84 to 84*d* are illustrative of a solid state electron tube which is the mainstay of a backup system that is completely resistant to the EMP phenomenon. The base of the subminiature electron tube denoted by numeral 647 consists of a plate mode means and an array of carrier channels, which are denoted by elements 648 and 649. An additional cathode means and an electron stream is designated by elements 650 and 651. Numerals 652, 653 and 654 describe the RF input element, RF output element and a delay line means. Numerals 655, 656 and 657 describe three equivalent output wave guides. Elements 658 and 659 describe jointly an electro-optical transmission and coupling means to the subminiature device. Elements 660, 661 and 662 denote a helical coupled vane which is utilized as a subminiature heating element, a hole and slot means deployed as a spacer means and a multiple input electro-optical energy transmission means. Numeral 663 represents the RF input/output and delay are described by element 663*a* while elements 663*b*, 663*c* and 663*d* designate an accelerator, a collector and a cathode heater element. The so called sole and electron stream elements are specified by numerals 663*e* and 663*f*. The radiation hardness of the above mentioned micro miniature electron tube was found to be superior to the VHSIC class of elements and this includes bipolar, CMOS, CMOS, SOS, NMOS and more specifically such electronic component systems classified as FLSI, ECL and STTL or their equivalents.

FIG. 81 exemplifies a simplified combination block diagram and schematic representations of only one of several optical electronic analog/digital converter feedback units employed for sensory updates, servo scans and the like. Alpha numeric values are assigned to each subsystem in order to more clearly define a few basic component systems. Elements £1, £2 and £3 are indicative of the optical electronic sensory array, optical electronic encoder, and analog/digital interfacing and keying means. Alpha numeric values £4, £5 and £6 through £10 designates array selectors and a full complement of input storage buffers. Element £11, £12 and £13 through £15 denote a clock/timing means, column drivers and display terminals. Element £16 collectively describes a VLSI chip containing data input transfer, a column selector, comparator encoder/decoder signal outflow means. Elements £17, £18, £19 and £20 designate a voltage to frequency converter, monopulse multivibrator drive means and a line driver line receiver bidirectional means.

FIGS. 86 through 86*d* define the structure of the protective shielding which is utilized as a barrier against various forms of thermal and ionizing radiation. Heavy shielding has been deployed by others to protect sensitive electronic equipment from damage, the novelty here lies in the specific.

FIG. 87 denotes a simplified block diagram which explicitly shows the effective position of both the tone generator and speech synthesizer relative to an interactive computer complex. Numeral 1111 denotes a key matrix, numeral 1112 describes an encoder means and number 1113 indicates a multiplexer unit. Numbers 1114 and 1115 are illustrative of logic gates, whereas numeral 1116 describes a commercially available ROM, RAM and EEPROM means, such as the SDK86 and or its equivalent as described earlier in this disclosure. Numerals 1118, 1119 and 1120 describe a interactive graphics display terminal, a tone generator and a speech synthesizer as previously indicated in the body of this disclosure. Numeral 1121 through 1126 depicts the entire ancillary portion of the computer complex as denoted by numeral 1121, which has operative subunits described therein by numerals 1122 to 1126; which provide for a totally interactive expandable system, with a voice recognition and voice actuated computerized command program. The operative subunits overlap each other partially. Numerals 1122 and 1123 depict preparatory functions where the data is processed. The data enters and exits the computer complex as illustrated by number 1124; whereas numeral 1125 is indicative of a decision process. The online storage means of the computer complex is described by numeral 1126. The relevancy modularized redundant software alluded to earlier will be discussed based on current data generated on fault probability by Fairchild, Rockwell, Texas Instruments, Intel and others in the field. The logic of having equivalent modularized systems is based on the present trend of data accumulated on electronic component systems optical electronic interfacing systems failures.

FIG. 88 depicts in brief both the failures experienced and the mean time per failure plotted against the execution time wherein both curve. The curvalinear failure being experienced eventually reaches a platue, whereas the present mean time per failure remains relatively linear, until a critical level in time is reached and then the slope ascends exponentially as described by the field equation expressed herein below:

Software Reliability Compiled As A Function Of Execution Time $$m_{fe} = M_{fo} \int_{\infty}^{0} \left[ 1 - \mathrm{EXP}\left[ - \frac{C\tau}{M_{fo}to} \right] \right]$$

and $$T = To\,\mathrm{EXP} \int_{\infty}^{0} \left[ \frac{C\tau}{MoTo} \right]$$

$m_{fe}$=number of failures experienced $M_{fo}$=total number of failures possible per a finite time interval To is equivalent to the mean time per failure $\tau$ denotes the cummulative execution time C is the test compression factor FIG. 88*a* is equivalent by definition to FIG. 88 with additional parameters describing the effects of current, firing pulse rate per unit time in relation to the rate of errors incurred per system. FIGS. 88*b*, 88*c* designate a complexed graphical representation of projecting a reflective region in space from which to reflect and/or deflect incident beams from the MALKE device to various target loci not in the line of sight. FIG. 88*c* is a legend corresponding to FIG. 88*b*, which has been constructed based on experimental evidence described in the foregoing specification. Experimental research conducted with mock-up miniaturized versions of the MALKE device additionally yielded a novel industrial process defined as atomic or Molecular Beam Projective Field Materialization (or AMB/PFM). AMB/PFM is a well delineated process whereby specific substances are voltilized then converted into a high energy plasma, which is focused into a beam and projected into a finite point in space within finite period of time. The above mentioned process greatly differs from various electroplating processes which require a charged or neutral metallic surface to coat or plate in that no apparent surface or object needs to be present. An exemplarily experiment was conducted at one thousandth scale, whereby a beam of reflective chromium was dispersed onto a specified portion of space exactly one kilometer away from the source beam generator. The said beam usually formed from a reflective metallic such as chromium which travels a calculated distance wherein dispersal is initiated at a predesignated point determined by the initial mass velocity of the plasma beam, the energy level of said beam, gravity, where present; interia atmospheric resistance; where present and other forces including, but not limited to electromagnetic phenomenea. Generally the said point materializes as an elongated sphere or irregular eliptoid between one and four orders of magnitude $10^1$ to $10^4$ times greater in diameter than the initial radius of the source beam. The dispersal pattern appeared to be independent of the mass velocity or energy initially exhibited by the plasma, as could best be determined by over 100 trials. In the case where metallics such as aluminum, chromium or reflective mediums were deployed a elongated spherical or irregular elliptical cloud or tenuous fog with a 62.7±0.5 to 84.9±0.5 mean percent reflectivity was achieved and substantiated by laser beam analysis. The mean reflectivity is accessed to be the mean average of the ratio of emissive light transmitted through and reflected from the projected irregular plasma medium conducted over one hundred trials. The amount of energy required to project a focused beam of said metallics into a low planetary orbit based on experimental results conducted on earth would be enormous, irregular spherical area approximately six centimeters in diameter, which would take an estimated 100 gigajoules averaged over interval of 60.0 seconds. The disadvantage of a non-AME/PFM system such as a reflective balloon, a satellite, or rocket with a mirrored surface are the time factor and the detection by low horizon electronic surveillance, including radar. It takes anywhere from 20 minutes to one hour to launch or orbit from a land base or similar such instillation and satellites already placed in a low or high geosynchronous orbit are subject to detection and attack by even the most conventional of ASAT systems. A reflective surface which can be rapidly materialized along the horizon is vertical and invisible to all known forms of radar. It is proposed once said reflective structure is materialized, a straight on sight parallel can be calculated and implemented between identified targets on ground (i.e. missiles, ground bases and the like) and the reflective cloud or said materialized structure. The disadvantage of the ABM/PFM process when compared to more conventional systems are obvious the source material and the energy required for projection of a small reflective shield would be enormous requiring the output of a nuclear reactor or its equivalent.

The cost in energy required to produce either a high energy laser emission and or particle beam emission has been estimated, based on experimental results to be between 4.8 to 8.2 gigajoules which is considerably lower than the AMB/PFM process. The 4.8 to 8.2 gigajoule value corresponds to the unidirectional energy required to destroy or damage an ultravelocity projection approximately ten kilometers above the earths surface and initially requires a continuous beam to rarefy and or displace the atmosphere between the source of the emissive beam and identified target. Once an optical window or corridor has been established by a continuous emissive source, the ultravelocity target or projectile can be engaged. Nearly 100 percent of the initial input energy according to experimental evidence is needed to displace and or rarefy the atmosphere forming a corridor between said emissive source and said target. If a AMB/PFM source was utilized a laser or other emissive source, the overall energy expenditure required to compensate for atmospheric displacement or rarefication or losses incurred in the process of reflecting of said emissive beams would yield a to ten fold elevation in power over $I_o$.* Experimental evidence indicates that after the reflective cloud is dispersed it has a mean life of between twenty minutes to one hour under ideal conditions, four to six minutes under conditions simulating solar wind effects and three to four minutes under conditions where intense emissive beams are being reflected by said metallic cloud onto one or more specified target structures. The projected metallic or reflective medium begins to undergo degradation when subjected to intense laser or particle beam emissions. The degradation of the AMB/PFM source under intense bombardment by an emissive source has been linked to the acceleration of thermal kinetic parameters within the projected medium and uneven dispersal or boiling off acid reflective medium.

*the initial output $=I_o$

The type of charge beams experimented with consisted of electrons protrons and short life charge neutrons, however positrons various heavy charged ions and the like subatomic particles could be effectively generated and deployed. There are means available by which a charged shield could be projected and materialized with the capacity to deflect or repell said charged emissive beams; however experimental evidence indicates that such a structure is twice as likely to undergo degradation. Obviously degradation can be countered by continuously or periodically replenishing the projected reflective or deflective source restoring said source by the AMB/PFM process. The experimental results of the foregoing is summarized in the pictorial graph contained in FIGS. 88*a*, 88*b* respectively.

The basic configuration of a fiber optics based laser gyro system equivalent to that which is present in both the piezoelectric and conduit arm systems is presented in a illustrative manner by FIG. 89. Elements, 01, $\phi$2 and $\phi$3 denote the laser source, polarizing controller/-polarizer means and directional coupler. Elements $\phi$4, $\phi$5, and $\phi$6 designate the phase modulator, the fiber optics spool and the solid state emission amplifier. Elements $\phi$7, $\phi$8, and $\phi$9 further designate a phonton detector, a wave comparator, and a wave descriminator means.

The principles of laser gyroscopics and interferometry are well understood and conceptually can be described by several common diagrams and field equations contained herein below:

Emissive light is essentially split by an automated beam splitter at points and it travels along a circular path $\varnothing$ until the same said emissive light completes its circuit and recombines at the original source of incident transmission, in this case point $\theta$, where the temporal transmissions interval can be appropriately differenced. The gyro phase shift is typically illustrated by the duel or dye transmission paths LCCW and LCW such that;

If $W \neq 0, \Delta L \neq 0$ and the Path length difference $$\Delta L = LCW - LCCW \geqq \Delta\phi$$

$$\Delta\phi = \frac{8\pi AN}{\lambda C},$$

as described in FIG. 89*a*, wherein W is defined as the rate of rotation, A denotes the area enclosed by the light path, and N is equivalent to the number of turns in the light path. The number of turns in a fiber optics coil is ideally directly proportional to the overall accuracy of the laser gyro system provides that signal losses incurred are limited to about two decibels per kilometer. The optimum diameter of the fiber optics element is less than or equal to 25 microns and the length of the spool to be greater than 1 kilometer but less than 100 kilometers. The absolute wavelength of the laser emitter is defined by $\lambda$ and the constant C which defines the velocity of light.

The assemblage of automated subsystems embodied within the invention are interactive and during the operation of the MALKE device must compensate for deviations which manifest themselves either from activities generated by the internal complement of systems or originating from environmental factors. The mechanism by which automated systems remain responsive to disturbances or deviat deviations are feedback loops associated with various sensors, comparators and controller means. The typical feedback loop associated with operative systems, subsystems and the like embodied with the invention is clearly illustrated pictorically herein below: wherein discrepencies or disturbances are detected by sensors, $\theta$i which send collectively their digitized signals to comparators, which act as error detectors. Error signals $\theta$E are sent to controller means which elicits actuator means which are additionally provided with power sources that generate loads leading to an output signal $\theta$o. Error signals are detected as deviations and appropriately compensated for either increasing the output of one or more systems or diminishing the said output or modifying the output in some prescribed fashion. The foreward transfer functions $K_1G_1(S)_1\ K_2G_2(S)_2$ The feedback signals are defined by element $\theta_f$. From the above illustration one skilled in the art can readily understand and appreciate the operation of mechanisms embodied within the operative framework of feedback loops and variations of same.

FIG. 90 is a flow chart for the program governing the frequency, duration, intensity and other characteristics of the sonic emissions produced by the acoustical generator means. The user initiates process 568 wherein the MALKE device is aimed or pointed at a target along the axis of sight, while the user actuates or keys the laser designator means which is described by process 569 and acoustical locator means 570. The data processed by elements 569, 570 are channeled to process 571 which entails a subprogram wherein the process of target acquisition is instituted on the said data. The start sequence, number 572 is actuated upon the completion of numeral 571. The user selects a set of instructions which define parameters such as power level or intensity, pulse shape and the duration of the acoustical emission, as indicated by programming process 573. Once element 573 is keyed then verification process 574 determines whether or not the primary targets are illustrated. If the primary targets are not illuminated (i.e. identified, tracked and locked onto) then the data from 574 is reconveyed to element 571 for reprocessing. If however, conformation of illuminated targets are exacted by determinant process 574 then process 576 is actuated. The information supplied from 574 is supplemented by a subprogram 575 which provides an informational update on primary targets. It is in process 575, wherein acoustical transmissions are deployed to engage primary target designations 1, 2, 3 . . . N. The first emission sequence is immediately followed by the administration of a second sequential sonic burst which is delivered to primary targets, as indicated by numeral 577. The data from 577 is sent to a number of determinant processes as described by elements 578 through 585. Process 578 determines if all the parameters are operational. If the parameters are all actuated then data from process 578 is conveyed to element 580, if not then the data from 578 is conveyed to process 579. It is in 579 where circuits are electronically scanned to verify power parameters and to recalibrate systems. Elements 580, 583 and 584 ascertains status of the intensity, pulse shape and duration of the acoustical emission; whereas if negative values are elicited by the aforementioned processes then means 581, 582 and 585 operate to reset and correct deviations in the established norms of intensity, pulse, shape and the duration of the acoustical emissions. Elements 578 through 585 collectively input into system 586. It is in element 586 wherein the proper execution of instructions is displayed to the user. If no secondary targets are available then the program is terminated, element 587 and the start sequence 572 is once more reinstituted. If secondary targets are specified then reinterative processes, collectively assigned the value 588 are enlisted. The processes contained within subprogram 588 are equivalent to those 574 through 586. Once the keyed instructions are completed in means 588 the program is terminated and the system is placed in a standby state numeral 589.

While much effort has gone into describing the operation of the invention in air, on land and indirectly in space oceanic operations are within the scope of the invention. The identification, tracking and pursuit of chemical species eminating from one or more targets is incorporated by reference by patent disclosure U.S. Pat. No. 4,589,078 and related patents. The identification, tracking and related activities are useful in identifying targets on the basis of combustion or other chemical residues not known to be generated by neutral or nonenemy forces. The data generated by sensors measuring laser spectroscopy, emission/re-emission spectra particle charge and motility of said chemical species is referenced and cross-correlated with data entering from other systems.

Computer programming concerning the tracking and pursuit of chemical emitters will be disclosed in part in the form of annexed algorithms. The aforementioned algorithms disclosed herein are based on derivations of mathematical formulae originally needed to identify, track and/or pursue chemical species in a state of dynamic flux, as sited in patent disclosure U.S. Pat. No. 4,589,078, which is hereby incorporated by reference into the specifications. Although the algorithms were originally deployed to track the motion of complexed chemical species with either a high rate of decay and or chemical reactivity, the said algorithms are applicable to the identification and pursuit of complexes chemical species emitted by a source target. The complexes of emitted chemical species consists of but are not limited to plumes emitted by the exhaust of rocket engines, the vaporization of ablative shielding upon atmospheric reentry, the reactivity of hull structures and or the release or discharge of exogenous chemical species into the environment. Variations of the algorithms have been useful in the identification and tracking of targets emitting a class of exogenous mediums described as surfactants. Surfactants, as described herein, are those substances or chemical species emitted along the external hull of targeted vessel or body deployed to reduce resistance or turbulence between the surface area of the hull structure and the surrounding medium transversed by the targeted structure. Additionally, the statistic formats or subroutines incorporated with said algorithms are applicable to laser/radar image enhancement, laser/sonar enhancement, laser designation or other related processes.

Experimental evidence based on a series of imulation tests indicate that a beam transmission of between 1.25 millimeters to 1.0 centimeters requires a near continuous incidence power of between 2.6 2.6–4.8 Gigajoules to penetrate through 50.0 klilometers of atmosphere in order to displace the linear cylindrical volume of atmosphere between the emitter source and target. High energy laser beam transmissions are effectively neutralized within 40–50 meters of aqueous mediums typical of sea water, whereas lower energy blanket transmissions in the shorter wavelengths ranging from the blue to near violet bands effectively penetrate oceanic mediums in excess of 300 meters. The lower shorter wavelength, higher frequency transmissions are useful in communications, the transmission and retrieval of data and chemical analysis of subsurface emitters such as submergibles, mines or subterranean aquatic bases.

FIG. 91 is a representative flow diagram for a basic program which precisely measures the distance of the emissive fiber optics element from a given target, on the basis of signal time difference differentials. The input/output parameter is a low level emission signal which is bounced or reflected from the target site, and it can be effectively assessed by onboard catheter based sensors, as denoted by numeral 615. The input/output parameters actuate the start sequence indicated by numeral 616. The initiation of the start sequence actuates the auto keyed wave detection spectram analyzer number 617, which then engages number 618. Number 618 represents a single optical electronic memory chip, which is incorporated into the catheter structure, and which is keyed to search for unique and properly specified wave functions. The data received from number 618 is further prepared and calibrated, such that the wave sign of the reference beam which incidents on the specified target is logged, as described by number 619. Once the data is properly logged, then it is set into an ongoing timing sequence denoted by numeral 620. The data output derived collectively from numerals 617–620 is acted upon, the verification of this continuous process is established by numeral 621, where if a negative response is elicited the data is then shunted to number 624. If confirmation is established such that the data is being operated on, then the collective data is conferred to numeral 622. It is in numeral 622 wherein the control operation measuring the duration of a signal, which is returned by either reflection or traced re-emissions derived from the target site is assessed. The input is processed by a priority compiler means which is described by number 623. The wave differential $\Delta T$ is read out in relation to a deterministic subprogram, which defines distance as a function of time, as noted by numeral 624. An ancillary subroutine of numeral 624 is denoted by number 625; and the transference of all $\Delta T$ program data is then converted into their digitized binary distance equivalents. As the various operations are performed on the data in number 625, the entire system is placed in a standby condition denoted by number 626, which is then followed by an interrupt/process interrupt condition, described by numbers 627 and 628. This is done until an ancillary process of gauging data is actuated, set and confirmed by element 629. The data is then conveyed from element 629 to number 630, where it is displayed continuously to denote vector position of the specified target site relative to the catheter means; while sensors undergo repeated recalibration after each measurement is exacted. Once the process denoted by numeral 630 has completed one phase of the operation, an output signal resetting the timing sequence is inacted and duly noted by numeral 631; and then the entire program is terminated, as indicated by number 632. At the point of program termination, number 632, a termination signal is sent to numeral 617 to flag its operation.

The following mathematical equations derivations are employed in accordance with the invention herein below: A subprogram yield Δt difference between a reference beam and the emissive return or reflection of a said beam, both taken over time yielding the absolute target distance.

The MALKE device embodies the unitary assemblage of emissive and control means forming an extended emissive cavity. The M.A.L.K.E. unit is replete with redundant backup system calculated to be actuated in the event of a systems failure or keyed by the user upon command. Thus far the operations of various subsystems embodied within the aforementioned device have been discussed in detail; however the mechanism by which all systems operate collectively together in an extended emissive cavity had only been alluded to in the specifications. FIG. 92 a block diagram discloses the main control center CPU number 1127 which is centrally located, surrounded by a network of secondary control systems. The secondary control systems are incorporated as redundant features in the event the CPU is overloaded or damaged by excessive radiation heat or explosive impacts. The effective real time speed and size of the secondary systems in more than 50% of the cases is two to three orders of magnitude greater than the VHSIC system magnitude greater than the VHSIC system embodied within the CPU. The basic advantage of the aforementioned secondary control systems are that they are nearly impervious to radiation, heat explosive impact and EMP.*

The rate of radioactive decay is equivalent to $16^6$ rads, temperature equal to 1150°±05° C. for twenty minutes, disjunctive impact of one hundred thousand G's and an electric discharge of between 40-60,000 Amps.

The CPU, element 1127 of FIG. 92 is surrounded by an array of electro-optical I/O junctions collectively described by numeral 1128. Numerals 1129, 1130 and 1131 designate the pulsar and megapulsar laser emitter means. Numeral 1132 defines an ancillary automated and/or manual override system servicing elements 1129 through 1131. Numerals 1133, 1134 and 1135 are assigned to an excismer laser generator, a combination acoustical radiofrequency source and chemical combustion type laser emitter means, respectively. Element 1136 is equivalent to element 1132 and services elements 1133 through 1135. The synchrontron devices requires a secondary controller means, an auxiliary CPU and an electro-optical I/O network of junctions which are assigned numbers 1137, 1138 and 1139. The actual synchrontron unit, a type of free electron laser generator is defined by numeral 1140. The magnetic field strength, sequence in which separate magnetic elements are actuated and the means to control slit aperture and/or deflection are described by elements 1141, 1142 and 1143. Units controlling the fields polarity, the rate at which particles are accelerated and specification of particles to be accelerated from a suitable source are designed by means, 1144, 1145 and 1146. Auxillary manual override for elements 1141 through 1143 and means 1144 through 1146 are described by units 1147, 1148. If charged particles are to be deployed in the presence or absence of laser emissions the ying yang focusing element 1149, are actuated in conjunction with horizontal and vertical deflection means 1150, 1151 to control the aperture of emission for said beams of charged particles.

The transmission of coherent radiation emissive beams and or streams of charged particles are directed by an array of automated mirror elements 1—n described in part by means 1152, 1153. The automated mirror units are motivated to intercept one or more designated beams in three dimensions. The incident surfaces of each said mirror means are charged by elements 1154, 1155 which operate to regulate the wavelengths and or to select for the presentation of one or more lines within one or more given wavelengths. Decompensation of the mirror elements over extended periods of operation or where highly energetic coherent transmissions in the short end of the spectrum are deployed and in order to restore reflectivity of said mirror means coating and resurfacing elements 1158, 1159. Controller means 1160 and or ancillary means 1161 regulate the operations of elements 1152 through 1159. Additionally, elements 1152 through 1159 may be alternately controlled from the CPU proper, 1128 and or the intervention of automated/manual override means, 1132. Numerals 1156, 1157 designate control complexes which provide axial and translational motion in three dimensions for the complement of automated mirrors.

The piezoelectric focusing element consists of a finite number of separate and distinct focusing elements which are indicated by numerals 1162, 1163. Each focusing element 1162, 1163 are variably focused by a complex of piezoelectric motivator elements defined by numerals 1164, 1165. The surfaces are chargeable in order to deflect a stream of charged particles onto one or more target loci by element 1166, 1167. In the event the reflective surface undergoes deterioration units 1168, 1169 provide resurfacing. Secondary controller means 1170 embodied within the plateform housing the said piezoelectric focusing complex provide the necessary programming for target engagement.

The aforementioned plateform for the complement of piezoelectric elements 1—n is situated upon a magnetic levitation means defined by numeral 1171. The magnetic levitation means consist of an array of separate and distinct magnetic levitation units arranged circumferentially around the piezoelectric focusing complement which is situated above an opposing automated magnetic levitation means composed of equivalent electromagnetic elements. The vertical ascent and descent of the piezoelectric focusing complement is governed by unit 1172. The yaw, pitch and rotation of the piezoelectric focusing complement is governed by means 1173, 1174 and 1175, respectively. Additionally, provided is an ancillary control means, number 1176 which controls the entire output of the above mentioned magnetic levitation elements assign numbers 1171 through 1175.

In the event the magnetic levitation means fails to operate than a hydraulic motivator means described by element 1177 is actuated by the CPU, 1127 and or auxillary manual override means 1132. The vertical ascent and descent of the plateform is controlled through means 1178. Axial rotation of the said plateform structure about its central axis is initiated by means 1179.

Magnetic levitation and automated focusing of the piezoelectric means under the direction of the CPU allows near relativistic targeting and subsequent engagement of one or more designated targets; whereas hydraulic motivation is four orders of magnitude slower ($10^4$).

The operation of other ancillary systems including but not limited to the operation of automated dye system, active coolant pumps and or various robotic means are indicated collectively by elements 1180, 1181. The channelling of power from a reactor source the operation of the MHD system and related systems are also defined by element 1180, 1181. Passive systems such as the primary coolant means are mentioned but are separate, distinct and independent from the CPU and operate autonomously, to the exclusion of all other systems.

FIG. 93 discloses in part an abbreviated flow diagram summarizing the operation of the MALKE device. The extent to which operation is conducted within each system and subsequent interaction initiated between systems and subsystems is sufficiently summarized for one skilled in the art to readily understand the operation of the MALKE device. Numerals 1182 through 1192 of FIG. 93 disclose ten complexed and variable separate and distinct subprograms deployed by the MALKE means to identify, acquire and pursue designated targets. Disclosed earlier in the specifications where various equations and or programming formats deployed to illiminate and track numerous targets exhibiting complexed and variable behavior ranging from multiphase radar means to spectral shifts provided by doppler laser analysis. Single numeric values are assigned to each subprogram rather than reiterating the complexity of each subprogram. Numeral 1191 embodies the programming formats disclosed in part by FIGS. 51 through 54*b*. Subprograms entailing laser designation, multiple phase radar and three dimensional telemetry systems are disclosed by numerals 1182, 1183 and 1184. Elements 1185, 1186 and 1187 accesses emissions generated by sonar, radiofrequency and transmission alluding to VHF, UHF and other bands. Numerals 1188, 1189, 1190 and 1191 are assigned to subprograms encompassing radioactive decay, nuclear magnetic resonance, laser doppler analysis of emitted chemical species and other ancillary processes. Numerals 1192, 1193 define manual interrupt processing systems or override means and associated keying operations. Manual means 1192 consists of but is not limited to voice command/voice recognition systems, manual key stroke or touch access control, light pen cursor designation and or other means. Elements 1182 through 1193 collectively input into subprogram 1194 wherein data is collated, target acquisition and target pursuit are initiated prior to engaging preparatory process 1195. Preparatory process provides compression of collated data derived from program 1194. Decision process 1196 determines whether or not the compression of data is sufficient and whether or not target acquisition and or pursuit is adequate enough to enlist engagement of said target(s). If target acquisition pursuit and the like are adequately prepared then the system is placed on standby momentarily while data is transferred by element 1197 to element 1210. If it is determined by decision process 1195 that data compression has been inadequate, or that the signals have been significantly distorted or that signals from two of the detection means remain uncorrelated then filter and auto-correlation process 1190 is engaged to reprocess the information. The information reprocessed and filtered by process 1196 is reconveyed to preparatory process 1194.

It the unlikely event of a total systems failure regarding target acquisition then target engagement can be keyed alternately by one of two ancillary bypass systems. The first bypass system is inacted by the user manually and entails but is not limited to targeting by on site observation, hardware operated by the user directly in conjunction with remote ancillary systems extending to the insertion of fuel rods into a reactor element to power up energy depleted systems. Numeral 1198 is indicative of a user based manual override or bypass system, wherein commands are introduced by the user at a secondary rather than a primary level of integration. Data is transferred from 1198 to processes 1200, 1201. Data is displayed as indicated by number 1200. Numeral 1201 designates a subprogram which initiates and executes target identification, tracking and or pursuit of said target. Numerals 1202, 1203 defines ancillary routines and subroutines appropriately defining and refining parameters associated with target acquisition. Process 1204 prepares data and signals subprogram 1210. Numerals 1205 through 1209 are equivalent to numerals 1199 through 1204 with the exception that 1205 unlike 1199 is triggered by an automated rather than a manually operated program. The assignment extent and subsequent deployment of one or more energy emissive system(s) and the sequencing of said system(s) is initially controlled by subprogram 1210. Numerals 1211 through 1216 specify the types of emissive systems to be deployed, the extent and temporal interval in which the energy source(s) will engage on or more designated targets. Numerals 1211, 1212 and 1213 specify emissions to be generated by the pulsar, megapulsar (s) and radiofrequency, piezoelectric/acoustical systems. Numerals 1214, 1215 and 1216 specify the actuation sequence for the chemical combustion laser generator means, the synchrotron generator unit and the excismer laser, respectively. Numerals 1217 through 1222 define preparatory processes for elements 1211 through 1216. Numerals 1223, 1224, and 1225 describe subprograms defining parameters for subsystems of the synchrontron device, 1215, including but not limited to selection of particle type, power or speed or particle beam discharge and beam operation control. Elements 1217 through 1222 collectively engage programs 1226, wherein the specification commands are executed and channeled to their proper designated actuation programs. Six equivalent actuation subprograms are disclosed in FIG. 93; however a fully automated device may have a minimum of twenty actuation programs to a maximum of one hundred depending on the number of emissive systems. Element 1226 enlists the actuation programs 1227 through 1302, inclusive. Since the actuation programs are equivalent then the disclosure of one discloses the operation of the remaining five said programs. Numeral 1227 is a preparatory process, wherein incoming complexed data transmissions undergo signal processing and demodulation. Numerals 1228, 1129 entails the means whereby the energy supplied to a given system(s) and the duration of operation of the said are specified and appropriately executed. Decision process 1230 access whether or not the functions are correctly dispatched from elements 1228, 1229. If it is determined by 1230 that all functions regarding power output and the duration of the output are correct than process 1232 is engaged. If however, it is determined that either the power or durational interval of delivery (is) are improperly executed, but present, then clerical operation 1231 is imposed on the data from 1230 and the revised data is reconveyed to element 1229 to be collated with incoming impulses. Process 1232 exacts or accesses subprograms for the emission of specified wave characteristics and or beam type. In the case of the synchrontron unit, regardless of the type of particle being deployed acceleration is a direct function of power supplied and spectral properties such as wavelengths and or spectral lines contained within said wavelengths are a direct function of beam acceleration and the slit size of the aperture control means. Decision process 1233 verify the selection of one or more wave characteristics and the like. If verification by element 1233 is affirmed then secondary temporal sequencing means are enlisted, as indicated by number 1235; however unverifiable wave characteristics; spectral lines or the like are conveyed to process 1234 wherein the data is filtered, reprocessed and reintroduced to element 1129. The duration or interval of time specified wave characteristic(s), spectral line(s) or other properties contained within on or more emission is (are) presented is controlled by process 1236. Decision process 1236 verifies the duration in time said wave characteristics, spectral lines and the like processes are presented with unsubstantiated resultant data which is reconveyed along with incoming data to deterministic process 1230 for analysis. If verification by decision process 1236 is exacted then subprogram 1237 is enlisted; wherein ancillary, auxiliary and primary support systems are provided with sufficient instructions to be actuated. Decision process 1238 determines whether or not the proper command have been issued and received by the aforementioned system. If insufficiency exists in the instructions necessary to actuate said systems then preparatory process 1239 is enlisted which amplifies and filters the exiting signals. The signal prepared by process 1239 are conveyed to process 1240 for further enhancement and restructuring prior to being submitted with data entering determinate process 1236. If positive confirmation is exacted by decision process 1238 then the data is transferred from the actuation program elements 1227 through 1238 to the program governing systems implementations wherein the respective systems are called upon to execute the entire complement of commands, as indicated by numeral 1241. As stated earlier the six actuation programs specified in FIG. 93 of the disclosure are equivalent; therefore numerals 1227 through 1241, 1242 through 1256, 1257 through 1271, 1272 through 1286, 1287 through 1301 and 1302 through 1316 are all equivalent. Numerals 1241, 1256 and 1271 are equivalent to 1286, 1301 and 1316 wherein data is transferred from the respective actuation programs. FIG. 93 embodies the information contained within FIGS. 93', 93'' and said Figures are equivalent to FIG. 93.

FIGS. 94, 94' disclose in part the programming format which implements systems operation for the one or more systems embodied with the MALKE device. It is within the implementation process wherein either one or more operative systems are actuated and or viable alternative systems are inacted in the event of a systems failure or some other fault developing which renders the selected or specified system(s) inoperative or unavailable to the user. Transfer processes 1241 through 1316 collectively define equivalent subprograms enlisted collectively by the six equivalent transfer points, 1241, 1256, 1271, 1286, 1301 and 1316, respectively. Data from transfer points 1241 through 1316 actuate preparatory process 1317 which encodes the signal and transmits said signal to process 1318, which filters and amplifies the signal; prior to engaging preparatory process 1319, wherein a separation and decoding sequence occurs. The information prepared by element 1319 is conveyed to deterministic process 1339 to debasing modulator element 1320; wherein the signal is converted into at least six divergent transmission beams with portions of said transmissions, being conveyed to at least six separate and distinct loci or logic centers controlling separate subsystems considered the synchrontron device or system consisting of a multitude of smaller subsystems. The type of particle or source beam(s) utilized is executed by subprogram 1321. The rate of acceleration of said particle beam(s) is determined by subprogram 1324. The confinement of field strength, which shapes the characteristics of said beam(s) as wavelength characteristics, spectral lines and related properties are executed by subprogram 1327. Subprograms 1330, 1333 and 1336 actuate mechanisms responsible for directing, diverging and focussing the source beam(s). Determinate processes 1323, 1326 and 1329 are equivalent in function to 1332, 1335 and 1338. The said deterministic processes are associated with separate and distinct sensor based feedback loops to determine whether or not the instructions of the subsystems are appropriately executed. If the respective subprograms instructions are impeded or are partially implemented then preparatory processes 1322, 1325, 1328 1331, 1334 and 1337 reprocess the data and reconveys the information to the respective subprograms. If however, the subprograms are properly executed in turn then the positive signals sent by the deterministic processes are collective acting as forcing function actuating high order functions assigned numeric value 1376. As disclosed previously the data from preparatory process 1319 is diverged and sent to both process 1320 and deterministic process 1339. If it is determined that the prepared data is insufficient to properly activate do to deficiencies in the processing of signals then the data is conveyed to elements 1340 through 1342 which reprocesses the information and reengages process 1377. Clerical operation 1340 wherein data signals are reorganized and reclassified prior to being sent to process 1341. It is within process 1341 where the data is prepared to re-enter the main sequence of the program. Preparatory process 1341 engages comparator element 1342, wherein the reprocessed data is conveyed along with new data to update data not sent to preparatory process 1317. If however, decision process 1339 determines that the data is sufficient to actuate the specified system(s) but said system(s) are inoperative then alternative system(s) must be activated. As indicated by subprogram 1343 a bypass switches to the next available operative system. Decision process 1344 determines whether or not a bypass system is available. If it is determined than an alternative source or system(s) are unavailable due to impeded access routes then alternative access routes are engaged, as indicated by process 1345. If however, an alternative source is available then subprogram 1349 is enlisted by decision process 1344. Subprogram 1345 entails statistical formats, which completes partially deleted garbled or jammed signals. Process 1345 enlists decision process 1346, which determines whether or not the function of the signals can be properly identified. If proper identification is established then preparatory and filter process 1347, 1348 are inacted and the data is summated with incoming data from 1343 to be reevaluated by decision process 1344. If a negative response is enlisted by process 1346 then higher order functions 1376 are engaged. Subprogram 1349 displays the data, numeral 1350, which alerts the user and provides for manual intervention, as indicated by number 1351 and engages process 1352. Process 1352 is a subprogram wherein data pooled from other processes undergo integration. Once data has been pooled and undergone integration decision process 1353 determines whether or not data integration is properly executed. If positive affirmation of integration is determined by decision process 1353, then process 1355 is enlisted and if not the data is conveyed to process 1354. Process 1354 is a subprogram which subjects data to statistical analysis to eliminate signal distortion; whereas process 1355 enhances and filters the data signals. Data retrieved from elements 1354, 1355 are entered into deterministic process 1356, wherein verification of signal clearity is established. If signal clearity is not confirmed then the signal undergoes further enhancement redigitized and filtered as indicated by elements 1357, 1358, respectively. If positive confirmation is substantiated by process 1356 then process 1359 is engaged, wherein the alternative system is fully actuated. Decision process 1360 determines whether or not the alternative system is fully actuated and if a negative response is elicted then process 1361, 1362 are engaged. Data from 1360 is implemented by process 1361 wherein the said system(s) is (are) placed on standby and data is transferred or reconveyed back to element 1349, as indicated by element 1362. Positive affirmation of the actuation process is confirmed by process 1360 then subprogram 1363 governing a controller mechanism is activated. Each emissive system and the like is formed from the operative interaction of several subsystems and subprogram 1363 which collectively keys the actuation and sequencing of said subsystems. Decision processes 1364, 1365 and 1366 determine the operative viability of each subsystem, in relation to the overall operation of the entire system. Decision process 1364 determines the sufficiency of power limits accessed deliverable to specified subsystems. Decision process 1365 is enlisted upon positive confirmation of an adequate power source which determines if special properties, such as wave characteristics are selected. Decision process 1366 determines whether or not emissive beam(s) generated are properly focused and or directed to points of utilization. Negative responses elicited from decision processes 1364, 1365 and 1366 are appropriately dealt with by conveying the data to processes 1367, 1368 and 1376, respectively. Processes 1367, 1368 institute routines and subroutines which amplify signals and switch to auxiliary backup systems in the event of a systems failure. Preparatory process 1369 receives impulses from means governed by elements 1367, 1368 and actuate various feedback loops associated with the operation of said auxiliary backup systems. Process 1370 entails a subprogram which is responsible for the execution of all commands wherein upon termination the subsystems are temporarily placed in a standby state, as indicated by numeral 1371. Process 1372 is a subprogram requiring the initiation of maintainance mechanisms including but not limited to the recharging of reservoirs, restoration of reflectivity to a surface undergoing rapid deterioration and discharge of excess residual heat or the byproducts of the emissive source beam generators. Deterministic process 1373 verifies whether or not maintenance has been properly effected on subsystems. If it can be positively affirmed that the specified systems have all undergone appropriate maintenance then preparatory process 1374 is engaged; whereas preparatory process 1369 is reenlisted if a negative response is indicated by process 1373. Preparatory process 1374 and termination element 1375 shutdown all operative subsystems and transfers the remaining data to be acted upon further by higher order functions, as indicated by numeral 1376. The programming format for the entire complement of subsystems embodied within the MALKE device is replete with subprograms governing bypass processes for subsystems with redundant or repetitive functions.

FIGS. 95, 96 both entail the programming formats executed by one of several equivalent automated mirror means embodied within the MALKE device. The primary function of the automated mirror complex is to direct and or selectively alter the characteristics of wavelengths and the lines contained therein, within the confines of an extended optical emissive cavity. Each automated mirror element is actuated by signals generated by one of three sources described by numerals 1377, 1378 and 1379. Numeral 1379 provides a set of impulses which keys preparatory process 1380 and is unique in that it is a reinteractive process, wherein information is continuously recycled constantly updating the system from one moment to the next. Numerals 1378, 1379 are a set of equivalent instructions from either the CPU, user or some alternate source actuating preparatory process 1380. Preparatory process 1380 actuates an array of sensory means associated with a feedback loop controlling motivator means utilized to translate the mirror element in three dimensions. Preparatory progress 1380 actuates the start sequence described by number 1381. Process 1382 determines the number of beams to incident against a predetermined automated mirror means. Interrogative processes determine whether or not the number of specified beam(s) incident upon a designated mirror means. If conformation of engagement can be established between the specified mirror means and the incident beam(s) then process 1383 is enlisted. If not the data from 1382 is reconveyed to process 1380 to be reinstituted along incoming data. Secondary preparatory process 1384 processes transfers reprocessed information along with data conveyed by decision process 1382 to a subprogram defined by element 1385. It is subprogram 1385 wherein the position of the incident beam(s) are computed and accessed against the absolute position of the specified automated mirror means. The data from 1385 is conveyed to preparatory process 1386; whereby data retrieved is processed to determine whether or not the mirror means is engaged by said beam(s). Decision process 1387 determines whether or not the specified mirror means centroid is engaged. If said centroid is not engaged then the data from 1387 is conveyed to decision process 1390. If the centroid of the mirror is engaged then process 1388 is complemented; wherein the mirror means is selectively oscillated to diffuse, or disperse the beam(s) more evenly along the surface of the aforementioned centroid. If the centroid is engaged in the prescribed manner then the data is conveyed directly to a higher order function processing center to be collated with other data, number 1389. Decision process 1390 1391 and 1392 essentially determine whether or not the x, y and z axis of the mirror means coincide with the central axis(es) of the incident beam(s).

Decision process 1390 determines whether the axis of the aforementioned mirror means coincides with the coordinates necessary to allow the centroid of the mirror means to be illuminated by incident beam(s). If the x axis of the mirror means deviates from coordinates necessary to provide a illumination of the centroid then process 1391 is enlisted. Process 1391 actuates a motivator means which translates the entire mirror unit to specified points between 0 and 360 degrees, until the unit is brought into alignment with the incident beam(s). Decision process 1392 confirms whether or not the axial coordinates coincide with the coordinates required to provide illumination of the target controid. If illumination is confirmed by determinant process 1392, the motivator means is automatically disengaged and a systems stop is flaged for the x axis as indicated by numeral 1393. If confirmation can not be ascertained then higher order functions are enlisted, as indicated by numeral 1402. Negative responses elicited by decision processes 1390, 1391 and 1392 enlist subprograms 1393, 1394, 1395 and 1396, wherein compensatory measures are instituted by axial translation motivators automated in the y and z axes, respectively. Decision process 1397, 1398 and 1399 determine whether or not the the mirror centroid is engaged, positive responses enlists processes 1399, 1400 and 1401, respectively; whereas negative responses in all cases enlist higher order functions collectively described by number 1402. Data from element 1402 is conveyed to decision process 1403; wherein it is determined if all translational coordinates coincide with those x, y, z coordinates necessary to illuminate the aforementioned centroid. If any confirmation is exacted by process 1403 then the data signal acts to enlist both process 1404, 1405 and in the absence of confirmation process 1407, is actuated. Numeral 1404 denotes a subprogram which institutes a reiterative process wherein data is recycled continuously providing a record of the previous positions of both the incident beam(s) and the specified automated mirror element. The input derived from 1404 is sent to 1377, which reinstitutes the cycle. Numeral 1405 flags the actuation of one or more concurrent programs controlling emissivity and coating, as indicated collectively by number 1406. If confirmation can not be ascertained by determinant process 1403 then process 1407 is engaged, wherein alternate feedback loops are instituted and/or alternate programs are keyed to actuate equivalent backup mirror means enlisted by the CPU or alternate sources.

FIGS. 96 to 99 disclose detailed program formats typical of the type of formats governing selective emissivity and reestablishing the integrity of the mirrors reflective element. The entire above mentioned formats are instituted once confirmation of centroid illumination is established, as indicated by numeral 1406. The electrical impulses emitted by numeral 1406 in affect acts as a forcing function actuating keying process 1408. Keying process 1408 actuates, preparatory process 1409, which places three separate and distinct subprograms into an active mode, as indicated by numerals 1410, 1411 and 1412, respectively. Subprogram 1410 determines the integrity of the mirror element and in the event of loss of said integrity or decompensation of reflectivity institutes programming of a compensatory nature. Subprogram 1411 specifies fine electronic tuning of electro-optical systems controlling selective emissivity. Subprogram 1412 initiates a process, wherein wavelengths are selectively emitted; whereas other emission or wavelengths are reflected.

FIGS. 96 to 96'' disclose a programming format governing coded instruction concerning the number of emissions and characteristics within wavelengths to be selected or are regulated by altering the charge characteristics of the aforementioned mirror elements. Subprogram 1411 is concerned with differentially selecting for certain specified wavelengths and lines contained therein by differentially altering the charge of the mirror element within the automated beam splitter means. The wavelength and/or lines within the wavelength are specified by subprogram 1411. The coded signals from the separate charging means, for sequencing is indicated by preparatory element 1411*a*. the actual electronic sequence governing emissivity is controlled by element 1411*b*. The instructions from element 1411*b* are desiminated to process 1411*c* wherein the actual command is executed. Process 1411*c* simultaneously enlists subprograms 1411*d* through 1411*x* and associated processes denoted by elements 1411*e* through 1411*z*, respectively. The functions performed by elements 1411*d* to 1411*g* are equivalent to subprograms and associated processes accompanying the aforementioned programs, with the exception that each subprogram determines a different number of wavelengths or spectral lines contained within a given wavelength or multiple wavelengths. Although only six subprograms are indicated by elements 1411*d*, 1411*h*, 1411*l*, 1411*p*, 1411*t* and 1411*x* command elements 1411*b*, 1411*c* may have in excess of 1000 equivalent subprograms. For the sake of simplicity consider subprogram 1411*d* to contain therein in the short end of the spectrum and subprogram 1411*x* to contain all wavelengths and spectral lines contained therein in the long end of the spectrum. Further, assume the four intermediate subprograms, 1411*h*, 1411*l*, 1411*o* and 1411*p* correspond to intermediate wavelengths and spectral lines in between the long end of the spectrum, which corresponds to microwaves and the short end of the spectrum which approaches shorter wavelenghts such as ultraviolet radiation. Subprogram 1411*d* adjust the emissivity of given automated mirror means to correspond to a given wavelength and or lines(s) in the short end of the spectrum. Process 1411*d* engages preparatory process 1411*e* which keys the correct charging sequence necessary to coincide with the correct wavelength or spectral lines specified by subprogram 1411*d*. Through a series of interactive feedback loops associated with sensory apparatus deterministic process 1411*f* assess whether or not the correct emissivity has been ascertained. A negative response elicited from decision element 1411*f* reinstitutes preparatory process 1411*e* which intensifies the signal strength biasing the charge on the automated mirror. A positive response elicited by deterministic process 1411*f* conveys the data to processes 1411*g* wherein the signal concerning emissivity status of the automated mirror element is filtered, amplified and reprocessed before being reconveyed to higher order function 1402. Elements 1411*d* to 1411*g*, 1411*h* to 1411*k*, 1411*l* to 1411*o*, 1411*p* to 1411*s*, 1411*t* to 1411*w* and 1411*x* to 1411*z'* are equivalent.

Subprogram 1412 is indicated in part in FIG. 96' and is responsible for the gross adjustments in emissivity, whereas 1411 makes the fine adjustments in emissivity for the aforementioned automated mirror element. The emissive wavelengths are specified by process 1412*a* which conveys data to deterministic processes 1412*b*. The automated mirror element previously mentioned is a subunit of the automated beam splitter means. A negative response elicited by decision process 1412*b* reconveys data back to 1412*a* for reprocessing; whereas an affirmative response channels data to element 1412*c*. It is within process 1412*c* broadly adjusts the spectral lines contained within the wavelengths and engages deterministic process 1412*d* which accesses the current status of emissivity. Decision process 1412*d* determines to what extent if any the command has to be executed and the extent to which selectivity has been achieved. If any array of sensors contained within a feedback loop indicate that the correct wavelengths and or spectral lines within the wavelengths have been selected then process 1412*e* is actuated. If selective emissivity has not been or only partially achieved then preparatory process 1412*f* is enlisted, wherein parameters are modified, updated and the emissive beam(s) are reanalyzed to establish whether the incident beam(s) consist of charge particles or not. Data from 1412*f* is conveyed to determinant process 1412*g* which confirms emissivity is impeded due to the presence of incident particle beam(s) of a specified charge. Data from 1412*h* engages deterministic process 1412*i*. Decision process 1412*i* determines whether or not no emissivity or partial emissivity occurs due to the presence of one or more charged beam(s). If it is determined that the deflection and or modification of a charged beam(s) in the presence of one or more neutral charged, or photonic coherent emissive beam(s) impedes the mechanism by which selective emissivity is achieved then a compensatory process are activated, as described by numerals 1412*j*, 1412*k*. It is in preparatory process 1412*j* wherein compensatory measures are formulated in regards to strength of charge, polarity, duration of surface charge and number or frequency of executions. Process 1412*k* executes the compensatory measures. Losses incurred in reflectivity due to the deterioration of the reflective surface is compensated by program 1410, which provides restoration of the reflective surface. The integrity of the reflective coating is accessed by determinant process 1410*a*. If reflectivity is deemed sufficient by 1410*a* then preparatory process 1410*b* is engaged; whereas a negative response by decision process 1410*a* elicits subprogram 1410*c*. It is subprogram 1410*c* wherein compensatory means measures are enlisted to restore the reflectivity. Decision process 1410*d* determines whether or not the restoration process inacted by subprogram 1410*c* is sufficient to reestablish reflectivity to some specified norms. If it is determined that reflectivity according to some specified norm has been reestablished then subprogram 1410*e* is enlisted and upon completion reengages process 1409. A negative response elicited by deterministic process 1410*d* enlists subprogram 1410*f*, which enacts alternate compensatory action and upon completion returns to preparatory process 1409 for the next cycle.

The higher order functions define collectively by numeral 1402 is monitored and interrogated by a number of determinant processes. Determinant process 1402*a* accesses whether or not the 1402 is operative if a negative response is elicted by 1402*a* then preparatory process 1402*b* is inacted if not then a positive response by decision process 1402*a* enlists 1402*e*. Preparatory process 1402*b* engages subprogram 1402*c*, which taps alternate higher order function and places processes 1402*e* to 1402*g* determine coarse or gross and fine tuning of emissivity and determinant process 1402*i*, 1402*h* which then institutes recycling to elements 1407, 1410 and 1411, respectively.

As previously indicated, the MALKE device is replete with alternate backup systems containing a large number of repetitive circuits. If one system or circuit fails an alternate circuit and or programming route is immediately selected to replace either some or all of the functions lost. The figures describing the operation of the automated beam splitter unit embodying the said mirror means is only one single unit of an entire complement of equivalent units and the failure of anyone unit is immediately compensated by other units.

In FIG. 97 element 1407 engages keying process 1408 which in turn enlists preparatory process 1409 enlists processes 1410, 1411 and 1412 as indicated previously in FIG. 96. Process 1412 like 1411 and 1412 are subprograms embodying elements previously assigned alpha numeric values 1410*a* to 1410*f*, 1411*a* to 1411*z'* and 1412*a* through 1412*i*. Coded instruction concerning the number of emissions and characteristics within wavelengths to be selected for are regulated by altering the charge characteristics of the aforementioned mirror elements. Subprogram 1411 is concerned with differentially selecting for certain specified wavelengths and lines contained therein by differentially altering the charge of the mirror element within the automated beam splitter means. The wavelength and or lines within the wavelength are specified by subprogram 1412. The coded signals from the separate charging means, for sequencing is indicated by element 1413. The actual electronic sequence governing emissivity is controlled by element 1414. The instructions from element 1414 are desiminated to process 1415 wherein the actual command is executed. Decision process 1416 determines to what extent if any the command has to be executed and the extent to which selectivity has been achieved. If any array of sensors contained within a feedback loop indicate that the correct wavelengths and or spectral lines within the wavelengths have been selected then process 1417 is actuated. If selective emissivity has not been or only partially achieved then preparatory process 1418 is enlisted, wherein parameters are modified, updated and the emissive beam(s) are reanalyzed to establish whether the incident beam(s) consist of charge particles or not. Decision process 1419 determines whether or not no emissivity or partial emissivity occurs due to the presence of one or more charged beam(s) If it is determined that the deflection and or modification of a charged beam(s) in the presence of one or more neutral, charged, or photonic coherent emissive beam(s) impedes the mechanism by which selective emissivity is achieved than a compensatory process is actuated, as described by numerals 1420, 1421 and 1422. If it is determined that emissivity has not been impeded by the deflection of a charged particle emissive source then process 1423 is enlisted. It is in process 1423 wherein data is prepared, reprocessed and reevaluated prior to being reintroduced to process 1420 to be acted upon. Numerals 1424 through 1432 are redundant and equivalent to the aforementioned disclosed by numeral 1415 to 1423. There are as many as ten redundant processes for each function of the automated mirror element; but no fewer than two redundant processes for each said function. Redundant programs are duely noted herein by representative numeric equivalents, 1424 to 1432 through 1496 to 1504, inclusive. FIG. 97 embodies the information contained within FIGS. 97', 97'', which are collectively equivalent to FIG. 97.

Processes 1420, 1429, 1438, 1447, 1465, 1474, 1483, 1492, 1501 re-enter the main program sequence through processes 1505, 1506, as disclosed by FIG. 97, inclusive; process 1507 of FIG. 98 provides for the modification or refinement of the spectral lines embodied with one or more incident emissions. Data is transferred by 1506 from 1505, which specifies the wavelength characteristics to process 1507, which also receives information from process 1505. Data conveyed from processes 1411, 1507 enlists process 1508 which specifies exactly the number of spectral lines and the types of wavelength characteristics. The emissive wavelength(s) is verified by deterministic process 1509, which upon confirmation enlists process 1510. If confirmation of data regarding spectral lines, wavelengths, wavelength(s) characteristics by decision process 1509 is unsubstantiated then process 1508 is re-enlisted. Process 1510 refines the wave characteristics of the emissive beam(s) to specifically emit specified spectral lines(s), while simultaneously reflecting other emissions. Decision process 1511 determines through various onboard systems and ancillary means whether or not the selection of wavelengths and/or spectral lines are properly executed. If said wavelength(s) and or spectral lines are properly executed numeral 1512 is enlisted; if not the data from 1511 is returned and reprocessed along with data entering from process 1507. Process 1512 controls the sequencing of wavelengths, spectral lines and or wavelength characteristics presented by the mirror element. Rapid sequencing of different spectral lines is of primary importance for analysis of returning signals during target acquisition or for transmissions pertaining to communications. Sequence verification is determined by decision process 1513. If process 1513 has determined that the correct sequence of lines of wavelength, spectral lines and the like, element 1514 is engaged. If the correct sequence of wavelengths, spectral lines, wave characteristic and the like is indeterminate, then the data is restructured and reevaluated by process 1515 which upon completion enlists process 1514. Decision process 1516 determines whether or not the proper sequences have been executed by process 1514. If upon reevaluation it has been determined that the proper sequence was correctly presented in its entirety then process 1515 is actuated. If data signals obtained from 1514 are unsubstantiated by decision process 1516 then preparatory element 1517 and filter process 1518 are engaged with the resultant data being reintroduced along with data from process 1512 to determinant process 1513. If the correct sequence of wavelength spectral lines or other wavelength characteristics are properly executed within the specified time intervals then the unit is placed on standby, as indicated by numeral 1519. Standby state 1519 enlists higher order functions 1520 to receive further instructions.

Subprogram 1410 is initiated to run concurrently with subprograms 1411, 1412. Subprogram 1410 is a low priority system which is periodically initiated when it has been determined by the internal sensory means that mirror deterioration which has occurred to a point requiring either replacement or repair of said mirror means. Subprogram 1410 entails the compensatory replacement of reflective coating to reflective surfaces the aforementioned mirror means decompensated by prolonged exposure to energic emissions. A list of coded instructions are transmitted from subprogram 1410 to element 1521. Element 1521 enacts scanning means to access the integrity of the mirror means. Decision process 1522 determines whether or not a partial or full loss of said mirrors functional integrity has occurred. If there has been either no loss or only negligible loss incurred by the mirror element then process 1523 is enlisted, wherein the status of the mirror is codeded and conveyed back to element 1520 to be acted upon by higher order functions. If however it has been determined that a significant loss of the mirror means functional integrity then deterministic processes 1524, 1526, 1528 and 1530 are enacted to access the extent of damage to said mirror element. Decision process 1524 determined whether or not 0.90 or more of the functional integrity or reflectivity remains intact, process 1525 is elected, and if not decision process 1526 is enlisted. Decision processes 1526, 1528 and 1530 determine if the functional integrity is greater or less then 0.80 of the optimum value, greater than or equal to 0.60 of the optimum value and less than or equal to 0.50 of the optimum value, respectively. The corresponding operative processes aforementioned indicate decision processes are indicated by numerals 1525, 1527, 1529 and 1530 respectively. The corresponding operative processes assess the exact amount of damage occurred by said mirror element and the required compensatory actions necessary to re-establish the units functional integrity. Processes 1525, 1527, 1529 and 1531 enter subprogram 1532. It is within subprogram 1532 wherein the quantity of reflective dielectric coating, flux and the like are volatilized by electronic processes controlled by element 1532. Deterministic process 1533 which assesses whether or not the proper proportions of reflective dielectric coating, flux and or other materials are volatilized in their proper quantities. If volatilization has not occurred so that the correct quantity of volatiles are released then clerical process 1534 is enlisted to re-evaluate the contents of the available dielectric coating flux and or other materials both volatilized and available in the various primary and secondary reservoirs, flow channels and the like. The data is regarding the status of the aforementioned materials, which are indicated by 1534 and then conveyed back to subprogram 1532. If it is determined that sufficient quantities of the said materials are volatilizible and available then preparatory process 1535 is enlisted. It is in preparatory process 1535; wherein numbers of appropriate release mechanisms solenoids and switching elements are actuated then placed on standby, as indicated by numeral 1536, until clerical process 1537 is engaged. The process embodied by clerical operation 1537 sites the various release mechanisms which are operational and engages numeral 1538; wherein the various specified release mechanisms are actuated in the proper sequence by a set of commands executed by 1538. An array of internal sensory means monitor the metered flow of reflective dielectric coating, flux and other specified materials into and out of various entry and exit ports and the like wherein said materials are ultimately discharged, as determined by process 1539. If the appropriate release mechanism has been actuated and the appropriate quantities of materials released then process 1540 is engaged; and if the appropriate quantities specified release is not monitored, clerical operation 1537 is re-enlisted.

Once the vaporized or volatilized dielectric, flux and or other materials are released a series of plating electrodes are sequentially actuated, differentially charging the surface, which is to be restored by plating or coating process. As stated earlier in the specifications the dielectric upon vaporization by induction or radiofrequency means, maybe charged and the surface to be coated may also be charged differentially along the said surfaces to assist the electroplating process. An array of electrodes are circumferentially located around the periphery of the aforementioned mirror element and are the source of the differential charging sequence. Process 1540 inacts the proper charging and discharging sequence of electrodes circumferentially disposed around the said mirror element. Determinate processes 1541, 1543, 1545 and 1547 taken in turn verify the extent to which the operative functions are restored, based on the restoration of the reflective dielectric and the like of the mirror element. The surface is divided into four quadrants and with each quadrant completed charge is differentially transferred uniformly to the next quadrant to be coated, until the process is completed. Processes 1542, 1544, 1546 and 1548 are compensatory measures taken in turn in the event the specified portions of the mirror element remains partially decompensated. Upon completion of the entire complement of quadrants, the data is sent to a compiler means to be collated, as indicated by element 1549. Data from 1549 is sent to operative process 1550, wherein a series of clerical operations are executed. Upon completion of the clerical operations executed by process 1550 preparatory process 1551 is enlisted; whereby various regulatory and compensatory processes are to be terminated. The commands for the shutdown or deactivation of the entire complement of compensatory and or regulatory systems is executed by process 1552; where upon a return is effected by element 1553 to higher order functions where new instructions will be issued.

The program format indicated by FIGS. 97 through 99 are abbreviated versions of the programming required to operate only one of a large number of equivalent automated mirror means. The exact operation of programs required to operate the above mentioned system is beyond the scope of this invention; however the programming formats disclosed in the specifications are sufficient for one skilled in the art to readily understand and appreciate the devices operation. All programming formats disclosed in the patent specifications are necessarily abbreviated for the forementioned system as are the structural variations of the various operative subsystems; also disclosed in the specifications which describes the basic embodiment of the MALKE device.

FIG. 99 discloses in part the flow diagram controlling the programming format for a single piezoelectric complement constituting a single piezoelectric focusing element. The charging/discharging sequence, coating and like processes with the exception of axial rotation are equivalent to the automated mirror means. Data enters the system through transfer point 1554 and there exist literally tens of thousands similar such transfer points leading to and from equivalent programs. The aforementioned data transmitted from transfer point 1554 is accessed by clerical operation 1555; wherein the incoming data is first catagorized then collated prior to being sent to preparatory process 1556. Preparatory process 1556 enhances and amplifies the signal transmission to be received by separate piezoelectric focusing means. Decision process 1557 verifies whether or not signals have been sufficiently catagorized and enhanced to actuate the piezoelectric elements. It is in subprogram 1558 wherein protagonist and antagonistic plates are actuated. Data from 1558 is conveyed to deterministic processes 1559, 1560 and 1561, which verify the operative status of the piezoeletric focusing means in any one of three dimensions, giving the said piezoelectric focusing means six degrees of freedom. A positive verification from 1559 enlists 1560 and a positive affirmation from 1560 enlists process 1561. Negative responses from 1559, 1560 enlist element 1562 whereas a negative response in deterministic process 1561 enlists process 1569. Course corrections for the motion of coordinates are initiated and executed in process 1562. Verification of said course corrections is indicated by decision process 1563. If a negative response is elicited by process 1563 then the clerical operation 1564 is enlisted; however if a positive response is elicited by decision process 1563 the system is placed on standby and transferred to process 1566. Operative process 1564 like decision process 1563 and inlet element 1565, wherein data is transferred and the system is placed into a standby state. Data is transferred from 1568 to subprograms 1566, 1569. Subprogram 1566 enlists process 1567, wherein data is displayed to other systems and the user 1568. Subprogram 1569 enlists higher order functions and reenters the loop at transfer point 1554. The data entering loop at transfer point 1554. The data entering from transfer point 1554 is processes along with other data and if for any reason decision process 1557 is unable to confirm sufficiency of signals then determine process 1570 is enlisted. Decision process 1570 determines whether or not insufficiency of signals are due to radiation, jamming or white noise. If white noise impedes signal transmission then filter process 1571 is engaged, and deterministic process 1572 is accessed. Deterministic process 1572 determines whether or not there are ample portions of the signal to actuate the piezoelectric means. If portions of said signal(s) are satisfactory then subprogram 1573 is enlisted; wherein data is subjected to statistical analysis based on the best fit theory. The reprocessed signal transmission reenters the loop from element 1573 to deterministic process 1557. If portions of said signal transmission are impeded or distorted due to high levels of ionizing radiation, intentional jamming or other reasons then deterministic process 1572 enlists process 1574; wherein alternate electronic and electro-optical systems nearly impervious to all forms of high levels of ionizing radiation, jamming and or EMP. The data instructions are executed by process 1575 at a much slower rate, which enlists decision process 1576. It is within decision process 1576 that the extent or percent of commands executed by process 1575 is determined. If the percent of commands executed by 1575 is deemed sufficient by process 1576 then preparatory process 1577 is engaged; in the event a negative response is enlisted then the data is conveyed to process 1579. Element 1578 designates a data compression subprogram which reprocesses the data and reenters the loop by decision process 1575 and is conveyed from transfer process 1579 reentering said loop by way of process 1562. As stated earlier unsubstantiated or unconfirmed positional data in decision process 1561 is entered into subprogram 1569 to be acted upon; however if a positive confirmation can be exacted by determinate process 1561 then data is conveyed to process 1580. Process 1580 embodies a routine and subroutine; whereby each piezoelectric focusing element of a group is continuously oscillated in a compensatory fashion to maintain the proper focusing alignment of the reflective and or deflection surface. The focusing alignment of said reflective and/or the deflection surface is determined by decision process 1581.

Positive affirmation of alignment initiates preparatory process 1583; whereas a negative response enlists process 1582 which reprocesses the data and conveys it back to subprogram 1569. Preparatory program 1583 engages process 1584 wherein the piezoelectric focusing element by which one or more energy beam incident against the position of the entire focusing complex in relation to the central axis and base of the MALKE device. Confirmation of process 1584 by decision process 1585 wherein the entire system is placed in a standby mode, 1586. If a negative response is elicited by deterministic process 1585 then preparatory process 1587; whereby a recalibration of the entire piezoelectric focusing system and auto-correlation of processes are initiated by alternate subroutines 1588, 1589 and 1590, respectively. The status of enlisted subroutines 1588, 1589 and 1590 is displayed, as indicated by numeral 1591, which then places the system on standby and flags the entire program reconveying data to subprogram 1562, via transfer element 1592.

FIG. 100 discloses in part a flow chart embodying within the programming format the method by which the magnetic levitation means assists the piezoelectric focusing element to acquire and or engage target(s). Positional data and/or commands are essentially channeled from the CPU as described by number 1593 and transferred by number 1594 through various control centers to a secondary subelectronics element, as disclosed by number 1595. The full complement of electromagnetic singlets are actuated by preparatory process 1596, which also assesses the operational status of said singlet structures. The operative status and the total number of singlet structures available are readily accessed by clerical operation 1597. The data concerning the number of available units and number of units operationally ready is ascertained by determinate process 1598, which through a complex of sensor based feedback loops interrogates separate and distinct elements of the magnetic levitation means. The operative status of the electromagnetic levitation means is displayed, as indicated by number 1599, regardless of whether or not a positive or negative response is elicited. If a positive response is elicited by decision process 1598 then data is conveyed to preparatory process 1600; however if a negative response is elicited then the existing system is bypassed and an alternative system is engaged as indicated by element 1601. Information from 1601 is conveyed to preparatory process 1602 then clerical operation 1603, which indicates the number and status of available operative elements. Process 1603 engages process 1604; wherein the energization sequence of the complements of singlets, which is equivalent in function to process 1600. Process 1604 engages deterministic process 1605, which evaluates the operative capabilities of the sequencing element. An affirmation of the operative status of said sequencing element allows the data signals to be conveyed to process 1606; whereas a negative response reconveys the data from deterministic process 1604 back to preparatory process 1596 for reprocessing. Deterministic processes 1598, 1605 upon eliciting positive response engages subprogram 1606, wherein the exact sequence of energization is tentatively set and the system(s) are placed on standby; while the program goes to a trivergent preparatory state, as indicated by elements 1607, 1608. In preparatory process 1608 the data transmission is encoded into three separate and distinct signals for three separate and distinct, but interdependent subprograms. Said subprograms are run cojointly and determine the magnetic polarity, the field strength of the magnetic field and the duration of time each singlet is to be actuated in the previously established sequence. While the field strength of electromagnetic structure is set by the electrical current flow, the polarity of each singlet structure is a direct function of electric charge or bias; and as indicated earlier the structure of the singlet element allows the magnetic fields to be concentrated or focused, rather than uniformly dispersed lines of magnetic flux running from N to S poles. Magnetic levitation is accomplished by having separate and distinct singlet and related structures exerting like fields, which repulse one another and variations such as tilt, pitch, yaw and even 360 degrees rotation result from the selective a reversal of polarity or magnetic field oscillation associated with the entire complement of singlets and related structures.

Preparatory process 1608 engages subprogram 1609 wherein the polarity of each electromagnetic structure, such as the singlet elements are determined in the magnetic levitation complement. Deterministic process 1610 accesses whether or not subprogram 1609 has been inacted. If it is determined by process 1610 that subprogram 1609 has been enacted then clerical operation 1611 is engaged and if a negative response is elicited then data signals from process 1610 is reconveyed back to preparatory process 1608 for reprocessing along with incoming signals transferred from 1609. The number of singlets and related structures, the polarity exhibited by each in a sequence and various programmed alteration of same are catagorized and are classified according to known references by clerical operation 1611. If a significant number of elements within the magnetic levitation means remain unclassified then an alternate route is chosen, whereby deterministic process 1612 selects alternate subprogram 1613; whereas a positive affirmation enlist decision process 1620. Subprogram 1613 is enlisted when a number of elements are either inoperative and/or ineffectual. It is within subprogram wherein alternate electronic routes are chosen to reach inoperative or ineffective elements of the magnetic levitation means and/or to select viable alternative singlets or related structures to replace those structures deemed inoperative or ineffectual. Once subprogram 1613 has executed its aforementioned functions, the status of each of the effected elements of said magnetic levitation means are organized and listed in turn by clerical operation 1614. The status of said elements are conveyed from clerical operation 1614 to display means 1615 and from there to determinant process 1616. Decision process 1616 verifies that the status of all primary elements of the magnetic complement which upon a positive affirmation enlists preparatory process 1619; whereas a negative response enlists process 1617 which reprocesses the information and then transfers the same said information to higher order functions, as indicated by element 1618. Preparatory process 1619 which performs statistical analysis on the data signals and reenlists process 1609. Deterministic process 1620 is enlisted by decision process 1612 if systems are classified as being operational. Deterministic process 1620 evaluates whether or not the proper polarity is exhibited by the singlet elements and if verification is established then subprogram 1624 is engaged; wherein all the instruction concerning field polarity charge bias and the frequency or oscillatory changes in polarity of each said singlet element of the levitation complement. If decision process 1620 determines that the singlets are all operational; and that if a significant number of said elements are marginally impeded or have slower than the optimum response time, then deterministic process 1621 is inacted. Deterministic process 1621 accesses whether or not the demination in response time is do to the deterioration of subelements within the structure or due to spurious signals generated by other sources or the sensor based feedback loop utilized to monitor polarity of the magnetic levitation system. If process 1621 determines that the partial loss in function is due to spurious signals then sensors are temporarily bypassed and keying operation 1623 is enlisted; which engages subprogram 1624, wherein the total complement of instructions regarding polarity are executed. If process 1621 determines that the actuating of ancillary structures servicing singlet elements are at fault, then clerical operation 1622 is enlisted; wherein alternate routines and subroutines are listed and provides a forcing function for keying operation 1623. The data from subprogram 1624 is transferred to preparatory process 1631, as indicated by element 1625.

The intensity or strength of the magnetic fields exerted by singlets and ancillary support structures is initially governed by subprogram 1616; wherein the desired charge or current applied to electromagnets and other structures is computed for the entire complement of singlet elements and the like. The computational instructions from subprogram 1626 are verified by deterministic process 1627, which upon positive confirmation process 1632 is enlisted and if a negative response is received then decision process 1628 is enlisted. Decision process 1628 determines whether or not all the aforementioned elements are actuated in accordance with the set of instructions supplied subprogram 1626. If a positive response is elicited by 1628 then preparatory process 1631 is engaged and if a negative response is elicited then preparatory process 1629 is enlisted. Preparatory process 1629 codified the data transmission and enlists subprogram 1630 for signal processing and reassignment of power transmissions to alternate singlet structures. Subprogram 1630 enlists preparatory process 1631 transfer element 1625. Process 1632 entails a subprogram which adjusts and disperses the prescribed current supplying the singlet(s) or electromagnets and ancillary structures. Decision process 1633, 1634 and 1635 are interrogation operation which serve to determine the amperage, voltage and charged biased of the current supplied to the aforementioned magnetic levitation elements. Positive responses elicited by deterministic processes 1633, 1634 which engages subprogram 1637; whereas an affirmative response from deterministic process 1635 enlisted clerical operation 1636. Clerical operation 1636 registers or lists the power of charging each singlet or electromagnet structures which are cross-referenced against the distance and angle of ascent or descent relative to the base and central axis of the MALKE device. Once clerical operation 1636 has performed its function subprogram 1637 is enlisted wherein the charging sequences, field strength focusing of magnetic fields and the like are choreographed or orchestrated with the necessary compensatory adjustment instituted in the programming to correct for unpredictable variances imposed by environmental factors. The signals transmitted from subprogram 1637 enlist preparatory process 1631. A negative response from decision process 1635 enlists deterministic process 1638, wherein a series of instruction interrogates previous programming to determine whether or not charge biasing requires oscillation from a positive to a negative electromagnetic time based or temporal fields. If a negative response is elicited by deterministic process 1638 then subprogram 1639 is engaged; where alternate commands for charge biased are issued along with new instructions for field strength and related processes. The modified instructions from subprogram 1639 are conveyed to preparatory process 1641 are transferred by 1640, which reenters the programming loop to engage preparatory process 1637. If positive confirmation of charge bias and the like is indicated by decision process 1638 then preparatory process 1641 is enlisted; wherein the transmission is redigitized and readied to undergo compression, in process 1642. Data compression is initiated in process 1642, which conveys the reprocessed transmission to element 1640, which transfers said transmission to preparatory process 1631, which then engages subprogram 1650 wherein all instructions are integrated and executed.

The temporal intervals of charging discharging, polarity and the like are specified by subprogram 1643. The dispersal patterns of time intervals to separate and distinct singlet elements, electromagnets, charging coils and the like are codified in preparatory process 1644. Codified transmissions are conveyed from preparatory process 1644 to subprogram 1645; whereby the said transmissions are disseminated to various specified or separately designated points for utilization by elements of the magnetic levitation means. Decision process 1646 evaluates the functions of subprogram 1645 and if a positive response is elicited then process 1647 is enlisted; or alternatively if a negative response is elicited then data is reconveyed back to preparatory process 1608. Subprogram 1647 institutes a variety of routines and subroutines, which provide variations in programming and enlists preparatory process 1648. Preparatory process 1648 collates and statistically ranks the routines and/or subroutines most likely to effect the optimum temporal execution time delays and the like for designated elements of the magnetic levitation means. The highest ranked routines and subroutines are those which are to optimize the overall operation of the said magnetic levitation means, as prescribed by process 1648, which engages subprogram 1649, which then selects said optimal time response. The data from 1648 reengages the programming loop at transfer point 1640, which addresses preparatory operation 1631. As indicated earlier the data transmission derived from all three subprograms 1609, 1626 and 1643 are assigned to preparatory process 1631. It is within preparatory process 1631 wherein the data from the three subprograms are collated, complexed and reprocessed prior to being sent to subprogram 1650. Subprogram 1650 entails the programming necessary to implement and execute the entire complement subprograms, routines and subroutines associated with the operation of the magnetic levitation means. Process 1650 enlists upon completion deterministic process 1651, which evaluates the extent to which all instructions or commands are executed. If it is determined by decision process 1651 that all commands have been appropriately executed then the resultant data is conveyed to a program entailing higher order functions, as described by process 1654. The higher order functions generally reassign commands, provides further instructions to the magnetic levitation system based on information obtained from other systems concerning the location of incident beams, the status of elements for the piezoelectric focusing means, the condition of the reflective or deflective surface and the operational readdress of alternative systems such as the hydraulic lift means in the event a widespread system failure is anticipated for the magnetic levitation means based on data derived from sensors monitoring the environment. A negative confirmation elicited by decision process 1651 entails that the number of non-responsive elements be listed and the extent of inoperativeness be listed by clerical operation 1652. Clerical operation enlists process 1653; wherein the necessary compensatory measure are appropriately listed prior sending the transmission to higher order functions, indicated by process 1654. FIG. 100 is represented in greater detail by FIGS. 100' to 100'''', which are equivalent to said Figure.

The full recitation of exact programming for all subsystems deployed by the MALKE device is presently beyond the scope of this patent, which entails only a simplified structural format regarding the operation of the said device. The material presented in the specifications is more than ample for one ordinarily skilled in the art to readily understand and construct an operational version of the MALKE device. The structural design, circuitry, flow diagrams, programming, formats and the like are generalizations incorporating various aspects of variations of same.

FIG. 101 is a concise partial circuit and block diagram describing in part the operation of said magnetic levitation means, which is readily understood by those skilled in the art.

The array of plasma engines, energy weapons and M.A.D. means are coupled in common to a CPU and nuclear power source. Under conditions of full engagement the operation of the aforesaid plasma engines are restricted to less than forty three percent of the total operating capacity. The remaining fifty seven percent of said operating capacity is diverted to the weapons systems previously indicated in the specifications. The aforesaid forty three percent and fifty seven percent operating capacity is consistent with mathematical modeling and computer generated graphics. The optimum expenditure in time for the distribution of power and information processing is limited to not more than forty five minutes.

Once target identification, target acquisition and pursuit of said target has been accomplished by the aforementioned vehicular device the onboard CPU must determine through expert programming the course of action to be executed by said device. Target identification is initiated with detection of said target and embodies the compilation of a target profile. The compilation of said target profile entails a high resolution scan of said target to determine the physical characteristics, the exact location, range, speed and other attributes of said target relative to the MALKE vehicular devices. It is assumed that both the aforesaid target and the aforementioned vehicular device are in a state of dynamic flux. Further the onboard CPU's expert programs must have the capacity to assess the offensive and defensive capabilities of said targets and must compute the probable outcome of engagement prior to initiating action. The type of action taken against enemy vessels essentially consists of a repertoire of behaviors embodied within six categories. Enemy targets must either be disabled, diverted, denied or destroyed in accordance with four of the aforesaid six categories. The remaining categories consist of covert operations and related processes involving surveillance. To disable any enemy vessels generally involves pinpoint attacks on specified targets, centers of armament, communications and propulsion means. The diverting of enemy resources which must be unsuccessfully expended in the pursuit and/or subsequent engagement decoys or said device is paramount to successful battle scenarios. To deny the enemy access of critical supplies, communications, or mobility greatly diminishes the enemies capacity to wage war. The very last resort is to effect destruction of either the enemy vessels and/or the personnel contained within said vessels. The destruction of enemy forces to preserve friendly forces or to secure a region for said forces is a task executed when no other viable alternative is possible. The retrival of unexpended nuclear missiles, electronics or other devices might well involve the dispersal of radiation, toxins or other substances, which only effect the vital processes of the personel aboard the targeted vessels. Covert operations includes, but are not limited to, delivery and subsequent dispersel of carrier mediated anesthetics or other substances to hostile forces in the event of kidnaping or highjacking of vessels where captives are taken; and/or other acts of terriorism; wherein said terrorist must be taken alive to undergo interrogation at a later date. Surveilance of either hostile or potentially hostile forces is of primary importance when intelligence must be gathered to determine the course of future operations. At any given time either one or all six of the aforesaid categories may overlap during the execution of actions by said vehicular device against specified targets. The foregoing equations entailing multipath tracking and targeting of objects and related algorithms describe only in part the process of targeting various processes enlisted to neutralize enemy forces.

The acquisition of targets exhibiting numerous complexed alterations in their course, also known as multipath behavior, in a high density region of equivalent or similar such objects. The assignment of sensors to targets, the allocation of internal tracking systems and the dispersal means to neutralize said targets are determined by expert programs. The amount of data retrieved by high resolution scanning elements and the consignment of computational vectors per target per microsecond is on the order of one hundred million Gigabits per second. The aforesaid data in subjected to consolidation and reduction techniques but not limited to, linear regression analysis, Baysian probalistic determination, statistical inference and/or evidential reasoning. Data assimilated during an attack scenario is further complicated by electronic counter measure ECM to $EC^{4\rightarrow n}M$ inducing false alarms, interference due to synthetic noise (jamming), or natural back ground radiation, clutter, EMP(electromagnetic pulse), cross chatter, decoying, or other means which must be eliminated either through electronic filtering and/or other processes.

A single real time frame generated by a high resolution scanning element with an average mean turn around computational time of ten milliseconds generates ten million bits of data. 360 degree scans occurring at a rate of one hundred per second of generates one billion bits of data. A full scale model version the aforesaid MALKE vehicular device will embody a minimum optimimal number one hundred high resolution scanning elements accumulating one hundred billion bits of observational data per second. Multiple target tracking (MTT) under a pitch battle scenario involves a need to partition false targets, decoys, friendly targets and the like from tracks generated by hostile targets. One method of partitioning observational data is the implementation of a multiple hypothesis tracking (MHT), in which data measurements taken at a previous time interval are compiled with incoming data to assist in the correlation of decision making processes. It is a natural progression of MHT formulation that aggregates of hypothesis are generated per a specified number of observations; however the number of hypothesis must fall within an amount which allows implementation of programs contained within said expert systems. The generation of a hypothesis tree and corresponding hypothesis matrix, as denoted in FIGS. 102, 102*a*, indicates that thirty-four hypotheses are formed from only two scans of data containing two observations per scan. Originally described by Blackman. FIGS. 103, 103*a* illustrates the effects of pruning as a means to eliminate low probability hypotheses coupled with the process of statistical combination, which consolidates tracks, also described by Blackman, FIGS. 105, 105*a* are indicative of an approach known as cluster of hypotheses a data reduction technique wherein gates of tracks falling within overlapping clusters are eliminated by mathematical association and reduced to single characteristic categories originally described by Ried and then Blackman. The basic purpose of clustering is to reduce a large tracking problem containing large volumes of observational data into smaller more manageable ones, which can be rapidly solved independently. Each cluster will have its own set of observations corresponding tracks, a hypothesis matrix and a set of probabilities and associated hypotheses. FIGS. 103*a* through 104*a* describe hypothesis matrix taken after a third scan whereas the hypothesis matrix described in FIG. 102*a* defines only two scans.

The generation of hypothesis tree as illustrated in FIG. 102 would be impractical without the implementation of data reduction techniques involving pruning, combination, clustering or other such methods. Here the term FA corresponds to all observations taken to be false alarms, NT refers to the observation which initiates track number 1 and T1 is the observation. y, (k) is the jith observation received on the scan k. Observations $y_1(1)_1$ $y_2(1)$ are either labeled as false alarms (FA) or new tracks ($NT1_1$ $NT_2$), such that after the first observation is received there are two branches generated with the following hypotheses FA: observation taken to be a false alarm;

NT1: observation initiates the new track number 1. Thereafter, the track is referred to as T1;

T1: observation associated with existing track 1.

$H_1$:$y_1(1)$=FA,$H_2$:$y_1(1)$ becomes NT1

It is possible that the first observation may be determined to be a false alarm (FA) and therefore the previous hypothesis and track return and their previous number must be adjusted for, such that, upon receipt of observation $y_2$ $(1)_1$ $H_1$ and $H_2$ become $H_1$:$y_1(1)$=FA, $y_2(1)$=FA $H_2$:$y_1(1)$=NT1, $y_2(1)$=FA.

It is assumed that a single target produces only one observation per scan and no tracks existed at this time prior to the initial observation $y_1$ (1) which can be correlated with NT1. The option that observation $y_1$ (1) initiates a new track is considered, such that, two more hypotheses are created, as described by $H_3$:$y_1(1)$=FA, $y_2(1)$=NT2

$H_4$:$y_1(1)$=NT1, $y_2(1)$=NT2.

An identical track will often appear in more than one hypothesis for example NT1 appears in both $H_2'$ and $H_4'$. If the first observation from the second data set $y_1$ (2) is determined to be a false alarm then the first four hypotheses become $H_1$:$y_1(1)$=FA,$y_2(1)$=FA,$y_1(2)$=FA $H_2$:$y_1(1)$=NT1,$y_2(1)$=FA, $y_1(2)$=FA $H_3$:$y_1(1)$=FA,$y_2(1)$=NT2, $y_1(2)$=FA $H_4$:$y_1(1)$=NT1,$y_2(1)$=NT2, $y_1(2)$=FA.

Additionally if the gating relationships are satisfied the association of $y_1$ (2) with tracks T1 and T2 will be considered. T1 is contained in previous hypotheses $H_2$, $H_4$ and two more current hypotheses linking $y_1$ (2) with $T_1$ and the subsequent inclusion of $y_1$ (2) must be redefined to be T3. T1 is further linked to $y_2$ (2), such that the next two current hypothesis are $H_5$: $y_1(1)$=NT1, $y_2(1)$=FA, $y_1(2)\rightarrow$T1=T3

$H_6$: $y_1(1)$=NT1, $y_2(1)$=NT2, $y_1(2)\rightarrow$T1=T3.

Equivalently, for the two options $y_1$ (2) is assigned to T2, such that $H_7$: $y_1(1)$=FA, $y_2(1)$=NT2, $y_1(2)\rightarrow$T2=T4

$H_8$: $y_1(1)$=NT1, $y_2(1)$=NT2, $y_1(2)\Delta$T2=T4

The hypotheses associated with the new track options are described by $H_9$: $y_1(1)$=FA, $y_2(1)$=FA, $y_1(2)$=NT5

$H_{10}$: $y_1(1)$=NT1, $y_2(1)$=FA, $y_1(2)$=NT5

$H_{11}$: $y_1(1)$=FA, $y_2(1)$=NT2, $y_1(2)$=NT5

$H_{12}$: $y_1(1)$=NT1, $y_2(1)$=NT2, $y_1(2)$=NT5

Eight tracks containing a maximium number of two component observations, which are defined herein below within brackets, such that, <u>One Point Tracks</u>

$$T1 = y_1(1),\ T2 = y_2(1) \qquad \text{(i)}$$
$$T5 = y_1(2),\ T8 = y_2(2)$$

<u>Two Point Tracks</u>

$$T3 = [y_1(1), y_1(2)],\ T4 = [y_2(1), y_1(2)] \qquad \text{(ii)}$$
$$T6 = [y_1(1), y_2(2)],\ T7 = [y_2(1), y_2(2)]$$

The process continuous with observations $y_2$ (2) resulting in the generator of 34 hypotheses, as indicated by the hypothesis tree and corresponding hypothesis matrix described in FIGS. 102, 102*a* The aforementioned matrix table and hypothesis tree serve to illustrate the accelerated rate at which hypotheses are incurred or generated. Reid and others have estimated that with the addition of another data set emboding two observations to the hypothesis tree and corresponding to tabular hypothesis matrix described in FIG. 102 that in excess of five hundred, hypotheses would be generated. The number of tracks generated per scan exceed ten orders of magnitude when data scans occurs at a rate of one every ten milliseconds. The need to consolidate and reduce the number of hypotheses by ranking, pruning, combining or clustering is paramont to the overall operation of the vehicular device.

Alternately ranking hypothesis based on simularities of state estimates and covariance quantities as for example a bases of comparing target track A of one hypothesis with target B of another hypothesis, such that, $$|x_{Ai} - x_{Bi}| \leqq \beta \sqrt{p_{Aii} + p_{Bii}}$$

and $$p_{Aii} < \gamma p_{Bii}, p_{Bii} < \gamma p_{Aii}$$

whereby i is indexed over all estimation states with B=0.1 and v=2.0. If it is determined by the program that the hypotheses can be combined then each track-pair can be combined by implementing the following formulas, $$x = \frac{p_1 x_A + p_2 x_B}{p_1 + p_2}$$

with covariance matrix P expressed by, $$P = \frac{p_1 P_A + p_2 P_B + \frac{p_1 p_2}{p_1 + p_2}(x_A - x_B)(x_A - x_B)^T}{p_1 + p_2}$$

where $P_1$ and $P_2$ refer to the probabilities associated with the aforesaid hypotheses being combined with one another. The probability associated with the combined hypothesis (Pc) becomes the sum of the probabilities of similar hypotheses described by the expression ($Pc = P_1 + P_2$).

FIGS. 103, 103*a* illustrate the effects of both pruning and combining hypotheses and clustering of said hypotheses based on the teaching of Breckman, Reid and others. The combination of tracks utilizing the N-scan criterion or similarity test as a basis of combining hypotheses is illustrated by illustration A of FIG. 103. The probability of one hypothesis that is to be retained is agumented by the probabilities of similar or equivalent deleted hypotheses. Data points $y_1$ (2) and $y_2$ (2) each fall within the validation gates of the tracks initiated on the previous scan. It is assumed that a low probability of false alarm; which appears to be weighted, such that, hypotheses $H_{15}$ and $H_{20}$, each of which embodies two, two point tracks that survives pruning. Virtually all hypotheses are deleted with the exception of $H_{15}$, $H_{20}$, and all enters are equivalent except those entries following below data points $y_1$ (1) and $y_2$ (1) which are associated T1 and T2, respectively. Illustration A of FIG. 103 indicates that tracks T3, T4, T6, T7 and the corresponding remaining predicted positions P3, P4, P6 and P7. Illustration B of FIG. 104 describes the hypothetical regions of validation associated with the aforesaid predicted position of said tracks for the interval of time corresponding to the next scan. Data point $y_1$ (3) is in close proximity to predicated position P6 of track T6 to form T9, and is assumed to survive pruning; whereas $y_2$ (3) is not close to P4. Track T9 is included in all three aforesaid hypotheses and is removed from said hypotheses to form a new cluster, as indicated in the table of reduced hypotheses matrix taken after the third scan. Track T9 is described by the following relation, $$T9 = [y_1(1), y_2(2), y_1(3)]$$

Track T9 initiates a new cluster with a single hypothesis which is valid because none of the observations contained within T9 are embodied within the three hypotheses remaining in the previous cluster, as indicated herein below, $H_1$: $T4 = [y_2(1), y_1(2)], y_2(3) = FA$ $H_2$: $T11 = [y_2(1), y_1(2), y_2(3)]$ $H_3$: $T4 = [y_2(1), y_1(2)], y_2(3) = NT12.$ The above hypotheses where described in illustration A of FIG. 103 and denotes the simplest case of targets passing by one another while heading in separate directions. New clusters are initiated any time an observation does not fall within the gates of previous tracks contained within existing clusters. When the observations fall within the gates of two tracks from different clusters, the said clusters are combined or merged prior to processing with the observations forming a super-cluster. The set of tracks and observations of said upper-cluster is the sum of those in prior clusters. Additionally when an observation falls within the gates of two or more tracks originating within two different clusters, said clusters are merged such that, the merging is completed prior to the observation being processed. Further, the number of hypotheses is a new super-cluster is the product of the number of hypotheses in prior clusters and the associated probability are products of the prior probabilities.

Another method for assessing observational data referred as to ALL Neighbors Data Association ANDA combines the hypotheses accumulated after each scan before the next scan is processed. ANDA first proposed by Bar-Shalom and Tse includes the methods of probabilistic data association PDA which leads to a modified tracking filter known as PDAF and a special case of that MHT method called JPDA. The JPDA and or PDA method is geared to access target track input so the probabilities are computed on the bases of previously established tracks in contrast to the MHT method in which options are computed for the measurements. The PDA method establishes the presence of target tracks in the presences of extraneous signals generated by clutter multiple image subposition or various returns which undergo distortion. Breckman has product the following problem which effectively explicates the PDA method. The probability of detection PD and the gate is determined to be large enough so that the target return when present will fall within the track gate PG, such that, $P_G \cong 1.0$. It is additionally assumed that the extraneous return density to be Poisson with density B, which includes new targets and false returns described by the expression, $$\beta = \beta NT + \beta FT.$$

Given N observations taken within the gate of track i, the initial condition $H_2$ where none of the observations are valid with N+1 hypotheses formed, the probability of Ho is proportional to p';o, where, $$p'_{10}=\beta^N(1-P_D)$$

Equivalently the probability of hypothesis Hj (j 1,2, . . . , N) the observation j is the valid return which is proportional to $$p'_{ij}=\frac{\beta^{N-1}P_D e^{-\frac{d_{ij}}{2}}}{(2\pi)^{M2}\sqrt{|S_1|}},\ j=1,2,\ldots,N$$

and the probabilistic Pij associated with the N+1 hypotheses are computed through the normalization equation $$pij=\frac{p'_{ij}}{\sum_{1=0}^{N} pij}$$

The factor $B^{N-1}$ cancels during the normalization process and therefore the expression is excluded from the computation of Pij, which upon simplification reduces to $$pij=\begin{cases}\dfrac{h}{b+\sum_{i=1}^{N}\alpha i1}, & j=0\text{(no valid observation)}\\[2ex] \dfrac{\alpha ij}{b+\sum_{i=1}^{N}\alpha i1}, & 1\leqq j\leqq N\end{cases}$$

where $$b=(1-P_D)\beta(2\pi)^{M/2}\sqrt{|S_i|}$$

$$\alpha ij=P_D e^{-\frac{\alpha_{ij}^2}{2}}$$

Based on the works of Bar-Shalom and Tse the hypotheses are merged where a weighted sum of residuals undergo Kalman filtering associated with the N observations, such that, $$\tilde{y}_i(k)=\sum_{j=1}^{N} p_{ij}\tilde{y}_{ij}(k)$$

where
$\tilde{y}_{ij}(k)=yi(k)-H\hat{x}i(k|k-1)$
$yj(k)$ = observation $j$ received at scan $k$ Upon Kalman filtering updates the subscript i denoting track i is omitted, such that $$\hat{x}(k|k)=\hat{x}(k|k-1)+K(k)\tilde{y}(k)$$

with the gain, K(k), and the covariance derived from scan k is modified in accordance to equation $$P(k|k)=p^o(k|k)+dP(k)$$

where P (K|K) is the Kalman covariance that would be computed for a single return were present and dP(k) is an increment added to indicate the effect of uncertain correlation. Equations defining po(K|K) and dP(K) are described by expression $$P^o(k|k)=p_{i0}P(k|k-1)+(1-p_{i0})P^*(k|k)$$

$$dP(k)=K(k)\left[\sum_{i=1}^{N} p_{ij}\tilde{y}_{ij}\tilde{y}_{ij}^T-\tilde{y}_i\tilde{y}_i^T\right]K^T(k)$$

with P*(K1K) being the Kalman covariance, such that, $$P^*(k|k)=[I-K(k)H]P(k|k-1)$$

The term dP(k) increases the covariance to the observations embodied within the track gate and the a posteriori probabilities upon combination of equations, $$\tilde{y}_i(k)=\sum_{j=1}^{N} p_{ij}\tilde{y}_{ij}(k)$$

where $$\tilde{y}_{ij}(k)=y_j(k)-H\hat{x}_i(k|k-1)$$

$y_j(k)$ = observation $j$ received at scan $k$ $$P^o(k|k)\ p_{i0}P(k|k-1)+(1-p_{i0})P^*(k|k)$$

$$dP(k)=K(k)\left[\sum_{i=1}^{N} p_{ij}\tilde{y}_{ij}\tilde{y}_{ij}^T-\tilde{y}_i\tilde{y}_i^T\right]K^T(k)$$

and deleting of subscript i for track i, such that, $$\tilde{y}=p_1\tilde{y}_1$$
$$dP(k)=K[p_1\tilde{y}_1\tilde{y}_1^T-\tilde{y}\tilde{y}^T]\,K^T=p_1(1-p_1)\,K\tilde{y}_1\tilde{y}_1^TK^T$$

which gives a maximum correction for uncertainty where the probability that the observation P1 equals 0.5 and if two measurement are in the gate, such that P1=P2=0.5, Po=0, the covariance correction term becomes, $$dP=0.25\ K(\tilde{y}_1-\tilde{y}_2)(\tilde{y}_1-\tilde{y}_2)^TK^T,$$

The JPDA method will be discussed presently because of its application in sonar and other surveillance systems. The JPDA method is equivalent to the PDA technique with the exception that the association probabilities are computed using the full complement of tracks and observations. The probability computation of $$\frac{b}{b+\sum_{i=1}^{N}\alpha_{ij}},\ \frac{\alpha_{ij}}{b+\sum_{i=1}^{N}\alpha_{ij}},$$

or Pij. must be extended to include multiple tracks in which multiple observations fall within the validation gate of said track as described by Breckman in illustration A of FIG. 105. Illustration A of FIG. 105 discloses three observations O1, O2, and O3 inscribed within the gate of predicted position P1 of track T1; whereas O2 and O3 fall within gate of track T2. Here the JPDA method computes weighted residual for T1 based on the previous aforesaid observations; however the weights for O2, O3 are reduced and the residual for T2 will be formed using O2, O3. The basic difference between the hypothesis matrix previously described and the JDPA approach is that said approach is target orientated emphasizing hypothetical alternative to target tracks. The corresponding table B of FIG. 105*a*, also formulated by Breckman describes the associated hypothesis probabilities. The numbers assigned to the tracks, such that, the numeral 0 represent represents a null assignment or no observations to a given track and gij refers to the Gaussian likely function associated with the assignment observation j to track i. The aforesaid table illustrates the structure for computing the hypothesis probabilities $PH_1$ and No, NT are assigned to the number of observations and tracks that denote certain common factors which may appear in P' H1. Given the common factor $B^{(No-NT)}$ when No>NT: whereas the common factor is $1-PD^{(NT-No)}$ if NT>No. The probability of detection PD is direct, the probabilities PH1 are normalized and computed in a standard manner where NH is the total number of hypotheses, such that, $$P(H_1) = \frac{P(H_1)}{\sum_{i=1}^{N_H} P(H_1)}.$$

illustrates A of FIG. 105 exhibits a two dimensional measurement in which, $$M = 2, \sqrt{|S_1|} = \sigma_{\bar{x}}\,\sigma_{\bar{y}}$$

and with numerical values $$\sigma_{\bar{x}} = \sigma_{\bar{y}} = 1, \beta = 0.03, P_D = 0.7$$

$$d_{11}^2 = 1, d_{12}^2 = 2, d_{13}^2 = 4$$

$$d_{22}^2 = 2.5, d_{23}^2 = 3.$$

Table B of FIG. 105*a* lists the probabilities associated with the hypotheses. The observation j is optimally assigned to track i to compute the probability Pij and the sum is to be taken over said probabilities from said hypotheses in which the assignment occurs, such that, probabilities, $$p_{10} = P(H_1) + P(H_5) + P(H_8) = 0.011 + 0.041 + 0.032 = 0.084$$
$$p_{11} = P(H_2) + P(H_6) + P(H_9) = 0.086 + 0.306 + 0.239 = 0.631$$
$$p_{12} = P(H_3) + P(H_{10}) = 0.053 + 0.145 = 0.198$$
$$p_{13} = P(H_4) + P(H_7) = 0.019 + 0.068 = 0.087$$

for track 1 and $$p_{20} = P(H_1) + P(H_2) + P(H_3) + P(H_4) = 0.169$$
$$p_{21} = 0$$
$$p_{22} = P(H_5) + P(H_6) + P(H_7) = 0.415$$
$$p_{23} = P(H_8) + P(H_9) + P(H_{10}) = 0.416$$

for track 2. The expected heavily weighted events are computed to be the assignment of O1 through T1 and O2 or O3 through T2. The associated probability is taken to be zero in the case of $P_{21}$ if said observation does not fall within the gate of a given track just as j; o indicates null condition or no assignment.

The conformation of multiple targets within the contexts of the MTT theory is more precisely accomplished with the implementation of a system deploying an array of sensory elements, as described in FIG. 106. The use of multiple sensors requires the compilation, correlation, identification and subsequent analyses of data from different types of sensory means in order to procure target identification. Programs emboding statistical formats collate and rank data regarding target attributes including but not limited to characteristic acoustical infra-red and radar emissions discerning the size, shape, range, speed and other properties associated with targets. Additionally kinetmatic attributes such as relative position, range, speed, et center can be reduced to steady state variable vectors under condition of dynamic flux when said attributes are correlated with other data concerning the disposition of targets. The primary application of the Denpster-Shafer method also known as evidential reasoning readily links itself to multiple sensor data where the miscorrelation and/or uncertainty exists in the identification of targets. Attribute data is used directly in the correlation process to identify targets. Sensors allocated for tracking targets have their own separate and distinct track files. Tracks embodied within said track files are established on the basis of measurements received from the individual sensors which are implemented by data exchanged between said data sensors and the central track file, which continuously updates said track file of the sensor level tracking means, enabling said central track file to form a synergistic composite.

The advantages of said sensor level tracking means are a reduction in data-bus loading, a reduction in computational loading and a probability of surviving degradation due to the distribution of tracking capabilities. Multiple sensors convey different data and data containing redundant information to be processed. There is communication between sensors and between the sensor elements and the central track file which is utilized to update sensor level track files when deploying the multi sensor fusion technique wherein the central level tracks are updated with sensor level track data and the multiple hypotheses tracking approach is integrated at the central level when said sensor level tracks data are combined in order to minimize the problem of uncorrelated measurement error, inaccuracies in tracking, false correlation in regions effected by clutter, false image patterns and the degradation of data incurred by electronic counter measures and less frequent scans. Central level tracking enhance continuously and track confirmation. Different types of sensor elements will under dynamic conditions exhibit different thresholds, levels of resolution or abilities to identify, confirm and sustain tracks. The implementation of data detected by different types of sensors allocated for each track greatly increase the probability of track acquisition and survaliance for a given sensor. Radar sensors even in a phased array may loose a track when subjected to clutter, glutches or fading in a return of signals due to radar cross-section scintillation which would otherwise be retained by an infra-red (CCD), acoustical signals processed by differential sonar scanners. The synergistic interaction of different sensors optimizes the tracking process and air born objects are more accurately assessed by radar in regards to range, absolute distances and structural configuration, whereas high resolution acoustics determines sounds attributes associated with targets and infra-detection yields more accurate measurements in angle or identify specific heat structures. The overall real time required to acquire, track and correlate target signatures is diminished by as much as four orders of magnetude by track to track correlation and combining sensor level tracks which essentially identify the same target.

Different, types of sensory elements can be adjusted to maintain different state estimation vectors, such that, there exists a difference in the covariance matrices reducing the time necessary to make calculations when using state estimates and corresponding covariance elements common to multiple sensors. The Wiener and Bar-Shalom describe a method by which the chi-square properties of the difference in the state estimation vectors xi, xy for recent estimates at arbitrary scan k, such that tracks which are not updated within the same interval of time are extrapolated to some common joint. Two tracks are taken at scan k, yield state vector estimates and covariance matrices, track i: $x_i(k)$, $P_i(k)$ track j: $x_j(k)$, $P_j(k)$.

The difference vector diy formed at scan k gives common state estimates, $$d_{ij}=\hat{x}_i-\hat{x}_j$$

where subscript k is omitted.

If said tracks are independent, the covariance matrix Uij for dij is defined by, $$U_{ij}=P_i+P_j$$

with Gaussian distribution, $$R^2=d^t_{ij}\,U^{-1}_{ij}d_{ij}$$

will have the chi-square, $X^2n$, with the number of degrees of freedom, n, equal to the number of elements in the state vectors. Periodic tests to accept or reject the hypothesis that two tracks are derived from the same source are defined by similarity threshold Ts, such that, $R^2 \geqq Ts$, tracks are not from the same source $R^2 < Ts$, tracks are from the same source, which is based on the chi-square properties of $R^2$ requiring experimentation and optimally choosen as a function of target density. The resultant formulation of $R^2$ is not entirely valid because of error correlation between the sensor estimates. Said error correlation in accordance with Bar-Shalom modifies covariance matrix Vij. The cross covariance matrix Pij is defined by the initial correlation, such that for $K>0$ values of Pij $(K|K)$ are calculated based on recursive relationship, $$P_{ij}(k|k) = A_i(k)B(k-1)A_j^T(k)$$

where, $$A_i(k) = I - K_i(k)H_i$$

$$A_j(k) = I - K_j(k)H_j$$

$$B(k-1) = \Phi_i P_{ij}(k-1|k-1)\Phi_j^T + Q(k-1).$$

The subscripts i, j refers to sensor system i, j, whereas Φ, K, H, and Q defines Kalman filtering elements. Substituting the modified covariance describes previous yields, $$U_{ij}=P_i+P_j-P_{ij}-P^T_{ij}.$$

Tracks determined to originate from the same source are combined into a single vector, which minimizes the expected error, such that, $$x_c=x_i+C[x_j-x_i]$$

$$C=[P_i-p_{ij}]U^{-1}_{ij}$$

and the covariance matrix associated with the estimate of the previous equation yield, $$P_c=P_i-[P_i-P_{ij}]U^{-1}_{ij}[P_i-P_{ij}]^T.$$

The correlation of sensor-level tracks into central-level tracks form new state estimates as indicated in FIG. 106 involves the same type of logic involved in the observation to track correlation discused previously in regards to elements contained within said Figure. Sensor-level tracks are extra polated to some common fusion time point then the central or global track file is initalized with the track file from the most accurate sensor means which has the highest resolution, the lowest absolute threshold and the lowest detection error ratio of any of the aforesaid sensory means the track files from the other sensors are correlated one at a time with the central-level tracks and new state estimate formulated, as indicated in the flow chart discloses in FIG. 107. If the correlation of sensor-level tracks obtained from different sensory means are taken in repetition and the gating criteria are satisfied, then potential correlation between sensor-level tracks that have been rejected in the past need not be reconsidered saving time.

Data output tracks are accumulated in the output central file which accumulates data in attribute generator means. Radar doppler signitures describing the target profile the infra-red signiture designated the mean radiance or thermal re-emission of said targets, acoustic emissions of specific engines, motorized units or sonar profiles derived from said targets forming target types. It is necessary to maintain attribute and target type estimates in the event one or more attributes are assigned to more than one target type. Certain sensor-level data processors directly converts measured attributes into target type specifically those detecting analog signals emitted from targets, such as those optical and electronic elements, which detect chemical species emitted from said targets. It is obvious that there is no need to include attribute and target type information in the overall correlation and target identification process. Track files will contain estimated probabilities for attributes and target types with the initial values given by a priori probabilities which are updated by post priori observations.

The general Bayesian structure of discrete quantities and statistical inference methods leads itself most readily to solve the problem of estimating attributes and target types. The measurement process for attribute estimation updates are defined by the relationship.

$P(X_m|X)$ = probability of receiving measurement $X_m$ given that the true quantity is $X$.

Upon receiving data the aforesaid updated can be computed on the basis of Bages rule where $$P(X|X_m) = \frac{P(X_m|X)P(X)}{P(X_m)}$$

and $P(X)$ = prior probability associated with $X$ $$P(X_m) = \sum_N P(X_m|X)P(X)$$

such that, P (X|Xm) becomes the new prior probability upon receiving additional data. The previous equation provides a method by which the estimated probabilities of target type and attribute classes or states can be asertained based directly on the measurements Xm.

The accumulation of attribute data assists the estimation of the target type and excludes certain alternatives, The relationships between expected attributes and target types by the implementation of present data with prior accumulated data is defined by matrix M (B|A), such that, $$M(B|A)_{ij} = P(b_j|a_i) =$$

conditional probability of attribute $b_j$ given target type $a_i$

Pearl teaches a special case of inference where the parent node A refers to a target type with state ai, the descendents are indicated by B, C with state bj and cj, respectively; are denoted sibling elements and are related through said parent node, such that $$P(b_j, c_i|a_j) = P(b_j|a_i)\, P(c_i|a_j).$$

Additionally, the probability of attribute bj is represented by the product of two terms and a normalizing constant αB in the expression $$P(bj) = \alpha_s\, \lambda(b_j) q(bj)$$

where $$\lambda(bj) = P(B_m|bj)$$

$$q(bj) = P(bj|D^u(B))$$

$B_m$ = set of direct measurements on attribute $B$ $D^u(B)$ = data entering the estimate of $B$ from above.

The above equation indicates that the probability associated with bj is the product of the term based upon the direct measurement, Bm of B described by Λ ($b_j$) and indirect term $D^u$(B). Term $D^u$ (B) includes data goes into the estimation of A based on prior information on A, which is based on the direct measurement of A and indirect measurements on A using attributes C, D, et certain, other than B. The indirect term is defined by $$q(bj) = \sum_i \left[ \frac{P(bj|ai)P(ai)}{r(B \rightarrow ai)} \right]$$

where r(B→a,) is the contribution from an estimate of B to the attribute data. Kinematic data and attribute data are combined and correlated with observation of existing tracks or initiate new tracks. The a posteriori probability of measured kinematic data is described by the expression, $$f(y) = \frac{e^{\frac{d2}{2}}}{(2\pi)^{M2}\sqrt{|S|}}$$

where $$d^2 = \bar{y}^T S^{-1} \bar{y}$$

$\bar{y}$ = residual vector (difference between predicted and measured quantities)

$S$ = residual covariance matrix $|S|$ = determinant of $S$ $M$ = measurement dimension.

Upon implementation the generalized a posteriori probability associated with kinematic data y and attribute data Zm becomes $$f(\bar{y}, Z_m) = \frac{e^{\frac{d2}{2}}}{(2\pi)^{M2}\sqrt{|S|}} P(Z_m|D_p),$$

where P(Zm/Dp) or its logarithm can be utilized in the multiple tree hypothesis.

Validity assessment, identity declaration eventually enter higher logic functions as operators within kernels associated with multiple task operations as disclosed in FIG. 106. Dempster and Shafer teach a method of evidential reasoning applicable when combining data by multiple sensors so that data is more accurate and more convient, lowering the level of uncertainty in determining whether or not a target is a friend, foe or neutral. The implementation of evidental reasoning is examplified by the set of n mutually exclusive and detailed proposition for target type $t_1, t_2 \ldots, t_n$ having assigned probability mass, $m(t_1)$, to any of the original propositions or disjunctions of said propositions. A disjunction is described as the proposition that a target is of the type $t_1$, $t_2$ which is also expressed as $t_1 V t_2$). Additionally there are $2^n - 1$ general propositions emboding all possible disjunctions assigned masses and said masses which are summed over the entire complement of said propositions must equal unity. The uncertainity mΦ is a mass assignment to the disjunction of the entire complement of the original propositions described by the expression, $$m(\theta) = m(a_1 v a_2 v \ldots v a_n).$$

The aforesaid masses can be assigned to the negation of propositions, such that, the mass assigned to the negation of $t_1$ is described by, $$m(\bar{a}_1) = m(a_2 v a_3 v \ldots v a_n).$$

The support for a given proposition is the sum of the full complement of masses assigned directly to said proposition. The support spt ($t_1$) for the basic proposition $t_1$ is the mass associated with $t_1$ (spt($t_1$) m($t_1$)). More complexed propositions where the target is either $t_1$, $t_2$ or $t_3$ the following expression is utilized to make the determination is described herein below, $$spt(a_2 v a_2 v a_3) = m(a_1) + m(a_2) + m(a_3) + m(a_1 v a_2) + \cdot m(a_2 v a_3) + m(a_2 v a_3) + m(a_1 v a_2 v a_3).$$

The plausibility of a given proposition is the sum of all mass not assigned to its negation, such that, $$pls(a_i)=1\ spt(\bar{a}_i).$$

Alternately, pls ($t_1$) can be computed for all masses associated with ai and all disjunctions, including $\theta$, that contain ai $$pls(a_1)=m(a_1)+m(a_1va_2)+\ldots+m(\theta).$$

The plausibility of $t_i$ defines the mass that is free to move the support $t_i$ and the interval [spt($t_i$) pls($t_i$)] represents the uncertainity interval with an arbitrary ignorance factor of [0,1] and a certain probability of 0.6, [0.6, 0.6]. Sensor resources are allocated on the basis of high probabilities that targets are a certain type alluding to geometric designs, inherent lethality or level of threat and the established kinematic parameters, such as the range, distance, velocity and the time required before reaching the lethal radius of said target. The CPU additionally functions to refine the sensitivity of the sensor and is based on the expected gain in utility allocating said sensors to given track which is found by comparing the utility of the expected state of knowledge before and after sensor allocation. Said utility is expressed by U(Q) where $Q=\sigma_x/\sigma xD$ and $\sigma x/\sigma xD$ is the ratio of the true estimation-error standard deviation of $\sigma x$ to the estimation-error standard deviation, $\sigma xD$.

The marginal or expected utility for track update with a specified sensor is estimated by the expression, $$U_0=MAX[P_TU_D,(1-P_T)U_{ND}]$$

said marginal utility is optimaly weighted by the probability of detection $P_D$. The term $U_D$ utility associated with declaring target presence when the target is determined to be present; whereas $U_{WD}$ is the utility associated with correctly declaring the target to be absent. The probability that a sensor will report a target to be present is described herein below:

$$P(\bar{R})=P(R|T)P_T+P(R|T)(1-P_T)$$

and $$P(R)=1-P(R)$$

where

P(T|R)=probability of target presence given a potential sensor report of target presence P(T|$\bar{R}$)=probability of target presence given a potential sensor report that the target is not present P(R|T)=conditional probability that the sensor will report target presence given that it is present R(R|$\bar{T}$)=conditional probability that the sensor will report the target present when it is not Similar definitions hold for the terms P($\bar{R}$|T), P($\bar{R}$|$\bar{T}$), P($\bar{T}$|R), and P($\bar{T}$|$\bar{R}$).

The a posteriori probabilities of target presence is conditional upon the events that said reports are to be presently described by R, such that, $$P(T|R)=\frac{P(R|T)P_T}{P(R)},\ P(T|\bar{R})=\frac{P(\bar{R}|T)P_T}{P(\bar{R})}.$$

The expected utility after sensor allocation is averaged over the events that said sensor report target present R and absent R. The terms $U_{SR}$ and $U_{SR}$ are the expected utilities after sensor detection for the aforesaid events, such that, $$U_{SR}=MAX[P(T|R)U_D,\ P(\bar{T}|R)U_{NP}]$$

$$U_{SR}=MAX[P(T''R)U_D,\ P(\bar{T}|R)U_{NP}].$$

The averaging over said sensor events the expected utility after sensor allocation is $$U_S=P(R)U_{SR}+P(\bar{R})U_{SR}$$

where the marginal utility is defined by $U_s-U_o$.

The CPU increases or decreases the sensitivity of various said sensor elements and assigns or reassigns separate sensory elements in the acquistion of targets. Data obtained from the CPU additionally supplements incoming data in order to either interpolute back to specified targets origin and/or extrapolates future positions of said targets based on previous tracks. It is believed that the entire complement of compartments described in FIG. 107 are readily understandable to those skilled in the art when taken in conjunction with the equations or variation of said equations defined previously in the specicatiions.

FIG. 107 represents a modified high level flow chart of the multiple hypotheses track algorithm described in the previous figure. FIG. 107 summarizes the processes enabling target acquisition, evaluation and pursuit of said target. The elements of the aforesaid flow chart are straight forward and therefore do not require further explination for one skilled in the art.

In the full battle scenario utilization the nearest neighbor correlation algorithms and other techniques lead to high frequencies of miscorrelation, target error and track instability. The amount of miscorrelation, target error and track instibility are significantly reduced. The number of hypotheses are limited by the processes of combination, pruning and other data reduction techniques involving statistical inference. The implementation of MHT is disclosed in FIG. 107 is for the sake of simplicity limited to a operation within a single cluster rather than multiple clusters.

FIGS. 108 through 108*d* exemplifies in detail the design and structure and the method by which interactive programs embodied within expert programs are encoded within the CPU and microprocessor elements contained within the CPU and microprocessor elements of the MALKE device and ancillary systems. The typical program contains a preamble identifying terms, the procedures to be conducted forming the methodology and the specifications of functions, factors, subterms and the like which are operated upon during the execution of a given program. Regardless of the number of subprograms nested within a main or primary program or the complexity of routines and subroutines encapsulated within said subprograms the structure and design features presented in the above-mentioned figures remain consistant with those embodied within the CPU and auxiliary structures of the MALKE device.

FIGS. 109, 109' denotes a concise program illustrating one type of syntex language and structure which assists in the implementation of interactive programs embodied within expert programs described in FIG. 108 through 108*d*. Here the data entering the program keys the actuation of the main program, which is preceded by the target acquisition process. The said program is arbitrary and must consider in an exemplary manner rather than in a limiting sense. Additionally, the foregoing exemplary algorithms, programs and related matter presented in the specifications should be considered language non-specific, which is the rational for presenting some programs in fortran, pascal, or other languages. The CPU is meant to be user specific and user compatable, once the initial code sequence is keyed to unlock and actuate the aforesaid MALKE device.

FIG. 110 entails a comparison of continuous time and discrete transforms. The type of mathematical formulas depicted in FIG. 110 are exemplary of those equations used in algorithms to analyze data retrieved from sensors during the target acquisition process and related processes. The convolution property of DFT when combined with the input segmentation into blocks of length $-N$ is known as fast convolution which is the optimium method to implement long or continuous input signals, medium length filters and extended temporal multiplication or addition processes. Circular convolutions are used to compute the linear convolution if a signal filter M and a block with signal length B such that the input signal is segmented into length B non-overlapping blocks and the output overlap is implemented with a process known as the output add method yielding a circular convolution of length $L=M+B-1$ for each input segments. If the complete input signal is segmented into K length $-B$ block then the time necessary to compute a fast convolution is described by $$T_{fast}=T_{fft}+2KT_{fft}+KLT_{aux}$$

whereby $T_{fft}$ is the time required for a length L-FFT and Taux is the time required for auxiliary calculations and corresponds to the time required for point by point frequency domain multiplications. The term $2KT_{fft}$ is indicative of the forward transforms of said blocks and the inverse transform of the product of the data transforms and the filter transforms; whereas K represents the point by point multiplications of transform values and auxiliary overlap-add circulations. The most efficient form of FFT uses dimensions of equivalent lengths and said lengths is known as the radix of the algorithm. The DFT of length N is related to the radix R by the equation $N=R^M$; wherein each radix has a length R and M describes the number of dimensions.

FIG. 111, 111*a* describe in detail the autocorrelation for continuous signals emitted or otherwise acquired from designated targets. Said figures consists of a modified block diagram describing signal acquisition, a diagram of signal processing and equations describing in detail the operation of the autocorrelation process. Functions of autocorreoation are performed on data signals during the process of signal enhancement, filtering and various techniques associated with repetition of signals allowing the implementation of data reduction processes.

FIGS. 112, 112*a* illustrates a concise exemplary program for calculating the standard deviation and variance and concise mathematical formulas contained within said program responsible for the implementation of said program. The program and corresponding assemblage of mathematical formulas which are responsible for algorithms embodied within programs calculating standard deviations for target acquisition, warheads assignment to said targets and choosing the means of neutralization of said targets. The calculations of standard deviation implements the catagorization traits exhibited by designated targets and provides an alternate approach to probabilistic analysis of targeting.

FIGS. 113, 113*a* describe a well known program by which data accumulated during the acquisition process for designated targets can be identified upon the application of data reduction techniques to said data placed within the guidelines of a second order curve fit. Second order linear approximations are made of target attributes exhibiting complex behavior patterns forming third, fourth, or higher order equations. The aforesaid program and implementation of said program accomplishes the function as the mathematical implementation of the Best Fit Method.

FIG. 114 through 114*b* describe in concise detail the three stages by which a single digitized signal emitted by a designated target is isolated by comparison and repetition and subjected to data reduction techniques. A single digitized signal obtained from a given designated target is isolated upon identification. Target acquisition embodies target pursuit, target tracking and ancillary processes, requiring a scanning rate in excess of ten hits per second. The greater the scanning rate the higher the frequency or repetition rate per second, which is an arbitrary interval of time. Equivalent or repetitive digitized signals of equivalent targets necessarily occur directly as a function of time and it is advantageous to reduce the size of a given sample in order to avoid overloading logic circuit and comparator elements responsible for the acquisition process. If signals obtained from designated targets are repetitive and equivalent then said data is digitized and digital values representing only a fraction of the attributes are exhibited by a single designated target after said target has been initially identified; thereby reducing the data and computational time needed for target reduction.

FIGS. 115 through 115*b* are pictorial representations of the data reduction process obtained within a single optical field element of the said MALKE device. The number of optical fields generated per a one second interval of time can range between $10^4$ to in excess of $10^9$ bytes per second. The narrowing of an optical field is but another example of data reduction, which was illustrated in FIG. 114.

Figure 115C:
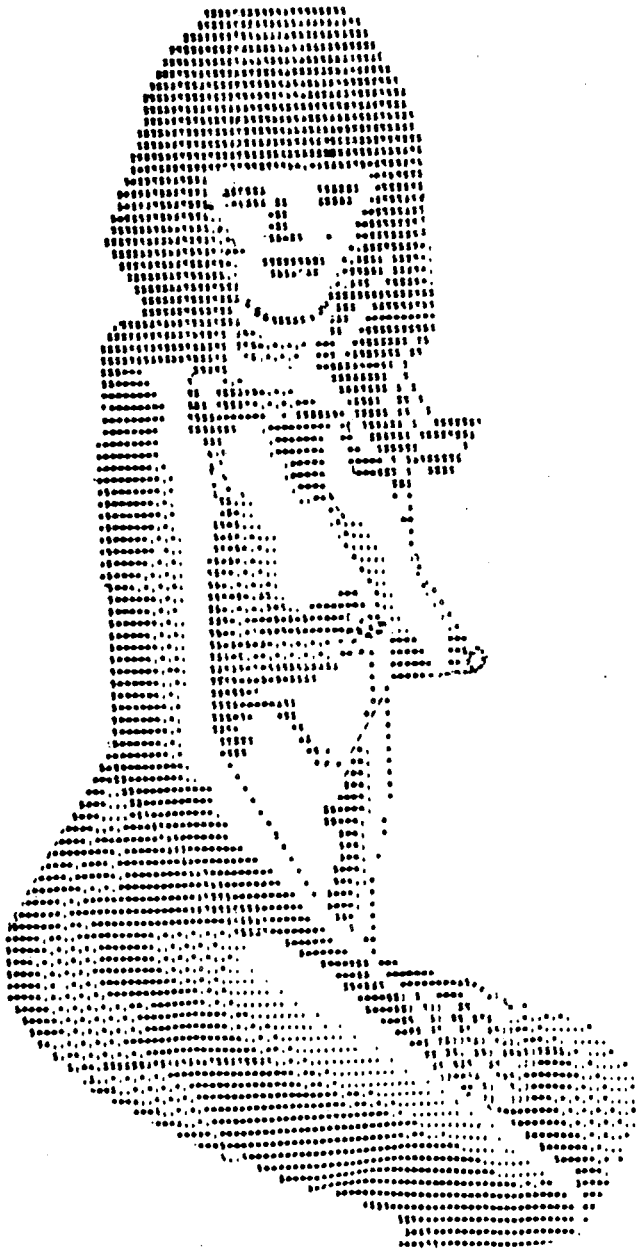

FIG. 115*c* is an pictorial illustration of a unlocking code exemplary of the type used to actuate the very first said MALKE device. Although somewhat whimsical encoded numbers or passwords release of automated systems to the user required the most unlikely encryptic code and visual punch up. Other codes and visual punch ups can be systematically programmed as frequently as passwords are changed.

FIG. 116 entails a concise digitized description of a single three dimensional time vector occupied by a necessarily occur directly as a function of time and it is advantageous to reduce the size of a given sample in order to avoid overloading logic circuit and comparator elements responsible for the acquisition process. If signals obtained from designated targets are repetitive and equivalent then said data is digitized and digital values representing only a fraction of the attributes are exhibited by a single designated target after said target has been initially identified; thereby reducing the data and computational time needed for target reduction.

FIGS. 115 through 115*b* are pictorial representations of the data reduction process obtained within a single optical field element of the said MALKE device. The number of optical fields generated per a one second interval of time can range between $10^4$ to in excess of $10^9$ bytes per second. The narrowing of an optical field is but another example of data reduction, which was illustrated in FIG. 114.

FIG. 115*c* is an pictorial illustration of a unlocking code exemplary of the type used to actuate the very first said MALKE device. Although somewhat whimsical encoded numbers or passwords release of automated systems to the user required the most unlikely encryptic code and visual punch up. Other codes and visual punch ups can be systematically programmed as frequently as passwords are changed.

FIG. 116 entails a concise digitized description of a single three dimensional time vector occupied by a single designated target within an arbitrary real time frame of ten microseconds. Said signal is arbitrarily choosen, exemplary of the type of signals generated by designated targets. The aforesaid signals consists of three spatial dimensional components which correspond to length, height and width displacement vectors and a fourth temporal component corresponding to some arbitrary real time vector. The spatial vector representations are presented in there digitized formats indicated by the vectors x, y and z, which are assigned to their respective x, y, z axis. The digitized signal corresponding to the aforesaid temporal interval is designated by the term t. The entire digitized spatial temporal complement defined by the parameters x, y, z and t are to be taken in an illustrative rather than in a literal manner.

FIGS. 117 through 117*c* describes a well known modification of a Cooley Tukey Radix - 8DIF FFT program, The program embodied with FIGS. 117 through 117*c* are similar to those programs utilized to implement data acquisition programs embodied within the CPU and/or microprocessor element of said MALKE device and ancillary systems. The program originally proposed by Burves should be taken in an illustrative rather than a literal manner, since only two dimensional vectors are scanned; whereas at least four dimensions are scanned, as previously indicated. Additionally, the radix and corresponding lengths including N are several orders of magnitude larger than those parameters indicated in said figures.

Some Key Relationships For Guided Weapons (One-On-One)

| | |
|---|---|
| $P_{ACQ}$ | Probability the Correct Target Is Acquired |
| $P_{FT}$ | Probability a False Target Is Acquired Prior To Correct Target Acquisition |
| $P_{GUIDE}$ | Probability the Weapon Seeker Maintains Lock On the Target and the Weapon Guides All the Way To Target Closure |
| $P_{HIT}$ | Probability the Weapon Selects "Correct" Aim Point and Hits the Target Within Desired Miss Distance |
| $P_{KILL/HIT}$ | Probability the Target Is Defeated |
| R | Weapon Reliability |

With These Simple Definitions - One-On-One Performance Is:

$P_{KILL} = P_{ACQ}(1-P_{FT})P_{GUIDE}\,P_{HIT}\,P_{KILL/HIT}\,R$

Conclusions Derived From Simple Definitions (For Guided Weapons)

Probability of Target Acquisition ($P_{ACQ}$)
Probability of False Target Acquisition ($P_{FT}$)

$P_{ACQ} = P_{ACQ}$ ($P_{FT}$) = ($P_{FT}$) [Delivery Accuracy, Target Location Errors, Search Area, Search Time, Range, Sensor/Seeker Field of View, Clutter, Target Signature(s), Field of View Scan Efficiency, Signal Processing Time, Weather, Countermeasures, etc.]

Probability of Continuous Guidance ($P_{GUIDE}$)

$P_{GUIDE} = P_{GUIDE}$ [Target Behavior (i.e., Fading, Shadows, Glint/Scintillation, etc.); Target Tracking Loop Characteristics, Guidance/Autopilot Characteristics, Airframe Performance, Clutter Leakage, Weather, Contermeasures, etc.]

Probability of Closure To Design Miss Distance ($P_{HIT}$)

$P_{HIT} = P_{HIT}$ [Aimpoint Selection Probability ($P_{AIM-P}$), Aimpoint Tracking Equivalent Noise ($g_{min}$); Autopilot/Airframe Time Constant ($\tau$), Weather, Countermeasures, etc.]

Probability of Target Defeat Given a Hit ($P_{KILL/HIT}$)

$P_{KILL/HIT} = P_{KILL/HIT}$ [Warhead Lethality, Target Vulnerability, Aimpoint, Miss Distance, Defeat Criteria, Impact Angles, etc.]

Some Key Relationships For Improved Sensing Munitions (One-On-One)

| | |
|---|---|
| $P_{FP}$ | Probability That One or More Targets Are Located In the Muntion Footprint |
| $P_{FF}$ | Probability That the Sensor False Prior To Target Detection and Fire |
| $P_{DET\&FIRE}$ | Probability That the Sensor Detects and Fires At An Appropriate Target |
| $P_{HIT}$ | Probability That the Warhead Impacts the Target At Desired Aiming Area (Similar To Guided Weapon Miss Distance) |
| $P_{KILL/HIT}$ | Probability the Target Is Defeated |
| R | Munition Reliability |

Performance Relationship For One-On-One Is $P_{KILL} = P_{FP}\,P_{DET\&FIRE}\,(1-P_{FF})\,P_{HIT}\,P_{KILL/HIT}\,R$ Sensor/Seeker Requirements Are Inextricably Tied To Mission Requirements and System/Employment Concept Probability Of Target Detection ($P_D$)

$$P_D = P_D\left(\frac{P_T}{P_N + P_C}\right)$$

$P_S$ = Target Signal
$P_N$ = Sensor Noise
$P_C$ = Clutter

Passive MMW Signatures

Target = Reflection ($r_T$) Of "Cold" Sky Radiance
$P_T = P_T(r_T A_T)\ r_T = 0.9$ Clutter = Reflection $r_C$ Of "Cold" Sky
$P_C = P_C(r_c P_c)\ r_c = 0.2$ Active Target Signatures Target = Reflection Of Transmitted Energy ($\sigma_T$)
$P_T = P_T(\sigma_T)$ Clutter = Reflection Of Transmitted Energy ($\sigma_O$)
$P_C = P_C(\sigma_o A_c)$ $$\text{MTI IMPROVEMENT FACTOR } I = \left(\frac{S_O/C_O}{S_I/C_I}\right)\text{Average}$$

SUBCLUTTER VISIBILITY SCV = ($C_I/S_I$) Allowed Average
CLUTTER VISIBILITY V = ($S_O/C_O$) Required
CLUTTER ATTENUATION CA = ($C_I/C_O$)

$I = SCV \times V = CA \times (S_O/S_I)$ Average

*ISM Is An Army Term: USAF Term Is Sensor Fuzed/Munition (SFM)

The priority of a designated target depends on the initial acquisition the characteristic of said track of directional vector exhibited by said target the velocity of said target and the immediate threat posed by the aforesaid target. The user based MALKE unit must determine whether the target is within optimium range and whether or not a first intercept and kill or neutralization assignment can be implemented. The maneuverability of the missile in relation to said target must exceed four to six times the maneuver capability of said target, in order to effect a successful intercept and subsequent engagement. The interval of time between launches of missile $T_L$ depends on the number of designated targets, $D_T$, assigned to the number of warheads available, $W_T$, the velocity of said target, $V_T$, relative to the velocity of said missile, $V_M$, and the number of scans required per second to track said target, which depends on the number of guidance channels open $N_G$ and the number of targets illuminated $T_L$ per second.

The time between launch is described by the equation herein below $$T_L \int_{0\to\infty}^{\text{init.}\to\infty} = f\left(\frac{\left(1+\frac{V_T}{V_M}\right)(T_H+Ts)}{\frac{N_G}{T_L}}\right)$$

where $T_H$ is the temporal interval of homing in on a target,

Ts represents the number of searches required for a temporal interval, $$\int_{0\leftarrow\text{lim.}}^{\text{init.}\to\text{lim.}} = \sum_{n>10}^{i=1} n\frac{dx}{dt}$$

$T_L$ is the number of target illuminated at greater than ten hits per second.

There is no limits to be placed on the said M.A.L.K.E. device in regards to size which effects range. The transector presented in this disclosure represents light deliver systems with a maximum range of ten to eighteen kilometers, therefore target engagement must occur optimally within the boost or coast phase of a designated target, unless the sustained flight corresponds to a low level missile such as a cruise, exocet, or equivalent system.

Figure 120:
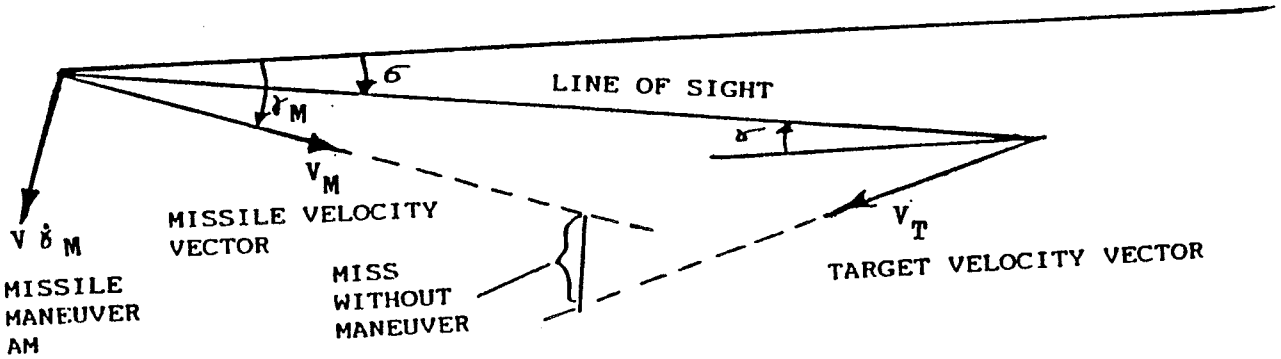

FIGS. 118 through 122 consist of a series of well defined diagrams and equations describing parameters of missile tracking and engagement. FIG. 118 describes the process of initial missile sizing to meet range, velocity and maneuverability implemented with close form solutions. FIG. 119 describes the parameter associated with target acquisition, some types of sensors embodied within the M.A.L.K.E. or missile element, the search and dual factors corresponding to homing, range, velocity and angular uncertainties. FIG. 120 corresponds to the use of proportional navigation implemented by terminal guidance. FIG. 121 describes the effects on targeting of said missile in relation to the operation of an inertial guidance system i.e. autopilot means. FIG. 122 describes primary factors governing acquisition, where radar is employed to implement said targeting. The equations presented in FIGS. 109 through 122 implement algorithms for programs involved in the acquisition, pursuit and subsequent engagement of targets.

Targeting of energy or particle beams with other equivalent source beams have been discussed earilier in the specifications in relation to photon scattering induced by collison and conversely by the subsequent dispersal of particle beam by photonic excitation. Experimental evidence with various source beam emitters mounted on mobile platform indicates that a high energy coherent emission can be effectively neutralized by a particle beam source as predicted by Einstein if certain criteria is satisfied in regards to power and other parameters. Converesely, a particle beam can also be neutralize by a coherent source of light such as a laser beam provided that the said beam incidents directly with said particle beam and that other criteria such as power output, wave characteristics and temporal considerations are meet. The relativistic speeds of target acquistion and subsequent engagement requires the implementation and execution of expert programs. Such said relativistic operations require an apriori knowledge of energy weapons and logistics for emitting point sources. Lacking an apriori knowledge of enemy positions and/or parameters of said emitting point source then a post priori first strike must be either encountered or anticipated based based on computation of existing energy weapon systems and logistics.

Stochastic target acquistion is described in part by variations of the Bayes estimate, the Maximum Likelyhood Method and on the basis of probability or other similar such methods. It therefore now becomes incumbent to recite some of the basic concepts governing real non-random and random parameters within the context of the minimum means square estimate which is the conditional mean of an a posteriori density (MMSE). The maximum a posteriori estimate (MAP) and for a class of cost functions. The fundamental concepts which will be described herein below were clearly defined by Bayes Cramer Rao, Wiley and other authors.

Mean-square error criterion, $$R(A)\ \Delta \int_{-\infty}^{\infty} [\hat{a}(R)-A]^2\, Pr|a(R|A)dR,$$

where the expectation is only over R, for it is the only random variable in the model. Minimizing R (A), we obtain $$\hat{a}_{ms}(R)=A.$$

The first measure of quality to be considered in the expectation of the estimate $$E[\hat{a}(R)]\ \Delta \int_{-\infty}^{+\infty} \hat{a}(R)Pr|a(R|A)dR$$

The possible values of the expectation can be grouped into three classes

1. If $E[\hat{a}(R)]=A$, for all values of A, we say that the estimate is unbiased. This statement means that the average value of the estimates equal the quantity we are trying to estimate.
2. If $E[\hat{a}(R)]=A+B$, where B is not a function of A, we say that the estimate has a known bias. We can always obtain an unbiased estimate by subtracting B from a(R).
3. If $E[\hat{a}(R)]=A+B(A)$, we say that the estimate has an unknown bias. Because the bias depends on the unknown parameter, it cannot simply subtract it out.

MAXIMUM LIKELIHOOD ESTIMATION

There are several ways to motivate the estimation procedure. The simple estimation can be exacted by the following equation;

$$r = A + n,$$

$$Pr|a(R|A) = (\sqrt{2_n}\ \sigma_n)^{-1} \exp\left[-\frac{1}{2\sigma_n^2}(R-A)^2\right].$$

$$\hat{a}_{mt}(R) = R.$$

The function $Pr|a(R|A)$, viewed as a function of A, as the likelihood function. In $Pr|a(R|A)$, is denoted as the log likelihood function. The maximum likelihood estimate $\hat{a}_m|(R)$ is that value of A at which the likelihood function is a maximum. If the maximum is interior to the range of A, and In Pr|a(R|A) has a continuous first derivative, then a necessary condition on am|(R) is obtained by differentiating In Pr|a(R|A) with repeat to A and setting the result equal to zero:

$$\frac{\partial In\ Pr|a(R|A)}{\partial A}\ A = d_m|(R) = 0$$

CRAMER-RAO INEQUALITY: NONRANDOM PARAMETERS

The variance of any estimate a(R) of the real variable A.

If â(R) is any unbiased estimate of A, the $$Var[\hat{a}(R) - A \geqq \left(E\left\{\left[\frac{\partial In\ Pr|a(R|A)}{\partial A}\right]^2\right\}\right)^{-1}$$

or equivalently, $$Var[\hat{a}(R) - A \geqq \left(-E\left[\frac{\partial^2\ In\ Pr|a(R|A)}{\partial A^2}\right]\right)^{-1}$$

where the following conditions are assumed to be satisfied:

$$\frac{\partial Pr|a(R|A)}{\partial A} \text{ and } \frac{\partial^2\ Pr|a(R|A)}{\partial A^2}$$

exist and are absolutely integratible.

The inequalities were first stated by Fisher derived by Cramer and Rao. Any estimate that satisfies the bound with an equality is called an efficient estimate. The proof is a simple application of the Schwarz inequality. â(R) is unbiased, $$E[\hat{a}(R) - A\Delta\ Pr|a(R|A)[\hat{a}(R) - A]\ dR = 0.$$

Differentiating both sides with respect to A, $$\frac{d}{dA}\int_{-\infty}^{\infty} Pr|\hat{a}(R|A)[\hat{a}(R) - A]\ dR =$$

$$\int_{-\infty}^{\infty} \frac{\partial}{\partial A}\ Pr|a(R|A)[\hat{a}(R) - A]\ dR = 0,$$

If differentiating occurs inside the integral then $$-\int_{-\infty}^{\infty} Pr|a(R|A)\ dR + \int_{-\infty}^{\infty} \frac{\partial In\ Pr|a(R|A)}{\partial A}\ Pr|a(R|A).$$

$$\int_{-\infty}^{\infty} \frac{\partial In\ Pr|a(R|A)}{\partial A}\ Pr|a(R|A)[a(R) - A]\ dR = 1.$$

Rewriting the following expression $$\int_{-\infty}^{\infty} \frac{\partial In\ Pr|a(R|A)}{\partial A}\ Pr|a(R|A)Pr|a(R|A)\ [a(R) - A]\ dR = 1,$$

and using the Schwarz inequality $$\left\{\int_{-\infty}^{\infty}\left[\frac{\partial In\ Pr|a(R|A)}{\partial A}\right]^2 Pr|a(R|A)\ dR\right\}\times$$

$$\left\{\int_{-\infty}^{\infty}[a(R) - A]^2\ Pr|a(R|A)\ dR\right\} \geqq 1,$$

where I recall from the derivation of the Schwarz inequality that equality holds if and only if $$\frac{\partial In\ Pr|a(R|A)}{\partial A} = [a(R) - A]\ k(A),$$

for all R and A. See that the two terms of the left side are the expectations in statement. Thus, $$E\{[a(R) - A]^2\} \geqq \left(E\left[\frac{\partial In\ Pr|a(R|A)}{\partial A}\right]^2\right)^{-1}$$

To prove statement. It is observed that $$\int_{-\infty}^{\infty} Pr|a(R|A)\ dR = 1.$$

Differentiating with respect to A, I have $$\int_{-\infty}^{\infty} \frac{\partial Pr|a(R|A)}{\partial A}\ dR =$$

$$\int_{-\infty}^{\infty} \frac{\partial InPr|a(R|A)}{\partial A}\ Pr|a(R|A)dR = 0.$$

Differentiating again with respect to A and applying obtaining $$\int_{-\infty}^{\infty} \frac{\partial^2 InPr|a(R|A)}{\partial A^2}\ Pr|a(R|A)dR +$$

$$\int_{-\infty}^{\infty}\left(\frac{\partial InPr|a(R|A)}{\partial A}\right)^2 Pr|a(R|A)dR = 0$$

or $$E\left[\frac{\partial^2 InPr|a(R|A)}{\partial A^2}\right] = -E\left[\frac{\partial InPr|a(R|A)}{\partial A}\right]^2$$

The maximum likelihood equation can be expressed as the following $$0 = \frac{\partial InPr|a(R|A)}{\partial A}\Big|_{A = \hat{a}m\ (R)}$$

$$(\hat{a}(R) - A)k(A)\Big|_{A = \hat{a}m\ (R)}$$

In order for the right-hand side to equal zero either $$\hat{a}(R) = \hat{a}_m|(R)$$

or $$k(a_{m|})=0.$$

LOWER BOUND ON THE MINIMUM MEAN-SQUARE ERROR IN ESTIMATING A RANDOM PARAMETER

In this section I prove the following theorem.

Theorem

Let a be a random variable and r, the observation vector. The mean-square error of any estimate a(R) satisfies the inequality $$E\{[\hat{a}(R)-a]^2\} \geqq \left(E\left\{\left[\frac{\partial InPr,a(R,A)}{\partial A}\right]^2\right\}\right)^{-1} = \left\{-E\left[\frac{\partial^2 InPr,a(R,A)}{\partial A^2}\right]\right\}^{-1}$$

Observe that the probability density is a joint density and the the expectation is over both a and r. The following conditions are assumed to exist:

1.

$$\frac{\sigma Pr,a(R,A)}{\partial A}$$

is absolutely integrable with respect to R and A.

2.

$$\frac{\sigma^2 Pr,a(R,A)}{\partial A^2}$$

is absolutely integrable with respect to R and A.

3. The conditional expectation of the error, given A, is $$B(A) = \int_{-\infty}^{\infty} [\hat{a}(R)-A]Pr|a(R|A)dR.$$

Assume that $$\lim_{A\to\infty} B(A)Pa(A) = 0,$$

$$\lim_{A\to-\infty} B(A)Pa(A) = 0.$$

Multiply both sides by Pa(A) and then differentiate with respect to A:

$$\frac{d}{dA}[Pa(A)] = -\int_{-\infty}^{\infty} Pr,a(R,A)dR + \int_{-\infty}^{\infty} \frac{\partial Pr,a(R,A)}{\partial A}[a(R)-A]dR.$$

Now integrate with respect to A:

$$Pa(A)B(A)\Big|_{-\infty}^{+\infty} = -1 +$$

-continued $$\int_{-\infty}^{\infty}\int_{-\infty}^{\infty} \frac{\partial Pr,a(R,A)}{\partial A}[\hat{a}(R)-A]dAdR.$$

The assumption in Condition 3 makes the left-hand side zero. The remaining steps are identical. The result is $$E\{[\hat{a}(R)-a]^2\} \geqq \left\{E\left[\left(\frac{\partial InPr,a(R,A)}{\partial A}\right)^2\right]\right\}^{-1}$$

or, equivalently, $$E\{[\hat{a}(R)-a]^2\} \geqq \left\{-E\left[\frac{\partial^2 InPra(RA)}{\partial A^2}\right] - \left[E\frac{\partial^2 InPa(A)}{\partial A^2}\right]\right\}^{-1}$$

with equality if and only if $$\frac{\partial InPr,a(R,A)}{\partial A} = k[a(R)-A],$$

for all R and all A. (In the non-random variable case we used the Schwarz inequality on an integral over R so that the constant k(A) could be a function of A.) Differentiating again gives an equivalent condition $$\frac{\partial^2 InPr,a(R,A)}{\partial A^2} = -k.$$

It may be written in terms of the a posterori density, $$\frac{\partial^2 InPa|r(A|R)}{\partial A^2} = -k.$$

RANDOM PROCESS ESTIMATION PROCEDURE

For random variables consider the general case of Bayes estimation in which we minimize the risk for some arbitrary scalar cost function C(a, a), but for our purposes it is adequate to consider only cost functions that depend on the error. The error vector is $$a_\epsilon(R) = \begin{bmatrix} \hat{a}_1(R)-a_1 \\ \hat{a}_2(R)-a_2 \\ \cdot \\ \cdot \\ \cdot \\ \hat{a}_K(R)-a_K \end{bmatrix} = \hat{a}(R)-a.$$

For a mean-square error criterion, the cost function is simply $$C(a_\epsilon(R)) \Delta \sum_{1=1}^{K} a_{\epsilon i}^2(R) = a_\epsilon^T(R)a_\epsilon(R).$$

This is just the sum of the squares of the errors. The risk is $$R_{ms} = \iint_{-\infty}^{\infty} C(a_\epsilon(R))Pr,a(R,A)dRdA$$

or $$R_{ms} = \int_{-\infty}^{\infty} Pr(R)dR \sum_{1=1}^{K} (\hat{a}_1(R) - A_1)^2 Pa|r(A|R)dA.$$

As before, we can minimize the inner integral for each R. Because the terms in the sum are positive, we minimize them separately. This gives $$\hat{a}_{ms}(R) = \int_{-\infty}^{\infty} APa|r(A|R)dA$$

or $$\hat{a}_{ms}(R) = \int_{-\infty}^{\infty} APa|r(A|R)dA.$$

It is easy to show that mean-square estimation commutes over linear transformations. Thus, if $$b = Da,$$

where D is a L×K matrix, and we want to minimize $$E[b_\epsilon^T(R)b_\epsilon(R)] = E\left[\sum_{1=1}^{L} b_\epsilon^2(R),\right]$$

the result will be, $$\hat{b}_{ms}(R) = D\hat{a}_{ms}(R).$$

For MAP estimation we must find the value of A that maximizes Pa|r(A|R). If the maximum is interior and In Pa|r(A|R)/A exists at the maximum then a necessary condition is obtained from the MAP equations. The logarithm of Pa|r(A|R), differentiate with respect to each parameter A i=1, 2, . . . , K, and set the result equal to zero. This gives a set of K simultaneous equations:

$$\left.\frac{\partial InPa'r(A|R)}{\partial A_i}\right|_{A=\hat{a}map(R)} = 0,\ i = 1, 2, \ldots, K.$$

A more compact manner by defining a partial derivative matrix operator $$V_A \triangleq \begin{bmatrix} \frac{\partial}{\partial A_1} \\ \frac{\partial}{\partial A_2} \\ \cdot \\ \cdot \\ \cdot \\ \frac{\partial}{\partial A_K} \end{bmatrix}.$$

This operator can be applied only to 1×m matrices; for example, $$\overline{V}_A G = \begin{bmatrix} \frac{\partial G_1}{\partial A_1} & \frac{\partial G_2}{\partial A_1} & \cdots & \frac{\partial G_m}{\partial A_1} \\ \cdot & & & \\ \cdot & & & \\ \cdot & & & \\ \frac{\partial G_1}{\partial A_K} & & & \frac{\partial G_m}{\partial A_K} \end{bmatrix}.$$

Several useful properties of $\overline{V}_A$ are developed. In this case it becomes a single vector equation, $$\overline{V}_A[\text{In Pa}|r(A|R)]A = a_{map}(R) = 0.$$

If given a probability space {Ω, F, P} and a n-dimensional Euclidean space $R^n$ equipped with a finite structure, i.e., each point $x \epsilon R^n$ is associated with an n-dimensional space $L_x^n$ having the coordinate origin at x (and a natural identification operation for all $L_x^n$, $x \epsilon R^n$). A scalar product generated by a metric in $R^n$ is fixed in $L_x^n$. The Cartesian coordinates are fixed in $R^n$. Consider the stochastic integral equation $$x_t = x + \int_0^t b(s,x_s)ds + \int_0^t o(s,x_s)dW_s$$

where $$x \epsilon R^n,\ t \epsilon [0, T],$$

$x_t$, $x_s$, are random variables with values in $R^n$, b(t, x) is a vector field on $R^n$, that is, for all (t, x)ϵ['0 , T] x $R^n$ the vector b(t, x)ϵ$L_x^n$: σ(t, x), for each (t, x)ϵ['0, T] x $R^n$, is the matrix ($\sigma_{11}, \ldots \sigma_{1n}$) of the linear mapping.

$$\sigma: L_x^n \rightarrow L_x^n,$$

$$w_t = \begin{pmatrix} w_t \\ \cdot \\ \cdot \\ \cdot \\ w_t^{(n)} \end{pmatrix} \epsilon R \text{ is a standard n-dimensional Wiener process.}$$

Weak solutions are adequate in those situations when the answers to the questions of our concern involve only the measure on the space of trajectories. Such questions include: the determination of various probabilities and mathematical expectations; problems related to the stability of processes, the existence of invariant measures; the problems of absolute continuity of measures for various processes; probabilistic representation of solutions of partial differential equations, etc.

WEAK UNIQUENESS (UNIQUENESS IN MEASURE)

If for any two solutions ($x_t'$, $w_t'$) and ($x_t''$, $w_t''$) all the finite-dimensional distributions coincide in all the pairs of processes mentioned above, we say that a solution of the above equation in unique in the weak sense, or unique in the sense of measure.

$$\begin{cases} dx_t = \sigma(x_t)de_t \\ x_o = 0 \end{cases}$$

where $$\sigma(x) = \begin{cases} 1, x \geqq 0 \\ -1, x < 0 \text{ (we note that } \sigma^2(x) \equiv 1). \end{cases}$$

WEAK UNIQUENESS

The martingale $$x_t = \int_C^t \sigma(x_s)dw_s,$$

according to is a Wiener process with respect to a new time $$T_t = \int_0^t \sigma^2(x_s)ds = t,$$

which coincides in the given case with the old one. Therefore, any solution $x_t$ has the same (namely, Wiener) finite-dimensional distributions.

(b) The existence of a weak solution

Taking an arbitrary Wiener process for $x_t$, we construct $$w_t = \int_0^t \sigma(x_s)dx_s.$$

The process $\overline{w}_t$ is also a Wiener process (it is possible to make a time substitution).

The aim is to deviate as little as possible from zero (i.e.) maximize one of the functionals $$M|X_T|$$
$$M\,x_T^2$$

$$M \int_0^T x_t^2 dt$$

or maximize one of the functionals $$M\{T_2 \Lambda T\}$$

$$R\{|x_T| < a\}$$

where $T_2 = \inf\{t: |x_t| > a\}$, $T_a \Lambda T = \min(T_a, T)$, etc. It is natural then in this situation to drive the process $x_t$ as fast as possible to zero, i.e. choose the control so that:

$$u_i = \begin{cases} -1, x_t > 0 \\ 0, x_t = 0 \\ 1, x_t < 0. \end{cases}$$

thus becomes

-continued $$dx_t = -\text{sign } x_t + dW_t$$
$$x_o = 0$$

Consider the filtering of an unobservable component of a two-dimensional process. Let there be given a process $(\theta_t, \xi_t)$ satisfying the equation $$d\theta_t = a(t, \theta_t, \xi_t)\,dt + dW_t^1$$

$$d\xi_t = A(t, \theta_t, \xi_t)\,dt + dW_t^2$$

It is required to estimate $\theta_t$ from the trajectory $\xi_0^t$. It is well-known that the best meansquare estimate $M(\theta_t F_t)$ is representable in the form $$M(\theta_t | F_t^\xi) = M(\theta_o F_o^\xi) + \int_0^t [.]\,ds - \int_0^t [.]\,dW_s$$

(the specific form of the integrands is of no interest to us), where $\overline{W}_t$ is the Wiener process given by $$\xi_t - \int_0^t M(A(s, \theta_s, \xi_s)F_s^\xi)ds$$

The construction procedure shows that the process $\overline{W}_t$ is $F_t^\xi$-measurable, i.e. $F_t^{\overline{w}} \subset F_t^\xi$. It is a well-known fact that the case when the process $\overline{w}_t$ is an innovation process is particularly important, i.e. $F_t^{\overline{w}} = F_t^\xi$ (this actually means that no information has been lost in going from the process $\theta_t$ to the process $\overline{w}_t$), and the equality $F_t^{\overline{w}} = F_t^\xi$ can be satisfied if and only if the equation $$d\xi_t = \alpha(t, \xi_0^t)\,dt + d\,\overline{W}_t$$

has a strong solution, where $$\alpha(t, \xi_0^t) = M(A(t, \theta_t, \xi_t)\,F_t^\xi).$$

So far target acquisition has been limited to the engagement of simple hyper-velocity trajectory modes, or single varient emissions traveling at extreme relativistic velocities with a prior or a posterori assessment. The next simplified equations will described in part the optimum assignment of emissive beams by said type of M.A.L.K.E. device to another equivalent device or multiple devices with greatly simplified field equations based on probabilistic expected kills or disintegrations per a given emissive disintegration. The elementary equations are very similar to well known expected missile kills per multiple salvo firing of conventional systems, which are well known by those skilled in the art.

Expected distintegrations of equivalent M.A.L.K.E. units, particle beam emitters, high energy lasers or other emissive devices when engaged by either multiple versions on single elements of the same such device. Probability that a particular set of emitter target assignments will occur is given by;

$$P = \frac{E!}{E_1!E_2!\ldots E_A}, \frac{i}{AE}, \frac{A!}{A_0\,A_1!\ldots A_E}$$

where

E = number of emissions actuated

A = number of targeted emitters $E_1$ = number of emissive beams assigned to 1th target emitters $A_J$=number of target emitters with J assigned emissive beam for a particular assignment the expected number of disintegrations $$\int_{1 \to n}^{0} f(x) \frac{dx}{dt} E(N) = \sum_{I=1}^{A} [1 - (1 - P_K)E_1]$$

where $P_K$=probability of disintegration for emissive beams.

Although various alternations or modifications may be suggested by those skilled in the art, it is the intention of the inventor(s) to embody within the patent warranted hereon all changes and modifications as reasonably and properly come within the scope of contributions to the art, without departing from the spirit of the invention.

What is claimed is:

1. An automated, independently targetable extravehicular platform including:

a plurality of propulsion engines carried by said platform, each of said engines including an array of plasma induction motors, each of said plasma induction motors being coupled to a silicon nitride sintered turbine; energy weapons carried by said platform;

programmed control means coupled to said propulsion engines and to said energy weapons for controlling the direction and magnitude of the thrust from said propulsion engines and for firing said energy weapons, all in accordance with an operational program in said programmed control means; and, a source of electrical power carried by said platform and electricity coupled to said propulsion engines, to said energy weapons and to said programmed control means for operating the same.

2. Apparatus according to claim 1 which includes, in addition, mass-action driver elements carried by said platform and coupled electrically to said programmed control means for control thereof and to said source of electrical power for the powering thereof.

3. Apparatus according to claim 1 in which said electrical power source is nuclear in nature.

4. Apparatus according to claim 1 in which each of said plasma induction motors includes, in addition, at least one primary plasma reservoir, at least one secondary plasma reservoir, a plasma injection unit coupled to said plasma reservoirs, and plasma control means electrically coupled to said injection unit and controlling operation of said injection unit and for providing electronic ignition sequencing of said injection unit.

5. Apparatus according to claim 4 in which each of said plasma induction motors includes in addition, substrate material coupled to said plasma reservoir in each of said induction motors which substrate charges said plasma reservoir from the medium in which said platform exists.

6. Apparatus according to claim 4 which includes, in addition, secondary plasma reservoir coupled to said sintered turbine, and excitation means coupled to said secondary plasma reservoir for generating plasma.

7. Apparatus according to claim 6 in which said excitation means includes an excismer source.

8. Apparatus according to claim 6 in which said excitation means includes an excismer and microwave source.

9. Apparatus according to claim 8 which includes, in addition, tube means coupling said secondary plasma reservoir to said sintered turbine.

10. Apparatus according to claim 9 which includes, in addition, radio-frequency means coupled to said tube means for further exciting the plasma from said secondary plasma reservoir.

11. Apparatus according to claim 9 which includes, in addition, electrical arc-discharge means coupled sintered turbine.

12. Apparatus according to claim 6 which includes, in addition, shaft means coupled to said sintered turbine which is coupled to a drive train which is coupled to a piezoelectric motor means.

* * * * *